US008783060B2

(12) United States Patent
Nishijima et al.

(10) Patent No.: US 8,783,060 B2
(45) Date of Patent: Jul. 22, 2014

(54) EJECTOR-TYPE REFRIGERANT CYCLE DEVICE

(75) Inventors: Haruyuki Nishijima, Obu (JP); Etsuhisa Yamada, Kariya (JP); Youhei Nagano, Iwakura (JP); Masami Taniguchi, Nagoya (JP)

(73) Assignee: Denso Corporation, Kariya (JP)

( * ) Notice: Subject to any disclaimer, the term of this patent is extended or adjusted under 35 U.S.C. 154(b) by 1254 days.

(21) Appl. No.: 12/653,417

(22) Filed: Dec. 14, 2009

(65) Prior Publication Data

US 2010/0162751 A1 Jul. 1, 2010

(30) Foreign Application Priority Data

Dec. 15, 2008 (JP) ..... 2008-318046
Oct. 1, 2009 (JP) ..... 2009-229766

(51) Int. Cl.

| | |
|---|---|
| ***F25B 1/06*** | (2006.01) |
| ***F25B 40/00*** | (2006.01) |
| ***F25B 41/00*** | (2006.01) |
| ***F25B 1/10*** | (2006.01) |
| *F25B 5/00* | (2006.01) |
| *F25B 13/00* | (2006.01) |

(52) U.S. Cl.

CPC ..... *F25B 41/00* (2013.01); *F25B 40/00* (2013.01); *F25B 2400/13* (2013.01); *F25B 1/10* (2013.01); *F25B 5/00* (2013.01); *F25B 2341/0011* (2013.01); *F25B 13/00* (2013.01)

USPC ..... 62/500

(58) Field of Classification Search

USPC ..... 62/515, 500, 502, 498

See application file for complete search history.

(56) References Cited

U.S. PATENT DOCUMENTS

| | | | | |
|---|---|---|---|---|
| 3,701,264 | A * | 10/1972 | Newton | 62/191 |
| 6,477,857 | B2 | 11/2002 | Takeuchi et al. | |
| 6,871,506 | B2 * | 3/2005 | Takeuchi et al. | 62/170 |
| 2002/0124592 | A1 | 9/2002 | Takeuchi et al. | |

(Continued)

FOREIGN PATENT DOCUMENTS

| | | |
|---|---|---|
| JP | H4-043261 | 2/1992 |
| JP | 2002-327967 | 11/2002 |

(Continued)

OTHER PUBLICATIONS

Office action dated Mar. 19, 2013 in corresponding Japanese Application No. 2009-229766.

*Primary Examiner* — Melvin Jones

(74) *Attorney, Agent, or Firm* — Harness, Dickey & Pierce, PLC

(57) ABSTRACT

A flow of refrigerant discharged from a first compressor and cooled by a radiator is branched by a first branch portion, and the branched refrigerant of one side is decompressed and expanded by a thermal expansion valve and is heat exchanged with the branched refrigerant of the other side in an inner heat exchanger. Therefore, the branched refrigerant of the other side supplied to the suction side evaporator and a nozzle portion of an ejector can be cooled, thereby improving COP. Furthermore, a suction port of a second compressor is coupled to an outlet side of the ejector so as to secure a drive flow of the ejector, and the refrigerant discharged from the second compressor and the refrigerant downstream of the thermal expansion valve are mixed to be drawn into the first compressor so that an ejector-type refrigerant cycle device can be operated stably.

19 Claims, 153 Drawing Sheets

(56) References Cited

U.S. PATENT DOCUMENTS

| | | | |
|---|---|---|---|
| 2004/0003608 | A1 | 1/2004 | Takeuchi et al. |
| 2007/0039337 | A1 | 2/2007 | Nishijima et al. |
| 2009/0229305 | A1 | 9/2009 | Yamada et al. |
| 2009/0229306 | A1 | 9/2009 | Yamada et al. |

FOREIGN PATENT DOCUMENTS

| | | |
|---|---|---|
| JP | 2004-044849 | 2/2004 |
| JP | 2007-010298 | 1/2007 |
| JP | 2007/051833 | 3/2007 |
| JP | 2007-057186 | 3/2007 |
| JP | 2007-147198 | 6/2007 |
| JP | 2008-020152 | 1/2008 |
| JP | 2008-025905 | 2/2008 |
| JP | 2008-039298 | 2/2008 |
| JP | 2008-209028 | 9/2008 |
| JP | 2008-261512 | 10/2008 |
| WO | WO 2009/128271 | 10/2009 |

* cited by examiner

EJECTOR-TYPE REFRIGERANT CYCLE DEVICE

CROSS REFERENCE TO RELATED APPLICATION

This application is based on Japanese Patent Applications No. 2008-318046 filed on Dec. 15, 2008, and No. 2009-229766 filed on Oct. 1, 2009, the contents of which are incorporated herein by reference in its entirety.

FIELD OF THE INVENTION

The present invention relates to an ejector-type refrigerant cycle device including an ejector.

BACKGROUND OF THE INVENTION

Conventionally, an ejector-type refrigerant cycle device including an ejector adapted as a refrigerant decompression function and a refrigerant circulation function is known.

For example, in an ejector-type refrigerant cycle device described in Patent Document 1, refrigerant discharged from a compressor is heat-exchanged with outside air in a radiator, and is cooled. The high-pressure refrigerant having been cooled is supplied to a nozzle portion of the ejector, and refrigerant evaporated in a suction side evaporator is drawn from a refrigerant suction port of the ejector.

Furthermore, in the ejector-type refrigerant cycle device described in Patent Document 1, a discharge side gas-liquid separator is located downstream of a diffuser portion of the ejector so as to separate the refrigerant flowing out of the diffuser portion into gas refrigerant and liquid refrigerant. In addition, a gas refrigerant outlet of the discharge side gas-liquid separator is coupled to a suction side of the compressor, a liquid refrigerant outlet of the discharge side gas-liquid separator is coupled to an inlet side of the suction side evaporator, and a refrigerant outlet side of the suction side evaporator is coupled to the refrigerant suction port of the ejector.

In the ejector used for the ejector-type refrigerant cycle device, the high-pressure refrigerant is decompressed and expanded in the nozzle portion of the ejector to be jetted, so that the refrigerant downstream of the evaporator is drawn from the refrigerant suction port by pressure drop of the jet refrigerant, thereby recovering the kinetic energy of refrigerant in the decompression and expansion at the nozzle portion.

Furthermore, the recovered kinetic energy (hereinafter, called as "recovery energy") is converted to the pressure energy in the diffuser portion of the ejector, so as to increase the refrigerant pressure to be drawn into the compressor. Therefore, drive power of the compressor is decreased, and coefficient of performance (COP) in the ejector-type refrigerant cycle device is improved.

[Prior Art Document]

[Patent Document 1] JP Patent No. 3322263

SUMMARY OF THE INVENTION

However, in the ejector-type refrigerant cycle device of Patent Document 1, the refrigerant suction capacity of the ejector is decreased in accordance with a flow amount decrease of the refrigerant (drive flow) passing through the nozzle, thereby decreasing the recovery energy. Thus, the improvement effect of COP is decreased in accordance with the flow amount decrease of the drive flow.

As an operation condition in which the flow amount decrease of the drive flow is caused, for example, there is a case where the pressure of high-pressure refrigerant is decreased in accordance with a decrease of an outside air temperature. That is, if the pressure of the high-pressure refrigerant is decreased in accordance with the decrease of the outside air temperature, a pressure difference between the high-pressure refrigerant and the low-pressure refrigerant is made smaller, thereby decreasing the flow amount of the drive flow in the ejector.

Furthermore, when the flow amount decrease of the drive flow is caused, the refrigerant suction capacity of the ejector is decreased, and thereby not only the recovery energy is decreased, but also it is difficult to supply liquid refrigerant from the discharge side gas-liquid separator to the suction side evaporator. Thus, refrigerating capacity obtained by the ejector-type refrigerant cycle device is decreased. As a result, the COP is greatly reduced.

With respect to the above problem, a PCT application No. PCT/JP2009/001767 (hereinafter, referred to as "prior application") proposes an ejector-type refrigerant cycle device shown in FIG. 183 as an entire schematic structure. In the ejector-type refrigerant cycle device of the prior application, a second compressor 21, which draws and compresses the refrigerant flowing out of a suction side evaporator 23 and discharges the compressed refrigerant to a refrigerant suction port 19*b* of the ejector 19, is additionally provided as compared with the cycle device of the Patent Document 1.

Thus, even in an operation condition in which the flow amount of the drive flow of the ejector 19 is decreased and the suction capacity of the ejector 19 is decreased, the second compressor 21 can supplement the refrigerant suction capacity of the ejector 19. Accordingly, regardless of variation in the flow amount of the drive flow, the refrigerant can be stably supplied to the suction side evaporator 23, thereby preventing a great decrease of the COP.

However, according to further examinations and studies by the inventors of the present application, although the refrigerant can be stably supplied to the suction side evaporator 23, the refrigerating capacity obtained at the suction side evaporator 23 may be deteriorated, and the effect for preventing the great decrease of the COP cannot be sufficiently obtained.

Based on studies regarding the above reason in the example of FIG. 183 by the inventors of the present application, high-dryness refrigerant having being compressed in iso-enthalpy in the second compressor 21 and having been increased in enthalpy is drawn into the refrigerant suction port 19*b*, and thereby the dryness of the refrigerant flowing out of a diffuser portion 19*c* of the ejector 19 becomes higher than that in the cycle device of the Patent Document 1.

The reason is follow. That is, when the dryness of the refrigerant flowing out of the diffuser portion 19*c* becomes higher, a liquid refrigerant amount separated at a discharge side gas-liquid separator 26 is reduced, and thereby a liquid refrigerant amount supplied to the suction side evaporator 23 from the discharge side gas-liquid separator 26 becomes smaller as compared with the cycle device of the Patent Document 1. Thus, the refrigerating capacity obtained in the suction side evaporator 23 may be decreased, and COP-reduction preventing effect cannot be sufficiently achieved.

Furthermore, in the example of FIG. 183, if lubrication oil (refrigerator oil) is mixed in the refrigerant in order to lubricate first and second compressors 11, 21, the refrigerator oil will generally dissolve in the liquid refrigerant of the flow-outlet side gas-liquid separator 26, and thereby the density of the refrigerator oil in the liquid refrigerant of the flow-outlet side gas-liquid separator 26 becomes larger than that in the cycle device of the Patent Document 1.

In addition, if the liquid refrigerant having the high-density refrigerator oil flows from the discharge side gas-liquid separator 26 to the suction side evaporator 23, the refrigerator oil may stay in the suction side evaporator 23. The staying of the refrigerator oil causes the flow of the refrigerant flowing into the suction side evaporator 23 to be reduced, thereby reducing the refrigerating capacity and causing lubrication shortage in the first and second compressors 11, 21.

In view of the foregoing problems, it is an object of the present invention to provide an ejector-type refrigerant cycle device which can be stably operated without reducing the COP, even in an operation condition in which a variation in a flow amount of a drive flow can be caused.

It is another object of the present invention to provide an ejector-type refrigerant cycle device which can obtain a high COP regardless of an operation condition.

It is another object of the present invention to provide an ejector-type refrigerant cycle device which can be stably operated without reducing the COP even in an operation condition in which a variation in a flow amount of a drive flow can be caused, and can obtain a high COP, regardless of an operation condition.

According to one aspect of the present invention, an ejector-type refrigerant cycle device includes: a first compression portion which compresses and discharges refrigerant; a radiator which cools high-pressure refrigerant discharged from the first compression portion; a first branch portion which branches a flow of the refrigerant flowing out of the radiator; a high-pressure side decompression portion which decompresses and expands the refrigerant of one side branched at the first branch portion; a second branch portion which branches a flow of the refrigerant of the other side branched at the first branch portion; an ejector which draws refrigerant from a refrigerant suction port by a flow of high-speed jet refrigerant jetted from a nozzle portion in which the refrigerant of one side branched at the second branch portion is decompressed and expanded, and mixes the jet refrigerant and the refrigerant drawn from the refrigerant suction port to be pressurized; a second compression portion which draws the refrigerant flowing from the ejector, and compresses and discharges the drawn refrigerant; a suction side decompression portion which decompresses and expands the refrigerant of the other side branched at the second branch portion; a suction side evaporator which evaporates the refrigerant decompressed and expanded by the suction side decompression portion, and causes the evaporated refrigerant to flow toward the refrigerant suction port; a join portion adapted to join a flow of the refrigerant discharged from the second compression portion and a flow of the refrigerant decompressed and expanded by the high-pressure side decompression portion, and to cause the joined refrigerant to flow toward a suction side of the first compression portion; and an inner heat exchanger which performs heat exchange between the refrigerant downstream of the high-pressure side decompression portion and the refrigerant of the other side branched at the first branch portion.

Accordingly, even in an operation condition in which the suction capacity of the ejector is decreased in accordance with a decrease of the flow amount of the drive flow in the ejector, the second compression portion draws the refrigerant downstream of the ejector, thereby preventing a decrease in the drive flow of the ejector.

Thus, suction action can be certainly exerted, and thereby the ejector-type refrigerant cycle device can be stably operated. At this time, because the refrigerant discharge capacity of the first compression portion can be adjusted independently with respect to the second compression portion, it can prevent the pressure of the high-pressure side refrigerant in the refrigerant cycle from being unnecessarily increased.

Furthermore, a refrigerant cycle, in which the refrigerant is circulated in this order of the first compression portion→the radiator→the first branch portion→the high-pressure side decompression portion→the inner heat exchanger→the join portion→the first compression portion, can be used for cooling the refrigerant flowing into the suction side evaporator.

Thus, the enthalpy of the refrigerant flowing into the suction side evaporator is reduced and the refrigerating capacity obtained in the suction side evaporator can be increased, thereby improving the COP.

Furthermore, the refrigerant is circulated in this order of the first compression portion→the radiator→the first branch portion→the inner heat exchanger→the second branch portion→the suction side decompression portion→the ejector→the second compressor→the join portion→the first compression portion, and thereby the flow of the refrigerant passing through the suction side evaporator becomes circular.

Thus, even when a lubrication oil for lubricating the first and second compression portions is mixed in the refrigerant, it can prevent the lubrication oil from staying in the suction side evaporator.

Furthermore, because the first compression portion can also draw a middle-pressure gas refrigerant joined at the join portion, the compression work amount of the first compression portion when the refrigerant is compressed in iso-entropy can be reduced as compared with a' case where the first compression portion draws only the refrigerant discharged from the second compression portion, thereby improving the COP.

As a result, even in an operation condition in which a variation in the flow amount of the drive flow is caused, the ejector-type refrigerant cycle device can be stably operated.

For example, in the ejector-type refrigerant cycle device, a first auxiliary inner heat exchanger may be provided to perform heat exchange between the refrigerant flowing from the ejector and the refrigerant of the other side branched at the first branch portion.

Because the first auxiliary inner heat exchanger can cool the refrigerant flowing into the suction side evaporator via the first and second branch portions, the enthalpy of the refrigerant flowing into the suction side evaporator can be reduced, thereby further improving the COP.

Alternatively/Furthermore, a second auxiliary inner heat exchanger may be provided to perform heat exchange between the refrigerant to be drawn into the refrigerant suction port and the refrigerant of the other side branched at the first branch portion.

Because the second auxiliary inner heat exchanger can cool the refrigerant flowing into the suction side evaporator via the first and second branch portions, the enthalpy of the refrigerant flowing into the suction side evaporator can be reduced, thereby further improving the COP.

Furthermore, an auxiliary radiator may be provided to cool the refrigerant of the other side branched at the first branch portion in the ejector-type refrigerant cycle device.

Because the auxiliary radiator can cool the refrigerant flowing into the suction side evaporator via the first and second branch portions, the enthalpy of the refrigerant flowing into the suction side evaporator can be reduced, thereby further improving the COP.

Furthermore, a discharge side evaporator may be located between an outlet side of the ejector and a suction side of the second compression portion, to evaporate the refrigerant flowing out of the ejector.

In this case, the cooling capacity can be exerted not only in the suction side evaporator but also in the discharge side evaporator. Furthermore, the suction side evaporator becomes in a refrigerant evaporation pressure in accordance with the suction action of the jet refrigerant, and the discharge side evaporator becomes in a refrigerant evaporation pressure after being pressurized in the ejector, and thereby the refrigerant evaporation temperature can be made different between the suction side evaporator and the discharge side evaporator.

In the ejector-type refrigerant cycle device, when a refrigerant flow amount flowing from the second branch portion to the nozzle portion is as a nozzle-side refrigerant flow amount Gnoz and a refrigerant flow amount flowing from the second branch portion toward the suction side decompression portion is as a decompression-side refrigerant flow amount Ge, the second branch portion may be configured such that a flow amount ratio Gnoz/Ge of the nozzle-side refrigerant flow amount Gnoz to the decompression-side refrigerant flow amount Ge can be adjusted in accordance with a variation of a cycle load.

Here, the ejector draws the refrigerant from the refrigerant suction port based on a negative pressure generated by the jet refrigerant jetted from the nozzle portion. Furthermore, the speed energy of the mixed refrigerant between the jet refrigerant and the suction refrigerant is converted to the pressure energy in the diffuser portion.

Thus, if the refrigerant supplied to the nozzle portion of the ejector, that is, the drive flow is not obtained, it is impossible to exert the refrigerant suction action and the refrigerant pressurizing action, and thereby it is impossible to reduce the drive force of the second compressor by increasing the pressure of the suction refrigerant of the second compressor. In addition, if a suitable flow amount of the refrigerant is not supplied to the suction side evaporator, it is impossible to exert the refrigerating capacity required in the suction side evaporator.

Thus, when the refrigerant flow amount flowing into the second branch portion is changed in accordance with the variation in the load of the refrigerant cycle, by adjusting the flow amount ratio Gnoz/Ge at a suitable value, the COP can be improved, regardless of the operation condition.

The load of the refrigerant cycle can be indicated by a physical amount having a relationship with a thermal load of the ejector-type refrigerant cycle device. For example, the load of the refrigerant cycle can be indicated by a heat-radiating capacity required in the radiator (i.e., radiation load of the radiator) or a heat-absorbing capacity required in the suction side evaporator (i.e., heat-absorbing load of the suction side evaporator).

For example, in a low load operation in which the cycle load is decreased than a general operation, the flow amount ratio Gnoz/Ge may be increased than that in the general operation. Alternatively, in a high load operation in which the cycle load is increased than the general operation, the flow amount ratio Gnoz/Ge may be decreased than that in the general operation.

For example, the suction side decompression portion may be an electrical variable throttle mechanism configured to change its refrigerant passage area. In this case, the ejector-type refrigerant cycle device may be provided with a throttle capacity control portion which controls operation of the variable throttle mechanism. Thus, the control portion can control operation of the variable throttle mechanism so as to adjust the flow amount ratio Gnoz/Ge. The flow amount ratio Gnoz/Ge can be easily adjusted.

According to another aspect of the present invention, an ejector-type refrigerant cycle device includes: a first compression portion which compresses and discharges refrigerant; a radiator which cools high-pressure refrigerant discharged from the first compression portion; a first branch portion which branches a flow of the refrigerant flowing out of the radiator; a high-pressure side decompression portion which decompresses and expands the refrigerant of one side branched at the first branch portion; an ejector which draws refrigerant from a refrigerant suction port by a flow of high-speed jet refrigerant jetted from a nozzle portion in which the refrigerant of the other side branched at the first branch portion is decompressed and expanded, and mixes the jet refrigerant and the refrigerant drawn from the refrigerant suction port to be pressurized; a discharge side gas-liquid separator which separates the refrigerant flowing out of the ejector into gas refrigerant and liquid refrigerant; a second compression portion which draws gas refrigerant separated at the discharge-side gas-liquid separator, and compresses and discharges the drawn refrigerant; a suction side decompression portion which decompresses and expands the liquid refrigerant separated at the discharge side gas-liquid separator; a suction side evaporator which evaporates the refrigerant decompressed and expanded by the suction side decompression portion, and causes the evaporated refrigerant to flow toward the refrigerant suction port; a join portion adapted to join a flow of the refrigerant discharged from the second compression portion and a flow of the refrigerant decompressed and expanded by the high-pressure side decompression portion, and to cause the joined refrigerant to flow toward a suction side of the first compression portion; an inner heat exchanger which performs heat exchange between the refrigerant downstream of the high-pressure side decompression portion and the refrigerant of the other side branched at the first branch portion; and an oil return passage configured to communicate a refrigerant outlet side of the suction side evaporator with a suction side of the second compressor so as to return oil mixed in the refrigerant to a side of the second compression portion.

Accordingly, reduce of the flow amount of the drive flow can be restricted by the action of the second compression portion, thereby certainly exerting the suction action in the ejector. Therefore, the ejector-type refrigerant cycle device can be operated stably.

Thus, it is possible to obtain both the COP improvement due to the inner heat exchanger, and the COP improvement due to the suction of the join refrigerant, joined at the join portion, from the first compression portion.

Furthermore, because the oil return passage is provided, it can prevent the lubricating oil from staying in the suction side evaporator even when the lubricating oil for lubricating the first and second compression portions is mixed in the refrigerant.

As a result, even in an operation condition in which a variation in the flow amount of the drive flow can be caused, the ejector-type refrigerant cycle device can be stably operated without decreasing the COP.

In the ejector-type refrigerant cycle device, a first auxiliary inner heat exchanger may be provided to perform heat exchange between the refrigerant flowing from the ejector and the refrigerant of the other side branched at the first branch portion.

Because the first auxiliary inner heat exchanger can reduce the enthalpy of the refrigerant flowing into the suction side evaporator, thereby further improving the COP.

Furthermore, a second auxiliary inner heat exchanger may be provided to perform heat exchange between the refrigerant to be drawn into the refrigerant suction port and the refrigerant of the other side branched at the first branch portion.

Because the second auxiliary inner heat exchanger can reduce the enthalpy of the refrigerant flowing into the suction side evaporator, thereby further improving the COP.

Furthermore, a discharge side evaporator may be located between an outlet side of the ejector and an inlet side of the discharge side gas-liquid separator, to evaporate the refrigerant flowing out of the ejector. Thus, the refrigerating capacity can be exerted not only in the suction side evaporator but also in the discharge side evaporator.

Furthermore, a high-pressure side gas-liquid separator may be provided to separate the refrigerant flowing from the radiator into gas refrigerant and liquid refrigerant, and to introduce the separated liquid refrigerant toward downstream. Thus, the saturated liquid refrigerant can be branched in the first branch portion, thereby the cycle operation can be made easily stable.

In the ejector-type refrigerant cycle device, the radiator may be provided with a condensation portion which condenses the refrigerant, a gas-liquid separation portion which separates the refrigerant flowing out of the condensation portion into gas refrigerant and liquid refrigerant, and a supercool portion which super-cools the liquid refrigerant flowing out of the gas-liquid separation portion.

Thus, the saturated liquid refrigerant can be branched in the first branch portion, thereby the cycle operation can be made easily stable.

Furthermore, in the ejector-type refrigerant cycle device, a bypass passage through which the high-pressure refrigerant discharged from the first compression portion is introduced to the suction side evaporator, and an opening/closing portion for opening and closing the bypass passage may be provided.

Thus, in a defrosting time of the suction side evaporator, by opening the opening/closing portion, high-temperature refrigerant discharged from the first compressor can flow into the suction side evaporator, thereby frosting the suction side evaporator.

Alternatively, in the ejector-type refrigerant cycle device, a bypass passage through which the high-pressure refrigerant discharged from the first compression portion is introduced to the discharge side evaporator, and an opening/closing portion for opening and closing the bypass passage may be provided.

Thus, in a defrosting time of the discharge side evaporator, by opening the opening/closing portion, high-temperature refrigerant discharged from the first compressor can flow into the discharge side evaporator, thereby frosting the discharge side evaporator.

In the ejector-type refrigerant cycle device, a radiation capacity adjusting portion adjusting a radiation capacity of the radiator may be further provided. In this case, the high-pressure refrigerant discharged from the first compression portion is the refrigerant flowing out of the radiator. The radiation capacity adjusting portion can reduce the radiation capacity of the radiator when the opening/closing portion opens the bypass passage.

Here, the meaning of reducing the radiation capacity not only includes the meaning of simply reducing the radiation capacity but also includes the meaning that the radiation capacity is made zero (i.e., heat radiation is not caused in the radiator).

According to another aspect of the present invention, an ejector-type refrigerant cycle device includes: a first compression portion which compresses and discharges refrigerant; a first branch portion which branches a flow of high-pressure refrigerant discharged from the first compression portion; a first radiator which cools the refrigerant of one side branched at the first branch portion; a second radiator which cools the refrigerant of the other side branched at the first branch portion; a high-pressure side decompression portion which decompresses and expands the refrigerant cooled at the first radiator; a second branch portion which branches a flow of the refrigerant cooled at the second radiator; an ejector which draws refrigerant from a refrigerant suction port by a flow of high-speed jet refrigerant jetted from a nozzle portion in which the refrigerant of one side branched at the second branch portion is decompressed and expanded, and mixes the jet refrigerant and the refrigerant drawn from the refrigerant suction port to be pressurized; a second compression portion which draws the refrigerant flowing from the ejector, and compresses and discharges the drawn refrigerant; a suction side decompression portion which decompresses and expands the refrigerant of the other side, branched at the second branch portion; a suction side evaporator which evaporates the refrigerant decompressed and expanded in the suction side decompression portion, and causes the evaporated refrigerant to flow toward the refrigerant suction port; a join portion adapted to join a flow of the refrigerant discharged from the second compression portion and a flow of the refrigerant decompressed and expanded by the high-pressure side decompression portion, and to cause the joined refrigerant to flow toward a suction side of the first compression portion; and an inner heat exchanger which performs heat exchange between the refrigerant downstream of the high-pressure side decompression portion and the refrigerant of the other side branched at the first branch portion.

Accordingly, a reduce of the flow amount of the drive flow can be restricted by the action of the second compression portion, thereby certainly exerting the suction action in the ejector. Therefore, the ejector-type refrigerant cycle device can be operated stably.

Thus, it is possible to obtain both the COP improvement due to the inner heat exchanger, and the COP improvement due to the suction of the join refrigerant, joined at the join portion, from the first compression portion.

Furthermore, because the heat-exchanging capacity (heat radiating performance) of the first radiator and the heat-exchanging capacity (heat radiating performance) of the second radiator can be changed independently, the heat exchanging capacity of the second radiator and the heat exchanging capacity (heat absorbing performance) of the suction side evaporator can be easily suited. Thus, the operation of the ejector-type refrigerant cycle device can be made further stable.

Furthermore, the refrigerant is circulated in this order of the first compression portion→the first branch portion→the second radiator→the inner heat exchanger→the second branch portion→the suction side decompression portion→the suction side evaporator→the ejector→the second compressor→the join portion→the first compression portion, and thereby the flow of the refrigerant passing through the suction side evaporator becomes circular.

Thus, even when a lubrication oil for lubricating the first and second compression portions is mixed in the refrigerant, it can prevent the lubrication oil from staying in the suction side evaporator.

As a result, even in an operation condition in which a variation in the flow amount of the drive flow is caused, the ejector-type refrigerant cycle device can be stably operated without reducing the COP.

For example, in the ejector-type refrigerant cycle device, a first auxiliary inner heat exchanger may be provided to perform heat exchange between the refrigerant flowing from the ejector and the refrigerant flowing out of the second radiator.

Because the first auxiliary inner heat exchanger can cool the refrigerant flowing into the suction side evaporator via the second branch portion, the enthalpy of the refrigerant flowing into the suction side evaporator can be reduced, thereby further improving the COP.

Furthermore, a second auxiliary inner heat exchanger may be provided to perform heat exchange between the refrigerant to be drawn into the refrigerant suction port and the refrigerant of the other side branched at the first branch portion.

Because the second auxiliary inner heat exchanger can cool the refrigerant flowing into the suction side evaporator via the second branch portion, the enthalpy of the refrigerant flowing into the suction side evaporator can be reduced, thereby further improving the COP.

Furthermore, a discharge side evaporator may be located between an outlet side of the ejector and a suction side of the second compression portion, to evaporate the refrigerant flowing out of the ejector. In this case, the cooling capacity can be exerted not only in the suction side evaporator but also in the discharge side evaporator.

In the ejector-type refrigerant cycle device, when a refrigerant flow amount flowing from the second branch portion to the nozzle portion is as a nozzle-side refrigerant flow amount Gnoz and a refrigerant flow amount flowing from the second branch portion toward the suction side decompression portion is as a decompression-side refrigerant flow amount Ge, the second branch portion may be configured such that a flow amount ratio Gnoz/Ge of the nozzle-side refrigerant flow amount Gnoz to the decompression-side refrigerant flow amount Ge can be adjusted in accordance with a variation of a cycle load.

Thus, when the refrigerant flow amount flowing into the second branch portion is changed in accordance with the variation in the load of the refrigerant cycle, by adjusting the flow amount ratio Gnoz/Ge at a suitable value, the COP can be improved, even in an operation condition in which a variation in a flow amount of a drive flow can be caused, regardless of an operation condition.

The load of the refrigerant cycle can be indicated by a physical amount having a relationship with a thermal load of the ejector-type refrigerant cycle device. For example, the load of the refrigerant cycle can be indicated by a heat-radiating capacity required in the second radiator (i.e., radiation load of the second radiator) or a heat-absorbing capacity required in the suction side evaporator (i.e., heat-absorbing load of the suction side evaporator).

For example, in a low load operation in which the cycle load is decreased than a general operation, the flow amount ratio. Gnoz/Ge may be increased than that in the general operation. Alternatively, in a high load operation in which the cycle load is increased than the general operation, the flow amount ratio Gnoz/Ge may be decreased than that in the general operation.

In the ejector-type refrigerant cycle device, at least one of a first high-pressure side gas-liquid separator and a second high-pressure side gas-liquid separator may be provided. The first high-pressure side gas-liquid separator is provided to separate the refrigerant flowing from the first radiator into gas refrigerant and liquid refrigerant and to introduce the separated liquid refrigerant toward downstream, and the second high-pressure side gas-liquid separator is provided to separate the refrigerant flowing from the second radiator into gas refrigerant and liquid refrigerant and to introduce the separated liquid refrigerant toward downstream.

Furthermore, at least one of the first and second radiators may include a condensation portion which condenses the refrigerant, a gas-liquid separation portion which separates the refrigerant flowing out of the condensation portion into gas refrigerant and liquid refrigerant, and a super-cool portion which super-cools the liquid refrigerant flowing out of the gas-liquid separation portion. Thus, the operation of the refrigerant cycle can be made stable.

Furthermore, in the ejector-type refrigerant cycle device, a bypass passage through which the high-pressure refrigerant discharged from the first compression portion is introduced to the suction side evaporator, and an opening/closing portion for opening and closing the bypass passage may be provided. Thus, defrosting of the suction side evaporator can be performed.

Alternatively, in the ejector-type refrigerant cycle device, a bypass passage through which the high-pressure refrigerant discharged from the first compression portion is introduced to the discharge side evaporator, and an opening/closing portion for opening and closing the bypass passage may be provided. Thus, defrosting of the discharge side evaporator can be performed.

In any ejector-type refrigerant cycle device, a radiation capacity adjusting portion for adjusting a radiation capacity of the first and second radiators may be further provided. In this case, the high-pressure refrigerant discharged from the first compression portion is the refrigerant flowing out of the first and second radiators. The radiation capacity adjusting portion can reduce the radiation capacity of the first and second radiators when the opening/closing portion opens the bypass passage.

Here, the meaning of reducing the radiation capacity not only includes the meaning of simply reducing the radiation capacity but also includes the meaning that the radiation capacity is made zero (i.e.; heat radiation is not caused in the first and second radiators).

The inner heat exchanger may be adapted to perform heat exchange between the refrigerant upstream of the join portion and downstream of the high-pressure side decompression portion, and the refrigerant of the other side branched at the first branch portion.

In this case, the inner heat exchanger may be adapted to perform heat exchange between the refrigerant, joined at the join portion with the refrigerant discharged from the second compression portion, among the refrigerant downstream of the high-pressure side decompression portion, and the refrigerant of the other side branched at the first branch portion. Thus, a temperature difference between the high-pressure refrigerant and the low-pressure refrigerant in the inner heat exchanger can be improved.

The suction side decompression portion may be an expansion unit which expands the refrigerant in volume and decompresses the refrigerant so as to convert the pressure energy of the refrigerant to the mechanical energy of the refrigerant. In this case, the mechanical energy output from the expansion unit can be effectively used, thereby improving the energy efficiency in the entire ejector-type refrigerant cycle device.

Furthermore, a pre-nozzle decompression portion may be provided to decompress and expand the refrigerant to flow into the nozzle portion.

Thus, by the action of the pre-nozzle decompression portion, the refrigerant flowing into the nozzle portion can be decompressed into a gas-liquid two-phase state. Therefore, as compared with a case where only the liquid refrigerant flows into the nozzle portion, boiling of the refrigerant in the nozzle portion can be facilitated, thereby improving the nozzle efficiency.

As a result, a pressure increasing amount is increased in the ejector, thereby further improving the COP. Here, the nozzle efficiency is the energy conversion efficiency when the pressure energy of the refrigerant is converted to the speed energy thereof in the nozzle portion.

Furthermore, when the pre-nozzle decompression portion is configured by a variable throttle mechanism, the refrigerant flow amount flowing into the nozzle portion can be changed in accordance with the variation in the load of the refrigerant cycle. As a result, the refrigerant cycle can be operated with a high COP.

The pre-nozzle decompression portion may be located between an outlet side of the second branch portion and an inlet side of the nozzle portion, to decompress and expand the refrigerant to flow into the nozzle portion. Furthermore, an inner heat exchanger may be provided to perform heat exchange between the refrigerant downstream of the high-pressure side decompression portion and the refrigerant of the other side branched at the second branch portion.

Accordingly, the refrigerant of the other side branched at the second branch portion, that is, the refrigerant flowing into the suction side evaporator can be cooled by the inner heat exchanger, thereby reducing the enthalpy of the refrigerant flowing into the suction side evaporator. Thus, the COP can be further improved.

Furthermore, the enthalpy of the refrigerant flowing into the nozzle portion from the second branch portion is not reduced unnecessarily. Thus, the recovery energy amount in the nozzle portion can be increased, and thereby the COP improvement can be further increased. The reason is that the tile of the iso-entropy line on the Mollier diagram becomes more gradual as the enthalpy of the refrigerant flowing into the nozzle portion increases.

Thus, when the refrigerant is expanded in the nozzle portion in iso-entropy by the same pressure, the enthalpy difference (recovery energy) between the enthalpy of the refrigerant at the inlet side of the nozzle portion and the enthalpy of the refrigerant at the outlet side of the nozzle portion can be made larger as the enthalpy of the refrigerant at the inlet side of the nozzle portion becomes higher. The pressurizing amount of the ejector is increased as an increase of a recovery energy amount, and thereby the COP improvement can be further increased.

In the ejector-type refrigerant cycle device, a pre-nozzle decompression portion may be located between a refrigerant outlet side of the second branch portion and a refrigerant inlet side of the nozzle portion, to decompress and expand the refrigerant to flow into the nozzle portion. In this case, the first auxiliary heat exchanger is adapted to perform heat exchange between the refrigerant flowing out of the ejector and the refrigerant of the other side branched at the second branch portion.

Accordingly, the refrigerant of the other side branched at the second branch portion, that is, the refrigerant flowing into the suction side evaporator can be cooled by the auxiliary inner heat exchanger. Thus, the enthalpy of the refrigerant flowing into the nozzle portion is not reduced unnecessarily by the auxiliary inner heat exchanger, and thereby the COP can be further improved.

In the ejector-type refrigerant cycle device, a pre-nozzle decompression portion may be located between a refrigerant outlet side of the second branch portion and a refrigerant inlet side of the nozzle portion, to decompress and expand the refrigerant to flow into the nozzle portion. In this case, the second auxiliary heat exchanger may be adapted to perform heat exchange between the refrigerant to be drawn into the refrigerant suction port and the refrigerant of the other side branched at the second branch portion.

Accordingly, the refrigerant of the other side branched at the second branch portion, that is, the refrigerant flowing into the suction side evaporator can be cooled by the second auxiliary inner heat exchanger. Thus, the enthalpy of the refrigerant flowing into the nozzle portion is not reduced unnecessarily by the second auxiliary inner heat exchanger, and thereby the COP can be further improved.

In the ejector-type refrigerant cycle device, a first pressure difference (Pdei−Pnozi) between a refrigerant pressure (Pdei) at the inlet side of the pre-nozzle decompression portion and a refrigerant pressure (Pnozi) at the inlet side of the nozzle portion, and a second pressure difference (Pdei−Pnozo) between the refrigerant pressure Pdei at the inlet side of the pre-nozzle decompression portion and the refrigerant pressure (Pnozo) at the outlet side of the nozzle portion may be set such that $0.1 \leq (Pdei-Pnozi)/(Pdei-Pnozo) \leq 0.6$.

By adjusting the flow amount ratio Gnoz/Ge at a suitable value in accordance with a variation in the load of the refrigerant cycle, the COP can be improved regardless of the operation condition.

It is because the COP is changed based on the first pressure difference (Pdei−Pnozi) between the refrigerant pressure (Pdei) at the inlet side of the pre-nozzle decompression portion and the refrigerant pressure (Pnozi) at the inlet side of the nozzle portion, and the second pressure difference (Pdei−Pnozo) between the refrigerant pressure Pdei at the inlet side of the pre-nozzle decompression portion and the refrigerant pressure (Pnozo) at the outlet side of the nozzle portion.

As a special means for realizing a suitable flow amount ratio Gnoz/Ge, the first pressure difference (Pdei−Pnozi) and the second pressure difference (Pdei−Pnozo) have the relationship of $0.1 \leq (Pdei-Pnozi)/(Pdei-Pnozo) \leq 0.6$. Thus, the COP can be improved, even in an operation condition in which a variation in a flow amount of a drive flow can be caused, regardless of an operation condition.

For example, the pre-nozzle decompression portion may decompress and expand the refrigerant such that a dryness of the refrigerant flowing into the nozzle portion is not smaller than 0.003 and not larger than 0.14.

Because the pre-nozzle decompression portion decompresses and expands the refrigerant flowing into the nozzle portion such that the dryness of the refrigerant flowing into the nozzle portion becomes in a range not smaller than 0.003 and not larger than 0.14, the flow amount ratio (Gnoz/Ge) can be adjusted at a suitable value. Thus, a high COP can be achieved, regardless the operation condition, even in the operation condition in which the variation in the flow amount of the drive flow can be caused.

Furthermore, the pre-nozzle decompression portion may be an expansion unit which expands the refrigerant in volume and decompresses the refrigerant so as to convert the pressure energy of the refrigerant to the mechanical energy of the refrigerant. Thus, the mechanical energy output from the expansion unit can be effectively used, thereby improving the energy efficiency in the entire ejector-type refrigerant cycle device.

According to another aspect of the present invention, an ejector-type refrigerant cycle device includes: a first compression portion which compresses and discharges refrigerant; an exterior heat exchanger adapted to perform heat exchange between the refrigerant and outside air; a using side heat exchanger adapted to perform heat exchange between the refrigerant and a fluid to be heat-exchanged; a refrigerant passage switching portion that selectively switches between a refrigerant passage of a cooling operation mode for cooling the fluid to be heat-exchanged, and a refrigerant passage of a heating operation mode for heating the fluid to be heat-exchanged; a first branch portion which branches a flow of the refrigerant flowing out of the exterior heat exchanger in the cooling operation mode; a high-pressure side decompression portion which decompresses and expands the refrigerant of one side branched at the first branch portion in the cooling operation mode; a second branch portion which branches a flow of the refrigerant of the other side branched at the first branch portion in the cooling operation mode; an ejector which draws refrigerant from a refrigerant suction port by a flow of high-speed jet refrigerant jetted from a nozzle portion in which the refrigerant of one side branched at the second branch portion is decompressed and expanded in the cooling operation mode, and mixes the jet refrigerant and the refrigerant drawn from the refrigerant suction port to be pressurized; a second compression portion which draws the refrigerant flowing from the ejector, and compresses and discharges the drawn refrigerant, in the cooling operation mode; a suction side decompression portion which decompresses and expands the refrigerant of the other side branched at the second branch portion in the cooling operation mode; a join portion adapted to join a flow of the refrigerant discharged from the second compression portion and a flow of the refrigerant decompressed and expanded by the high-pressure side decompression portion, and to cause the joined refrigerant to flow toward a suction side of the first compression portion, in the cooling operation mode; and an inner heat exchanger which performs heat exchange between the refrigerant downstream of the high-pressure side decompression portion and the refrigerant of the other side branched at the first branch portion, in the cooling operation mode. In the ejector-type refrigerant cycle device, in the cooling operation mode, the refrigerant passage switching portion is switched such that: the using side heat exchanger causes the refrigerant decompressed and expanded by the suction side decompression portion is evaporated and to flow toward the refrigerant suction port, and the refrigerant discharged from the first compressor is cooled in the exterior heat exchanger. Furthermore, in the heating operation mode, the refrigerant passage switching portion is switched such that the refrigerant discharged from the first compression portion is cooled in the using side heat exchanger and the refrigerant is evaporated in the exterior heat exchanger.

Thus, in the cooling operation mode, the second compression portion draws the refrigerant downstream of the ejector, thereby preventing a decrease in the drive flow of the ejector. Thus, suction action can be certainly exerted in the ejector, and thereby the ejector-type refrigerant cycle device can be stably operated.

Thus, it is possible to obtain both the COP improvement due to the inner heat exchanger, and the COP improvement due to the suction of the join refrigerant, joined at the join portion, from the first compression portion.

Furthermore, in the cooling operation mode, a refrigerant cycle, in which the refrigerant is circulated in this order of the first compression portion→the exterior heat exchanger→the first branch portion→the inner heat exchanger→the second branch portion→the suction side decompression portion→the using side heat exchanger→the ejector→the second compressor→the join portion→the first compression portion, and thereby the flow of the refrigerant passing through the using side heat exchanger becomes circular.

Thus, even when a lubrication oil for lubricating the first and second compression portions is mixed in the refrigerant, it can prevent the lubrication oil from staying in the using side heat exchanger.

As a result, even in an operation condition in which a variation in the flow amount of the drive flow is caused, the ejector-type refrigerant cycle device can be stably operated without reducing the COP. Furthermore, because the refrigerant passage switching portion selectively switches between the refrigerant passages, the fluid to be heated can be heated.

In the ejector-type refrigerant cycle device, an auxiliary inner heat exchanger may be provided such that the refrigerant flowing out of the ejector is heat exchanged with the refrigerant of the other side branched at the first branch portion in the cooling operation mode.

Because the auxiliary inner heat exchanger can cool the refrigerant flowing into the using side heat exchanger, the enthalpy of the refrigerant flowing into the using side heat exchanger can be reduced, thereby further improving the COP.

Alternatively, an auxiliary exterior heat exchanger may be provided to cool the refrigerant of the other side branched at the first branch portion in the cooling operation mode.

Because the auxiliary exterior heat exchanger can cool the refrigerant flowing into the using side heat exchanger, the enthalpy of the refrigerant flowing into the using side heat exchanger can be reduced, thereby further improving the COP.

According to another aspect of the present invention, an ejector-type refrigerant cycle device includes: a first compression portion which compresses and discharges refrigerant; first and second exterior heat exchangers adapted to perform heat exchange between the refrigerant and outside air; a using side heat exchanger adapted to perform heat exchange between the refrigerant and a fluid to be heat-exchanged; a refrigerant passage switching portion selectively switches between a refrigerant passage of a cooling operation mode for cooling the fluid to be heat-exchanged, and a refrigerant passage of a heating operation mode for heating the fluid to be heat-exchanged; a first branch portion which branches a flow of the refrigerant discharged from the first compression portion, and causes the branched refrigerant of one side to flow toward the first exterior heat exchanger and causes the branched refrigerant of the other side to flow toward the second exterior heat exchanger, in the cooling operation mode; a high-pressure side decompression portion which decompresses and expands the refrigerant heat-exchanged in the first exterior heat exchanger, in the cooling operation mode; a second branch portion which branches a flow of the refrigerant heat-exchanged in the second exterior heat exchanger, in the cooling operation mode; an ejector which draws refrigerant from a refrigerant suction port by a flow of high-speed jet refrigerant jetted from a nozzle portion in which the refrigerant of one side branched at the second branch portion is decompressed and expanded in the cooling operation mode, and mixes the jet refrigerant and the refrigerant drawn from the refrigerant suction port to be pressurized; a second compression portion which draws the refrigerant flowing from the ejector, and compresses and discharges the drawn refrigerant, in the cooling operation mode; a suction side decompression portion which decompresses and expands the refrigerant of the other side branched at the second branch portion in the cooling operation mode; a join portion adapted to join a flow of the refrigerant discharged from the second compression portion and a flow of the refrigerant decompressed and expanded by the high-pressure side decompression portion, and to cause the joined refrigerant to flow toward a suction side of the first compression portion, in the cooling operation mode; and an inner heat exchanger which performs heat exchange between the refrigerant downstream of the high-pressure side decompression portion and the refrigerant flowing out of the second exterior heat exchanger, in the cooling operation mode. In the ejector-type refrigerant cycle device, in the cooling operation mode, the refrigerant passage switching portion is switched such that: the refrigerant discharged from the first compressor is cooled in the first and second exterior heat exchangers, and the using side heat exchanger causes the refrigerant decompressed and expanded by the suction side decompression portion to be evaporated and to flow toward the refrigerant suction port. Furthermore, in the heating operation mode, the refrigerant passage switching portion is switched such that the refrigerant discharged from the first compression portion is cooled in the using side heat exchanger and the refrigerant is evaporated in the second exterior heat exchanger.

Thus, in the cooling operation mode, a reduce of the flow amount of the drive flow can be restricted by the action of the second compression portion, thereby certainly exerting the suction action in the ejector. Therefore, the ejector-type refrigerant cycle device can be operated stably.

Thus, it is possible to obtain both the COP improvement due to the inner heat exchanger, and the COP improvement due to the suction of the join refrigerant, joined at the join portion, from the first compression portion.

Furthermore, because the heat-exchanging capacity of the first exterior heat exchanger and the heat-exchanging capacity of the second exterior heat exchanger can be changed independently, the heat-exchanging capacity of the second exterior heat exchanger and the heat exchanging capacity (heat absorbing performance) of the using side heat exchanger can be easily suited. Thus, the operation of the ejector-type refrigerant cycle device can be made further stable.

Furthermore, the refrigerant is circulated in this order of the first compression portion→the first branch portion→the second exterior heat exchanger→the inner heat exchanger→the second branch portion→the suction side decompression portion→the using side heat exchanger→the ejector→the second compressor→the join portion→the first compression portion, and thereby the flow of the refrigerant passing through the using side heat exchanger becomes circular.

Thus, even when a lubrication oil for lubricating the first and second compression portions is mixed in the refrigerant, it can prevent the lubrication oil from staying in the using side heat exchanger.

As a result, even in an operation condition in which a variation in the flow amount of the drive flow is caused, the ejector-type refrigerant cycle device can be stably operated without reducing the COP. Furthermore, because the refrigerant passage switching portion switches between the refrigerant passages, a fluid to be heated can be heated.

For example, in the ejector-type refrigerant cycle device, an auxiliary inner heat exchanger may be provided to perform heat exchange between the refrigerant flowing from the ejector and the refrigerant flowing out of the second exterior heat exchanger in the cooling operation mode.

Because the auxiliary inner heat exchanger can cool the refrigerant flowing into the using side heat exchanger, the enthalpy of the refrigerant flowing into the using side heat exchanger can be reduced, thereby further improving the COP in the cooling operation mode.

Furthermore, in the ejector-type refrigerant cycle device, the auxiliary using-side heat exchanger may be provided to evaporate the refrigerant flowing out of the ejector, in the cooling operation mode. In this case, the cooling capacity can be exerted not only in the using side heat exchanger but also in the auxiliary using-side heat exchanger.

Furthermore, in the ejector-type refrigerant cycle device, the inner heat exchanger may be adapted to perform heat exchange between the refrigerant upstream of the join portion and downstream of the high-pressure side decompression portion, and the refrigerant of the other side branched at the first branch portion, in the cooling operation mode.

Alternatively, the inner heat exchanger may be adapted to perform heat exchange between the refrigerant, joined at the join portion with the refrigerant discharged from the second compression portion, among the refrigerant downstream of the high-pressure side decompression portion, and the refrigerant of the other side branched at the first branch portion, in the cooling operation mode.

In the ejector-type refrigerant cycle device, a first discharge capacity changing portion for changing a discharge capacity of the refrigerant discharged from the first compression portion, and a second discharge capacity changing portion for changing a discharge capacity of the refrigerant discharged from the second compression portion may be further provided. In this case, the first discharge capacity changing portion and the second discharge capacity changing portion may be configured to be capable of changing the refrigerant discharge capacity of the first compression portion and the second compression portion, respectively.

Because the refrigerant discharge capacity of the first compression portion and the refrigerant discharge capacity of the second compression portion are adjusted independently, each of the first and second compression portions can be operated with a high compression efficiency. Thus, the COP as the entire ejector-type refrigerant cycle device can be further improved.

For example, the first compression portion and the second compression portion may be accommodated in the same house. In this case, the size of the first compression portion and the second compression portion can be made smaller, thereby reducing the size of the entire ejector-type refrigerant cycle device.

Furthermore, the first compression portion may pressurize the refrigerant to be equal to or higher than the critical pressure of the refrigerant.

BRIEF DESCRIPTION OF THE DRAWINGS

FIG. 120 is a Mollier diagram showing a refrigerant state in the ejector-type refrigerant cycle device according to the 81st embodiment;

FIG. 121 is an entire schematic diagram of an ejector-type refrigerant cycle device according to an 82nd embodiment of the invention;

FIG. 122 is a Mollier diagram showing a refrigerant state in the ejector-type refrigerant cycle device according to the 82nd embodiment;

FIG. 123 is an entire schematic diagram of an ejector-type refrigerant cycle device according to an 83rd embodiment of the invention;

FIG. 124 is a Mollier diagram showing a refrigerant state in the ejector-type refrigerant cycle device according to the 83rd embodiment;

FIG. 125 is an entire schematic diagram of an ejector-type refrigerant cycle device according to an 84th embodiment of the invention;

FIG. 126 is a Mollier diagram showing a refrigerant state in the ejector-type refrigerant cycle device according to the 84th embodiment;

FIG. 127 is an entire schematic diagram of an ejector-type refrigerant cycle device according to an 85th embodiment of the invention;

FIG. 128 is a Mollier diagram showing a refrigerant state in the ejector-type refrigerant cycle device according to the 85th embodiment;

FIG. 129 is a Mollier diagram showing a refrigerant state in an ejector-type refrigerant cycle device according to an 86th embodiment of the invention;

FIG. 130A is a Mollier diagram showing a refrigerant state in a general operation mode according to the 86th embodiment, and FIG. 130B is a Mollier diagram showing a refrigerant state in a defrosting operation mode according to the 86th embodiment;

FIG. 131 is a Mollier diagram showing a refrigerant state in an ejector-type refrigerant cycle device according to an 87th embodiment of the invention;

Figure 132A:
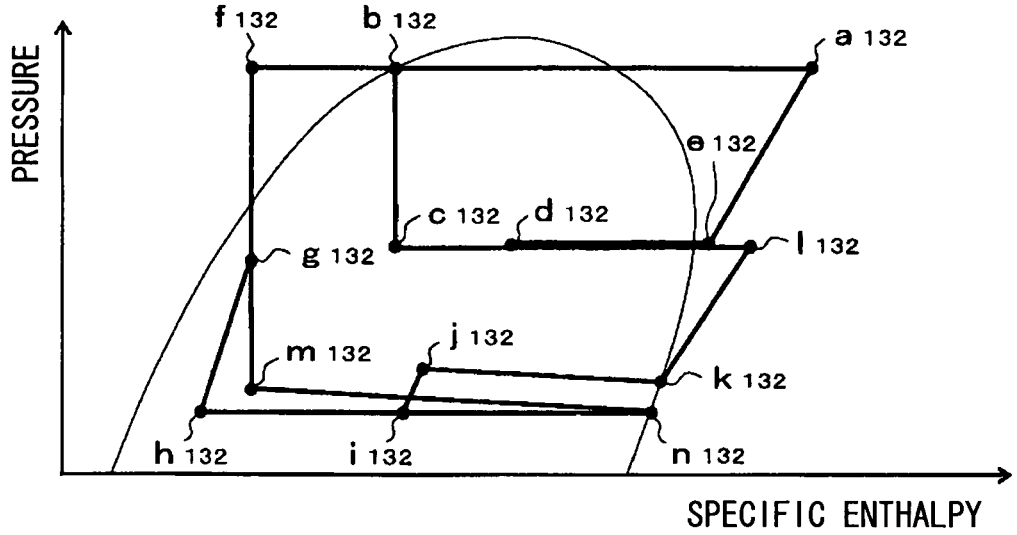
Figure 132B:
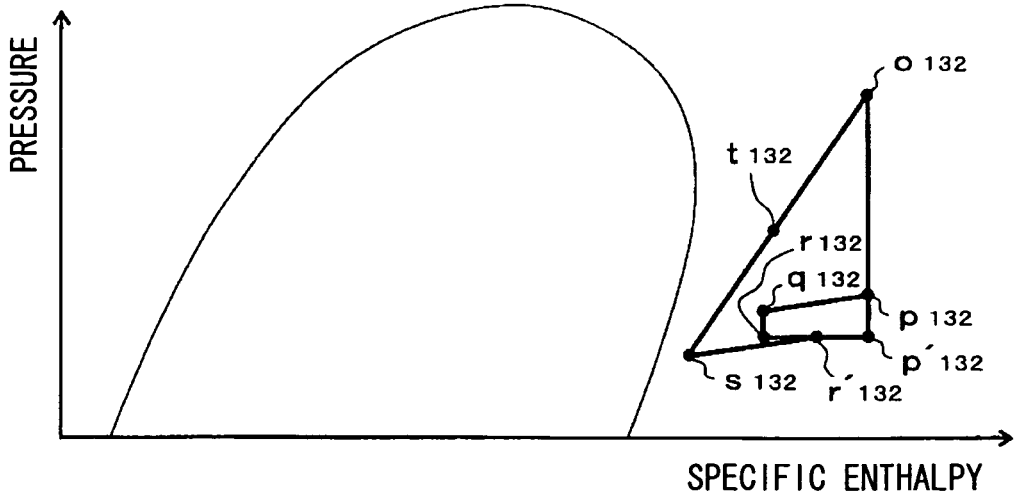
Figure 133:
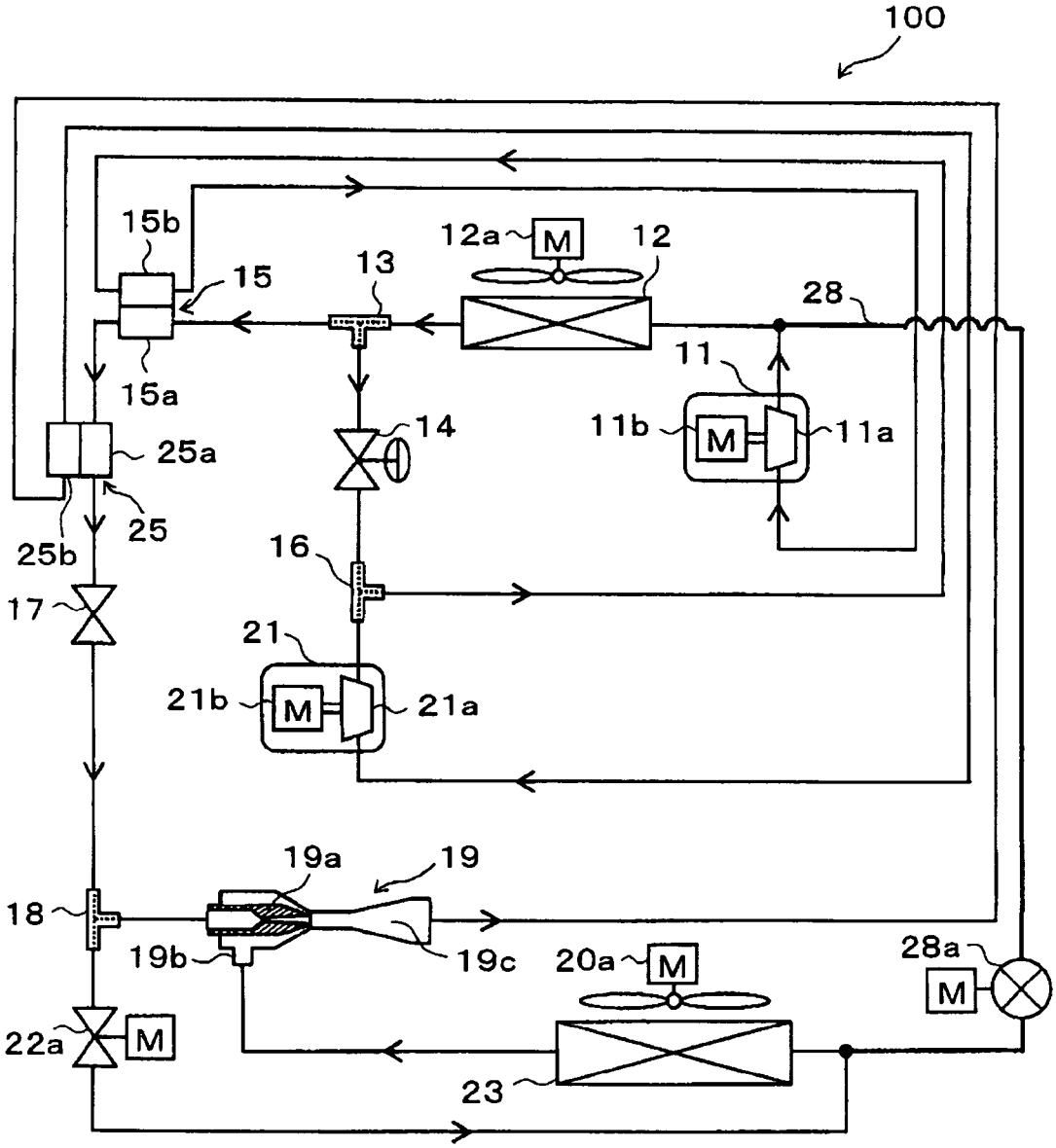
Figure 134A:
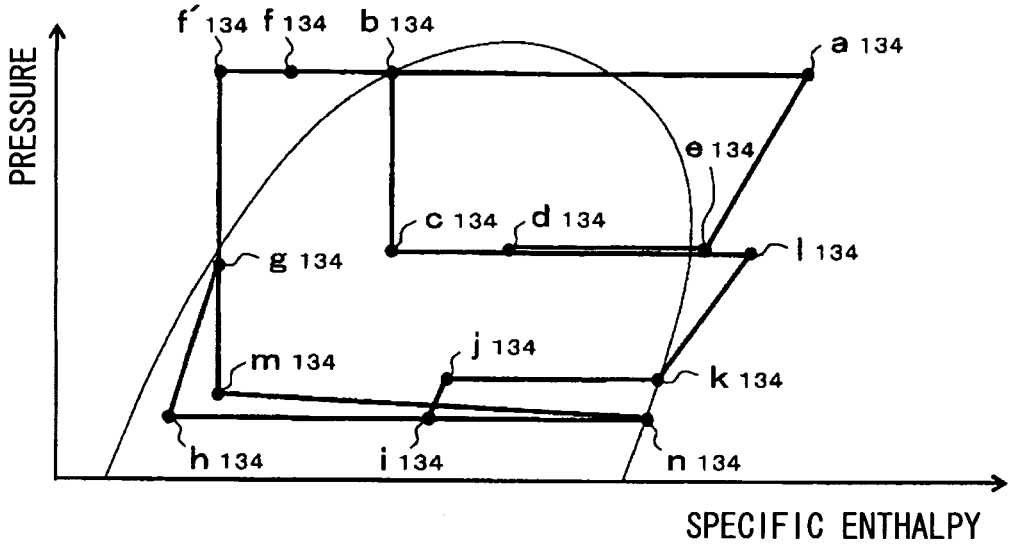
Figure 134B:
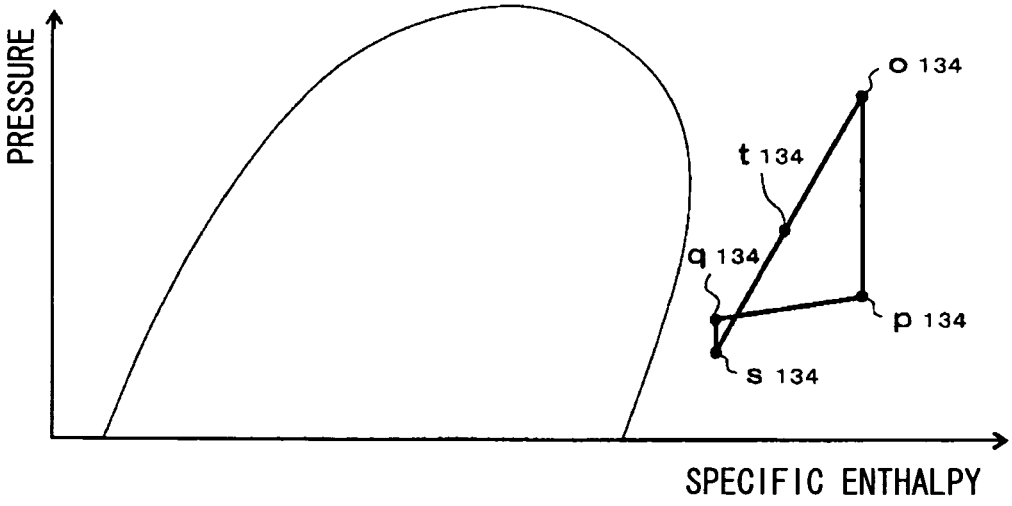
Figure 135:
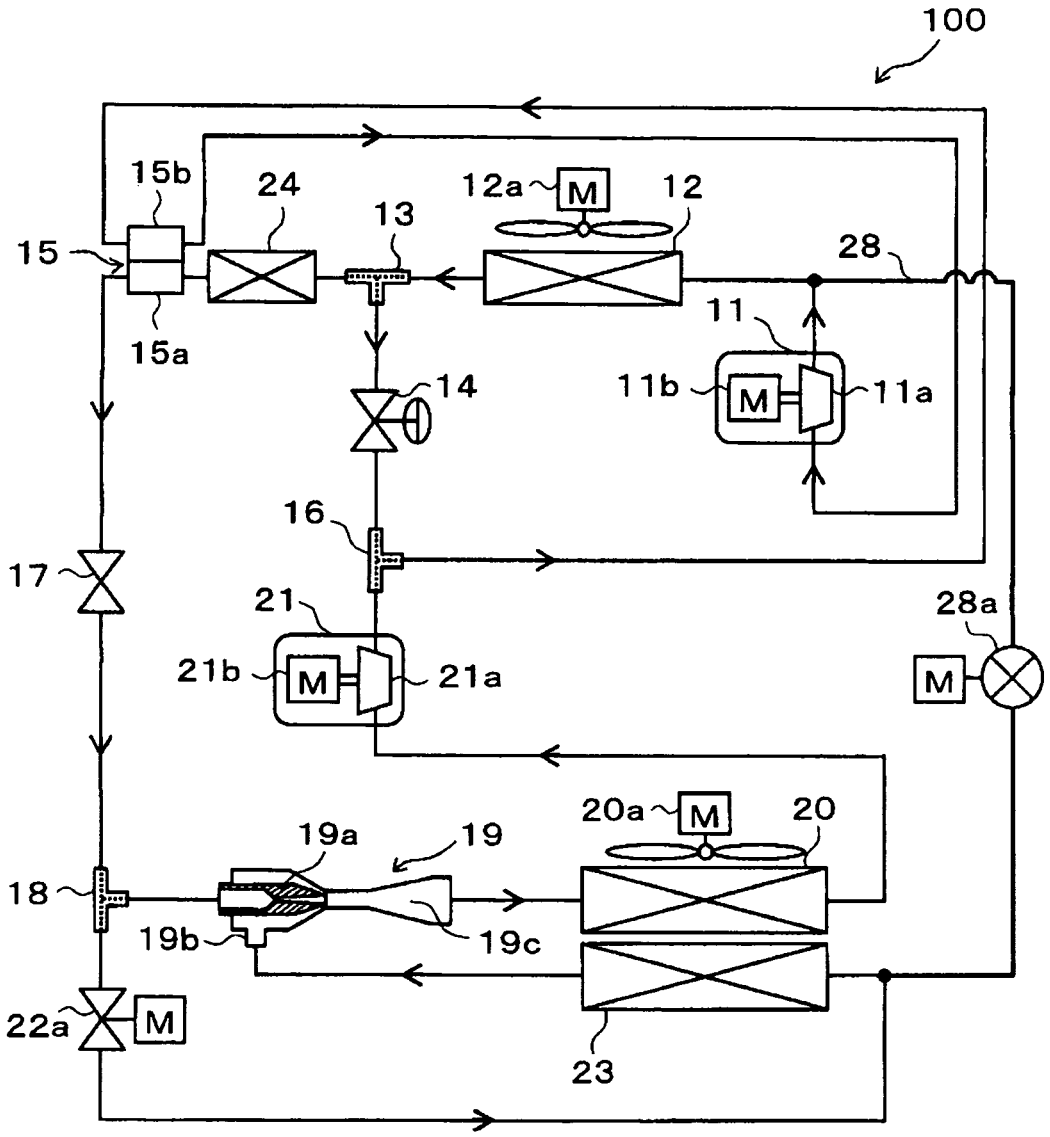
Figure 136A:
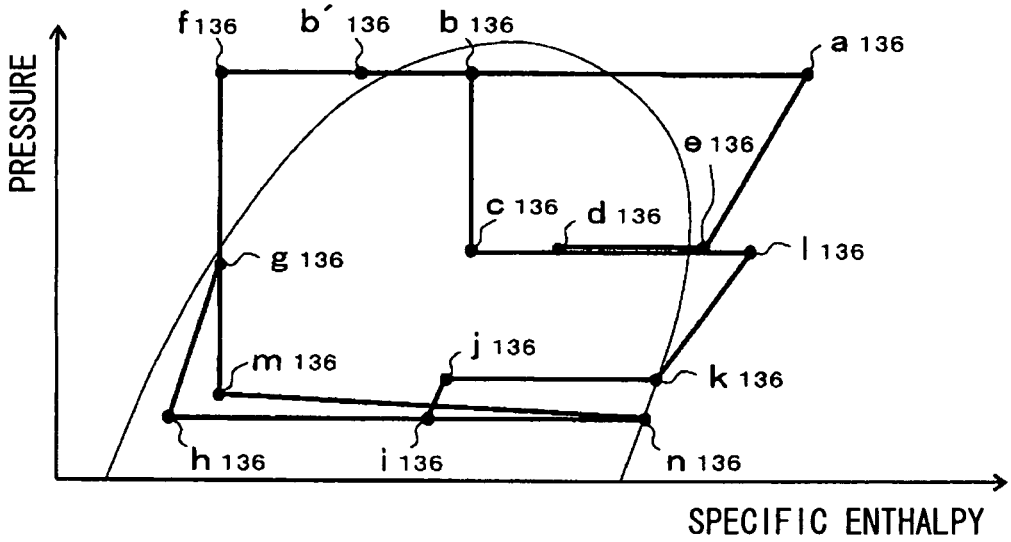
Figure 136B:
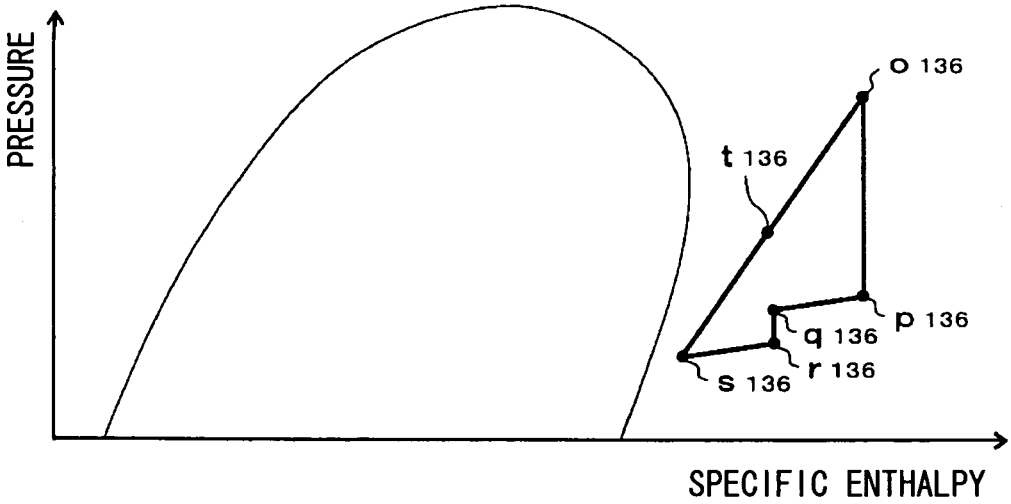
Figure 137:
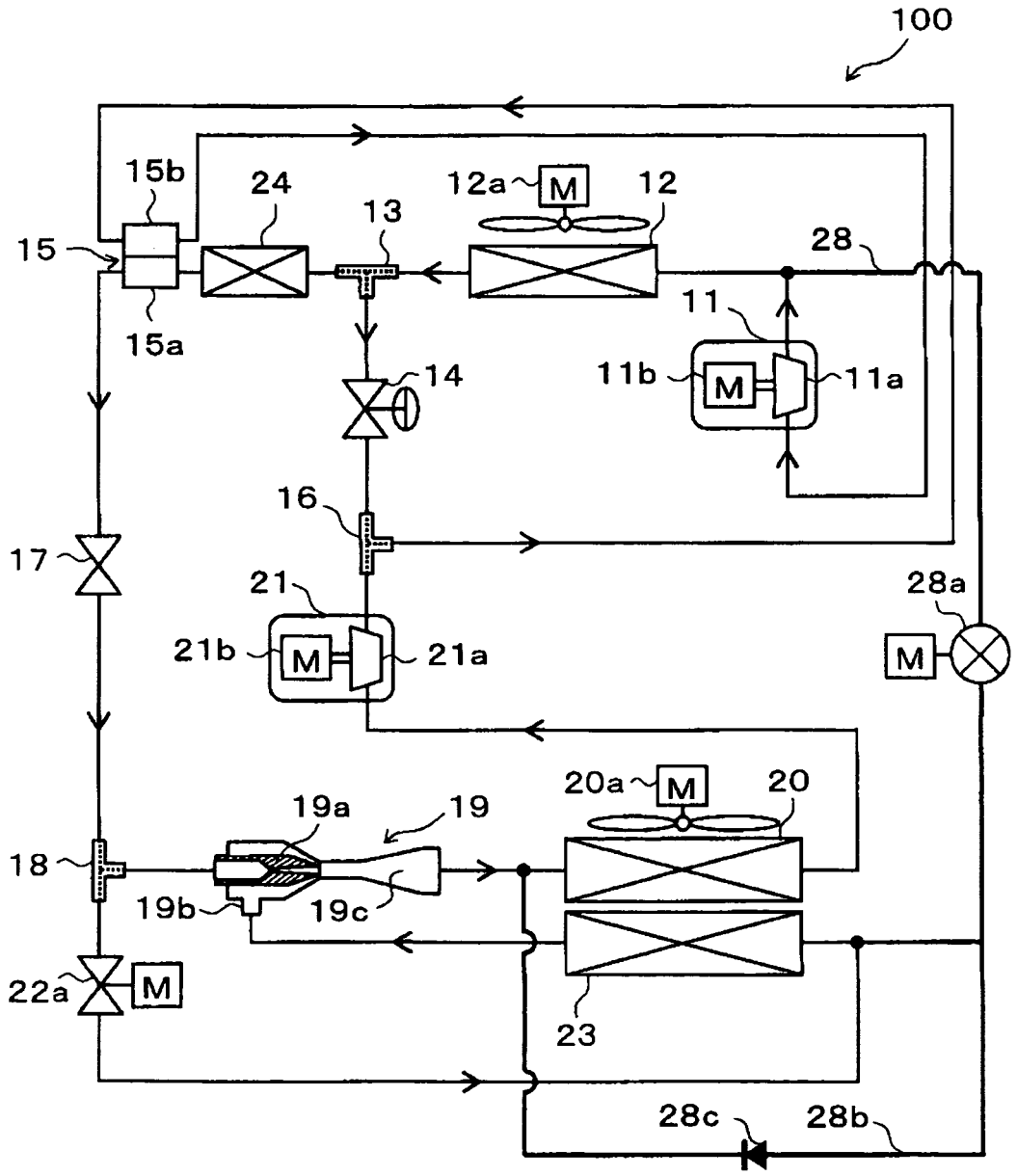
Figure 138A:
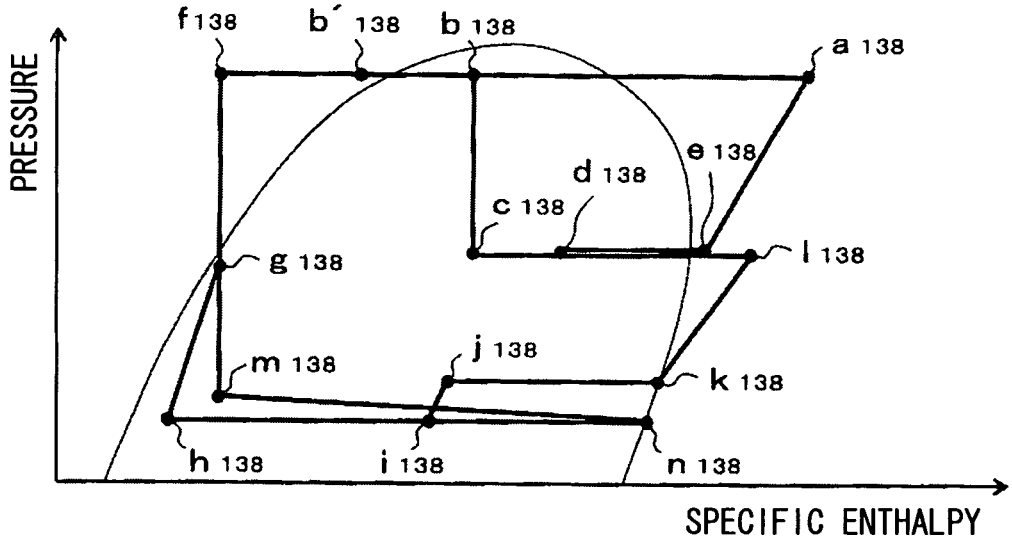
Figure 138B:
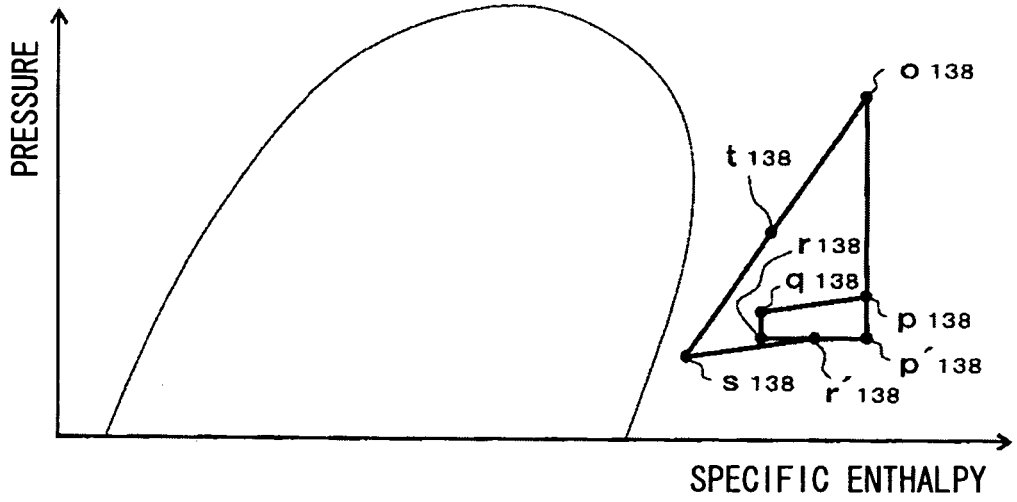
Figure 139:
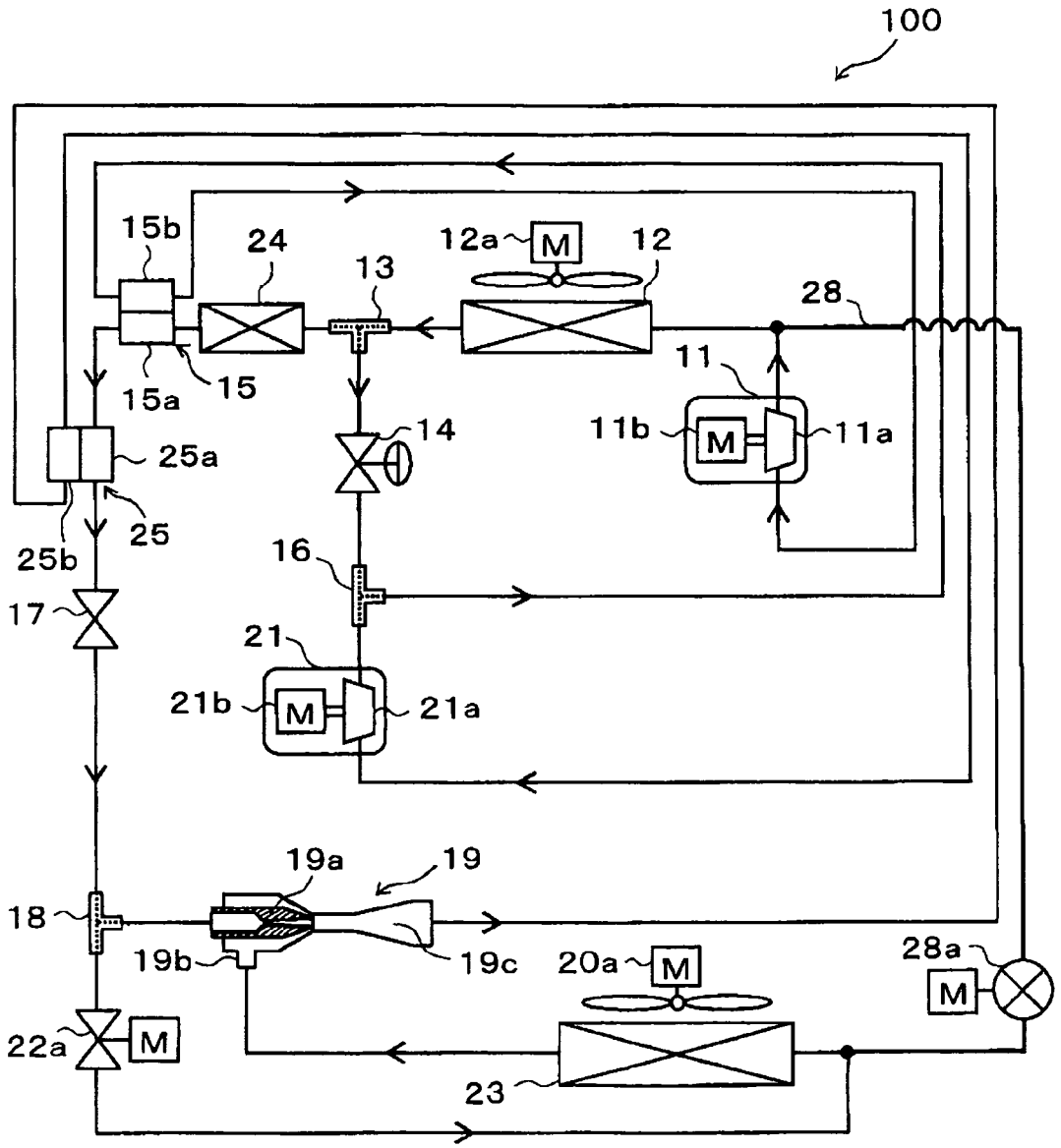
Figure 140A:
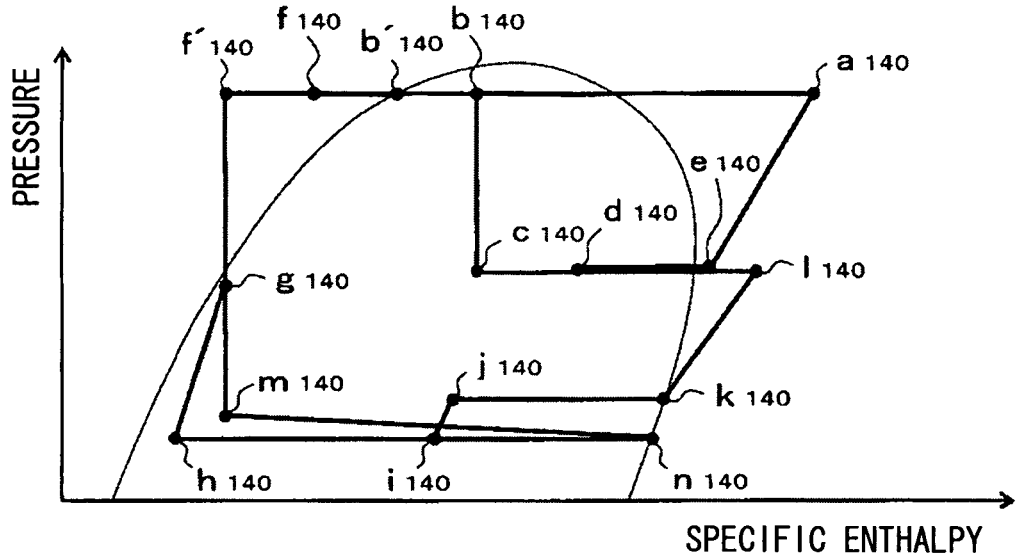
Figure 140B:
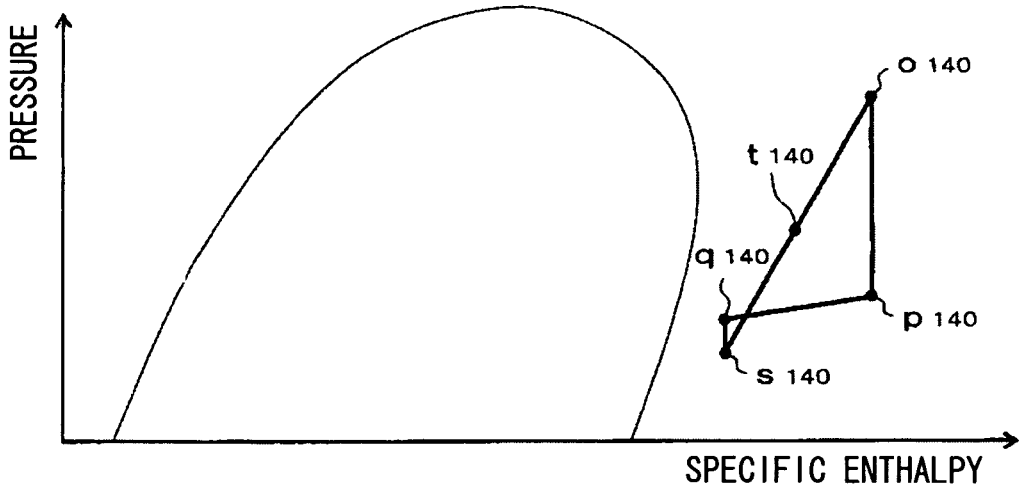
Figure 141:
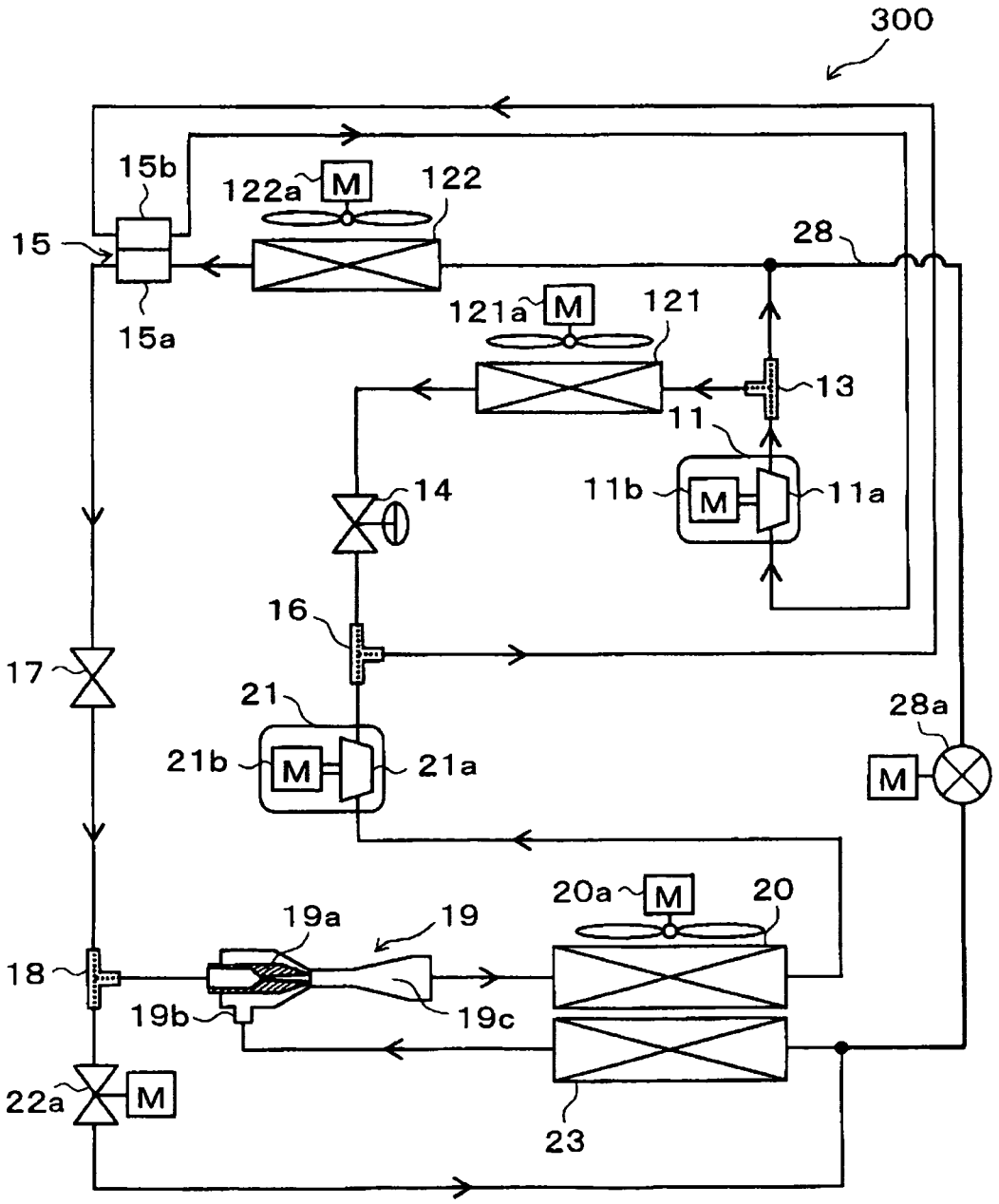
Figure 142A:
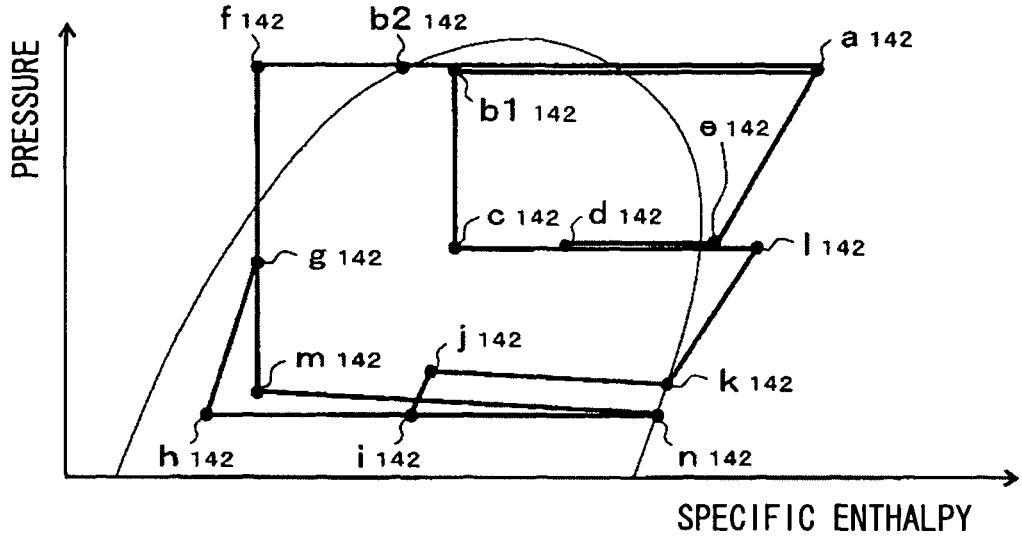
Figure 142B:
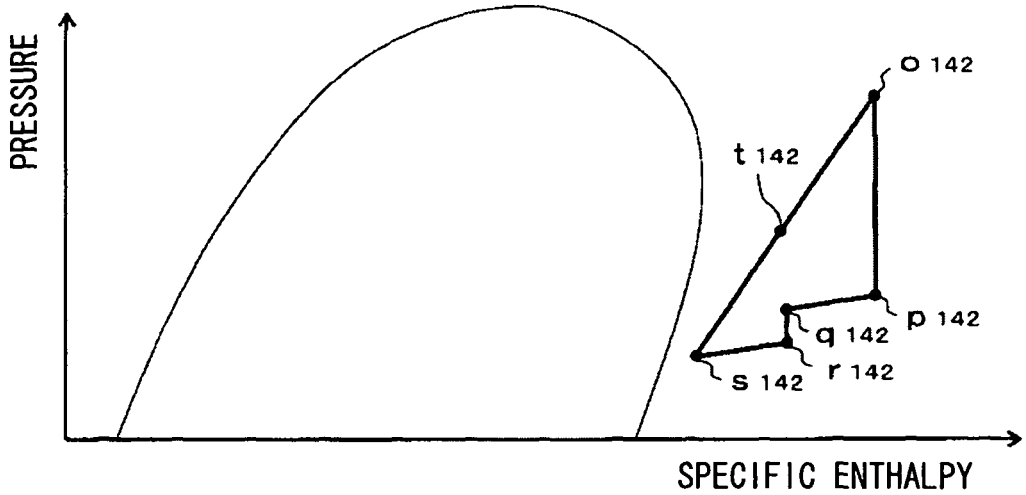
Figure 143:
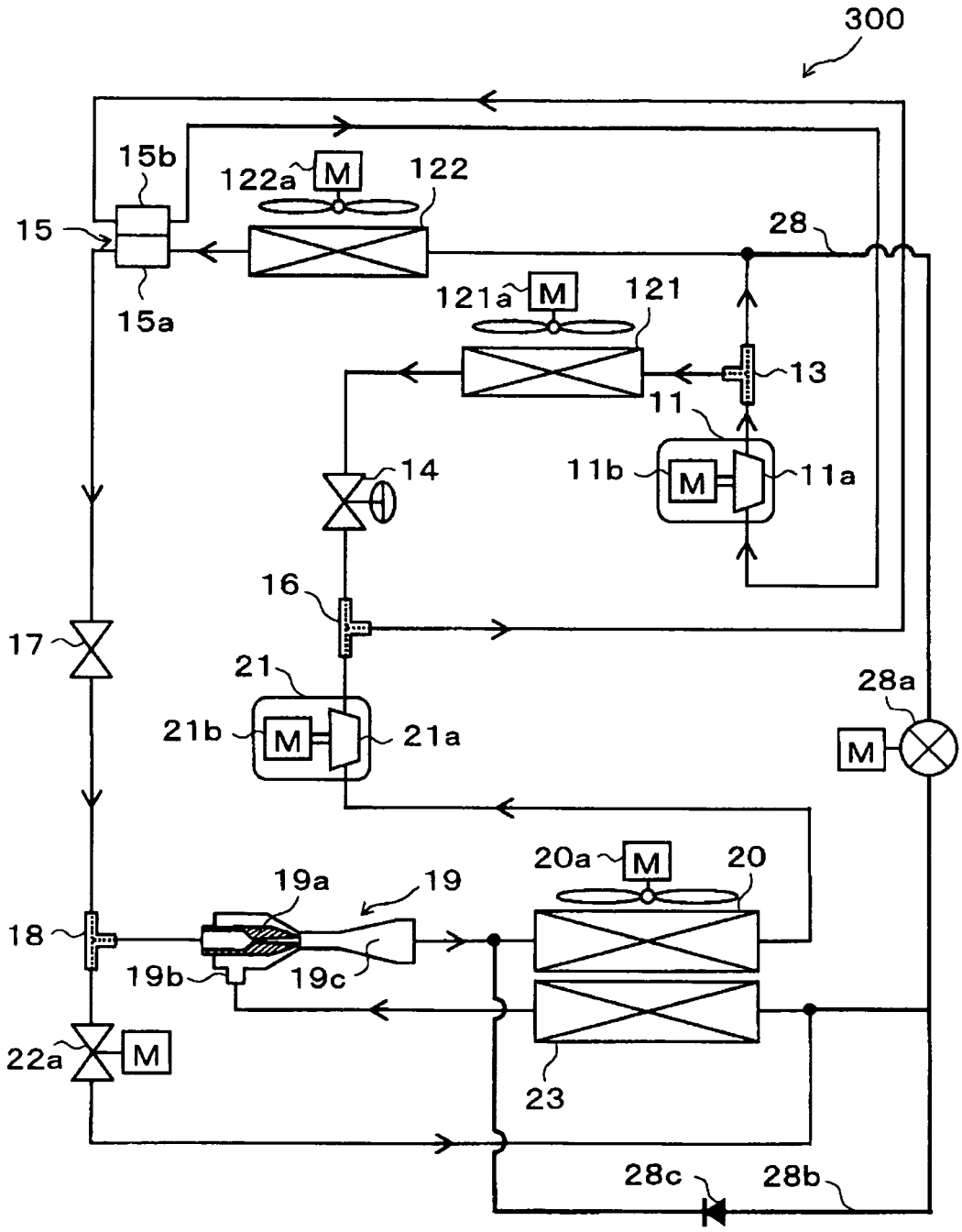
Figure 144A:
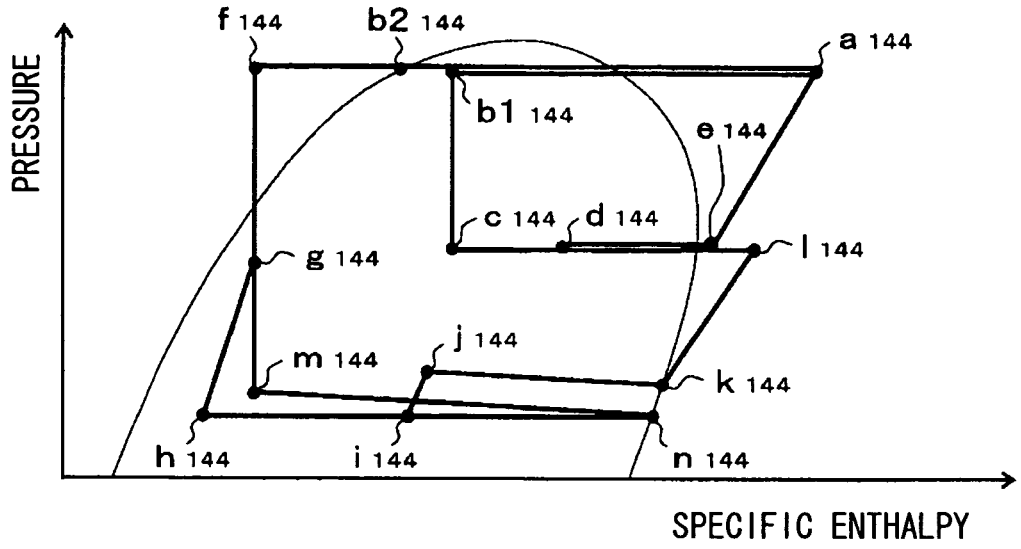
Figure 144B:
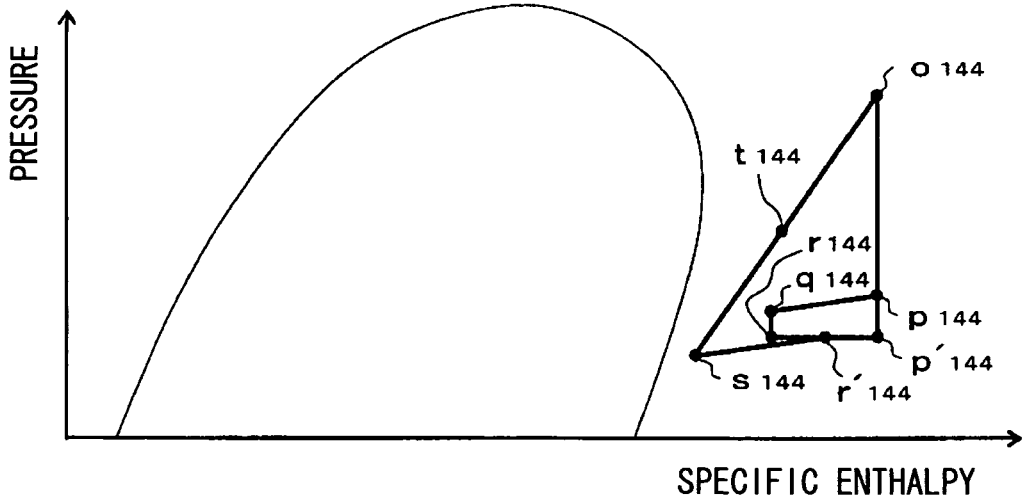
Figure 145:
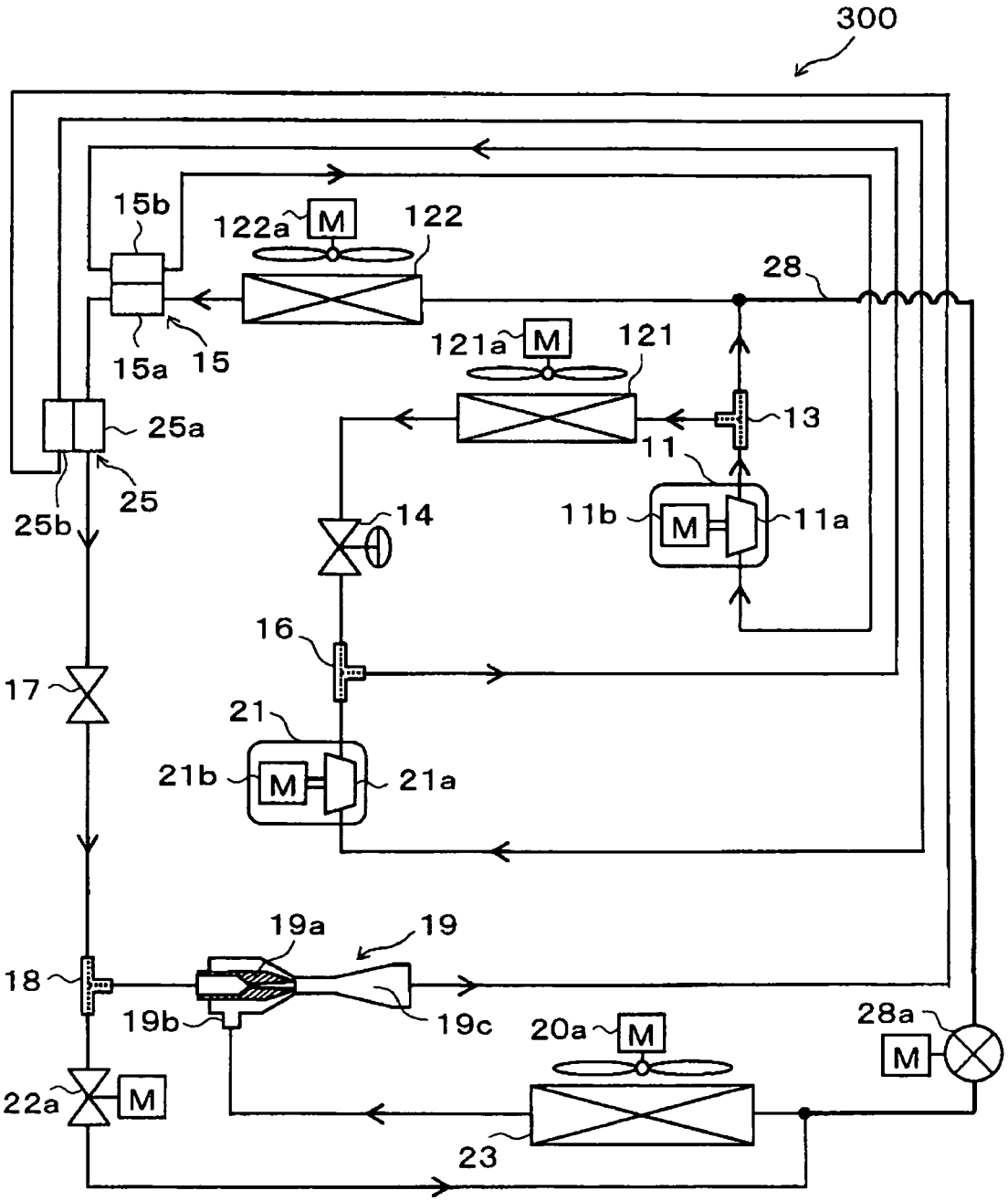
Figure 146A:
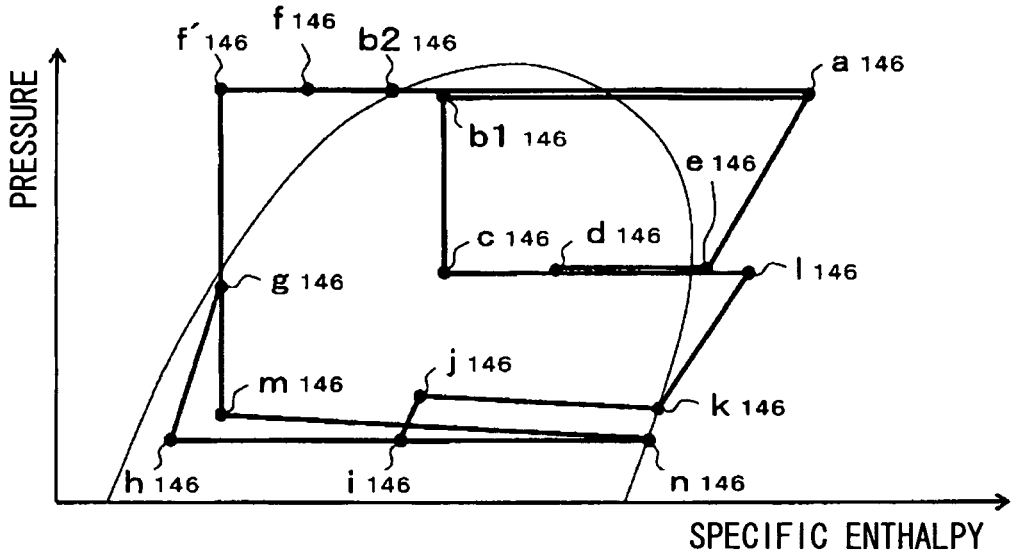
Figure 146B:
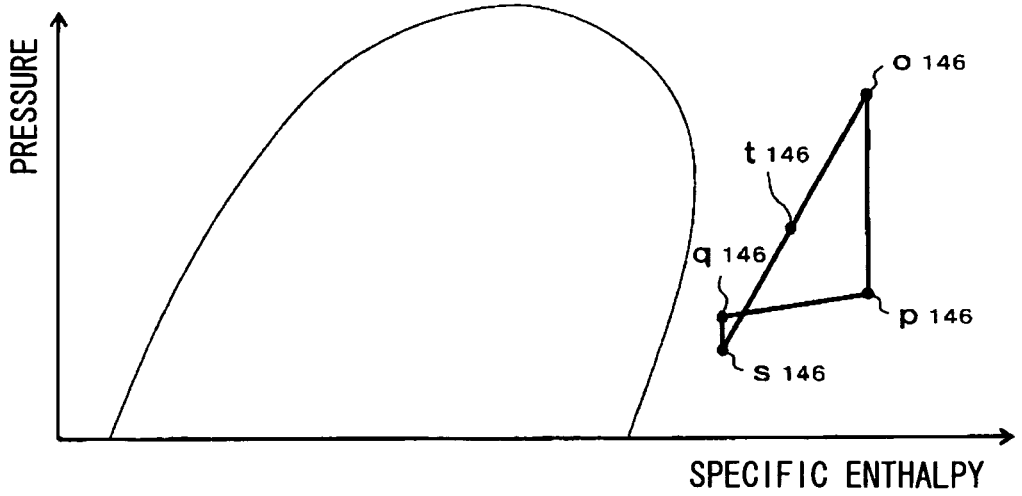
Figure 147:
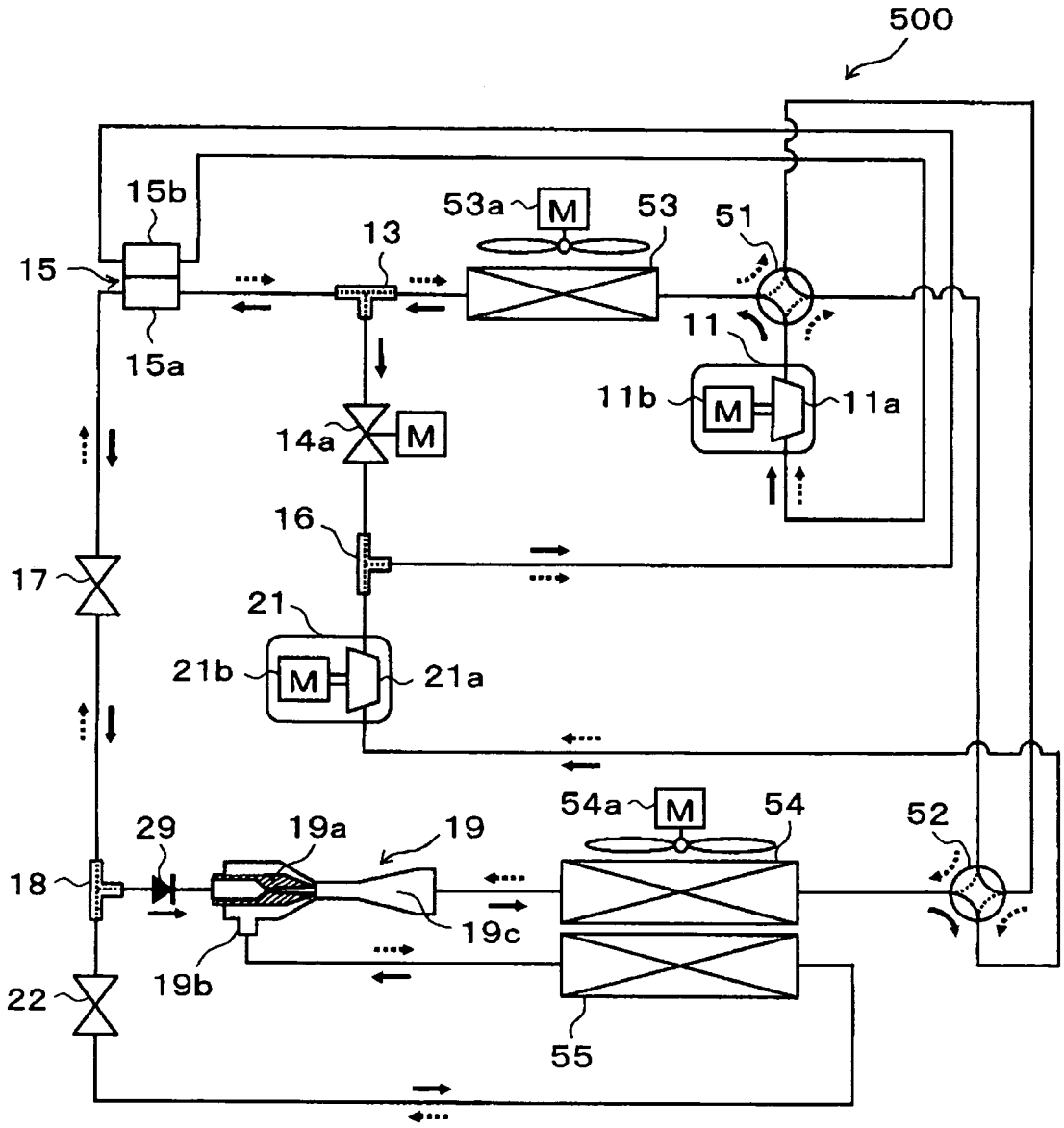
Figure 148A:
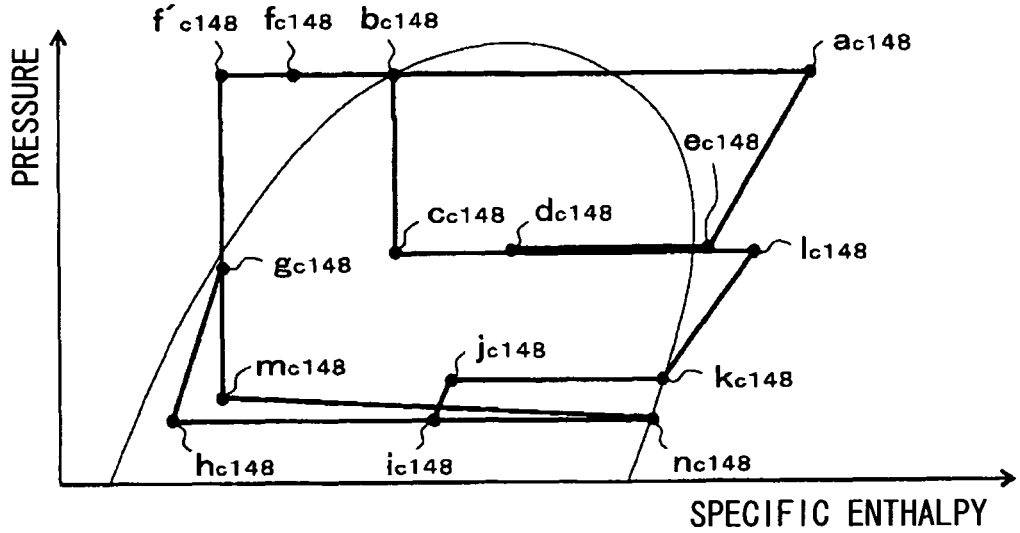
Figure 148B:
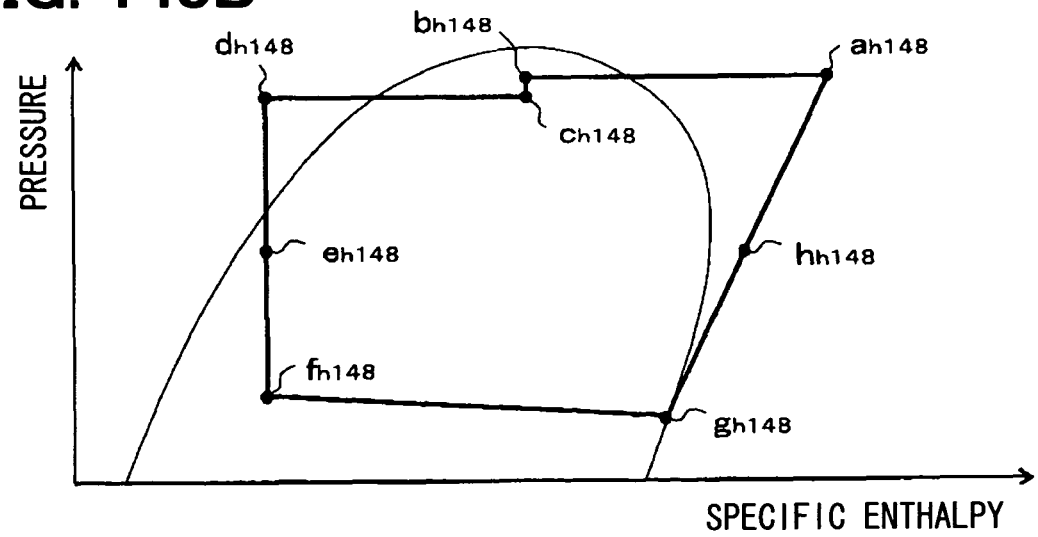
Figure 149:
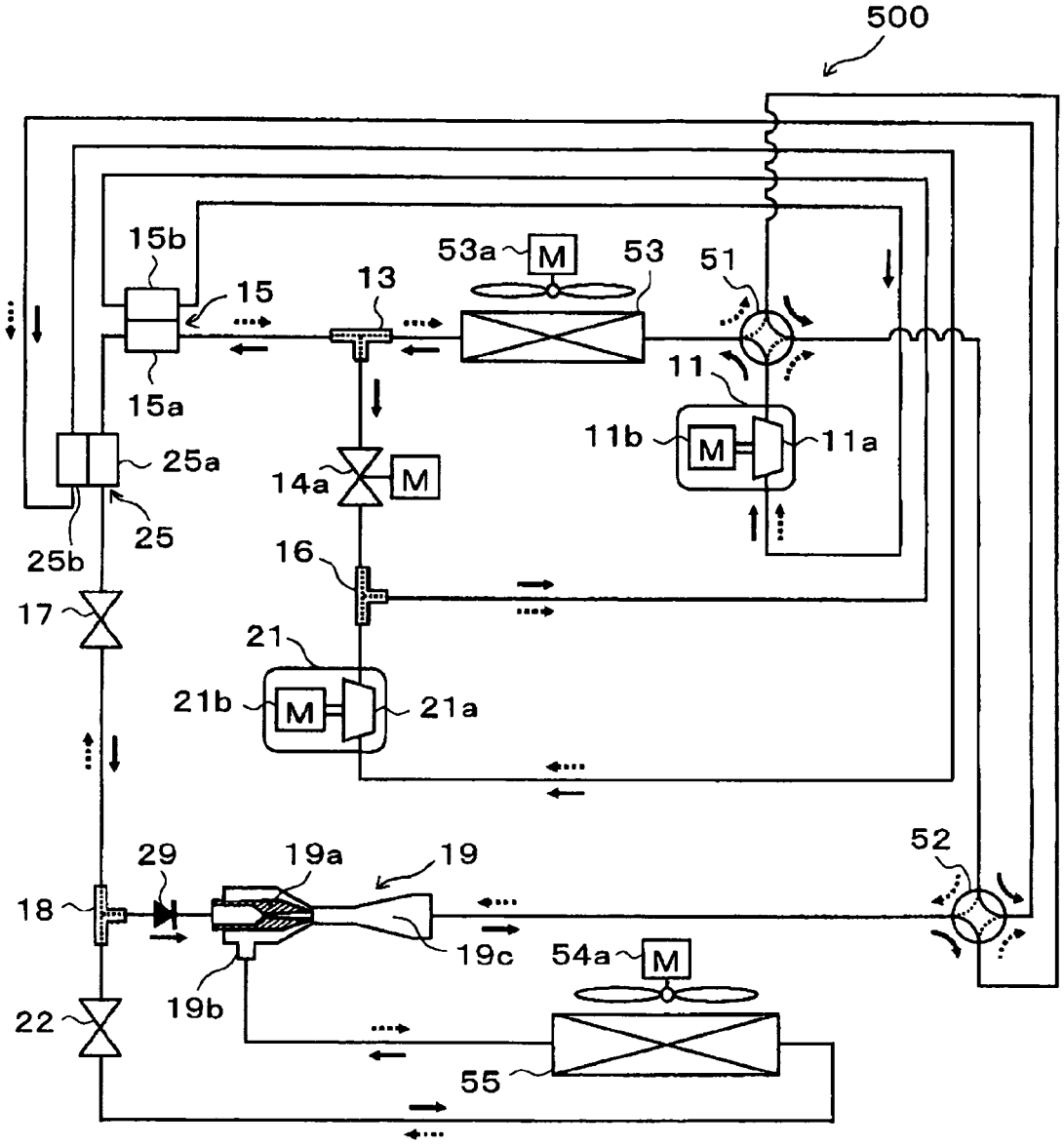
Figure 150A:
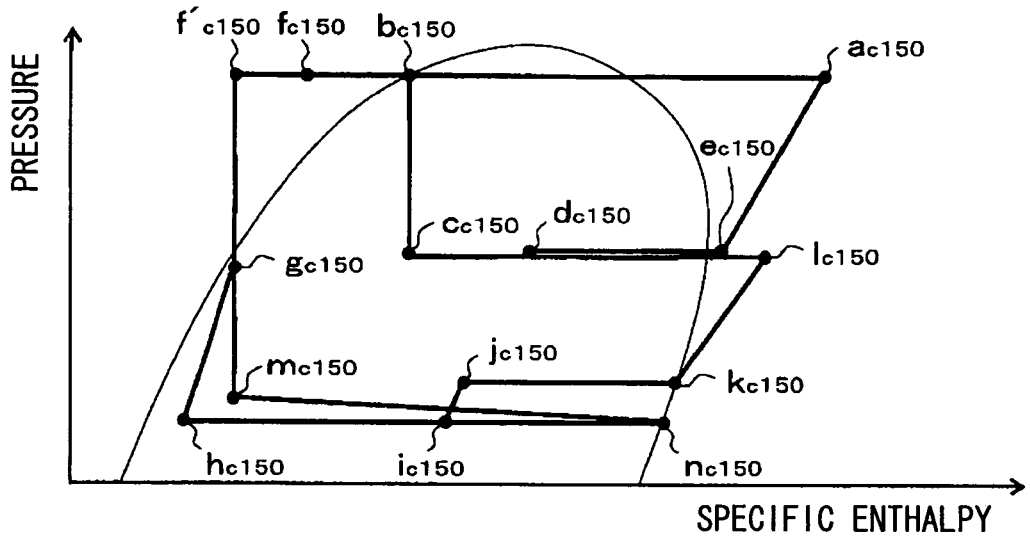
Figure 150B:
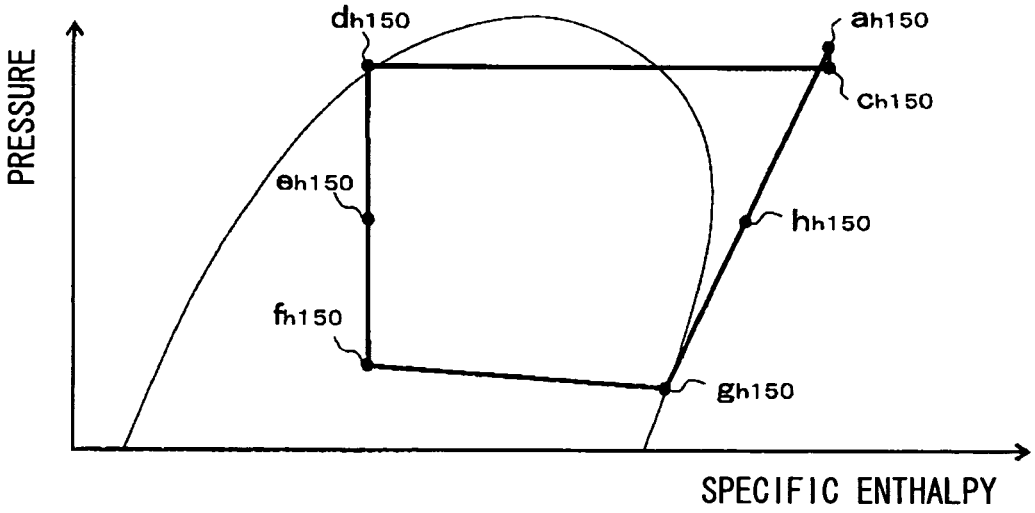
Figure 151:
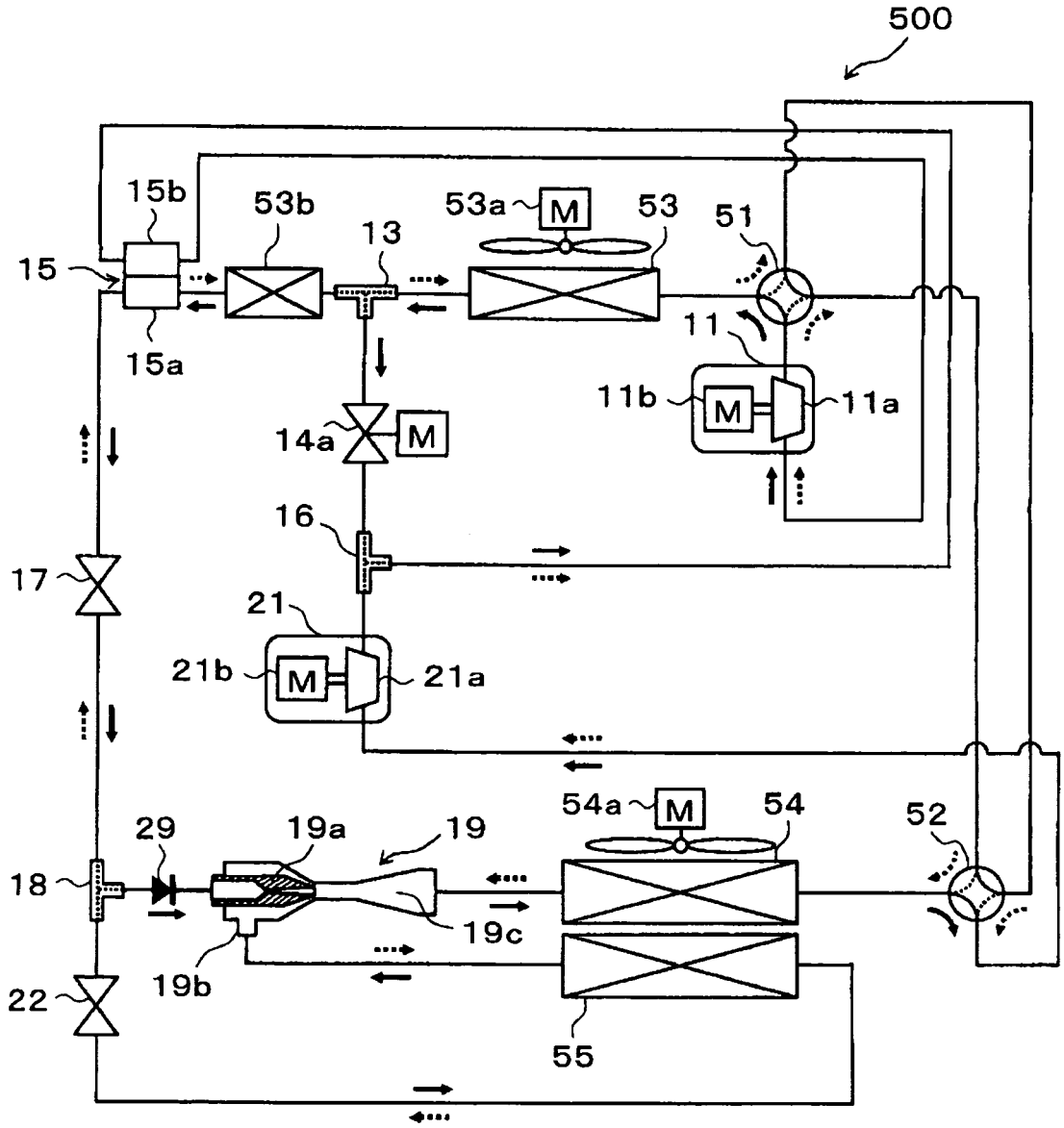
Figure 152A:
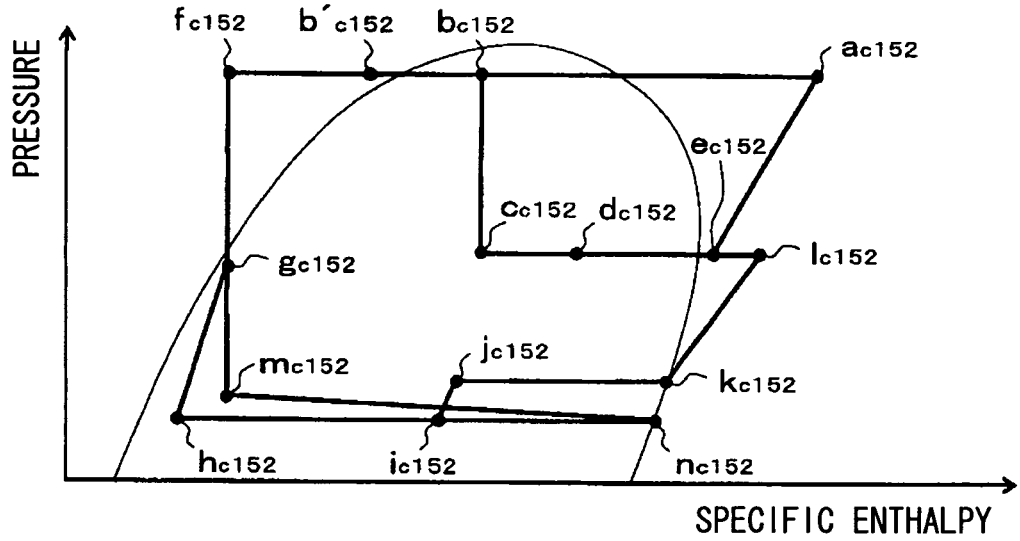
Figure 152B:
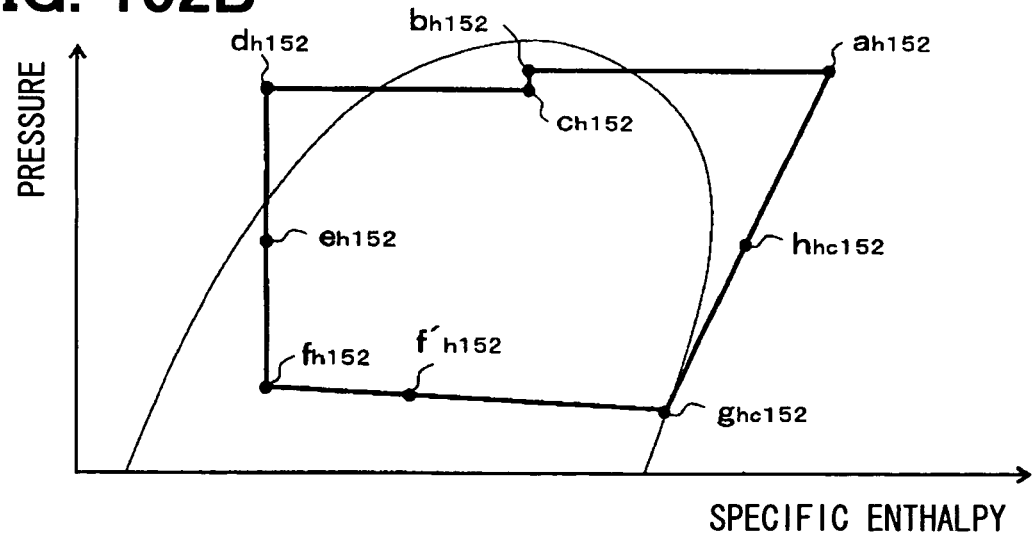
Figure 153:
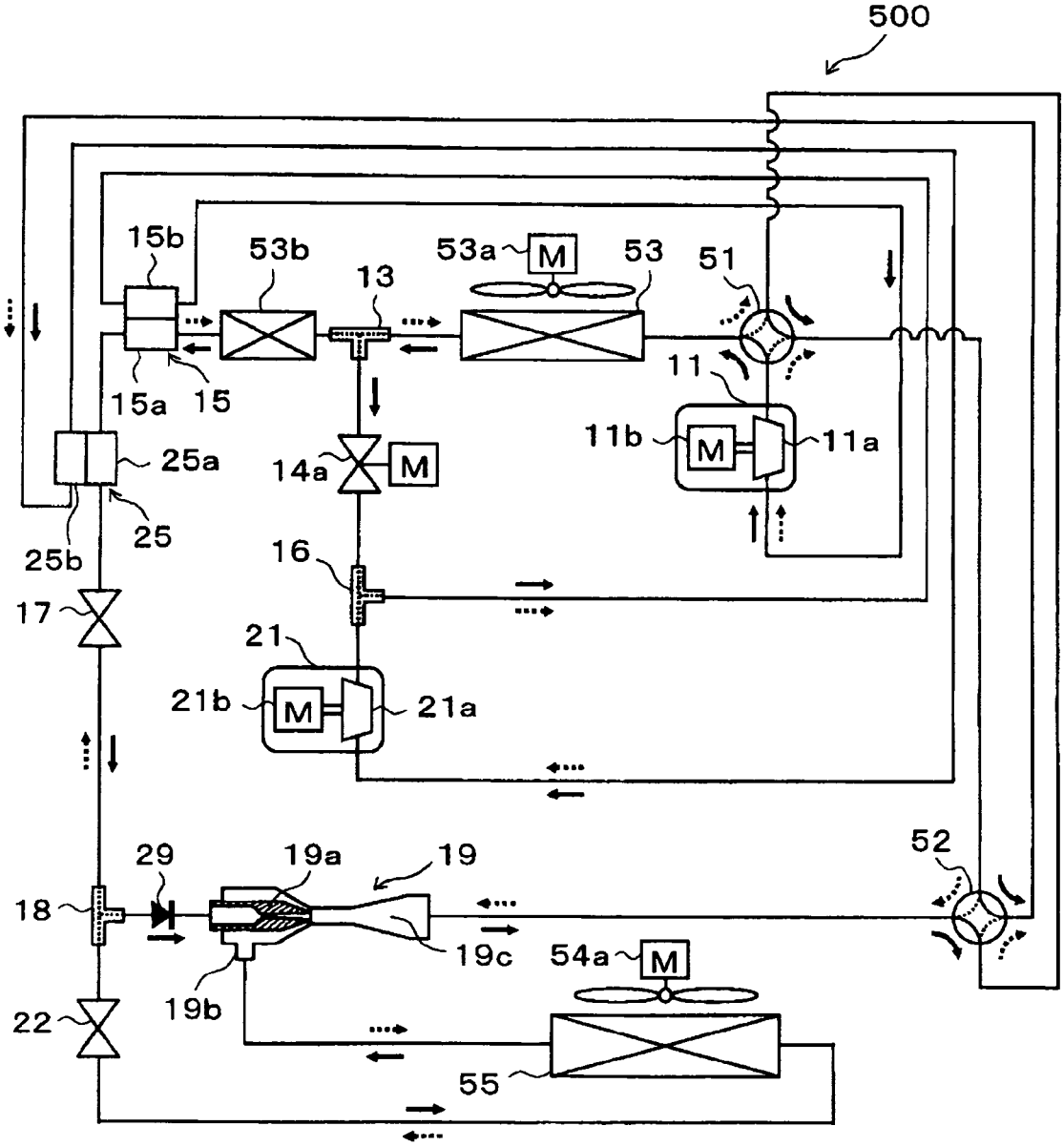
Figure 154A:
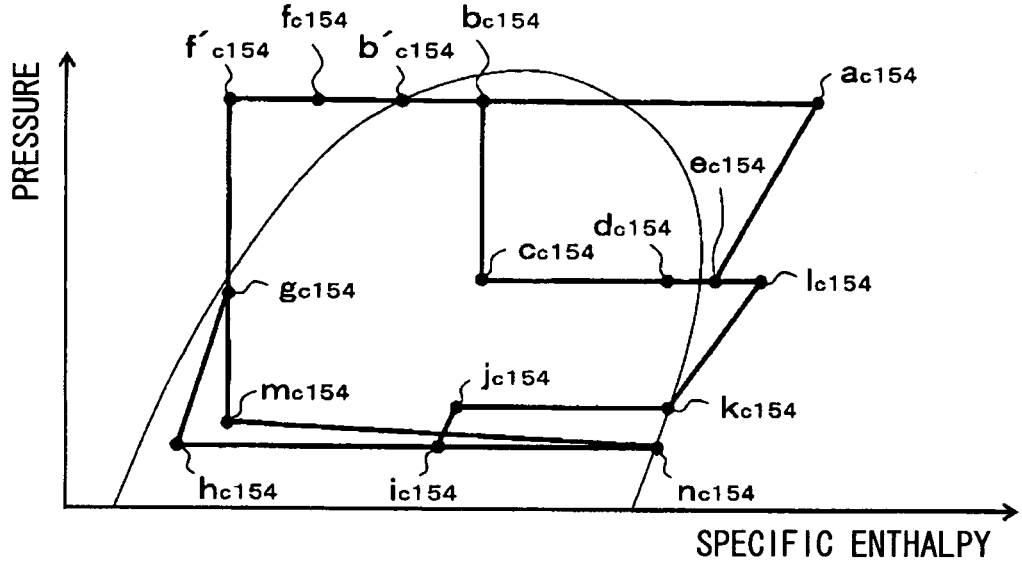
Figure 154B:
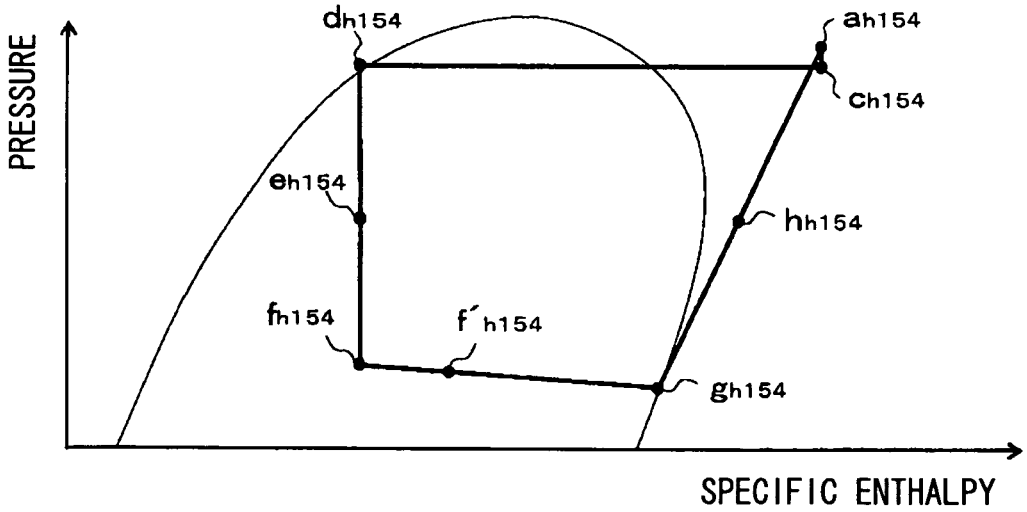
Figure 155:
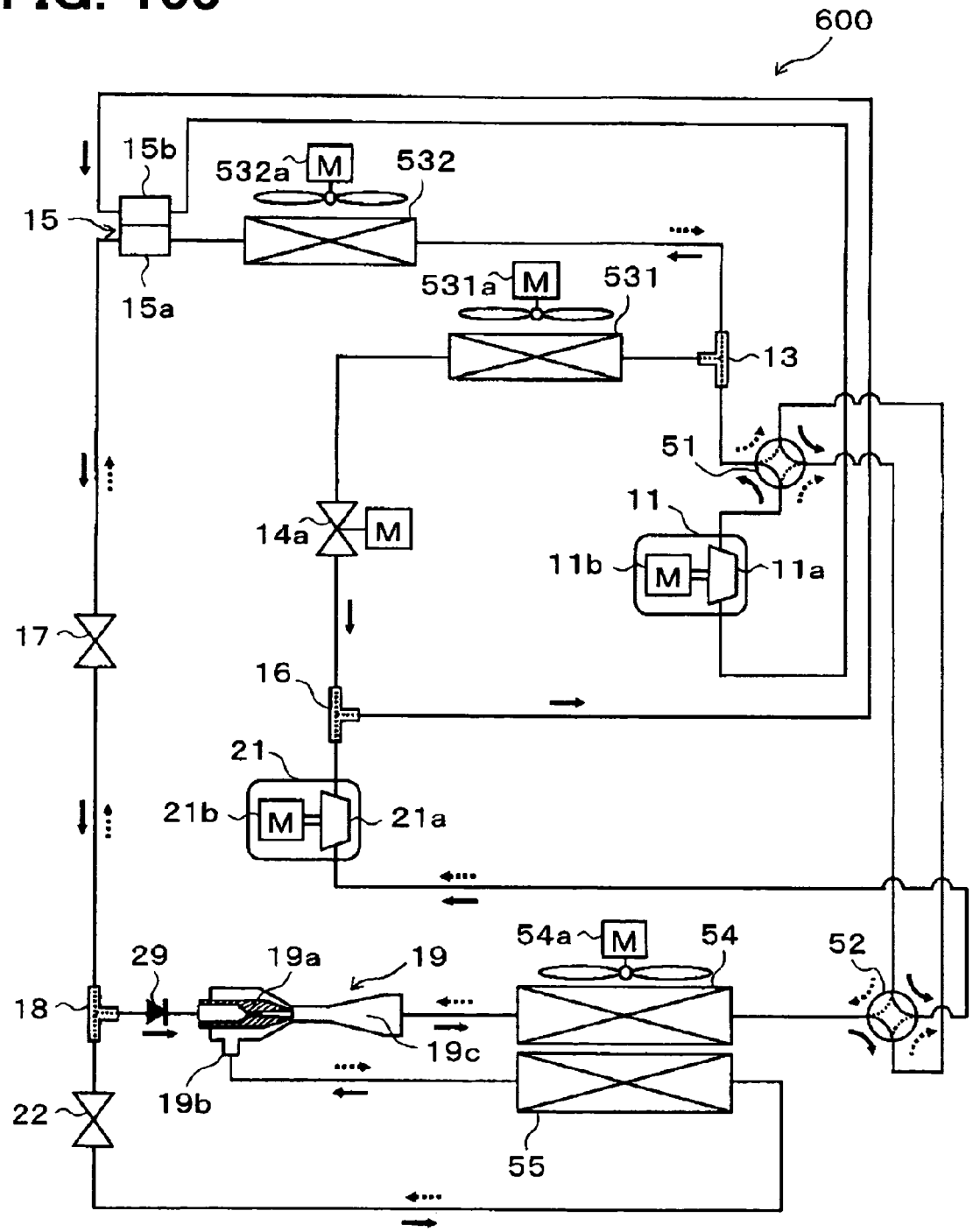
Figure 156A:
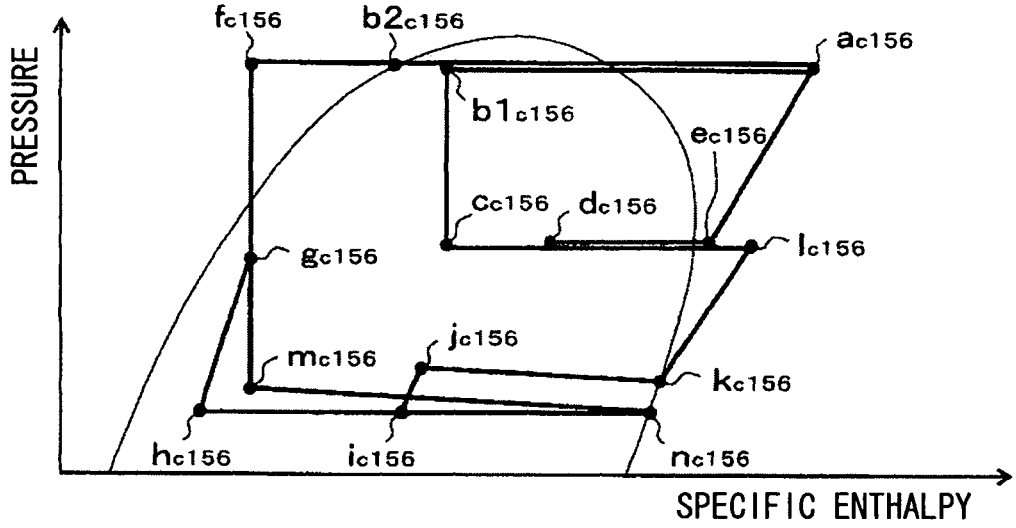
Figure 156B:
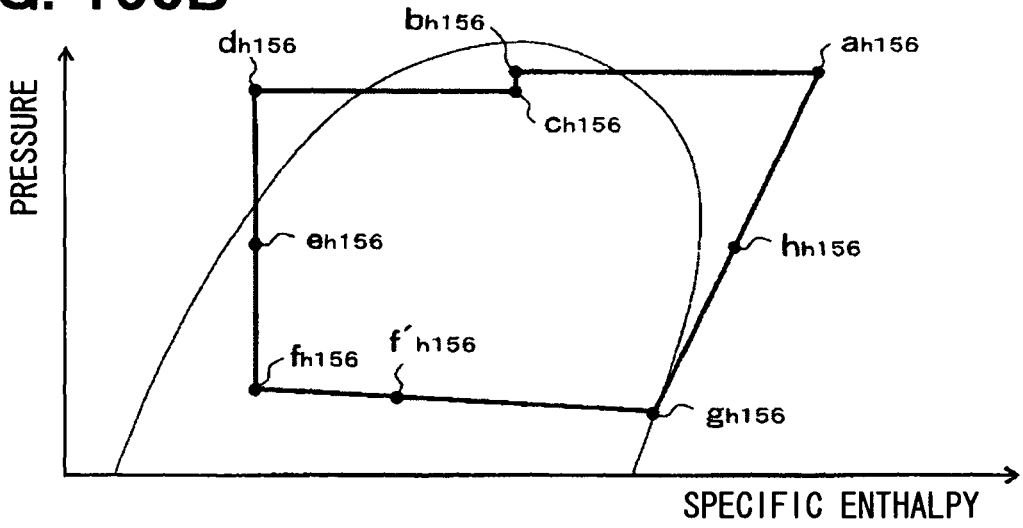
Figure 157:
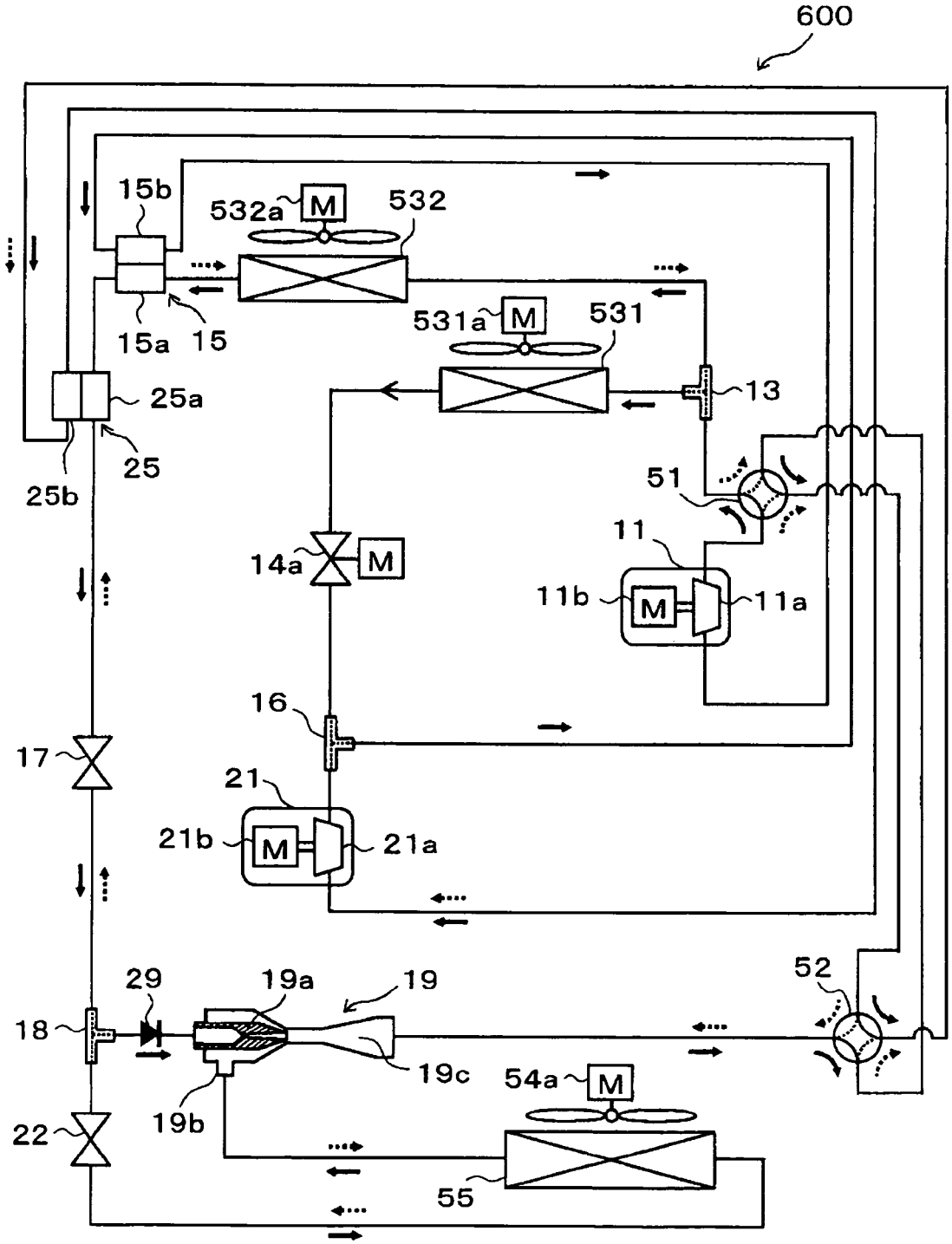
Figure 158A:
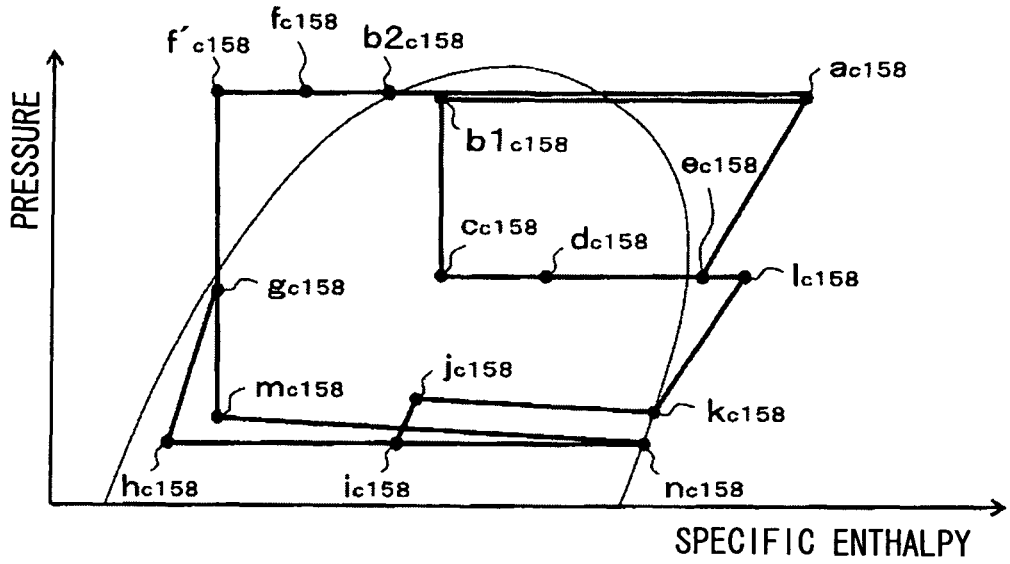
Figure 158B:
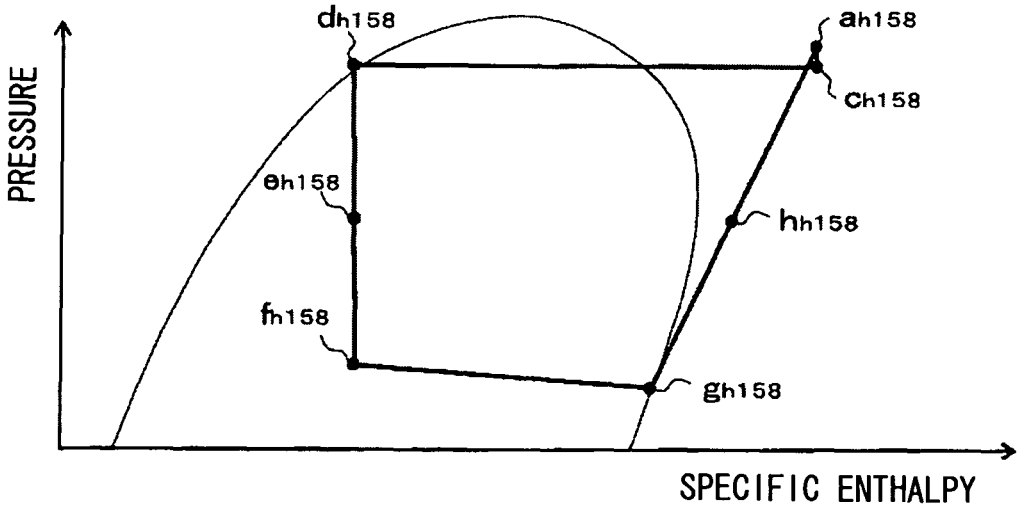
Figure 159:
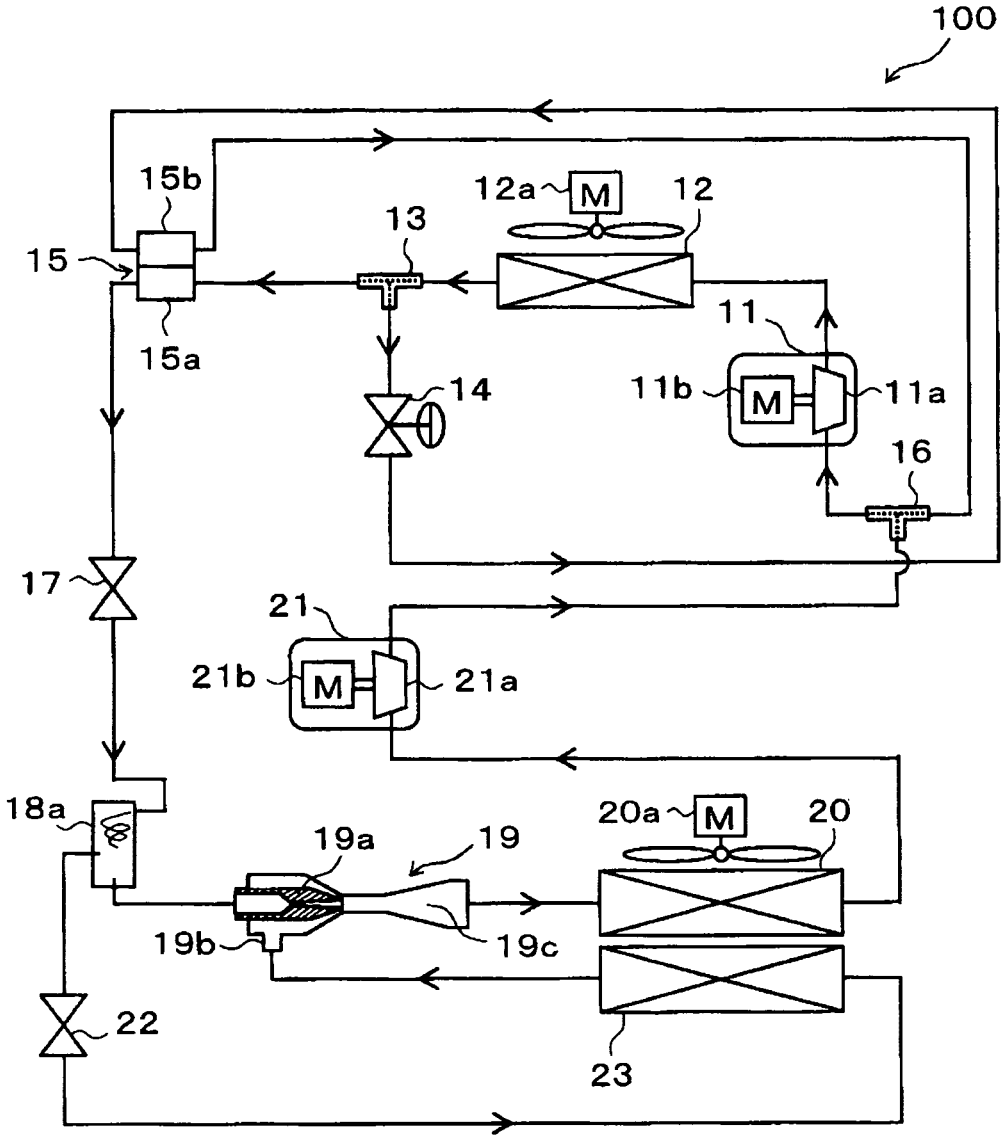
Figure 160:
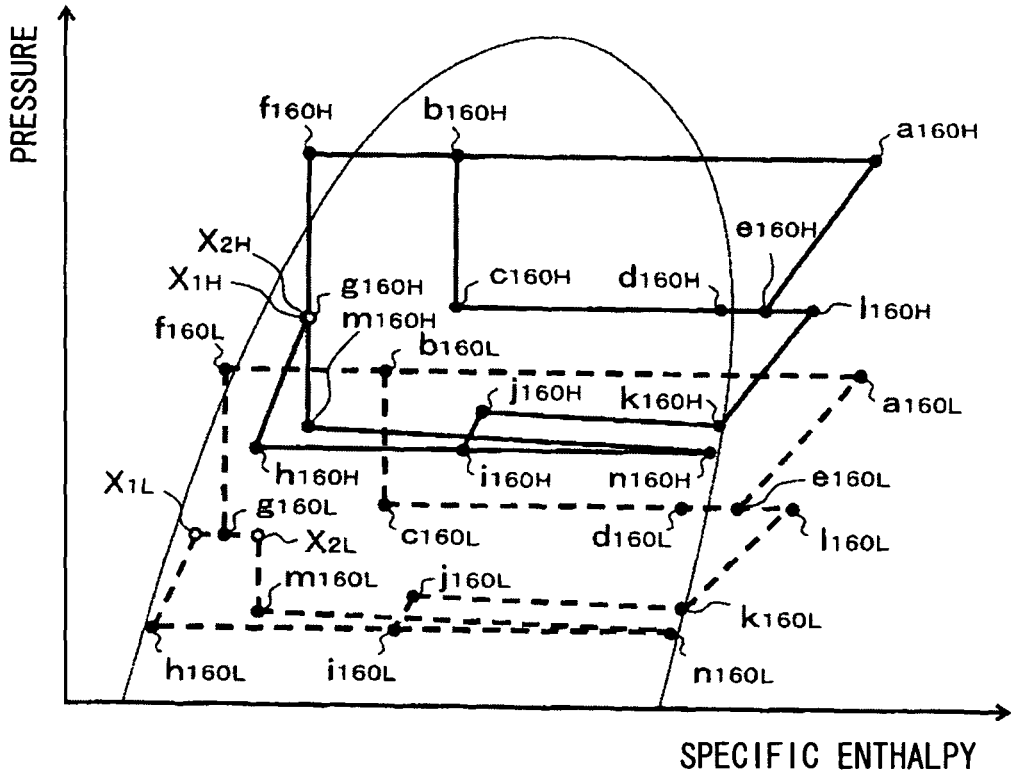
Figure 161:
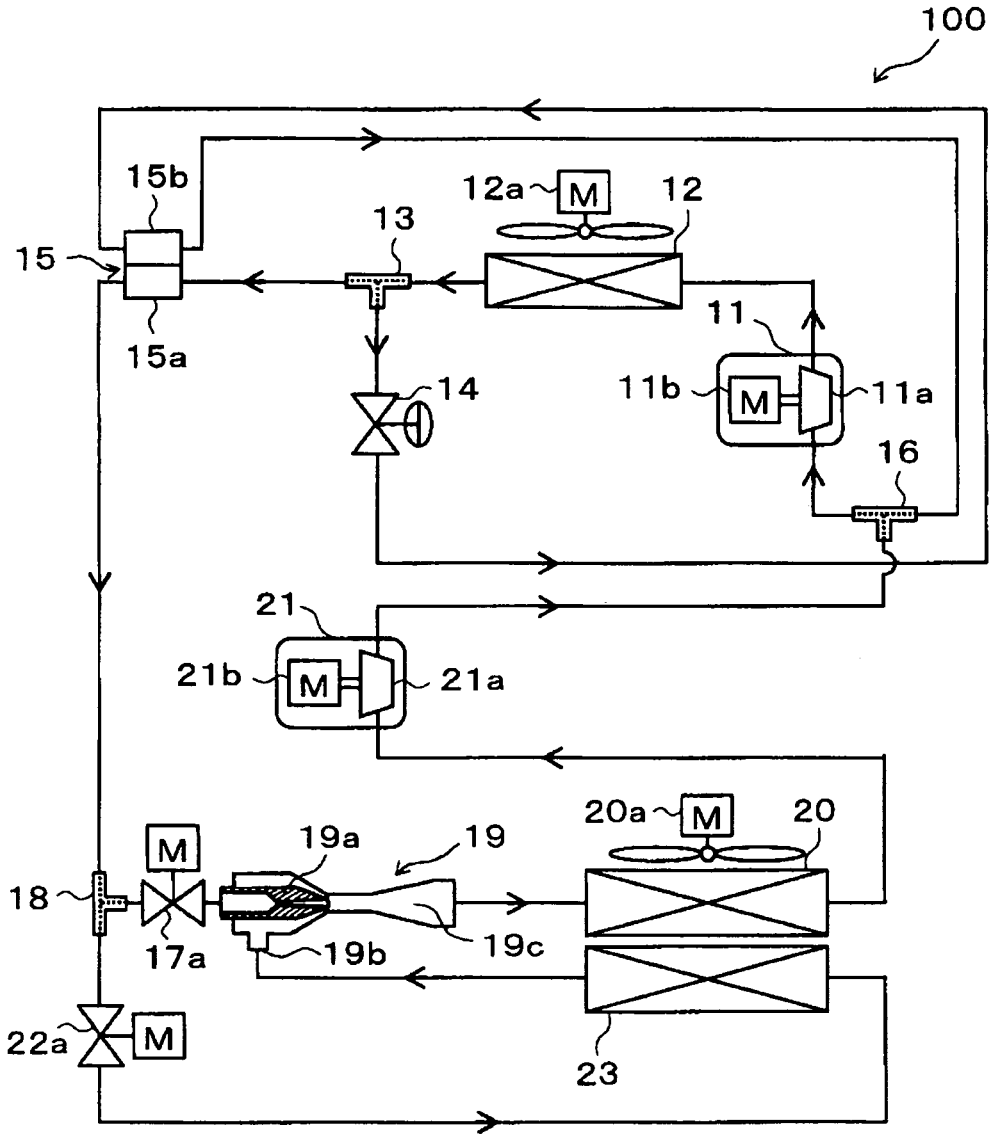
Figure 162:
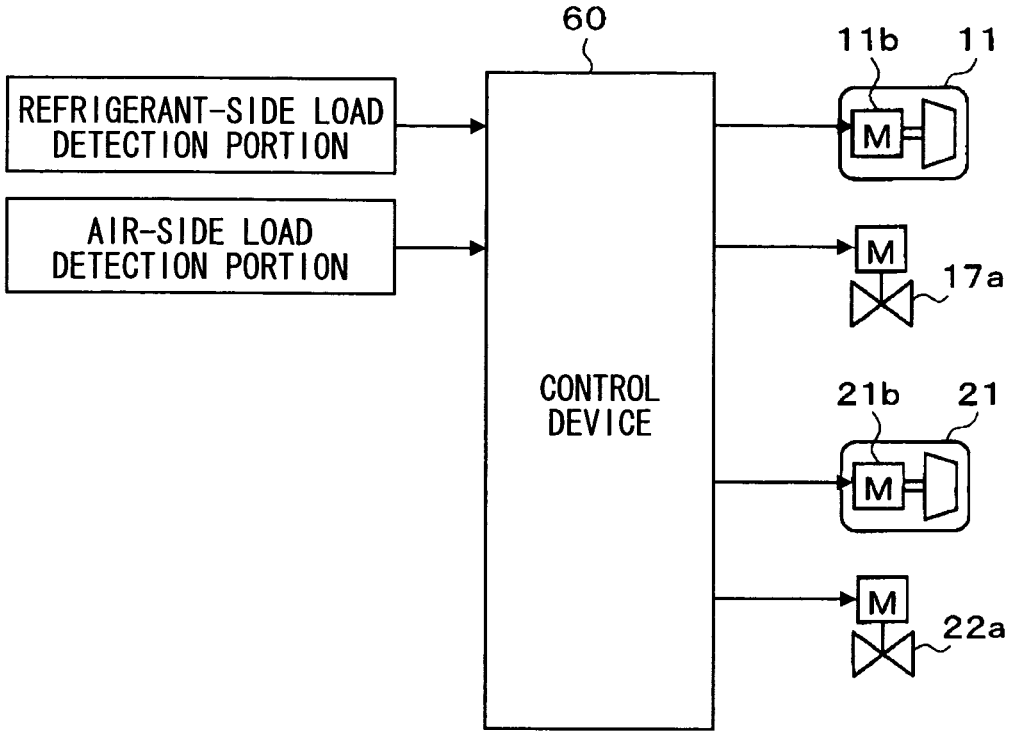
Figure 163A:
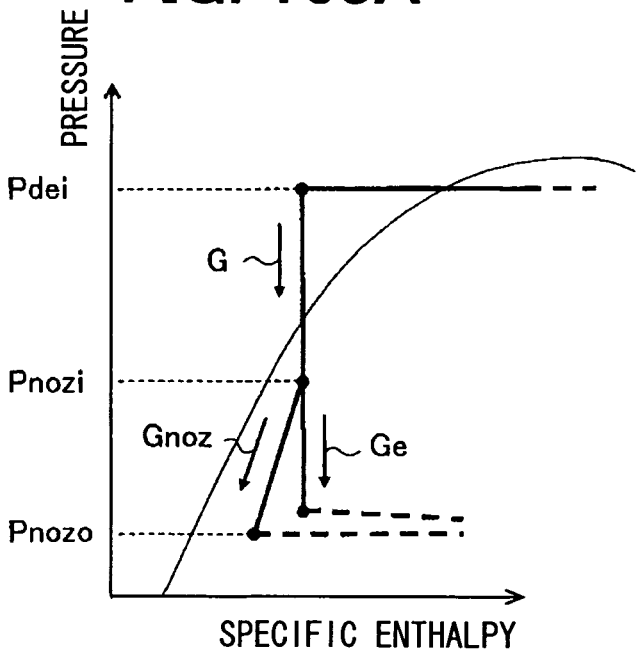
Figure 163B:
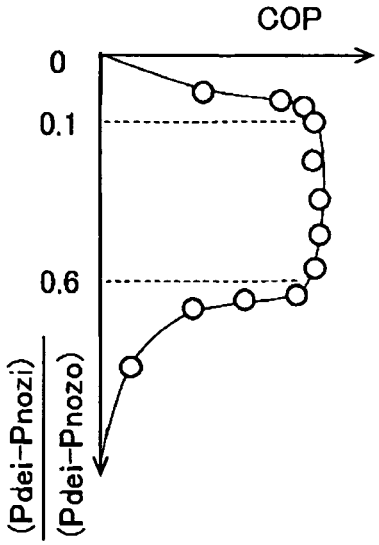
Figure 164:
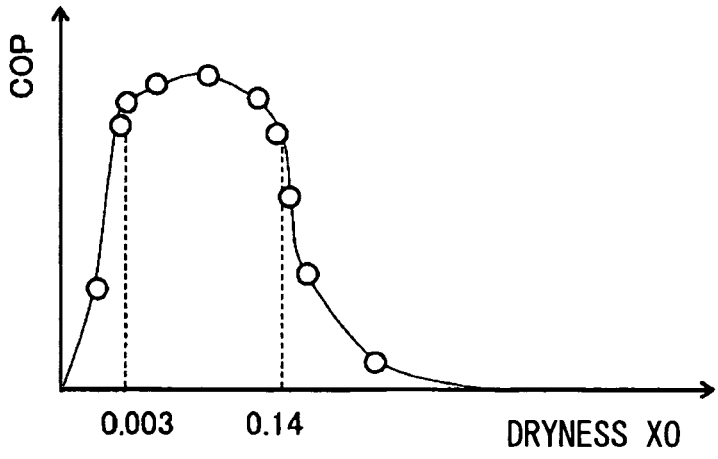
Figure 165:
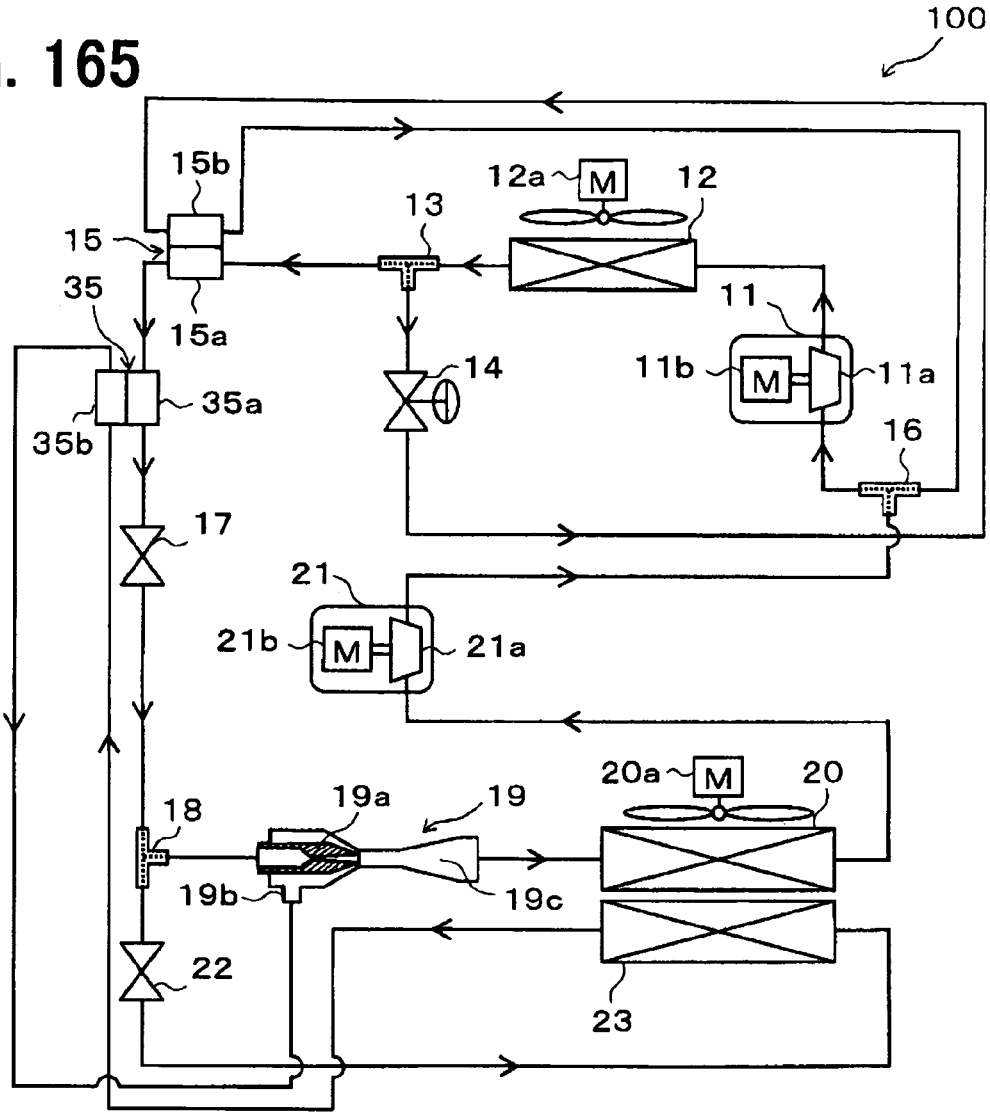
Figure 166:
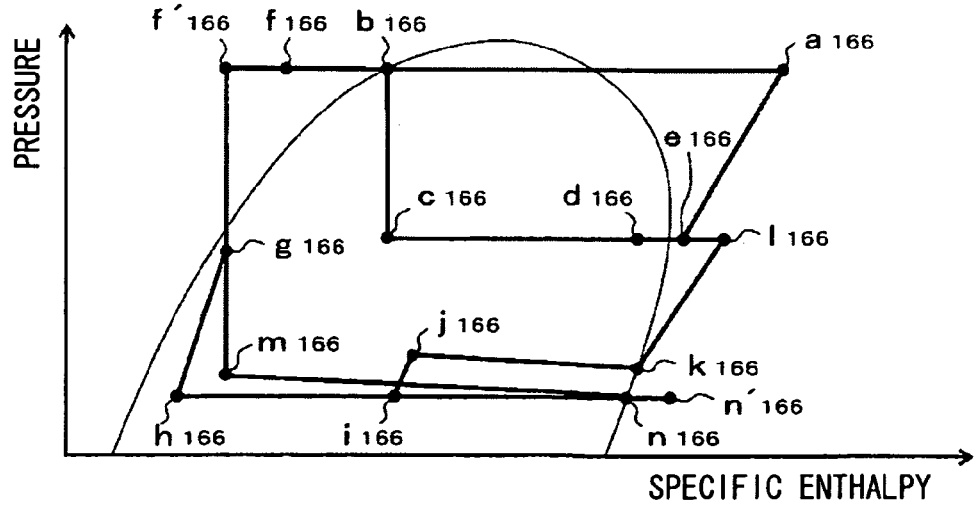
Figure 167:
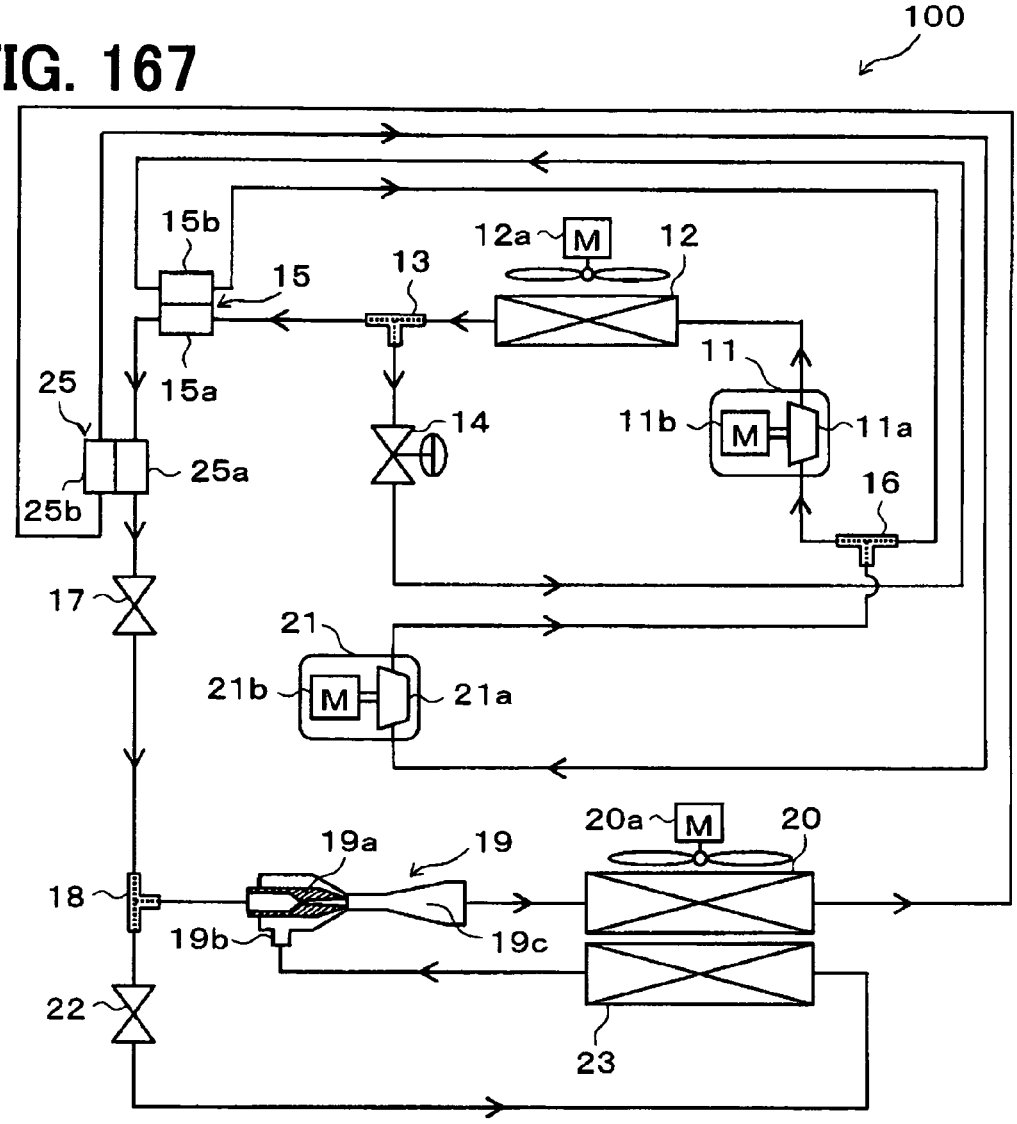
Figure 168:
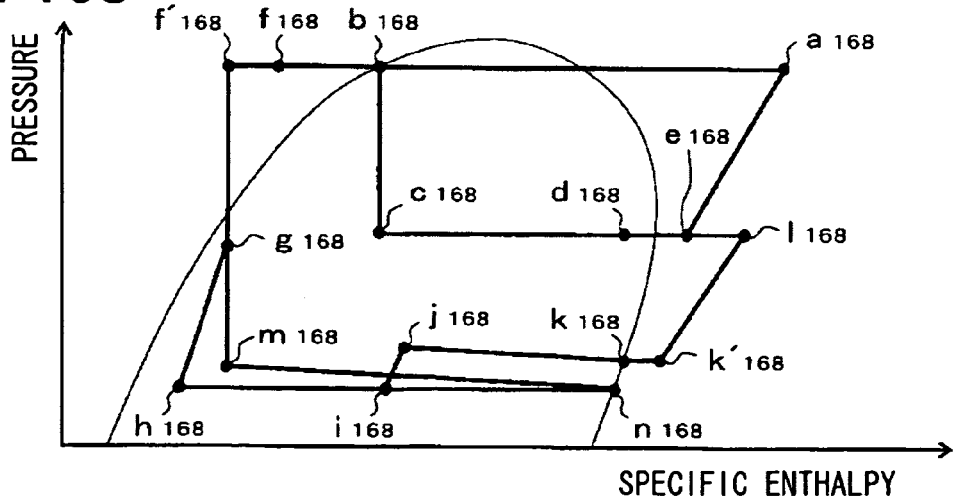
Figure 169:
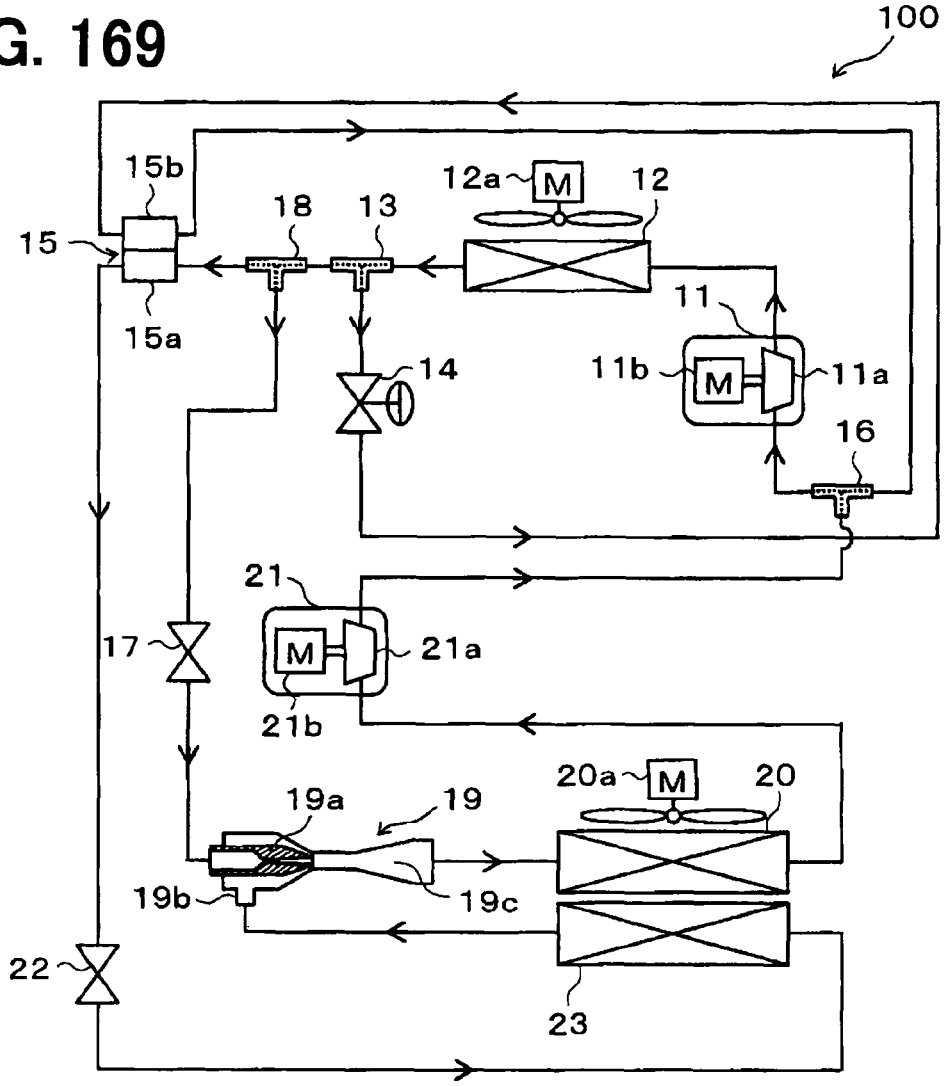
Figure 170:
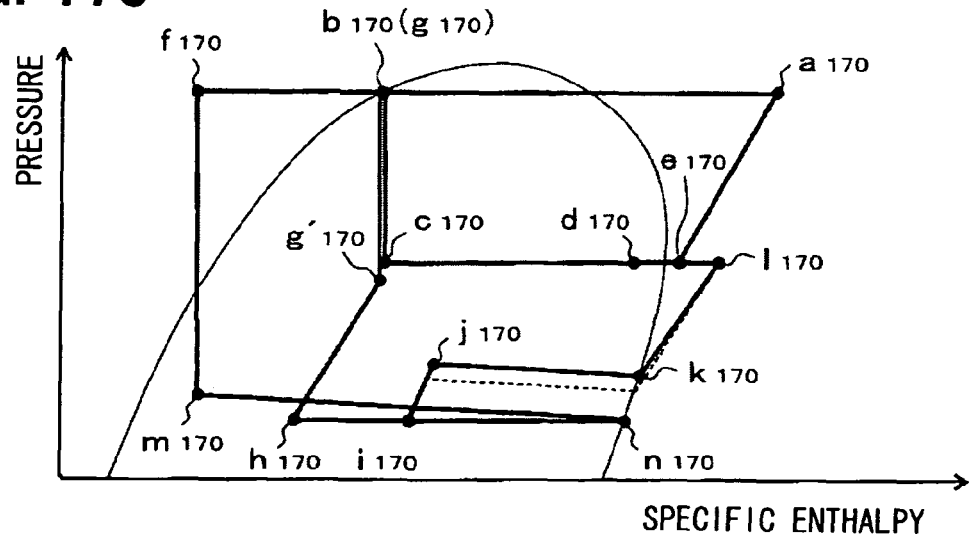
Figure 171:
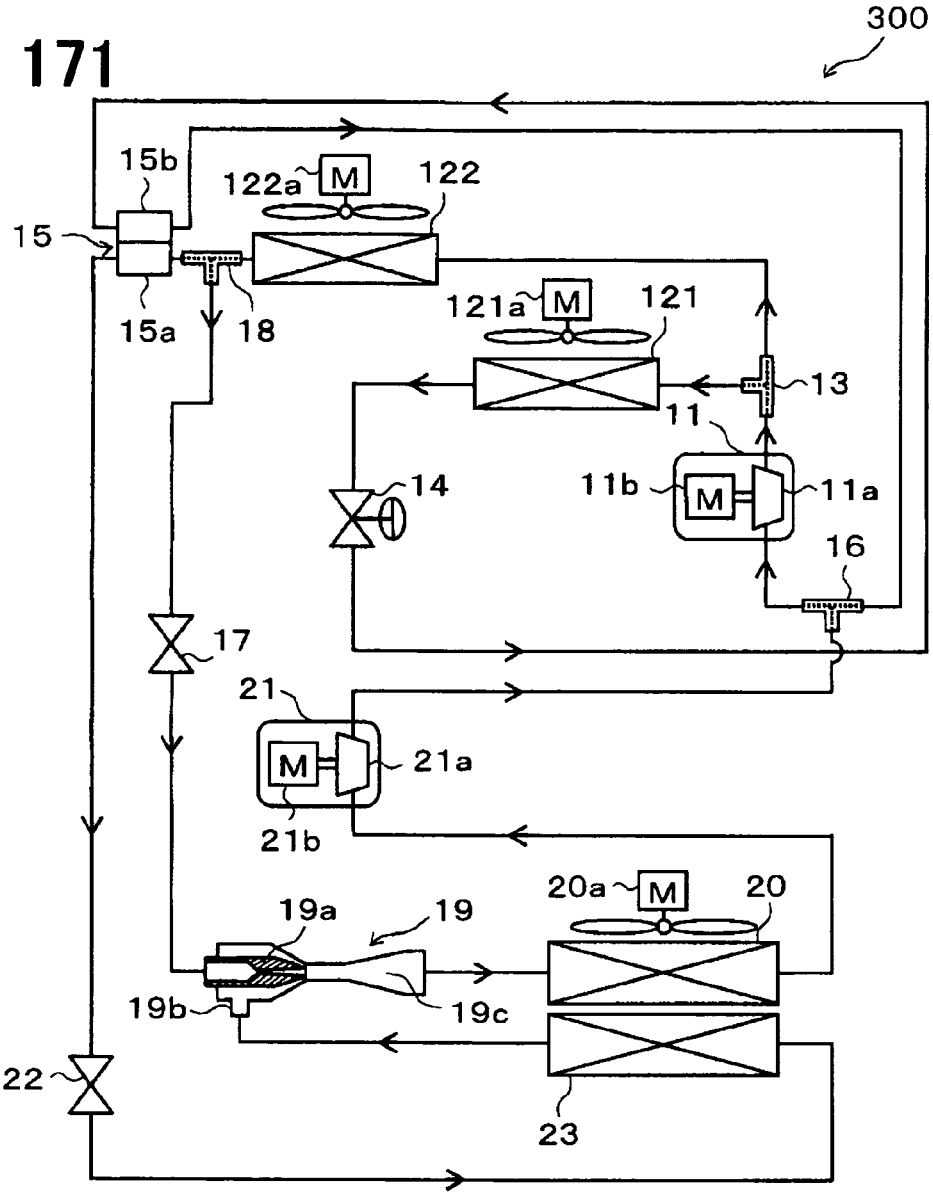
Figure 172:
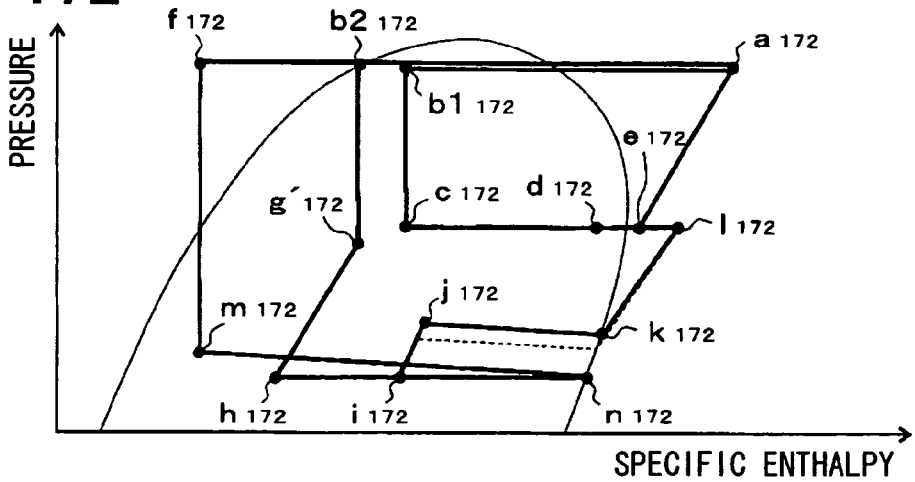
Figure 173:
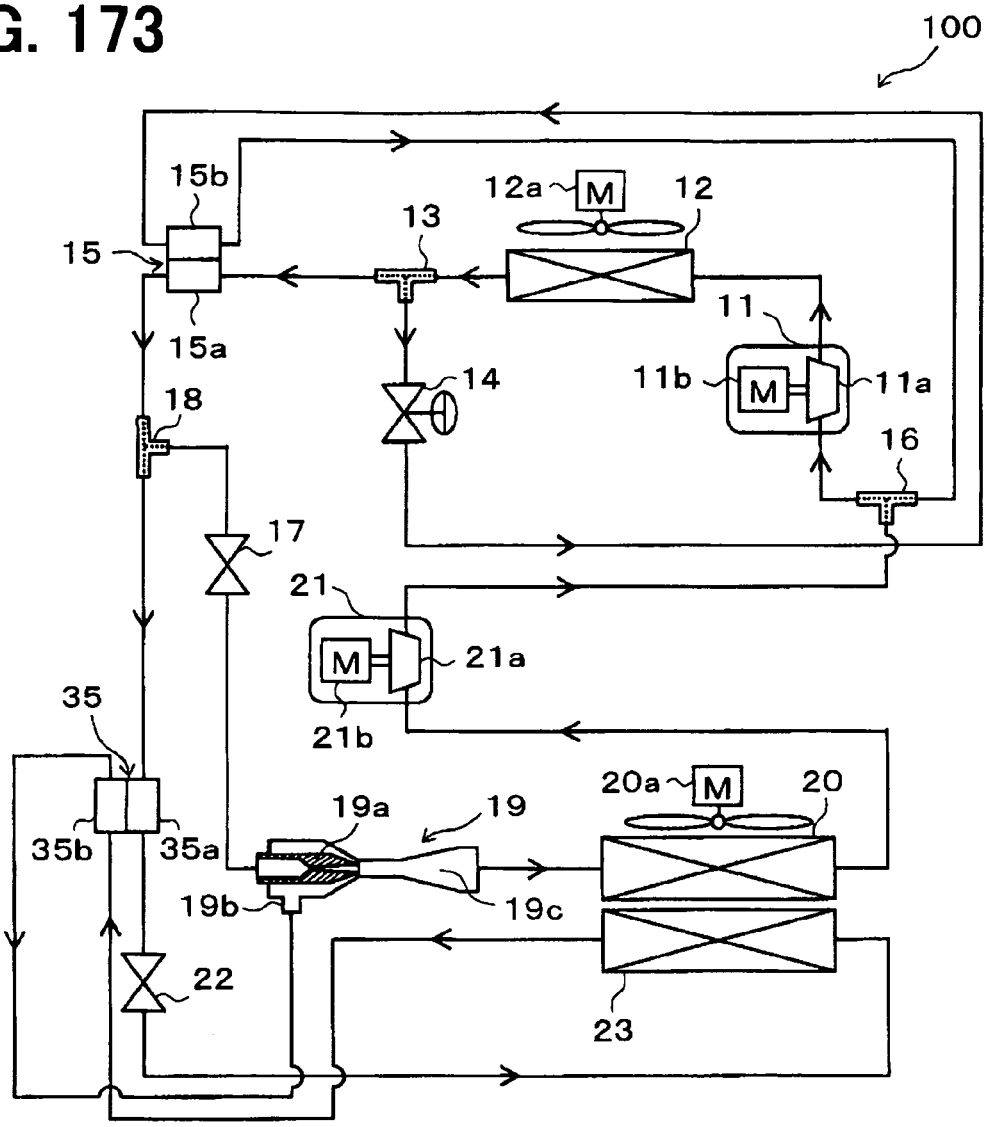
Figure 174:
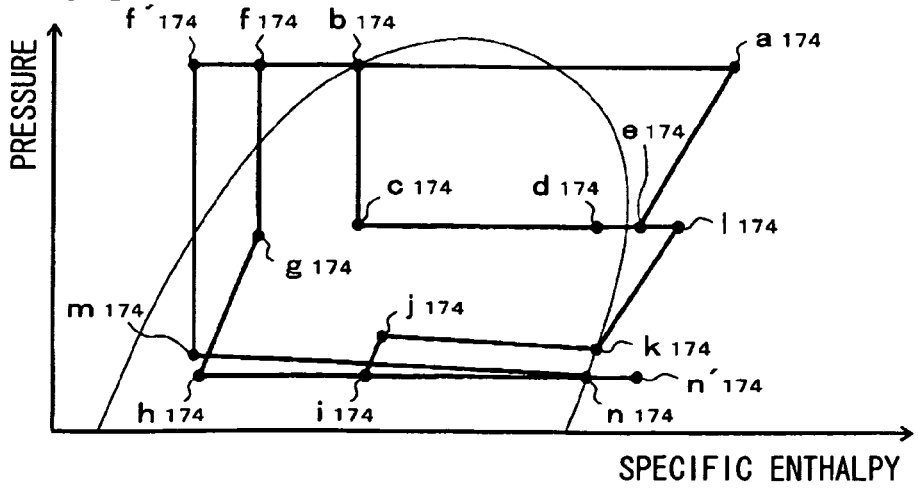
Figure 175:
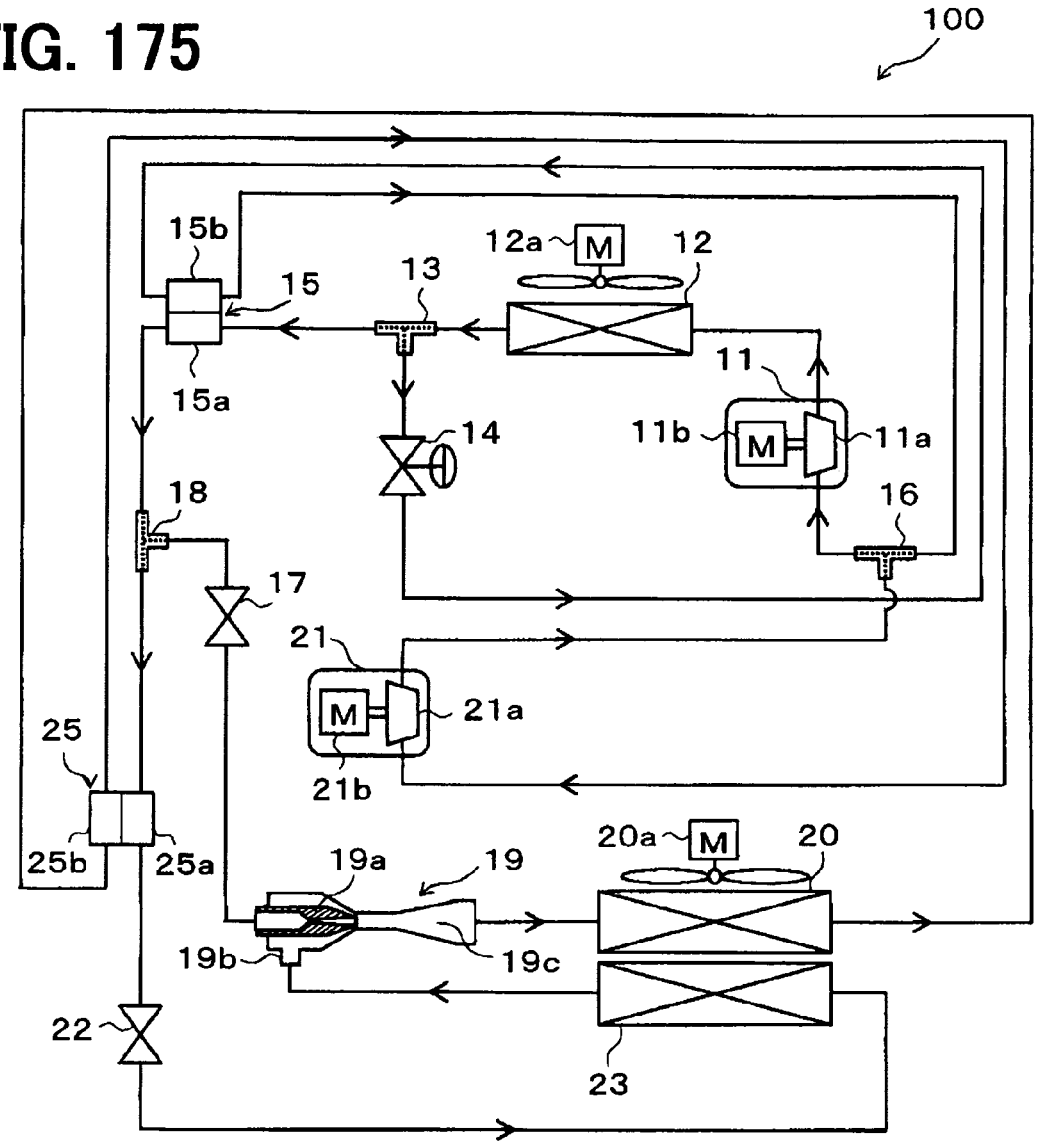
Figure 176:
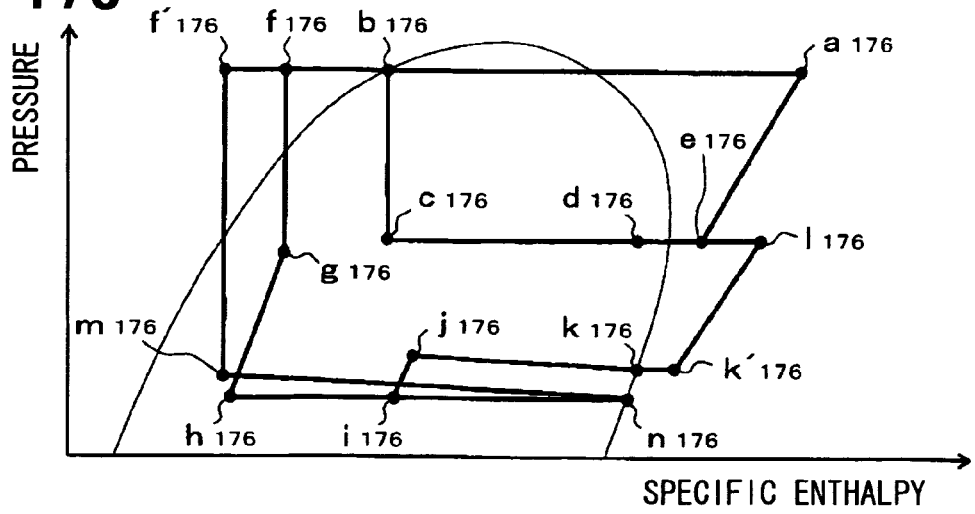
Figure 177:
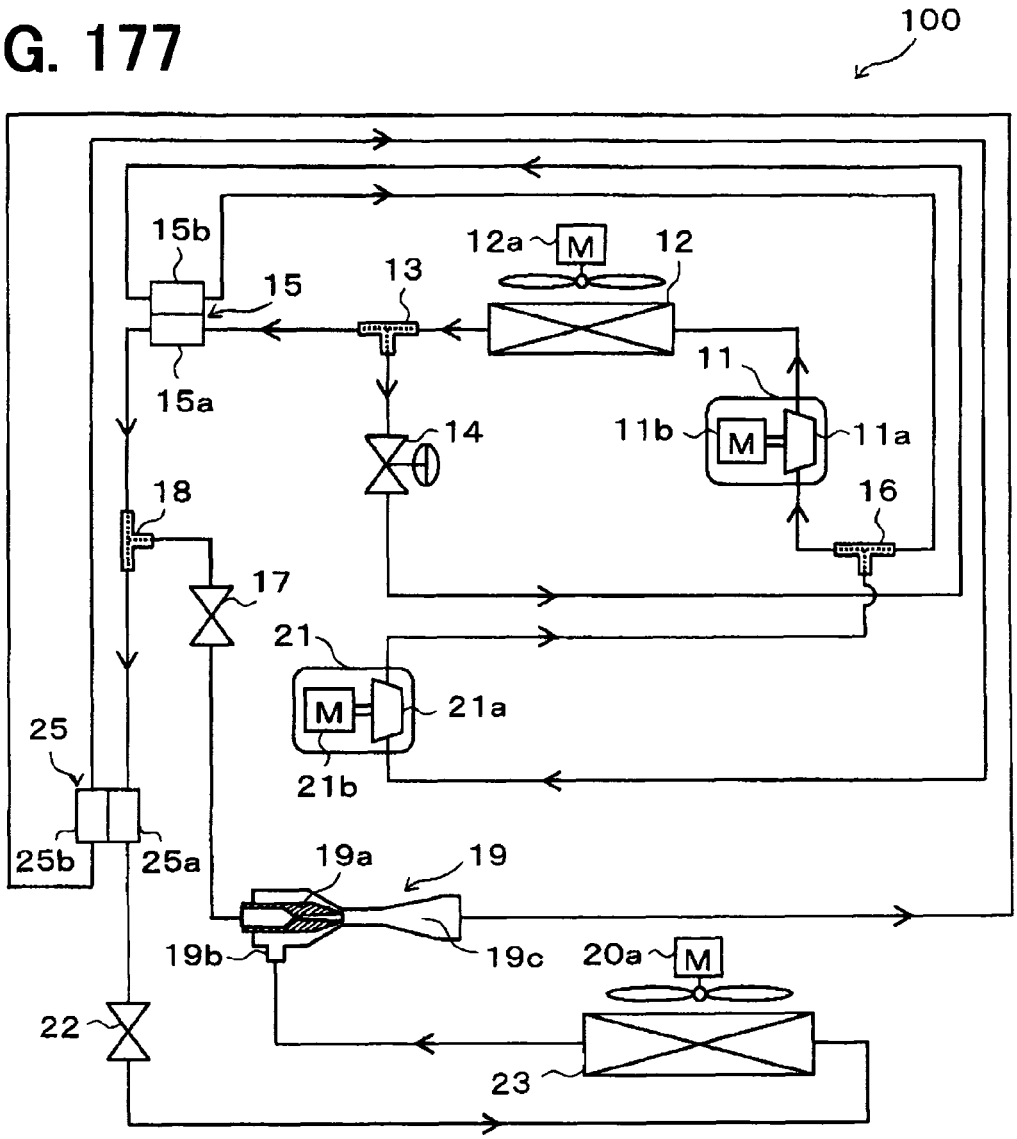
Figure 178:
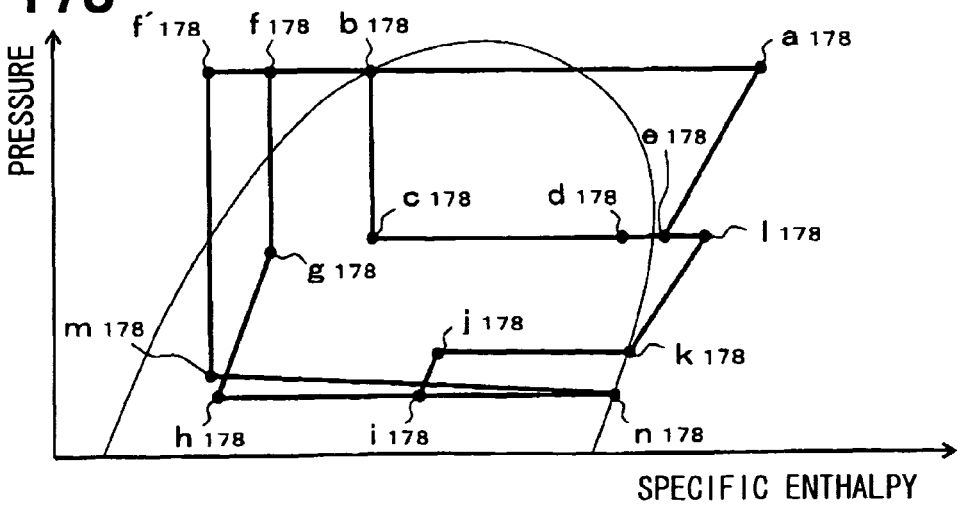
Figure 179:
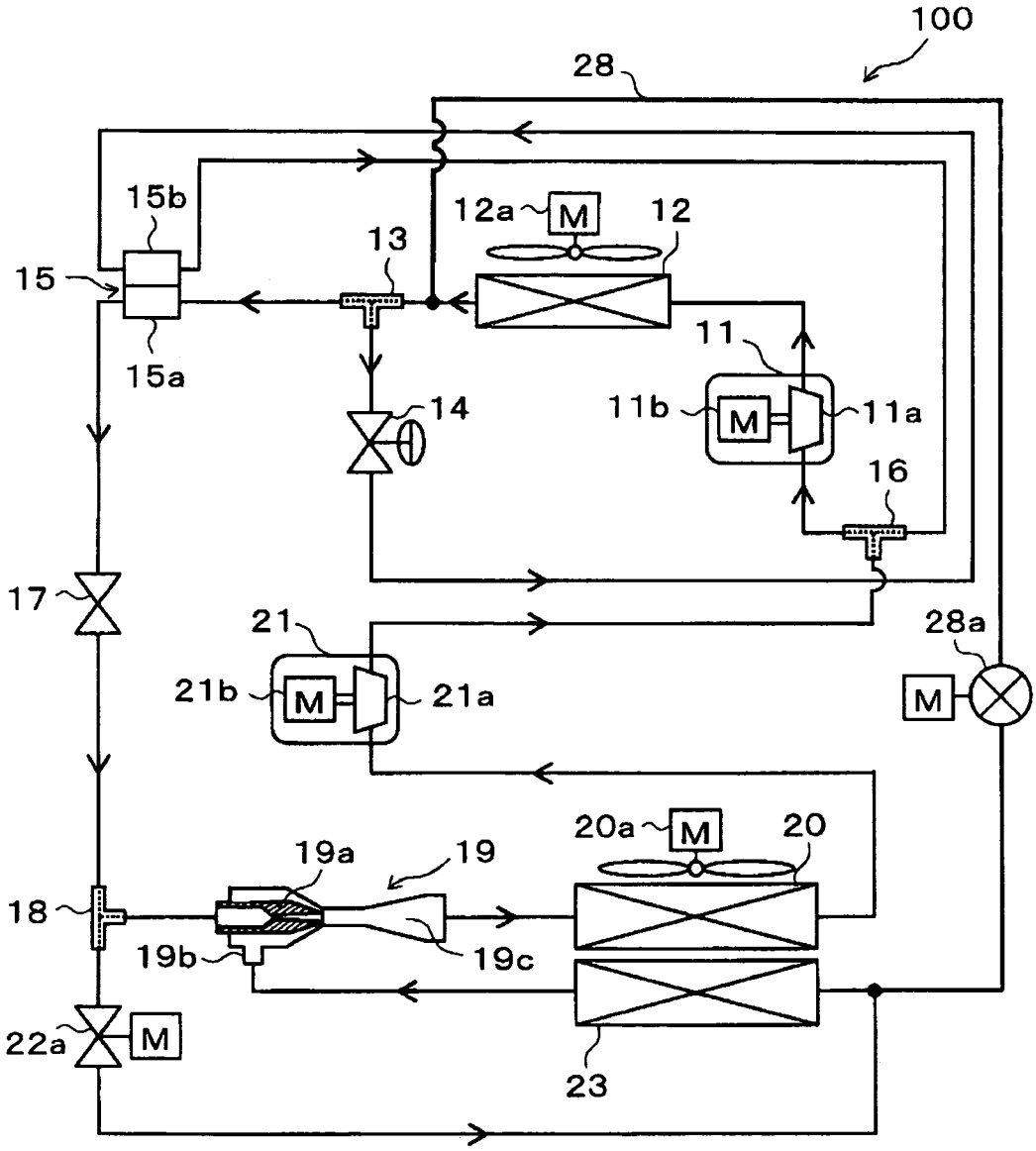
Figure 180:
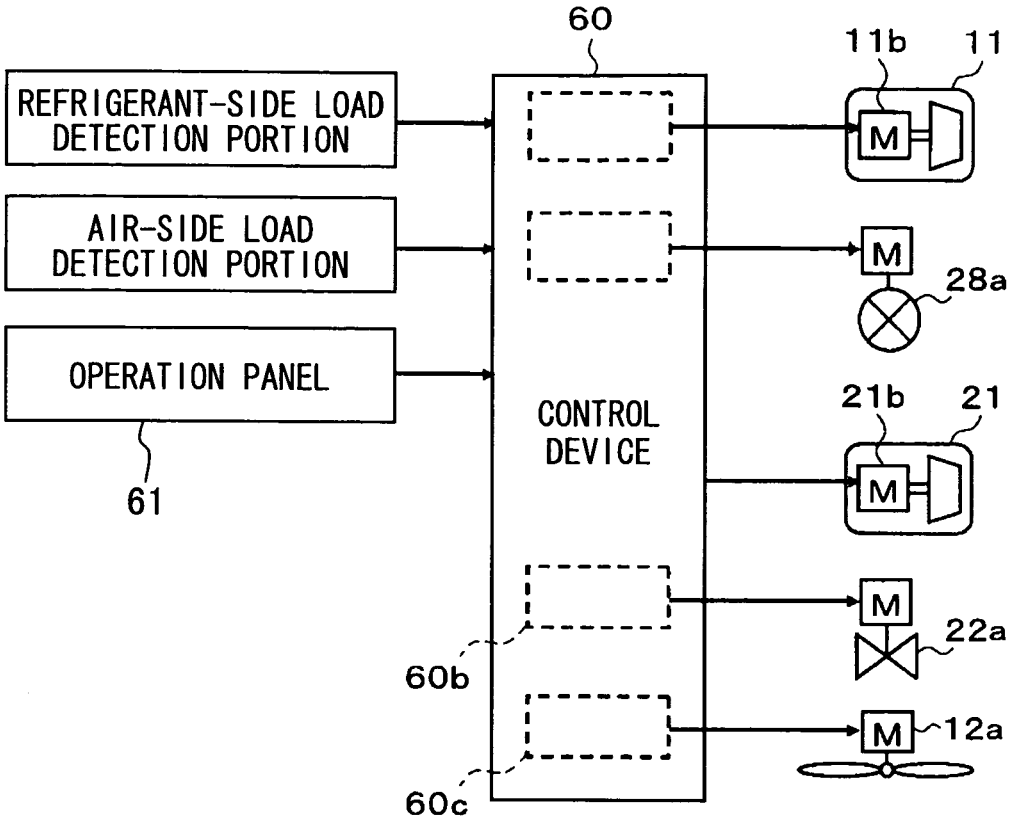
Figure 181:
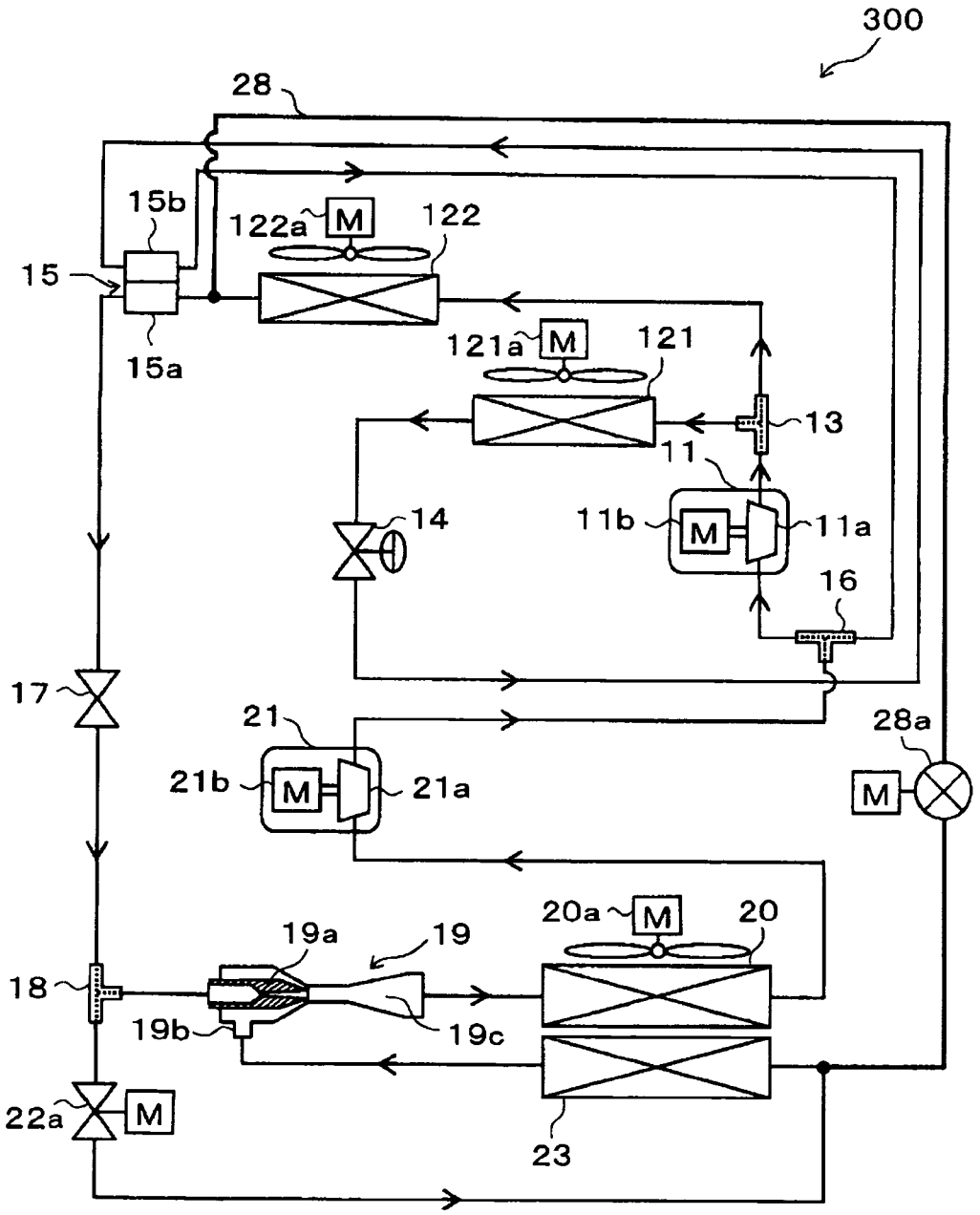
Figure 182:
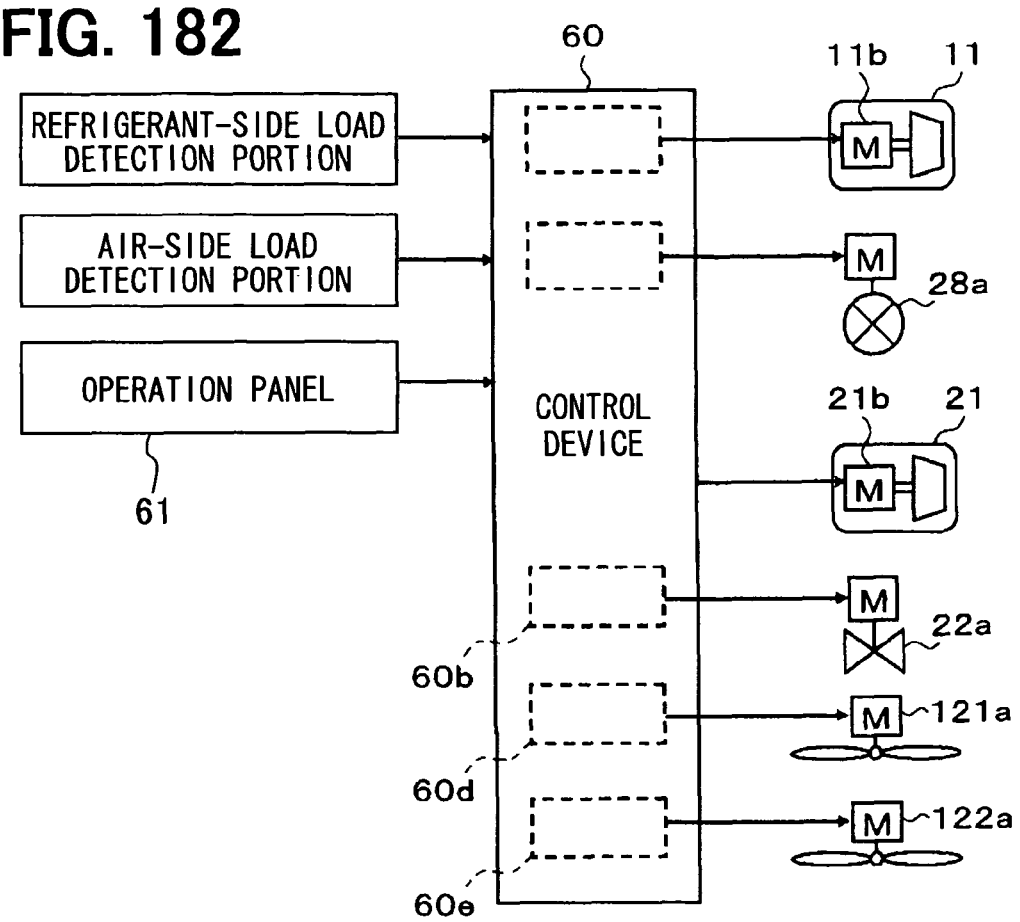
Figure 183:
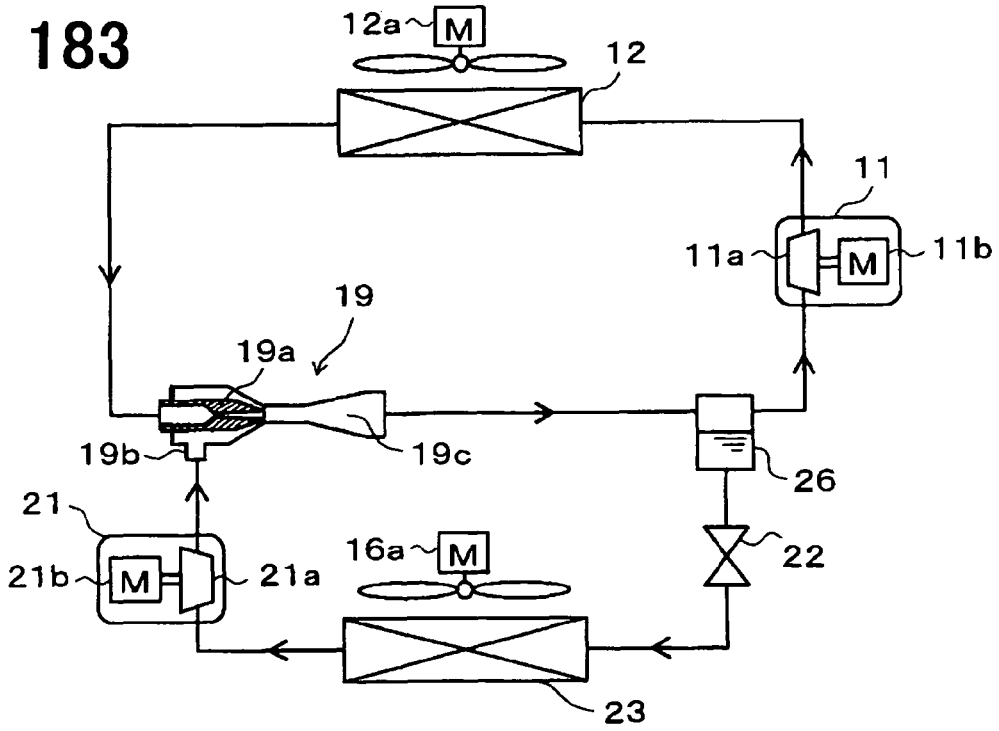

FIG. 132A is a Mollier diagram showing a refrigerant state in a general operation mode according to the 87th embodiment, and FIG. 132B is a Mollier diagram showing a refrigerant state in a defrosting operation mode according to the 87th embodiment;

FIG. 133 is a Mollier diagram showing a refrigerant state in an ejector-type refrigerant cycle device according to an 88th embodiment of the invention;

FIG. 134A is a Mollier diagram showing a refrigerant state in a general operation mode according to the 88th embodiment, and FIG. 134B is a Mollier diagram showing a refrigerant state in a defrosting operation mode according to the 88th embodiment;

FIG. 135 is a Mollier diagram showing a refrigerant state in an ejector-type refrigerant cycle device according to an 89th embodiment of the invention;

FIG. 136A is a Mollier diagram showing a refrigerant state in a general operation mode according to the 89th embodiment, and FIG. 136B is a Mollier diagram showing a refrigerant state in a defrosting operation mode according to the 89th embodiment;

FIG. 137 is a Mollier diagram showing a refrigerant state in an ejector-type refrigerant cycle device according to a 90th embodiment of the invention;

FIG. 138A is a Mollier diagram showing a refrigerant state in a general operation mode according to the 90th embodiment, and FIG. 138B is a Mollier diagram showing a refrigerant state in a defrosting operation mode according to the 90th embodiment;

FIG. 139 is a Mollier diagram showing a refrigerant state in an ejector-type refrigerant cycle device according to a 91st embodiment of the invention;

FIG. 140A is a Mollier diagram showing a refrigerant state in a general operation mode according to the 91st embodiment, and FIG. 140B is a Mollier diagram showing a refrigerant state in a defrosting operation mode according to the 91st embodiment;

FIG. 141 is a Mollier diagram showing a refrigerant state in an ejector-type refrigerant cycle device according to a 92nd embodiment of the invention;

FIG. 142A is a Mollier diagram showing a refrigerant state in a general operation mode according to the 92nd embodiment, and FIG. 142B is a Mollier diagram showing a refrigerant state in a defrosting operation mode according to the 92nd embodiment;

FIG. 143 is a Mollier diagram showing a refrigerant state in an ejector-type refrigerant cycle device according to a 93rd embodiment of the invention;

FIG. 144A is a Mollier diagram showing a refrigerant state in a general operation mode according to the 93rd embodiment, and FIG. 144B is a Mollier diagram showing a refrigerant state in a defrosting operation mode according to the 93rd embodiment;

FIG. 145 is a Mollier diagram showing a refrigerant state in an ejector-type refrigerant cycle device according to an 94th embodiment of the invention;

FIG. 146A is a Mollier diagram showing a refrigerant state in a general operation mode according to the 94th embodiment, and FIG. 146B is a Mollier diagram showing a refrigerant state in a defrosting operation mode according to the 94th embodiment;

FIG. 147 is an entire schematic diagram of an ejector-type refrigerant cycle device according to a 95th embodiment of the invention;

FIG. 148A is a Mollier diagram showing a refrigerant state in a cooling operation mode according to the 95th embodiment, and FIG. 148B is a Mollier diagram showing a refrigerant state in a heating operation mode according to the 95th embodiment;

FIG. 149 is an entire schematic diagram of an ejector-type refrigerant cycle device according to a 96th embodiment of the invention;

FIG. 150A is a Mollier diagram showing a refrigerant state in a cooling operation mode according to the 96th embodiment, and FIG. 150B is a Mollier diagram showing a refrigerant state in a heating operation mode according to the 96th embodiment;

FIG. 151 is an entire schematic diagram of an ejector-type refrigerant cycle device according to a 97th embodiment of the invention;

FIG. 152A is a Mollier diagram showing a refrigerant state in a cooling operation mode according to the 97th embodiment, and FIG. 152B is a Mollier diagram showing a refrigerant state in a heating operation mode according to the 97th embodiment;

FIG. 153 is an entire schematic diagram of an ejector-type refrigerant cycle device according to a 98th embodiment of the invention;

FIG. 154A is a Mollier diagram showing a refrigerant state in a cooling operation mode according to the 98th embodiment, and FIG. 154B is a Mollier diagram showing a refrigerant state in a heating operation mode according to the 98th embodiment;

FIG. 155 is an entire schematic diagram of an ejector-type refrigerant cycle device according to a 99th embodiment of the invention;

FIG. 156A is a Mollier diagram showing a refrigerant state in a cooling operation mode according to the 99th embodiment, and FIG. 156B is a Mollier diagram showing a refrigerant state in a heating operation mode according to the 99th embodiment;

FIG. 157 is an entire schematic diagram of an ejector-type refrigerant cycle device according to a 100th embodiment of the invention;

FIG. 158A is a Mollier diagram showing a refrigerant state in a cooling operation mode according to the 100th embodiment, and FIG. 158B is a Mollier diagram showing a refrigerant state in a heating operation mode according to the 100th embodiment;

FIG. 159 is an entire schematic diagram of an ejector-type refrigerant cycle device according to a 101st embodiment of the invention;

FIG. 160 is a Mollier diagram showing a refrigerant state in the ejector-type refrigerant cycle device according to the 101st embodiment;

FIG. 161 is an entire schematic diagram of an ejector-type refrigerant cycle device according to a 102nd embodiment of the invention;

FIG. 162 is a block diagram of an electrical control system of the ejector-type refrigerant cycle device according to the 102nd embodiment;

FIGS. 163A and 163B are graphs showing the relationships between a first pressure difference, a second pressure difference and the COP in an ejector-type refrigerant cycle device according to a 103rd embodiment;

FIG. 164 is a graph showing the relationships between the COP and a dryness Xo of refrigerant flowing into a nozzle portion in an ejector-type refrigerant cycle device according to a 104th embodiment of the invention;

FIG. 165 is an entire schematic diagram of an ejector-type refrigerant cycle device according to a 105th embodiment of the invention;

FIG. 166 is a Mollier diagram showing a refrigerant state in the ejector-type refrigerant cycle device according to the 105th embodiment;

FIG. 167 is an entire schematic diagram of an ejector-type refrigerant cycle device according to a 106th embodiment of the invention;

FIG. 168 is a Mollier diagram showing a refrigerant state in the ejector-type refrigerant cycle device according to the 106th embodiment;

FIG. 169 is an entire schematic diagram of an ejector-type refrigerant cycle device according to a 107th embodiment of the invention;

FIG. 170 is a Mollier diagram showing a refrigerant state in the ejector-type refrigerant cycle device according to the 107th embodiment;

FIG. 171 is an entire schematic diagram of an ejector-type refrigerant cycle device according to a 108th embodiment of the invention;

FIG. 172 is a Mollier diagram showing a refrigerant state in the ejector-type refrigerant cycle device according to the 108th embodiment;

FIG. 173 is an entire schematic diagram of an ejector-type refrigerant cycle device according to a 109th embodiment of the invention;

FIG. 174 is a Mollier diagram showing a refrigerant state in the ejector-type refrigerant cycle device according to the 109th embodiment;

FIG. 175 is an entire schematic diagram of an ejector-type refrigerant cycle device according to a 110th embodiment of the invention;

FIG. 176 is a Mollier diagram showing a refrigerant state in the ejector-type refrigerant cycle device according to the 110th embodiment;

FIG. 177 is an entire schematic diagram of an ejector-type refrigerant cycle device according to a 111th embodiment of the invention;

FIG. 178 is a Mollier diagram showing a refrigerant state in the ejector-type refrigerant cycle device according to the 111th embodiment;

FIG. 179 is an entire schematic diagram of an ejector-type refrigerant cycle device according to a 112th embodiment of the invention;

FIG. 180 is a block diagram showing an electrical control system of the ejector-type refrigerant cycle device according to the 112th embodiment;

FIG. 181 is an entire schematic diagram of an ejector-type refrigerant cycle device according to a 113th embodiment of the invention;

FIG. 182 is a block diagram showing an electrical control system of the ejector-type refrigerant cycle device according to the 113th embodiment; and FIG. 183 is an entire schematic diagram of an ejector-type refrigerant cycle device of a prior application.

DETAILED DESCRIPTION OF THE PREFERRED EMBODIMENTS (1st Embodiment)

Figure 1:
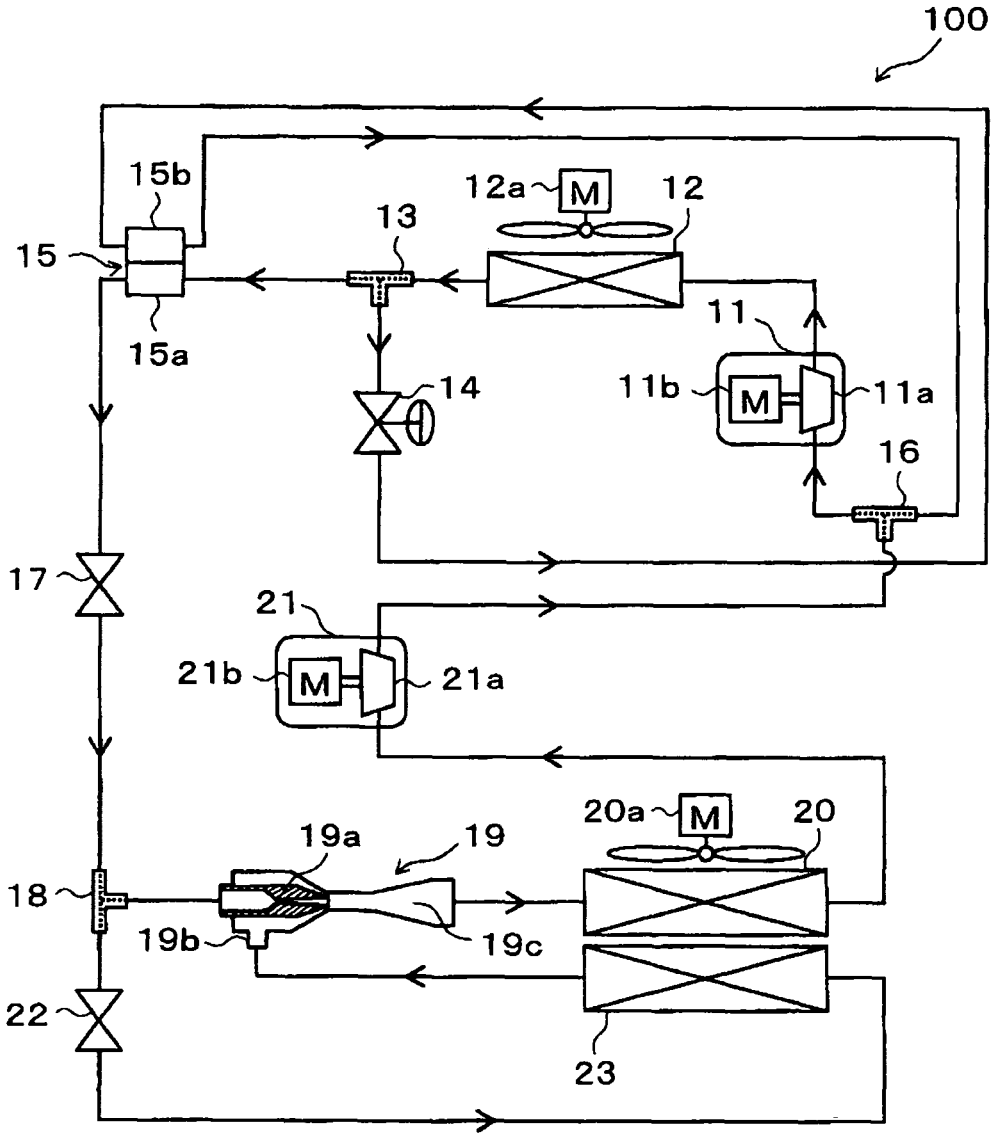
FIG. 1 is an entire schematic diagram of an ejector-type refrigerant cycle device according to a 1st embodiment of the invention.

An ejector-type refrigerant cycle device 100 of the present invention, adapted as a refrigerator, will be described with reference to FIGS. 1 and 2. The refrigerator is for cooling a refrigerating interior room, that is a space to be cooled, to an extremely low temperature such as in a range between −30° C. and −10° C. FIG. 1 is an entire schematic diagram of the ejector-type refrigerant cycle device 100 of the present embodiment.

In the ejector-type refrigerant cycle device 100 of the present embodiment, a first compressor 11 is configured to draw refrigerant, to compress the drawn refrigerant, and to discharge the compressed refrigerant. For example, the first compressor 11 is an electrical compressor in which a first compression portion 11*a* having a fixed displacement is driven by a first electrical motor 11*b*. As the first compression portion 11*a*, various compressors such as a scroll type compressor, a vane type compressor and a rotary-piston type compressor can be used.

The operation (e.g., rotational speed) of the first electrical motor 11*b* is controlled by using control signals output from a control device. As the first electrical motor 11*b*, an AC motor or a DC motor may be used. By controlling the rotational speed of the first electrical motor 11*b*, the refrigerant discharge capacity of the first compression portion 11*a* can be changed. Thus, in the present embodiment, the first electrical motor 11*b* can be adapted as a discharge capacity changing portion for changing the discharge capacity of the refrigerant of the first compression portion 11*a*.

A refrigerant radiator 12 is disposed on a refrigerant discharge side of the first compressor 11. The radiator 12 exchanges heat between high-pressure refrigerant discharged from the first compressor 11 and outside air (i.e., air outside the room) blown by a cooling fan 12*a* to cool the high-pressure refrigerant. The rotation speed of the cooling fan 12*a* is controlled by a control voltage output from the control device so as to control an air blowing amount from the cooling fan 12*a*.

The heat radiation capacity of the radiator 12 is increased or decreased in accordance with an increase or decrease of the blown air amount depending on the control rotation speed. Furthermore, the radiator 12 of the present embodiment becomes in a state almost without causing the heat radiation when the cooling fan 12*a* is stopped. Thus, the cooling fan 12*a* of the present embodiment is adapted as a radiation capacity adjusting portion which adjusts the heat radiation capacity of the radiator 12.

In the present embodiment, a flon-based refrigerant is used as the refrigerant for a refrigerant cycle of the ejector-type refrigerant cycle device 100 to form a vapor-compression subcritical refrigerant cycle in which a refrigerant pressure on the high-pressure side does not exceed the critical pressure of the refrigerant. Thus, the radiator 12 serves as a condenser for cooling and condensing the refrigerant. Furthermore, a refrigerator oil having a solubility with respect to the liquid refrigerant is mixed to the refrigerant in order to lubricate the first compression portion 11*a* and a second compression portion 21*a*, so as to be circulated in the refrigerant cycle together with the refrigerator oil.

A first branch portion 13 is connected to a refrigerant outlet side of the radiator 12, to branch a high-pressure refrigerant flowing out of the radiator 12. For example, the first branch portion 13 is a three-way joint member having three ports that are used as one refrigerant inlet and two refrigerant outlets.

The three-way joint member used as the first branch portion 13 may be configured by bonding pipes having different pipe diameters, or may be configured by providing plural refrigerant passages in a metal block member or a resin block member. One of the two refrigerant outlets of the first branch portion 13 is connected to a thermal expansion valve 14 adapted as a high-pressure side decompression portion, and the other one of the two refrigerant outlets of the first branch portion 13 is connected to a high-pressure sire refrigerant passage 15*a* of an inner heat exchanger 15 described later.

The thermal expansion valve 14 has a temperature sensing portion (not shown) provided at the refrigerant suction side of the first compression portion 11*a*. The thermal expansion valve 14 is a variable throttle mechanism, in which a super-heat degree at the refrigerant suction side of the first compression portion 11*a* is detected based on temperature and pressure of the refrigerant at the refrigerant suction side of the compressor 11*a*, and its valve-open degree (refrigerant flow amount) is adjusted by using a mechanical mechanism so that the super-heat degree at the refrigerant suction side of the first compression portion 11*a* is approached to a predetermined value.

A refrigerant outlet side of the thermal expansion valve 14 is connected to a middle-pressure side refrigerant passage 15*b* of the inner heat exchanger 15. The inner heat exchanger 15 is configured to perform heat exchange between the refrigerant branched at the first branch portion 13 and passing through the high-pressure side refrigerant passage 15*a*, and the refrigerant passing through the middle-pressure side refrigerant passage 15*b* downstream of the thermal expansion valve 14.

More specifically, in the present embodiment, the refrigerant downstream of the thermal expansion valve 14 is the refrigerant upstream of a join portion 16 described later, in the refrigerant having been decompressed at the thermal expansion valve 14. Thus, the refrigerant flowing toward the thermal expansion valve 14 from the first branch portion 13 flows in this order of the thermal expansion valve 14→the middle-pressure side refrigerant passage 15*b* of the inner heat exchanger 15→the join portion 16.

As a special structure of the inner heat exchanger 15, a double-pipe heat exchange structure may be used, in which an inner pipe forming the middle-pressure side refrigerant passage 15*b* is provided inside of an outer pipe forming the high-pressure side refrigerant passage 15*a*. The high-pressure side refrigerant passage 15*a* may be provided as the inner pipe, and the middle-pressure side refrigerant passage 15*b* may be as the outer pipe. Furthermore, refrigerant pipes for defining the high-pressure side refrigerant passage 15*a* and the middle-pressure side refrigerant passage 15*b* maybe bonded by brazing to have a heat exchange structure.

The refrigerant outlet side of the middle-pressure refrigerant passage 15*b* of the inner heat exchanger 15 is connected to a refrigerant inlet of the join portion 16. The join portion 16 is configured to join the flow of the refrigerant flowing out of the middle-pressure side refrigerant passage 15*b* of the inner heat exchanger 15 and the flow of refrigerant discharged from the second compression portion 21*a* of the second compressor 21 described later, and to cause the joined refrigerant to flow toward the refrigerant suction side of the first compression portion 11*a*, The basic structure of the join portion 16 is similar to the first branch portion 13*a*. The join portion 16 is provided with two refrigerant inlets and one refrigerant outlet, in the three ports of the three-way joint member.

As shown in FIG. 1, a refrigerant outlet side of the high-pressure side refrigerant passage 15*a* of the inner heat exchanger 15 is connected to a first fixed throttle 17 that is used as a pre-nozzle decompression portion, in which the refrigerant, to flow into a nozzle portion 19*a* of an ejector 19 described later, is decompressed and expanded to a middle pressure. As the first fixed throttle 17, a fixed throttle such as a capillary tube, an orifice or the like can be used.

A second branch portion 18 is connected to a refrigerant outlet side of the first fixed throttle 17, to further branch the refrigerant branched at the first branch portion 13 and having been decompressed and expanded in the first fixed throttle 17. The basic structure of the second branch portion 18 is similar to the first branch portion 13.

One of the two refrigerant outlets of the second branch portion 18 is connected to an inlet side of the nozzle portion 19*a* of the ejector 19, and the other one of the two refrigerant outlets of the second branch portion 18 is connected to a second fixed throttle 22 used as a suction side decompression portion described later. The ejector 19 is adapted as a refrigerant decompression portion for decompressing and expanding the refrigerant, and as a refrigerant circulation portion for circulating the refrigerant by the suction action of a high-speed refrigerant flow jetted from the nozzle portion 19*a*.

The ejector 19 is configured to have the nozzle portion 19*a* and a refrigerant suction port 19*b* and the like. The refrigerant passage sectional area of the nozzle portion 19*a* is throttled in the refrigerant flow direction so that the middle pressure refrigerant from the one stream branched at the second branch portion 18 is decompressed and expanded in iso-entropy. The refrigerant suction port 19*b* is provided to communicate with a space in the ejector 19, where the jet port of the nozzle portion 19*a* is provided, so as to draw the refrigerant flowing out of a suction side evaporator 23 described later.

A diffuser portion 19*c* is provided in the ejector 19 on a downstream side of the nozzle portion 19*a* and the refrigerant suction port 19*b* in the refrigerant flow, so as to mix the high-velocity refrigerant flow jetted from the nozzle portion 19*a* with the suction refrigerant drawn from the refrigerant suction port 19*b*, and to increase the refrigerant pressure.

The diffuser portion 19*c* is formed in such a shape to gradually increase the passage sectional area of the refrigerant, and has an effect of reducing the velocity of the refrigerant flow so as to increase the refrigerant pressure. That is, the diffuser portion 19*c* has an effect of converting the velocity energy of the refrigerant to the pressure energy thereof. A mixing portion for mixing the jet refrigerant and the suction refrigerant may be provided in the ejector 19, so that the mixed refrigerant flows into the diffuser portion 19*c* in the ejector 19.

A discharge side evaporator 20 is connected to an outlet side of the ejector 19 (specifically, the outlet side of the diffuser portion 19*c*). The discharge side evaporator 20 is a heat-absorbing heat exchanger, in which refrigerant flowing out of the diffuser portion 19*c* of the ejector 19 is evaporated by heat-exchanging with air inside the refrigerator, blown by a blower fan 20*a*, so as to provide heat-absorbing action. Thus, a fluid to be heat-exchanged with the refrigerant in the discharge side evaporator 20 is the air in the room of the refrigerator.

A refrigerant suction port of the second compressor 21 is connected to a refrigerant outlet side of the discharge side evaporator 20. The basic structure of the second compressor 21 is similar to that of the first compressor 11. Thus, the second compressor 21 is an electrical compressor in which a fixed-displacement type second compression portion 21*a* is driven by a second electrical motor 21*b*. The second electrical motor 21*b* of the present embodiment is adapted as a second discharge capacity changing portion for changing a refrigerant discharge capacity of the second compression portion 21*a*.

The one of the refrigerant inlets of the join portion 16 is connected to a refrigerant discharge port of the second compressor 21, and the refrigerant outlet of the joint portion 16 is connected to the refrigerant suction port of the first compression portion 11*a*.

As shown in FIG. 1, a second fixed throttle 22 is connected to the other one of the refrigerant outlets of the second branch portion 18. The basic structure of the second fixed throttle 22 is similar to the first fixed throttle 17. The second fixed throttle 22 is for decompressing and expanding the refrigerant of the other flow branched at the second branch portion 18, and is adapted as a suction side decompression portion which decompresses and expands the refrigerant to flow into the suction side evaporator 23 connected to a refrigerant outlet side of the second fixed throttle 22.

The suction side evaporator 23 is configured to perform heat exchange between low-pressure refrigerant decompressed and expanded at the second fixed throttle 22 and the interior air blown by the blower fan 20*a* and having passed through the discharge side evaporator 20, and is adapted as a heat-absorbing heat exchanger in which the refrigerant is evaporated so as to exert heat-absorbing action. The refrigerant suction port 19*b* of the ejector 19 is connected to a refrigerant outlet side of the suction side evaporator 23.

In the present embodiment, the discharge side evaporator 20 and the suction side evaporator 23 are configured by a heat exchanger with a fin-and-tube structure, and heat exchange fins are used in common in both the discharge evaporator 20 and the suction side evaporator 23. The discharge side evaporator 20 and the suction side evaporator 23 are integrally constructed, such that a tube structure in which the refrigerant flowing out of the ejector 19 flows, and a tube structure in which the refrigerant flowing out of the second fixed throttle 22 flows, are formed independently from each other.

Thus, the air blown by the blower fan 20*a* is heat-absorbed at first in the discharge side evaporator 20, and then is heat-absorbed in the suction side evaporator 23. When the discharge side evaporator 20 and the suction side evaporator 23 are integrally formed, the components of both the evaporators may be made of aluminum, and may be bonded integrally by using bonding means such as brazing. Alternatively, the components of both the evaporators may be connected integrally by using a mechanical engagement means such as a bolt-fastening.

The control device (not shown) is constructed of a generally-known microcomputer including CPU, ROM and RAM and the like, and its circumferential circuits. The control device is a control portion that performs various calculations and processes based on a control program stored in the ROM, and controls operation of various electrical actuators (11*a*, 12*a*, 20*a*, 21*a*)

The control device includes a function portion as the first discharge-capacity control portion which controls the operation of the first electrical motor 11*b*, a function portion as the second discharge-capacity control portion which controls the operation of the second electrical motor 21*b*, and a function portion as the heat-radiation capacity control portion that controls the operation of the cooling fan 12*a*.

The first discharge-capacity control portion, the second discharge-capacity control portion and the heat-radiation capacity control portion may be configured by different control devices, respectively. Into the control device, detection values from a sensor group (not shown) including an outside air sensor for detecting an outside air temperature, an inside temperature sensor for detecting an interior temperature of the room of the refrigerator, and various operation signals from an operation panel (not shown) in which an operation switch for operating the refrigerator and the like are provided are input.

Next, operation of the present embodiment with the above structure will be described based on the Mollier diagram shown in FIG. 2. When the operation switch of the operation panel is turned on, the control device causes the first and second electrical motors 11*b*, 21*b*, the cooling fan 12*a*, the blower fan 20*a* to be operated. Thus, the first compressor 11 draws the refrigerant, compresses the refrigerant to a high pressure refrigerant, and discharges the compressed refrigerant (point $a_2$ in FIG. 2).

High-temperature and high-pressure refrigerant discharged from the first compressor 11 flows into the radiator 12, and is heat-exchanged with the blown air (outside air) blown by the cooling fan 12*a* to be radiated and condensed (point $a_2$→point $b_2$). The flow of the refrigerant flowing out of the radiator 12 is branched by the first branch portion 13 into a flow of the refrigerant flowing toward the thermal expansion valve 14 and a flow of the refrigerant flowing toward the high-pressure side refrigerant passage 15*a* of the inner heat exchanger 15.

The refrigerant flowing into the thermal expansion valve 14 is decompressed and expanded in iso-enthalpy to a middle-pressure refrigerant, and becomes in a gas-liquid two-phase state (point $b_2$→point $c_2$). At this time, the valve open degree of the thermal expansion valve 14 is adjusted so that a super heat degree (point $e_2$) of the refrigerant at the refrigerant suction side of the first compressor 11 becomes a predetermined value. The middle-pressure refrigerant flowing out of the thermal expansion valve 14 flows into the middle-pressure side refrigerant passage 15*b* of the inner heat exchanger 15.

The middle-pressure refrigerant flowing into the middle-pressure side refrigerant passage 15*b* of the inner heat exchanger 15 is heat-exchanged with the high-pressure refrigerant flowing into the high-pressure side refrigerant passage 15*a* from the first branch portion 13, and thereby increasing its enthalpy (point $c_2$→point $d_2$). The refrigerant flowing out of the middle-pressure side refrigerant passage 15*b* is joined with the discharge refrigerant (point $l_2$) of the second compressor 21 by the join portion 16 (point $d_2$→point $e_2$), and the joined refrigerant is drawn into the first compressor 11 to be compressed again (point $e_2$→point $a_2$).

The enthalpy of the refrigerant flowing into the high-pressure-side refrigerant passage 15*a* of the inner heat exchanger 15 from the first branch portion 13 is decreased (point $b_2$→point $f_2$), and flows into the first fixed throttle 17. The refrigerant flowing into the first fixed throttle 17 is decompressed and expanded in iso-enthalpy, and becomes in a gas-liquid two-phase state (point $f_2$→point $g_2$).

The flow of the refrigerant flowing out of the first fixed throttle 17 is branched by the second branch portion 18 into a flow of the refrigerant flowing into the nozzle portion 19*a* of the ejector 19 and a flow of the refrigerant flowing into the second fixed throttle 22.

The second branch portion 18, the nozzle portion 19*a* and the flow amount characteristics (pressure loss characteristics) of the second fixed throttle 22 are set so that a flow ratio Gnoz/Ge can be set by the second branch portion 18 to become an optimal ratio at, which a high COP can be obtained in the entire cycle. Here, the flow ratio Gnoz/Ge is a ratio of a nozzle-side refrigerant flow amount Gnoz flowing to the nozzle portion 19*a* to a decompression-portion side refrigerant flow amount Ge flowing toward the second fixed throttle 22.

The refrigerant flowing into the nozzle portion 19*a* of the ejector 19 from the second branch portion 18 is decompressed and expanded by the nozzle portion 19*a* in iso-entropy (point $g_2$→point $h_2$). In the decompression and expansion in the nozzle portion 19*a*, the pressure energy of the refrigerant is converted to the speed energy of the refrigerant, and the refrigerant is jetted with a high speed from a refrigerant jet port of the nozzle portion 19*a*. Thus, the refrigerant flowing out of the suction side evaporator 23 is drawn into the ejector 19 from the refrigerant suction port 19*b*.

Furthermore, the jet refrigerant jetted from the nozzle portion 19*a* and the suction refrigerant drawn from the refrigerant suction port 19*b* are mixed in the diffuser portion 19*c* of the ejector 19 (point $h_2$→point $i_2$, point $n_2$→point $i_2$), and are pressurized in the diffuser portion 19*c* (point $i_2$→point $j_2$). That is, passage sectional area is enlarged in the diffuser portion 19*c* as toward downstream so that the speed energy of the refrigerant is converted to the pressure energy thereof, thereby increasing the pressure of the refrigerant.

The refrigerant flowing out of the diffuser portion 19*c* flows into the discharge side evaporator 20, and is evaporated by absorbing heat from air inside of the refrigerator, blown by the blower fan 20*a* (point $j_2$→point $k_2$). Thus, the air blown into the interior of the refrigerator is cooled. The refrigerant flowing out of the suction side evaporator 23 is drawn into the second compressor 21, and is compressed to a middle pressure (point $k_2$→point $l_2$).

At this time, the control device controls operation of the second electrical motor 21*b* of the second compressor 21, so that the refrigerant downstream of the ejector 19 is drawn by the suction action of the second compressor 21, thereby preventing a decrease in the flow amount of the drive flow of the ejector 19 and providing the refrigerant suction action in the ejector 19.

Furthermore, the operation of the first electrical motor 11*b* of the first compressor 11 is controlled so as to prevent a high-pressure side refrigerant pressure of the cycle, that is, the discharge refrigerant pressure of the first compressor 11, from being unnecessarily increased in accordance with the refrigerant discharge capacity of the second compressor 21. The refrigerant discharged from the second compressor 21 is joined with the refrigerant flowing out of the middle-pressure side refrigerant passage 15*b* of the inner heat exchanger 15 in the join portion 20 (point $l_2$→point $e_2$), and then is drawn into the first compressor 11.

The refrigerant flowing toward the second fixed throttle 22 from the second branch portion 18 is decompressed and expanded in iso-enthalpy to become to a low-pressure refrigerant (point $g_2$→point $m_2$). The low-pressure refrigerant decompressed and expanded by the second fixed throttle 22 flows into the suction side evaporator 23, and is evaporated by absorbing heat from air having passed through the discharge side evaporator 20, blown by the blower fan 20*a* into the refrigerator.

Thus, air to be blown into the interior of the refrigerator is further cooled. The refrigerant flowing out of the suction side evaporator 23 is drawn into the ejector 19 from the refrigerant suction port 19*b* (point $n_2$→point $i_2$).

The ejector-type refrigerant cycle device 100 of the present embodiment is operated above, and thereby the following excellent effects can be obtained.

(A) Because the flow of the refrigerant is branched in the second branch portion 18 such that the flow amount ratio Gnoz/Ge becomes in an optimal flow amount ratio, the refrigerant can be suitably supplied to both the discharge side evaporator 20 and the suction side evaporator 23. Thus, cooling action can be exerted in both the discharge side evaporator 20 and the suction side evaporator 23, at the same time.

The refrigerant evaporation pressure of the suction side evaporator 23 becomes in a pressure after being decompressed by the second fixed throttle 22, and the refrigerant evaporation pressure of the discharge side evaporator 20 becomes in a pressure after being pressurized in the diffuser portion 19*c*. Thus, the refrigerant evaporation temperature of the suction side evaporator 23 can be made lower than that of the refrigerant evaporation temperature of the discharge side evaporator 20.

Furthermore, with respect to the flow direction of blown air of the blower fan 20*a*, the discharge side evaporator 20 having a relatively high refrigerant evaporation temperature is located upstream, and the suction side evaporator 23 having a relatively low refrigerant evaporation temperature is located downstream. Thus, it is possible to secure both of a temperature difference between the blown air and the refrigerant evaporation temperature in the discharge side evaporator 20, and a temperature difference between the blown air and the refrigerant evaporation temperature in the suction side evaporator 23. As a result, heat exchanging efficient can be improved in both the discharge side evaporator 20 and the suction side evaporator 23.

(B) Even in an operation condition in which the flow amount of the drive flow of the ejector 19 decreases, that is, even in an operation condition in which the suction capacity of the ejector 19 decreases, refrigerant from a downstream side of the diffuser portion 19*c* of the ejector 19 is drawn by the suction action of the second compressor 21 (second compression portion 21*a*), thereby preventing a decrease in the flow amount of the drive flow of the ejector 19. Thus, the suction capacity of the ejector 19 can be supplemented, and thereby the ejector-type refrigerant cycle device can be stably operated.

Even when the refrigerant discharge capacity of the second compressor 21 is increased, the refrigerant discharge capacity of the first compression portion 11*a* can be adjusted, thereby preventing the high-pressure side refrigerant pressure of the cycle from being unnecessarily increased. Thus, it can prevent the COP from being unnecessarily decreased. As a result, even in an operation condition in which a variation in the flow amount of the drive flow can be caused, the ejector-type refrigerant cycle device can be stably operated without decreasing the COP.

The above effects are extremely effective in a refrigerant cycle device having a large pressure difference between the high-pressure refrigerant and the low-pressure refrigerant, for example, in a refrigerant cycle device in which the interior temperature of the refrigerator that is a space to be cooled is decreased to a very low temperature (e.g., −30° C.-−10° C.) as in the present embodiment.

(C) In a refrigerant cycle in which the refrigerant is circulated in this order of the first compressor 11→the radiator 12→the first branch portion 13→the thermal expansion valve 14→the middle-pressure side refrigerant passage 15*b* of the inner heat exchanger 15→the join portion 16→the first compressor 11, the refrigerant to flow into the suction side evaporator 23 and the discharge side evaporator 20 can be cooled by the inner heat exchanger 15.

Thus, the enthalpy of the refrigerant flowing into the suction side evaporator 23 and the discharge side evaporator 20 can be decreased, and the refrigerating capacity obtained in the suction side evaporator 23 and the discharge side evaporator 20 can be increased, thereby improving the COP.

(D) The refrigerant to pass through an evaporator such as the discharge side evaporator 20 and the suction side evaporator 23 flows in this order of the first compressor 11→the radiator 12→the first branch portion 13→the high-pressure side refrigerant passage 15*a* of the inner heat exchanger 15→the first fixed throttle 17→the second branch portion 18→the ejector 19→the discharge side evaporator 20→the second compressor 21→the join portion 16→the first compressor 11, and, at the same time, flows in this order of the first compressor 11→the radiator 12→the first branch portion 13→the high-pressure side refrigerant passage 15*a* of the inner heat exchanger 15→the first fixed throttle 17→the second branch portion 18→the second fixed throttle 22→the suction side evaporator 23→the ejector 19→the discharge side evaporator 20→the second compressor 21→the join portion 16→the first compressor 11 (first compression portion 11*a*).

That is, because the flow of the refrigerant passing through the evaporator such as the discharge side evaporator 20 and the suction side evaporator 23 becomes in circular, even when a lubrication oil (refrigerator oil) for the first and second compressors 11, 21 is mixed in the refrigerant, it can prevent the oil from staying in the discharge side evaporator 20 and in the suction side evaporator 23, As a result, the ejector-type refrigerant cycle device can be stably operated.

(E) Because the middle-pressure refrigerant joined at the join portion 16 can be drawn to the first compression portion 11*a*, the compression operation amount of the first compression portion 11*a* while the refrigerant is compressed in isoentropy can, be decreased as compared with a case where only the discharge refrigerant of the second compression portion 21*a* is drawn, thereby improving the COP.

(F) Because the refrigerant decompressed by the first fixed throttle 17 is in the gas-liquid two-phase state (point $g_2$), gas-liquid two-phase refrigerant can flow into the nozzle portion 19*a* of the ejector 19. Thus, it is compared with a case where the liquid refrigerant flows into the nozzle portion 19*a*, boiling of the refrigerant in the nozzle portion 19*a* can be facilitated, thereby improving the nozzle efficiency.

Thus, a recovery energy amount is increased, and a pressure increasing amount is increased in the diffuser portion 19*c*, thereby improving the COP. Furthermore, it is compared with the case there the liquid refrigerant flows into the nozzle portion 19*a*, the refrigerant passage area of the nozzle portion 19*a* can be enlarged, and thereby the processing of the nozzle portion 19*a* can be made easy. As a result, the product cost of the ejector 19 can be decreased, thereby reducing the product cost in the entire of the ejector-type refrigerant cycle device 100.

(2nd Embodiment)

Figure 3:
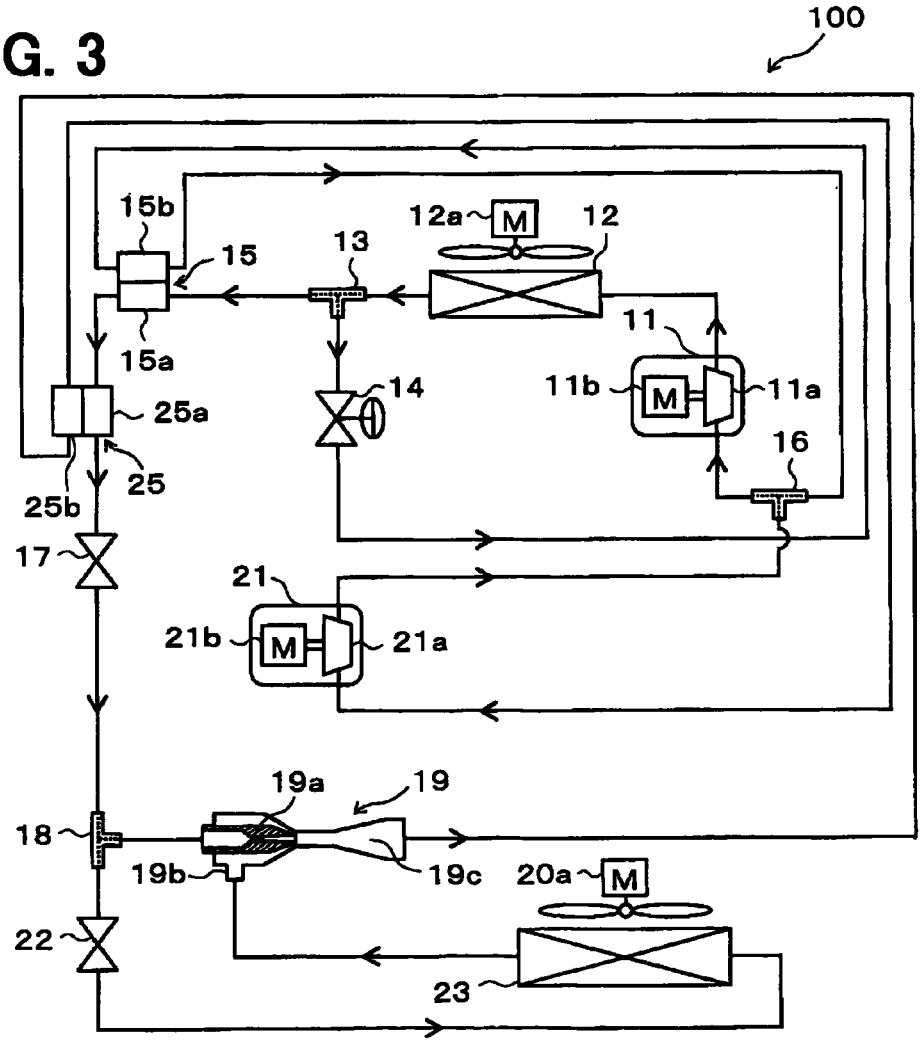
FIG. 3 is an entire schematic diagram of an ejector-type refrigerant cycle device according to a 2nd embodiment of the invention.

As shown by the entire schematic diagram of FIG. 3, the present embodiment describes regarding an example in which an auxiliary inner heat exchanger 25 is added and the discharge side evaporator 20 is removed, with respect to the ejector-type refrigerant cycle device 100 of the 1st embodiment. In the example of FIG. 3, the same parts or corresponding parts with the 1st embodiment are indicated by the same reference numbers. The following figures are indicated by the same way.

The basic structure of the auxiliary inner heat exchanger 25 of the present embodiment is the same as that of the inner heat exchanger 15 of the 1st embodiment. The auxiliary inner heat exchanger 25 is configured to perform heat exchange between the refrigerant passing through a high-pressure side refrigerant passage 25*a*, having passed through the inner heat exchanger 15 from the first branch portion 13, and the refrigerant passing through a low-pressure side refrigerant passage 25*b*, from the diffuser portion 19*c* of the ejector 19.

The refrigerant passing through the high-pressure side refrigerant passage 25*a* in the present embodiment is the refrigerant flowing through a refrigerant passage from an outlet side of the high-pressure side refrigerant passage 15*a* of the inner heat exchanger 15 toward the first fixed throttle 17. Thus, the refrigerant flowing toward the inner heat exchanger 15 from the first branch portion 13 flows in this order of the inner heat exchanger 15→the auxiliary inner heat exchanger 25→the first fixed throttle 17. The other configurations are the same as those in the 1st embodiment.

Operation of the present embodiment with the above structure will be described based on the Mollier diagram of FIG. 4. Regarding the signs indicating the refrigerant states in FIG. 4, the same refrigerant states as in FIG. 2 are indicated by using the same alphabets, but the additional signs behind the alphabets are only changed based on the figure numbers. The same is adapted for the Mollier diagrams in the following embodiments.

Figure 4:
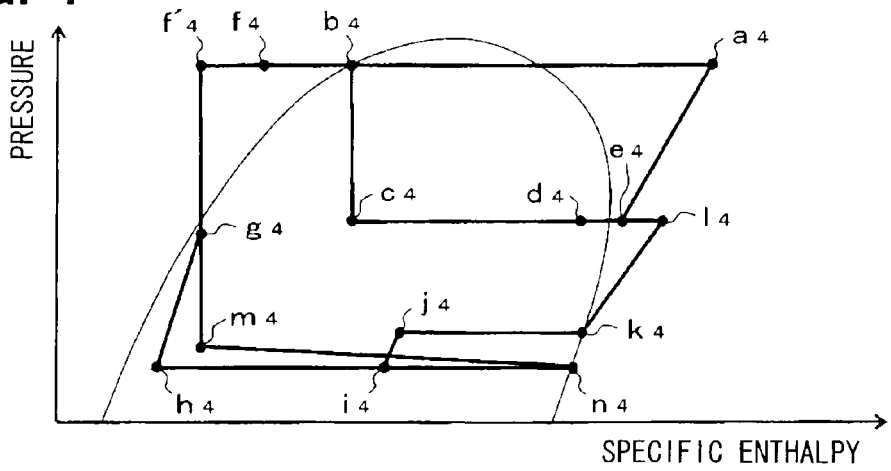
FIG. 4 is a Mollier diagram showing a refrigerant state in the ejector-type refrigerant cycle device according to the 2nd embodiment.

When the ejector-type refrigerant cycle device 100 of the present embodiment is operated, the refrigerant flowing out of the diffuser portion 19*c* is evaporated in the low-pressure side refrigerant passage 25*b* of the auxiliary inner heat exchanger 25, thereby increasing the enthalpy of the refrigerant drawn into the second compressor 21 (point $j_4$→point $k_4$; in FIG. 4). Furthermore, the refrigerant flowing out of the high-pressure side refrigerant passage 15*a* of the inner heat exchanger 15 is further radiated in the high-pressure side refrigerant passage 25*a* of the inner heat exchanger 25, thereby further reducing the enthalpy (point $f_4$→point $f'_4$, in FIG. 4).

The other operations of the present embodiment are similar to those of the above-described 1st embodiment. Thus, in the present embodiment, the cooling action can be achieved in the suction side evaporator 23 while the same effects as in (B)-(F) of the above-described 1st embodiment can be obtained. Furthermore, by the operation of the auxiliary inner heat exchanger 25, the enthalpy of the refrigerant flowing into the suction side evaporator 23 is reduced, and the refrigerating capacity obtained in the suction side evaporator 23 can be increased, thereby further improving the COP.

In the present embodiment, the refrigerant flowing from the first branch portion 13 toward the inner heat exchanger 15 flows in this order of the inner heat exchanger 15→the auxiliary inner heat exchanger 25→the first fixed throttle 17, and thereby the enthalpy of the refrigerant flowing to the suction side evaporator 23 can be reduced. The reason is that the temperature of a low-pressure refrigerant flowing through the low-pressure side refrigerant passage 25*b* of the auxiliary inner heat exchanger 25 is lower than a middle-pressure refrigerant flowing through the middle-pressure side refrigerant passage 15*b* of the inner heat exchanger 15.

In a case where a temperature difference between the middle pressure refrigerant and the low-pressure refrigerant becomes smaller, the refrigerant flowing from the first branch portion 13 toward the inner heat exchanger 15 may be set to flow in this order of the high-pressure side refrigerant passage 25*a* of the auxiliary inner heat exchanger 25→the high-pressure side refrigerant passage 15*a* of the inner heat exchanger 15→the first fixed throttle 17.

(3rd Embodiment)

Figure 5:
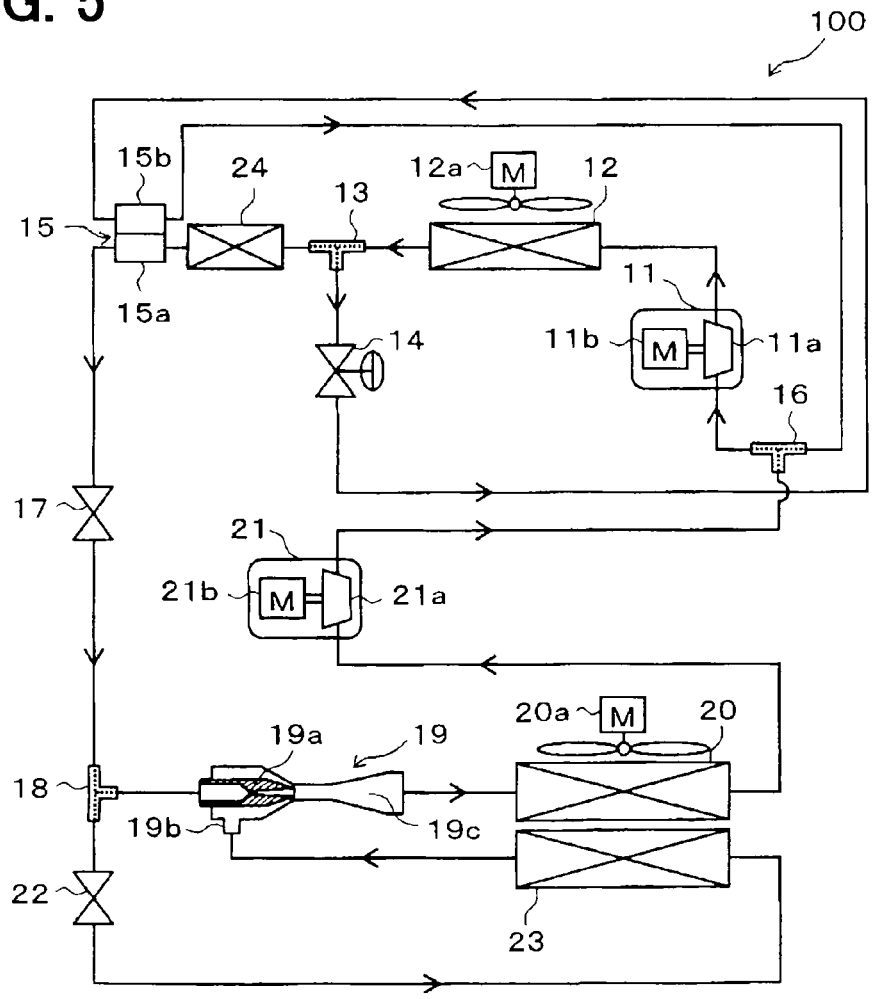
FIG. 5 is an entire schematic diagram of an ejector-type refrigerant cycle device according to a 3rd embodiment of the invention.

As shown by the entire schematic diagram of FIG. 5, the present embodiment describes regarding an example in which an auxiliary radiator 24 is added, with respect to the ejector-type refrigerant cycle device 100 of the 1st embodiment. The auxiliary radiator 24 is a heat-radiating heat exchanger in which the high-pressure refrigerant flowing from the first branch portion 13 toward the inner heat exchanger 15 is heat exchanged with air (outside air) outside of the room, blown by the cooling fan 12*a*, thereby further cooling the high-pressure refrigerant.

In FIG. 5, the cooling fan 12*a* is located near the radiator 12 for easily indicating in the figure, however, the cooling fan 12*a* is configured to blow the outside air to not only the radiator 12 but also to the auxiliary radiator 24. The radiator 12 and the auxiliary radiator 24 may be configured to blow air outside the room of the refrigerator by using respectively independent blower fans.

The radiator 12 of the present embodiment can be made to reduce its heat-exchange capacity by reducing its heat exchanging area, relative to the present embodiment. Furthermore, as shown in FIG. 5, in the present embodiment, the refrigerant flowing from the first branch portion 13 toward the inner heat exchanger 15 flows in this order of the auxiliary radiator 24→the inner heat exchanger 15→the first fixed throttle 17.

The first branch portion 13 of the present embodiment is configured such that the flow amount of the refrigerant flowing toward the auxiliary radiator 24 is larger than the flow amount of the refrigerant flowing toward the thermal expansion valve 14. The above adjustment of the flow amounts can be performed by adjusting the refrigerant passage areas and the like in respective refrigerant passages in the first branch portion 13. The other configurations of the present embodiment are similar to those in the 1st embodiment.

Figure 6:
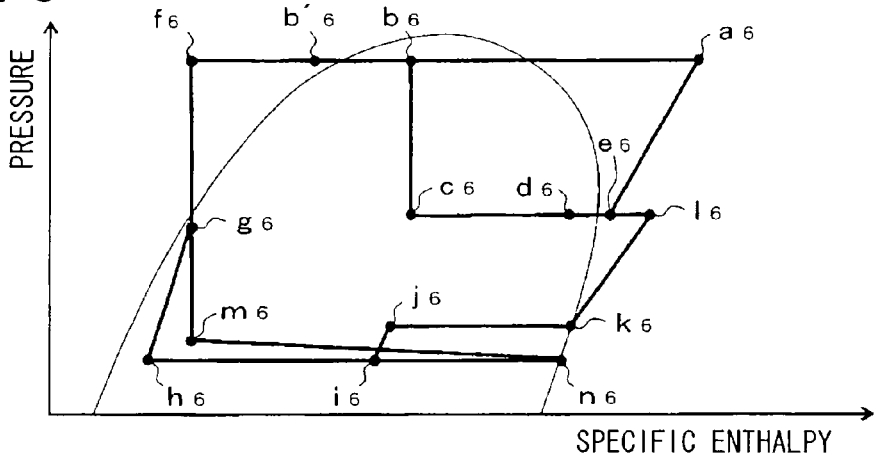
FIG. 6 is a Mollier diagram showing a refrigerant state in the ejector-type refrigerant cycle device according to the 3rd embodiment.

Operation of the present embodiment will be described based on the Mollier diagram of FIG. 6. In the present embodiment, the discharge refrigerant (point $a_6$, in FIG. 6) of the first compressor 11 is radiated and condensed in the radiator 12 to become in a gas-liquid two-phase state (point $a_6$→point $b_6$). It is because the heat exchanging capacity of the radiator 12 is decreased with respect to the 1st embodiment.

The high-pressure refrigerant flowing out of the radiator 12 flows into the first branch portion 13, and is branched into a flow of the refrigerant flowing toward the thermal expansion valve 14 and a flow of the refrigerant flowing toward the auxiliary radiator 24 in the first branch portion 13. The refrigerant flowing toward the auxiliary radiator 24 flows in this order of the auxiliary radiator 24→the high-pressure side refrigerant passage 15*a* of the inner heat exchanger 15*a*, thereby further reducing the enthalpy of the refrigerant (point $b_6$→point $b'_6$→point $f_6$).

The other operations of the present embodiment are similar to those of the above-described 1st embodiment. Thus, in the present embodiment, the same effects as in (A)-(F) of the above-described 1st embodiment can be obtained. At the same time, by the operation of the auxiliary radiator 24, the enthalpy of the refrigerant flowing into the suction side evaporator 23 can be reduced, and the refrigerating capacity obtained by the suction side evaporator 23 and the discharge side evaporator 20 can be increased.

Furthermore, the flow amount of the refrigerant flowing toward the auxiliary radiator 24 from the first branch portion 13 is set to be larger than the flow amount of the refrigerant flowing toward the thermal expansion valve 14, the refrigerant flow amounts supplied to the suction side evaporator 23 and the discharge side evaporator 20 can be increased. As a result, the refrigerating capacity obtained by the suction side evaporator 23 and the discharge side evaporator 20 can be increased.

In the present embodiment, the refrigerant flowing from the first branch portion 13 toward the inner heat exchanger 15 flows in this order of the auxiliary radiator 24→the high-pressure side refrigerant passage 15*a* of the inner heat exchanger 15→the first fixed throttle 17. Therefore, the enthalpy of the refrigerant flowing into the suction side evaporator 23 can be effectively decreased. The reason is that the temperature of air outside the room, to be heat-exchanged with the refrigerant in the auxiliary radiator 24, is higher than the middle-pressure refrigerant flowing through the middle-pressure side refrigerant passage 15*b* of the inner heat exchanger 15.

In a case where a temperature difference between the middle pressure refrigerant and air outside the room of the refrigerator becomes smaller, the refrigerant flowing from the first branch portion 13 toward the inner heat exchanger 15 may be set to flow in this order of the high-pressure side refrigerant passage 15*a* of the inner heat exchanger 15→the auxiliary radiator 24→the first fixed throttle 17.

(4th Embodiment)

Figure 7:
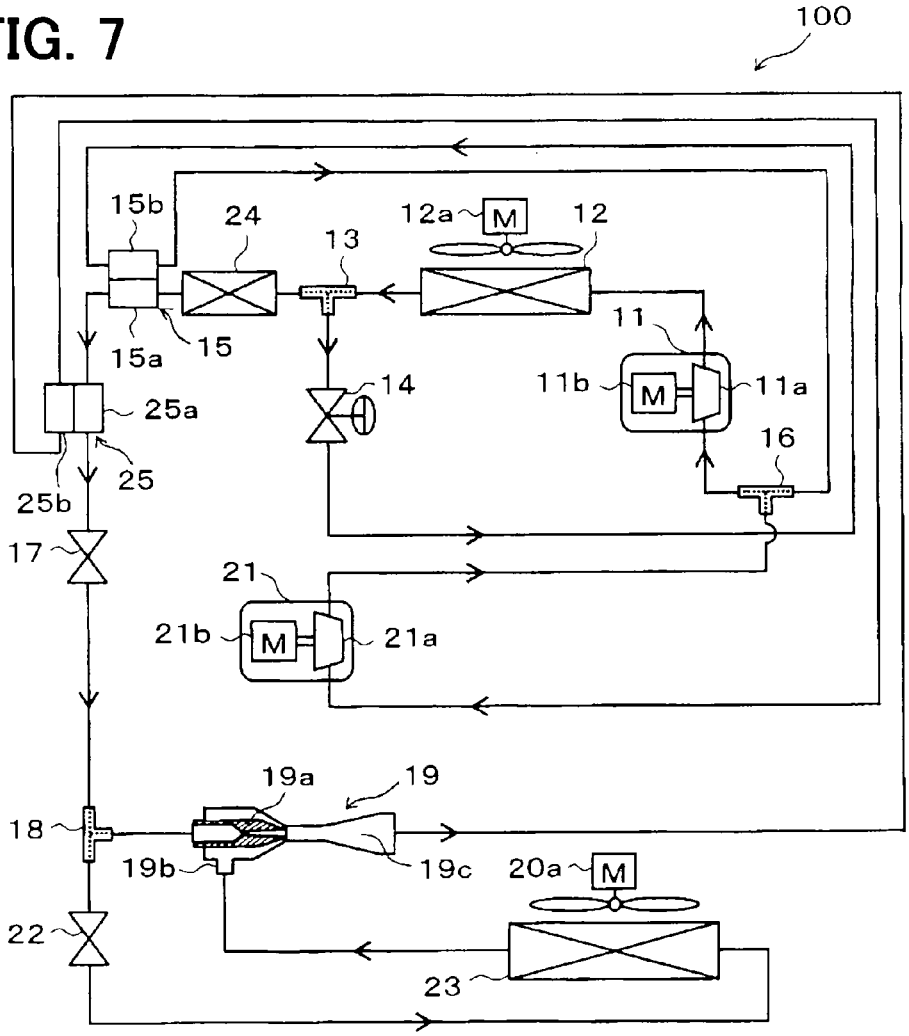
FIG. 7 is an entire schematic diagram of an ejector-type refrigerant cycle device according to a 4th embodiment of the invention.

As shown by the entire schematic diagram of FIG. 7, the present embodiment describes regarding an example in which the auxiliary inner heat exchanger 25 similar to the 2nd embodiment is added and the discharge side evaporator 20 is removed, with respect to the ejector-type refrigerant cycle device 100 of the 2nd embodiment.

In the present embodiment, the refrigerant flowing toward the inner heat exchanger 15 from the first branch portion 13 flows in this order of the auxiliary radiator 24→the inner heat exchanger 15→the auxiliary inner heat exchanger 25→the first fixed throttle 17. The other configurations are the same as those in the 3rd embodiment.

Figure 8:
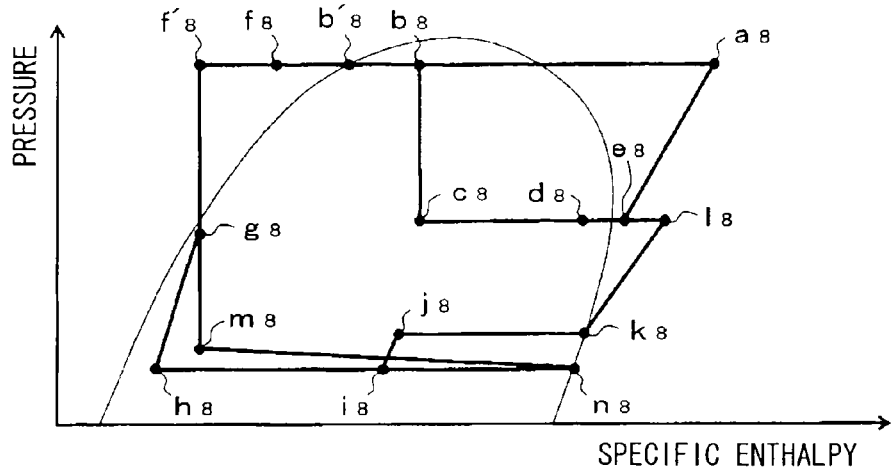
FIG. 8 is a Mollier diagram showing a refrigerant state in the ejector-type refrigerant cycle device according to the 4th embodiment.

Operation of the present embodiment with the above structure will be described based on the Mollier diagram of FIG. 8. In the present embodiment, the high-pressure refrigerant flowing out of the radiator 12 is branched in the first branch portion 13 into the flow of the refrigerant flowing toward the thermal expansion valve 14 and the flow of the refrigerant flowing toward the auxiliary radiator 24.

The refrigerant flowing from the first branch portion 13 toward the auxiliary radiator 24 flows in this order of the auxiliary radiator 24→the high-pressure side refrigerant passage 15*a* of the inner heat exchanger 15*a*, thereby further reducing the enthalpy of the refrigerant (point $b_8$→point $b'_8$→point $f_8$ in FIG. 8), similar to the 3rd embodiment.

Similarly to the 2nd embodiment, the refrigerant flowing out of the diffuser portion 19*c* is evaporated in the low-pressure side refrigerant passage 25*b* of the auxiliary inner heat exchanger 25, thereby increasing the enthalpy of the refrigerant drawn into the second compressor 21 (point $j_8$→point $k_8$). Furthermore, the refrigerant flowing out of the high-pressure side refrigerant passage 15*a* of the inner heat exchanger 15 is further radiated in the high-pressure side refrigerant passage 25*a* of the inner heat exchanger 25, thereby reducing the enthalpy (point $f_8$→point $f'_8$).

The other operations of the present embodiment are similar to those of the above-described 3rd embodiment. Thus, in the present embodiment, the cooling action can be achieved in the suction side evaporator 23 while the same effects as in (B)-(F) of the above-described 1st embodiment can be obtained. Furthermore, by the operation of the auxiliary radiator 24 and the auxiliary inner heat exchanger 25, the enthalpy of the refrigerant flowing into the suction side evaporator 23 is reduced, and the refrigerating capacity obtained in the suction side evaporator 23 can be increased, thereby further improving the COP.

In the present embodiment, the refrigerant flowing from the first branch portion 13 toward the inner heat exchanger 15 flows in this order of the auxiliary radiator 24→the inner heat exchanger 15→the auxiliary inner heat exchanger 25→the first fixed throttle 17, and thereby the enthalpy of the refrigerant flowing to the suction side evaporator 23 can be effectively reduced, similarly to the second and 3rd embodiments.

(5th Embodiment)

Figure 9:
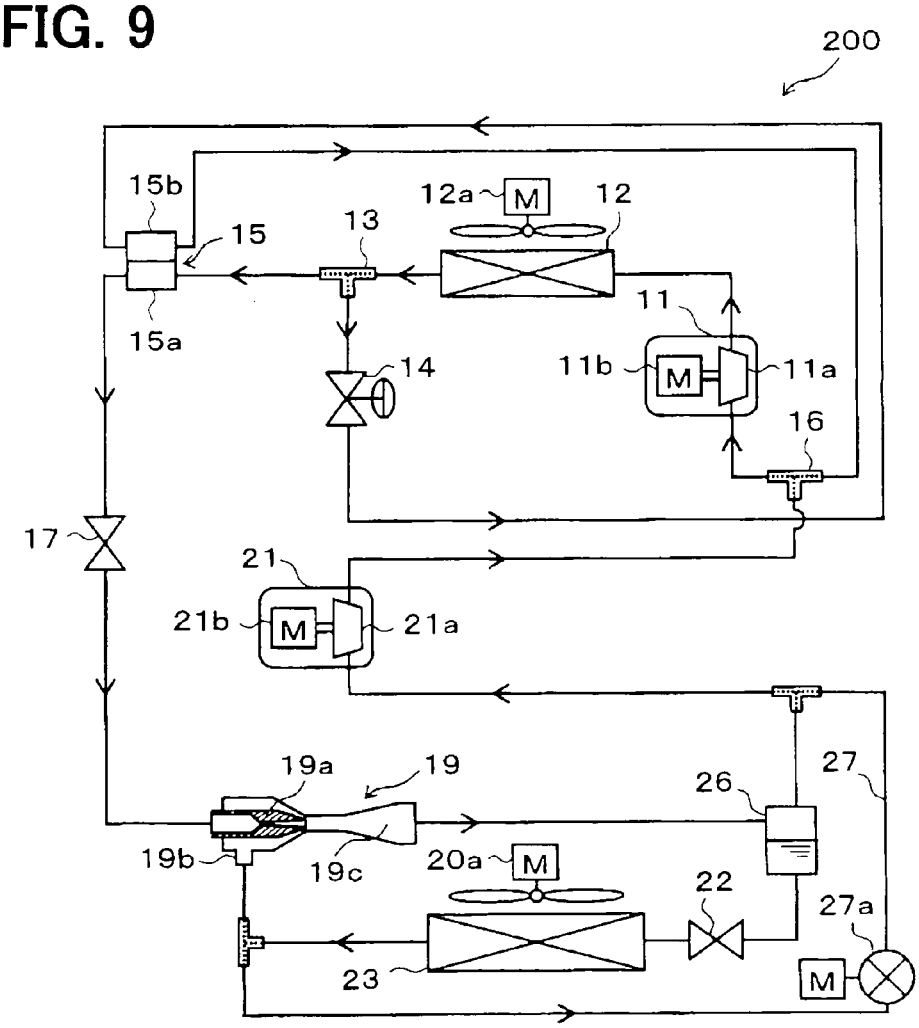
FIG. 9 is an entire schematic diagram of an ejector-type refrigerant cycle device according to a 5th embodiment of the invention.
Figure 10A:
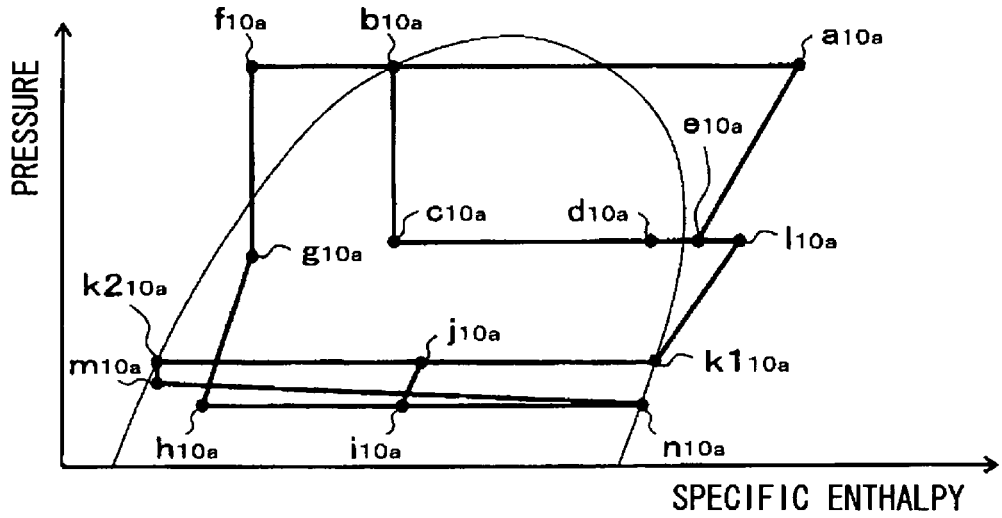
FIG. 10A is a Mollier diagram showing a refrigerant state in a general operation mode according to the 5th embodiment.
Figure 10B:
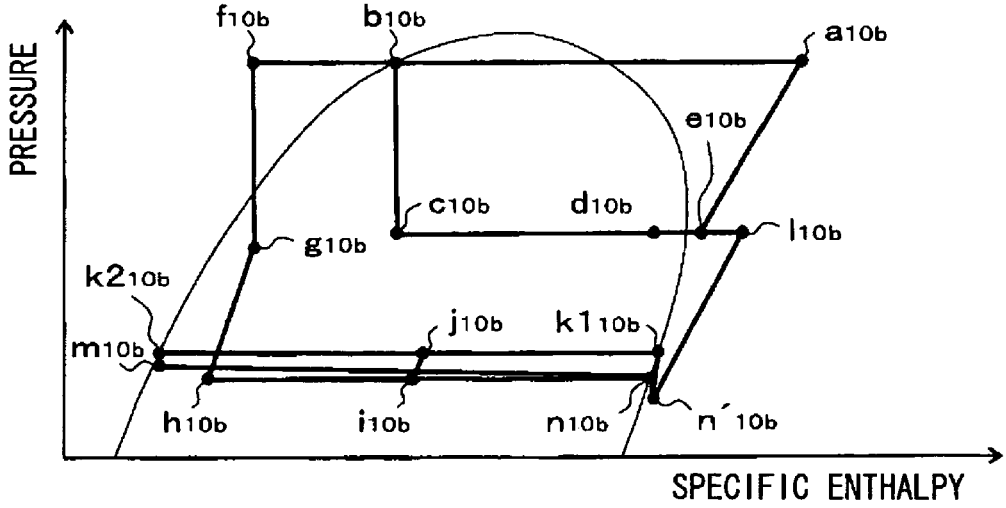
FIG. 10B is a Mollier diagram showing a refrigerant state in an oil returning operation mode according to the 5th embodiment.

An example, in which an ejector-type refrigerant cycle device 200 of the present invention is applied to a refrigerator similarly to the 1st embodiment, will be described with reference to FIGS. 9, 10A and 10B. FIG. 9 is an entire schematic diagram of the ejector-type refrigerant cycle device 200 of the present embodiment. In the ejector-type refrigerant cycle device 200 of the present embodiment, components and connection states, that is, cycle configurations, are changed with respect to the ejector-type refrigerant cycle device 100 of the 1st embodiment.

As shown in FIG. 9, in the present embodiment, the second branch portion 18 is removed, so that the total flow amount of the refrigerant flowing out of the first fixed throttle 17 flows into the nozzle portion 19*a* of the ejector 19, as compared with the ejector-type refrigerant cycle device 100 of the 1st embodiment that is the pre-condition of the present embodiment. Furthermore, the discharge side evaporator 20 is removed, and an accumulator 26 as a discharge side gas-liquid separator is located at a refrigerant outlet side of the diffuser portion 19*c* of the ejector 19 so as to separate the refrigerant flowing out of the diffuser portion 19*c* of the ejector 19 into gas refrigerant and liquid refrigerant and to store a surplus refrigerant in the refrigerant cycle.

The refrigerant suction port of the second compressor 21 is connected to a gas-refrigerant outlet of the accumulator 26, and the second fixed throttle 22 is connected to a liquid refrigerant outlet of the accumulator 26. Furthermore, the refrigerant inlet side of the suction side evaporator 23 is connected to the refrigerant outlet side of the second fixed throttle 22. Furthermore, in the present embodiment, an oil return passage 27 is provided to be connected to a refrigerant outlet side of the suction side evaporator 23 and the refrigerant suction side of the second compressor 21.

The oil return passage 27 is a passage through which a refrigerator oil is returned from the refrigerant outlet side of the suction side evaporator 23 to the refrigerant suction port of the second compressor 21. Furthermore, an opening/closing valve 27*a* for opening or closing the oil return passage 27 is provided in the oil return passage 27. The opening/closing valve 27*a* is an electromagnetic valve in which its opening or closing operation is controlled by a control voltage output from the control device.

Furthermore, a refrigerant passage area of the opening/closing valve 27*a*, when the opening/closing valve 27*a* is opened, is formed to be smaller than a refrigerant passage area of the oil return passage 27. Thus, the refrigerant passing through the oil return passage 27 is decompressed while passing through the opening/closing valve 27*a*. The other configurations are similar to those of the above-described 1st embodiment.

Operation of the present embodiment with the above structure will be described based on the Mollier diagram of FIGS. 10A and 10B. In the ejector-type refrigerant cycle device 200 of the present embodiment, a general operation mode for cooling the room of the refrigerator and an oil returning operation mode are selectively switched every a predetermined time. In the oil returning operation mode, the refrigerator oil is returned to the second compressor 21 while the room of the refrigerator is cooled. FIG. 10A is the Mollier diagram in the general operation mode, and FIG. 10B is the Mollier diagram in the oil returning operation mode.

In the general operation mode, the control device causes the first and second electrical motors 11*b*, 21*b*, the cooling fan 12*a*, the blower fan 20*a* to be operated. Furthermore, the control device causes the opening/closing valve 27*a* to be in a valve closing state.

Thus, the refrigerant (point $a_{10a}$ in FIG. 10A) discharged from the first compressor 11 is cooled in the radiator 12, and is branched by the first branch portion 13. Similarly to the 1st embodiment, the refrigerant flowing toward the thermal expansion valve 14 from the first branch portion 13 flows in this order of the thermal expansion valve 14→the inner heat exchanger 15→the join portion 16→the first compressor 11 (point $b_{10a}$→point $c_{10a}$→point $d_{10a}$→point $e_{10a}$).

The refrigerant from the first branch portion 13 toward the high-pressure side refrigerant passage 15*a* of the inner heat exchanger 15 flows in this order of the high-pressure side refrigerant passage 15*a* of the inner heat exchanger 15→the first fixed throttle 17 (point $b_{10a}$→point $f_{10a}$→point $g_{10a}$) similarly to the 1st embodiment, and then all the flow amount of the refrigerant flowing out of the first fixed throttle 17 flows into the nozzle portion 19*a* of the ejector 19.

The refrigerant flowing into the nozzle portion 19*a* of the ejector 19 is decompressed and expanded by the nozzle portion 19*a* in iso-entropy (point $g_{10a}$→point $h_{10a}$). Similarly to the 1st embodiment, the jet refrigerant jetted from the nozzle portion 19*a* and the suction refrigerant drawn from the refrigerant suction port 19*b* are mixed in the diffuser portion 19*c* of the ejector 19 (point $h_{10a}$→point $i_{10a}$, point $n_{10a}$→point $i_{10a}$), and are pressurized in the diffuser portion 19*c* (point $i_{10a}$→point $j_{10a}$).

The refrigerant flowing out of the diffuser portion 19*c* is separated into gas refrigerant and liquid refrigerant in the accumulator 26 (point $j_{10a}$→point $k1_{10a}$, point $j_{10a}$→point $k2_{10a}$). The refrigerant flowing out of the gas refrigerant outlet of the accumulator 26 is drawn into the second compressor 21, and is compressed to a middle pressure (point $k1_{10a}$→point $l_{10a}$).

At this time, the control device controls operation of the second electrical motor 21*b* of the second compressor 21, so that the refrigerant downstream of the ejector 19 is drawn by the suction action of the second compressor 21, thereby securing the drive flow of the ejector 19. Furthermore, the operation of the first electrical motor 11*b* of the first compressor 11 is controlled so as to prevent a high-pressure side refrigerant pressure of the refrigerant cycle, that is, the discharge refrigerant pressure of the first compressor 11, from being unnecessarily increased in accordance with the refrigerant discharge capacity of the second compressor 21.

The refrigerant discharged from the second compressor 21 is joined with the refrigerant flowing out of the middle-pressure side refrigerant passage 15*b* of the inner heat exchanger 15 in the join portion 20 (point $l_{10a}$→point $e_{10a}$), and then is drawn into the first compressor 11.

The refrigerant flowing into the second fixed throttle 22 from the liquid refrigerant outlet of the accumulator 26 is decompressed and expanded in iso-enthalpy to become to a low-pressure refrigerant (point $k2_{10a}$→point $m_{10a}$). The low-pressure refrigerant decompressed and expanded by the second fixed throttle 22 flows into the suction side evaporator 23, and is evaporated by absorbing heat from air blown by the blower fan 20*a* into the refrigerator (point $m_{10a}$→point $n_{10a}$). Thus, the room of the refrigerator is cooled.

The entire flow amount of the refrigerant flowing out of the suction side evaporator 23 is drawn into the ejector 19 from the refrigerant suction port 19*b* (point $n_{10a}$→point $i_{10a}$), because the opening/closing valve 27*a* becomes in the valve-close state.

Next, the oil returning operation mode will be described. The oil returning operation mode is performed when the general operation mode is continuously performed for a first predetermined time. Then, the oil returning operation mode is performed for a second predetermined time. Here, the second predetermined time is set to be sufficiently shorter than the first predetermined time.

In the oil returning operation mode, the control device causes the opening/closing valve 27*a* to be opened so as to increase the refrigerant discharge capacity of the second compressor 21. Thus, as shown in the Mollier diagram of FIG. 10B, a part of the refrigerant flowing out of the suction side evaporator 23 flows into the oil return passage 27 by the suction action of the second compressor 21.

The refrigerant flowing into the oil return passage 27 reduces its pressure while passing through the opening/closing valve 27*a* (point $n_{10b}$→point $n'_{10b}$), and is drawn into the second compressor 21 (point $n'_{10b}$). Thus, the refrigerator oil flowing into the suction side evaporator 23 together with the refrigerant is drawn into the second compressor 21.

Because the ejector-type refrigerant cycle device 200 of the present embodiment is operated above, the cooling action can be exerted in the suction side evaporator 23, the same effects as (B), (C), (E) and (F) of the 1st embodiment can be effectively obtained.

(G) Furthermore, in the present embodiment, because the oil return passage 27 and the opening/closing valve 27*a* are provided, the oil returning operation mode can be performed. As a result, even when the refrigerator oil for lubricating the first and second compression portions 11*a*, 21*a* is mixed in the refrigerant, it can prevent the refrigerator oil from staying in the suction side evaporator 23. Therefore, the ejector-type refrigerant cycle device can be stably operated.

In the present embodiment, the opening/closing valve 27*a* is provided in the oil return passage 27. However, instead of the opening/closing valve 27*a*, an oil-returning check valve for only allowing a flow from a side of the suction side evaporator 23 to a side of the second compressor 21 may be provided.

(6th Embodiment)

Figure 11:
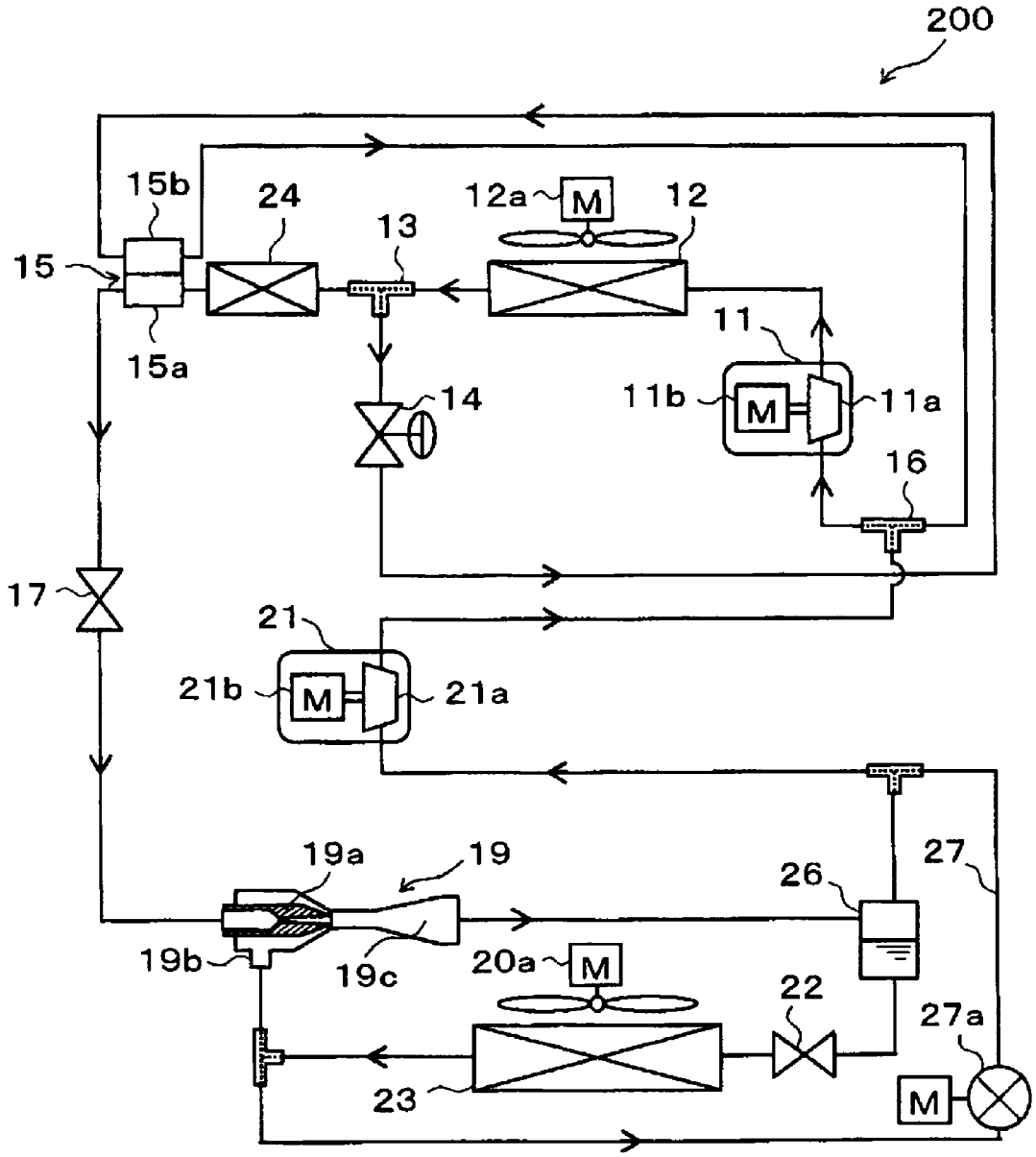
FIG. 11 is an entire schematic diagram of an ejector-type refrigerant cycle device according to a 6th embodiment of the invention.

As shown by the entire schematic diagram of FIG. 11, in the present embodiment, the discharge side evaporator 20 and the auxiliary radiator 24 as in that of the 3rd embodiment are added, with respect to the ejector-type refrigerant cycle device 200 of the 5th embodiment.

The present embodiment is configured, such that the heat exchanging capacity of the radiator 12 is reduced, and the flow amount of the refrigerant flowing toward the auxiliary radiator 24 is made larger than the flow amount of the refrigerant flowing toward the thermal expansion valve 14, as compared with the 5th embodiment. The other configurations are similar to those of the 5th embodiment.

Figure 12A:
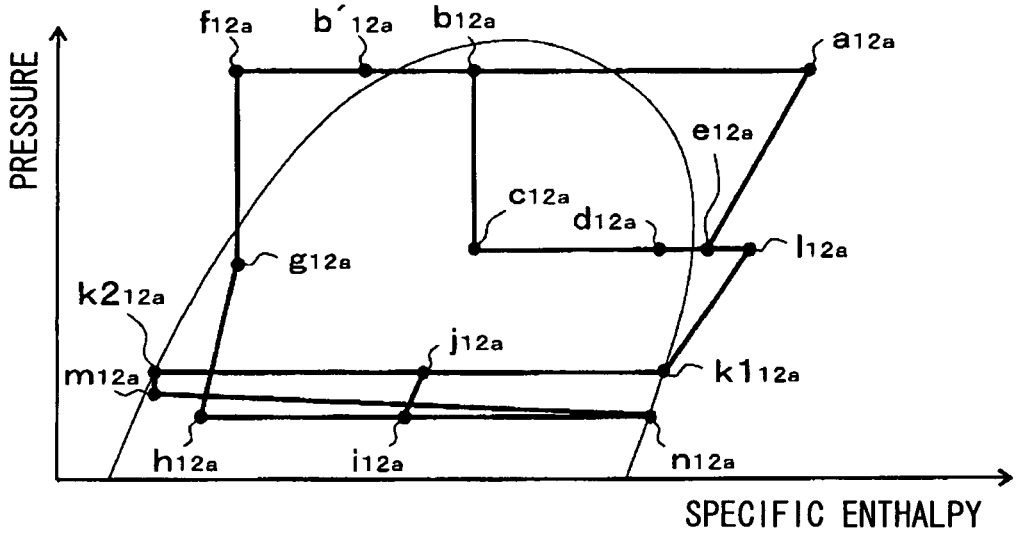
FIG. 12A is a Mollier diagram showing a refrigerant state in a general operation mode according to the 6th embodiment.
Figure 12B:
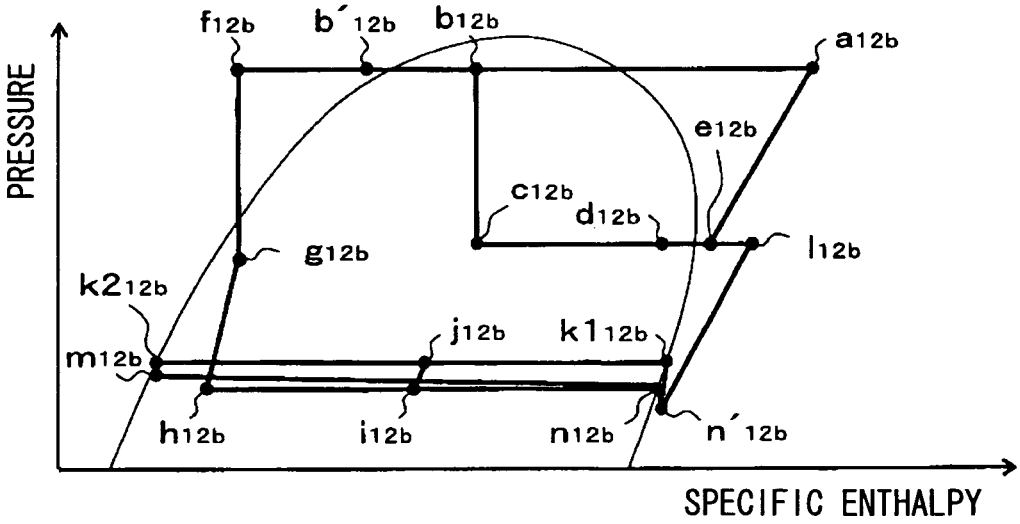
FIG. 12B is a Mollier diagram showing a refrigerant state in an oil returning operation mode according to the 6th embodiment.

When the ejector-type refrigerant cycle device 200 is operated, as in the Mollier diagram of FIGS. 12A,12B, in each operation mode of the general operation mode and the oil returning operation mode, the refrigerant flowing from the first branch portion 13 toward the auxiliary radiator 24 flows in this order of the auxiliary radiator 24→the high-pressure side refrigerant passage 15*a* of the inner heat exchanger 15, thereby reducing the enthalpy of the refrigerant (point $b_{12a}$→point $b'_{12a}$→point $f_{12a}$).

Furthermore, the refrigerant flowing out of the diffuser portion 19*c* flows into the discharge side evaporator 20, and is evaporated by absorbing heat from the interior air blown and circulated by the blower fan 20*a* (point $j_{12a}$→point $k1_{12a}$). Thus, the air blown into the room of the refrigerator is cooled. FIG. 12A is the Mollier diagram of the general operation mode, and FIG. 12B is the Mollier diagram of the oil returning operation mode. The other operation of the present embodiment is similar to that of the 5th embodiment.

Thus, in the present embodiment, the effects similar to those of the 5th embodiment can be obtained. Furthermore, similarly to the 3rd embodiment, the enthalpy of the refrigerant flowing into the suction side evaporator 23 can be reduced by the operation of the auxiliary radiator 24, and thereby the refrigerating capacity obtained in the suction side evaporator 23 and the discharge side evaporator 20 can be increased.

Furthermore, because the flow amount of the refrigerant flowing toward the auxiliary radiator 24 from the first branch portion 13 is adjusted to be larger than the flow amount of the refrigerant flowing toward the thermal expansion valve 14, the flow amount of the refrigerant supplied to the suction side evaporator 23 and the discharge side evaporator 20 can be increased. As a result, the refrigerating capacity obtained in the suction side evaporator 23 and the discharge side evaporator 20 can be increased.

(7th Embodiment)

Figure 13:
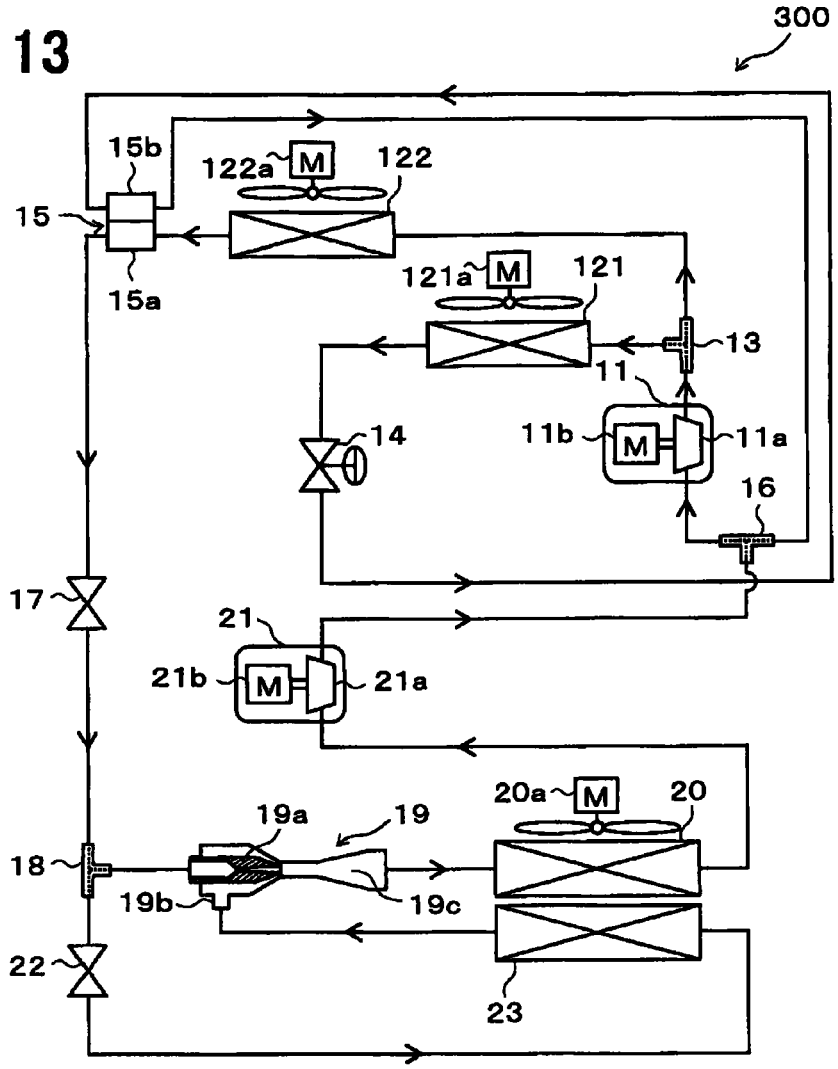
FIG. 13 is an entire schematic diagram of an ejector-type refrigerant cycle device according to a 7th embodiment of the invention.
Figure 14:
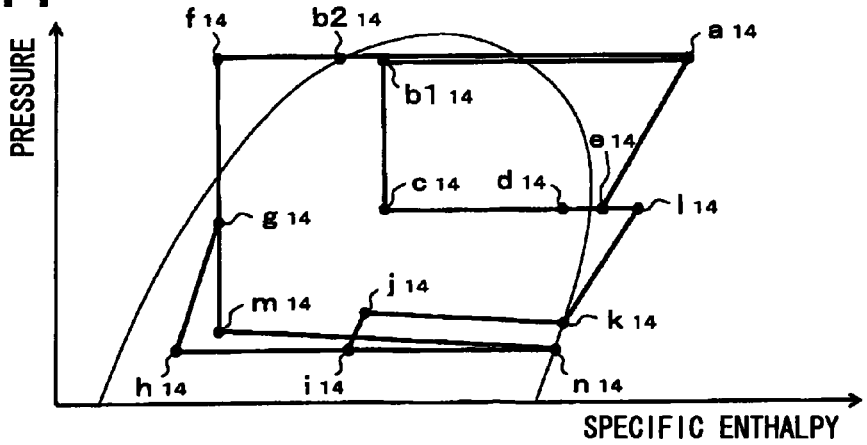
FIG. 14 is a Mollier diagram showing a refrigerant state in the ejector-type refrigerant cycle device according to the 7th embodiment.

An example, in which an ejector-type refrigerant cycle device 300 of the present invention is applied to a refrigerator similarly to the 1st embodiment, will be described with reference to FIGS. 13, 14. FIG. 13 is an entire schematic diagram of an ejector-type refrigerant cycle device 300 of the present embodiment. In the ejector-type refrigerant cycle device 300 of the present embodiment, components and connection states, that is, cycle configurations, are changed with respect to the ejector-type refrigerant cycle device 100 of the 1st embodiment.

As shown in FIG. 13, in the present embodiment, the first branch portion 13 is arranged at the refrigerant discharge side of the first compressor 11. A first radiator 121 is connected to one of the refrigerant outlets of the first branch portion 13, and a second radiator 122 is connected to the other one of the refrigerant outlets of the first branch portion 13.

The first radiator 121 is a heat-radiating heat exchanger, in which high-pressure refrigerant flowing out of one of the refrigerant outlets of the first branch portion 13 is heat-exchanged with air (outside air) outside the room of the refrigerator, blown by a cooling fan 121*a*, so that the high-pressure refrigerant is radiated and cooled. The second radiator 122 is a heat-radiating heat exchanger, in which high-pressure refrigerant flowing out of the other one of the refrigerant outlets of the first branch portion 13 is heat-exchanged with air (outside air) outside the room of the refrigerator, blown by a cooling fan 122*a*, so that the high-pressure refrigerant is radiated and cooled.

In the ejector-type refrigerant cycle device 300 of the present embodiment, a heat-exchanging area of the first radiator 121 is made smaller than that of the second radiator 122, so that the heat exchanging capacity (heat radiating performance) of the first radiator 121 is reduced than the heat exchanging capacity (heat radiating performance) of the second radiator 122. Each of the cooling fans 121*a*, 122*a* is an electrical blower in which the rotation speed (i.e., air blowing amount) is controlled by a control voltage output from the control device. In the present embodiment, the cooling fans 121*a*, 122*a* are adapted as a heat-radiating capacity adjusting portion which adjusts the heat radiating capacity of the respective first and second radiators 121, 122.

A thermal expansion valve 14, adapted as a high-pressure side decompression portion similarly to the 1st embodiment, is connected to a refrigerant outlet side of the first radiator 121. Furthermore, a middle-pressure side refrigerant passage 15*b* of an inner heat exchanger 15 having the structure similar to the 1st embodiment is connected to a refrigerant outlet side of the thermal expansion valve 14. The cycle configuration downstream of the middle-pressure side refrigerant passage 15*b* of the inner heat exchanger 15 in the refrigerant flow is similar to the 1st embodiment.

A high-pressure side refrigerant passage 15*a* of the inner heat exchanger 15 is connected to a refrigerant outlet side of the second radiator 122. The cycle configuration downstream of the high-pressure side refrigerant passage 15*a* of the inner heat exchanger 15 in the refrigerant flow is similar to the 1st embodiment.

Next, operation of the present embodiment will be described based on the Mollier diagram of FIG. 14. In the present embodiment, the refrigerant (point $a_{14}$ in FIG. 14) discharged from the first compressor 11 flows into the first branch portion 13, and is branched into the flow of the refrigerant flowing toward the first radiator 121 and the flow of the refrigerant flowing toward the second radiator 122.

The refrigerant flowing into the first radiator 121 is heat exchanged with air (outside air) blown by the cooling fan 121*a*, and is radiated and condensed (point $a_{14}$→point $b1_{14}$). On the other hand, the refrigerant flowing into the second radiator 122 is heat exchanged with air (outside air) blown by the cooling fan 122*a*, and is radiated and condensed (point $a_{14}$→point $b2_{14}$).

At this time, because the heat exchanging capacity of the first radiator 121 is set lower than the heat exchanging capacity of the second radiator 122, the enthalpy of the refrigerant flowing out of the first radiator 121 becomes higher than the enthalpy of the refrigerant flowing out of the second radiator 122.

The refrigerant flowing out of the first radiator 121 is decompressed and expanded in iso-enthalpy by the thermal expansion valve 14 (point $b1_{14}$→point $c_{14}$). On the other hand, the refrigerant flowing out of the second radiator 122 is radiated in the high-pressure side refrigerant passage 15*a* of the inner heat exchanger 15, and the enthalpy of the refrigerant is further reduced (point $b2_{14}$→point $f_{14}$). The other operation of the present embodiment is similar to that of the 1st embodiment.

In the present embodiment, the same effects as in (A)-(C), (E) and (F) of the 1st embodiment can be effectively obtained.

The refrigerant to pass through an evaporator such as the discharge side evaporator 20 and the suction side evaporator 23 flows in this order of the first compressor 11→the first branch portion 13→the second radiator 122→the high-pressure side refrigerant passage 15*a* of the inner heat exchanger 15→the first fixed throttle 17→the second branch portion 18→the ejector 19→the discharge side evaporator 20→the second compressor 21→the join portion 16→the first compressor 11, and, at the same time, flows in this order of the first compressor 11→the first branch portion 13→the second radiator 122→the high-pressure side refrigerant passage 15*a* of the inner heat exchanger 15→the first fixed throttle 17→the second branch portion 18→the second fixed throttle 22→the suction side evaporator 23→the ejector 19→the discharge side evaporator 20→the second compressor 21→the join portion 16→the first compressor 11.

That is, because the flow of the refrigerant passing through the evaporator such as the discharge side evaporator 20 and the suction side evaporator 23 becomes in circular, even when a lubrication oil (refrigerator oil) for the first and second compressors 11, 21 is mixed in the refrigerant, it can prevent the oil from staying in the discharge side evaporator 20 and in the suction side evaporator 23, As a result, the ejector-type refrigerant cycle device can be stably operated.

Furthermore, because the heat-exchanging capacity (heat radiating performance) of the first radiator 121 and the heat-exchanging capacity (heat radiating performance) of the second radiator 122 can be changed independently, the heat exchanging capacity of the second radiator 122 and the heat exchanging capacity (heat absorbing performance) of the suction side evaporator 23 can be easily suited. Thus, the operation of the ejector-type refrigerant cycle device can be made further stable.

(8th Embodiment)

Figure 15:
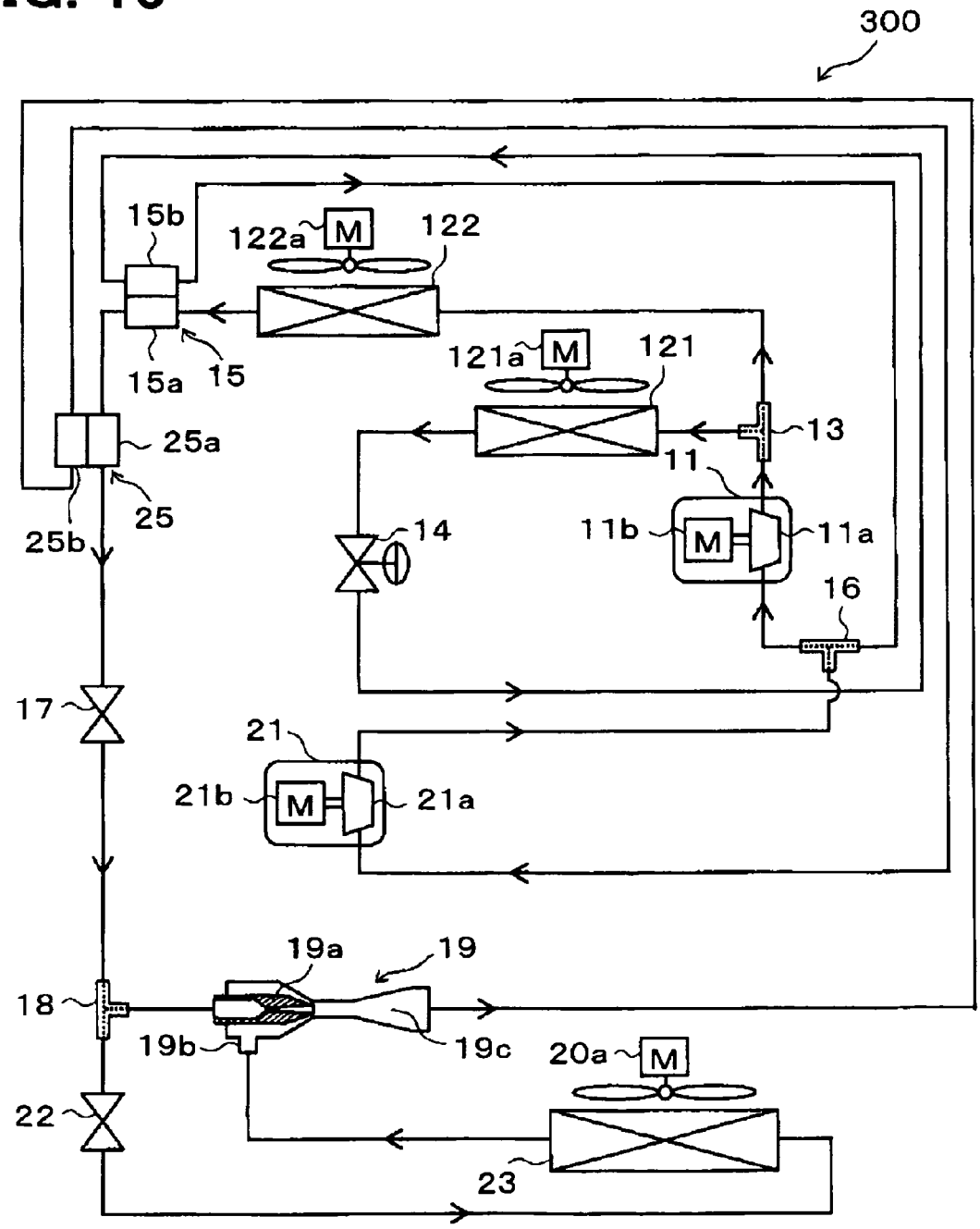
FIG. 15 is an entire schematic diagram of an ejector-type refrigerant cycle device according to an 8th embodiment of the invention.

As shown by the entire schematic diagram of FIG. 15, the present embodiment describes regarding an example in which the auxiliary inner heat exchanger 25 similar to the 2nd embodiment is added and the discharge side evaporator 20 is removed, with respect to the ejector-type refrigerant cycle device 300 of the 7th embodiment.

Figure 16:
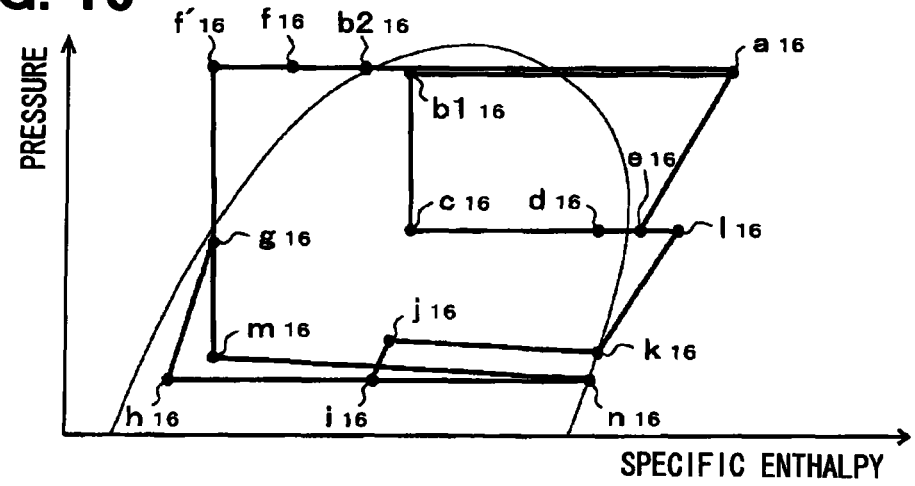
FIG. 16 is a Mollier diagram showing a refrigerant state in the ejector-type refrigerant cycle device according to the 8th embodiment.

When the ejector-type refrigerant cycle device 300 of the present embodiment is operated, as shown in the Mollier diagram of FIG. 16, the refrigerant flowing out of the diffuser portion 19*c* is evaporated in the low-pressure side refrigerant passage 25*b* of the auxiliary inner heat exchanger 25, thereby increasing the enthalpy of the refrigerant drawn into the second compressor 21 (point $j_{16}$→point $k_{16}$).

Furthermore, the refrigerant flowing out of the high-pressure side refrigerant passage 15*a* of the inner heat exchanger 15 is further radiated in the high-pressure side refrigerant passage 25*a* of the auxiliary inner heat exchanger 25, thereby reducing the enthalpy (point $f_{16}$→point $f'_{16}$).

Thus, in the present embodiment, the cooling action can be achieved in the suction side evaporator 23 while the same effects as in (B), (C), (E), (F) of the above-described 1st embodiment can be obtained. Furthermore, similarly to the 7th embodiment, the ejector-type refrigerant cycle device can be stably operated.

(9th Embodiment)

Figure 17:
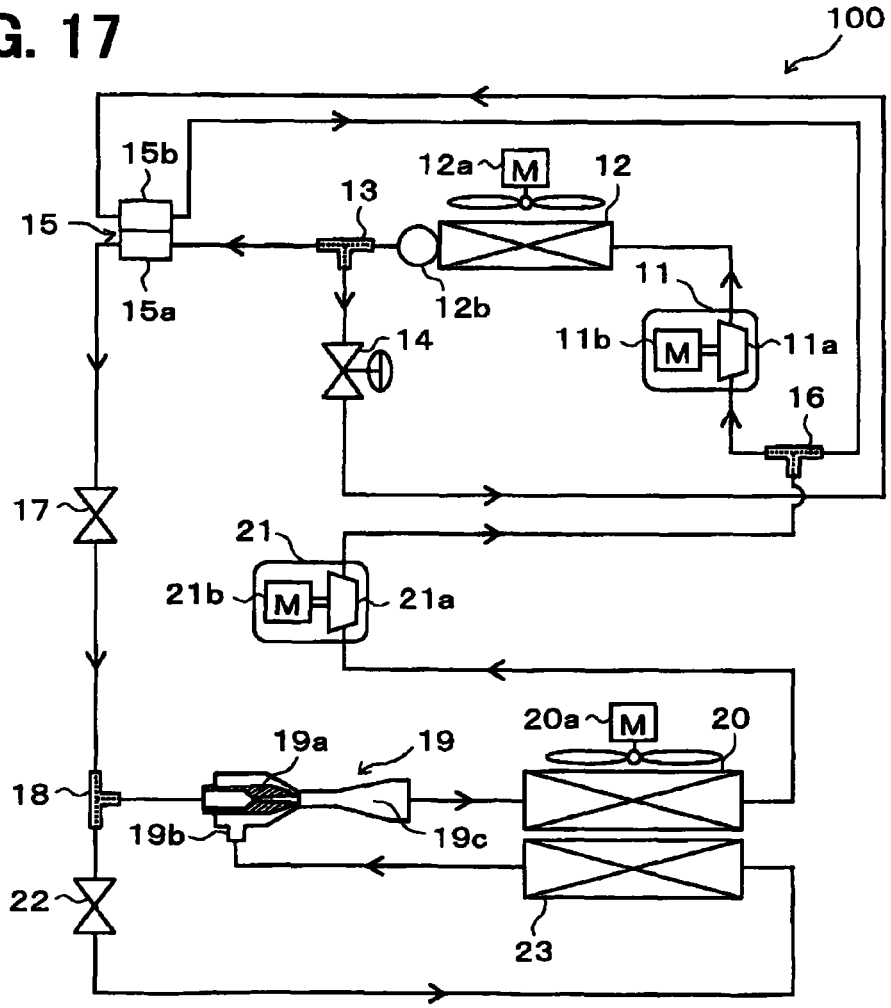
FIG. 17 is an entire schematic diagram of an ejector-type refrigerant cycle device according to a 9th embodiment of the invention.

In the present embodiment, as shown in FIG. 17, a liquid receiver 12*b*, adapted as a high-pressure side gas-liquid separator for separating the refrigerant flowing out of the radiator 12 into gas refrigerant and liquid refrigerant and for storing the surplus refrigerant therein, is located at the refrigerant outlet side of the radiator 12, with respect to the ejector-type refrigerant cycle device 100 of the 1st embodiment. The liquid receiver 12*b* causes the separated saturation liquid refrigerant to be introduced to the first branch portion 13 located downstream of the liquid receiver 12*b*.

According to the present embodiment, even when the load variation in the refrigerant cycle is caused, because the refrigerant to flow into the first branch portion 13 (corresponding to point $b_2$ of FIG. 2 of the 1st embodiment) is the saturation liquid refrigerant, the operation of the refrigerant cycle can be easily made stable.

(10th Embodiment)

Figure 18:
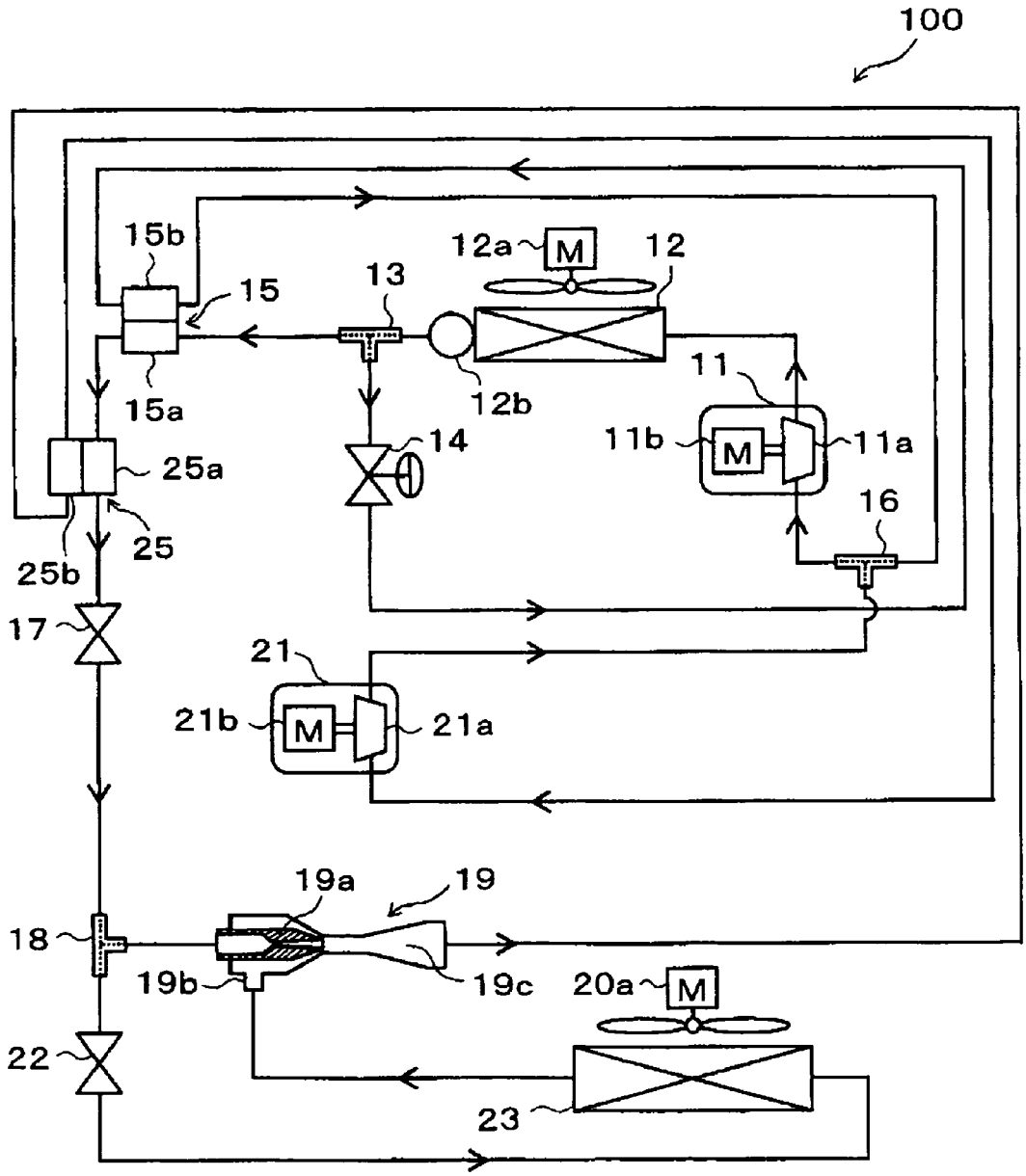
FIG. 18 is an entire schematic diagram of an ejector-type refrigerant cycle device according to a 10th embodiment of the invention.

In the present embodiment, as shown in FIG. 18, a liquid receiver 12*b* similar to that of the 9th embodiment is provided with respect to the ejector-type refrigerant cycle device 100 of the 2nd embodiment. Accordingly, similarly to the 9th embodiment, the operation of the refrigerant cycle can be easily made stable. A liquid receiver 12*b* similar to that of the 9th embodiment may be provided with respect to the ejector-type refrigerant cycle device 100 of the 3rd or 4th embodiment, or the ejector-type refrigerant cycle device 200 of the 5th or 6th embodiment.

(11th Embodiment)

Figure 19:
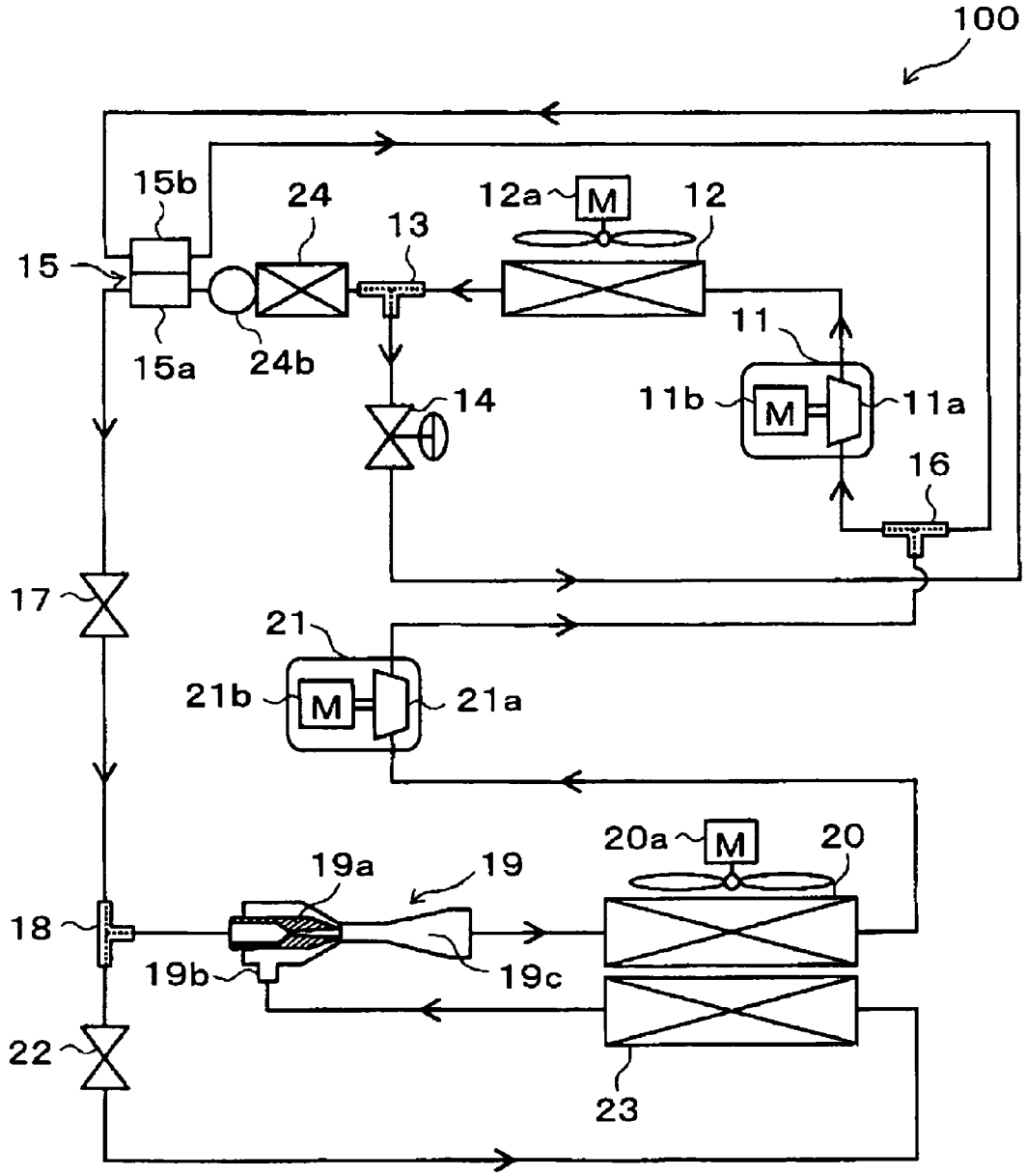
FIG. 19 is an entire schematic diagram of an ejector-type refrigerant cycle device according to an 11th embodiment of the invention.

In the present embodiment, as shown in FIG. 19, a liquid receiver 24*b*, adapted as a high-pressure side gas-liquid separator for separating the refrigerant flowing out of the auxiliary radiator 24 into gas refrigerant and liquid refrigerant and for storing the surplus refrigerant therein, is located at the refrigerant outlet side of the auxiliary radiator 24, with respect to the ejector-type refrigerant cycle device 100 of the 3rd embodiment. The liquid receiver 24*b* causes the separated saturation liquid refrigerant to be introduced to the high-pressure side refrigerant passage 15*a* of the inner heat exchanger 15 located downstream of the liquid receiver 24*b*.

According to the present embodiment, even when the load variation in the refrigerant cycle is caused, because the refrigerant to flow to the high-pressure side refrigerant passage 15*a* of the inner heat exchanger 15 (corresponding to point $b'_6$ of FIG. 6) is the saturation liquid refrigerant, the operation of the refrigerant cycle can be easily made stable.

(12th Embodiment)

Figure 20:
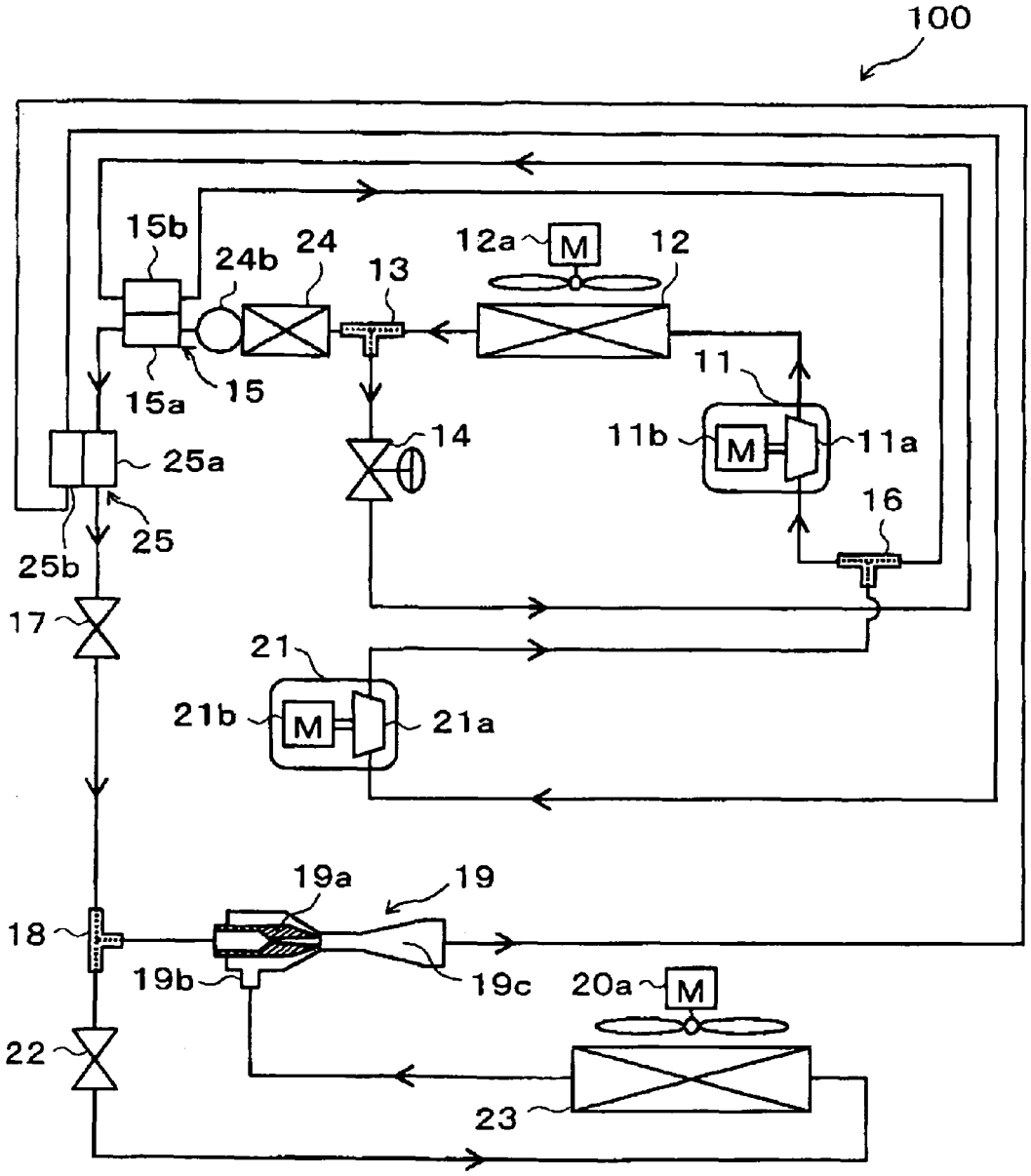
FIG. 20 is an entire schematic diagram of an ejector-type refrigerant cycle device according to a 12th embodiment of the invention.

In the present embodiment, as shown in FIG. 20, a liquid receiver 24*b* similar to that of the 11th embodiment is provided with respect to the ejector-type refrigerant cycle device 100 of the 4th embodiment. Accordingly, similarly to the 11th embodiment, the operation of the refrigerant cycle can be easily made stable.

(13th Embodiment)

Figure 21:
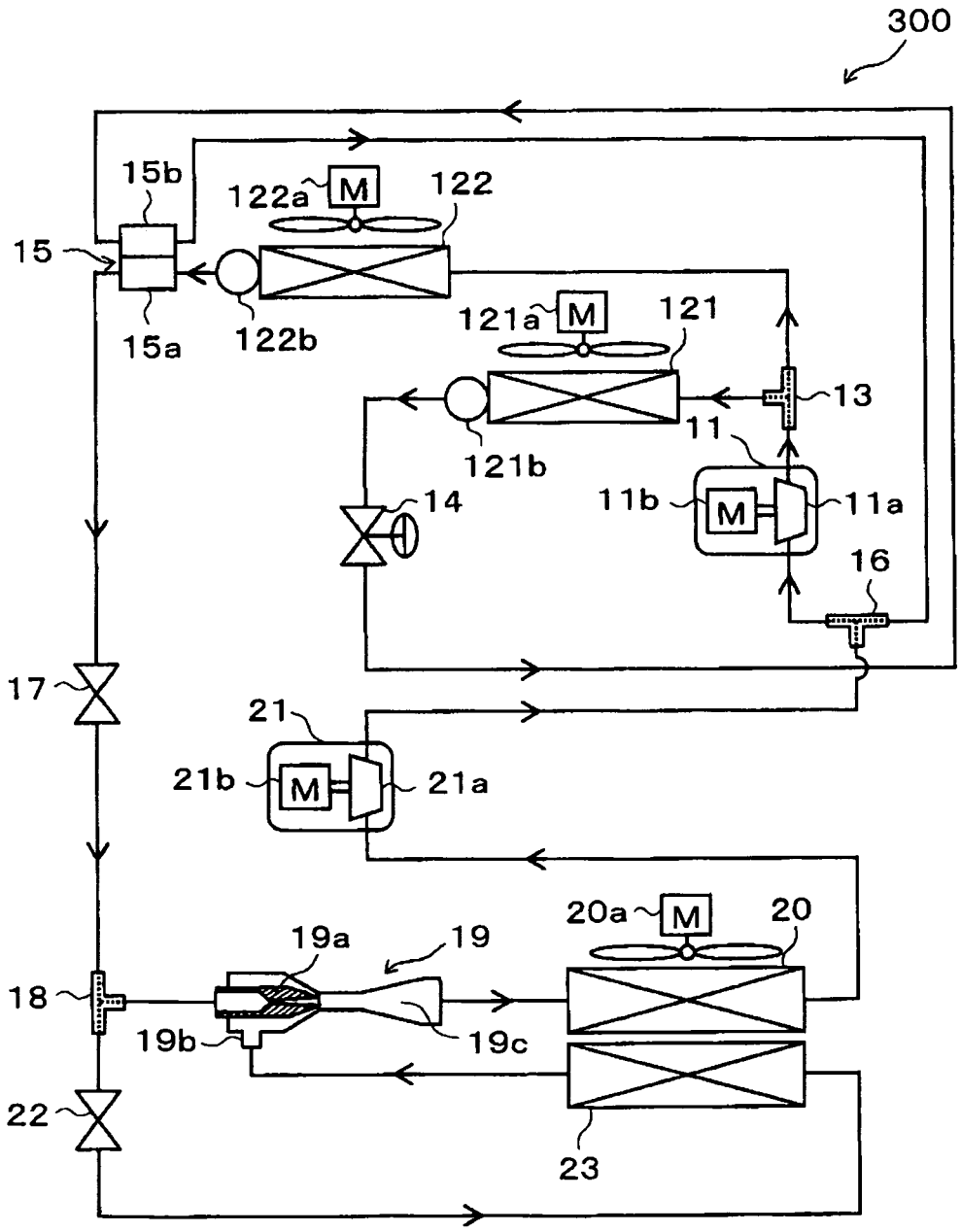
FIG. 21 is an entire schematic diagram of an ejector-type refrigerant cycle device according to a 13th embodiment of the invention.

In the present embodiment, as shown in FIG. 21, first and second liquid receivers 121*b*, 122*b*, adapted as high-pressure side gas-liquid separators for separating the refrigerant flowing out of the first and second radiators 121, 122 into gas refrigerant and liquid refrigerant and for storing the surplus refrigerant therein are located, respectively, at the refrigerant outlet sides of the first and second radiators 121, 122, with respect to the ejector-type refrigerant cycle device 300 of the 7th embodiment.

The first and second liquid receivers 121*b*, 122*b* cause the separated saturation liquid refrigerant to be introduced to the thermal expansion valve 14 and the high-pressure side refrigerant passage 15*a* of the inner heat exchanger 15, respectively.

According to the present embodiment, even when the load variation in the refrigerant cycle is caused, because the refrigerant to flow into the thermal expansion valve 14 from the first liquid receiver 121*b* and the refrigerant to flow into the inner heat exchanger 15 from the second liquid receiver 122*b* (corresponding to point $b1_{14}$ and point $b2_{14}$ of FIG. 14 of the 7th embodiment) are the saturation liquid refrigerant, the operation of the refrigerant cycle can be easily made stable.

In the present embodiment, an example in which both the first and second liquid receivers 121*b*, 122*b* are provided is described. However, one of the first and second liquid receivers 121*b*, 122*b* may be provided instead of the example in the present embodiment.

(14th Embodiment)

Figure 22:
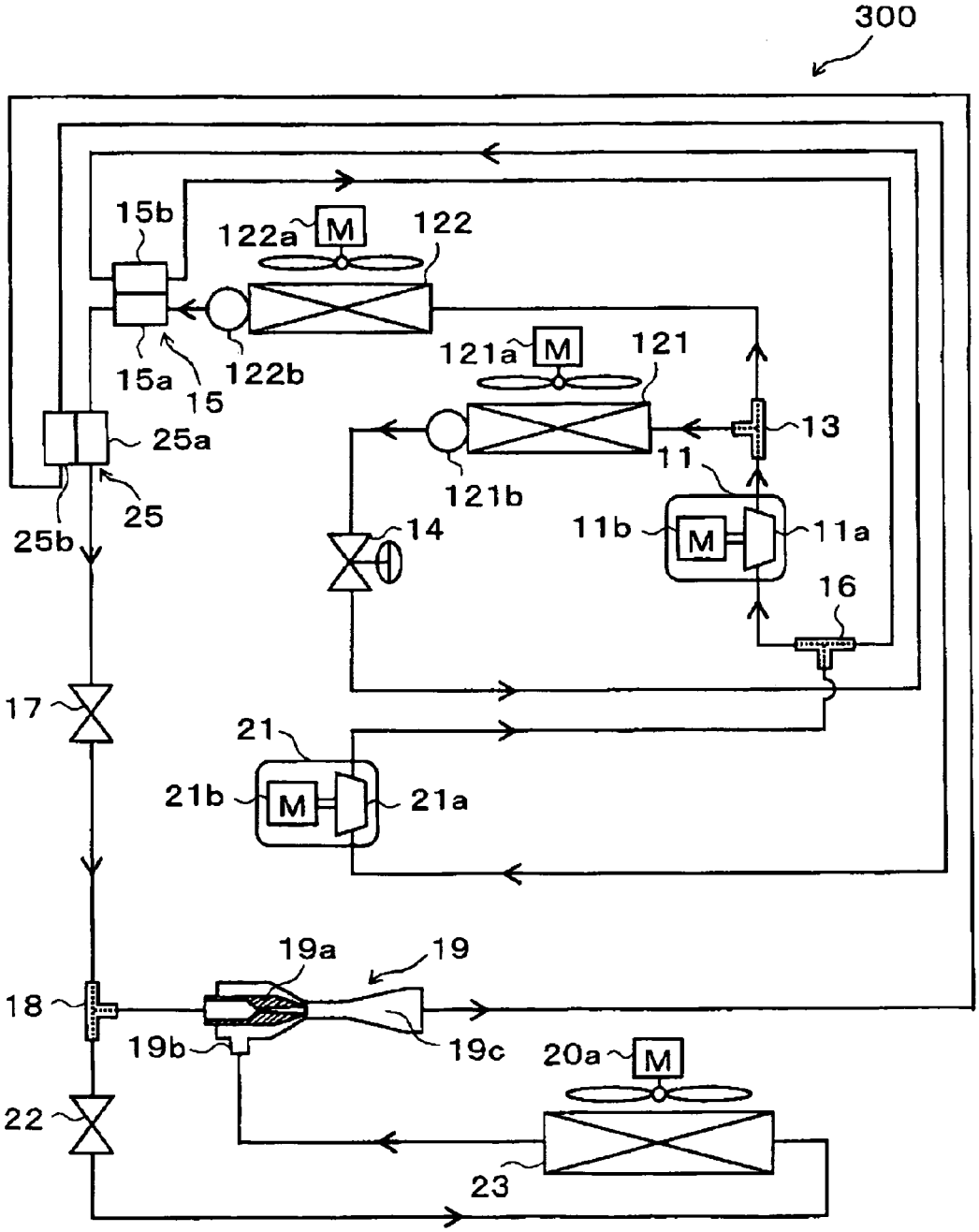
FIG. 22 is an entire schematic diagram of an ejector-type refrigerant cycle device according to a 14th embodiment of the invention.

In the 14th embodiment, as shown in FIG. 22, first and second liquid receivers 121*b*, 122*b* similar to that of the 13th embodiment are provided with respect to the ejector-type refrigerant cycle device 300 of the 8th embodiment. Accordingly, similarly to the 13th embodiment, the operation of the refrigerant cycle can be easily made stable. In the present embodiment, any one of the first and second liquid receivers 121*b*, 122*b* may be provided.

(15th Embodiment)

Figure 23:
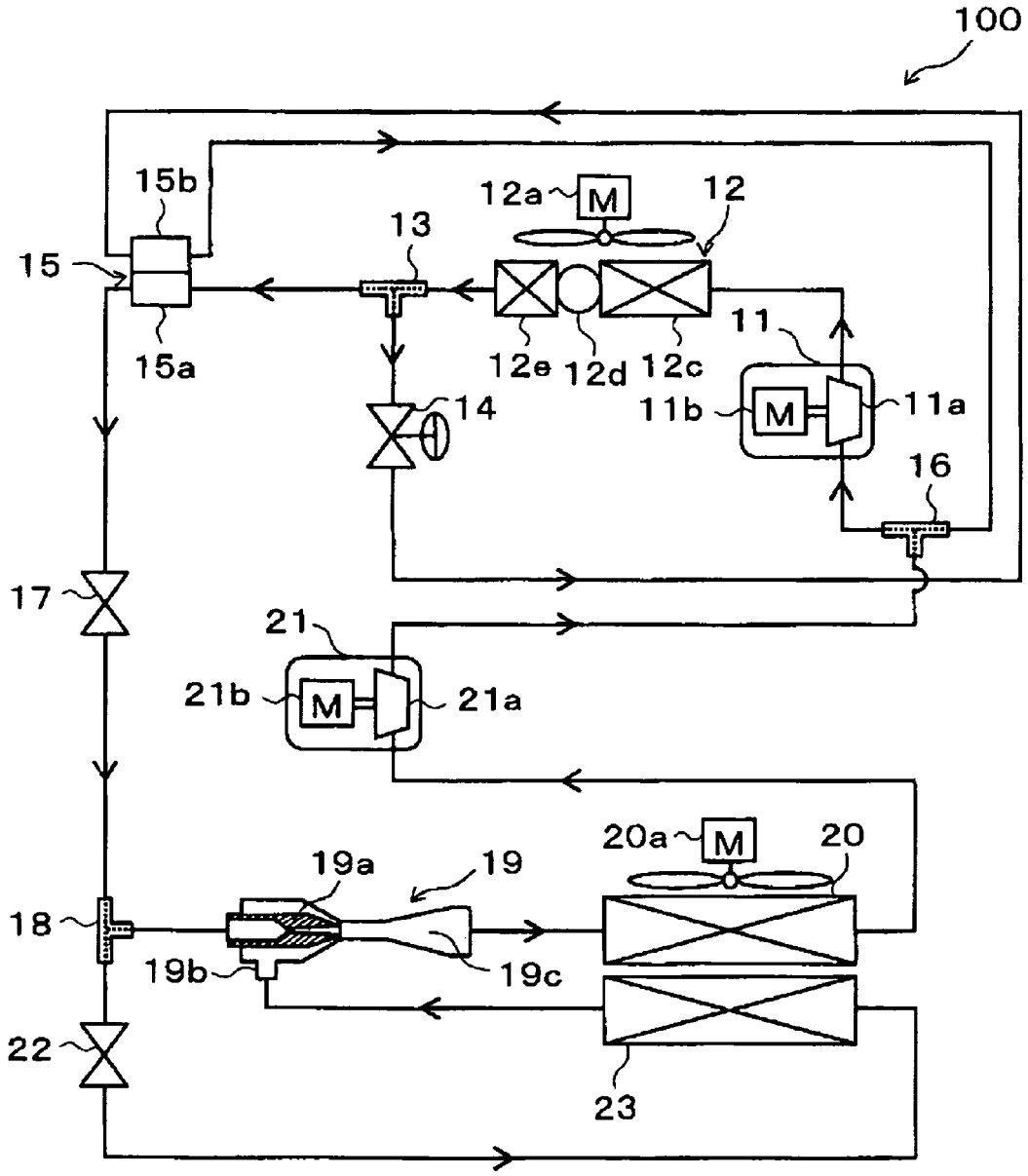
FIG. 23 is an entire schematic diagram of an ejector-type refrigerant cycle device according to a 15th embodiment of the invention.

In the present embodiment, as shown in the entire schematic diagram of FIG. 23, the structure of the radiator 12 is changed with respect to the ejector-type refrigerant cycle device 100 of the 1st embodiment.

Specifically, in the present embodiment, the radiator 12 includes a condensing portion 12*c* in which the refrigerant is condensed, a gas-liquid separation portion 12*d* (liquid receiving portion) for separating the refrigerant flowing out of the condensing portion 12*c* into the gas refrigerant and the liquid refrigerant, and a super-cooling portion 12*e* for super-cooling the liquid refrigerant flowing out of the gas-liquid separation portion 12*d*. That is, the radiator 12 is configured as a sub-cool type condenser. The other configurations are similar to those of the 1st embodiment.

According to the present embodiment, even when the load variation in the refrigerant cycle is caused, because the refrigerant to flow into the first branch portion 13 (corresponding to point $b_2$ of FIG. 2 of the 1st embodiment) is the saturation liquid refrigerant, the operation of the refrigerant cycle can be easily made stable. Furthermore, the enthalpy of the refrigerant flowing into the suction side evaporator 23 and the discharge side evaporator 20 can be reduced, and thereby the refrigerating capacity exerted in the suction side evaporator 23 and the discharge side evaporator 20 can be increased. As a result, the COP can be improved.

(16th-18th Embodiments)

Figure 24:
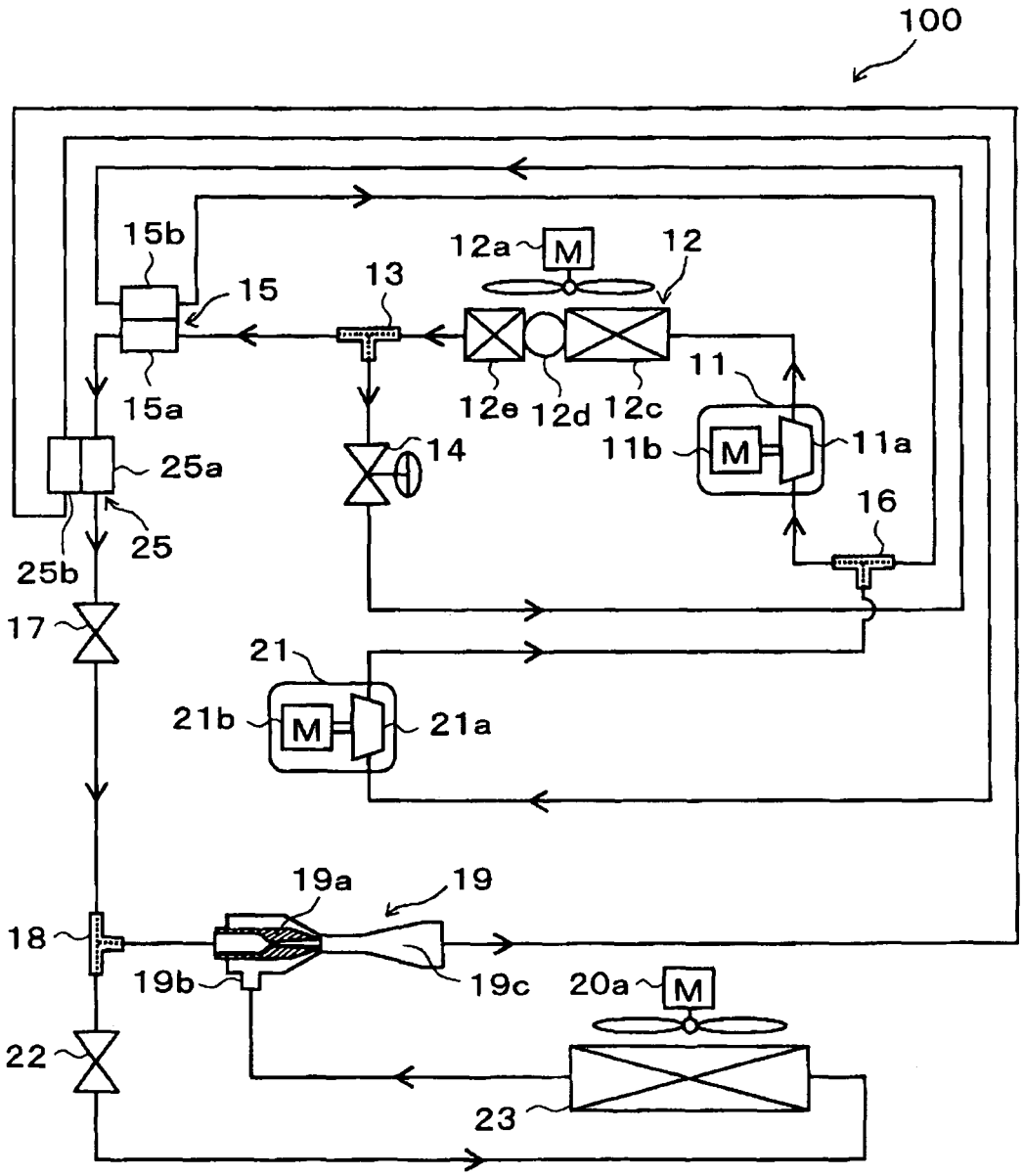
FIG. 24 is an entire schematic diagram of an ejector-type refrigerant cycle device according to a 16th embodiment of the invention.

In 16th embodiment, as shown in the entire schematic diagram of FIG. 24, a sub-cooling type condenser is adapted as the radiator 12 similarly to the 15th embodiment, with respect to the ejector-type refrigerant cycle device 100 of the 2nd embodiment. Accordingly, similarly to the 15th embodiment, the operation of the refrigerant cycle can be easily made stable, thereby further improving the COP.

Figure 25:
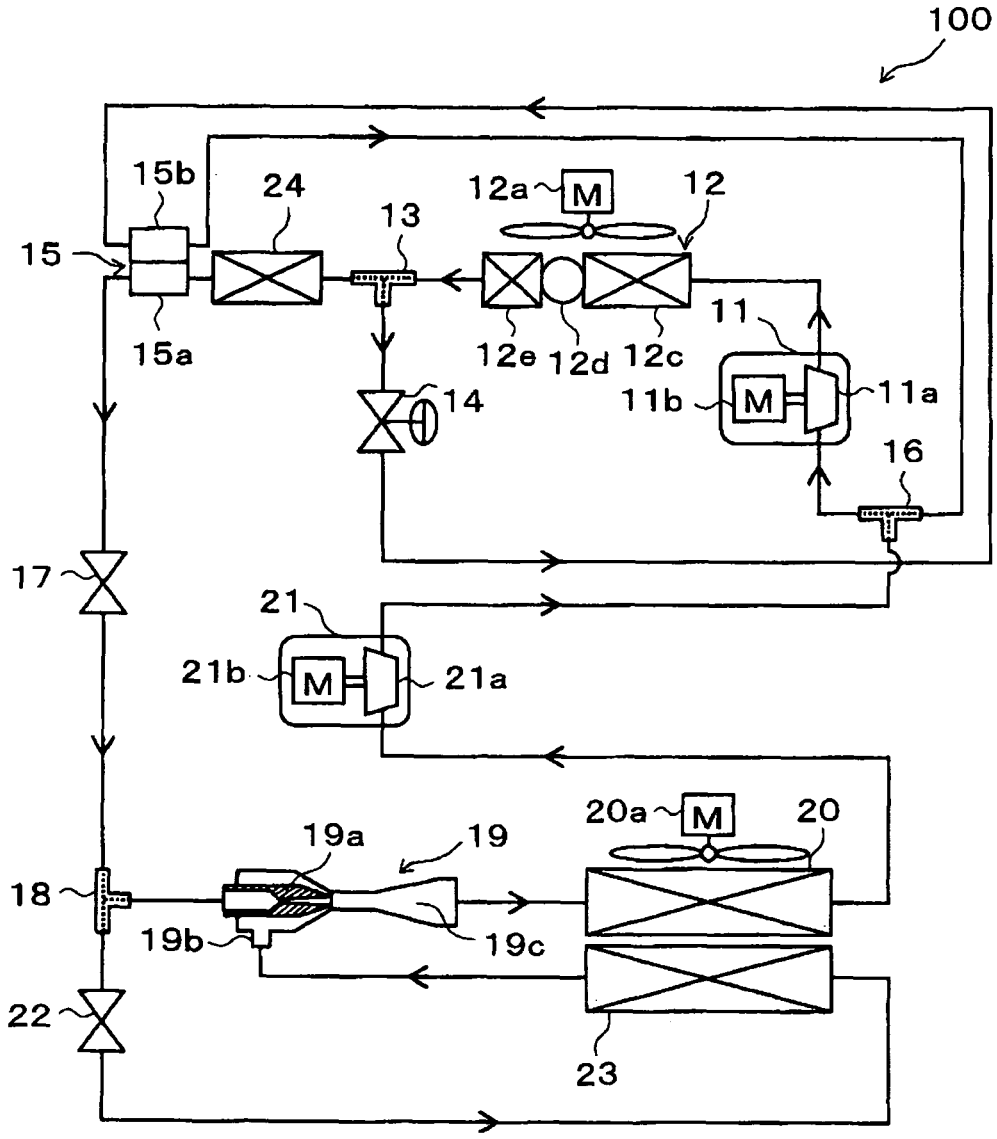
FIG. 25 is an entire schematic diagram of an ejector-type refrigerant cycle device according to a 17th embodiment of the invention.

In 17th embodiment, as shown in the entire schematic diagram of FIG. 25, a sub-cooling type condenser is adapted as the radiator 12 similarly to the 15th embodiment, with respect to the ejector-type refrigerant cycle device 100 of the 3rd embodiment. Accordingly, similarly to the 15th embodiment, the operation of the refrigerant cycle can be easily made stable, thereby further improving the COP.

Figure 26:
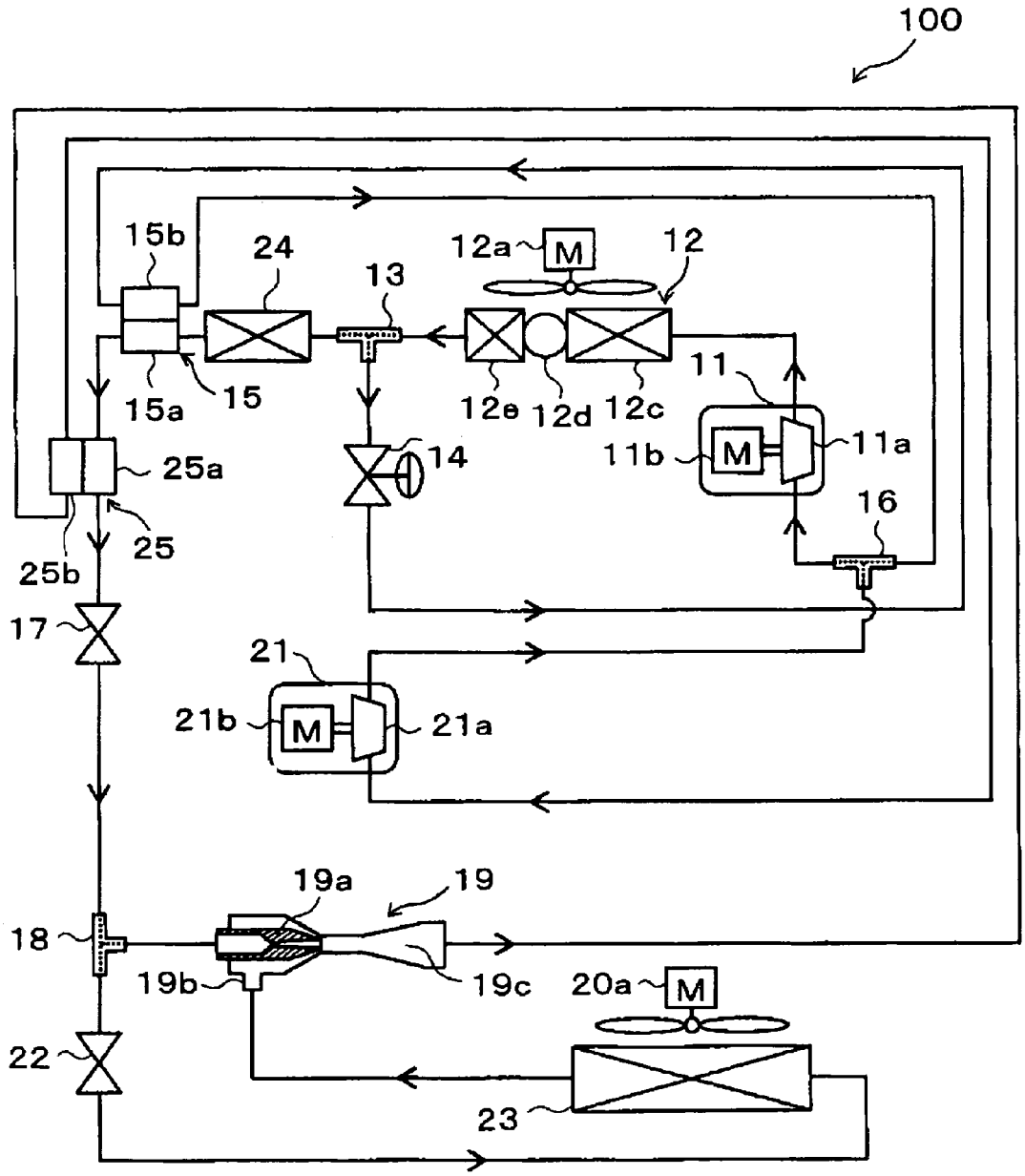
FIG. 26 is an entire schematic diagram of an ejector-type refrigerant cycle device according to a 18th embodiment of the invention.

In 18th embodiment, as shown in the entire schematic diagram of FIG. 26, a sub-cooling type condenser is adapted as the radiator 12 similarly to the 15th embodiment, with respect to the ejector-type refrigerant cycle device 100 of the 4th embodiment. Accordingly, similarly to the 15th embodiment, the operation of the refrigerant cycle can be easily made stable, thereby further improving the COP.

With respect to the ejector-type refrigerant cycle device 200 of the 5th or 6th embodiment, a sub-cooling type condenser may be adapted as the radiator 12.

(19th Embodiment)

Figure 27:
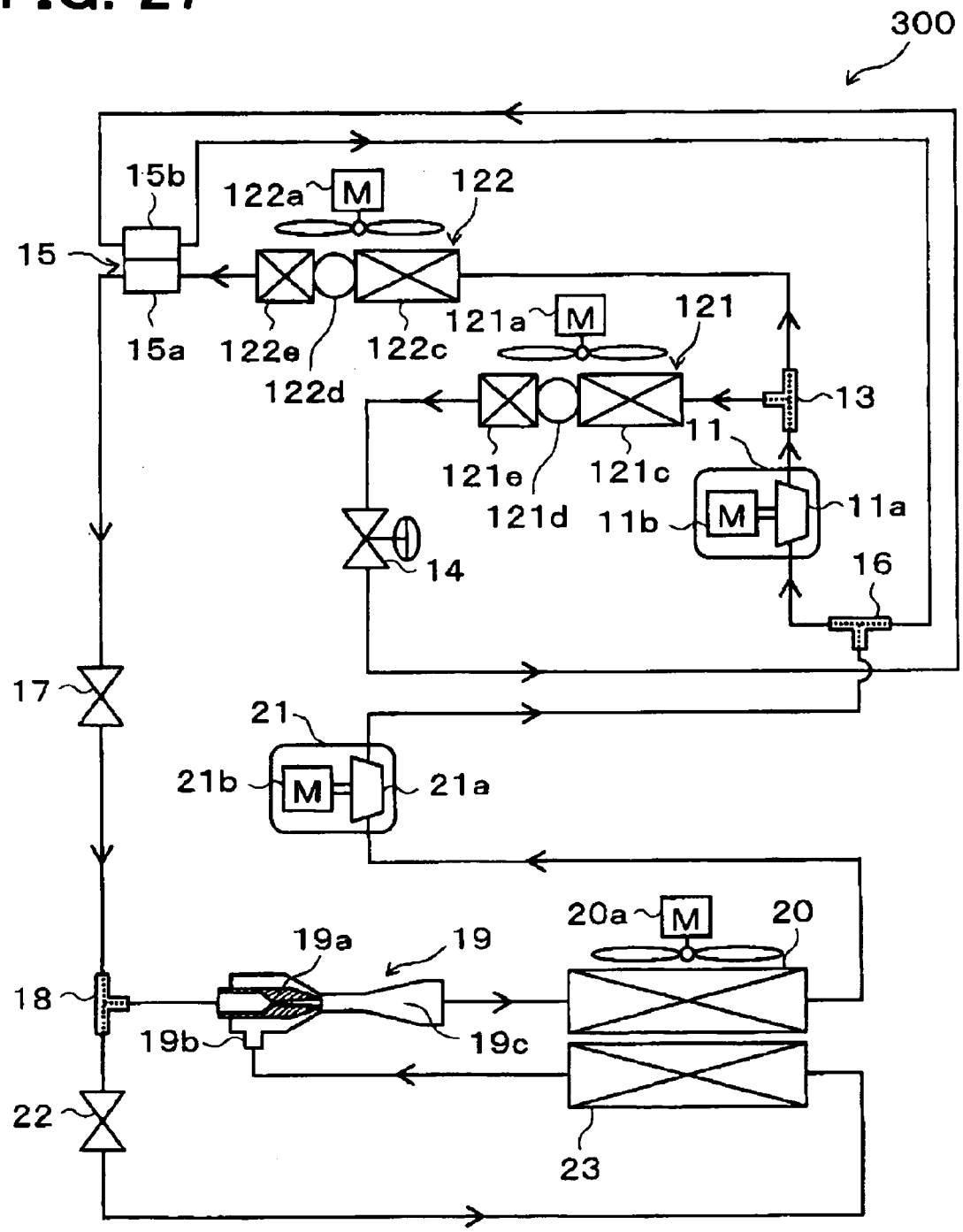
FIG. 27 is an entire schematic diagram of an ejector-type refrigerant cycle device according to a 19th embodiment of the invention.

In the present embodiment, as shown in the entire schematic diagram of FIG. 27, a sub-cooling type condenser is adapted as each of the first radiator 121 and the second radiator 122 similarly to the 15th embodiment, with respect to the ejector-type refrigerant cycle device 300 of the 7th embodiment.

Specifically, the first radiator 121 and the second radiator 122, respectively, include a condensing portion 121*c*, 122*c* in which the refrigerant is condensed, a gas-liquid separation portion 121*d*, 122*d* (liquid receiving portion) for separating the refrigerant flowing out of the condensing portion 121*c*, 122*c* into the gas refrigerant and the liquid refrigerant, and a super-cooling portion 121*e*, 122*e* for super-cooling the liquid refrigerant flowing out of the gas-liquid separation portion 121*d*, 122*d*. The other configurations are similar to those of the 7th embodiment.

According to the present embodiment, even when the load variation in the refrigerant cycle is caused, because the refrigerant to flow from the first radiator 121 to the thermal expansion valve 14 and the refrigerant flowing from the second radiator 122 to the inner heat exchanger 15 (corresponding to point $b1_{14}$ and point $b2_{14}$ of FIG. 14 of the 7th embodiment) are the saturation liquid refrigerant, the operation of the refrigerant cycle can be easily made stable.

Furthermore, the enthalpy of the refrigerant flowing into the suction side evaporator 23 and the discharge side evaporator 20 can be reduced, and thereby the refrigerating capacity exerted in the suction side evaporator 23 and the discharge side evaporator 20 can be increased. As a result, the COP can be further improved. In the present embodiment, both the first and second radiators 121, 122 are adapted as the sub-cool type condensers. However, any one of the first and second radiators 121, 122 may be adapted as the sub-cool type condenser.

(20th Embodiment)

Figure 28:
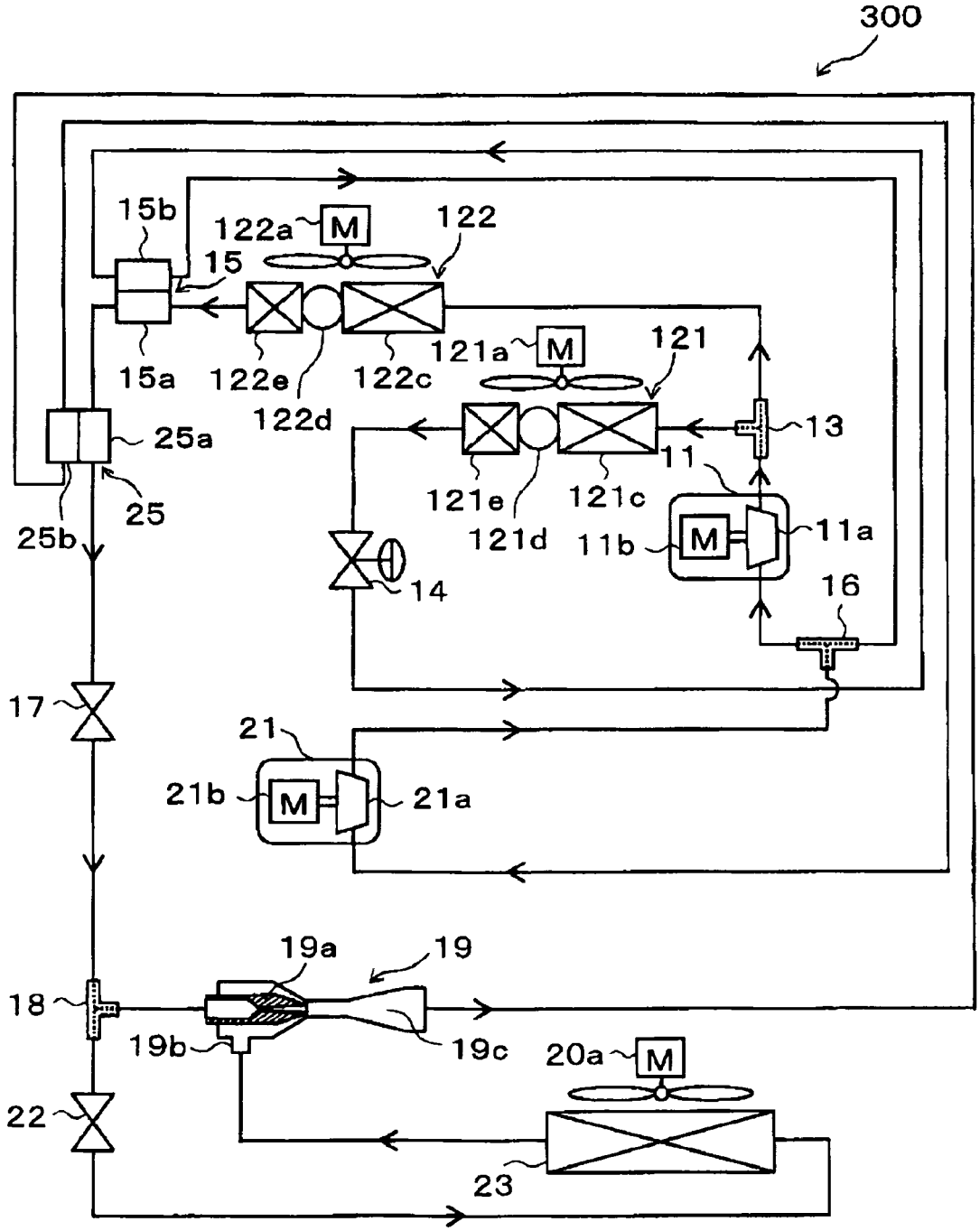
FIG. 28 is an entire schematic diagram of an ejector-type refrigerant cycle device according to a 20th embodiment of the invention.

In the present embodiment, as shown in the entire schematic diagram of FIG. 28, a sub-cooling type condenser is adapted as each of the first radiator 121 and the second radiator 122 similarly to the 19th embodiment, with respect to the ejector-type refrigerant cycle device 300 of the 8th embodiment.

Accordingly, similarly to the 19th embodiment, the operation of the refrigerant cycle can be easily made stable, and the COP can be further improved. Even in the present embodiment, any one of the first and second radiators 121, 122 may be adapted as the sub-cool type condenser.

(21st Embodiment)

Figure 29:
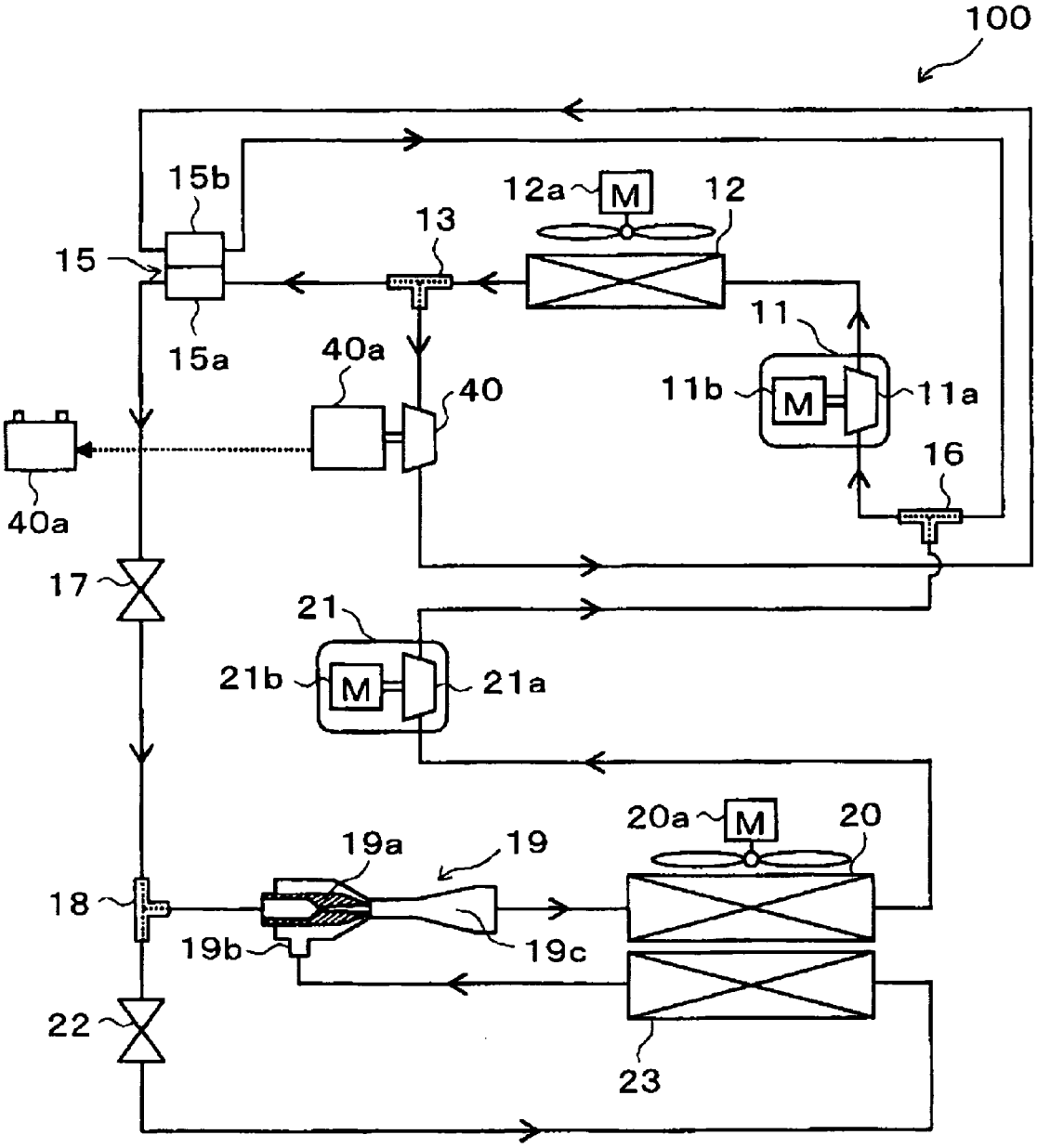
FIG. 29 is an entire schematic diagram of an ejector-type refrigerant cycle device according to a 21st embodiment of the invention.

In the present embodiment, as shown in the entire schematic diagram of FIG. 29, the thermal expansion valve 14 is removed, and an expansion unit 40 is provided, instead of the thermal expansion valve 14 with respect to the ejector-type refrigerant cycle device 100 of the 1st embodiment. The expansion unit 40 is adapted as a high-pressure side decompression portion, and is configured to convert the pressure energy of the refrigerant to the mechanical energy thereof so as to output.

In the present embodiment, specifically, a scroll-type capacity compression mechanism is adapted as the expansion unit 40. However, a capacity compression mechanism of the other type such as a vane type or a rotary-piston type compressor may be used. Furthermore, when the refrigerant flows reversely with respect to the refrigerant flow in a case where the capacity-type compression mechanism is used as the compression mechanism, a rotation shaft of the expansion unit 40 is rotated while the volume of the refrigerant is expanded and the pressure of the refrigerant is reduced, thereby outputting mechanical energy (rotation energy).

A rotation shaft of a generator 40*a* is connected to the rotation shaft of the expansion unit 40. The generator 40*a* converts the mechanical energy (rotation energy) output from the expansion unit 40 to the electrical energy. Furthermore, the electrical energy output from the generator 40*a* is stored in a battery 40*b*. The other structure and operation of the present embodiment are similar to those of the 1st embodiment.

When the ejector-type refrigerant cycle device 100 of the present embodiment is operated, not only the same effects as in (A)-(F) of the 1st embodiment can be effectively obtained, but also the energy efficiency in the entire ejector refrigerant cycle device 100 can be improved.

That is, in the present embodiment, upon the effect of the thermal expansion valve 14 of the 1st embodiment, the energy loss, caused while the refrigerant is decompressed and expanded in iso-enthalpy, can be recovered as the mechanical energy in the expansion unit 40. Furthermore, by converting the recovered mechanical energy to the electrical energy, the energy loss can be effectively used. As a result, the energy efficiency in the entire ejector-type refrigerant cycle device 100 can be improved.

The electrical energy stored in the battery 40*b* may be supplied to various electrical actuators 11*b*, 21*b*, 12*a*, 20*a* of the elector-type refrigerant cycle device 100, or may be supplied to an electrical load at an outside of the cycle components.

The recovered mechanical energy of the expansion unit 40 may be used as the mechanical energy without being converted to the electrical energy. For example, the rotation shaft of the expansion unit 40 may be connected to the rotation shafts of the first and second compression portions 11*a*, 21*a*, and may be used as a supplemental power source. In this case, the COP of the ejector-type refrigerant cycle device can be further improved.

Alternatively, the mechanical energy output from the expansion unit 40 may be used as a drive source of an exterior component. For example, in a case where a flywheel is used as the exterior component, the mechanical energy recovered in the expansion unit can be stored as the kinetic energy. Furthermore, in a case where a spring device is used as the exterior component, the mechanical energy recovered in the expansion unit can be stored as the elastic energy.

In the present embodiment, the expansion unit 40 is used as the high-pressure side decompression portion. However, the first fixed throttle 17 may be removed, and the expansion unit may be used as the pre-nozzle decompression portion. Alternatively, the second fixed throttle 22 may be removed, and the expansion unit may be used as the suction side decompression portion.

(22nd-26th Embodiments)

Figure 30:
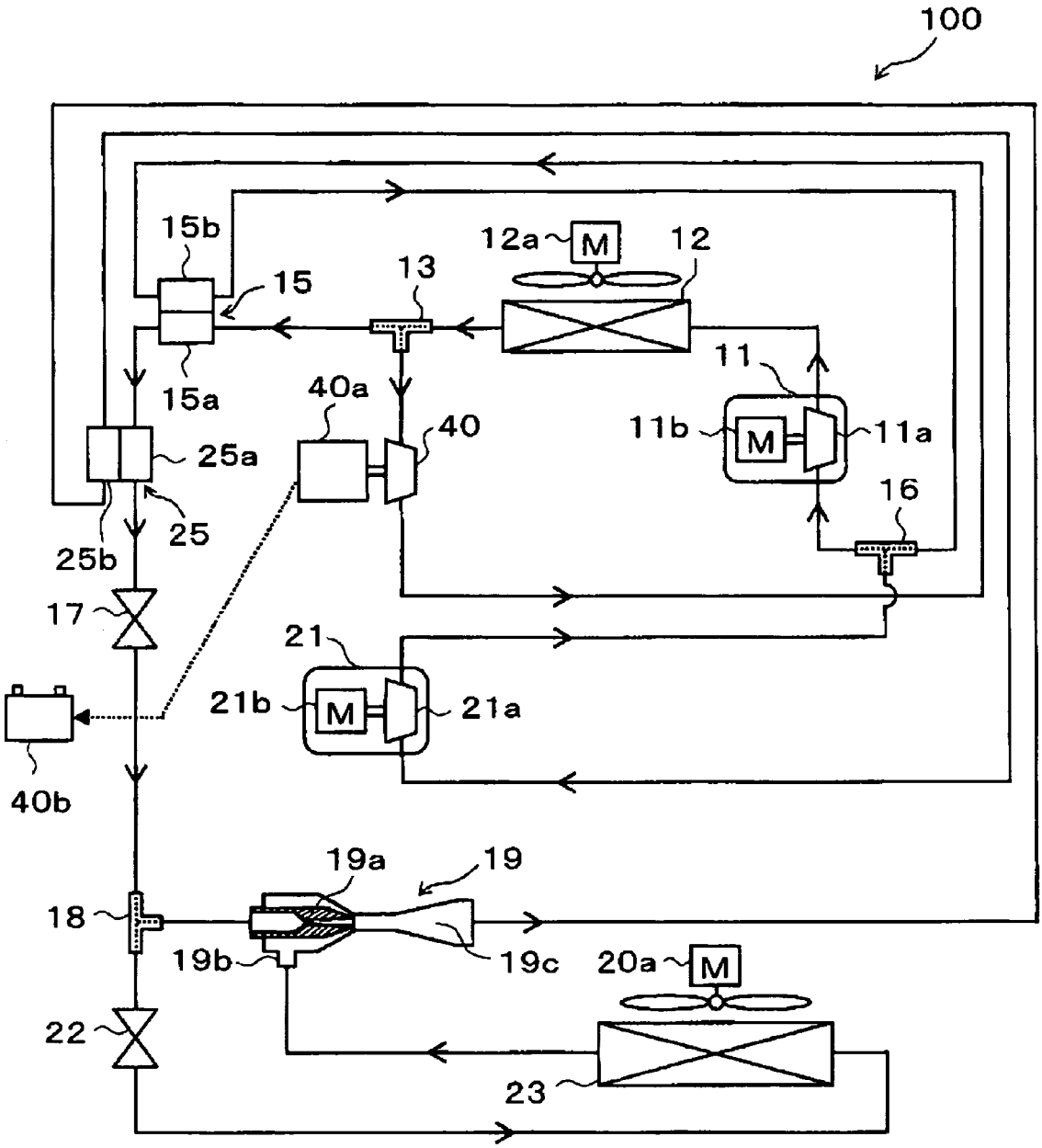
FIG. 30 is an entire schematic diagram of an ejector-type refrigerant cycle device according to a 22nd embodiment of the invention.

In the 22nd embodiment, as shown in the entire schematic diagram of FIG. 30, the thermal expansion valve 14 is removed, and the expansion unit 40 as the high-pressure side decompression portion, the generator 40*a* and the battery 40*b* are provided with respect to the ejector-type refrigerant cycle device 100 of the 2nd embodiment.

Thus, when the ejector-type refrigerant cycle device 100 of the present embodiment is operated, not only the effects similar to the 2nd embodiment can be effectively obtained, but also the energy efficiency in the entire ejector-type refrigerant cycle device 100 can be improved similar to the 21st embodiment.

Figure 31:
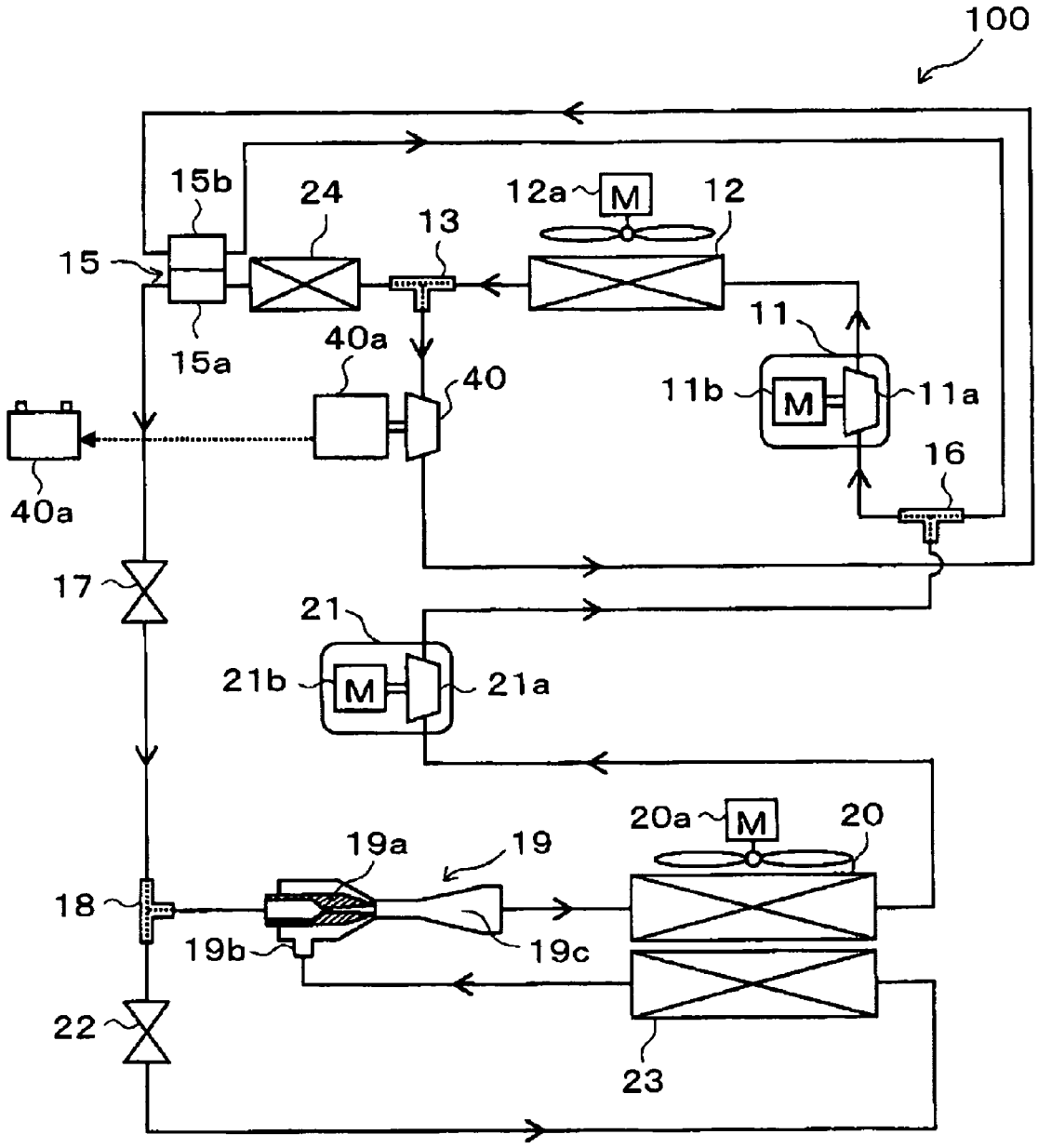
FIG. 31 is an entire schematic diagram of an ejector-type refrigerant cycle device according to a 23rd embodiment of the invention.

In the 23rd embodiment, as shown in the entire schematic diagram of FIG. 31, the thermal expansion valve 14 is removed, and the expansion unit 40 as the high-pressure side decompression portion, the generator 40*a* and the battery 40*b* are provided with respect to the ejector-type refrigerant cycle device 100 of the 3rd embodiment.

Thus, when the ejector-type refrigerant cycle device 100 of the present embodiment is operated, not only the effects similar to the 3rd embodiment can be effectively obtained, but also the energy efficiency in the entire ejector-type refrigerant cycle device 100 can be improved similar to the 21st embodiment.

Figure 32:
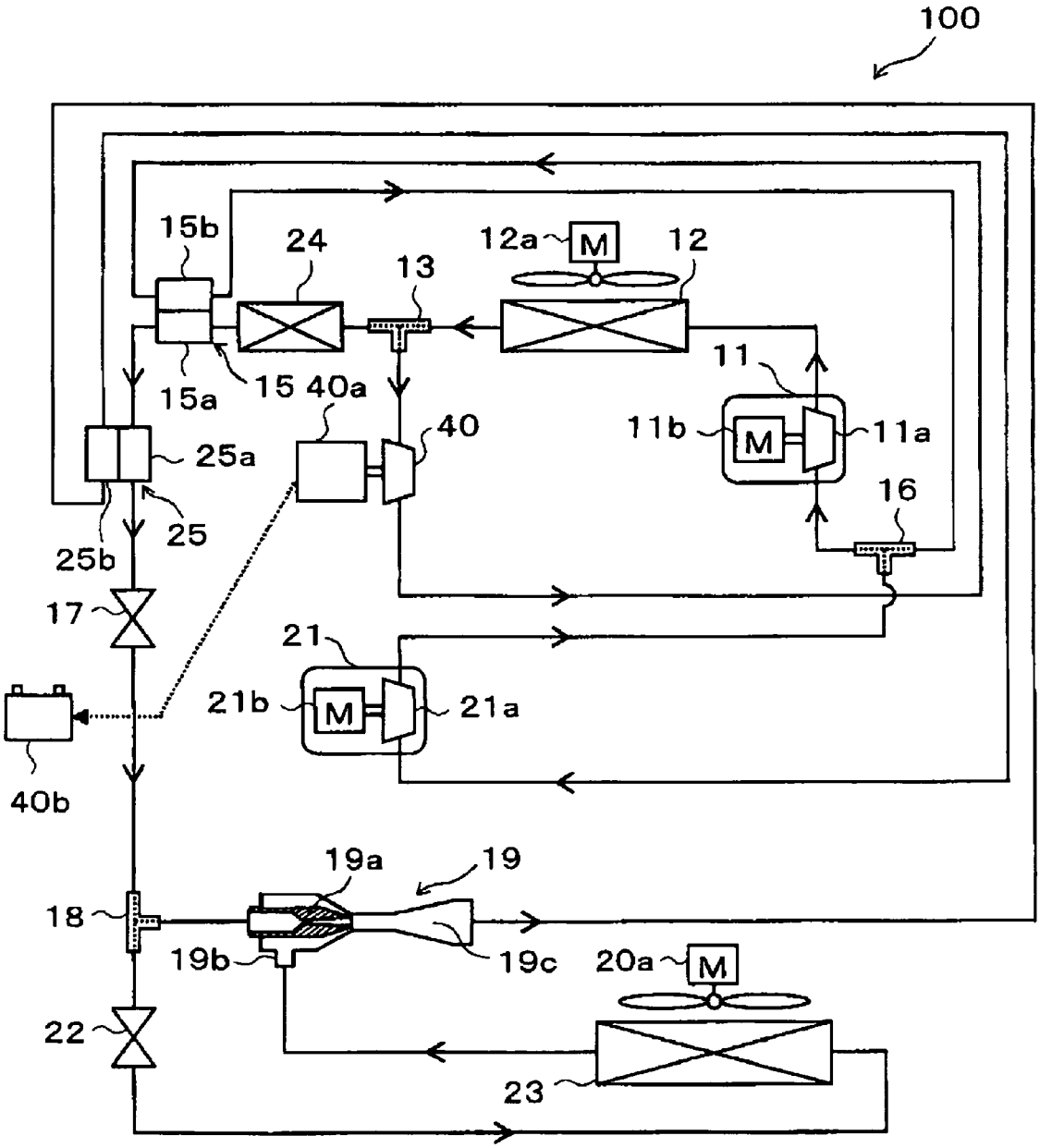
FIG. 32 is an entire schematic diagram of an ejector-type refrigerant cycle device according to a 24th embodiment of the invention.

In the 24th embodiment, as shown in the entire schematic diagram of FIG. 32, the thermal expansion valve 14 is removed, and the expansion unit 40 as the high-pressure side decompression portion, the generator 40*a* and the battery 40*b* are provided with respect to the ejector-type refrigerant cycle device 100 of the 4th embodiment.

Thus, when the ejector-type refrigerant cycle device 100 of the present embodiment is operated, not only the effects similar to the 4th embodiment can be effectively obtained, but also the energy efficiency in the entire ejector-type refrigerant cycle device 100 can be improved similar to the 21st embodiment.

Figure 33:
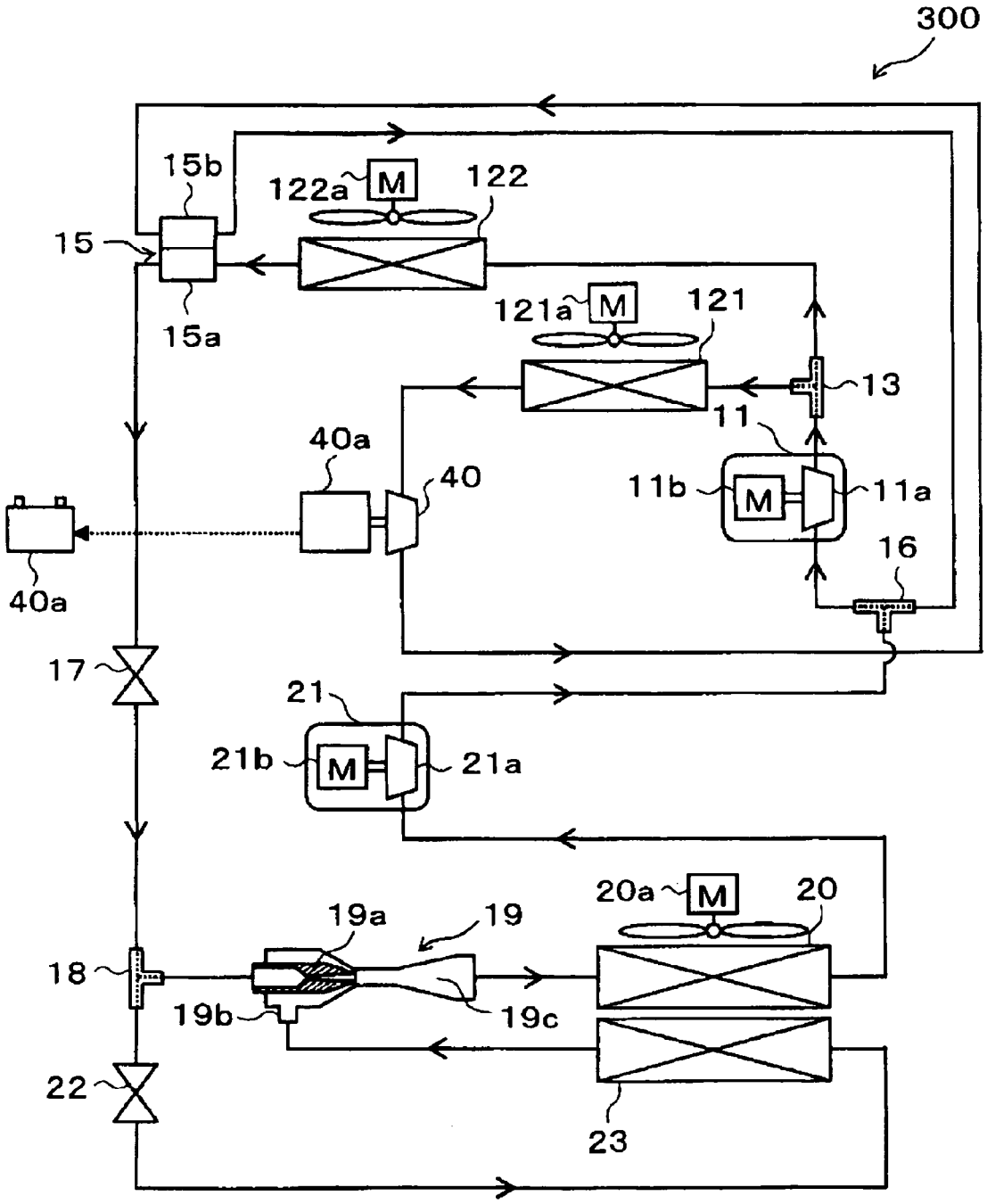
FIG. 33 is an entire schematic diagram of an ejector-type refrigerant cycle device according to a 25th embodiment of the invention.

In the 25th embodiment, as shown in the entire schematic diagram of FIG. 33, the thermal expansion valve 14 is removed, and the expansion unit 40 as the high-pressure side decompression portion, the generator 40*a* and the battery 40*b* are provided with respect to the ejector-type refrigerant cycle device 300 of the 7th embodiment.

Thus, when the ejector-type refrigerant cycle device 100 of the present embodiment is operated, not only the effects similar to the 7th embodiment can be effectively obtained, but also the energy efficiency in the entire ejector-type refrigerant cycle device 100 can be improved similar to the 21st embodiment.

Figure 34:
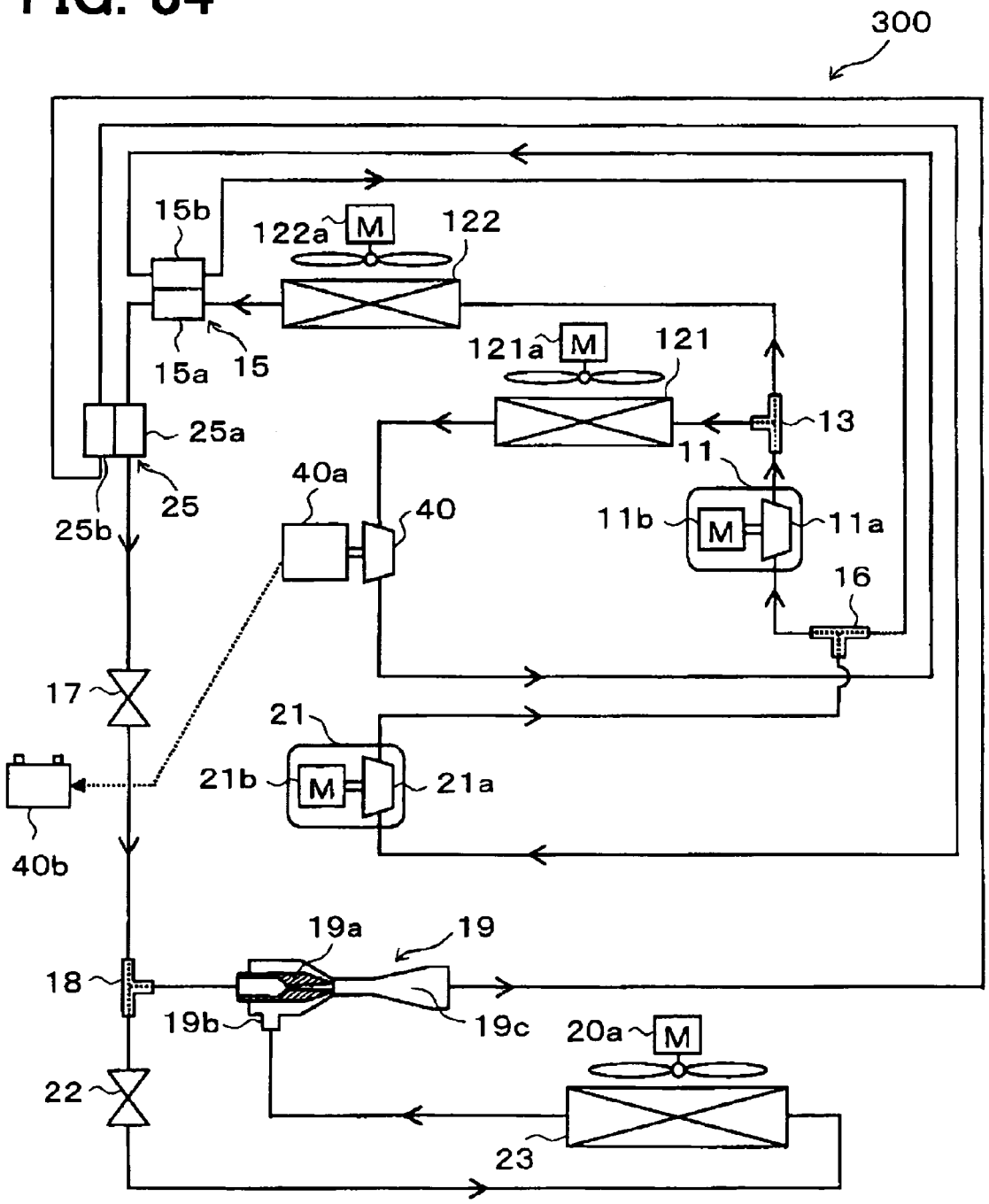
FIG. 34 is an entire schematic diagram of an ejector-type refrigerant cycle device according to a 26th embodiment of the invention.

In the 26th embodiment, as shown in the entire schematic diagram of FIG. 34, the thermal expansion valve 14 is removed, and the expansion unit 40 as the high-pressure side decompression portion, the generator 40*a* and the battery 40*b* are provided with respect to the ejector-type refrigerant cycle device 300 of the 8th embodiment.

Thus, when the ejector-type refrigerant cycle device 100 of the present embodiment is operated, not only the effects similar to the 8th embodiment can be effectively obtained, but also the energy efficiency in the entire ejector-type refrigerant cycle device 100 can be improved similar to the 21st embodiment.

In the 22nd-26th embodiments, the first fixed throttle 17 may be removed, and the expansion unit may be used as the pre-nozzle decompression portion. Alternatively, the second fixed throttle 22 may be removed, and the expansion unit may be used as the suction side decompression portion. Furthermore, in the ejector-type refrigerant cycle device 200 of the 5th or 6th embodiment, the expansion unit may be used as the thermal expansion valve 14 and the first and second fixed throttles 17, 22.

(27th Embodiment)

Figure 35:
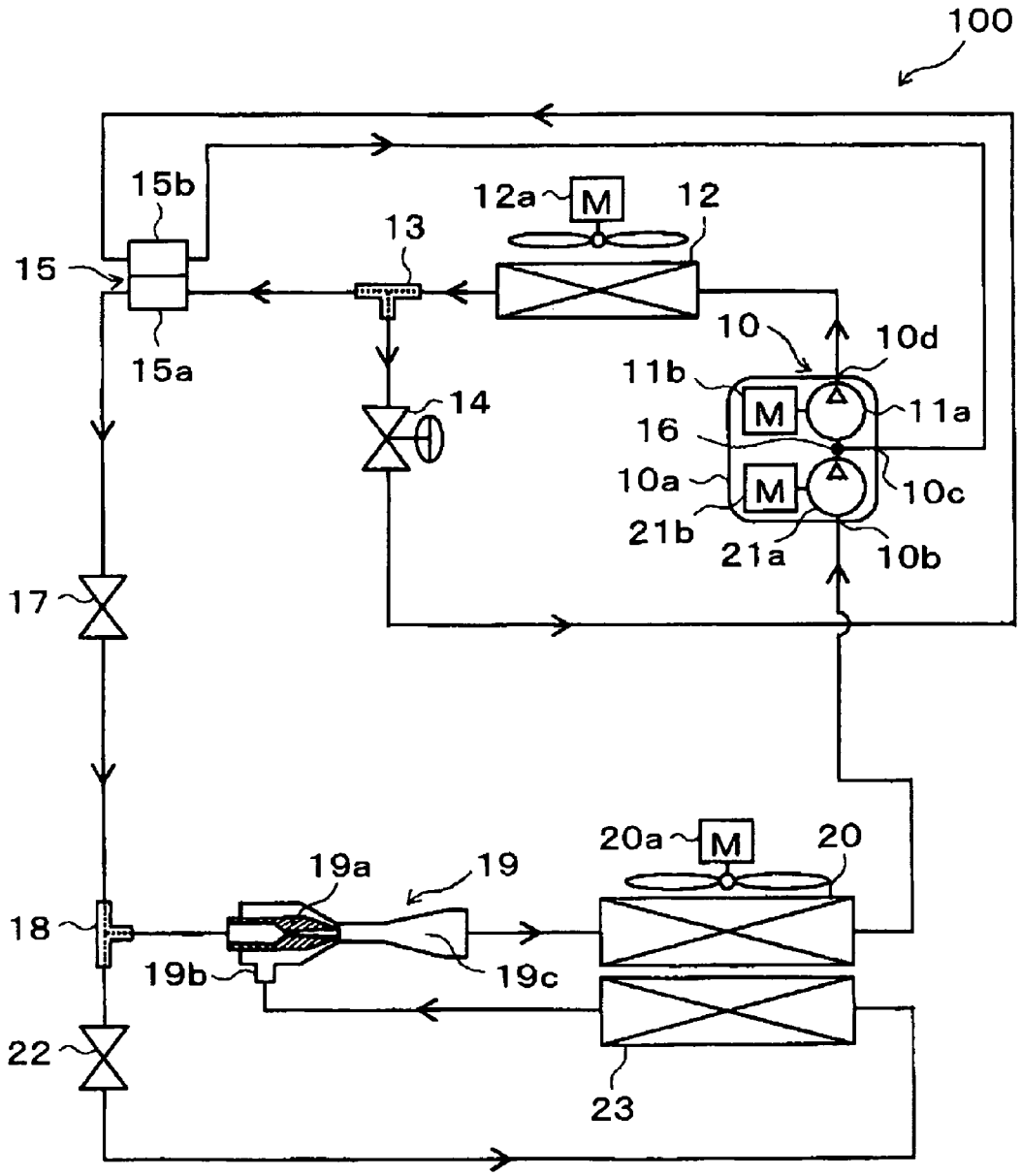
FIG. 35 is an entire schematic diagram of an ejector-type refrigerant cycle device according to a 27th embodiment of the invention.

In the present embodiment, as shown in the entire schematic diagram of FIG. 35, the first compressor 11 and the second compressor 21 of the 1st embodiment are configured as a single compressor 10. Specifically, the compressor 10 is a two-step pressurizing electrical compressor in which two compression portions of first and second compression portions 11*a*, 21*a* and first and second electrical motors 11*b*, 21*b* for driving the first and second compression portions 11*a*, 21*a* are accommodated in a single housing 10*a*.

Similarly to the 1st embodiment, various compression mechanisms such as a scroll-type compressor and a vane-type compressor can be used as the first and second compression portions 11*a*, 21*a*. By respectively independently controlling the operation (rotational speed) of the first electrical motor 11*b* and the second electrical motor 21*b* based on control signals output from the control device described later, any type of the AC motor or the DC motor may be used for the first and second electrical motors 11*b*, 21*b*.

The refrigerant discharge capacities of the first and second compression portions 11*a*, 21*a* can be respectively independently changed by the control of the rotation speed in the electrical motors 11*b*, 21*b*. Thus, the first and second electrical motors 11*b*, 21*b* of the present embodiment can be adapted as first and second discharge capacity changing portions which change the refrigerant discharge capacities of the first and second compression portions 11*a*, 21*a*, respectively.

In the housing 10*a*, there is provided with a suction port 10*b* from which low-pressure refrigerant is drawn, a middle-pressure port 10*c* for introducing middle-pressure refrigerant therein, and a discharge port 10*d* from which high-pressure refrigerant is discharged. The respective ports 10*b*-10*d* are connected to the first and second compression portions 11*a*, 21*a* in the housing 10*a*.

Specifically, the suction port 10*b* is connected to a suction port of the second compression portion 21*a*, the middle-pressure port 10*c* is connected to communicate with a discharge port of the second compression portion 21*a* and a suction portion of the first compression portion 11*a*, and the discharge port 10*d* is connected to a discharge port of the first compression portion 11*a*. Thus, the first compression portion 11*a* draws a middle-pressure refrigerant mixture of the refrigerant discharged from the second compression portion 21*a* and the refrigerant flowing from the middle-pressure port 10*c*, compresses the drawn refrigerant and discharge the compressed refrigerant.

As shown in FIG. 35, an outlet side of the diffuser portion 19*c* of the ejector 19 is coupled to the suction port 10*b* of the compressor 10, an outlet side of the middle-pressure side refrigerant passage 15*b* of the inner heat exchanger 15 is connected to the middle pressure port 10*c*, and a refrigerant inlet side of the radiator 12 is coupled to the discharge port 10*d*, so that a cycle configuration similar to that of the 1st embodiment can be formed. Furthermore, the join portion 16 of the present embodiment is configured within the compressor 10.

Thus, when the ejector-type refrigerant cycle device 100 of the present embodiment is operated, the effects similar to the 1st embodiment can be obtained. Furthermore, because the first and second compression portions 11*a*, 21*a* are accommodated within the same housing 10*a* to be integrally configured as the compressor 10, size reduction and low cost in the compressor 10 can be achieved. Accordingly, size reduction and low cost can be achieved in the entire of the ejector-type refrigerant cycle device 100

(28th Embodiment-32th Embodiment)

Figure 36:
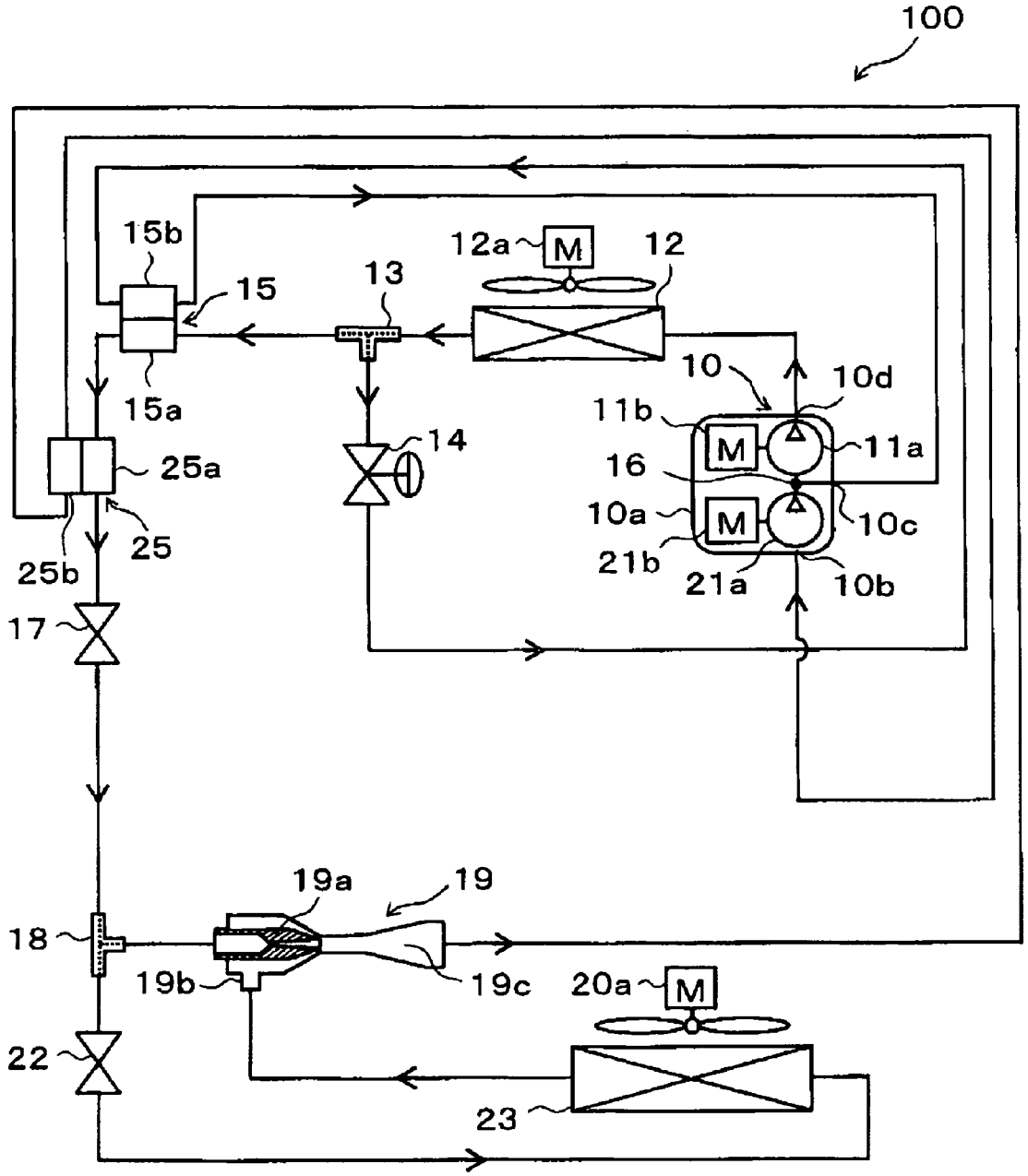
FIG. 36 is an entire schematic diagram of an ejector-type refrigerant cycle device according to a 28th embodiment of the invention.

In the 28th embodiment, as shown in the entire schematic diagram of FIG. 36, similarly to the 27th embodiment, the first compressor 11 and the second compressor 21 of the 2nd embodiment are configured as the single compressor 10. That is, as the compressor 10, a two-step pressurizing electrical compressor is used, so that a cycle similar to the 2nd embodiment can be configured.

When the ejector-type refrigerant cycle device 100 of the present embodiment is operated, the cycle is operated similarly to the 2nd embodiment, and thereby the same effects similarly to the 2nd embodiment can be obtained. Furthermore, size reduction and low cost of the compressor 10 can be achieved.

Figure 37:
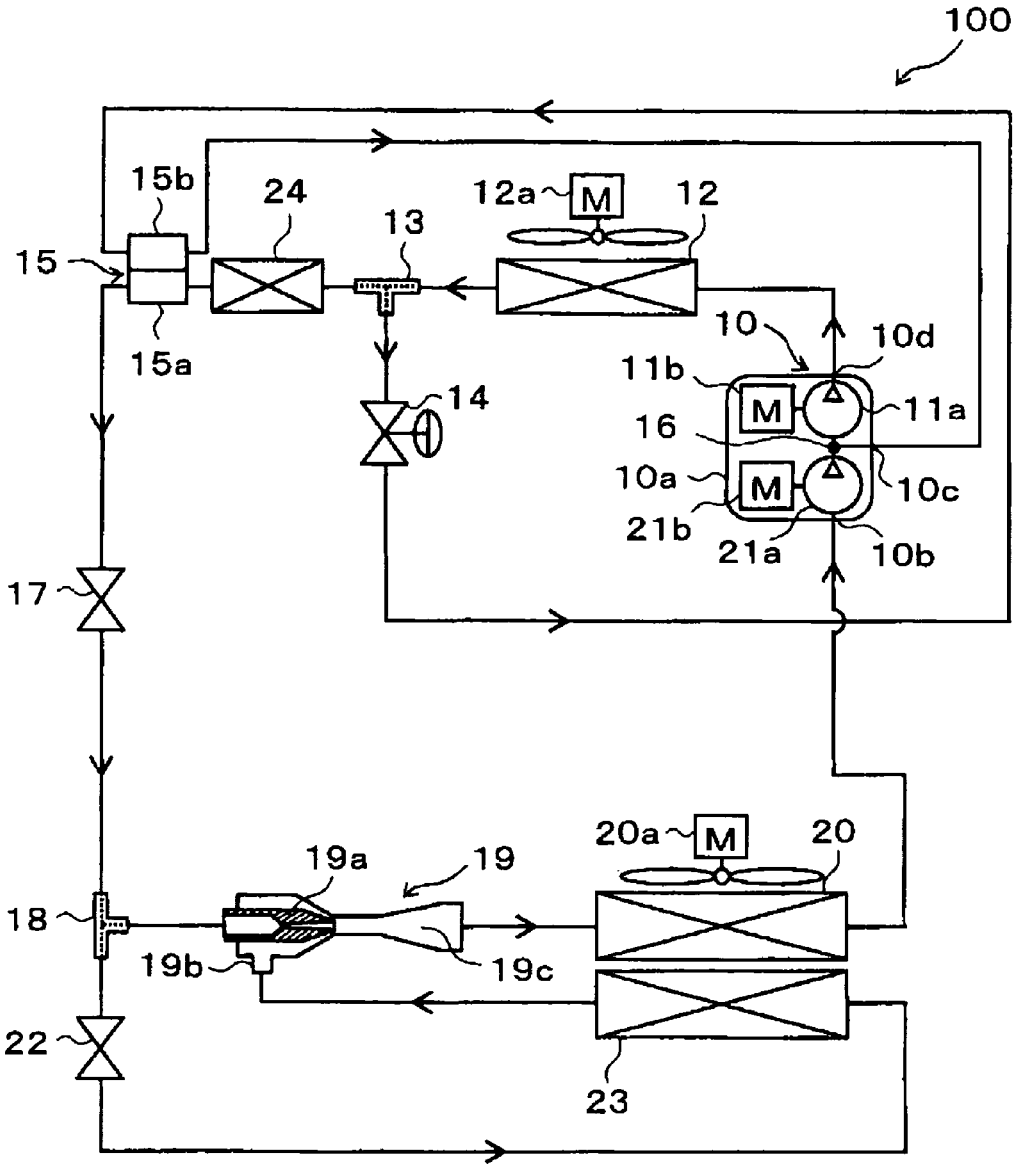
FIG. 37 is an entire schematic diagram of an ejector-type refrigerant cycle device according to a 29th embodiment of the invention.

In the 29th embodiment, as shown in the entire schematic diagram of FIG. 37, similarly to the 27th embodiment, the first compressor 11 and the second compressor 21 of the 3rd embodiment are configured as the single compressor 10. That is, as the compressor 10, a two-step pressurizing electrical compressor is used, so that a cycle similar to the 3rd embodiment can be configured.

When the ejector-type refrigerant cycle device 100 of the present embodiment is operated, the cycle is operated similarly to the 3rd embodiment, and thereby the same effects similarly to the 3rd embodiment can be obtained. Furthermore, size reduction and low cost of the compressor 10 can be achieved.

Figure 38:
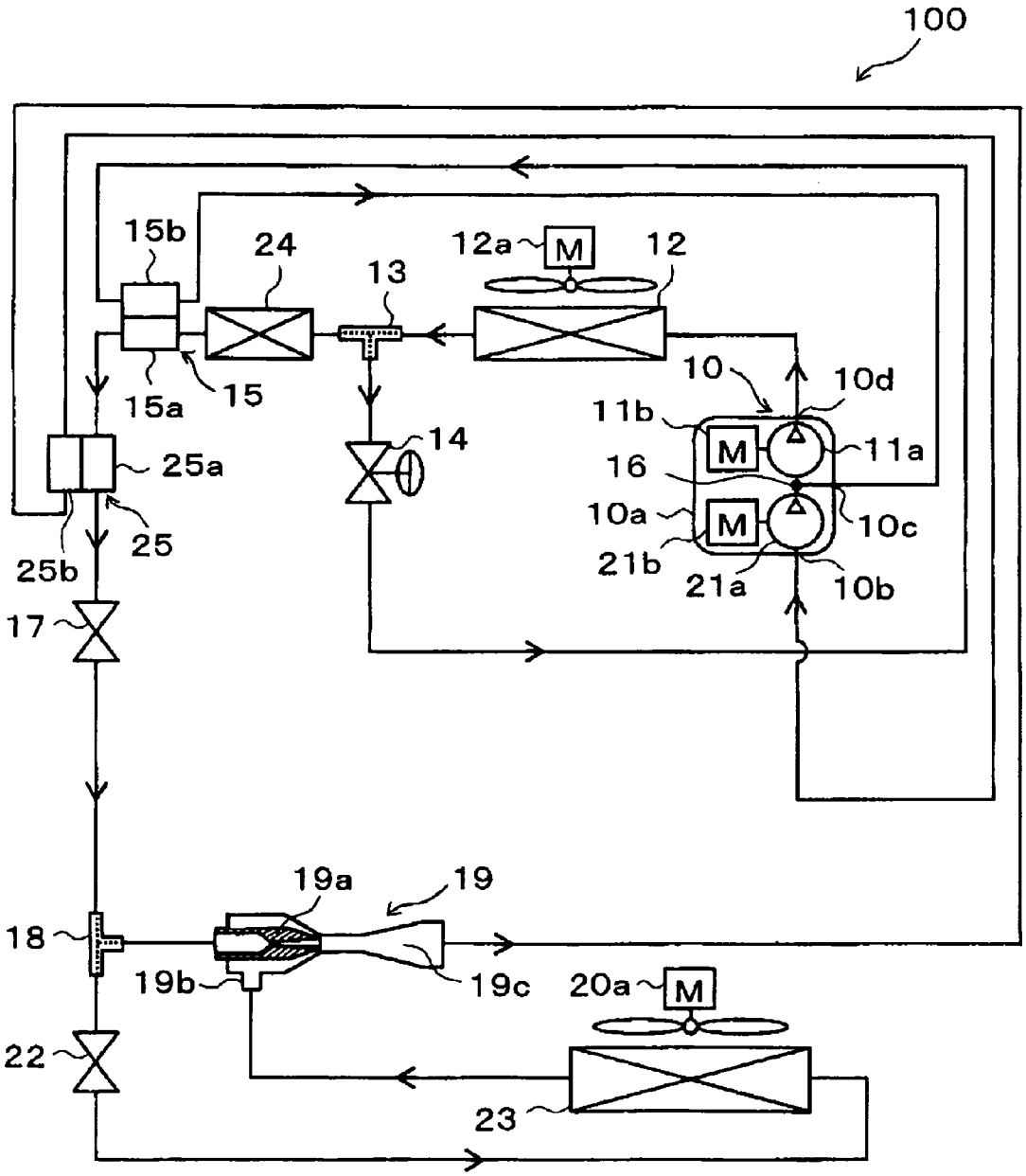
FIG. 38 is an entire schematic diagram of an ejector-type refrigerant cycle device according to a 30th embodiment of the invention.

In the 30th embodiment, as shown in the entire schematic diagram of FIG. 38, similarly to the 27th embodiment, the first compressor 11 and the second compressor 21 of the 4th embodiment are configured as the single compressor 10. That is, as the compressor 10, a two-step pressurizing electrical compressor is used, so that a cycle similar to the 4th embodiment can be configured.

When the ejector-type refrigerant cycle device 100 of the present embodiment is operated, the cycle is operated similarly to the 4th embodiment, and thereby the same effects similarly to the 4th embodiment can be obtained. Furthermore, size reduction and low cost of the compressor 10 can be achieved.

Figure 39:
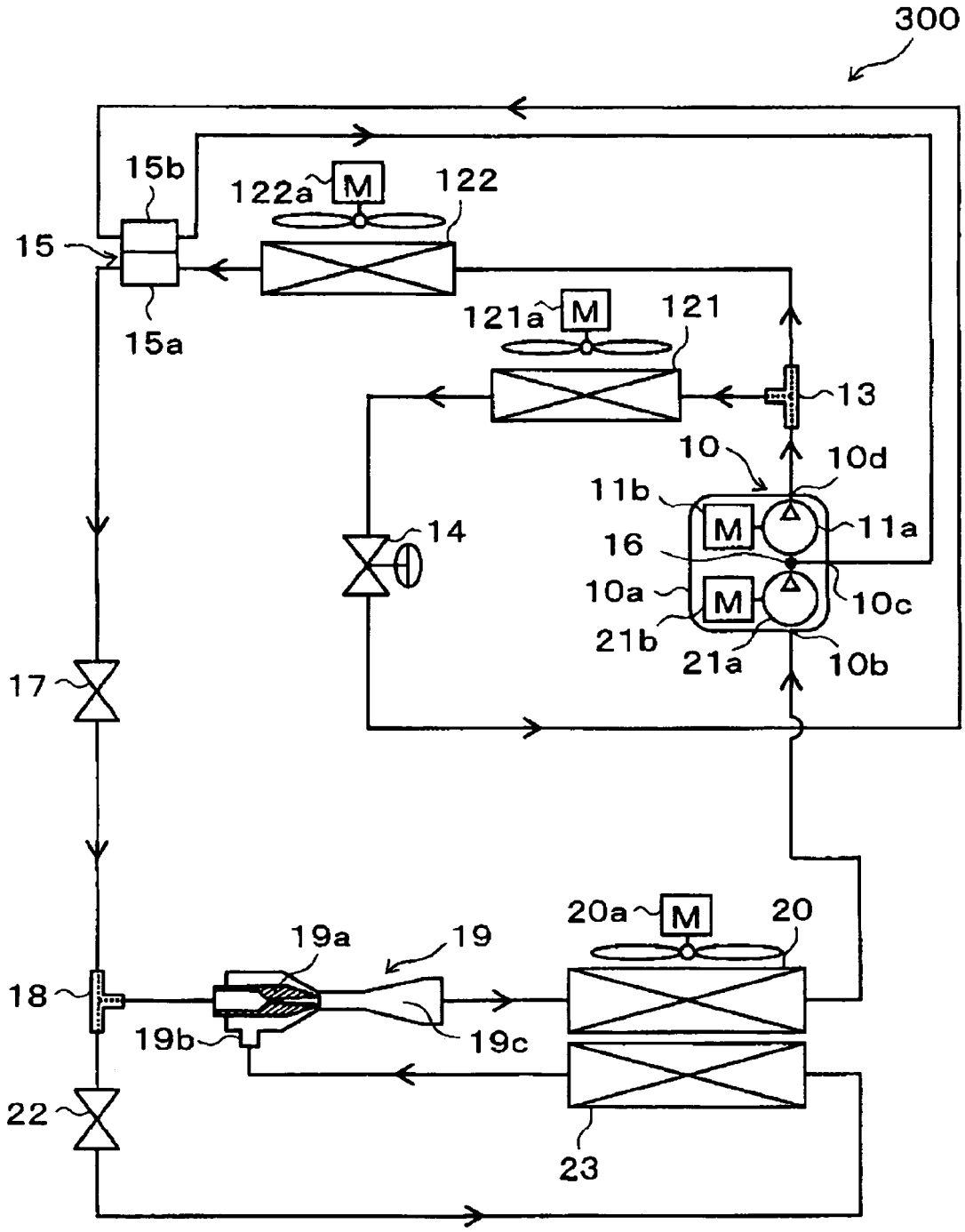
FIG. 39 is an entire schematic diagram of an ejector-type refrigerant cycle device according to a 31st embodiment of the invention.

In the 31st embodiment, as shown in the entire schematic diagram of FIG. 39, similarly to the 27th embodiment, the first compressor 11 and the second compressor 21 of the 7th embodiment are configured as the single compressor 10. That is, as the compressor 10, a two-step pressurizing electrical compressor is used, so that a cycle similar to the 7th embodiment can be configured.

When the ejector-type refrigerant cycle device 100 of the present embodiment is operated, the cycle is operated similarly to the 7th embodiment, and thereby the same effects similarly to the 7th embodiment can be obtained. Furthermore, size reduction and low cost of the compressor 10 can be achieved.

Figure 40:
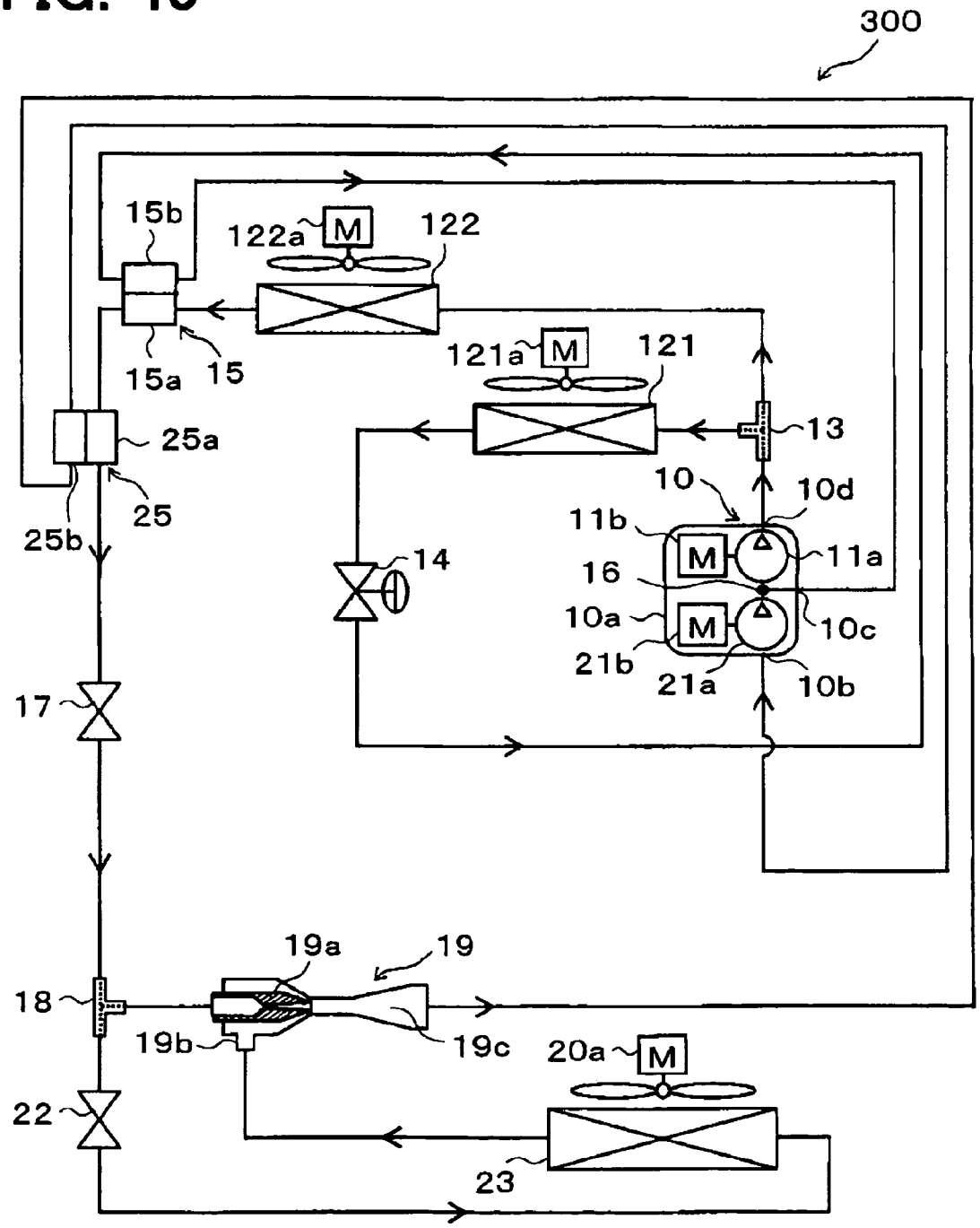
FIG. 40 is an entire schematic diagram of an ejector-type refrigerant cycle device according to a 32nd embodiment of the invention.

In the 32th embodiment, as shown in the entire schematic diagram of FIG. 40, similarly to the 27th embodiment, the first compressor 11 and the second compressor 21 of the 8th embodiment are configured as the single compressor 10. That is, as the compressor 10, a two-step pressurizing electrical compressor is used, so that a cycle similar to the 8th embodiment can be configured.

When the ejector-type refrigerant cycle device 100 of the present embodiment is operated, the cycle is operated similarly to the 8th embodiment, and thereby the same effects similarly to the 8th embodiment can be obtained. Furthermore, size reduction and low cost of the compressor 10 can be achieved.

With respect to the ejector-type refrigerant cycle device 200 of the 5th or 6th embodiment, a two-step pressurizing electrical compressor may be used.

(33rd Embodiment)

The above-described embodiments describe regarding an example in which general flon-based refrigerant is used as the refrigerant, so as to constitute a sub-critical refrigerant cycle in which the pressure of the refrigerant discharged from the compressor 11 becomes lower than the critical pressure of the refrigerant. However, the present embodiment describe regarding an example in which carbon dioxide is used as the refrigerant, so as to constitute a super-critical refrigerant cycle in which the pressure of the refrigerant discharged from the first compressor 11 becomes higher than the critical pressure of the refrigerant.

Figure 41:
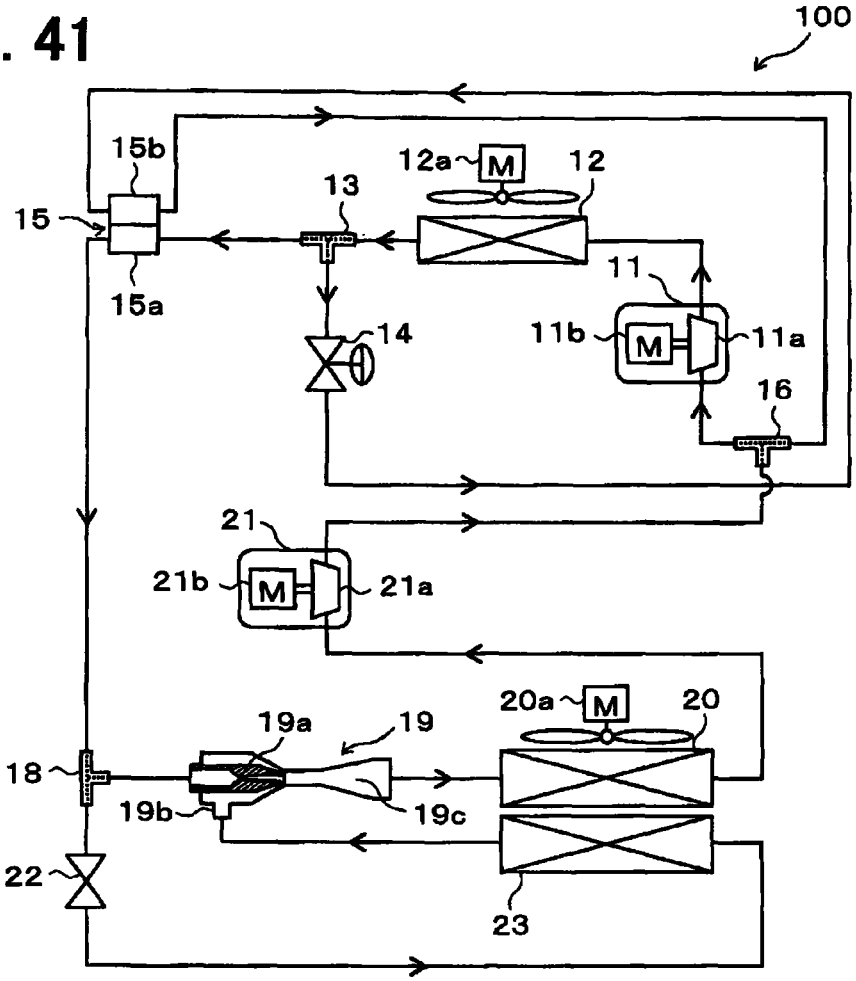
FIG. 41 is an entire schematic diagram of an ejector-type refrigerant cycle device according to a 33rd embodiment of the invention.

In the present embodiment, as shown in the entire schematic diagram of FIG. 41, the first fixed throttle 17 that is the pre-nozzle decompression portion is omitted with respect to the 1st embodiment. The other configurations in the present embodiment are similar to those of the 1st embodiment.

Next, operation of the ejector-type refrigerant cycle device 100 of the present embodiment will be described based on the Mollier diagram shown in FIG. 42. When the ejector-type refrigerant cycle device 100 of the present embodiment is operated, the refrigerant discharged from the first compressor 11 is radiated and cooled in the radiator 12. At this time, the refrigerant passing through the radiator 12 is heat-radiated in a super-critical state without being condensed (point $a_{42}$→point $b_{42}$).

The refrigerant flowing out of the radiator 12 flows into the first branch portion 13, and is branched by the first branch portion 13 into a flow of the refrigerant flowing toward the thermal expansion valve 14 and a flow of the refrigerant flowing toward the high-pressure side refrigerant passage 15*a* of the inner heat exchanger 15. High-pressure refrigerant of the super-critical state flowing from the first branch portion 13 into the high-pressure side refrigerant passage 15*a* of the inner heat exchanger 15 is radiated in the super-critical state (point $b_{42}$→point $f_{42}$).

The flow of the refrigerant flowing out of the high-pressure side refrigerant passage 15*a* of the inner heat exchanger 15 flows into the second branch portion 18, and is branched by the second branch portion 18 into a flow of the refrigerant flowing toward the nozzle portion 19*a* of the ejector 19 and a flow of the refrigerant flowing toward the second fixed throttle 22. The high-pressure refrigerant of the super-critical state flowing into the nozzle portion 19*a* from the second branch portion 18 is decompressed and expanded in isoentropy in the nozzle portion 19*a* (point $f_{42}$→point $h_{42}$).

On the other hand, the high-pressure refrigerant of the super-critical state flowing into the second fixed throttle 22 from the second branch portion 18 is decompressed and expanded in iso-enthalpy in the second fixed throttle 22 (point $f_{42}$→point $m_{42}$). The other operation of the present embodiment is similar to that of the 1st embodiment. Thus, in the configuration of the present embodiment, the effects similar to (A)-(E) of the 1st embodiment can be obtained.

Figure 42:
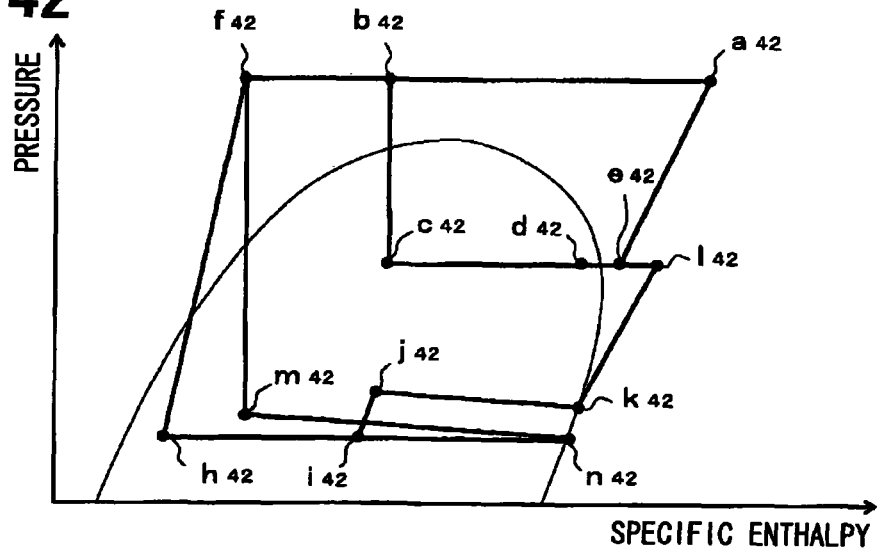
FIG. 42 is a Mollier diagram showing a refrigerant state in the ejector-type refrigerant cycle device according to the 33rd embodiment.

In the super-critical refrigerant cycle, the pressure of the high-pressure side refrigerant is higher than that in the sub-critical refrigerant cycle, a pressure difference between the high pressure and low pressure is enlarged, thereby increasing a decompression amount (pressure difference between point $f_{42}$ and point $h_{42}$ in FIG. 42) in the nozzle portion 19*a* of the ejector 19. Thus, a difference (recovery energy amount) between the enthalpy, of the refrigerant at the inlet side of the nozzle portion 19*a* and the enthalpy of the refrigerant at the outlet side of the nozzle portion 19*aa* can be increased, thereby further improving the COP.

(34th Embodiment)

Figure 43:
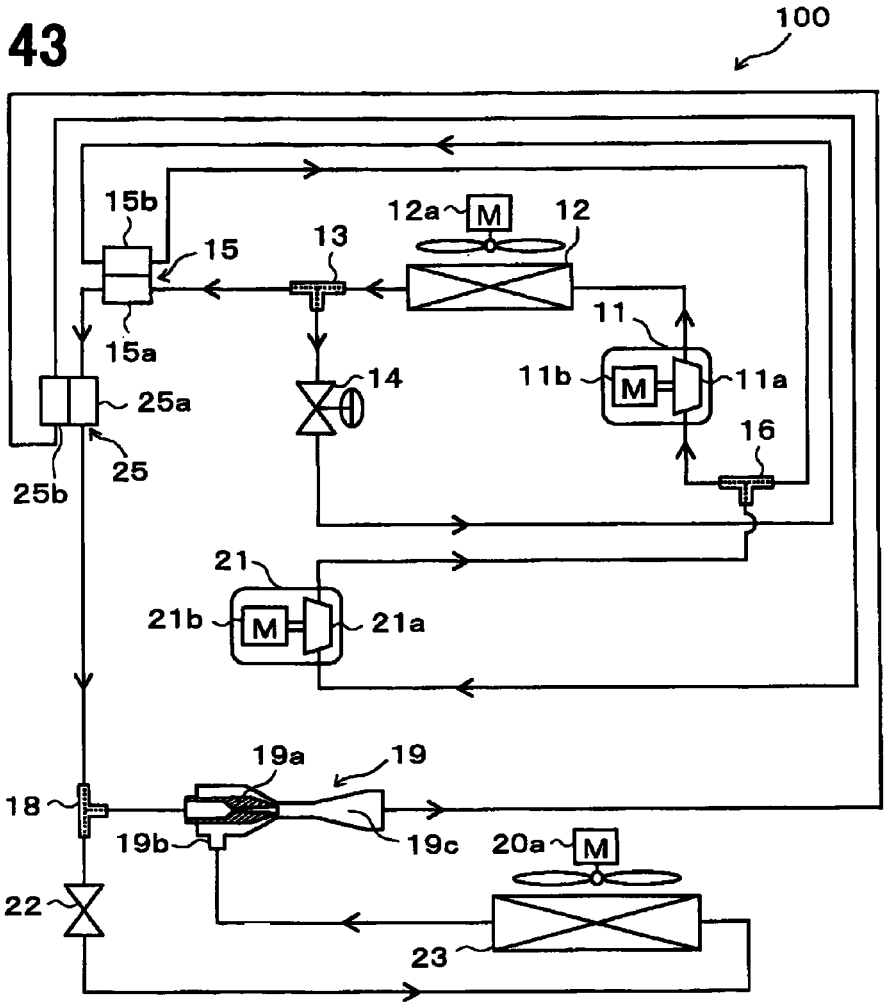
FIG. 43 is an entire schematic diagram of an ejector-type refrigerant cycle device according to a 34th embodiment of the invention.

In the present embodiment, as shown in the entire schematic diagram of FIG. 43, similarly to the 33th embodiment, the first fixed throttle 17 is omitted, and a super-critical refrigerant cycle in which the pressure of the refrigerant discharged from the first compressor 11 becomes higher than the critical pressure of the refrigerant is configured, with respect to the ejector-type refrigerant cycle device 100 of the 2nd embodiment.

Thus, when the ejector-type refrigerant cycle device 100 of the present embodiment is operated, the same effects as (B)-(E) of the 1st embodiment can be obtained, and the improvement effect of the COP as in the 2nd embodiment can be obtained.

Figure 44:
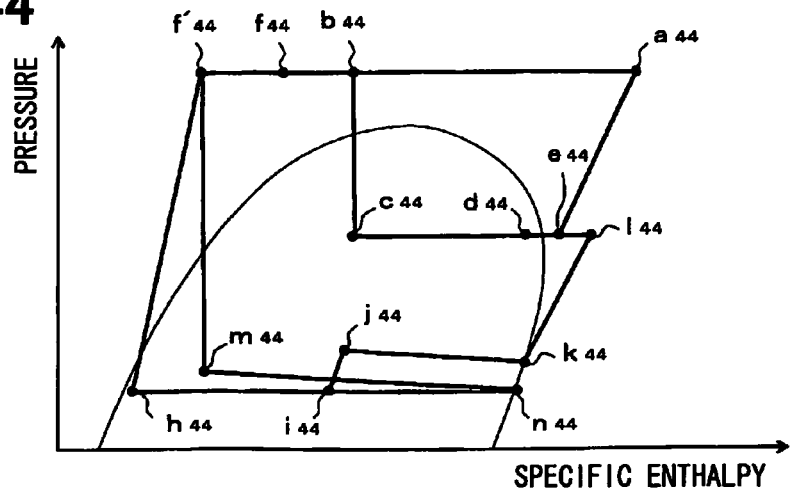
FIG. 44 is a Mollier diagram showing a refrigerant state in the ejector-type refrigerant cycle device according to the 34th embodiment.

Furthermore, as in the Mollier diagram of FIG. 44, a pressure difference between the high pressure and low pressure is enlarged as compared with the sub-critical refrigerant cycle, thereby increasing a decompression amount (pressure difference between point $f'_{44}$ and point $h_{44}$ in FIG. 44) in the nozzle portion 19*a*, of the ejector 19. Thus, similarly to the 33rd embodiment, a difference (recovery energy amount) between the enthalpy of the refrigerant at the inlet side of the nozzle portion 19*a* and the enthalpy of the refrigerant at the outlet side of the nozzle portion 19*a* can be increased, thereby further improving the COP.

(35th Embodiment)

Figure 45:
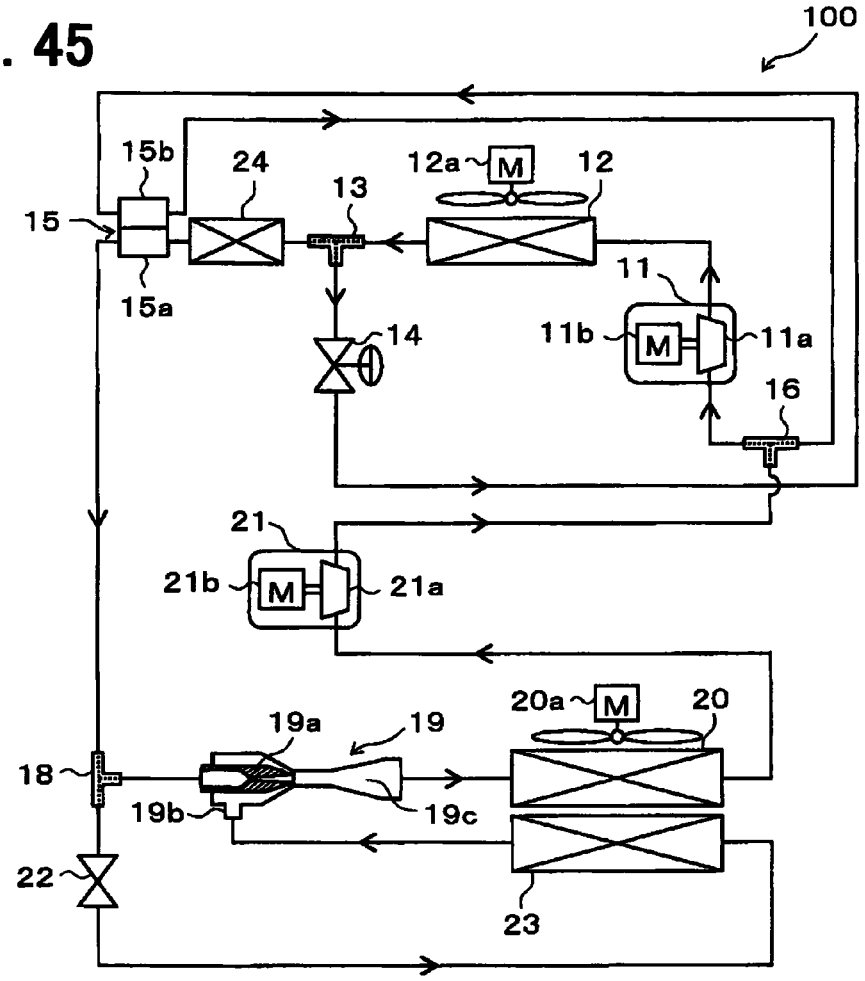
FIG. 45 is an entire schematic diagram of an ejector-type refrigerant cycle device according to a 35th embodiment of the invention.

In the present embodiment, as shown in the entire schematic diagram of FIG. 45, similarly to the 33th embodiment, the first fixed throttle 17 is omitted, and a super-critical refrigerant cycle in which the pressure of the refrigerant discharged from the first compressor 11 becomes higher than the critical pressure of the refrigerant is configured, with respect to the ejector-type refrigerant cycle device 100 of the 3rd embodiment.

Thus, when the ejector-type refrigerant cycle device 100 of the present embodiment is operated, the same effects as (A)-(E) of the 1st embodiment can be obtained, and the improvement effect of the COP and the increasing effect of the cooling capacity as in the 3rd embodiment can be obtained.

Figure 46:
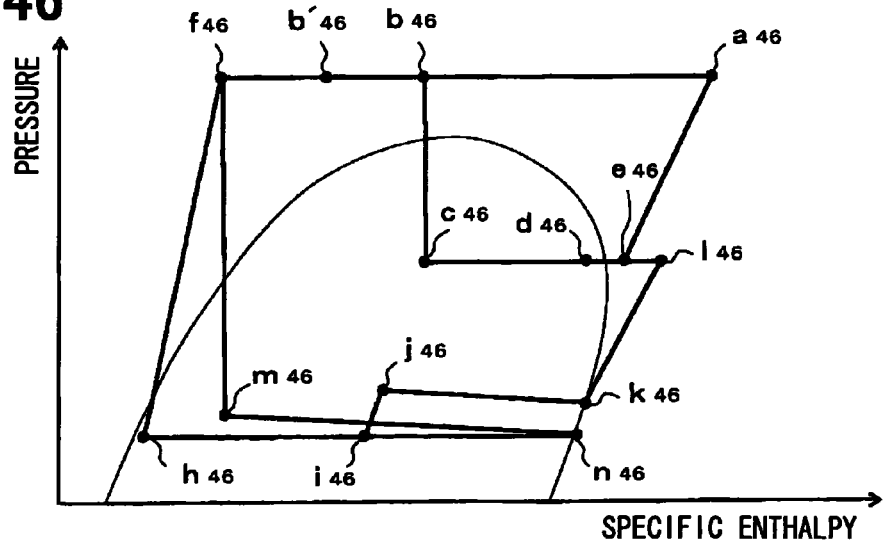
FIG. 46 is a Mollier diagram showing a refrigerant state in the ejector-type refrigerant cycle device according to the 35th embodiment.

Furthermore, as in the Mollier diagram of FIG. 46, a pressure difference between the high pressure and low pressure is enlarged as compared with the sub-critical refrigerant cycle, thereby increasing a decompression amount (pressure difference between point $f_{46}$ and point $h_{46}$ in FIG. 46) in the nozzle portion 19*a* of the ejector 19. Thus, similarly to the 33rd embodiment, a difference (recovery energy amount) between the enthalpy of the refrigerant at the inlet side of the nozzle portion 19*a* and the enthalpy of the refrigerant at the outlet side of the nozzle portion 19*a* can be increased, thereby further improving the COP.

(36th Embodiment)

Figure 47:
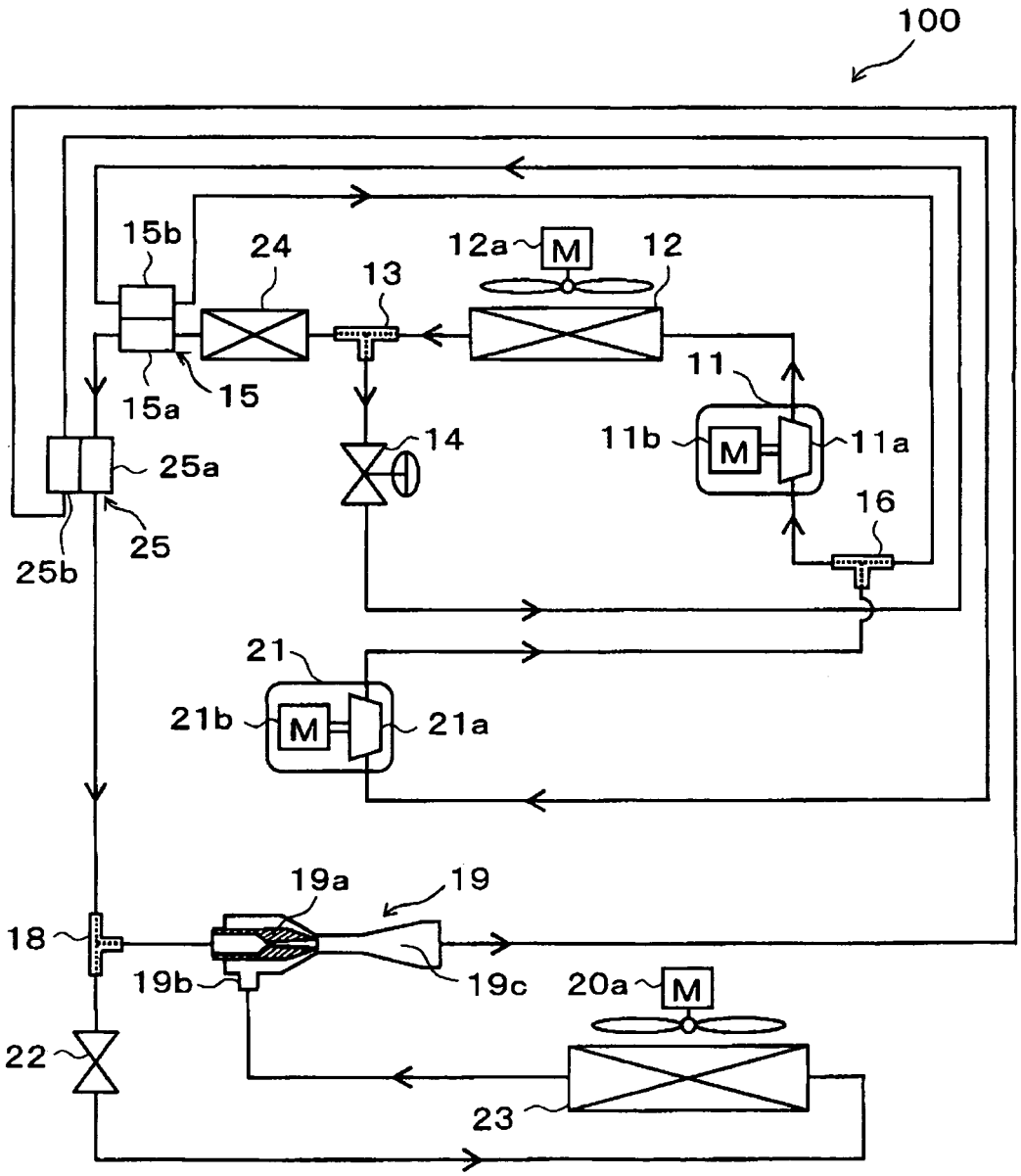
FIG. 47 is an entire schematic diagram of an ejector-type refrigerant cycle device according to a 36th embodiment of the invention.

In the present embodiment, as shown in the entire schematic diagram of FIG. 47, similarly to the 33th embodiment, the first fixed throttle 17 is omitted, and a super-critical refrigerant cycle in which the pressure of the refrigerant discharged from the first compressor 11 becomes higher than the critical pressure of the refrigerant is configured, with respect to the ejector-type refrigerant cycle device 100 of the 4th embodiment.

Thus, when the ejector-type refrigerant cycle device 100 of the present embodiment is operated, the same effects as (B)-(E) of the 1st embodiment can be obtained, and the improvement effect of the COP as in the 4th embodiment can be obtained.

Figure 48:
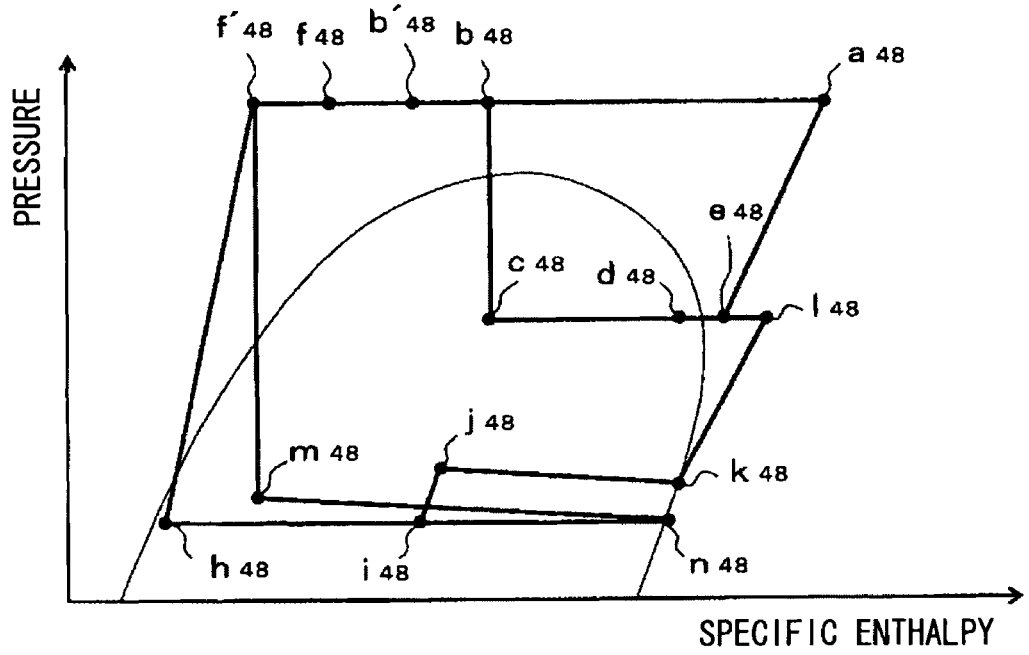
FIG. 48 is a Mollier diagram showing a refrigerant state in the ejector-type refrigerant cycle device according to the 36th embodiment.

Furthermore, as in the Mollier diagram of FIG. 48, a pressure difference between the high pressure and low pressure is enlarged as compared with the sub-critical refrigerant cycle, thereby increasing a decompression amount (pressure difference between point $f'_{48}$ and point $h'_{48}$ in FIG. 48) in the nozzle portion 19*a* of the ejector 19. Thus, similarly to the 33rd embodiment, a difference (recovery energy amount) between the enthalpy of the refrigerant at the inlet side of the nozzle portion 19*a* and the enthalpy of the refrigerant at the outlet side of the nozzle portion 19*a* can be increased, thereby further improving the COP.

(37th Embodiment)

Figure 49:
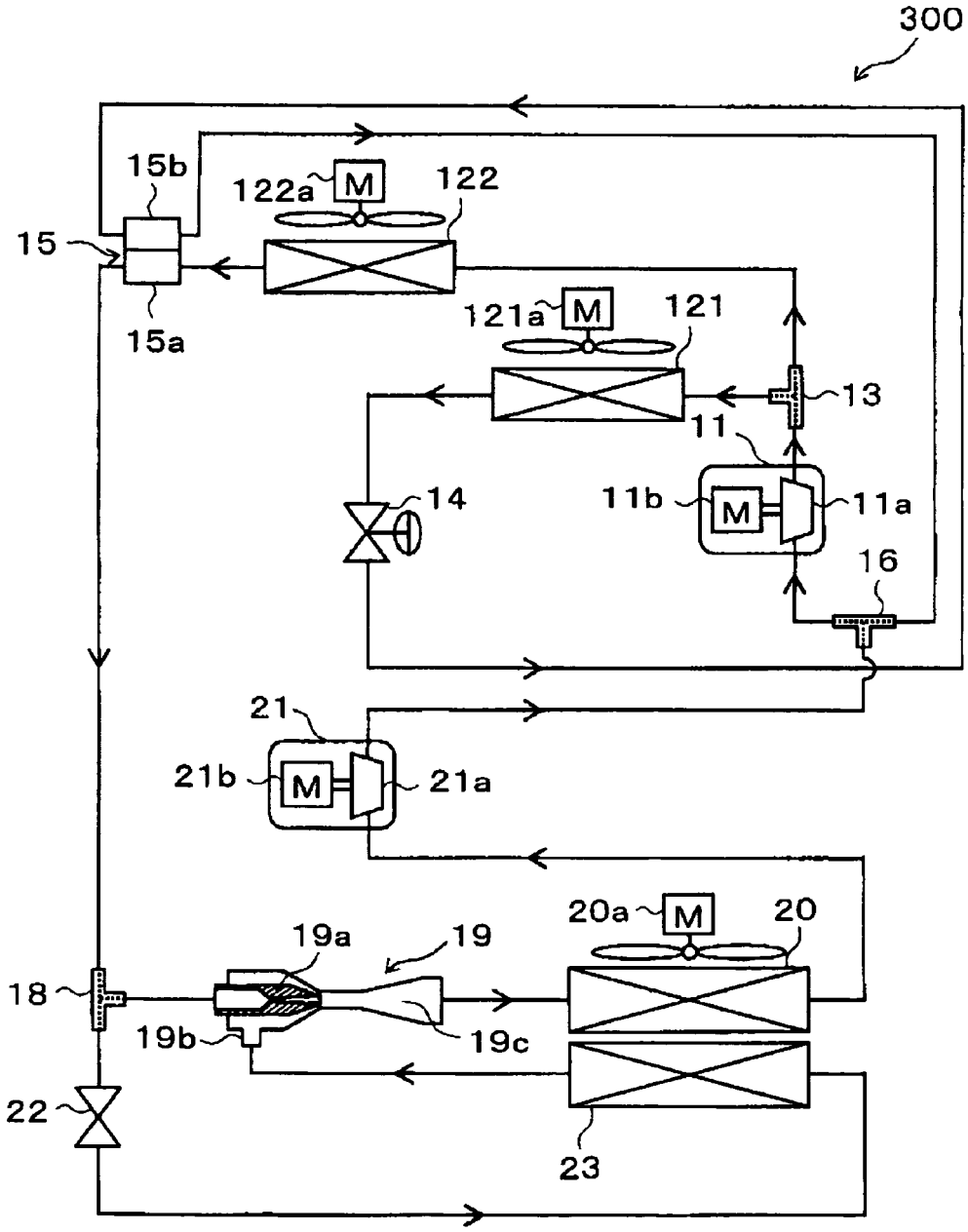
FIG. 49 is an entire schematic diagram of an ejector-type refrigerant cycle device according to a 37th embodiment of the invention.

In the present embodiment, as shown in the entire schematic diagram of FIG. 49, similarly to the 33th embodiment, the first fixed throttle 17 is omitted, and a super-critical refrigerant cycle in which the pressure of the refrigerant discharged from the first compressor 11 becomes higher than the critical pressure of the refrigerant is configured, with respect to the ejector-type refrigerant cycle device 300 of the 7th embodiment.

Thus, when the ejector-type refrigerant cycle device 300 of the present embodiment is operated, the same effects as (B), (C), (E) of the 1st embodiment can be obtained, and the refrigerant cycle can be stably operated while it can prevent the refrigerator oil from staying in the discharge side evaporator 20 and the suction side evaporator 23 as in the 7th embodiment.

Figure 50:
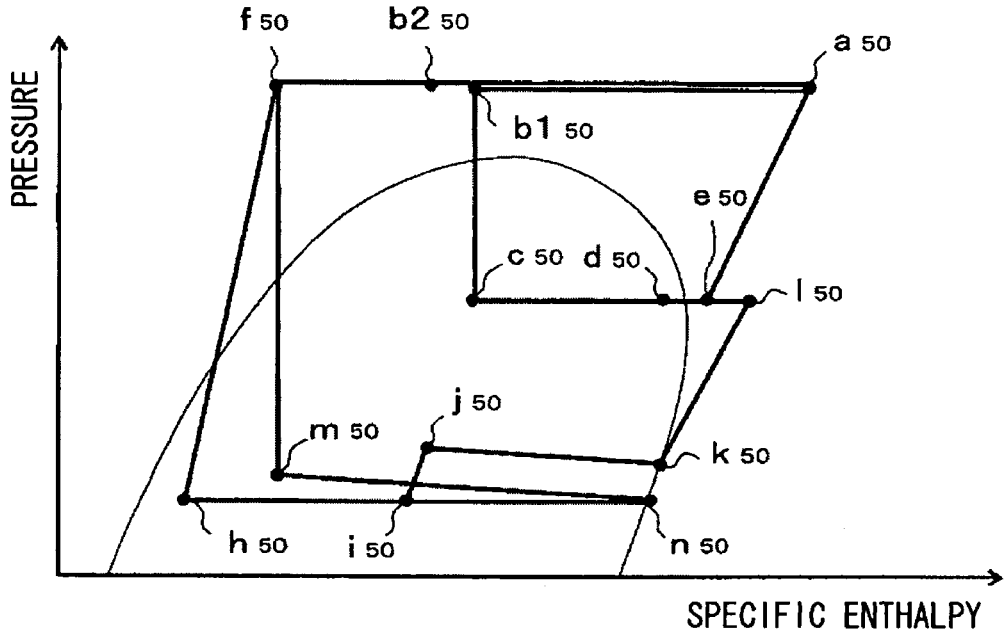
FIG. 50 is a Mollier diagram showing a refrigerant state in the ejector-type refrigerant cycle device according to the 37th embodiment.

Furthermore, as in the Mollier diagram of FIG. 50, a pressure difference between the high pressure and low pressure is enlarged as compared with the sub-critical refrigerant cycle, thereby increasing a decompression amount (pressure difference between point $f_{50}$ and point $h_{50}$ in FIG. 50) in the nozzle portion 19*a* of the ejector 19. Thus, similarly to the 33th embodiment, a difference (recovery energy amount) between the enthalpy of the refrigerant at the inlet side of the nozzle portion 19*a* and the enthalpy of the refrigerant at the outlet side of the nozzle portion 19*a* can be increased, thereby further improving the COP.

(38th Embodiment)

Figure 51:
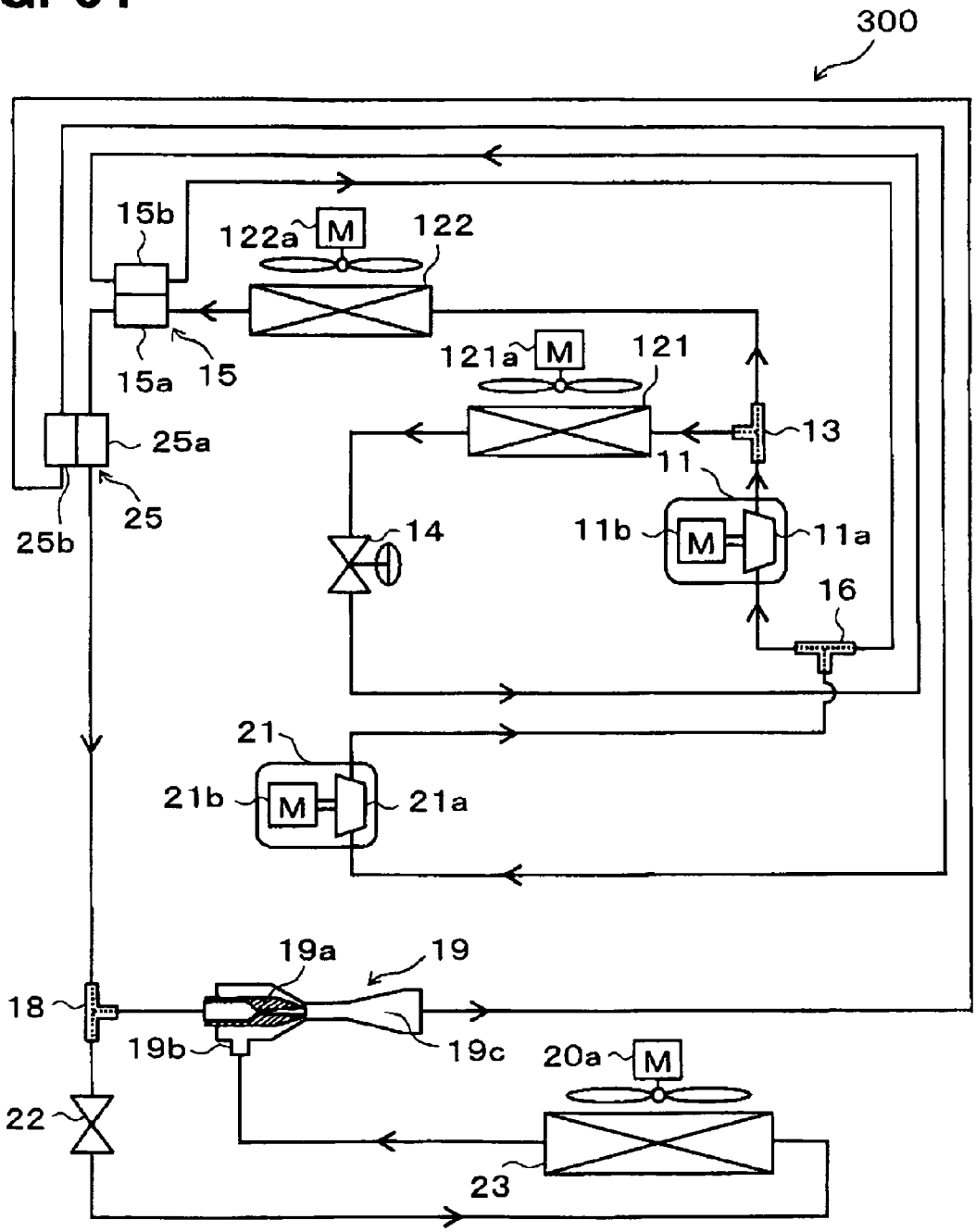
FIG. 51 is an entire schematic diagram of an ejector-type refrigerant cycle device according to a 38th embodiment of the invention.

In the present embodiment, as shown in the entire schematic diagram of FIG. 51, similarly to the 33th embodiment, the first fixed throttle 17 is omitted, and a super-critical refrigerant cycle in which the pressure of the refrigerant discharged from the first compressor 11 becomes higher than the critical pressure of the refrigerant is configured, with respect to the ejector-type refrigerant cycle device 100 of the 8th embodiment.

Thus, when the ejector-type refrigerant cycle device 100 of the present embodiment is operated, the same effects as (B), C), (E) of the 1st embodiment can be obtained, and the improvement effect of the COP as in the 8th embodiment can be obtained, and the refrigerant cycle can be stably operated while it can prevent the refrigerator oil from staying in the discharge side evaporator 20 and the suction side evaporator 23 as in the 8th embodiment.

Figure 52:
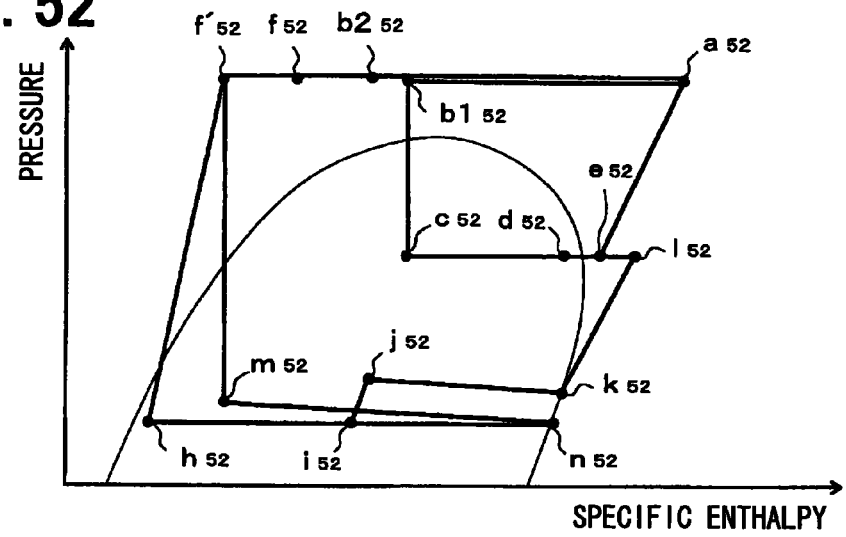
FIG. 52 is a Mollier diagram showing a refrigerant state in the ejector-type refrigerant cycle device according to the 38th embodiment.

Furthermore, as in the Mollier diagram of FIG. 52, a pressure difference between the high pressure and low pressure is enlarged as compared with the sub-critical refrigerant cycle, thereby increasing a decompression amount (pressure difference between point $f'_{52}$ and point $h_{52}$ in FIG. 52) in the nozzle portion 19*a* of the ejector 19. Thus, a difference (recovery energy amount) between the enthalpy of the refrigerant at the inlet side of the nozzle portion 19*a* and the enthalpy of the refrigerant at the outlet side of the nozzle portion 19*a* can be increased, thereby further improving the COP.

In the 33th-38th embodiments, the ejector-type refrigerant cycle devices 100, 300 of the 1st-4th, 7th, 8th embodiments are configured as the super-critical refrigerant cycles, respectively. However, the ejector-type refrigerant cycle devices 200 of the 5th and 6th embodiments may be configured as the super-critical refrigerant cycles, respectively.

(39th Embodiment)

39th embodiment of the present invention will be described with reference to FIGS. 53, 54A, 54B. In an ejector-type refrigerant cycle device 100 adapted to a refrigerator as in the 1st embodiment, because the refrigerant evaporation temperature in the suction side evaporator 23 becomes lower than 0° C., the suction side evaporator 23 may be easily frosted. When the frost is caused in the suction side evaporator 23, a fluid to be heat-absorbed (i.e., air in the room) may be difficult to flow into the suction side evaporator 23, and heat absorbing of the refrigerant may be restricted, thereby it is difficult to stably operate the refrigerant cycle.

Figure 53:
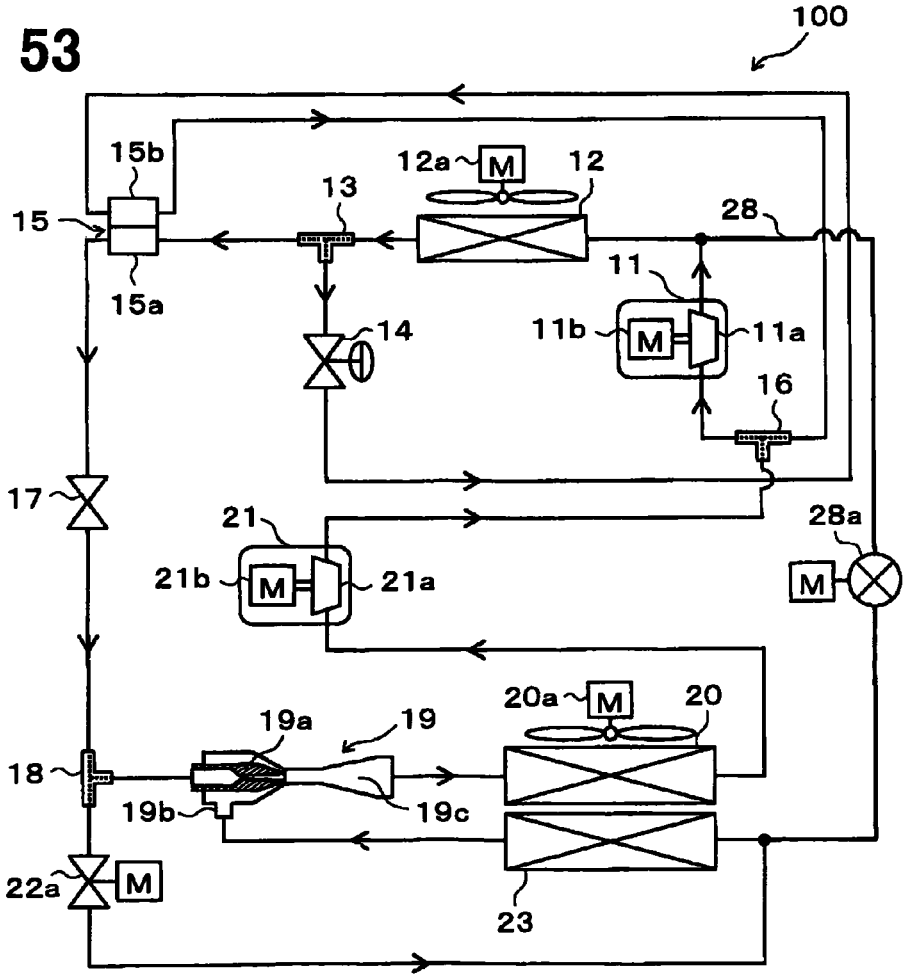
FIG. 53 is an entire schematic diagram of an ejector-type refrigerant cycle device according to a 39th embodiment of the invention.
Figure 54A:
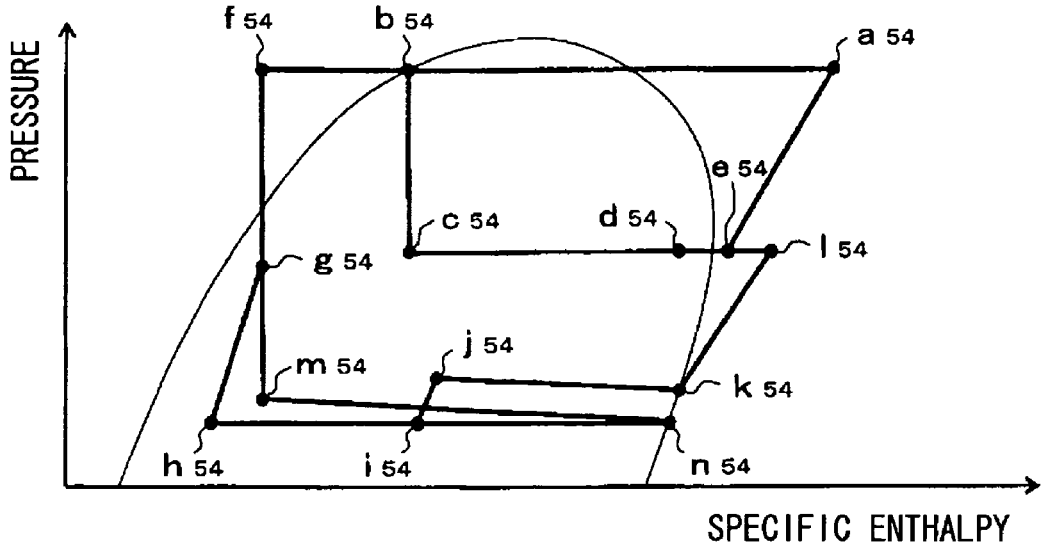
FIG. 54A is a Mollier diagram showing a refrigerant state in a general operation mode according to the 39th embodiment.

In the present embodiment, as shown in the entire schematic diagram of FIG. 53, a bypass passage 28 and an opening/closing valve 28*a* are added and an electrical variable throttle mechanism 22*a* is used as the suction side decompression portion, with respective to the ejector-type refrigerant cycle device 100 of the first embodiment.

The bypass passage 28 is a refrigerant passage through which the high-pressure refrigerant discharged from the compression portion 11*a* of the first compressor 11 is directly introduced to the suction side evaporator 23 while bypassing the radiator 12, and is configured by a refrigerant pipe connected to a position between the first compressor 11 and the radiator 12, and to a position between the variable throttle mechanism 22*a* and the suction side evaporator 23.

The opening/closing valve 28*a* is adapted as an opening/closing portion which opens or closes the bypass passage 28, and is an electromagnetic valve in which its opening and closing operation is controlled by a control signal output from the control device. Furthermore, a refrigerant passage area of the opening/closing valve 28*a*, when the opening/closing valve 28*a* is opened, is formed to be smaller than a refrigerant passage area of the bypass passage 28. Thus, the refrigerant passing through the bypass passage 28 is decompressed while passing through the opening/closing valve 28*a*.

As the opening/closing valve 28*a*, an opening/closing valve with a decompression function is used. It is for securing a pressure difference between the pressure of the suction side refrigerant of the compressor and the pressure of the discharge side refrigerant of the compressor. In addition, it is for preventing the refrigerant pressure inside the suction side evaporator 23 from being larger than the pressure resistance of the suction side evaporator 23 if the high-pressure refrigerant discharged from the compressor 10 directly flow into the suction side evaporator 23.

In the present embodiment, the refrigerant passage area of the opening/closing valve 28*a* is formed smaller, and thereby the pressure of the refrigerant flowing into the suction side evaporator 23 is reduced to the pressure resistance of the suction side evaporator 23.

Thus, when an opening/closing valve 28*a* without the decompression function is arranged in the bypass passage 28, it is prefer to locate a bypass-passage decompression portion in the bypass passage 28. As the bypass-passage decompression portion, a fixed throttle such as a capillary tube, an orifice or the like can be used.

The variable throttle mechanism 22*a* includes a valve body configured to variably change the throttle open degree, and an electrical actuator made of a stepping motor in which a throttle open degree of a valve body is changeable. Operation of the variable throttle mechanism 22*a* is controlled by a control signal output from the control device.

The operation of the present embodiment will be described based on the Mollier diagram of FIGS. 54A, 54B. In the present embodiment, the ejector-type refrigerant cycle device 100 is configured to selectively switch between a generation operation mode for cooling the room of the refrigerator, and a defrosting operation mode for performing a defrosting operation of the suction side evaporator 23 and the discharge side evaporator 20. FIG. 54A is a Mollier diagram showing refrigerant states in the general operation mode, and FIG. 54B is a Mollier diagram showing refrigerant states in the defrosting operation mode.

In the general operation mode, the control device causes the opening/closing valve 28*a* to be in a valve-closing state, and causes the variable throttle mechanism 22*a* to be set at a predetermined throttle degree. Thus, in the general operation mode, the present embodiment is operated similarly to FIG. 2 of the 1st embodiment, as in the Mollier diagram of FIG. 54A.

In contrast, in the defrosting operation mode, the control device causes the operation of the cooling fan 12*a* to be stopped, causes the variable throttle mechanism 22*a* to be in a fully close state, and causes the opening/closing valve 28*a* to be opened. Thus, the high-pressure refrigerant (point $o_{54}$ in FIG. 54B) discharged from the first compressor 11 flows into the bypass passage 28.

At this time, in the present embodiment, a refrigerant circuit having a low pressure loss is set, in which the refrigerant circulates in this order of the first compressor 11→the bypass passage 28→the suction side evaporator 23→the ejector 19→the discharge side evaporator 20→the second compressor 21, with respect to a refrigerant circuit having a large pressure loss in which the refrigerant circulates in this order of the first compressor 11→the radiator 12→the first branch portion 13→the inner heat exchanger 15→the first fixed throttle 17→the second branch portion 18→the ejector 19→the discharge side evaporator 20→the second compressor 21. Therefore, a large amount of the refrigerant discharged from the first compressor 11 flows into the bypass passage 28.

A three-way valve may be arranged in an inlet side connection portion or an outlet side connection portion of the bypass passage 28, so that the refrigerant discharged from the compressor 11 is only introduced to the side of the radiator 12 in the general operation mode, and the refrigerant discharged from the compressor 11 is only introduced to the side of the bypass passage 28 in the defrosting operation mode.

Alternatively, a general auxiliary opening/closing valve without a decompression function may be located in a refrigerant passage from the inlet side connection portion of the bypass passage 28 to the refrigerant inlet side of the radiator 12, so as to switch the refrigerant passage by opening the auxiliary opening/closing valve in the general operation mode or by closing the auxiliary opening/closing valve in the defrosting operation mode.

The high-temperature and high-pressure refrigerant flowing into the bypass passage 28 is decompressed and expanded in iso-enthalpy (point $o_{54}$→point $o_{54}$). Furthermore, gas refrigerant of high-temperature and low-pressure refrigerant having passed through the opening/closing valve 28*a* flows into the suction side evaporator 23 without flowing toward the variable throttle mechanism 22*a* because the throttle open degree of the variable throttle mechanism 22*a* is in the fully close state.

The refrigerant flowing into the suction side evaporator 23 radiates its heat quantity in the suction side evaporator 23 (point $p_{54}$→point $q_{54}$). Thus, the suction side evaporator 23 is defrosted. The refrigerant heat-radiated in the suction side evaporator 23 flows into the refrigerant suction port 19*b* of the ejector 19 by the refrigerant suction action of the second compressor 21, and is decompressed (point $q_{54}$→point $r_{54}$) by a pressure loss caused while passing through the interior of the ejector 19.

The refrigerant flowing out of the ejector 19 flows into the discharge side evaporator 20 to radiate a heat quantity in the discharge side evaporator 20 (point $r_{54}$→point $s_{54}$). Thus, defrosting of the discharge side evaporator 20 is performed. Furthermore, the refrigerant flowing out of the discharge side evaporator 20 flows in this order of the second compressor 21→the join portion 16→the first compressor 11, and is compressed again. (point $s_{54}$→point $t_{54}$→point $o_{54}$)

Thus, in the ejector-type refrigerant cycle device 100 of the present embodiment, the same effects as in the 1st embodiment can be obtained in the general operation mode, and the defrosting of the suction side evaporator 23 and the discharge side evaporator 20 can be performed in the defrosting operation mode.

In the present embodiment, the variable throttle mechanism 22*a* is used as the suction side decompression portion so that the throttle open degree of the variable throttle mechanism 22*a* is in the fully open state in the defrosting operation mode. However, the second fixed throttle 22 may be used as the suction side decompression portion, and a check valve may be located between the refrigerant outlet side of the suction side decompression portion and a connection portion of the bypass passage 28, so as to only allow the flow of the refrigerant from the suction side decompression portion toward the suction side evaporator 23.

In the present embodiment, the heat radiating capacity of the radiator 12 is not exerted when the control device stops the operation of the cooling fan 12*a* in the defrosting operation mode. Thus, for example, the bypass passage 28 may be configured such that high-pressure refrigerant downstream of the radiator 12 and upstream of the first branch portion 13 flows into the bypass passage 28.

(40th Embodiment)

Figure 55:
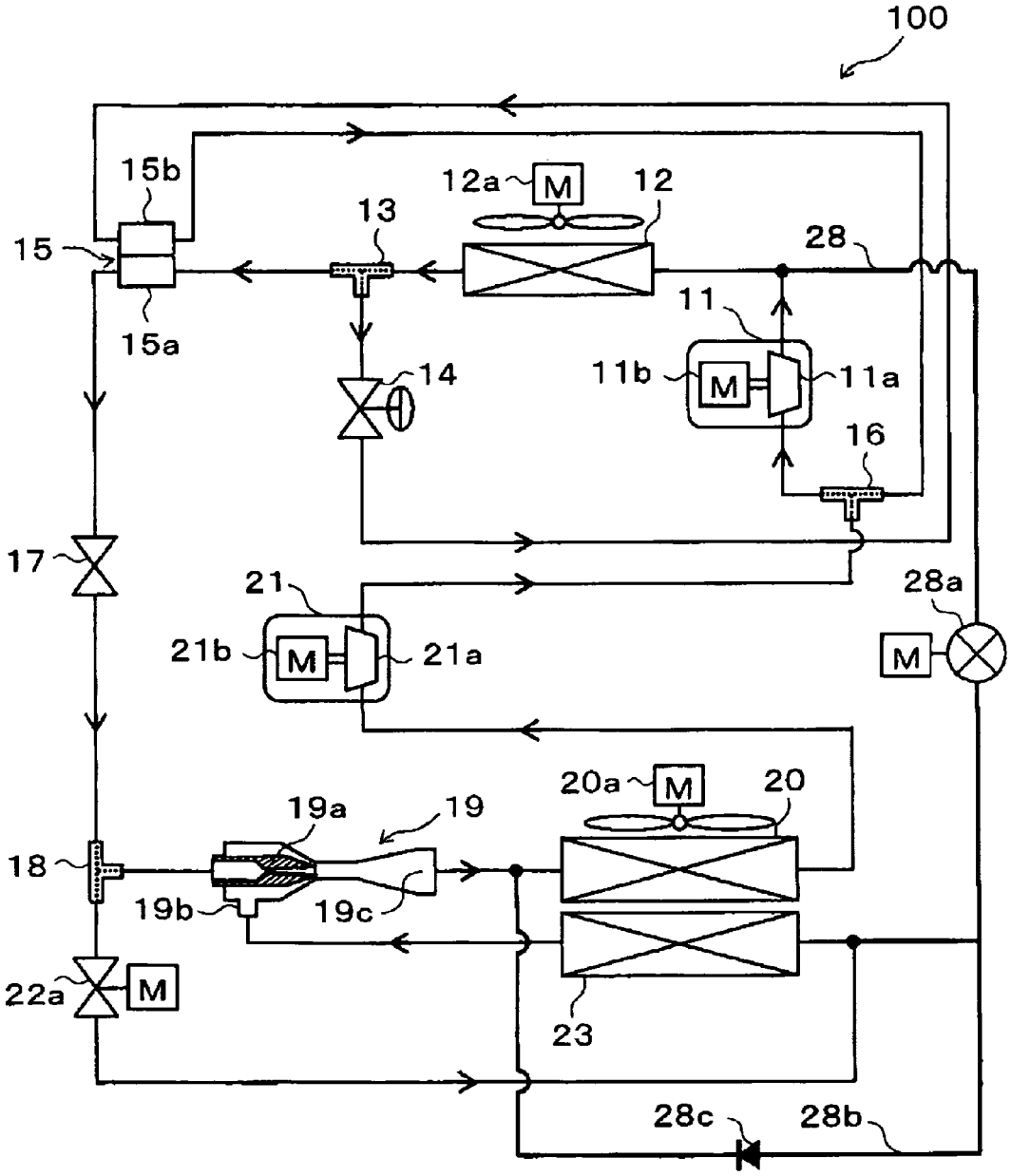
FIG. 55 is an entire schematic diagram of an ejector-type refrigerant cycle device according to a 40th embodiment of the invention.

In the present embodiment, as shown in FIG. 55, an auxiliary bypass passage 28*b* is added with respect to the ejector-type refrigerant cycle device 100 of the 39th embodiment, so that high-pressure refrigerant discharged from the compressor 11 can be introduced to the discharge side evaporator 20 through the auxiliary bypass passage 28*b*.

More specifically, the auxiliary bypass passage 28*b* of the present embodiment is a refrigerant passage connected to a downstream side of the opening/closing valve 28*a* in the bypass passage 28 in the defrosting operation mode, and to a position between the refrigerant discharge side of the diffuser portion 19*c* of the ejector 19 and the refrigerant inlet side of the discharge side evaporator 20.

An auxiliary check valve 28*c*, for prohibiting a flow of the refrigerant flowing from the diffuser portion 19*c* of the ejector 19 into the bypass passage 28 via the auxiliary bypass passage 28*b* in the general operation mode, is arranged in the auxiliary bypass passage 28*b*.

An auxiliary opening/closing valve may be used for opening and closing the auxiliary bypass passage 28*b*, instead of the auxiliary check valve 28*c*. In this case, the auxiliary opening/closing valve is closed in the general operation mode, and is opened in the defrosting operation mode.

Figure 2:
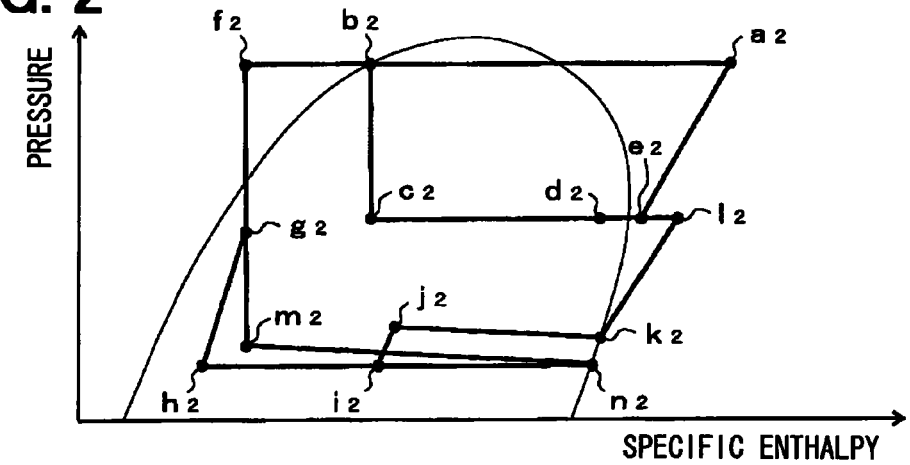
FIG. 2 is a Mollier diagram showing a refrigerant state in the ejector-type refrigerant cycle device according to the 1st embodiment.
Figure 56A:
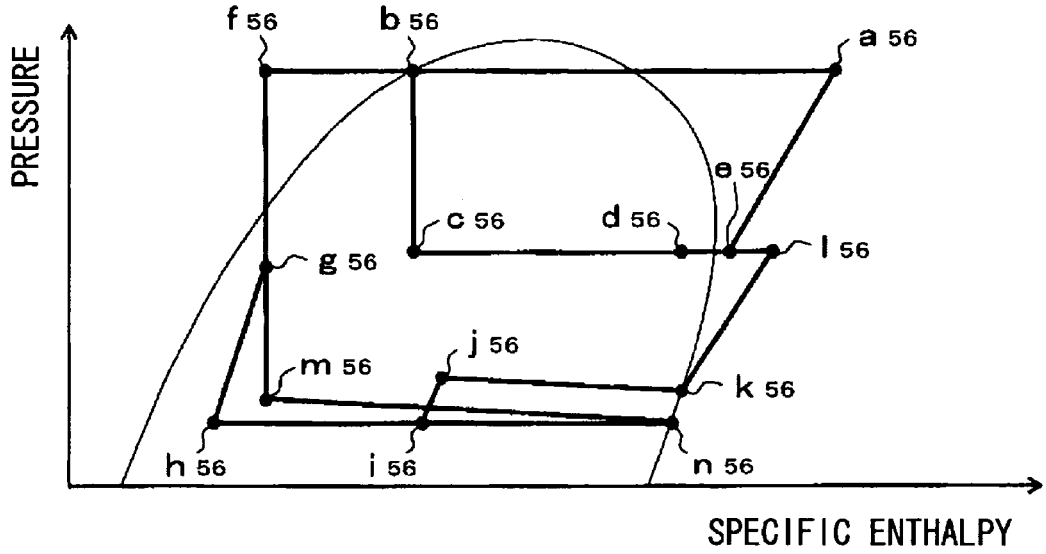
FIG. 56A is a Mollier diagram showing a refrigerant state in a general operation mode according to the 40th embodiment.

Thus, when the ejector-type refrigerant cycle device 100 of the present embodiment is operated in the general operation mode, the present embodiment is operated similarly to FIG. 2 of the 1st embodiment, as in the Mollier diagram of FIG. 56A.

Figure 56B:
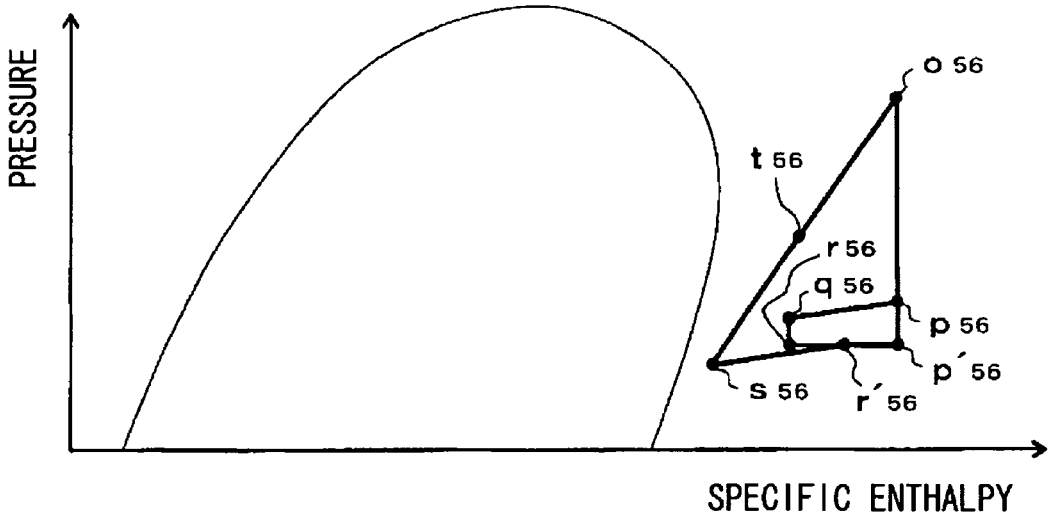
FIG. 56B is a Mollier diagram showing a refrigerant state in a defrosting operation mode according to the 40th embodiment.

In contrast, in the defrosting operation mode, as in the Mollier diagram of FIG. 56B, the high-pressure and high-temperature gas refrigerant discharged from the first compressor 11 flows into the bypass passage 28, and is decompressed and expanded in iso-enthalpy (point $o_{56}$→point $o_{56}$) while passing through the opening/closing valve 28*a*, similarly to the 39th embodiment.

The flow of the refrigerant having been decompressed by the opening/closing valve 28*a* is branched to a flow of the refrigerant flowing toward the suction side evaporator 23 and a flow of the refrigerant flowing toward the auxiliary bypass passage 28*b*. The high-temperature gas refrigerant flowing into the suction side evaporator 23 from the opening/closing valve 28*a* radiates its heat quantity in the suction side evaporator 23 (point $p_{56}$→point $q_{56}$). Thus, the suction side evaporator 23 is defrosted.

The refrigerant heat-radiated in the suction side evaporator 23 flows into the refrigerant suction port 19*b* of the ejector 19 by the refrigerant suction action of the second compressor 21, and is decompressed (point $q_{56}$→point $r_{56}$) by a pressure loss caused while passing through the interior of the ejector 19.

On the other hand, high-temperature gas refrigerant flowing into the auxiliary bypass passage 28*b* from the opening/closing valve 28*a* is decompressed while passing through the check valve 28*c* (point $p_{56}$→point $p'_{56}$), and is joined with the refrigerant flowing out of the diffuser portion 19*c* of the ejector 19 (point $p'_{56}$→point $r'_{56}$, point $r_{56}$→point $r'_{56}$). Furthermore, the joined refrigerant flows into the discharge side evaporator 20, and heat quantity is radiated in the discharge side evaporator 20 (point $r'_{56}$→point $s_{56}$). Thus, the discharge side evaporator 20 is defrosted.

The refrigerant radiated in the discharge side evaporator 20 flows in this order of the second compressor 21→the join portion 16→the first compressor 11, and is compressed again (point $s_{56}$→point $t_{56}$→point $o_{56}$). The other operation of the present embodiment is similar to the 39th embodiment.

Thus, in the ejector-type refrigerant cycle device 100 of the present embodiment, the same effects as in the 1st embodiment can be obtained in the general operation mode, and the defrosting of the suction side evaporator 23 and the discharge side evaporator 20 can be performed in the defrosting operation mode.

(41st Embodiment)

Figure 57:
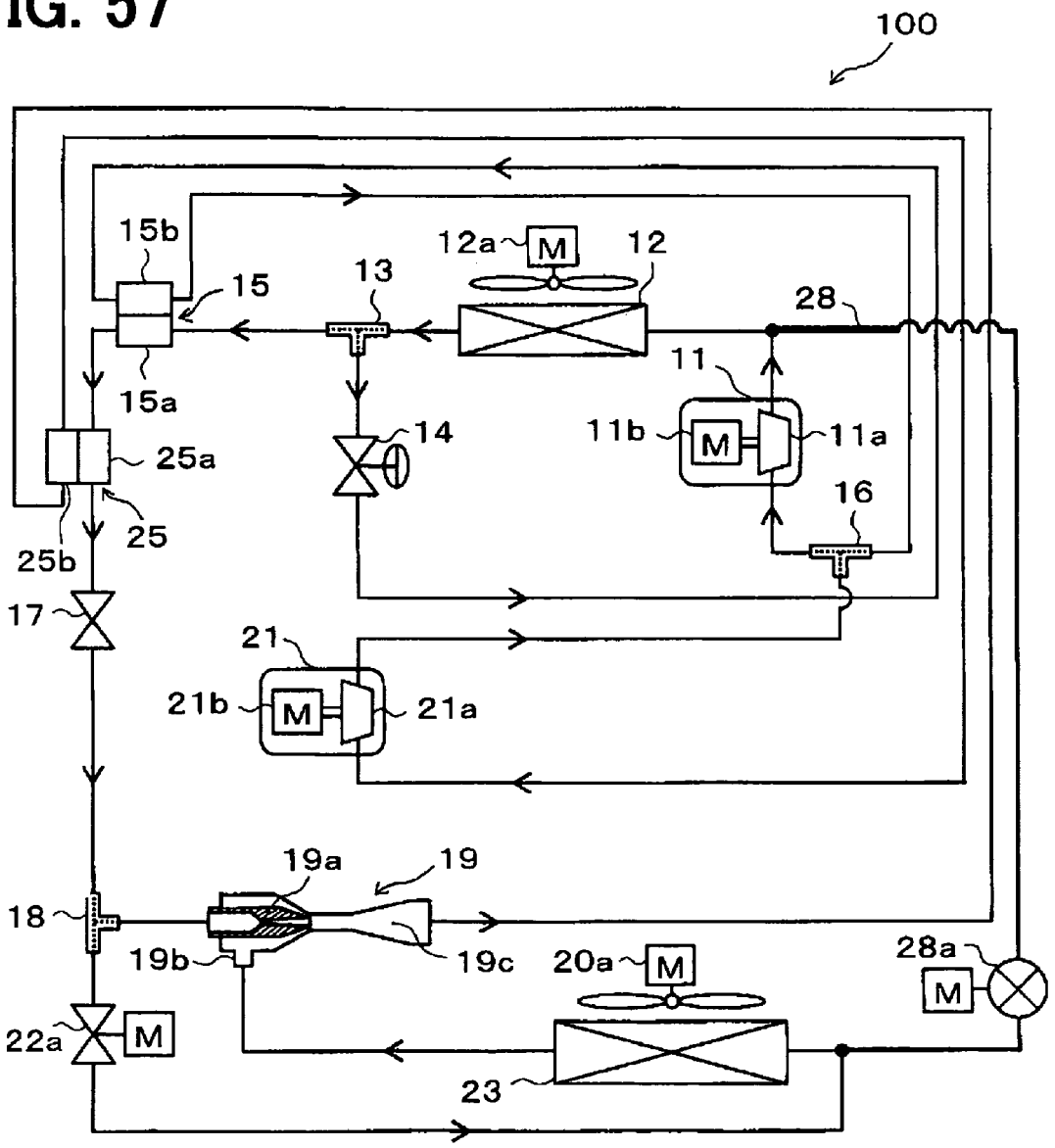
FIG. 57 is an entire schematic diagram of an ejector-type refrigerant cycle device according to a 41st embodiment of the invention.

In the present embodiment, as shown in FIG. 57, similarly to the 39th embodiment, the bypass passage 28 and the opening/closing valve 28*a* are added and the electrical variable throttle mechanism 22*a* is used as the suction side decompression portion so as to perform a defrosting operation mode, with respective to the ejector-type refrigerant cycle device 100 of the 2nd embodiment.

Figure 58A:
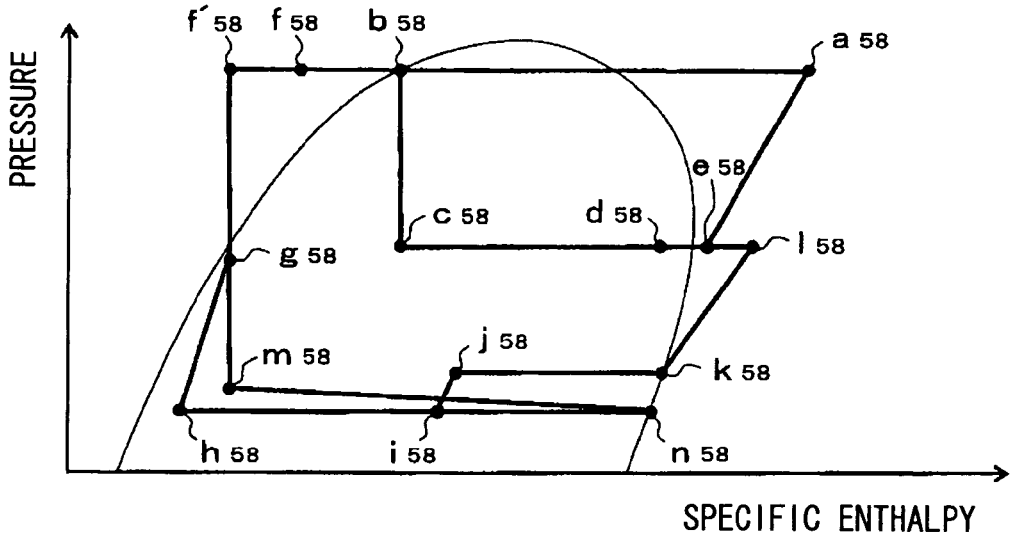
FIG. 58A is a Mollier diagram showing a refrigerant state in a general operation mode according to the 41st embodiment.

When the ejector-type refrigerant cycle device 100 of the present embodiment is operated in the general operation mode, the present embodiment is operated similarly to FIG. 4 of the 2nd embodiment, as in the Mollier diagram of FIG. 58A.

Figure 58B:
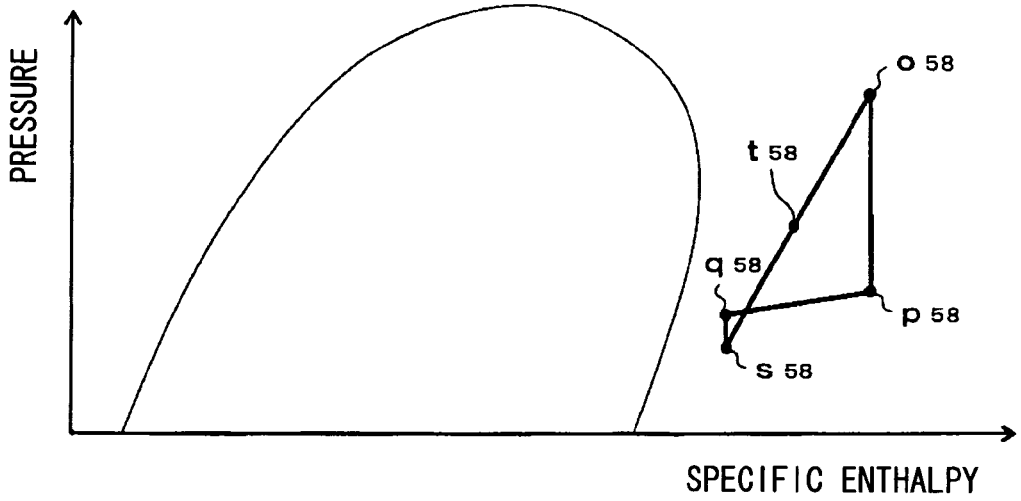
FIG. 58B is a Mollier diagram showing a refrigerant state in a defrosting operation mode according to the 41st embodiment.

In contrast, in the defrosting operation mode, as shown in the Mollier diagram of FIG. 58B, the high-pressure and high-temperature gas refrigerant discharged from the first compressor 11 flows into the bypass passage 28 because the opening/closing valve 28*a* is in the valve open state, and is decompressed and expanded in iso-enthalpy (point $o_{58}$→point $o_{58}$) while passing through the opening/closing valve 28*a*.

The high-temperature gas refrigerant decompressed by the opening/closing valve 28*a* flows into the suction side evaporator 23, and radiates its heat quantity in the suction side evaporator 23 (point $p_{58}$→point $q_{58}$). Thus, the suction side evaporator 23 is defrosted. The refrigerant heat-radiated in the suction side evaporator 23 flows into the refrigerant suction port 19*b* of the ejector 19 by the refrigerant suction action of the second compressor 21, and is decompressed (point $q_{58}$→point $s_{58}$) by a pressure loss caused while passing through the interior of the ejector 19.

The refrigerant flowing out of the ejector 19 flows in this order of the second compressor 21→the join portion 16→the first compressor 11, and is compressed again (point $s_{58}$→point $t_{58}$→point $o_{58}$). The other operation of the present embodiment is similar to the 39th embodiment.

Thus, in the ejector-type refrigerant cycle device 100 of the present embodiment, the same effects as in the 1st embodiment can be obtained in the general operation mode, and the defrosting of the suction side evaporator 23 can be performed in the defrosting operation mode.

(42nd Embodiment)

Figure 59:
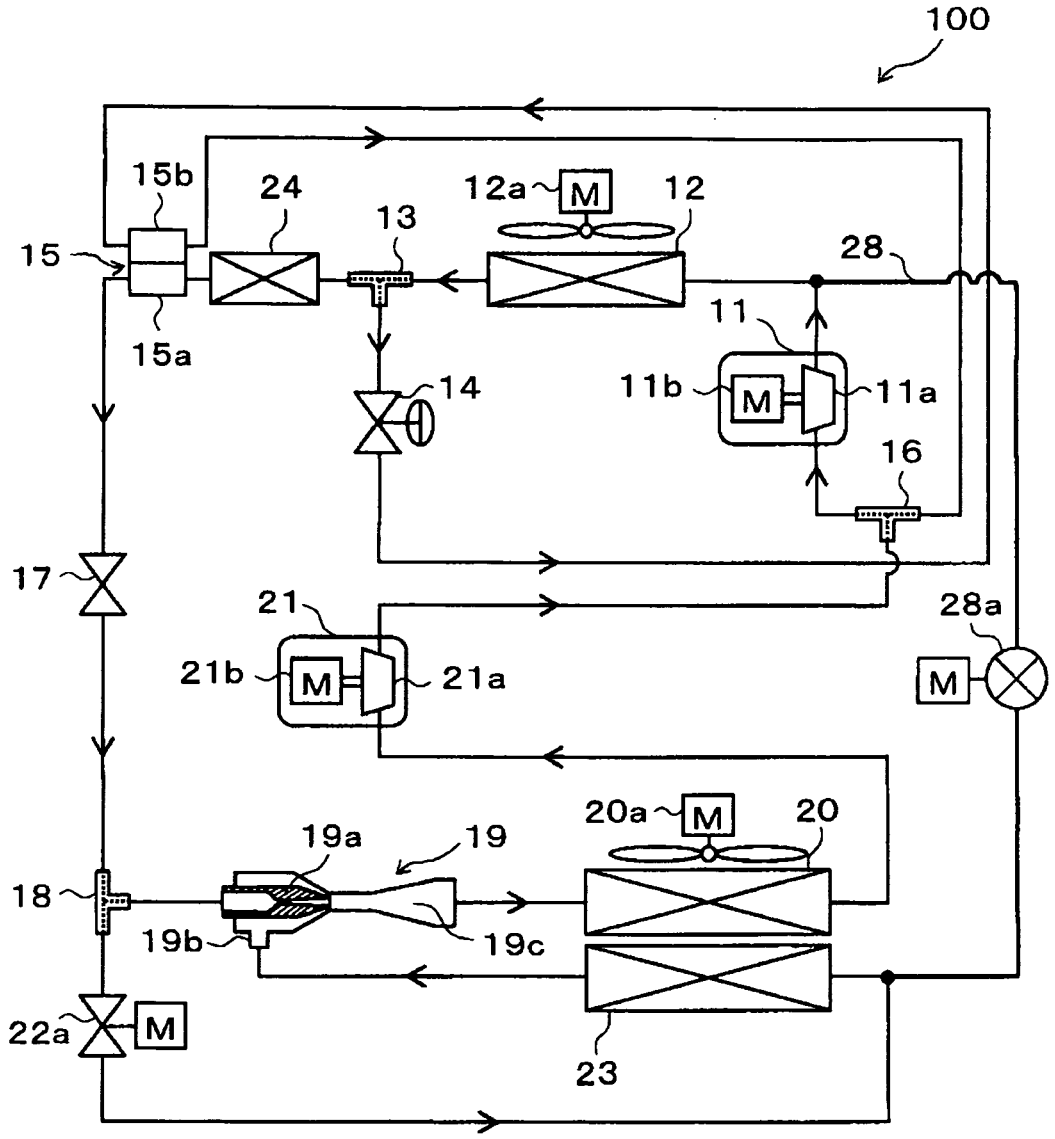
FIG. 59 is an entire schematic diagram of an ejector-type refrigerant cycle device according to a 42nd embodiment of the invention.

In the present embodiment, as shown in FIG. 59, similarly to the 39th embodiment, the bypass passage 28 and the opening/closing valve 28*a* are added and the electrical variable throttle mechanism 22*a* is used as the suction side decompression portion so as to perform a defrosting operation mode, with respective to the ejector-type refrigerant cycle device 100 of the 3rd embodiment.

Figure 60A:
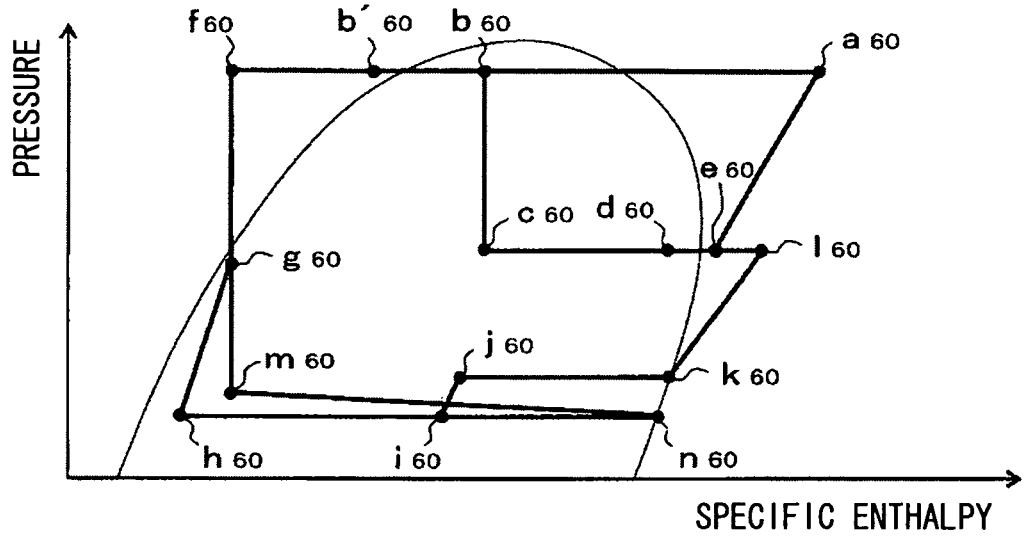
FIG. 60A is a Mollier diagram showing a refrigerant state in a general operation mode according to the 42nd embodiment.
Figure 60B:
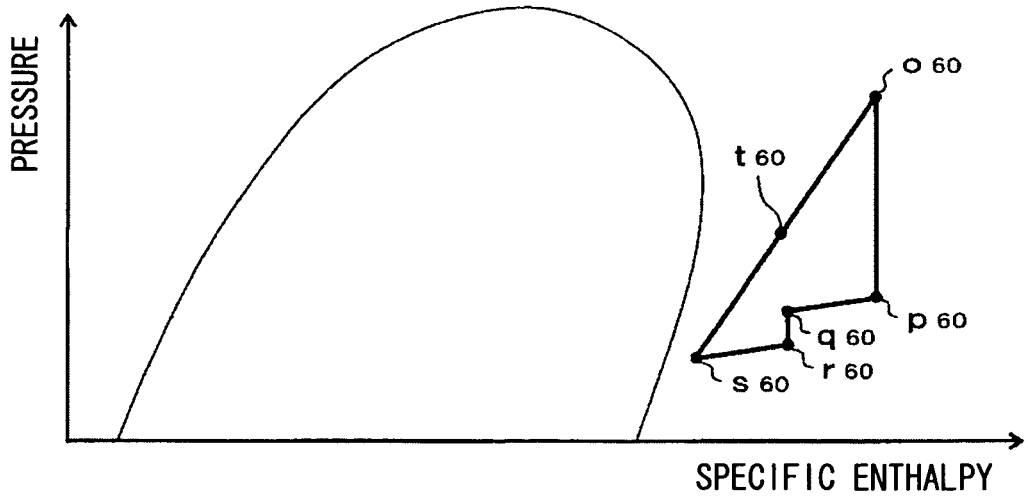
FIG. 60B is a Mollier diagram showing a refrigerant state in a defrosting operation mode according to the 42nd embodiment.

The basic operation of the present embodiment is similar to 39th embodiment. When the ejector-type refrigerant cycle device 100 of the present embodiment is operated in the general operation mode, the present embodiment is operated similarly to FIG. 6 of the 3rd embodiment, as in the Mollier diagram of FIG. 60A. In contrast, the defrosting operation mode is performed similarly to the defrosting operation mode of the 39th embodiment of FIG. 54B, as shown in the Mollier diagram of FIG. 60B.

Thus, in the ejector-type refrigerant cycle device 100 of the present embodiment, the same effects as in the 1st embodiment can be obtained in the general operation mode, and the defrosting of the suction side evaporator 23 and the discharge side evaporator 20 can be performed in the defrosting operation mode.

(43rd Embodiment)

Figure 61:
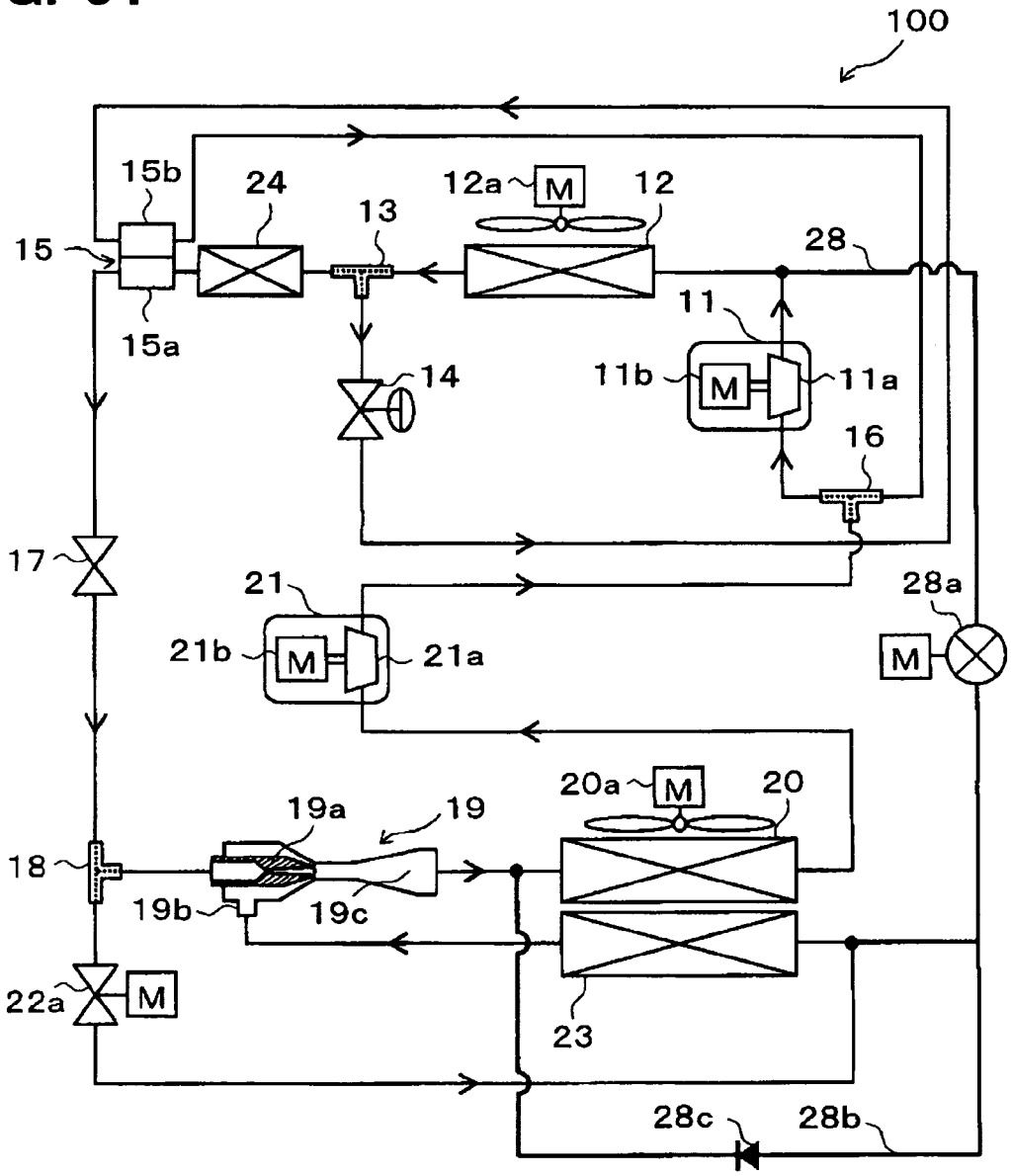
FIG. 61 is an entire schematic diagram of an ejector-type refrigerant cycle device according to a 43rd embodiment of the invention.

In the present embodiment, as shown in FIG. 61, with respect to the ejector-type refrigerant cycle device 100 of the 3rd embodiment, the bypass passage 28, the opening/closing valve 28*a*, the auxiliary bypass passage 28*b* and the auxiliary check valve 28*c* are added, and the electrical variable throttle mechanism 22*a* is used as the suction side decompression portion as in the 40th embodiment, so as to perform a defrosting operation mode.

Figure 62A:
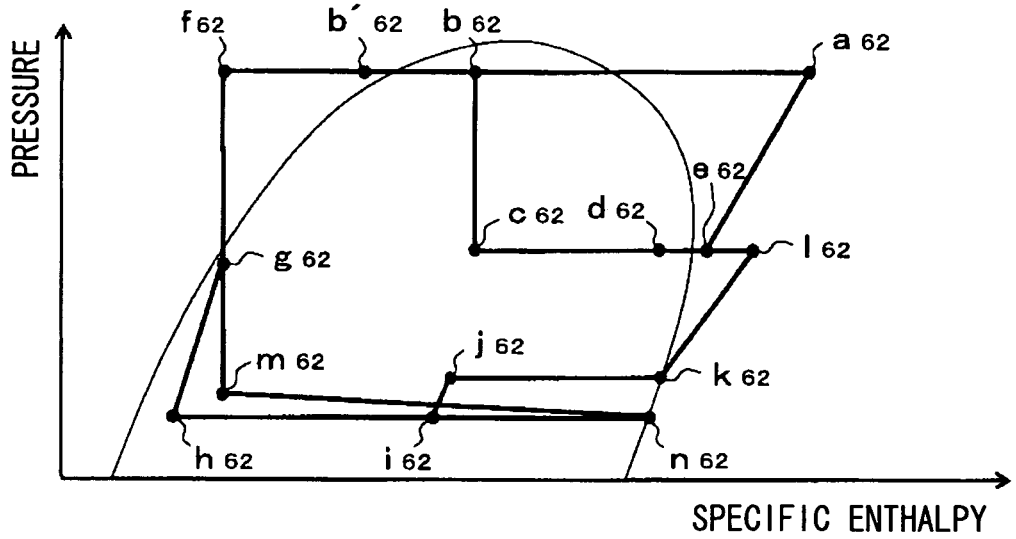
FIG. 62A is a Mollier diagram showing a refrigerant state in a general operation mode according to the 43rd embodiment.
Figure 62B:
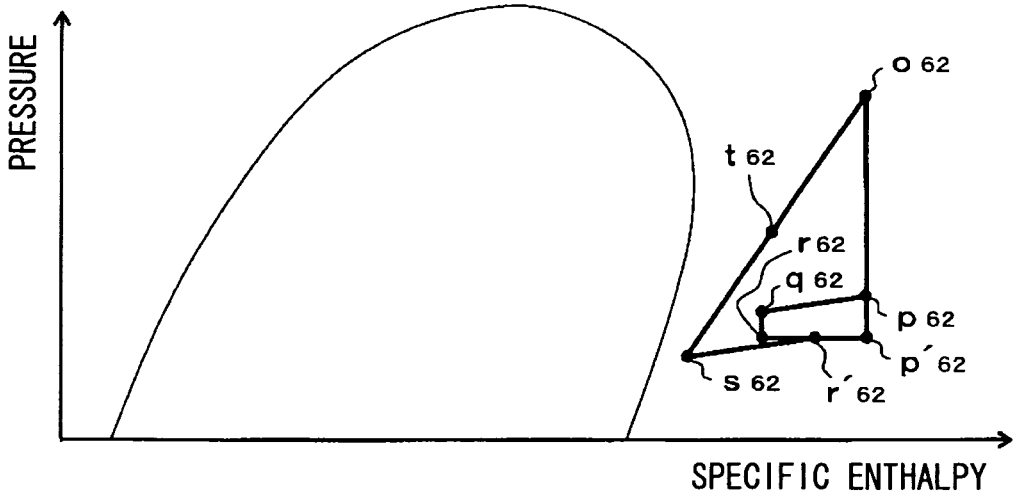
FIG. 62B is a Mollier diagram showing a refrigerant state in a defrosting operation mode according to the 43rd embodiment.

The basic operation of the present embodiment is similar to 39th embodiment. When the ejector-type refrigerant cycle device 100 of the present embodiment is operated in the general operation mode, the present embodiment is operated similarly to FIG. 6 of the 3rd embodiment, as in the Mollier diagram of FIG. 62A. In contrast, the defrosting operation mode is performed similarly to the defrosting operation mode of the 40th embodiment of FIG. 56B, as shown in the Mollier diagram of FIG. 62B.

Thus, in the ejector-type refrigerant cycle device 100 of the present embodiment, the same effects as in the 1st embodiment can be obtained in the general operation mode, and the defrosting of the suction side evaporator 23 and the discharge side evaporator 20 can be performed in the defrosting operation mode.

(44th Embodiment)

Figure 63:
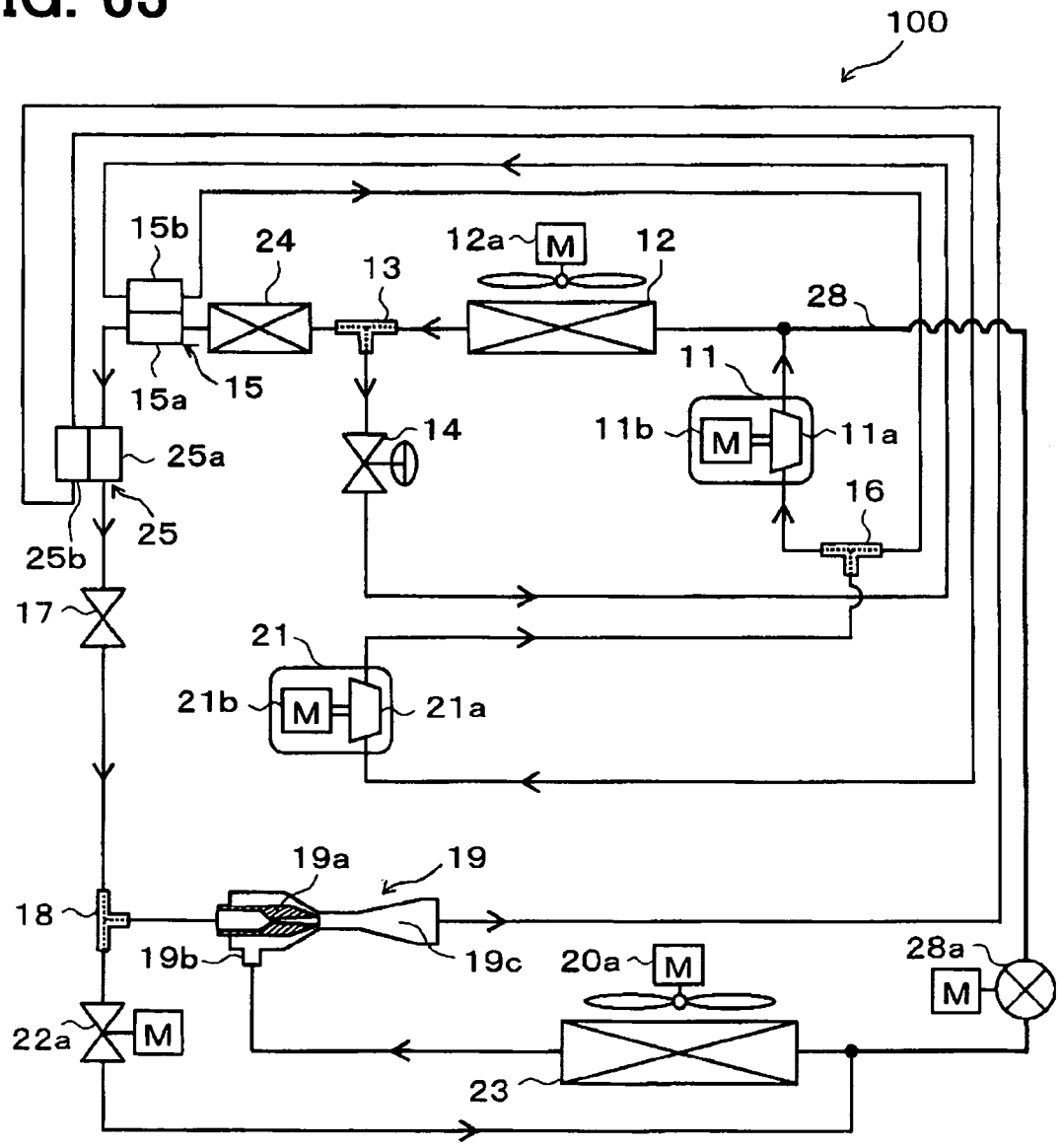
FIG. 63 is an entire schematic diagram of an ejector-type refrigerant cycle device according to a 44th embodiment of the invention.

In the present embodiment, as shown in FIG. 63, similarly to the 39th embodiment, the bypass passage 28 and the opening/closing valve 28*a* are added and the electrical variable throttle mechanism 22*a* is used as the suction side decompression portion so as to perform a defrosting operation mode, with respective to the ejector-type refrigerant cycle device 100 of the 4th embodiment.

Figure 64A:
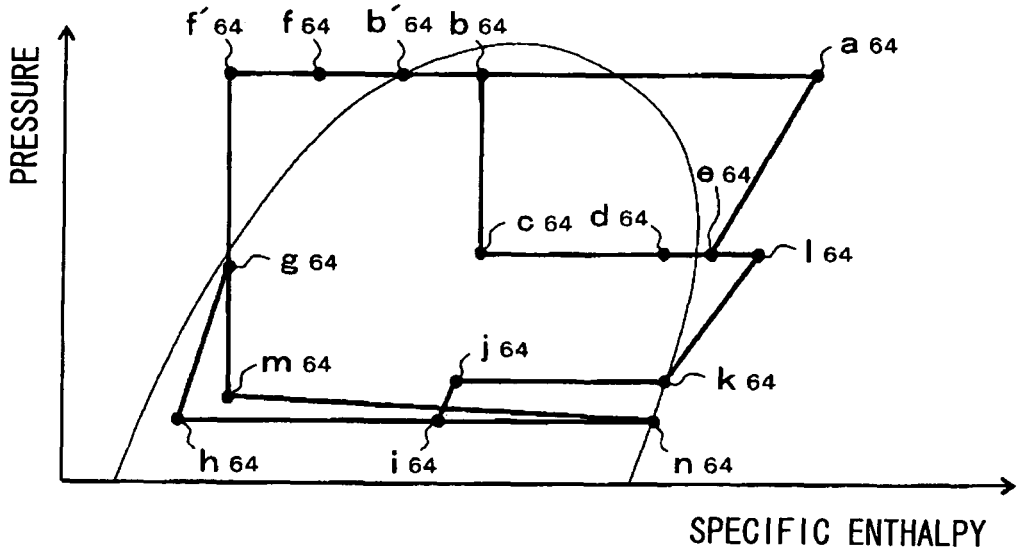
FIG. 64A is a Mollier diagram showing a refrigerant state in a general operation mode according to the 44th embodiment.
Figure 64B:
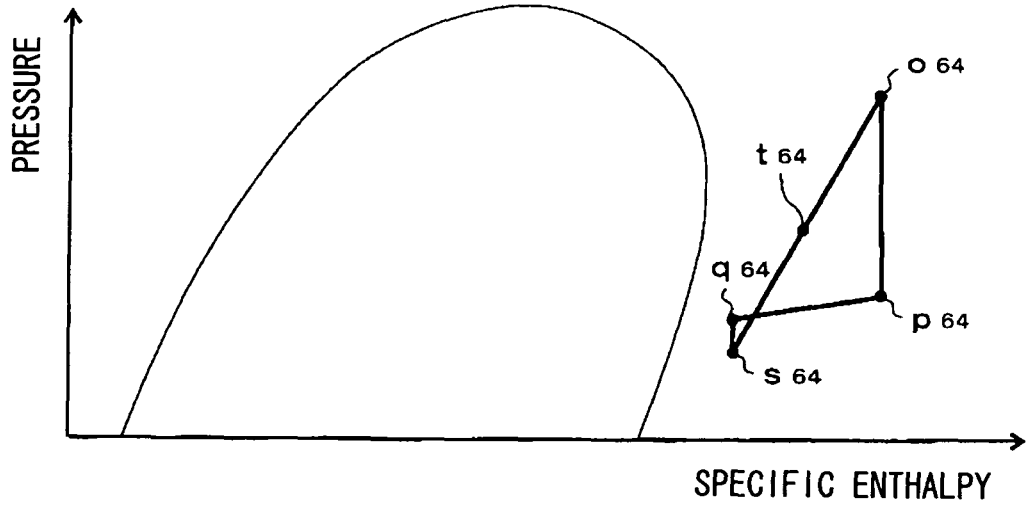
FIG. 64B is a Mollier diagram showing a refrigerant state in a defrosting operation mode according to the 44th embodiment.

The basic operation of the present embodiment is similar to 39th embodiment. When the ejector-type refrigerant cycle device 100 of the present embodiment is operated in the general operation mode, the present embodiment is operated similarly to FIG. 8 of the 4th embodiment, as in the Mollier diagram of FIG. 64A. In contrast, the defrosting operation mode is performed similarly to the defrosting operation mode of the 41st embodiment of FIG. 58B, as shown in the Mollier diagram of FIG. 64B.

Thus, in the ejector-type refrigerant cycle device 100 of the present embodiment, the same effects as in the 1st embodiment can be obtained in the general operation mode, and the defrosting of the suction side evaporator 23 and the discharge side evaporator 20 can be performed in the defrosting operation mode.

In the 39th to 44th embodiments, the bypass passage 28 and the opening/closing valve 28*a* are added with respective to the ejector-type refrigerant cycle device 100. However, the bypass passage 28 and the opening/closing valve 28*a* may be added with respective to the ejector-type refrigerant cycle device 200 of the 6th embodiment.

(45th Embodiment)

Figure 65:
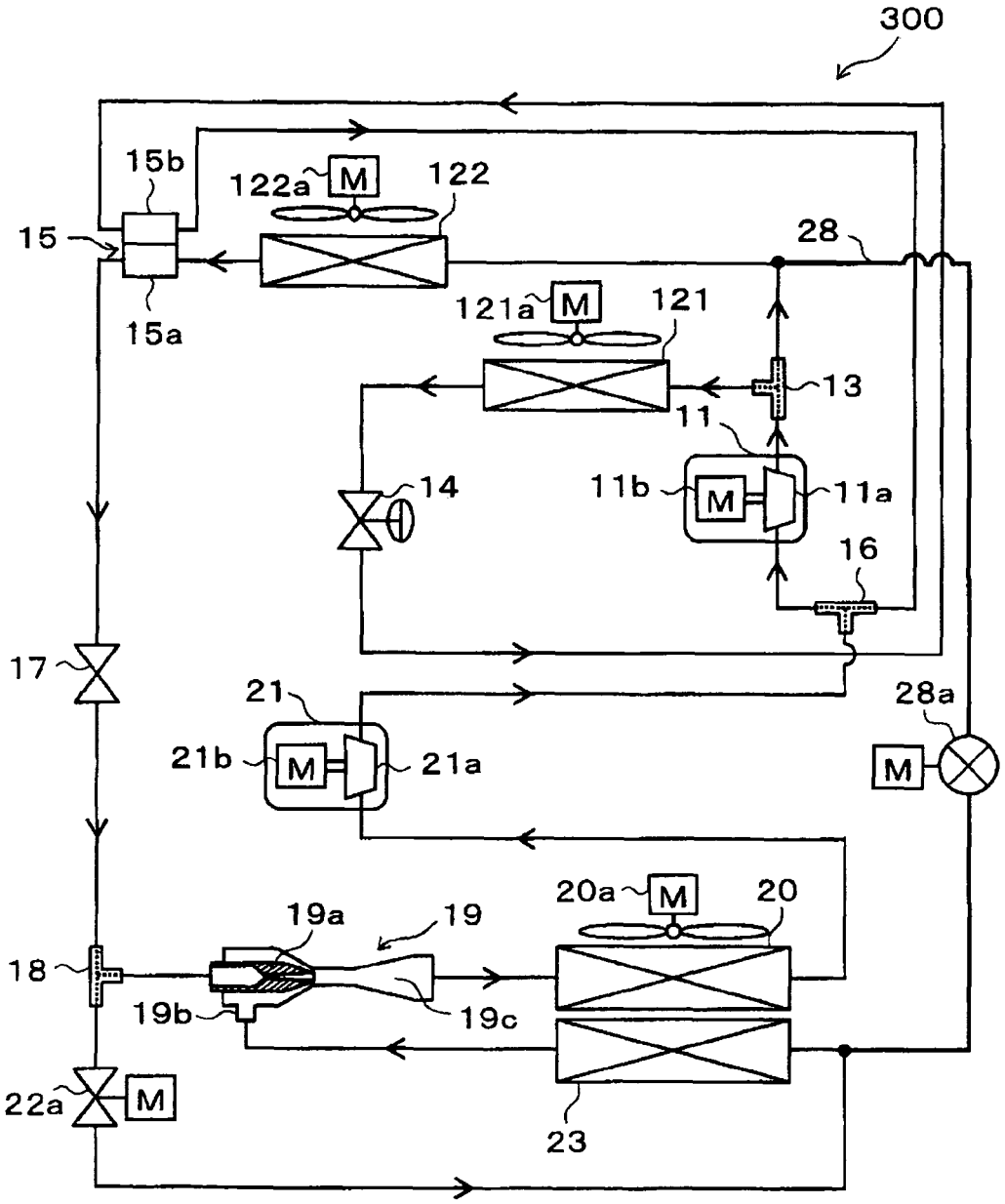
FIG. 65 is an entire schematic diagram of an ejector-type refrigerant cycle device according to a 45th embodiment of the invention.

In the present embodiment, as shown in FIG. 65, similarly to the 39th embodiment, a bypass passage 28 and an opening/closing valve 28*a* are added, and an electrical variable throttle mechanism 22*a* is used as the suction side decompression portion so as to perform a defrosting operation mode, with respective to the ejector-type refrigerant cycle device 100 of the 7th embodiment.

More specifically, the bypass passage 28 of the present embodiment is a refrigerant passage through which a high-pressure refrigerant from a position downstream of the first branch portion 13 and upstream of the second radiator 122 is directly introduced to the suction side evaporator 23 while bypassing the first and second radiators 121, 122. The bypass passage 28 may be configured such that the high pressure refrigerant from a position downstream of the first branch portion 13 and upstream of the second radiator 122 or the refrigerant discharged from the first compressor 11 and upstream of the first branch portion 13 is introduced to the suction side evaporator 23.

Figure 66A:
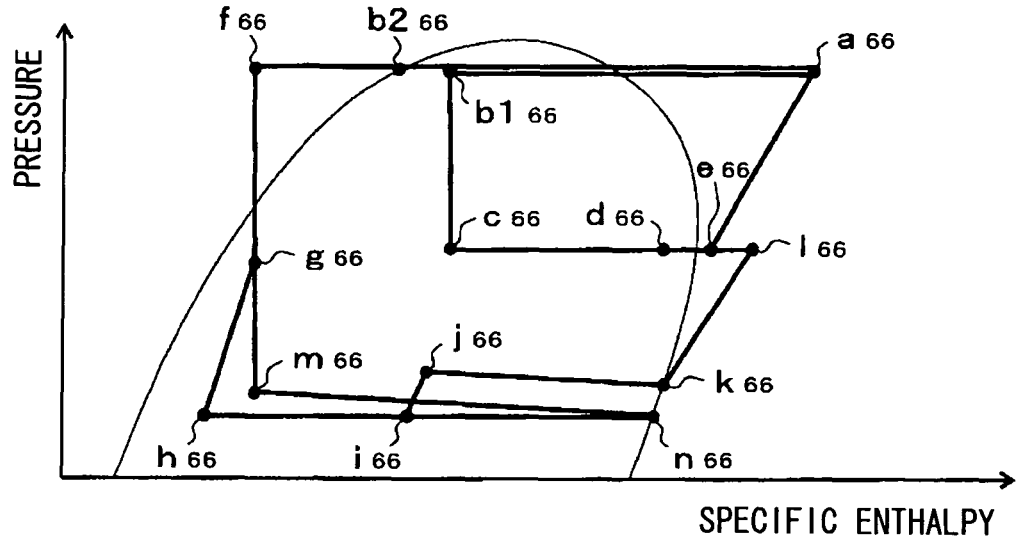
FIG. 66A is a Mollier diagram showing a refrigerant state in a general operation mode according to the 45th embodiment.

Operation of the ejector-type refrigerant cycle device 300 according to the present embodiment will be described with reference to FIGS. 66A and 66B. The basic operation of the present embodiment is similar to 39th embodiment. Thus, in the general operation mode, the present embodiment is operated similarly to FIG. 14 of the 7th embodiment, as in the Mollier diagram of FIG. 66A.

In contrast, in the defrosting operation mode, the control device causes the first cooling fan 121*a* and the second cooling fan 122*a* to be stopped, causes the variable throttle mechanism 22*a* to be in a fully open state, and causes the opening/closing valve 28*a* to be opened. Thus, the high-pressure refrigerant (point $o_{66}$ in FIG. 66B) discharged from the first compressor 11 flows into the bypass passage 28.

At this time, in the present embodiment, a refrigerant circuit having a low pressure loss is set, in which the refrigerant circulates in this order of the first compressor 11→the first branch portion 13→the bypass passage 28→the suction side evaporator 23→the ejector 19→the discharge side evaporator 20→the second compressor 21, with respect to a refrigerant circuit having a large pressure loss in which the refrigerant circulates in this order of the first compressor 11→the first branch portion 13→the first radiator 121→the inner heat exchanger 15→the first fixed throttle 17→the second branch portion 18→the ejector 19→the discharge side evaporator 20→the second compressor 21. Therefore, a large amount of the refrigerant discharged from the first compressor 11 flows into the bypass passage 28.

Figure 54B:
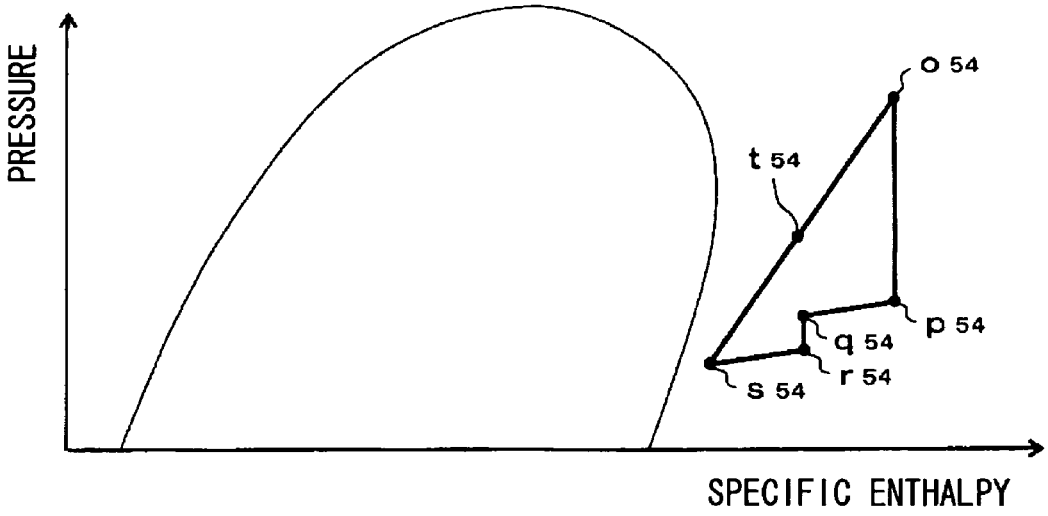
FIG. 54B is a Mollier diagram showing a refrigerant state in a defrosting operation mode according to the 39th embodiment.
Figure 66B:
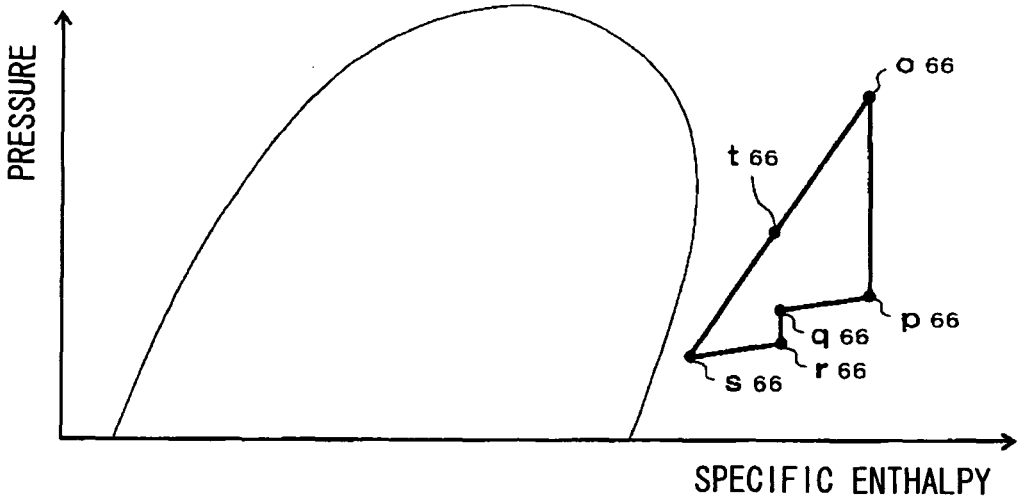
FIG. 66B is a Mollier diagram showing a refrigerant state in a defrosting operation mode according to the 45th embodiment.

Thus, in the defrosting operation mode, as shown in the Mollier diagram of FIG. 66B, the present embodiment is operated similarly to the defrosting operation mode of the 39th embodiment of FIG. 54B. Thus, in the ejector-type refrigerant cycle device 300 of the present embodiment, the same effects as in the 7th embodiment can be obtained in the general operation mode, and the defrosting of the suction side evaporator 23 and the discharge side evaporator 20 can be performed in the defrosting operation mode.

In the present embodiment, the heat radiating capacity of the first and second radiators 121, 122 is not exerted when the control device stops the operation of the cooling fans 121*a*, 122*a* in the defrosting operation mode.

Thus, for example, the bypass passage 28 may be configured such that high-pressure refrigerant downstream of the first radiator 121 and upstream of the thermal expansion valve 14 flows into the bypass passage 28. Alternatively, the bypass passage 28 may be configured such that high-pressure refrigerant downstream of the second radiator 122 and upstream of the inner heat exchanger 15 flows into the bypass passage 28.

(46th Embodiment)

Figure 67:
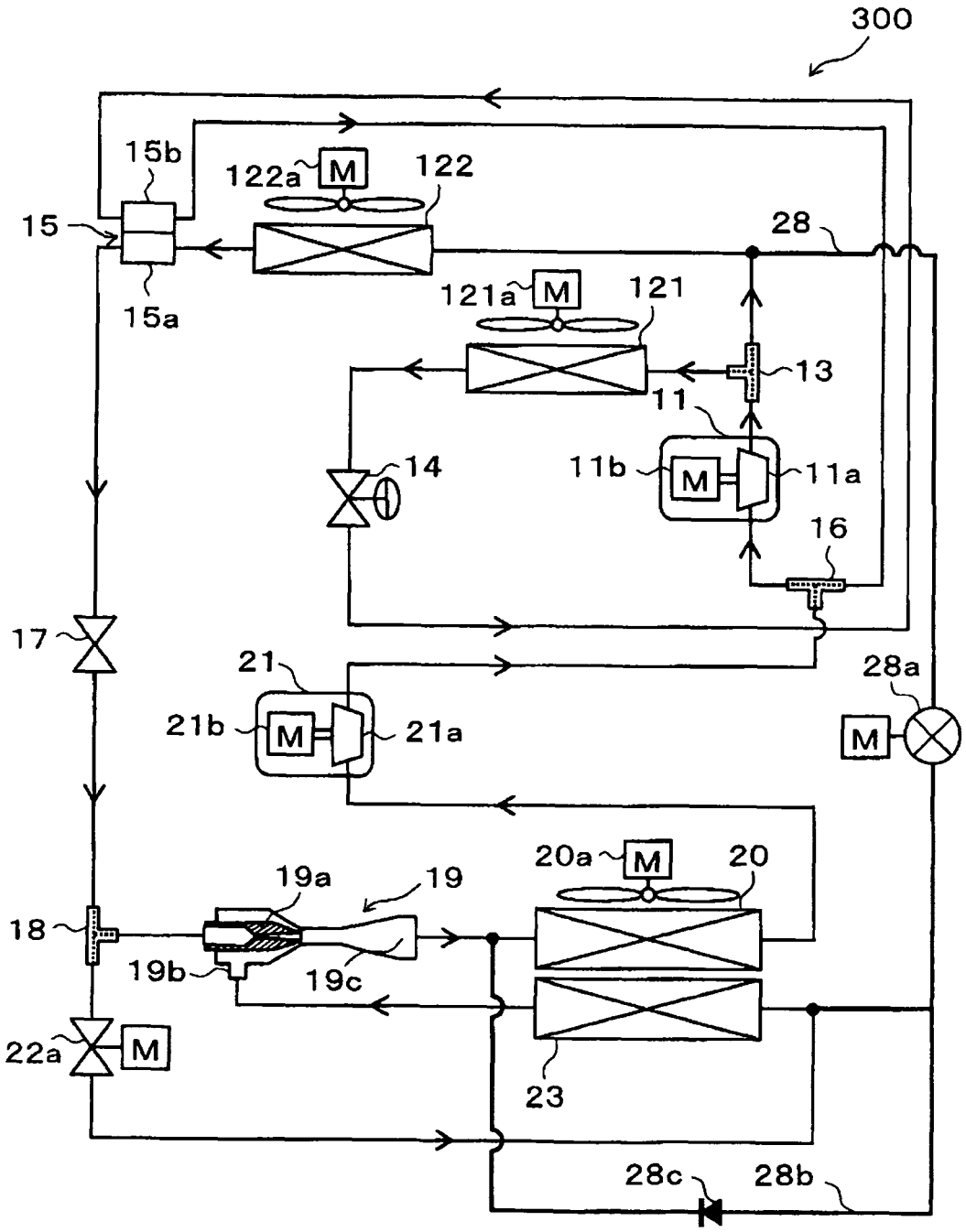
FIG. 67 is an entire schematic diagram of an ejector-type refrigerant cycle device according to a 46th embodiment of the invention.

In the present embodiment, as shown in FIG. 67, with respect to the ejector-type refrigerant cycle device 300 of the 45th embodiment, an auxiliary bypass passage 28*b*, through which high-pressure refrigerant discharged from the first compressor 11 flows into the discharge side evaporator 20, and the auxiliary check, valve 28*c* are added, similarly to the 40th embodiment.

Figure 68A:
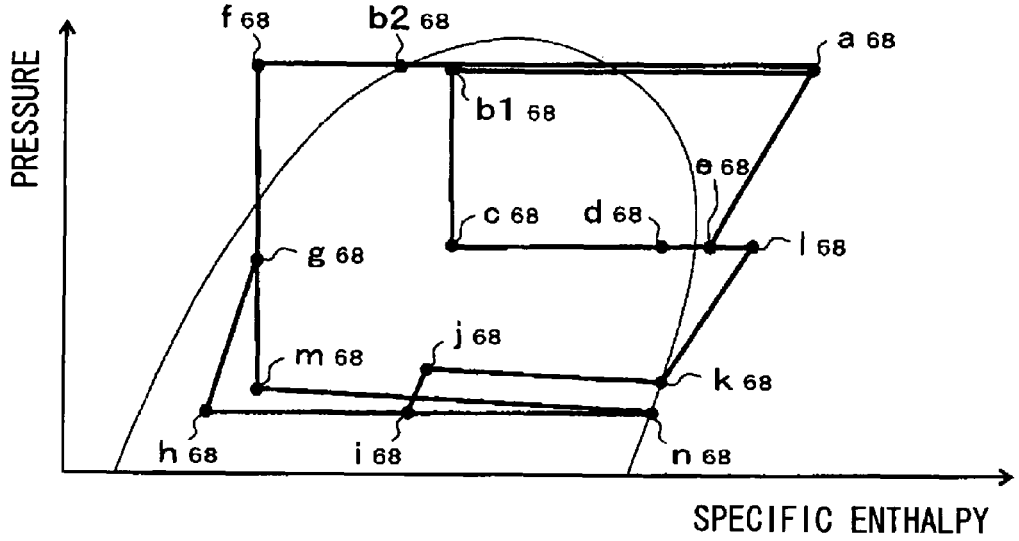
FIG. 68A is a Mollier diagram showing a refrigerant state in a general operation mode according to the 46th embodiment.
Figure 68B:
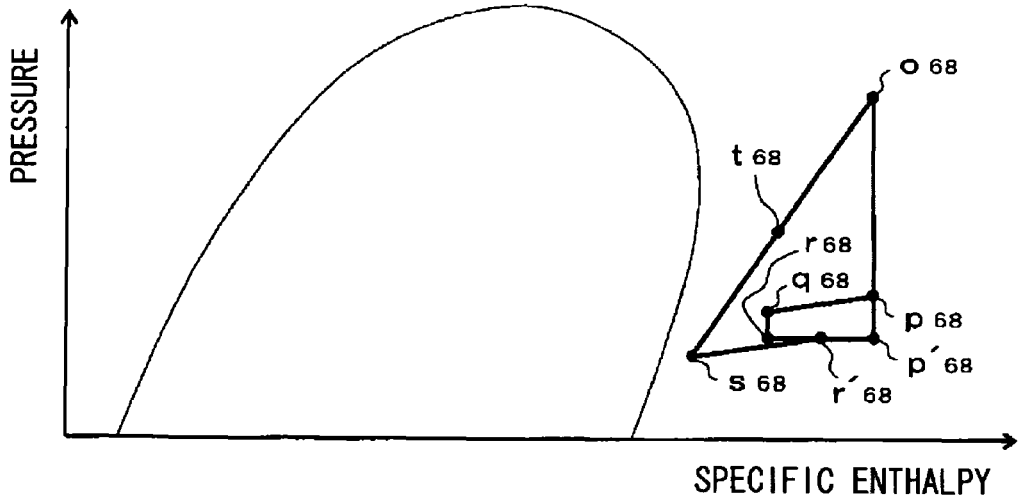
FIG. 68B is a Mollier diagram showing a refrigerant state in a defrosting operation mode according to the 46th embodiment.

The basic operation of the present embodiment is similar to 45th embodiment. When the ejector-type refrigerant cycle device 300 of the present embodiment is operated in the general operation mode, the present embodiment is operated similarly to FIG. 14 of the 7th embodiment, as in the Mollier diagram of FIG. 68A. In contrast, the defrosting operation mode is performed similarly to the defrosting operation mode of the 40th embodiment of FIG. 56B, as shown in the Mollier diagram of FIG. 68B.

Thus, in the ejector-type refrigerant cycle device 300 of the present embodiment, the same effects as in the 7th embodiment can be obtained in the general operation mode, and the defrosting of the suction side evaporator 23 and the discharge side evaporator 20 can be performed in the defrosting operation mode.

(47th Embodiment)

Figure 69:
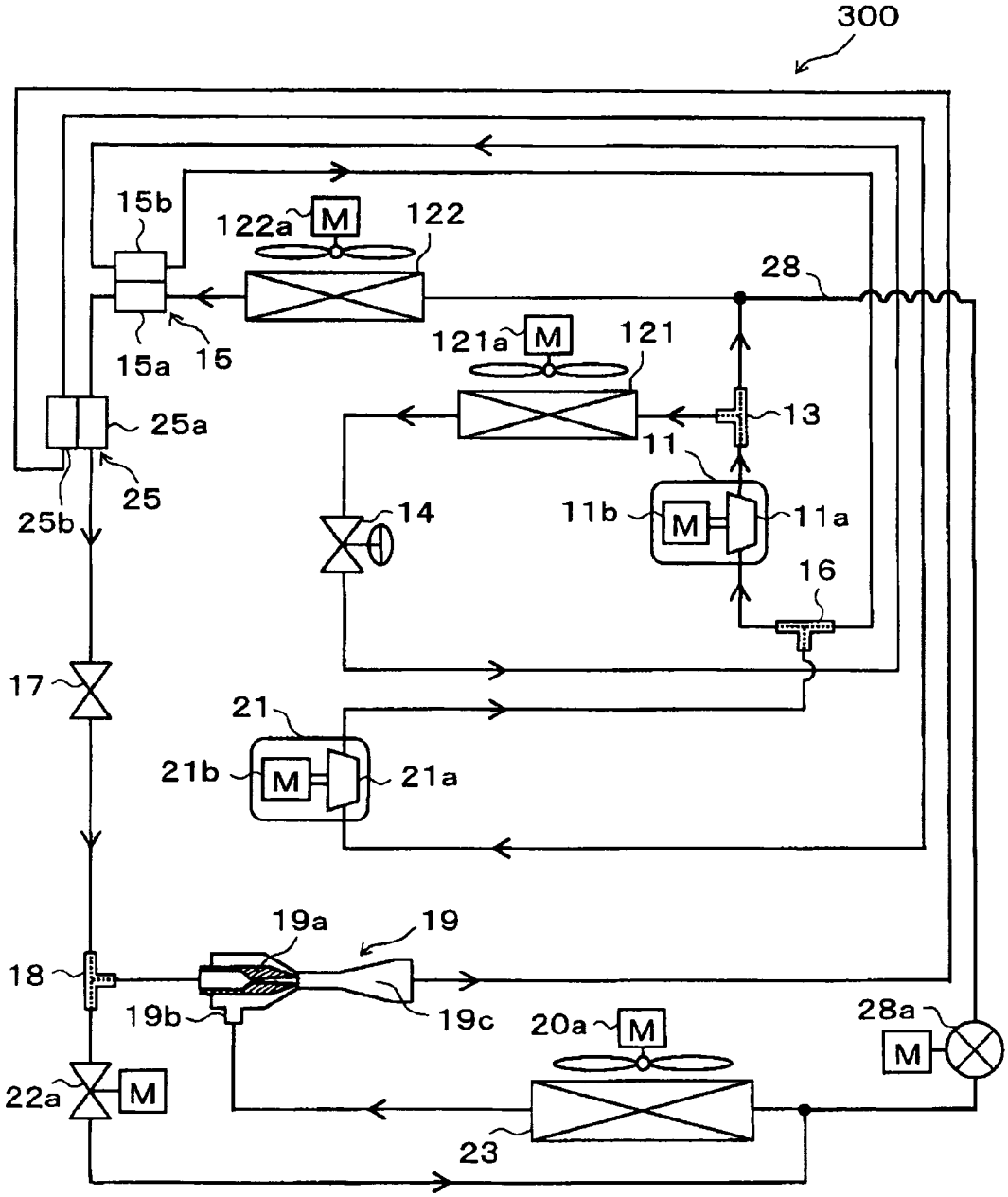
FIG. 69 is an entire schematic diagram of an ejector-type refrigerant cycle device according to a 47th embodiment of the invention.

In the present embodiment, as shown in FIG. 69, similarly to the 45th embodiment, the bypass passage 28 and the opening/closing valve 28*a* are added and the electrical variable throttle mechanism 22*a* is used as the suction side decompression portion so as to perform a defrosting operation mode, with respective to the ejector-type refrigerant cycle device 300 of the 8th embodiment.

Figure 70A:
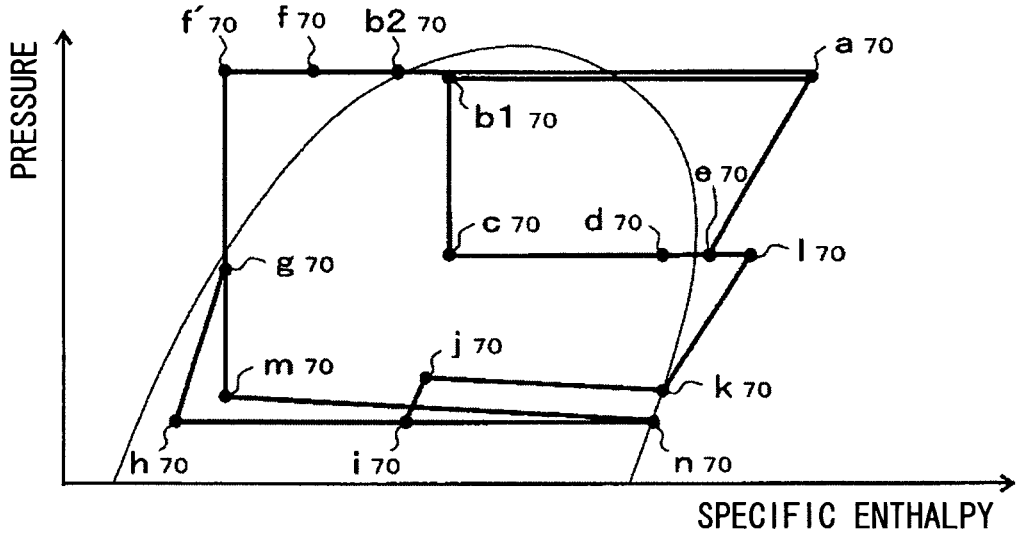
FIG. 70A is a Mollier diagram showing a refrigerant state in a general operation mode according to the 47th embodiment.
Figure 70B:
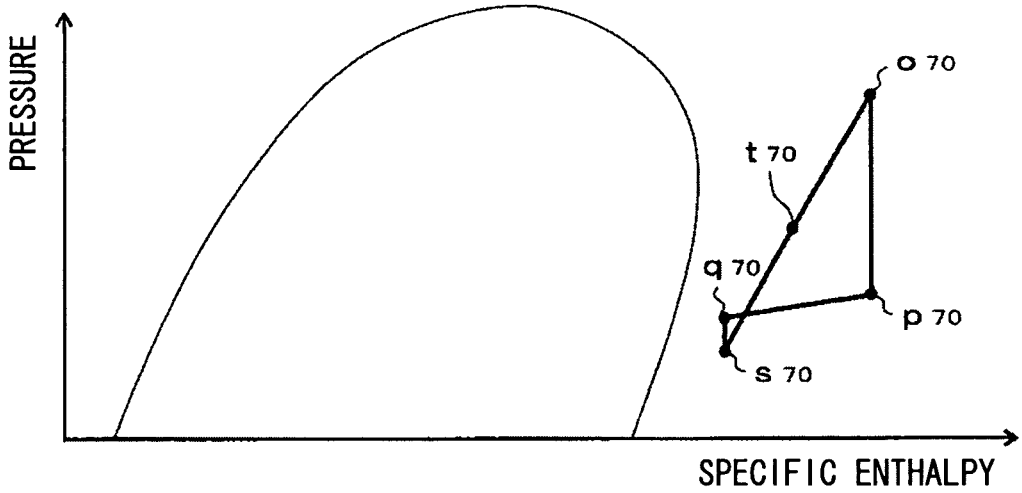
FIG. 70B is a Mollier diagram showing a refrigerant state in a defrosting operation mode according to the 47th embodiment.

The basic operation of the present embodiment is similar to 45th embodiment. When the ejector-type, refrigerant cycle device 300 of the present embodiment is operated, the general operation mode of the present embodiment is performed similarly to FIG. 16 of the 8th embodiment, as in the Mollier diagram of FIG. 70A. In contrast, the defrosting operation mode is performed similarly to the defrosting operation mode of the 41st embodiment of FIG. 58B, as shown in the Mollier diagram of FIG. 70B.

Thus, in the ejector-type refrigerant cycle device 300 of the present embodiment, the same effects as in the 8th embodiment can be obtained in the general operation mode, and the defrosting of the suction side evaporator 23 and the discharge side evaporator 20 can be performed in the defrosting operation mode.

(48th Embodiment)

Figure 71:
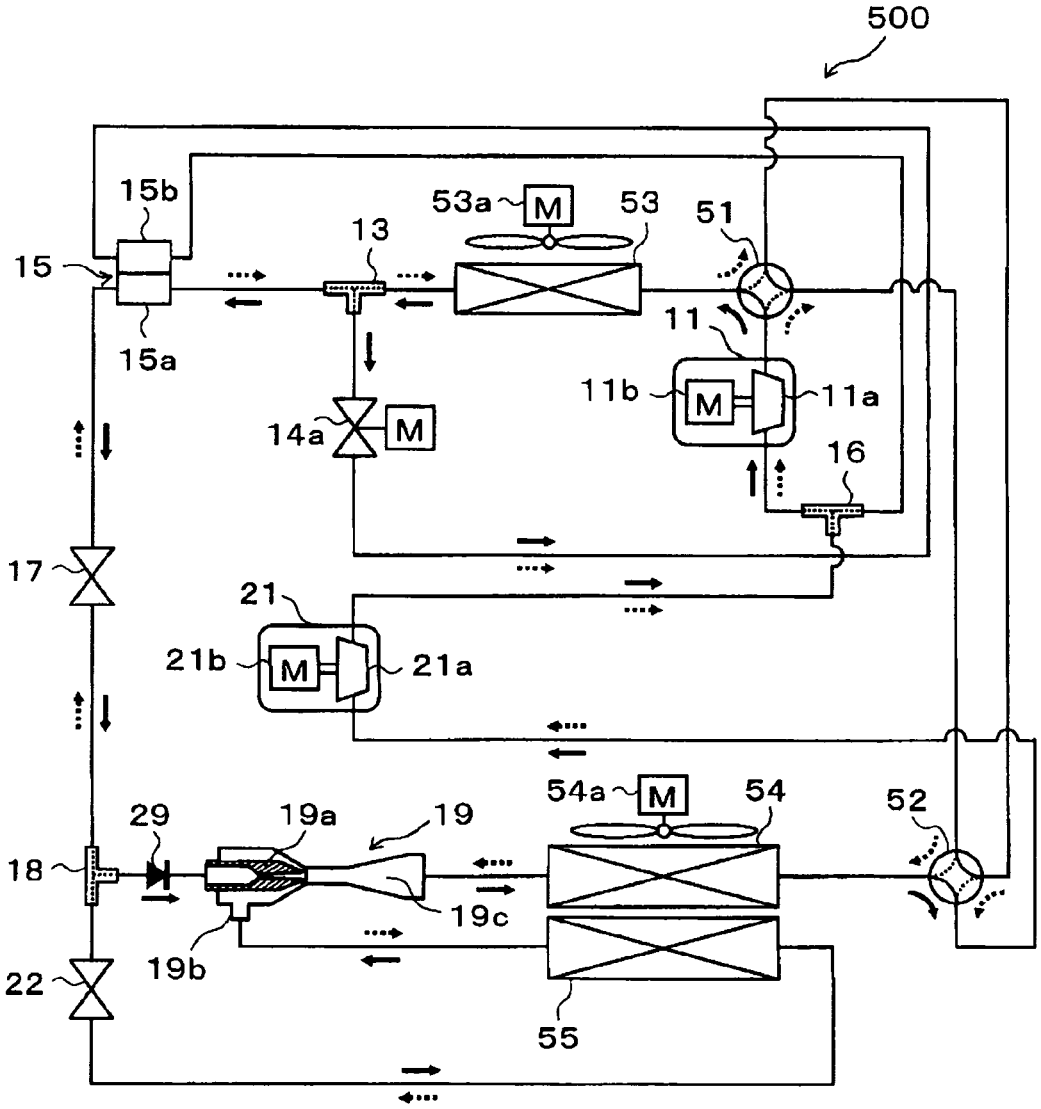
FIG. 71 is an entire schematic diagram of an ejector-type refrigerant cycle device according to a 48th embodiment of the invention.
Figure 72A:
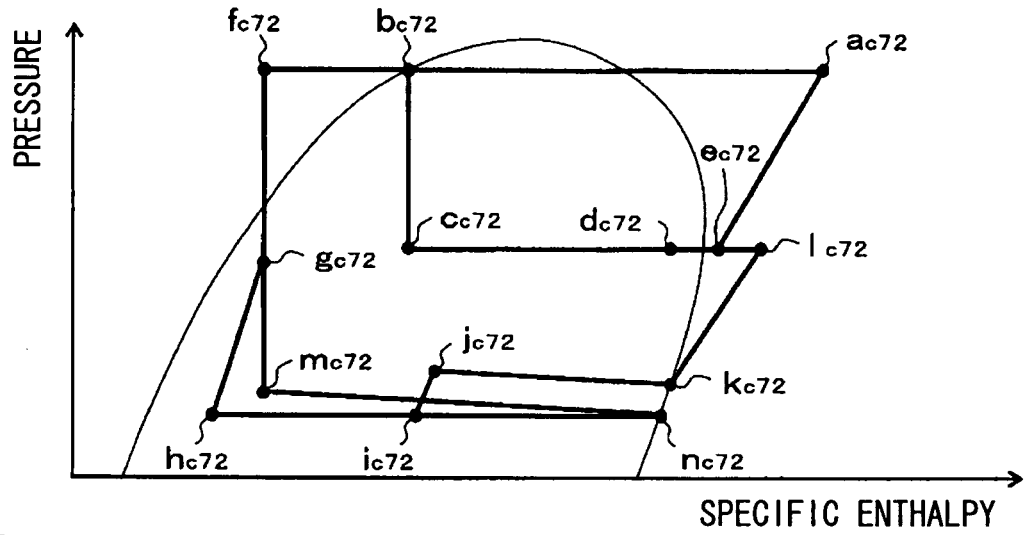
FIG. 72A is a Mollier diagram showing a refrigerant state in a cooling operation mode according to the 48th embodiment.

Next, 48th embodiment of the present embodiment will be described with reference to FIGS. 71, 72A, 72B. In the present embodiment, the ejector-type refrigerant cycle device of the present invention is typically applied to a cooling/heating storage unit for keeping the temperature of a room to a low temperature or a high temperature. FIG. 71 is an entire schematic diagram of an ejector-type refrigerant cycle device 500 of the present embodiment.

The ejector-type refrigerant cycle device 500 of the present embodiment is configured to be selectively switched between a cooling operation mode for cooling air inside a room of the storage unit, and a heating operation mode for heating air inside the room of the storage unit. The solid line arrows in FIG. 71 show the flow of the refrigerant in the cooling operation mode, and the chain line arrows in FIG. 71 show the flow of the refrigerant in the heating operation mode.

In an ejector-type refrigerant cycle device configured to be able of selectively switching the cooling operation mode and the heating operation mode, it is prefer to stably operate the ejector-type refrigerant cycle device even in an operation condition in which the suction capacity of the ejector 19 is decreased similarly to the above-described embodiments, when a refrigerant passage is switched so that the ejector is used as the refrigerant decompression portion.

In the present embodiment, the ejector-type refrigerant cycle device 500 is configured as follows. First, a first electrical four-way valve 51 is connected to a discharge side of a first compressor 11. The first electrical four-way valve 51 is a refrigerant passage switching portion, and operation of the first electrical four-way valve 51 is controlled based on a control signal output from the control device.

The first electrical four-way valve 51 switches between: a refrigerant passage (the circuit shown by the solid arrows of FIG. 71) connecting the refrigerant discharge port of the first compressor 11 and an exterior heat exchanger 53, and connecting two different refrigerant ports of a second electrical four-way valve 52 at the same time; and a refrigerant passage (the circuit shown by the chain arrows of FIG. 71) connecting the refrigerant discharge port of the first compressor 11 and one refrigerant port of the second electrical four-way valve 52, and connecting the exterior heat exchanger 53 and another refrigerant port of the second electrical four-way valve 52.

As in the refrigerant passage shown by the solid arrows of FIG. 71, in the cooling operation mode, the refrigerant discharge side of the first compressor 11 is connected to the exterior heat exchanger 53 via the first electrical four-way valve 51. The exterior heat exchanger 53 is a heat exchanger in which the refrigerant passing through therein is heat exchanged with exterior air blown by a blower fan 53*a*. The blower fan 53*a* is an electrical blower in which it rotation speed (air blowing amount) is controlled by a control voltage output from the control device.

A first branch portion 13 is connected to a refrigerant outlet side of the exterior heat exchanger 53 in the cooling operation mode. An electrical variable throttle mechanism 14*a* as a high-pressure side decompression portion is connected to one of the refrigerant outlets of the first branch portion 13, and a high-pressure side refrigerant passage 15*a* of an inner heat exchanger 15 is connected to the other one of the refrigerant outlets of the first branch portion 13.

The variable throttle mechanism 14*a* includes a valve body configured to be changeable in a throttle open degree, and an electrical actuator made of a stepping motor for changing the throttle open degree of the valve body. Furthermore, operation of the variable throttle mechanism 14*a* is controlled by a control signal output from the control device.

Specifically, a temperature sensor (not shown) and a pressure sensor (not shown) for respectively detecting temperature and pressure of the refrigerant drawn into the first compression portion 11*a* is connected to the control device of the present embodiment. Furthermore, the control device controls the valve open degree of the variable throttle mechanism 14*a* such that the super-heat degree of the refrigerant drawn into the first compression portion 11*a* becomes in a predetermined value.

A refrigerant outlet side of the variable throttle mechanism 14*a* in the cooling operation mode is connected to a middle-pressure side refrigerant passage 15*b* of the inner heat exchanger 15, and a join portion 16 is connected to a refrigerant outlet side of the middle-pressure side refrigerant passage 15*b*.

In the cooling operation mode, the refrigerant outlet side of the high-pressure side refrigerant passage 15*a* of the inner heat exchanger 15 is connected to a fixed throttle 17 and a second branch portion 18, similarly to the 1st embodiment. One of the refrigerant outlets of the second branch portion 18 is connected to a refrigerant inlet side of a nozzle portion 19*a* of an ejector 19, via a pre-nozzle check valve 29 which only allows a refrigerant flow from the second branch portion 18 toward the nozzle portion 19*a* of the ejector 19.

An auxiliary using-side heat exchanger 54 is connected to a refrigerant outlet side of the diffuser portion 19*c* of the ejector 19 in the cooling operation mode. The basic structure of the auxiliary using-side heat exchanger 54 is similar to the discharge side evaporator 20 of the 1st embodiment. The auxiliary using-side heat exchanger 54 is adapted to heat exchange between the refrigerant flowing therein and air inside the room blown by a blower fan 54*a*. The basic structure of the blower fan 54*a* is similar to the blower fan 20*a*.

The second electrical four-way valve 52 is connected to a refrigerant outlet side of the auxiliary using-side heat exchanger 54 in the cooling operation mode. The second electrical four-way valve 52 is a refrigerant passage switching portion, and its operation is controlled by a control signal output from the control device. The basic structure of the second electrical four-way valve 52 is similar to the first electrical four-way valve 51.

Specifically, the second electrical four-way valve 52 switches between: a refrigerant passage (the circuit shown by the solid arrows of FIG. 71) connecting the auxiliary using-side heat exchanger 54 and the refrigerant suction port of the second compressor 21, and connecting two different refrigerant ports of the first electrical four-way valve 51 at the same time; and a refrigerant passage (the circuit shown by the chain arrows of FIG. 71) connecting one refrigerant port of the first electrical four-way valve 51 and the auxiliary using-side heat exchanger 54, and connecting another refrigerant port of the first electrical four-way valve 51 and the refrigerant suction port of the second compressor 21.

The other one of the refrigerant outlets of the second branch portion 18 in the cooling operation mode is connected to a using-side heat exchanger 25 via a second fixed throttle 22. The basic structure of the using-side heat exchanger 55 is similar to the suction side evaporator 23 of the 1st embodiment. More specifically, the using-side heat exchanger 55 is configured to perform heat exchange between the refrigerant flowing therein and the air inside the room having passed through the auxiliary using-side heat exchanger 54, blown by the blower fan 54*a*.

A refrigerant outlet side of the using-side heat exchanger 55 is connected to a refrigerant suction port 19*b* of the ejector 19.

Next, operation of the present embodiment with the above structure will be described with reference to FIGS. 72A, 72B. The ejector-type refrigerant cycle device 500 of the present embodiment is configured to switch between the cooling operation mode for cooling the air inside the room, and the heating operation mode for heating air inside the room. FIG. 72A is a Mollier diagram showing refrigerant states in the cooling operation mode, and FIG. 72B is a Mollier diagram showing refrigerant states in the heating operation mode.

The cooling operation mode is performed when the cooling operation mode is selected by an operation switch of an operation panel. In the cooling operation mode, the control device causes the first and second electrical motors 11*b*, 21*b* and the blower fans 53*a*, 54*a* to be operated, and controls the throttle open degree of the variable throttle mechanism 14*a* as described above.

The control device switches the first electrical four-way valve 51 so as to connect the refrigerant discharge port of the first compressor 11 and the exterior heat exchanger 53, and to connect the two different refrigerant ports of the second electrical four-way valve 52, at the same time. In addition, the control device switches the second electrical four-way valve 52 so as to connect the auxiliary using-side heat exchanger 54 and the refrigerant suction port of the second compressor 21, and to connect the two different refrigerant ports of the first electrical four-way valve 51 at the same time. Thus, as in the solid arrows in FIG. 71, the following first, second and third refrigerant circuits are configured.

The first refrigerant circuit is configured so that the refrigerant flows in the circuit in this order of the first compressor 11→the first electrical four-way valve 51→the exterior heat exchanger 53→the first branch passage 13→the variable throttle mechanism 14*a*→the middle-pressure side refrigerant passage 15*b* of the inner heat exchanger 15→the join portion 16→the first compressor 11.

The second refrigerant circuit is configured so that the refrigerant flows in the circuit in this order of the first compressor 11→the first electrical four-way valve 51→the exterior heat exchanger 53→the first branch passage 13→the high-pressure side refrigerant passage 15*a* of the inner heat exchanger 15→the first fixed throttle 17→the second branch portion 18→the pre-nozzle check valve 29→the ejector 19→the auxiliary using-side heat exchanger 54→the second electrical four-way valve 52→the second compressor 21→the join portion 16→the first compressor 11.

The third refrigerant circuit is configured so that the refrigerant flows in the circuit in this order of the first compressor 11→the first electrical four-way valve 51→the exterior heat exchanger 53→the first branch passage 13→the high-pressure side refrigerant passage 15*a* of the inner heat exchanger 15→the first fixed throttle 17→the second branch portion 18→the second fixed throttle 22→the using-side heat exchanger 55→the ejector 19→the auxiliary using-side heat exchanger 54→the second electrical four-way valve 52→the second compressor 21→the join portion 16→the first compressor 11.

That is, in the cooling operation mode of the present embodiment, the exterior heat exchanger 53, the using-side heat exchanger 55 and the auxiliary using-side heat exchanger 54 are configured to respectively correspond to the radiator 12, the suction side evaporator 23 and the discharge side evaporator 20 of the 1st embodiment. Thus, as shown in FIG. 72A, the cooling operation mode of the present embodiment is performed similarly to that in FIG. 2 of the 1st embodiment, so as to cool the air of the room.

In contrast, the heating operation mode is performed when the heating operation mode is selected by the operation switch of the operation panel. In the heating operation mode, the control device causes the first and second electrical motors 11*b*, 21*b* and the blower fans 53*a*, 54*a* to be operated, and controls the throttle open degree of the variable throttle mechanism 14*a* to be in the fully close state.

The control device switches the first electrical four-way valve 51 so as to connect the refrigerant discharge port of the first compressor 11 and one refrigerant port of the second electrical four-way valve 52, and to connect the exterior heat exchanger 53 and another refrigerant port of the second electrical four-way valve 52, at the same time. In addition, the control device switches the second electrical four-way valve 52 so as to connect one refrigerant port of the first electrical four-way valve 51 and the auxiliary using-side heat exchanger 54, and to connect another refrigerant port of the first electrical four-way valve 51 and the refrigerant suction port of the second compressor 21, at the same time.

Figure 72B:
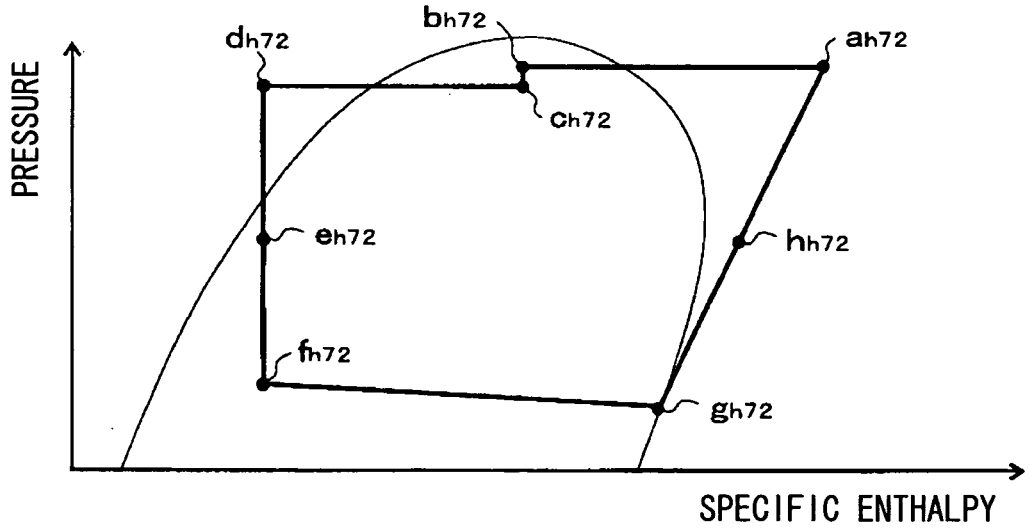
FIG. 72B is a Mollier diagram showing a refrigerant state in a heating operation mode according to the 48th embodiment.

Thus, the refrigerant discharged from the first compressor 11 flows into the auxiliary using-side heat exchanger 54 via the first and second electrical four-way valves 51, 52, and radiates heat by performing heat exchange with air inside the room, blown and circulated by the blower fan 54*a* (point $a_{h72}$→point $b_{h72}$, in FIG. 72B). Thus, the air of the room is heated.

The refrigerant flowing out of the auxiliary using-side heat exchanger 54 flows in the ejector 19 in a flow direction reversely from that of the cooling operation mode, in this order of the diffuser portion 19*c*→the refrigerant suction port 19*b*. The refrigerant flowing into the ejector 19 is pressure-reduced by a pressure loss in the ejector 19 (point $b_{h72}$→point $c_{h72}$).

The refrigerant flowing out of the refrigerant suction port 19*b* of the ejector 19 flows into the using-side heat exchanger 55, and is heat-radiated by performing heat exchange with the air inside the room, having passed through the auxiliary using-side heat exchanger 54, blown by the blower fan 54*a* (point $c_{h72}$→point $d_{h72}$). Thus, the air of the room is further heated.

The refrigerant flowing out of the using-side heat exchanger 55 is decompressed in the second fixed throttle 22, and is further decompressed in the first fixed throttle 17 via the second branch portion 18 (point $d_{h72}$→point $e_{h72}$→point $f_{h72}$). At this time, because of the pressure difference back and forth of the pre-nozzle check valve 29, the refrigerant does not flow from the second branch portion 18 into the nozzle portion 19*a*.

The refrigerant decompressed and expanded in the first fixed throttle 17 flows into the exterior heat exchanger 53, via the inner heat exchanger 15 and the first branch portion 13. In the heating operation mode, because the variable throttle mechanism 14*a* is in the fully close state, heat exchange is substantially not performed in the inner heat exchanger 15, and refrigerant does not flow from the first branch portion 13 toward the variable throttle mechanism 14*a*.

The refrigerant flowing into the exterior heat exchanger 53 absorbs heat by performing heat exchange with outside air blown by the blower fan 53*a* (point $f_{h72}$→point $g_{h72}$). The refrigerant flowing out of the exterior heat exchanger 53 flows in this order of the first electrical four-way valve 51→the second electrical four-way valve 52, and is drawn into the second compressor 21 to be compressed again (point $g_{h72}$→point $h_{h72}$). Furthermore, the refrigerant discharged from the second compressor 21 is drawn into the first compressor 11 via the join portion 16, and is compressed again (point $h_{h72}$→point $a_{h72}$).

The ejector-type refrigerant cycle device 500 of the present embodiment is operated above, and thereby the air in the room can be cooled in the cooling operation mode, and the air in the room can be heated in the heating operation mode. Furthermore, in the cooling operation mode using the ejector 19 as the refrigerant decompression portion, the ejector-type refrigerant cycle device can be stably operated without reducing the COP even when a variation in the flow amount of the drive flow of the ejector 19 is caused, similarly to the 1st embodiment.

(49th Embodiment)

Figure 73:
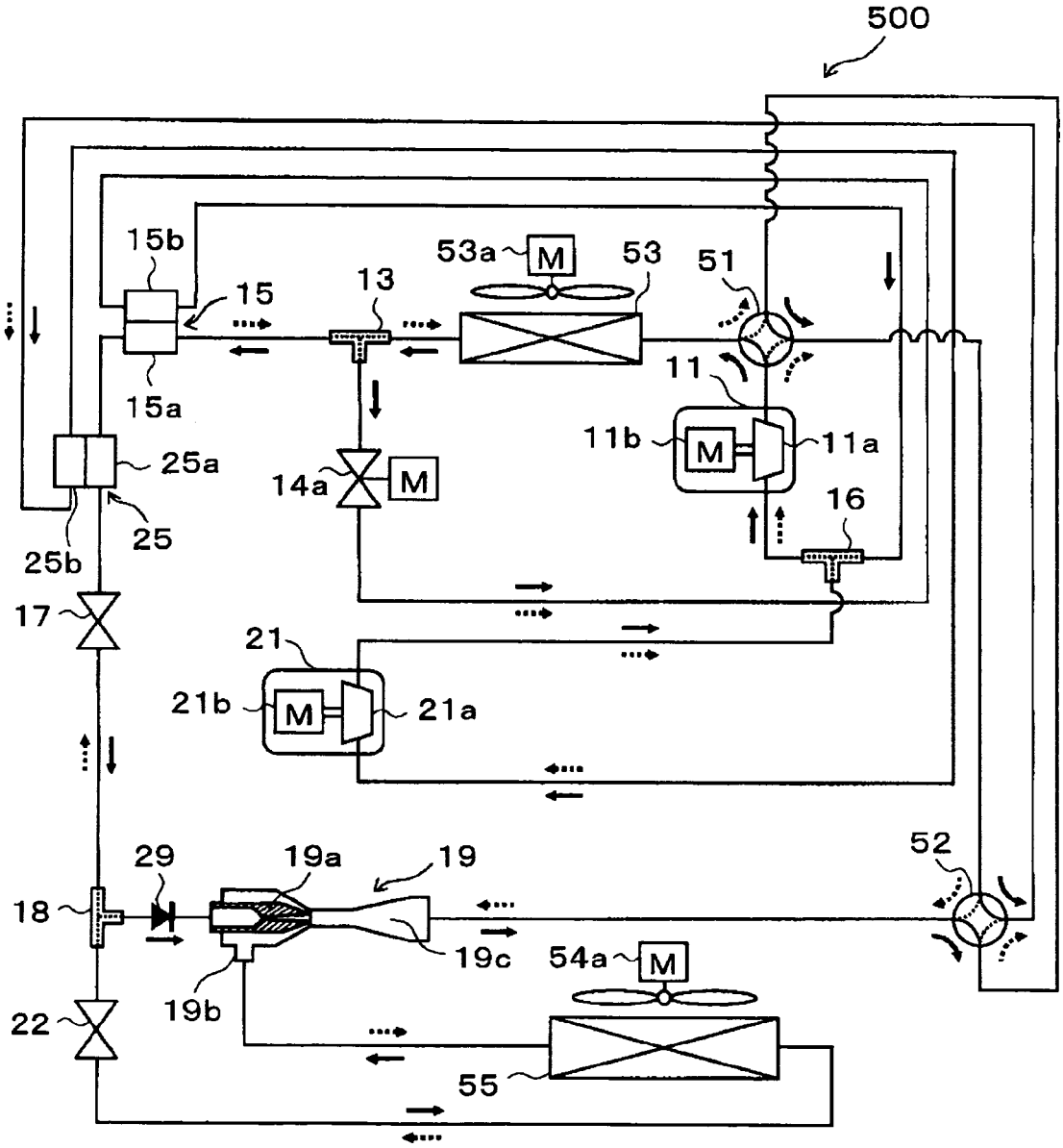
FIG. 73 is an entire schematic diagram of an ejector-type refrigerant cycle device according to a 49th embodiment of the invention.

In the present embodiment, as in the entire schematic diagram of FIG. 73, the auxiliary inner heat exchanger 25 similar to the 2nd embodiment is added, and the auxiliary using-side heat exchanger 54 is omitted, with respect to the ejector-type refrigerant cycle device 500 of the 48th embodiment.

In the auxiliary inner heat exchanger 25 of the present embodiment, in the cooling operation mode, the refrigerant flowing out of the inner heat exchanger 15 from the first branch portion 13 passes through the high-pressure side heat exchanger 25*a* and is heat-exchanged with the refrigerant passing through the low-pressure side refrigerant passage 25*b*, having passed through the diffuser portion 19*c* of the ejector 19.

The first electrical four-way valve 51 switches between: a refrigerant passage (the circuit shown by the solid arrows of FIG. 73) connecting the refrigerant discharge port of the first compressor 11 and the exterior heat exchanger 53, and connecting the two different refrigerant ports of the second electrical four-way valve 52 at the same time; and a refrigerant passage (the circuit shown by the chain arrows of FIG. 73) connecting the refrigerant discharge port of the first compressor 11 and one refrigerant port of the second electrical four-way valve 52, and connecting the exterior heat exchanger 53 and another refrigerant port of the second electrical four-way valve 52.

Furthermore, the second electrical four-way valve 52 of the present embodiment switches between: a refrigerant passage (the circuit shown by the solid arrows of FIG. 73) connecting the diffuser portion 19*c* of the ejector 19 and one refrigerant port of the first electrical four-way valve 51, and connecting another one of the refrigerant port of the first electrical four-way valve 51 and the low-pressure side refrigerant passage 25*b* of the auxiliary inner heat exchanger 25, at the same time; and a refrigerant passage (the circuit shown by the chain arrows of FIG. 73) connecting one refrigerant port of the first electrical four-way valve 51 and the diffuser portion 19*c* of the ejector 19, and connecting another refrigerant port of the first electrical four-way valve 51 and the low-pressure side refrigerant passage 25*b* of the auxiliary inner heat exchanger 25, at the same time.

Figure 74A:
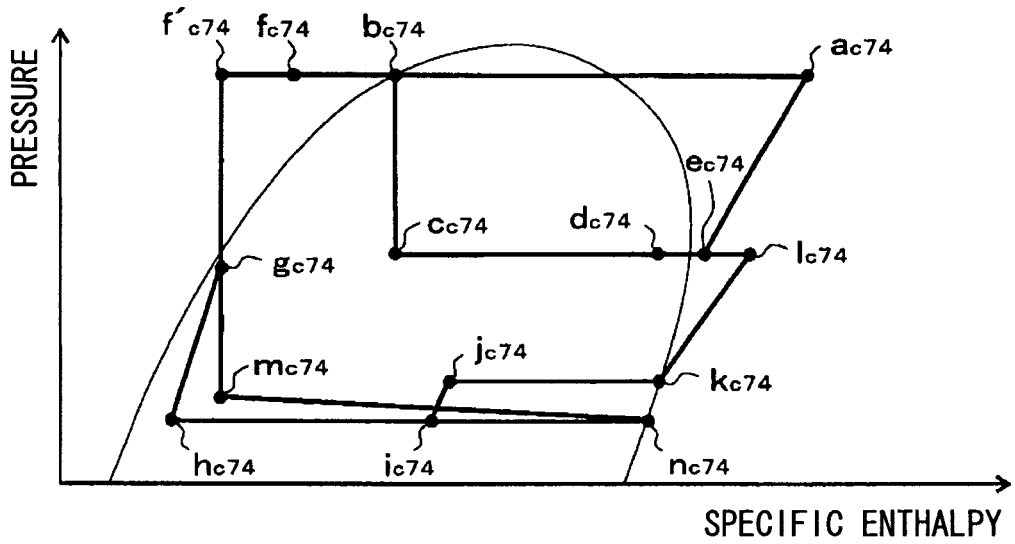
FIG. 74A is a Mollier diagram showing a refrigerant state in a cooling operation mode according to the 49th embodiment.

Next, operation of the present embodiment with the above structure will be described with reference to FIGS. 74A, 74B. The control device switches the first electrical four-way valve 51 so as to connect the refrigerant discharge port of the first compressor 11 and the exterior heat exchanger 53, and to connect the two different refrigerant ports of the second electrical four-way valve 52, and switches the second electrical four-way valve 52 so as to connect the diffuser portion 19*c* of the ejector 19 and one refrigerant port of the first electrical four-way valve 51, and to connect another one of the refrigerant port of the first electrical four-way valve 51 and the low-pressure side refrigerant passage 25*b* of the auxiliary inner heat exchanger 25. Thus, as in the solid arrows in FIG. 73, the following first, second and third refrigerant circuits are configured.

The first refrigerant circuit is configured so that the refrigerant flows in the circuit in this order of the first compressor 11→the first electrical four-way valve 51→the exterior heat exchanger 53→the first branch passage 13→the variable throttle mechanism 14*a*→the middle-pressure side refrigerant passage 15*b* of the inner heat exchanger 15→the join portion 16→the first compressor 11.

The second refrigerant circuit is configured so that the refrigerant flows in the circuit in this order of the first compressor 11→the first electrical four-way valve 51→the exterior heat exchanger 53→the first branch passage 13→the high-pressure side refrigerant passage 15*a* of the inner heat exchanger 15→the high-pressure side refrigerant passage 25*a* of the auxiliary inner heat exchanger 25→the first fixed throttle 17→the second branch portion 18→the pre-nozzle check valve 29→the ejector 19→the first and second electrical four-way valve 51, 52→the low-pressure side refrigerant passage 25*b* of the auxiliary inner heat exchanger 25→the second compressor 21→the join portion 16→the first compressor 11.

The third refrigerant circuit is configured so that the refrigerant flows in the circuit in this order of the first compressor 11→the first electrical four-way valve 51→the exterior heat exchanger 53→the first branch passage 13→the high-pressure side refrigerant passage 15*a* of the inner heat exchanger 15→the high-pressure side refrigerant passage 25*a* of the auxiliary inner heat exchanger 25→the first fixed throttle 17→the second branch portion 18→the second fixed throttle 22→the using-side heat exchanger 55→the ejector 19→the first and second electrical four-way valve 51, 52→the low-pressure side refrigerant passage 25*b* of the auxiliary inner heat exchanger 25→the second compressor 21→the join portion 16→the first compressor 11.

That is, in the cooling operation mode of the present embodiment, the exterior heat exchanger 53 and the using-side heat exchanger 55 are configured to respectively correspond to the radiator 12 and the suction side evaporator 23 of the 2nd embodiment. Thus, as shown in FIG. 74A, the cooling operation mode of the present embodiment is performed similarly to that in FIG. 4 of the 2nd embodiment, so as to cool the air of the room.

In contrast, in the heating operation mode, the control device switches the first electrical four-way valve 51 so as to connect the refrigerant discharge port of the first compressor 11 and one refrigerant port of the second electrical four-way valve 52, and to connect the exterior heat exchanger 53 and another refrigerant port of the second electrical four-way valve 52, at the same time. In addition, the control device switches the second electrical four-way valve 52 so as to connect one refrigerant port of the first electrical four-way valve 51 and the diffuser portion 19*c* of the ejector 19, and to connect another refrigerant port of the first electrical four-way valve 51 and the low-pressure side refrigerant passage 25*b* of the auxiliary inner heat exchanger 25, at the same time.

Thus, the refrigerant discharged from the first compressor 11 is decompressed in the ejector 19 while reversely flowing through the inner portion of the ejector 19 (point $a_{h74}$→point $c_{h74}$), and flows into the using-side heat exchanger 55, via the first and second electrical four-way valves 51, 52. The refrigerant flowing into the using-side heat exchanger 55 radiates heat by performing heat exchange with air inside the room, blown and circulated by the blower fan 54*a* (point $c_{h74}$→point $d_{h74}$). Thus, the air of the room is heated.

The refrigerant flowing out of the using-side heat exchanger 55 flows in this order of the second fixed throttle 22→the second branch portion 18→the first fixed throttle 17→the high-pressure side refrigerant passage 25*a* of the auxiliary inner heat exchanger 25 (point $d_{h74}$→point $e_{h74}$→point $f_{h74}$). At this time, because of the pressure difference back and forth of the pre-nozzle check valve 29, the refrigerant does not flow from the second branch portion 18 into the nozzle portion 19*a*.

The refrigerant flowing into the auxiliary inner heat exchanger 25 is almost not heat-exchanged in the auxiliary inner heat exchanger 25, because a temperature difference between the refrigerant flowing through the high-pressure side refrigerant passage 25*a* and the refrigerant flowing through the low-pressure side refrigerant passage 25*b* is extremely small.

The refrigerant flowing out of the high-pressure side refrigerant passage 25*a* of the auxiliary inner heat exchanger 25 flows in this order of the high-pressure side refrigerant passage 15*a* of the inner heat exchanger 15→the first branch portion 13→the exterior heat exchanger 53. In the heating operation mode, because the variable throttle mechanism 14*a* is in the fully close state, heat exchange is substantially not performed in the inner heat exchanger 15, and refrigerant does not flow from the first branch portion 13 toward the variable throttle mechanism 14*a*.

The refrigerant flowing into the exterior heat exchanger 53 absorbs heat by performing heat exchange with outside air blown by the blower fan 53*a* (point $f_{h74}$→point $g_{h74}$). The refrigerant flowing out of the exterior heat exchanger 53 flows in this order of the first electrical four-way valve 51→the second electrical four-way valve 52→the low-pressure side refrigerant passage 25*b* of the auxiliary inner heat exchanger 25.

The refrigerant flowing out of the low-pressure side refrigerant passage 25*b* of the auxiliary inner heat exchanger 25 is drawn into the second compressor 21 to be compressed again (point $g_{h74}$→point $h_{h74}$). Furthermore, the refrigerant discharged from the second compressor 21 is drawn into the first compressor 11 via the join portion 16, and is compressed again (point $h_{h74}$→point $a_{h74}$).

The ejector-type refrigerant cycle device 500 of the present embodiment is operated above, and thereby the air in the room can be cooled in the cooling operation mode, and the air in the room can be heated in the heating operation mode. Furthermore, in the cooling operation mode using the ejector 19 as the refrigerant decompression portion, the ejector-type refrigerant cycle device can be stably operated without reducing the COP even when a variation in the flow amount of the drive flow of the ejector 19 is caused, similarly to the 2nd embodiment.

(50th Embodiment)

Figure 75:
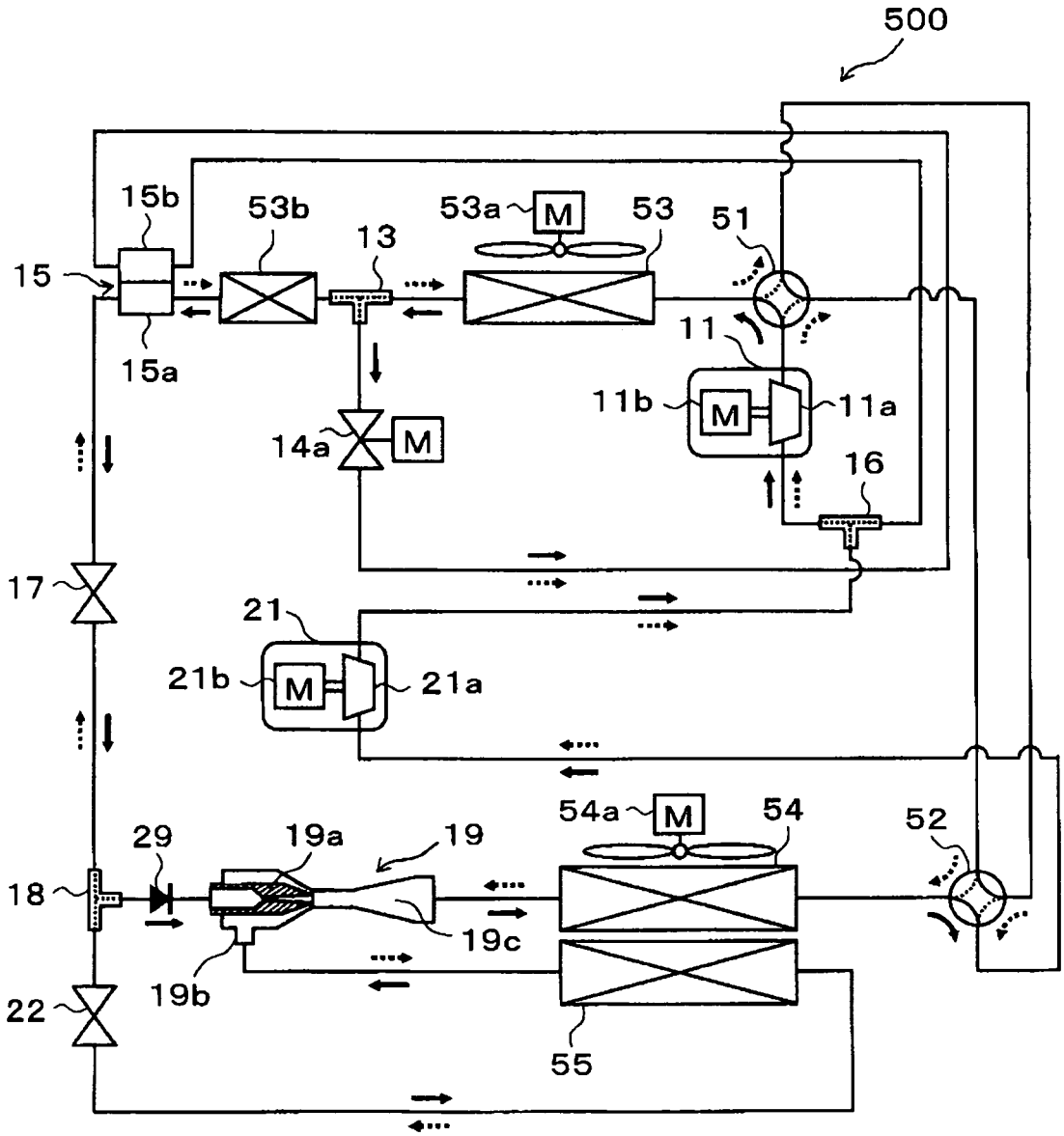
FIG. 75 is an entire schematic diagram of an ejector-type refrigerant cycle device according to a 50th embodiment of the invention.

In the present embodiment, as in the entire schematic diagram of FIG. 75, an auxiliary exterior heat exchanger 53*b* similar to the auxiliary radiator 24 of the 3rd embodiment is added, with respect to the ejector-type refrigerant cycle device 500 of the 48th embodiment. The auxiliary exterior heat exchanger 53*b* of the present embodiment is configured to perform heat exchange between the refrigerant flowing therein and air outside the room (outside air) blown by the blower fan 53*a*.

In the present embodiment, the heat exchange capacity of the exterior heat exchange 53 is made to be reduced, and the first branch portion 13 is configured such that a flow amount of the refrigerant flowing toward the auxiliary radiator 24 becomes larger than a flow amount of the refrigerant flowing toward the thermal expansion valve 14. The other configurations of the present embodiment are similar to those of the 48th embodiment.

Figure 76A:
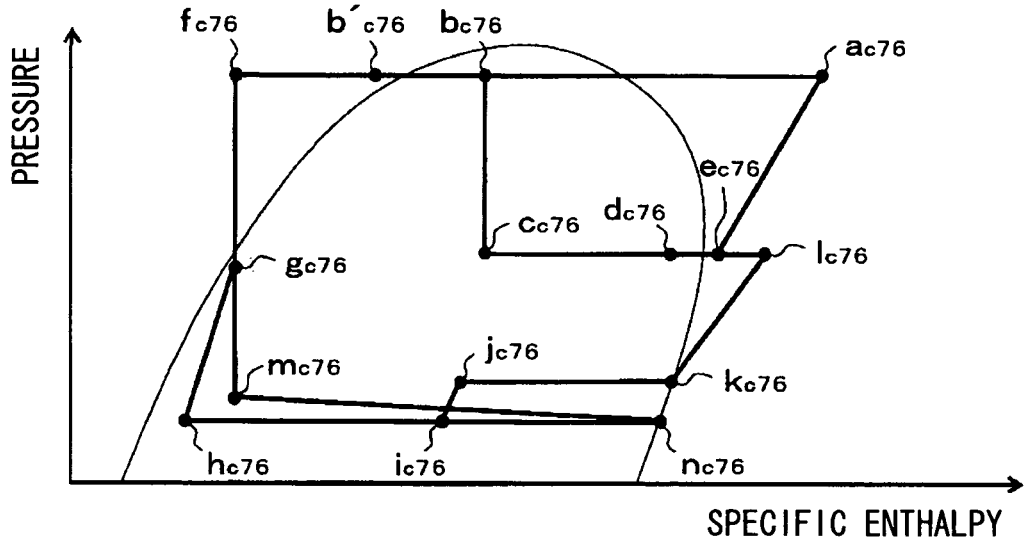
FIG. 76A is a Mollier diagram showing a refrigerant state in a cooling operation mode according to the 50th embodiment.

Next, operation of the present embodiment with the above structure will be described with reference to FIGS. 76A, 76B. The basic operation of the present embodiment is similar to the 48th embodiment. Thus, as in the solid arrows in FIG. 75, the following first, second and third refrigerant circuits are configured.

The first refrigerant circuit is configured so that the refrigerant flows in the circuit in this order of the first compressor 11→the first electrical four-way valve 51→the exterior heat exchanger 53→the first branch passage 13→the variable throttle mechanism 14*a*→the middle-pressure side refrigerant passage 15*b* of the inner heat exchanger 15→the join portion 16→the first compressor 11.

The second refrigerant circuit is configured so that the refrigerant flows in the circuit in this order of the first compressor 11→the first electrical four-way valve 51→the exterior heat exchanger 53→the first branch passage 13→the auxiliary exterior heat exchanger 53*b*→the high-pressure side refrigerant passage 15*a* of the inner heat exchanger 15→the first fixed throttle 17→the second branch portion 18→the pre-nozzle check valve 29→the ejector 19→the auxiliary using-side heat exchanger 54→the second electrical four-way valve 52→the second compressor 21→the join portion 16→the first compressor 11.

The third refrigerant circuit is configured so that the refrigerant flows in the circuit in this order of the first compressor 11→the first electrical four-way valve 51→the exterior heat exchanger 53→the first branch passage 13→the auxiliary exterior heat exchanger 53*b*→the high-pressure side refrigerant passage 15*a* of the inner heat exchanger 15→the first fixed throttle 17→the second branch portion 18→the second fixed throttle 22→the using-side heat exchanger 55→the ejector 19→the auxiliary using-side heat exchanger 54→the second electrical four-way valve 52→the second compressor 21→the join portion 16→the first compressor 11.

That is, in the cooling operation mode of the present embodiment, the exterior heat exchanger 53, the auxiliary exterior heat exchanger 53*b*, the auxiliary using-side heat, exchanger 54 and the using-side heat exchanger 55 are configured to respectively correspond to the radiator 12, the auxiliary radiator 24, the discharge side evaporator 20 and the suction side evaporator 23 of the 3rd embodiment. Thus, as shown in FIG. 76A, the cooling operation mode of the present embodiment is performed similarly to that in FIG. 6 of the 3rd embodiment, so as to cool the air of the room.

In contrast, in the heating operation mode, the control device switches the first electrical four-way valve 51 and the second electrical four-way valve 52, similarly to the 48th embodiment.

Figure 76B:
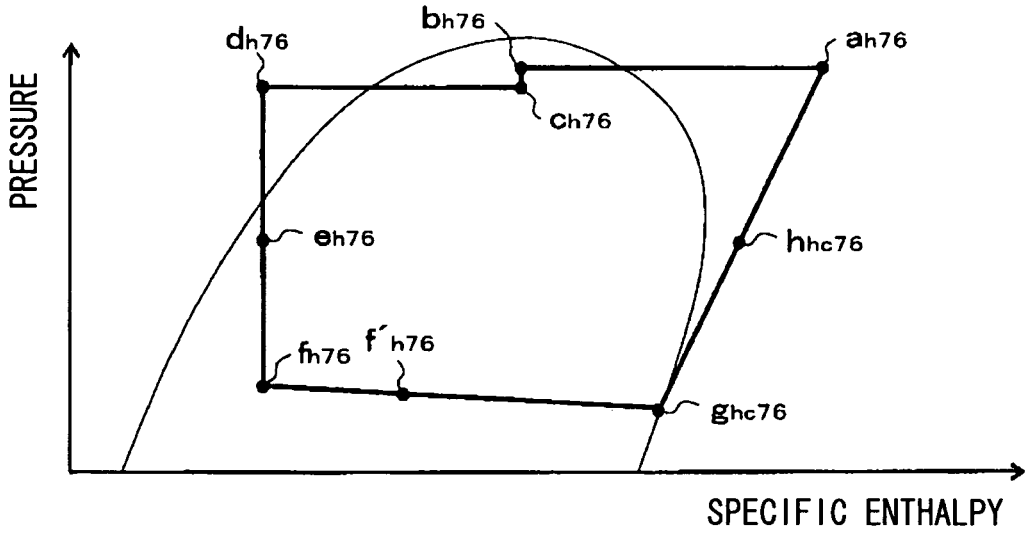
FIG. 76B is a Mollier diagram showing a refrigerant state in a heating operation mode according to the 50th embodiment.

Thus, the refrigerant discharged from the first compressor 11 flows in this order of the first electrical four-way valve 51→the second electrical four-way valve 52→the auxiliary using-side heat exchanger 54→the ejector 19→the using-side heat exchanger 55 (point $a_{h76}$→point $b_{h76}$→point $c_{h76}$→point $d_{h76}$, in FIG. 76B). Thus, the air of the room is heated.

The refrigerant flowing out of the using-side heat exchanger 55 flows in this order of the second fixed throttle 22→the second branch portion 18→the first fixed throttle 17, and is decompressed (point $d_{h76}$→point $e_{h76}$→point $f_{h76}$). The refrigerant decompressed and expanded in the first fixed throttle 17 flows into the auxiliary exterior heat exchanger 53*b* via the inner heat exchanger 15. The refrigerant flowing into the auxiliary exterior heat exchanger 53*b* is heat-exchanged with outside air blown by the blower fan 53*a* (point $f_{h76}$→point $f'_{h76}$).

The refrigerant flowing out of the auxiliary exterior heat exchanger 53*b* flows into the exterior heat exchanger 53 via the first branch portion. The refrigerant flowing into the exterior heat exchanger 53 is heat exchanged with outside air blown by the blower fan 53*a* to absorb heat (point $f'_{h76}$→point $g_{h76}$).

The refrigerant flowing out of the exterior heat exchanger 53 flows in this order of the first electrical four-way valve 51→the second electrical four-way valve 52, and is drawn into the second compressor 21 to be compressed again (point $g_{h76}$→point $h_{h76}$). Furthermore, the refrigerant discharged from the second compressor 21 is drawn into the first compressor 11 via the join portion 16, and is compressed again (point $h_{h76}$→point $a_{h76}$).

The ejector-type refrigerant cycle device 500 of the present embodiment is operated above, and thereby the air in the room can be cooled in the cooling operation mode, and the air in the room can be heated in the heating operation mode. Furthermore, in the cooling operation mode using the ejector 19 as the refrigerant decompression portion, the ejector-type refrigerant cycle device can be stably operated without reducing the COP even when a variation in the flow amount of the drive flow of the ejector 19 is caused, similarly to the 3rd embodiment.

(51st Embodiment)

Figure 77:
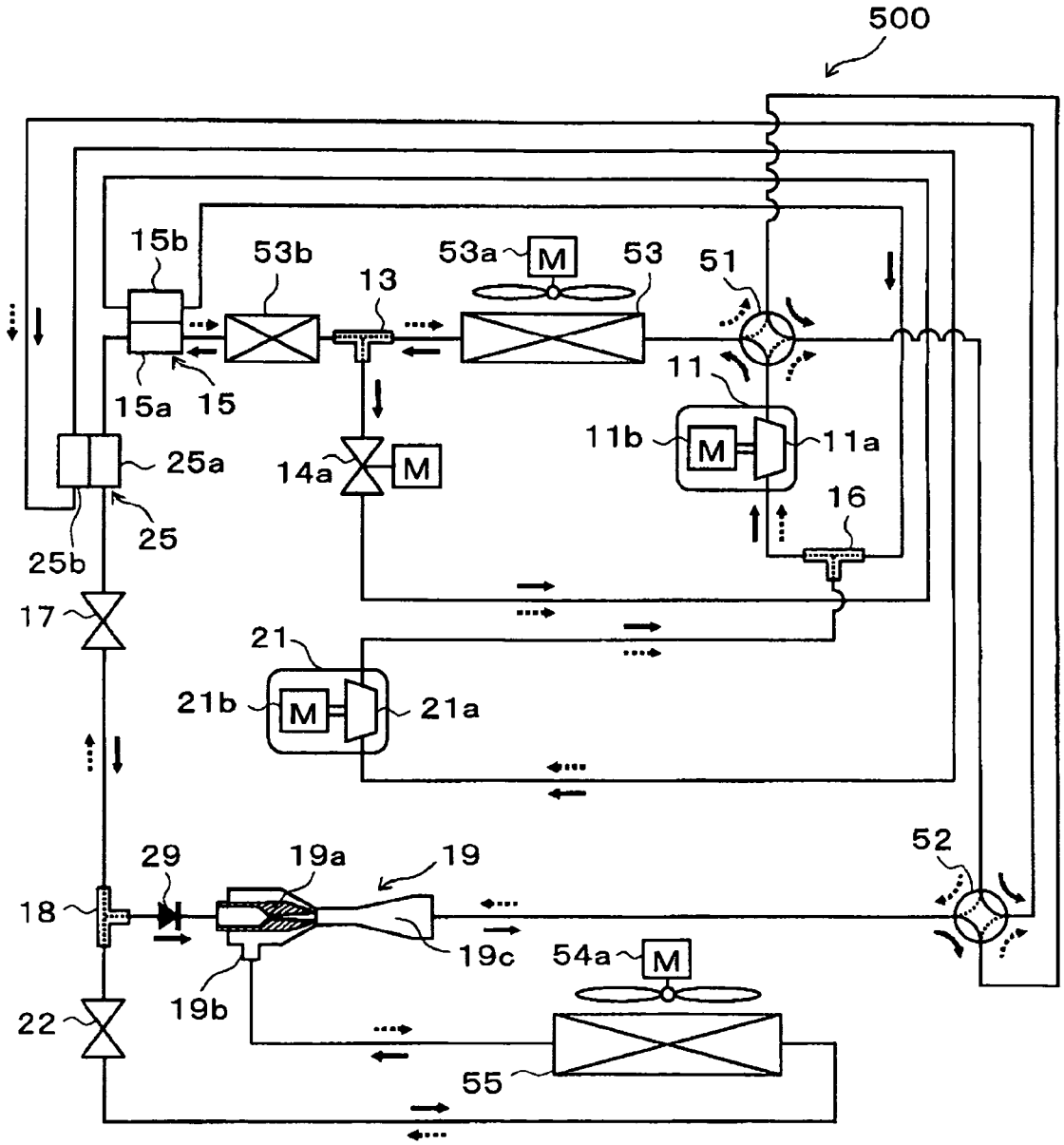
FIG. 77 is an entire schematic diagram of an ejector-type refrigerant cycle device according to a 51st embodiment of the invention.

In the present embodiment, as in the entire schematic diagram of FIG. 77, an auxiliary exterior heat exchanger 53*b* similar to the 50th embodiment is added, with respect to the ejector-type refrigerant cycle device 500 of the 49th embodiment. The other configurations of the present embodiment are similar to those of the 49th embodiment.

Figure 78A:
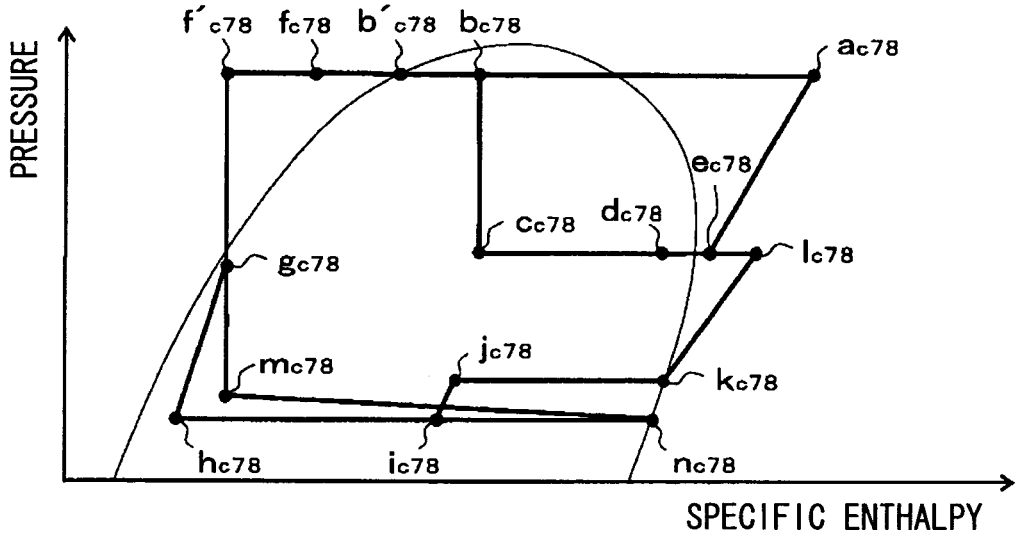
FIG. 78A is a Mollier diagram showing a refrigerant state in a cooling operation mode according to the 51st embodiment.

Next, operation of the present embodiment with the above structure will be described with reference to FIGS. 78A, 78B. The basic operation of the present embodiment is similar to the 48th embodiment. Thus, as in the solid arrows in FIG. 77, the following first, second and third refrigerant circuits are configured.

The first refrigerant circuit is configured so that the refrigerant flows in the circuit in this order of the first compressor 11→the first electrical four-way valve 51→the exterior heat exchanger 53→the first branch passage 13→the variable throttle mechanism 14*a*→the middle-pressure side refrigerant passage 15*b* of the inner heat exchanger 15→the join portion 16→the first compressor 11.

The second refrigerant circuit is configured so that the refrigerant flows in the circuit in this order of the first compressor 11→the first electrical four-way valve 51→the exterior heat exchanger 53→the first branch passage 13→the auxiliary exterior heat exchanger 53*b*→the high-pressure side refrigerant passage 15*a* of the inner heat exchanger 15→the high-pressure side refrigerant passage 25*a* of the auxiliary inner heat exchanger 25→the first fixed throttle 17→the second branch portion 18→the pre-nozzle check valve 29→the ejector 19→the first and second electrical four-way valve 51, 52→the low-pressure side refrigerant passage 25*b* of the auxiliary inner heat exchanger 25→the second compressor 21→the join portion 16→the first compressor 11.

The third refrigerant circuit is configured so that the refrigerant flows in the circuit in this order of the first compressor 11→the first electrical four-way valve 51→the exterior heat exchanger 53→the first branch passage 13→the auxiliary exterior heat exchanger 53*b*→the high-pressure side refrigerant passage 15*a* of the inner heat exchanger 15→the high-pressure side refrigerant passage 25*a* of the auxiliary inner heat exchanger 25→the first fixed throttle 17→the second branch portion 18→the second fixed throttle 22→the using-side heat exchanger 55→the ejector 19→the first and second electrical four-way valves 51, 52→the low-pressure side refrigerant passage 25*b* of the auxiliary inner heat exchanger 25→the second compressor 21→the join portion 16→the first compressor 11.

That is, in the cooling operation mode of the present embodiment, the exterior heat exchanger 53, the auxiliary exterior heat exchanger 53*b* and the using-side heat exchanger 55 are configured to respectively correspond to the radiator 12, auxiliary radiator 24 and the suction side evaporator 23 of the 4th embodiment. Thus, as shown in FIG. 78A, the cooling operation mode of the present embodiment is performed similarly to that in FIG. 8 of the 4th embodiment, so as to cool the air of the room.

In contrast, in the heating operation mode, the control device switches the first electrical four-way valve 51 and the second electrical four-way valve 52, similarly to the 49th embodiment.

Figure 78B:
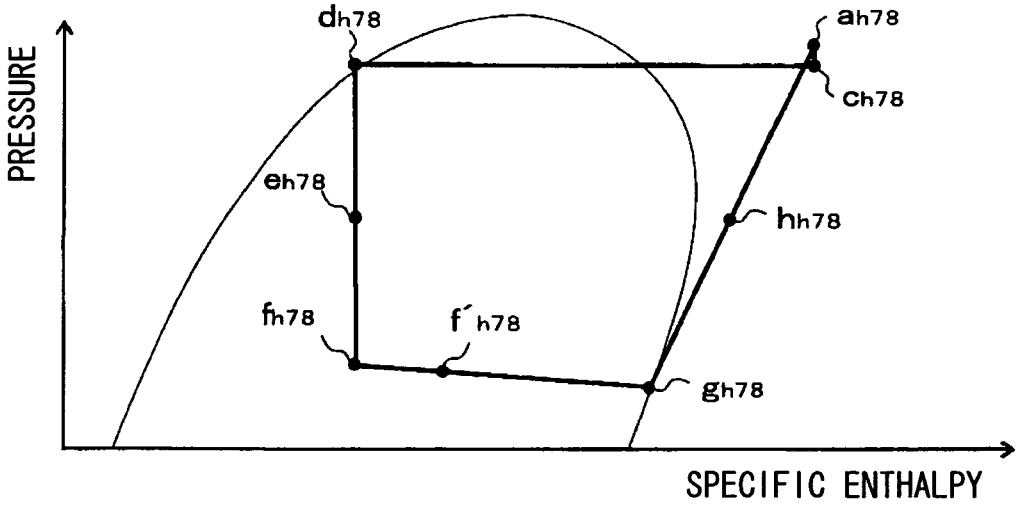
FIG. 78B is a Mollier diagram showing a refrigerant state in a heating operation mode according to the 51st embodiment.

Thus, the refrigerant discharged from the first compressor 11 flows in this order of the first electrical four-way valve 51→the second electrical four-way valve 52→the ejector 19→the using-side heat exchanger 55 (point $a_{h78}$→point $c_{h78}$→point $d_{h78}$, in FIG. 78B). Thus, the air of the room is heated.

The refrigerant flowing out of the using-side heat exchanger 55 flows in this order of the second fixed throttle 22→the second branch portion 18→the first fixed throttle 17, and is decompressed (point $d_{h78}$→point $e_{h78}$→point $f_{h78}$). The refrigerant decompressed and expanded in the first fixed throttle 17 flows into the auxiliary exterior heat exchanger 53*b* via the auxiliary inner heat exchanger 25 and the inner heat exchanger 15. The refrigerant flowing into the auxiliary exterior heat exchanger 53*b* is heat-exchanged with outside air blown by the blower fan 53*a* (point $f_{h78}$→point $f'_{h78}$).

The refrigerant flowing out of the auxiliary exterior heat exchanger 53*b* flows into the exterior heat exchanger 53 via the first branch portion 13. The refrigerant flowing into the exterior heat exchanger 53 is heat exchanged with outside air blown by the blower fan 53*a* to absorb heat (point $f'_{h78}$→point $g_{h78}$).

The refrigerant flowing out of the exterior heat exchanger 53 flows in this order of the first electrical four-way valve 51→the second electrical four-way valve 52→the low-pressure side refrigerant passage 25*b* of the auxiliary inner heat exchanger 25, and is drawn into the second compressor 21 to be compressed (point $g_{h78}$→point $h_{h78}$). Furthermore, the refrigerant discharged from the second compressor 21 is drawn into the first compressor 11 via the join portion 16, and is compressed again (point $h_{h78}$→point $a_{h78}$).

The ejector-type refrigerant cycle device 500 of the present embodiment is operated above, and thereby the air in the room can be cooled in the cooling operation mode, and the air in the room can be heated in the heating operation mode. Furthermore, in the cooling operation mode using the ejector 19 as the refrigerant decompression portion, the ejector-type refrigerant cycle device can be stably operated without reducing the COP even when a variation in the flow amount of the drive flow, of the ejector 19 is caused, similarly to the 4th embodiment.

(52nd Embodiment)

Figure 79:
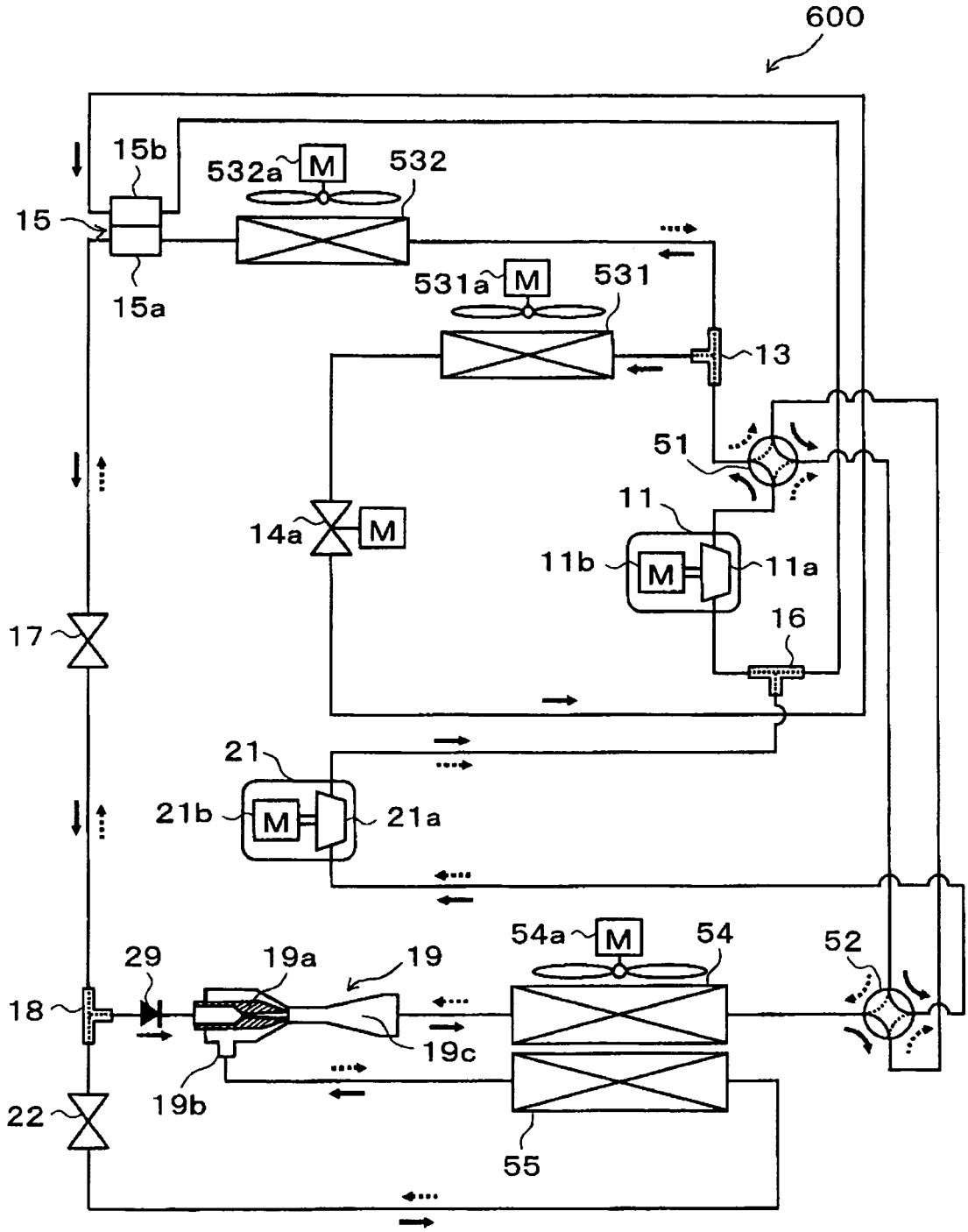
FIG. 79 is an entire schematic diagram of an ejector-type refrigerant cycle device according to a 52nd embodiment of the invention.
Figure 80A:
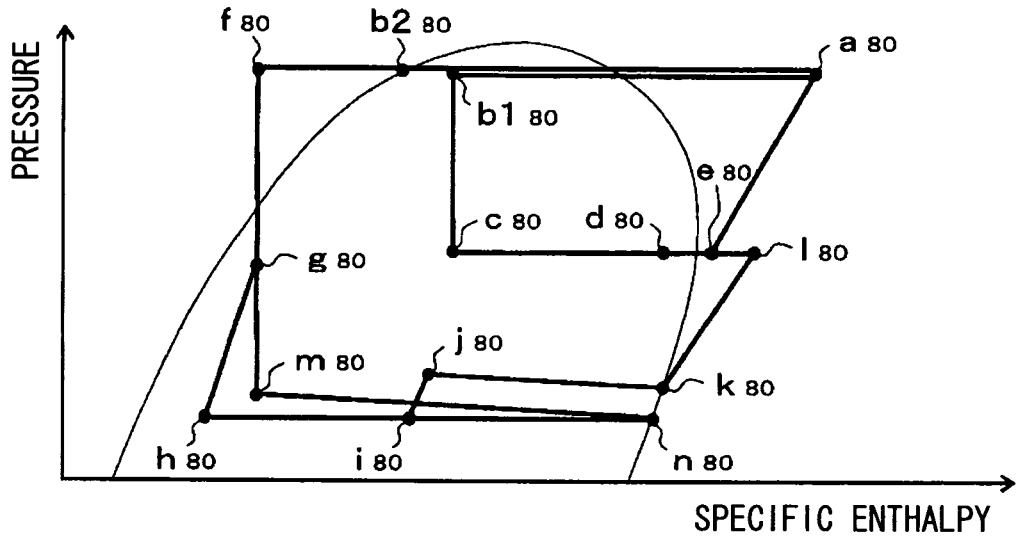
FIG. 80A is a Mollier diagram showing a refrigerant state in a cooling operation mode according to the 52nd embodiment.

In the present embodiment, an example, in which an ejector-type refrigerant cycle device 600 of the present invention is applied to a cooling/heating storage unit similarly to the 48th embodiment, will be described with reference to FIGS. 79, 80A and 80B. FIG. 79 is an entire schematic diagram of the ejector-type refrigerant cycle device 600 of the present embodiment. In the ejector-type refrigerant cycle device 600 of the present embodiment, components and connection states, that is, cycle configurations, are changed with respect to the ejector-type refrigerant cycle device 500 of the 48th embodiment that is a pre-condition of the present embodiment.

As shown in FIG. 79, in the present embodiment, the first branch portion 13 is arranged at the refrigerant discharge side of the first compressor 11. A first exterior heat exchanger 531 is connected to one of the refrigerant outlets of the first branch portion 13, and a second exterior heat exchanger 532 is connected to the other one of the refrigerant outlets of the first branch portion 13.

The first exterior heat exchanger 531 is a heat exchanger, in which high-pressure refrigerant flowing out of one of the refrigerant outlets of the first branch portion 13 is heat-exchanged with air (outside air) outside the room of the refrigerator, blown by a first blower fan 531*a*. The second exterior heat exchanger 532 is a heat exchanger, in which high-pressure refrigerant flowing out of the other one of the refrigerant outlets of the first branch portion 13 is heat-exchanged with air (outside air) outside the room, blown by a second blower fan 532*a*.

In the ejector-type refrigerant cycle device 600 of the present embodiment, a heat-exchanging area of the first exterior heat exchanger 531 is made smaller than that of the second exterior heat exchanger 532, so that the heat exchanging capacity (heat radiating performance) of the first exterior heat exchanger 531 is reduced than the heat exchanging capacity (heat radiating performance) of the second exterior heat exchanger 532. Each of the first and second blower fans 531*a*, 532*a* is an electrical blower in which the rotation speed (i.e., air blowing amount) is controlled by a control voltage output from the control device.

A variable throttle mechanism 14*a* as the high-pressure side decompression portion similar to the 48th embodiment is connected to the refrigerant outlet side of the first exterior heat exchanger 531. The cycle configuration downstream of the variable throttle mechanism 14*a* is similar to the 48th embodiment. On the other hand, the high-pressure side refrigerant passage 15*a* of the inner heat exchanger 15 is connected to the refrigerant outlet side of the second exterior heat exchanger 532. The cycle configuration downstream of the high-pressure side refrigerant passage 15*a* is similar to the 48th embodiment.

Thus, the first electrical four-way valve 51 switches between: a refrigerant passage (the circuit shown by the solid arrows of FIG. 79) connecting the refrigerant discharge port of the first compressor 11 and the first branch portion 13, and connecting the two different refrigerant ports of the second electrical four-way valve 52 at the same time; and a refrigerant passage (the circuit shown by the chain arrows of FIG. 79) connecting the refrigerant discharge port of the first compressor 11 and one refrigerant port of the second electrical four-way valve 52, and connecting the first branch portion 13 and another refrigerant port of the second electrical four-way valve 52.

Furthermore, the second electrical four-way valve 52 of the present embodiment switches between: a refrigerant passage (the circuit shown by the solid arrows of FIG. 79) connecting the auxiliary using-side heat exchanger 54 and one refrigerant port of the first electrical four-way valve 51, and connecting another one of the refrigerant port of the first electrical four-way valve 51 and the refrigerant suction port of the second compressor 21, at the same time; and a refrigerant passage (the circuit shown by the chain arrows of FIG. 79) connecting one refrigerant port of the first electrical four-way valve 51 and the auxiliary using-side heat exchanger 54, and connecting another refrigerant port of the first electrical four-way valve 51 and the refrigerant suction port of the second compressor 21, at the same time.

Next, operation of the present embodiment with the above structure will be described with reference to FIGS. 80A, 80B. The basic operation of the present embodiment is similar to the 48th embodiment.

In the cooling operation mode of the present embodiment, the control device switches the first electrical four-way valve 51 so as to connect the refrigerant discharge port of the first compressor 11 and the first branch portion 13, and to connect the two different refrigerant ports of the second electrical four-way valve 52, and switches the second electrical four-way valve 52 so as to connect the auxiliary using-side heat exchanger 54 and one refrigerant port of the first electrical four-way valve 51, and to connect another one of the refrigerant port of the first electrical four-way valve 51 and the refrigerant suction port of the second compressor 21. Thus, as in the solid arrows in FIG. 79, the following first, second and third refrigerant circuits are configured.

The first refrigerant circuit is configured so that the refrigerant flows in the circuit in this order of the first compressor 11→the first electrical four-way valve 51→the first branch passage 13→the first exterior heat exchanger 531→the variable throttle mechanism 14*a*→the middle-pressure side refrigerant passage 15*b* of the inner heat exchanger 15→the join portion 16→the first compressor 11.

The second refrigerant circuit is configured so that the refrigerant flows in the circuit in this order of the first compressor 11→the first electrical four-way valve 51→the first branch passage 13→the second exterior heat exchanger 532→the high-pressure side refrigerant passage 15*a* of the inner heat exchanger 15→the first fixed throttle 17→the second branch portion 18→the pre-nozzle check valve 29→the ejector 19→the auxiliary using-side heat exchanger 54→the first and second electrical four-way valve 51, 52→the second compressor 21→the join portion 16→the first compressor 11.

The third refrigerant circuit is configured so that the refrigerant flows in the circuit in this order of the first compressor 11→the first electrical four-way valve 51→the first branch passage 13→the second exterior heat exchanger 532→the high-pressure side refrigerant passage 15*a* of the inner heat exchanger 15→the first fixed throttle 17→the second branch portion 18→the second fixed throttle 22→the using-side heat exchanger 55→the ejector 19→the auxiliary using-side heat exchanger 54→the first and second electrical four-way valves 51, 52→the second compressor 21→the join portion 16→the first compressor 11.

That is, in the cooling operation mode of the present embodiment, the first exterior heat exchanger 531, the second exterior heat exchanger 532, the auxiliary using-side heat exchanger 54 and the using-side heat exchanger 55 are configured to respectively correspond to the first radiator 121, the second radiator 122, the discharge side evaporator 20 and the suction side evaporator 23 of the 7th embodiment. Thus, as shown in FIG. 80A, the cooling operation mode of the present embodiment is performed similarly to that in FIG. 14 of the 7th embodiment, so as to cool the air of the room.

In contrast, in the heating operation mode, the control device switches the first electrical four-way valve 51 so as to connect the refrigerant discharge port of the first compressor 11 and one refrigerant port of the second electrical four-way valve 52, and to connect the first branch portion 13 and another refrigerant port of the second electrical four-way valve 52. In addition, the control device switches the second electrical four-way valve 52 so as to connect one refrigerant port of the first electrical four-way valve 51 and the auxiliary using-side heat exchanger 54, and to connect another refrigerant port of the first electrical four-way valve 51 and the refrigerant suction port of the second compressor 21, at the same time.

In present embodiment, the control device causes the variable throttle mechanism 14*a* to be in the fully close state, and causes the first blower fan 531*a* to be stopped in the heating operation mode. Thus, as in the 48th embodiment, the refrigerant discharged from the first compressor 11 flows in this order of the first electrical four-way valve 51→the second electrical four-way valve 52→the auxiliary using-side heat exchanger 54→the ejector 19→the using-side heat exchanger 55 (point $a_{h80}$→point $b_{h80}$→point $c_{h80}$→point $d_{h80}$). Thus, the air of the room is heated.

The refrigerant flowing out of the using-side heat exchanger 55 flows in this order of the second fixed throttle 22→the second branch portion 18→the first fixed throttle 17 (point $d_{h80}$→point $e_{h80}$→point $f_{h80}$). The refrigerant decompressed and expanded in the first fixed throttle 17 flows into the second exterior heat exchanger 532 via the high-pressure side refrigerant passage 15*a* of the inner heat exchanger 15. The refrigerant flowing into the second exterior heat exchanger 532 is heat-exchanged with the outside air blown by the second blower fan 532*a* to absorb heat (point $f_{h80}$→point $g_{h80}$).

The refrigerant flowing out of the second exterior heat exchanger 532 flows in this order of the first branch portion 13→the first electrical four-way valve 51→the second electrical four-way valve 52, and is drawn into the second compressor 21 to be compressed therein (point $g_{h80}$→point $h_{h80}$). Furthermore, the refrigerant discharged from the second compressor 21 is drawn into the first compressor 11 via the join portion 16, and is compressed again (point $h_{h80}$→point $a_{h80}$).

In the heating operation mode, because the variable throttle mechanism 14*a* is in the fully close state, refrigerant does not flow from the first branch portion 13 toward the first exterior heat exchanger 531, and heat exchange is substantially not performed in the inner heat exchanger 15.

The ejector-type refrigerant cycle device 600 of the present embodiment is operated above, and thereby the air in the room can be cooled in the cooling operation mode, and the air in the room can be heated in the heating operation mode. Furthermore, in the cooling operation mode using the ejector 19 as the refrigerant decompression portion, the ejector-type refrigerant cycle device can be stably operated without reducing the COP even when a variation in the flow amount of the drive flow of the ejector 19 is caused, similarly to the 7th embodiment.

(53rd Embodiment)

Figure 81:
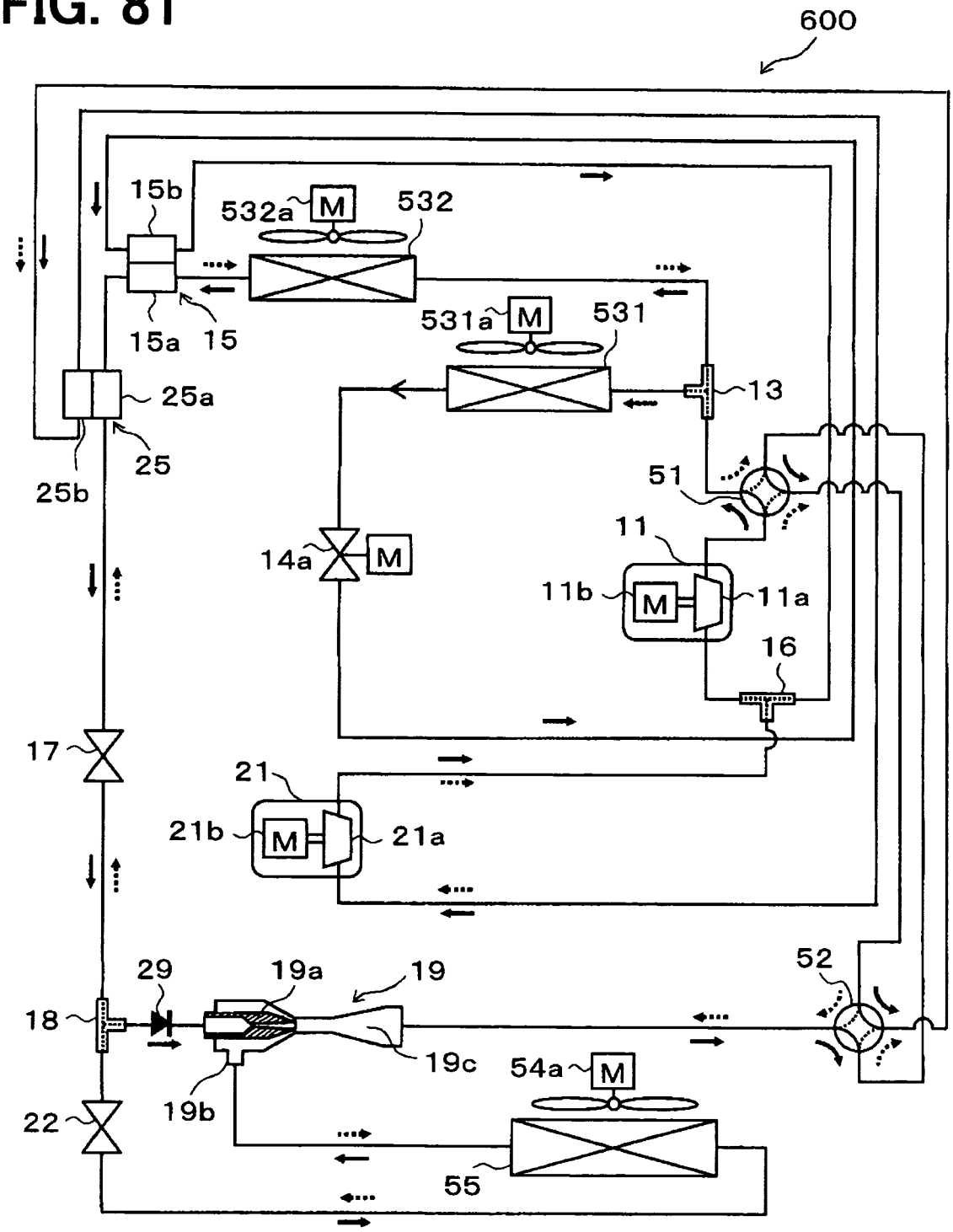
FIG. 81 is an entire schematic diagram of an ejector-type refrigerant cycle device according to a 53rd embodiment of the invention.

In the present embodiment, as in the entire schematic diagram of FIG. 81, the auxiliary inner heat exchanger 25 similar to the 8th embodiment is added, and the auxiliary using-side heat exchanger 54 is omitted, with respect to the ejector-type refrigerant cycle device 600 of the 52nd embodiment.

In the auxiliary inner heat exchanger 25 of the present embodiment, in the cooling operation mode, the refrigerant flowing out of the second exterior heat exchanger 532 flows through the high-pressure side heat exchanger 25*a*, and is heat-exchanged with the refrigerant passing through the low-pressure side refrigerant passage 25*b*, having passed through the diffuser portion 19*c* of the ejector 19.

The first electrical four-way valve 51 of the present embodiment switches between: a refrigerant passage (the circuit shown by the solid arrows of FIG. 81) connecting the refrigerant discharge port of the first compressor 11 and the first branch portion 13, and connecting the two different refrigerant ports of the second electrical four-way valve 52 at the same time; and a refrigerant passage (the circuit shown by the chain arrows of FIG. 81) connecting the refrigerant discharge port of the first compressor 11 and one refrigerant port of the second electrical four-way valve 52, and connecting the first branch portion 13 and another refrigerant port of the second electrical four-way valve 52.

Furthermore, the second electrical four-way valve 52 of the present embodiment switches between: a refrigerant passage (the circuit shown by the solid arrows of FIG. 81) connecting the diffuser portion 19*c* of the ejector 19 and one refrigerant port of the first electrical four-way valve 51, and connecting another one of the refrigerant port of the first electrical four-way valve 51 and the low-pressure side refrigerant passage 25*b* of the auxiliary inner heat exchanger 25, at the same time; and a refrigerant passage (the circuit shown by the chain arrows of FIG. 81) connecting one refrigerant port of the first electrical four-way valve 51 and the diffuser portion 19*c* of the ejector 19, and connecting another refrigerant port of the first electrical four-way valve 51 and the low-pressure side refrigerant passage 25*b* of the auxiliary inner heat exchanger 25, at the same time.

Figure 82A:
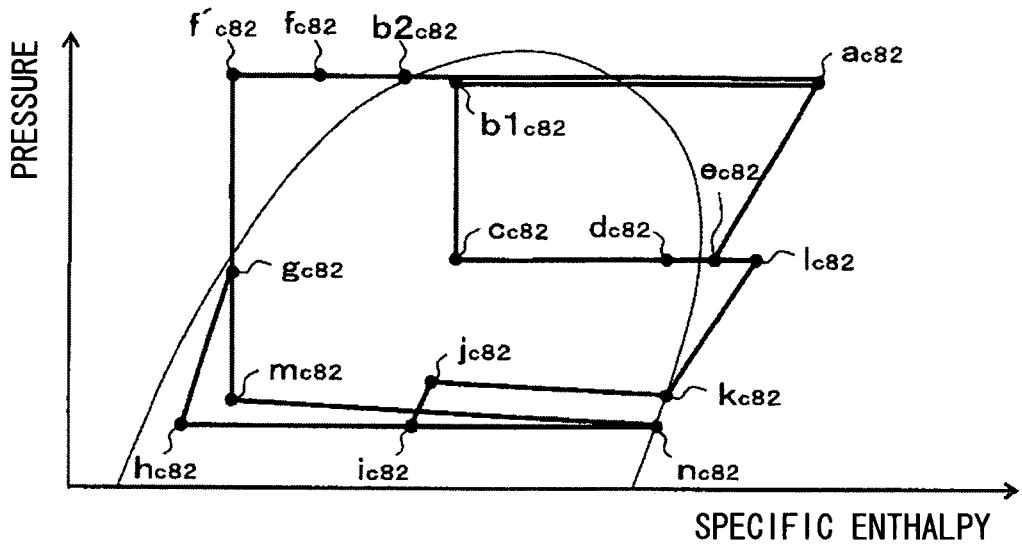
FIG. 82A is a Mollier diagram showing a refrigerant state in a cooling operation mode according to the 53rd embodiment.

Next, operation of the present embodiment with the above structure will be described with reference to FIGS. 82A, 82B. The basic operation of the present embodiment is similar to the 49th embodiment.

In the cooling operation mode of the present embodiment, the control device switches the first electrical four-way valve 51 so as to connect the refrigerant discharge port of the first compressor 11 and the first branch portion 13, and to connect the two different refrigerant ports of the second electrical four-way valve 52 at the same time, and switches the second electrical four-way valve 52 so as to connect the diffuser portion 19*c* of the ejector 19 and one refrigerant port of the first electrical four-way valve 51, and to connect another one of the refrigerant port of the first electrical four-way valve 51 and the low-pressure side refrigerant passage 25*b* of the auxiliary inner heat exchanger 25. Thus, as in the solid arrows in FIG. 81, the following first, second and third refrigerant circuits are configured.

The first refrigerant circuit is configured so that the refrigerant flows in the circuit in this order of the first compressor 11→the first electrical four-way valve 51→the first branch passage 13→the first exterior heat exchanger 531→the variable throttle mechanism 14*a*→the middle-pressure side refrigerant passage 15*b* of the inner heat exchanger 15→the join portion 16→the first compressor 11.

The second refrigerant circuit is configured so that the refrigerant flows in the circuit in this order of the first compressor 11→the first electrical four-way valve 51→the first branch passage 13→the second exterior heat exchanger 532→the high-pressure side refrigerant passage 15*a* of the inner heat exchanger 15→the high-pressure side refrigerant passage 25*a* of the auxiliary inner heat exchanger 25→the first fixed throttle 17→the second branch portion 18→the pre-nozzle check valve 29→the ejector 19→the first and second electrical four-way valve 51, 52→the low-pressure side refrigerant passage 25*b* of the auxiliary inner heat exchanger 25→the second compressor 21→the join portion 16→the first compressor 11.

The third refrigerant circuit is configured so that the refrigerant flows in the circuit in this order of the first compressor 11→the first electrical four-way valve 51→the first branch passage 13→the second exterior heat exchanger 532→the high-pressure side refrigerant passage 15*a* of the inner heat exchanger 15→the first fixed throttle 17→the second branch portion 18→the second fixed throttle 22→the using-side heat exchanger 55→the ejector 19→the first and second electrical four-way valve 51, 52→the low-pressure side refrigerant passage 25*b* of the auxiliary inner heat exchanger 25→the second compressor 21→the join portion 16→the first compressor 11.

That is, in the cooling operation mode of the present embodiment, the first exterior heat exchanger 531, the second exterior heat exchanger 532 and the using-side heat exchanger 55 are configured to respectively correspond to the first radiator 121, the second radiator 122 and the suction side evaporator 23 of the 8th embodiment. Thus, as shown in FIG. 82A, the cooling operation mode of the present embodiment is performed similarly to that in FIG. 16 of the 8th embodiment, so as to cool the air of the room.

In contrast, in the heating operation mode, the control device switches the first electrical four-way valve 51 so as to connect the refrigerant discharge port of the first compressor 11 and one refrigerant port of the second electrical four-way valve 52, and to connect the first branch portion 13 and another refrigerant port of the second electrical four-way valve 52, at the same time. In addition, the control device switches the second electrical four-way valve 52 so as to connect one refrigerant port of the first electrical four-way valve 51 and the diffuser portion 19*c* of the ejector 19, and to connect another refrigerant port of the first electrical four-way valve 51 and the low-pressure side refrigerant passage 25*b* of the auxiliary inner heat exchanger 25, at the same time.

In present embodiment, the control device causes the variable throttle mechanism 14*a* to be in the fully close state, and causes the first blower fan 531*a* to be stopped in the heating operation mode.

Thus, similarly to the 49th embodiment, the refrigerant discharged from the first compressor 11 is decompressed in the ejector 19 (point $a_{h82}$→point $c_{h82}$) while reversely flowing through the inner portion of the ejector 19, and flows into the using-side heat exchanger 55, via the first and second electrical four-way valves 51, 52. The refrigerant flowing into the using-side heat exchanger 55 radiates heat by performing heat exchange with air inside the room, blown and circulated by the blower fan 54*a* (point $c_{h82}$→point $d_{h82}$). Thus, the air of the room is heated.

The refrigerant flowing out of the using-side heat exchanger 55 flows in this order of the second fixed throttle 22→the second branch portion 18→the first fixed throttle 17, and is decompressed (point $d_{h82}$→point $e_{h82}$→point $f_{h82}$). The refrigerant decompressed and expanded at the first fixed throttle 17 flows into the second exterior heat exchanger 532 via the auxiliary inner heat exchanger 25 and the inner heat exchanger 15.

At this time, because a temperature difference between the refrigerant flowing through the high-pressure side refrigerant passage 25*a* and the refrigerant flowing through the low-pressure side refrigerant passage 25*b* is extremely small in the auxiliary inner heat exchanger 25, heat exchange is almost not performed in the auxiliary inner heat exchanger 25. Therefore, the refrigerant flowing into the second exterior heat exchanger 532 is heat-exchanged with outside air blown by the second blower fan.

The refrigerant flowing out of the second exterior heat exchanger 532 flows in this order of the first branch portion 13→the first electrical four-way valve 51→the second electrical four-way valve 52→the low-pressure side refrigerant passage 25*b* of the auxiliary inner heat exchanger 25, and is drawn into the second compressor 21 to be compressed therein (point $g_{h82}$→point $h_{h82}$). Furthermore, the refrigerant discharged from the second compressor 21 is drawn into the first compressor 11 via the join portion 16, and is compressed again (point $h_{h82}$→point $a_{h82}$).

In the heating operation mode, because the variable throttle mechanism 14*a* is in the fully close state, refrigerant does not flow from the first branch portion 13 toward the first exterior heat exchanger 531, and heat exchange is substantially not performed in the inner heat exchanger 15.

The ejector-type refrigerant cycle device 600 of the present embodiment is operated above, and thereby the air in the room can be cooled in the cooling operation mode, and the air in the room can be heated in the heating operation mode. Furthermore, in the cooling operation mode using the ejector 19 as the refrigerant decompression portion, the ejector-type refrigerant cycle device can be stably operated without reducing the COP even when a variation in the flow amount of the drive flow of the ejector 19 is caused, similarly to the 8th embodiment.

(54th Embodiment)

Figure 83:
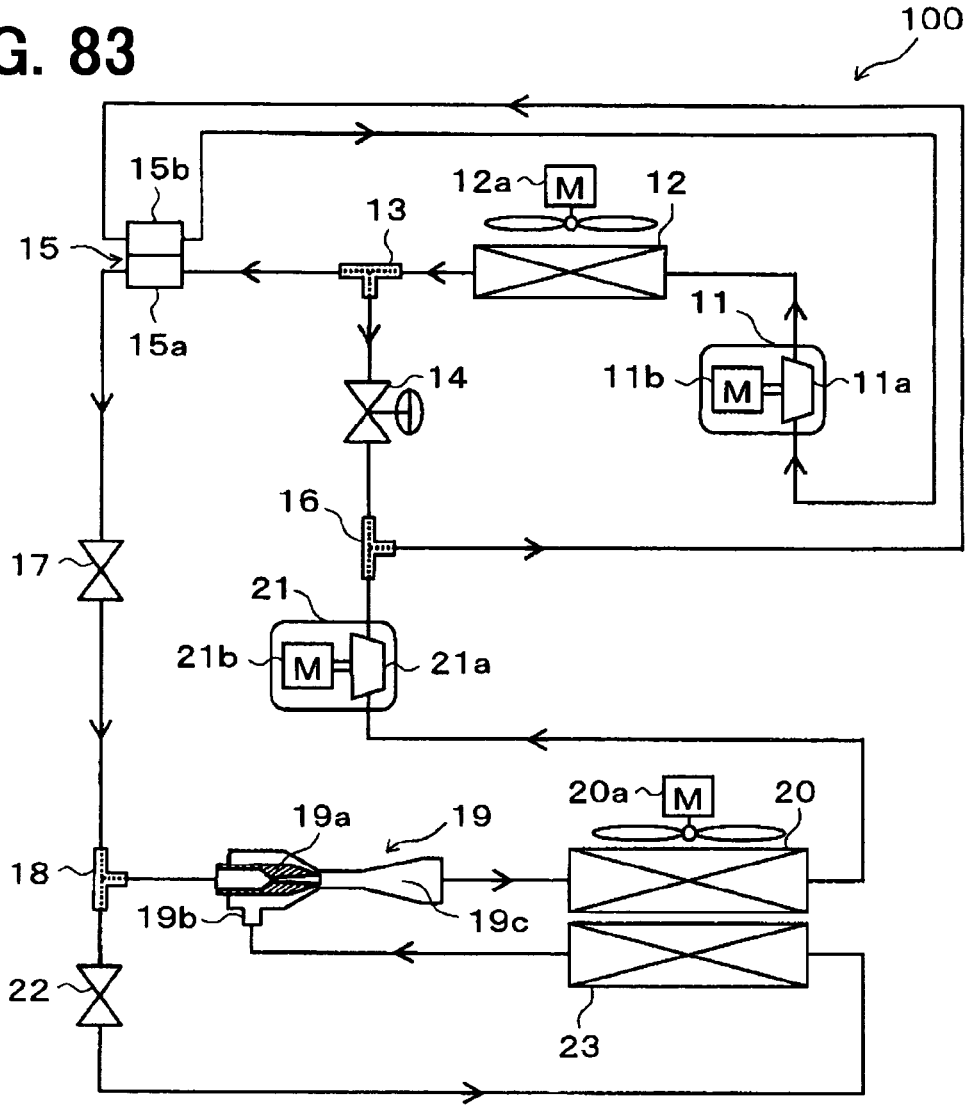
FIG. 83 is an entire schematic diagram of an ejector-type refrigerant cycle device according to a 54th embodiment of the invention.

In the present embodiment, as in the entire schematic diagram of FIG. 83, the arrangement of the join portion 16 is changed, with respect to the ejector-type refrigerant cycle device 100 of the 1st embodiment. That is, in the 1st embodiment, at the join portion 16, the refrigerant flowing out of the middle-pressure side refrigerant passage 15*b* of the inner heat exchanger 15 and the refrigerant discharged from the second compressor 21 are joined. In contrast, in the present embodiment, at the join portion 16, the refrigerant flowing out of the thermal expansion valve 14 and the refrigerant discharged from the second compressor 21 are joined.

Thus, in the inner heat exchanger 15 of the present embodiment, the refrigerant (point $c_{84}$) flowing out of the thermal expansion valve 14 and the refrigerant (point $l_{84}$) discharged from the second compressor 21 are joined as the join refrigerant (point $d_{84}$), and the join refrigerant is heat-exchanged with the refrigerant (point $b_{84}$) flowing from the first branch portion 13 into the inner heat exchanger 15. The other configuration and operation are similar to those of the 1st embodiment.

Figure 84:
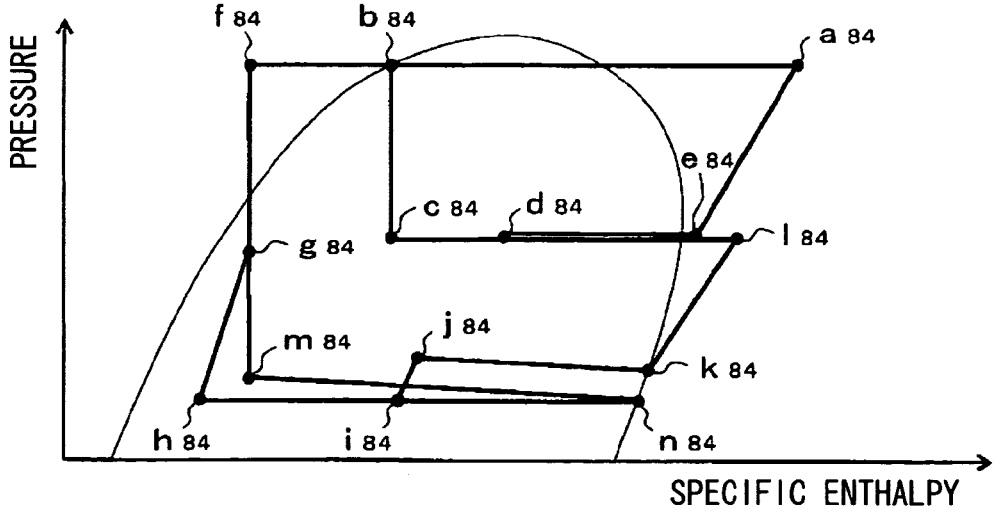
FIG. 84 is a Mollier diagram showing a refrigerant state in the ejector-type refrigerant cycle device according to the 54th embodiment.

As a result, as in the Mollier diagram of FIG. 84, the present embodiment is operated substantially similarly to the 1st embodiment, and the same effects of the 1st embodiment can be obtained.

(55th to 61st Embodiments)

Figure 85:
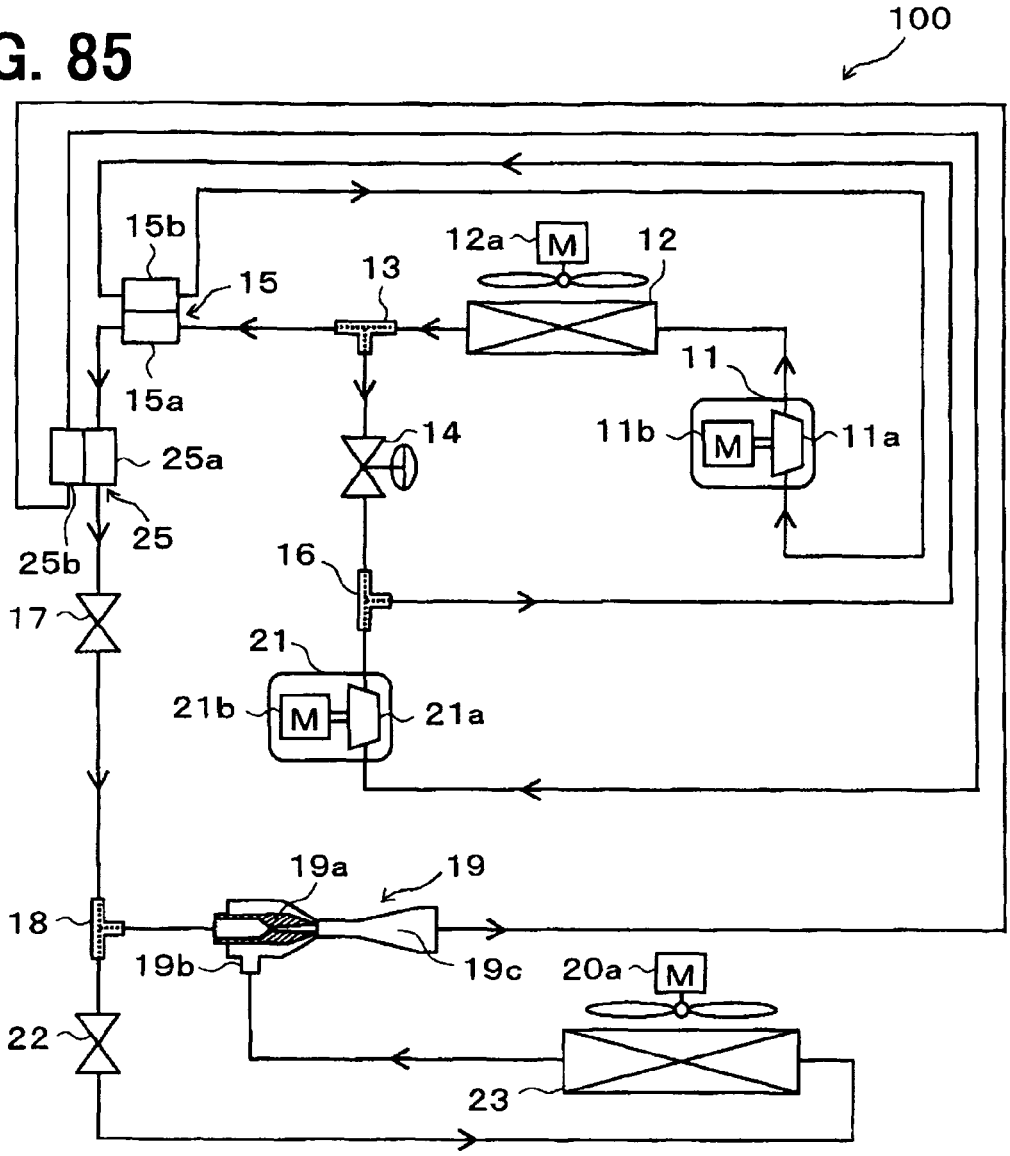
FIG. 85 is an entire schematic diagram of an ejector-type refrigerant cycle device according to a 55th embodiment of the invention.
Figure 86:
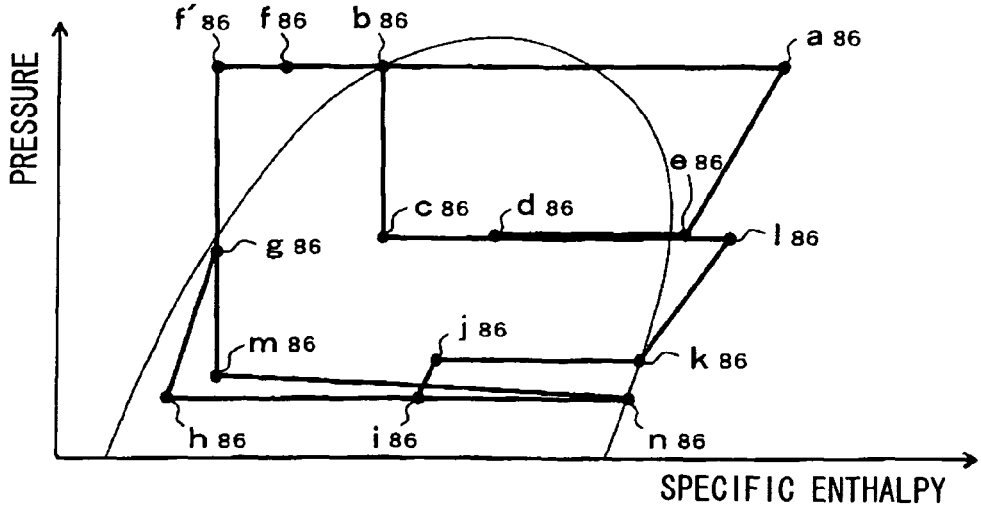
FIG. 86 is a Mollier diagram showing a refrigerant state in the ejector-type refrigerant cycle device according to the 55th embodiment.

In 55th embodiment, as shown in the entire schematic diagram of FIG. 85, the arrangement of the join portion 16 is changed similarly to the 54th embodiment, with respect to the ejector-type refrigerant cycle device 100 of the 2nd embodiment. Thus, as in the Mollier diagram of FIG. 86, the present embodiment is operated substantially similarly to the 2nd embodiment, and the same effects of the 2nd embodiment can be obtained.

Figure 87:
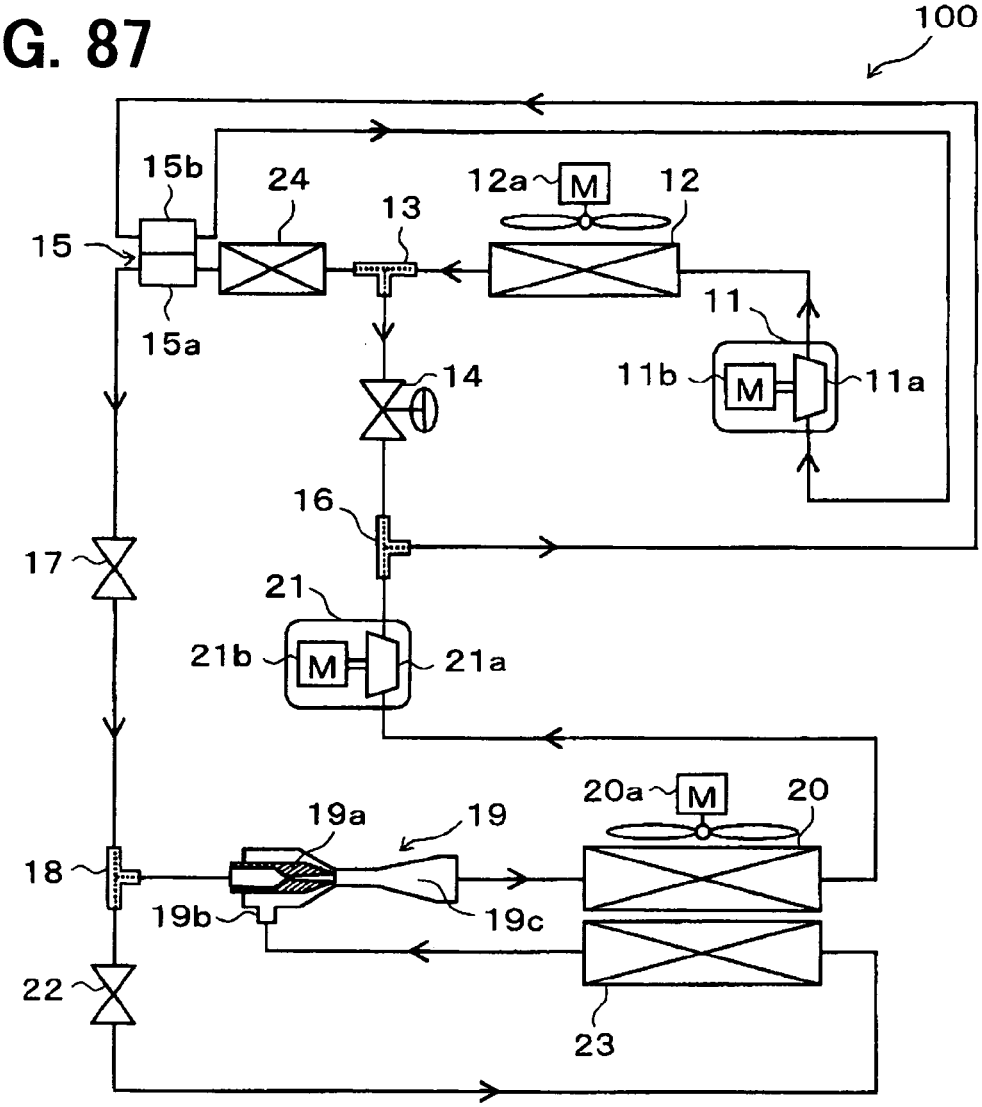
FIG. 87 is an entire schematic diagram of an ejector-type refrigerant cycle device according to a 56th embodiment of the invention.
Figure 88:
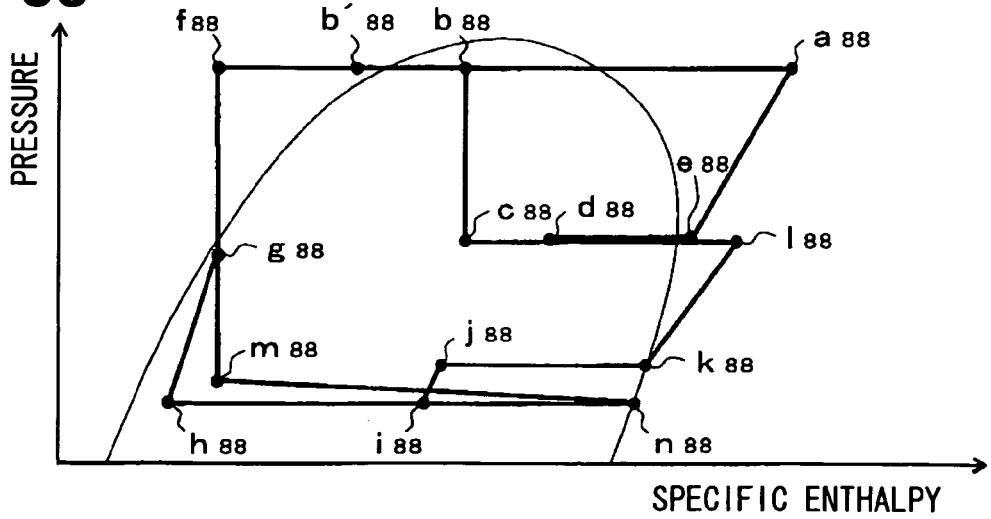
FIG. 88 is a Mollier diagram showing a refrigerant state in the ejector-type refrigerant cycle device according to the 56th embodiment.

In 56th embodiment, as shown in the entire schematic diagram of FIG. 87, the arrangement of the join portion 16 is changed similarly to the 54th embodiment, with respect to the ejector-type refrigerant cycle device 100 of the 3rd embodiment. Thus, as in the Mollier diagram of FIG. 88, the present embodiment is operated substantially similarly to the 3rd embodiment, and the same effects of the 3rd embodiment can be obtained.

Figure 89:
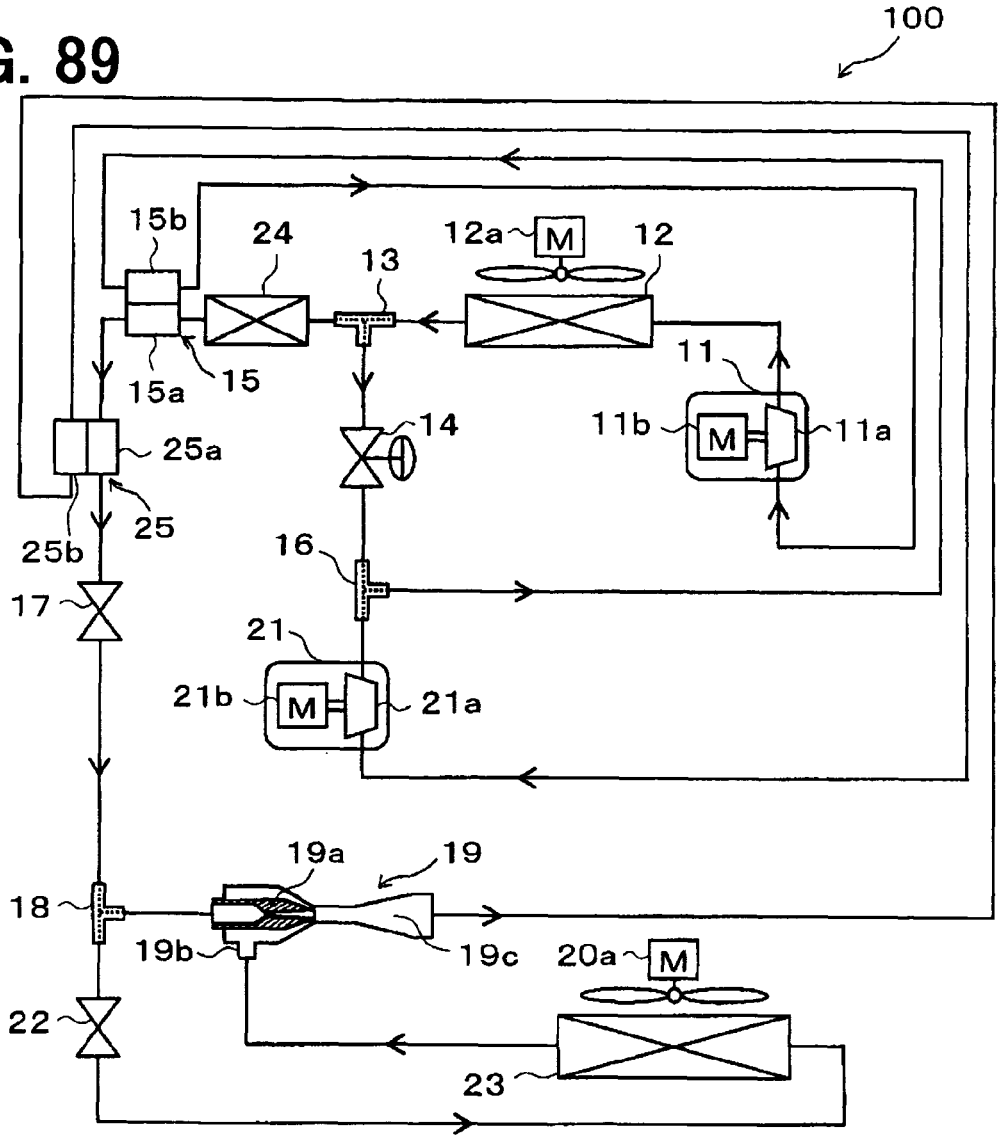
FIG. 89 is an entire schematic diagram of an ejector-type refrigerant cycle device according to a 57th embodiment of the invention.
Figure 90:
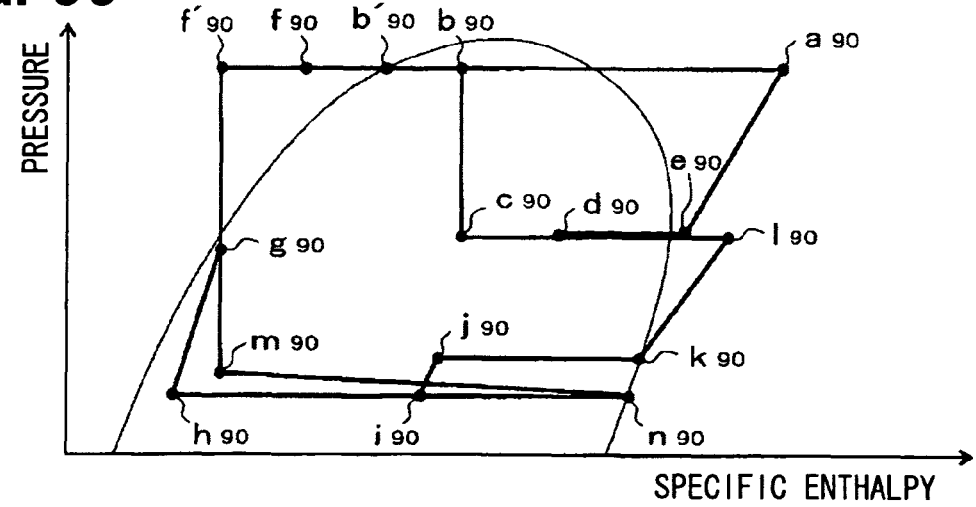
FIG. 90 is a Mollier diagram showing a refrigerant state in the ejector-type refrigerant cycle device according to the 57th embodiment.

In 57th embodiment, as shown in the entire schematic diagram of FIG. 89, the arrangement of the join portion 16 is changed similarly to the 54th embodiment, with respect to the ejector-type refrigerant cycle device 100 of the 4th embodiment. Thus, as in the Mollier diagram of FIG. 90, the present embodiment is operated substantially similarly to the 4th embodiment, and the same effects of the 4th embodiment can be obtained.

Figure 91:
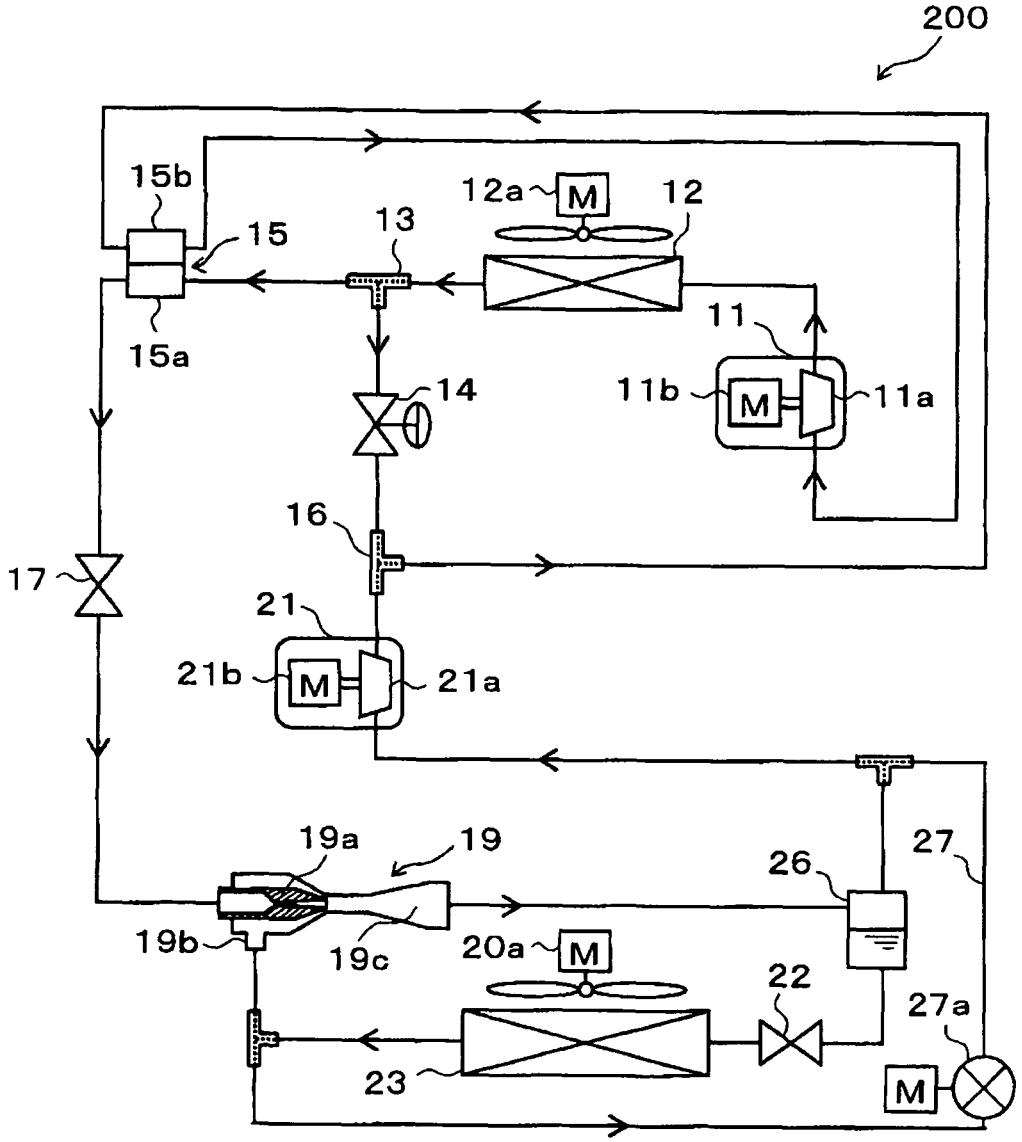
FIG. 91 is an entire schematic diagram of an ejector-type refrigerant cycle device according to a 58th embodiment of the invention.
Figure 92A:
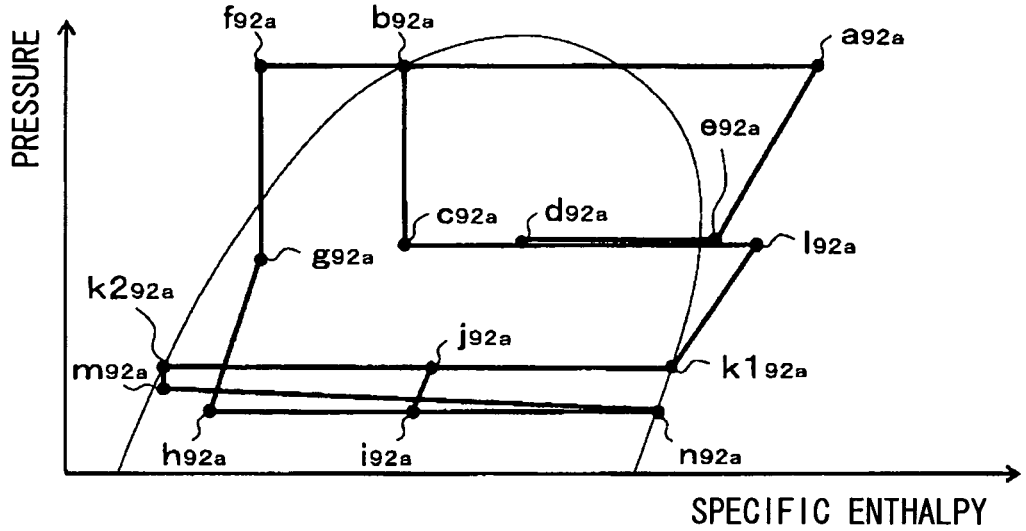
FIG. 92A is a Mollier diagram showing a refrigerant state in a general operation mode according to the 58th embodiment.
Figure 92B:
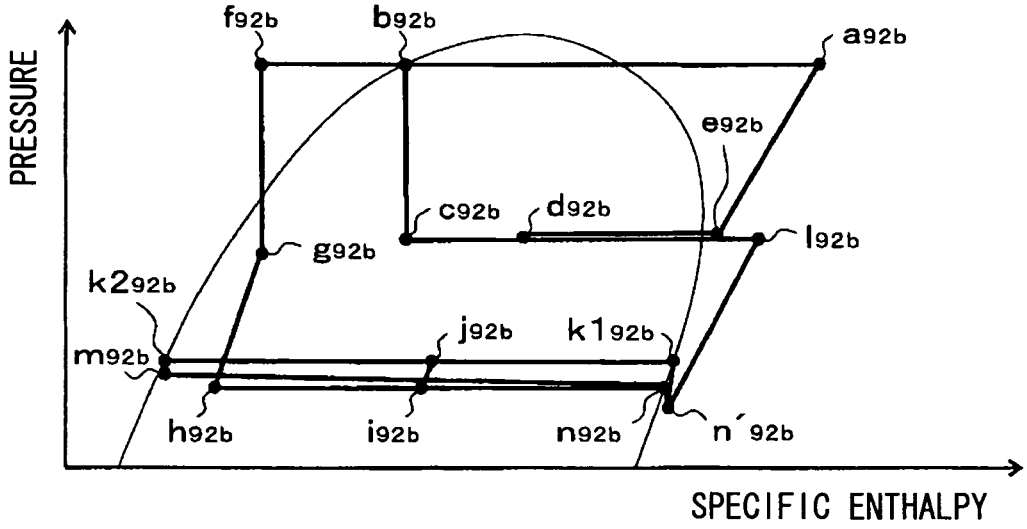
FIG. 92B is a Mollier diagram showing a refrigerant state in an oil returning operation mode according to the 58th embodiment.

In the 58th embodiment, as shown in the entire schematic diagram of FIG. 91, the arrangement of the join portion 16 is changed similarly to the 54th embodiment, with respect to the ejector-type refrigerant cycle device 200 of the 5th embodiment. Thus, as in the Mollier diagrams of FIGS. 92A, 92B, the present embodiment is operated substantially similarly to the 5th embodiment, and the same effects as in the 5th embodiment can be obtained.

Figure 93:
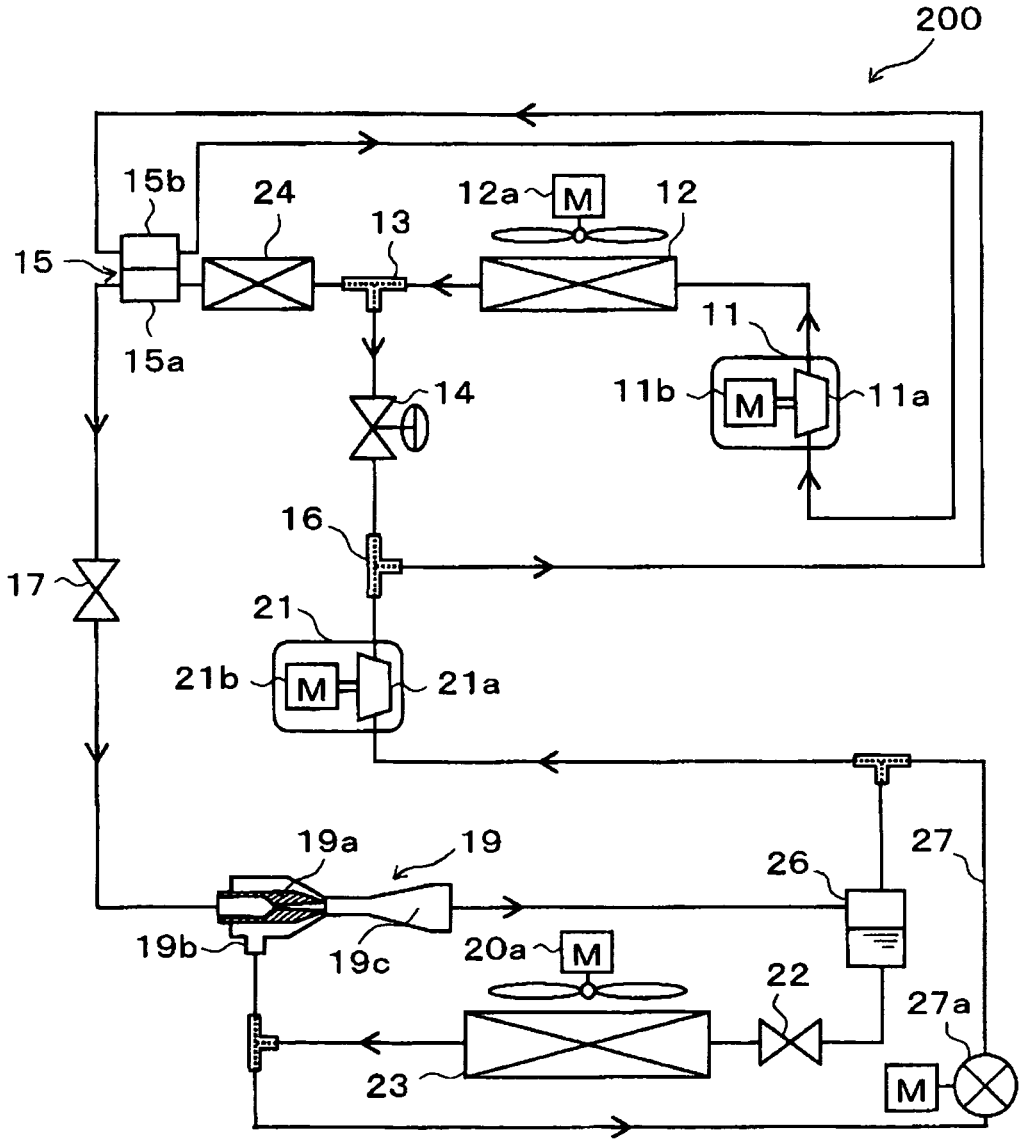
FIG. 93 is an entire schematic diagram of an ejector-type refrigerant cycle device according to a 59th embodiment of the invention.
Figure 94A:
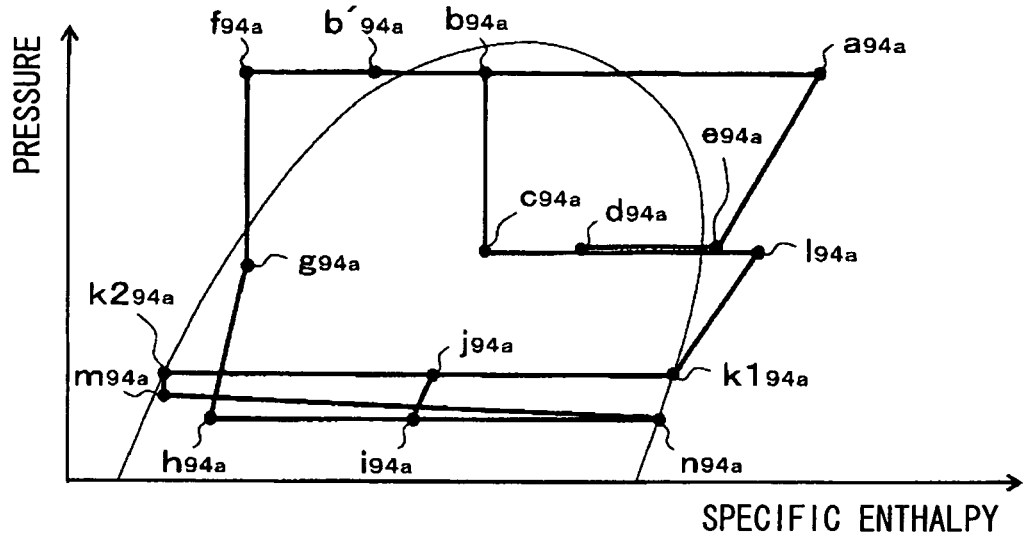
FIG. 94A is a Mollier diagram showing a refrigerant state in a general operation mode according to the 59th embodiment.
Figure 94B:
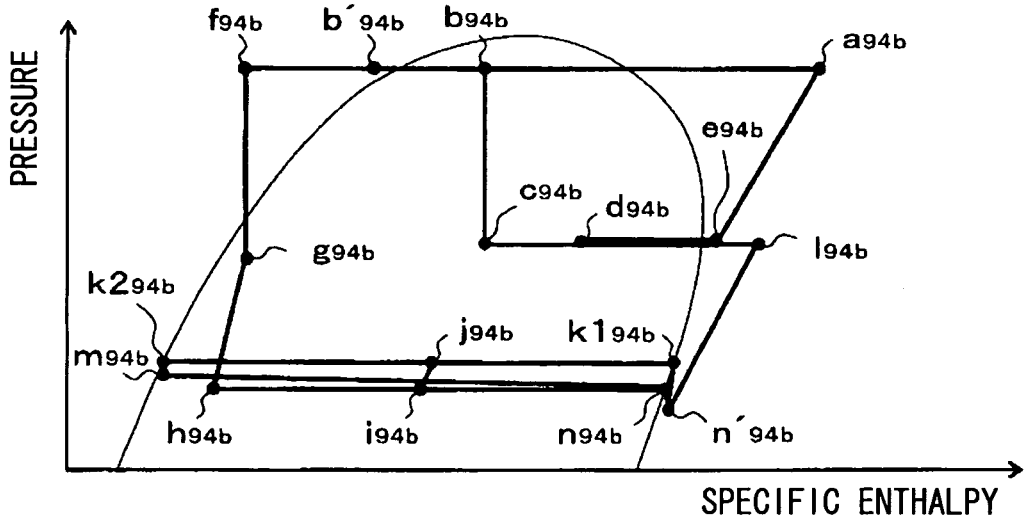
FIG. 94B is a Mollier diagram showing a refrigerant state in an oil returning operation mode according to the 59th embodiment.

In 59th embodiment, as in the entire schematic diagram of FIG. 93, the arrangement of the join portion 16 is changed similarly to the 54th embodiment, with respect to the ejector-type refrigerant cycle device 200 of the 6th embodiment. Thus, as in the Mollier diagrams of FIGS. 94A, 94B, the present embodiment is operated substantially similarly to the 6th embodiment, and the same effects as in the 6th embodiment can be obtained.

Figure 95:
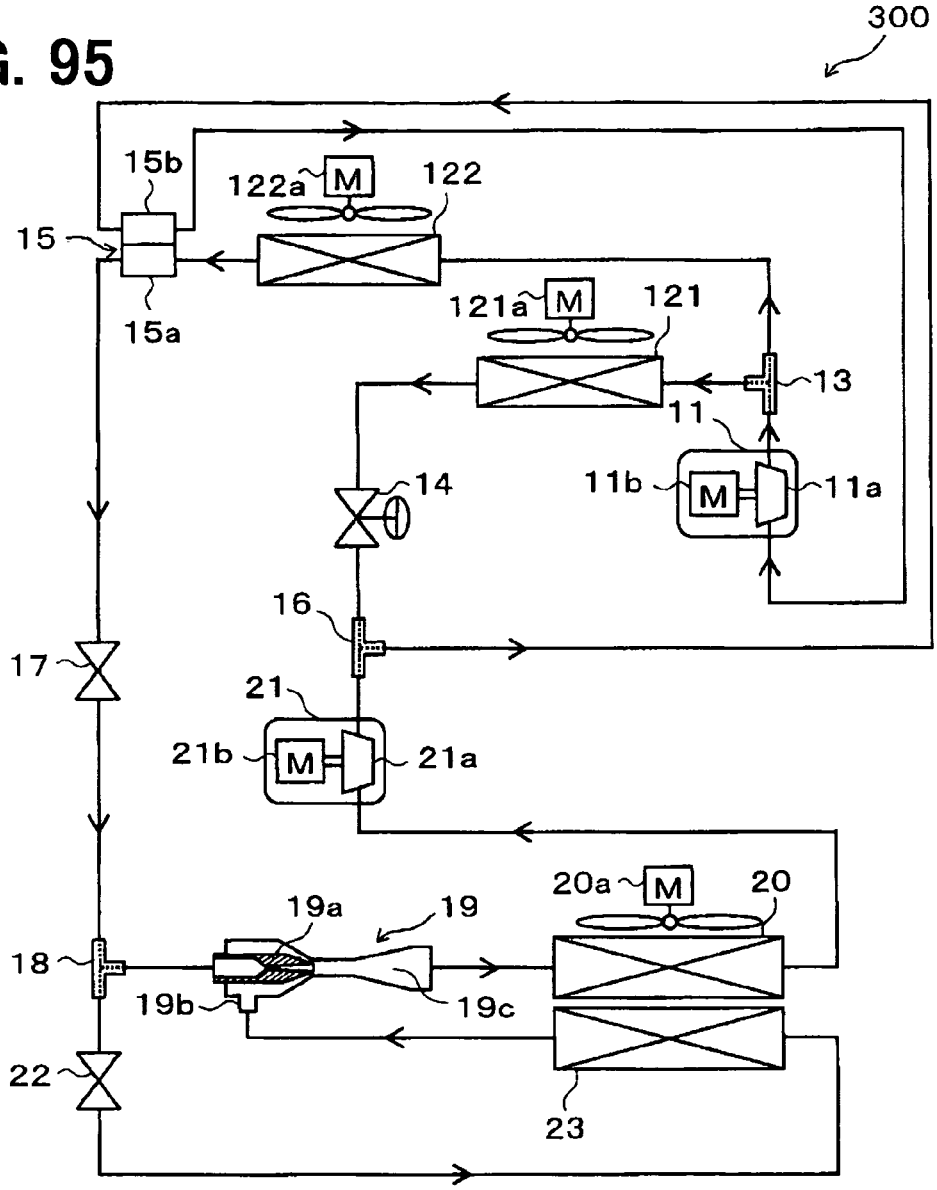
FIG. 95 is an entire schematic diagram of an ejector-type refrigerant cycle device according to a 60th embodiment of the invention.
Figure 96:
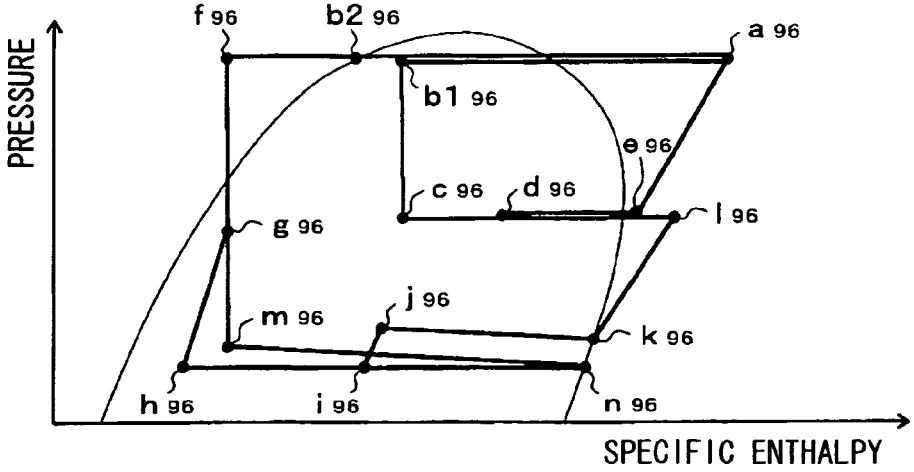
FIG. 96 is a Mollier diagram showing a refrigerant state in the ejector-type refrigerant cycle device according to the 60th embodiment.

In 60th embodiment, as in the entire schematic diagram of FIG. 95, the arrangement of the join portion 16 is changed similarly to the 54th embodiment, with respect to the ejector-type refrigerant cycle device 300 of the 7th embodiment. Thus, as in the Mollier diagram of FIG. 96, the present embodiment is operated substantially similarly to the 7th embodiment, and the same effects of the 7th embodiment can be obtained.

Figure 97:
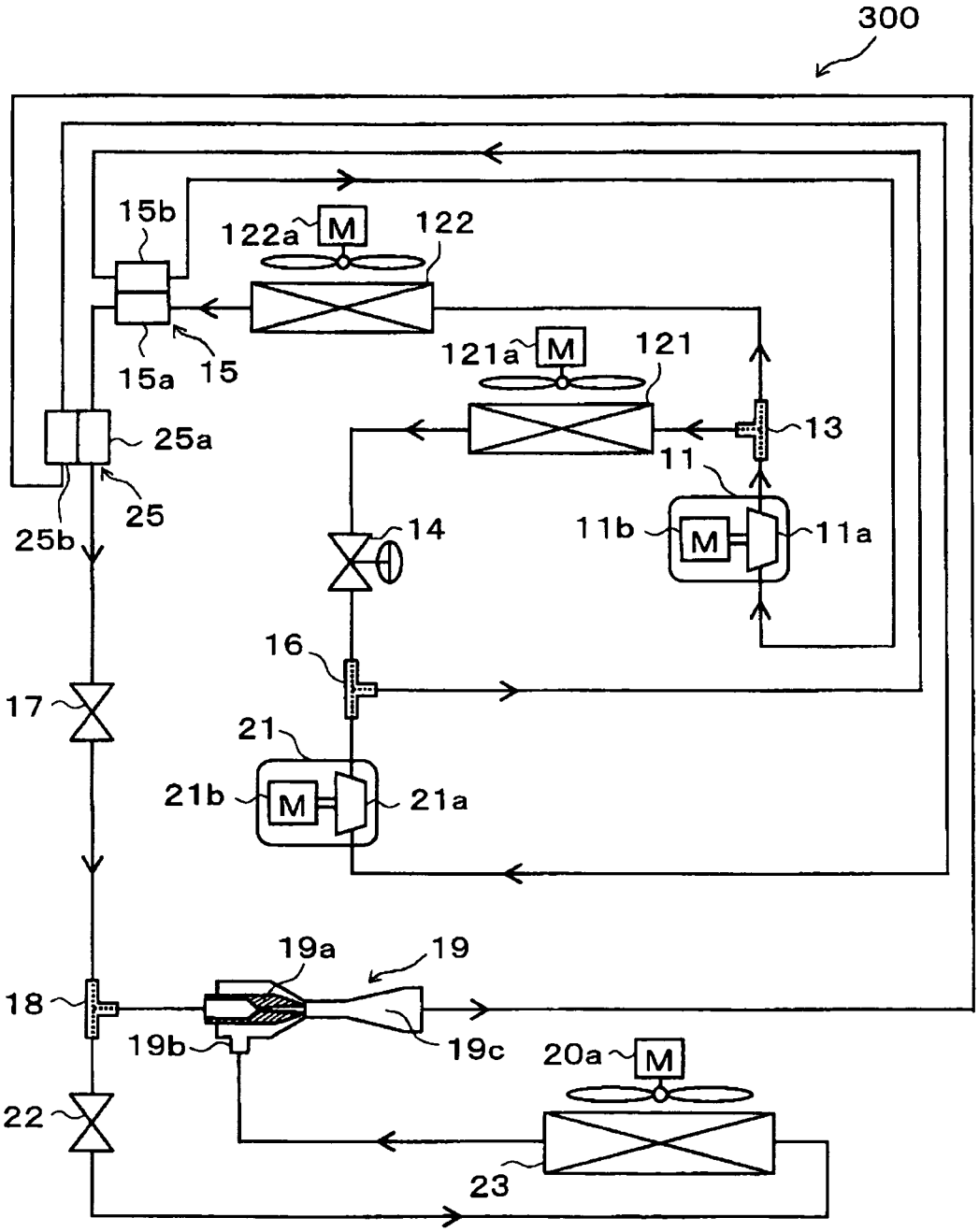
FIG. 97 is an entire schematic diagram of an ejector-type refrigerant cycle device according to a 61st embodiment of the invention.
Figure 98:
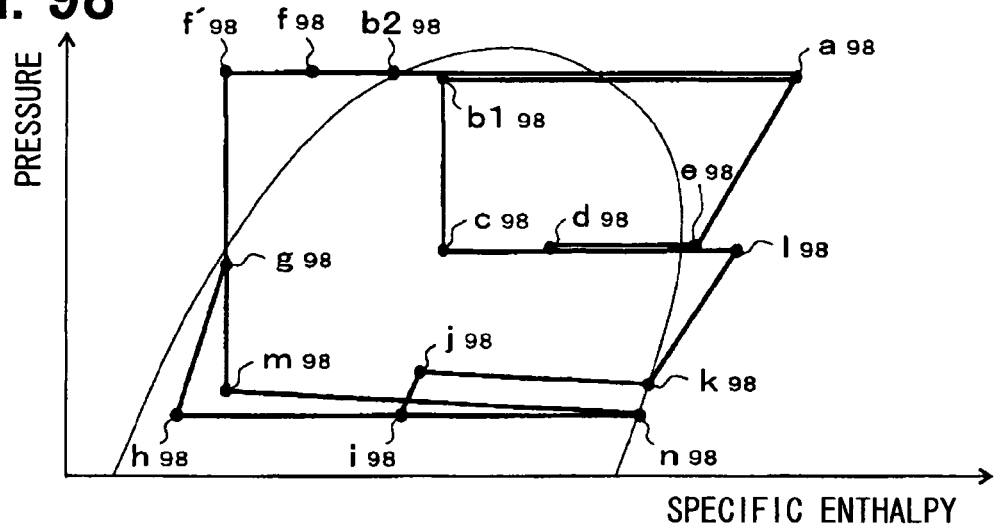
FIG. 98 is a Mollier diagram showing a refrigerant state in the ejector-type refrigerant cycle device according to the 61st embodiment.

In 61st embodiment, as in the entire schematic diagram of FIG. 97, the arrangement of the join portion 16 is changed similarly to the 54th embodiment, with respect to the ejector-type refrigerant cycle device 300 of the 8th embodiment. Thus, as in the Mollier diagram of FIG. 98, the present embodiment is operated substantially similarly to the 8th embodiment, and the same effects of the 8th embodiment can be obtained.

(62nd to 67th Embodiments)

Figure 99:
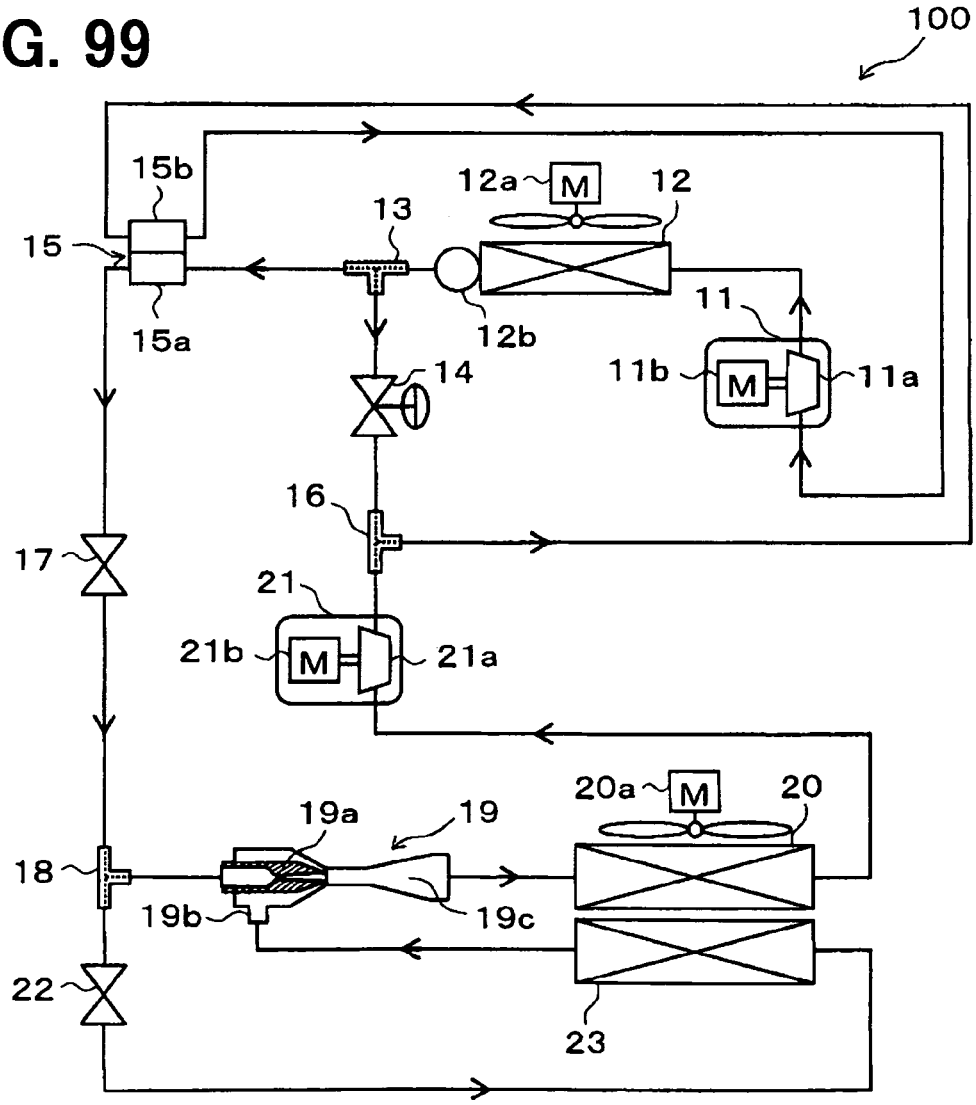
FIG. 99 is an entire schematic diagram of an ejector-type refrigerant cycle device according to a 62nd embodiment of the invention.

In 62nd embodiment; as in the entire schematic diagram of FIG. 99, a liquid receiver 12*b* as a high-pressure side gas-liquid separator is provided at the refrigerant outlet side of the radiator 12, with respect to the ejector-type refrigerant cycle device 100 of the 54th embodiment. The liquid receiver 12*b* is configured to introduce the separated saturation liquid refrigerant to the first branch portion 13 to the first branch portion 13. The present embodiment is operated substantially similarly to the 9th embodiment, and the same effects as in the 9th embodiment can be obtained.

Figure 100:
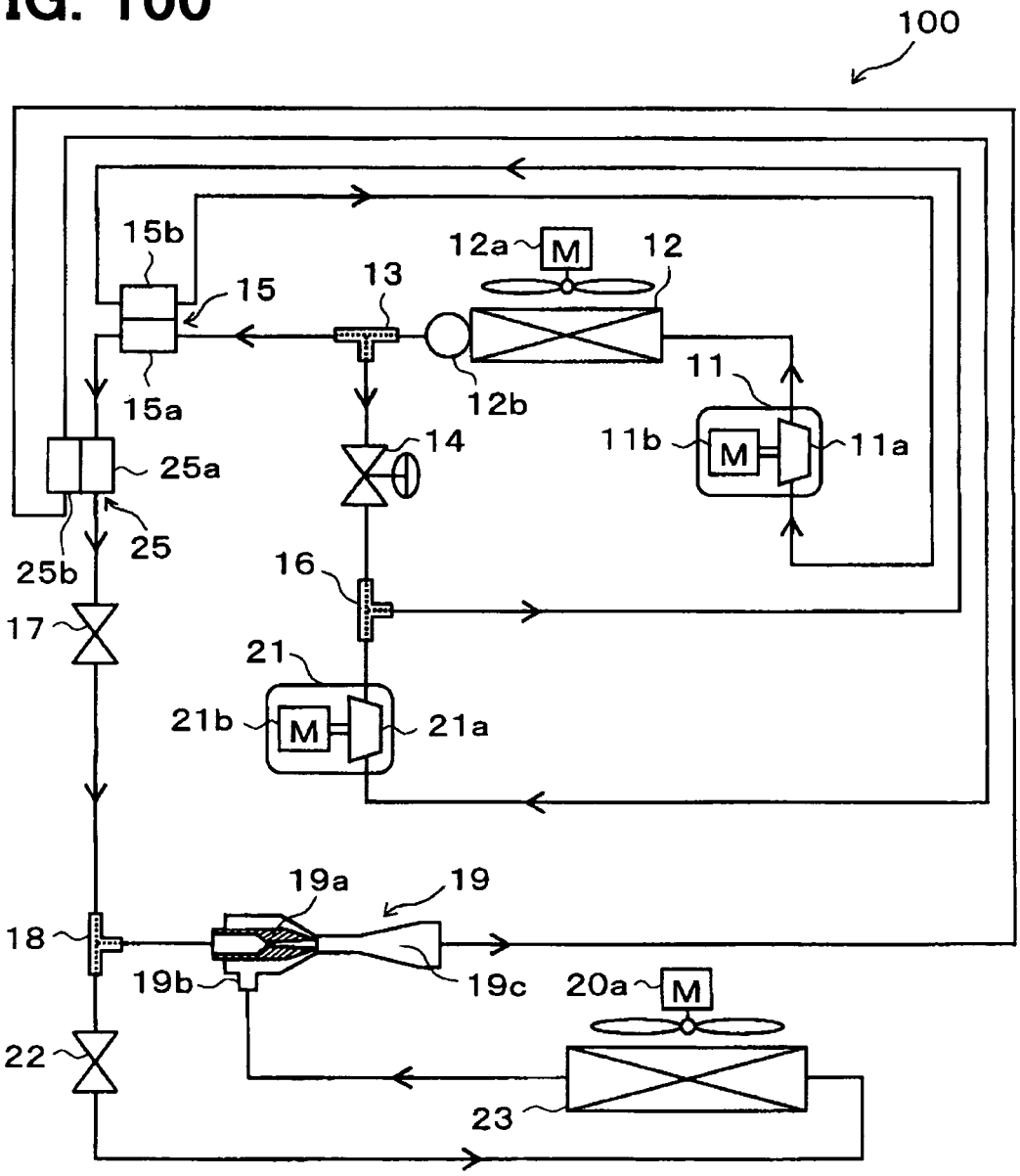
FIG. 100 is an entire schematic diagram of an ejector-type refrigerant cycle device according to a 63rd embodiment of the invention.

In 63rd embodiment, as in the entire schematic diagram of FIG. 100, a liquid receiver 12*b* as a high-pressure side gas-liquid separator is provided at the refrigerant outlet side of the radiator 12, with respect to the ejector-type refrigerant cycle device 100 of the 55th embodiment. The present embodiment is operated substantially similarly to the 10th embodiment, and the same effects as in the 10th embodiment can be obtained.

A liquid receiver 12*b* similar to the 62nd, 63rd embodiment may be provided, with respect to the ejector-type refrigerant cycle device 100 of the 55th, 56th embodiment, or the ejector-type refrigerant cycle device 200 of the 57th, 58th embodiment.

Figure 101:
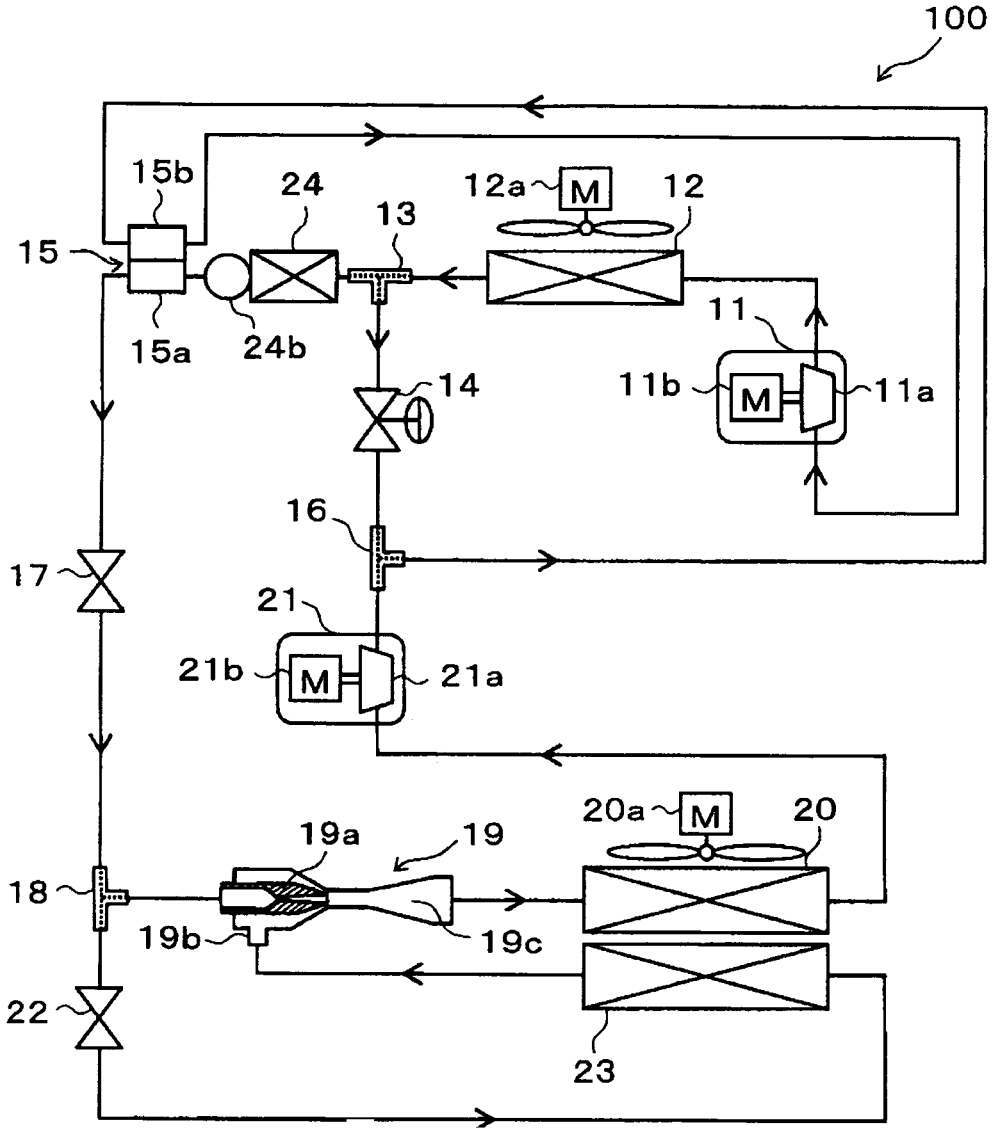
FIG. 101 is an entire schematic diagram of an ejector-type refrigerant cycle device according to a 64th embodiment of the invention.

In 64th embodiment, as in the entire schematic diagram of FIG. 101, a liquid receiver 24*b* as a high-pressure side gas-liquid separator is provided at the refrigerant outlet side of the auxiliary radiator 24, with respect to the ejector-type refrigerant cycle device 100 of the 56th embodiment. The present embodiment is operated substantially similarly to the 11th embodiment, and the same effects as in the 11th embodiment can be obtained.

Figure 102:
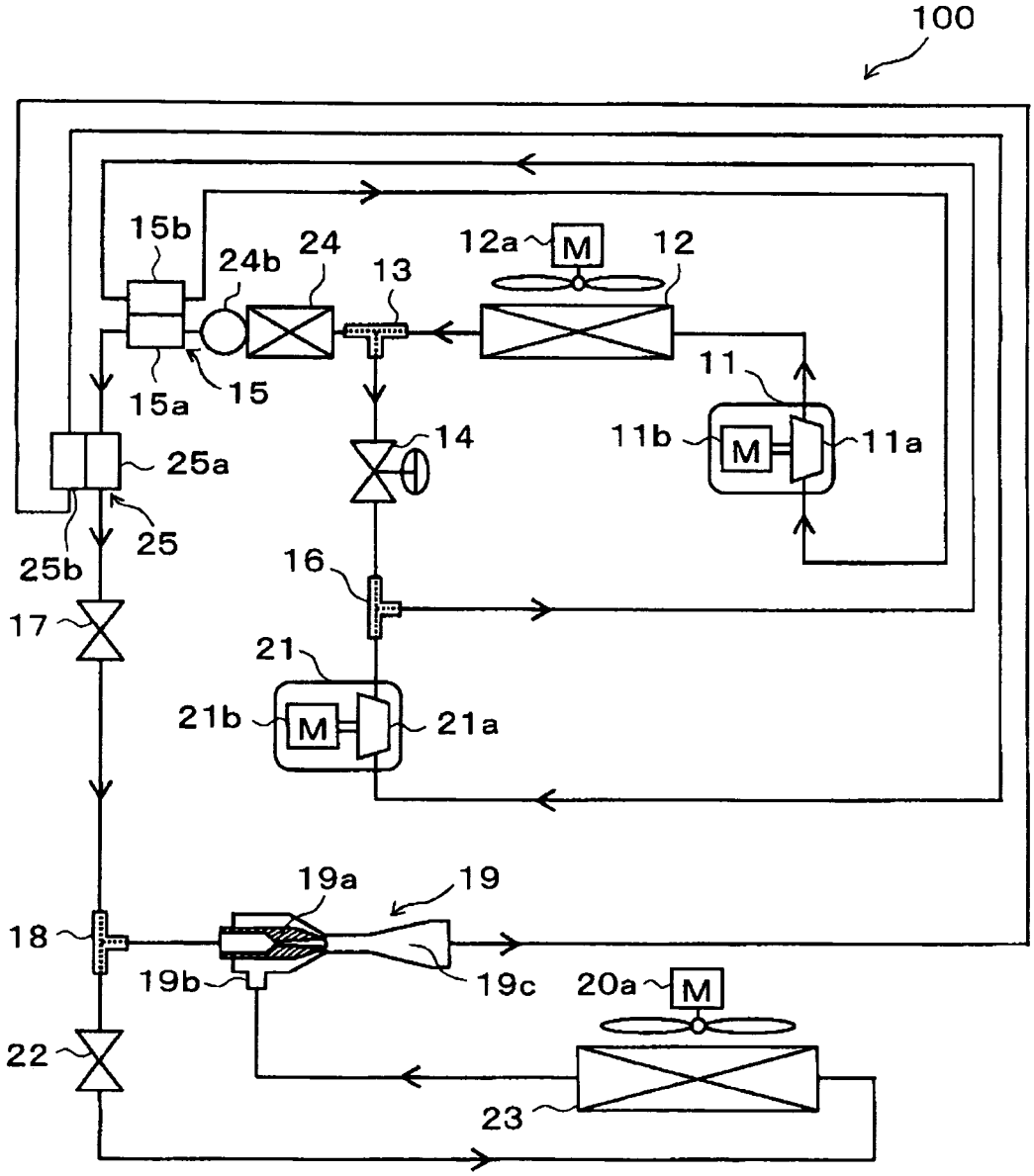
FIG. 102 is an entire schematic diagram of an ejector-type refrigerant cycle device according to a 65th embodiment of the invention.

In 65th embodiment, as in the entire schematic diagram of FIG. 102, a liquid receiver 24*b* as a high-pressure side gas-liquid separator is provided at the refrigerant outlet side of the auxiliary radiator 24, with respect to the ejector-type refrigerant cycle device 100 of the 57th embodiment. The present embodiment is operated substantially similarly to the 12th embodiment, and the same effects as in the 12th embodiment can be obtained.

Figure 103:
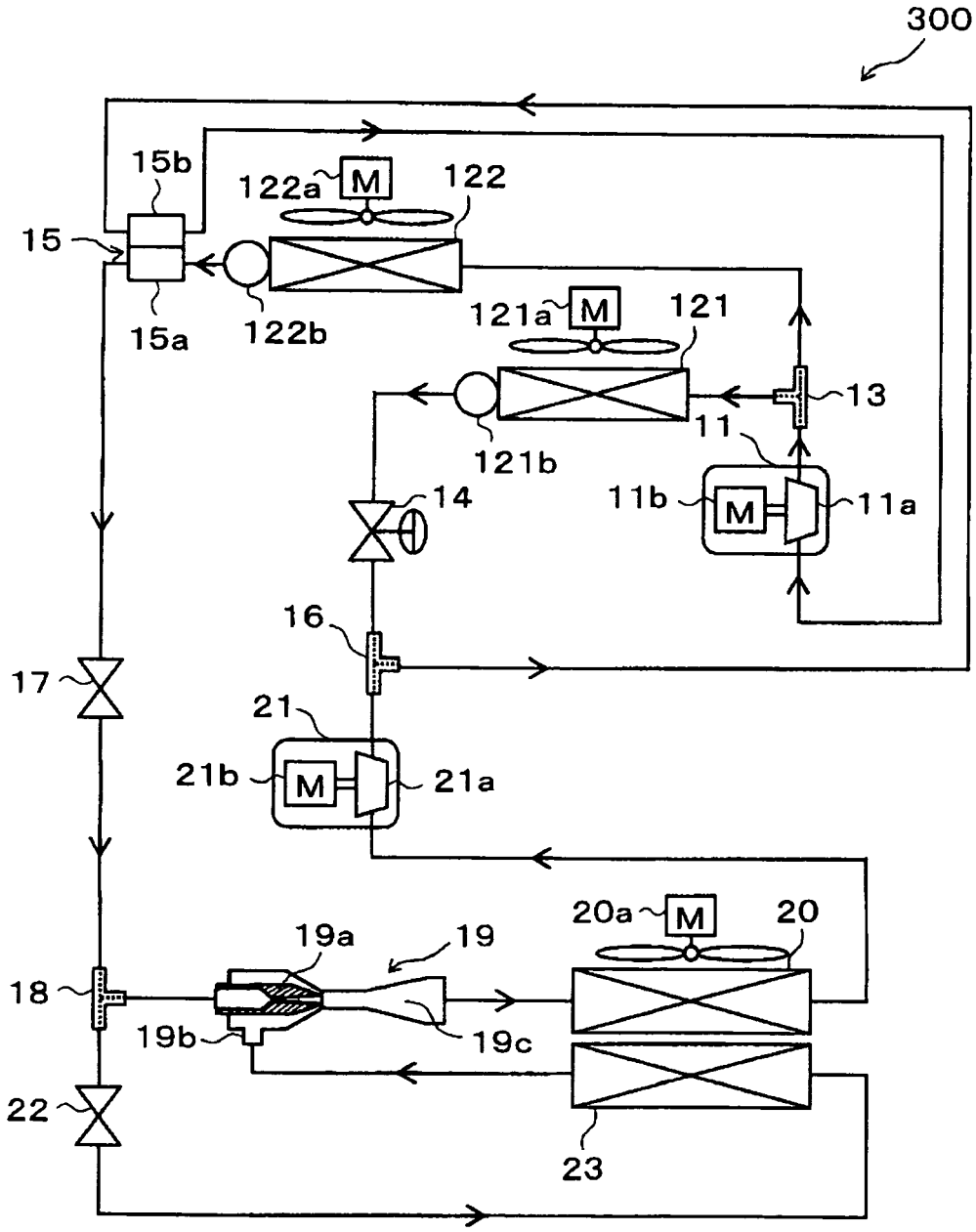
FIG. 103 is an entire schematic diagram of an ejector-type refrigerant cycle device according to a 66th embodiment of the invention.

In 66th embodiment, as in the entire schematic diagram of FIG. 103, first and second liquid receivers 121*b*, 122*b* as high-pressure side gas-liquid separators are provided respectively at the refrigerant outlet sides of the first and second radiators 121, 122, with respect to the ejector-type refrigerant cycle device 300 of the 60th embodiment. The present embodiment is operated substantially similarly to the 13th embodiment, and the same effects as in the 13th embodiment can be obtained.

Figure 104:
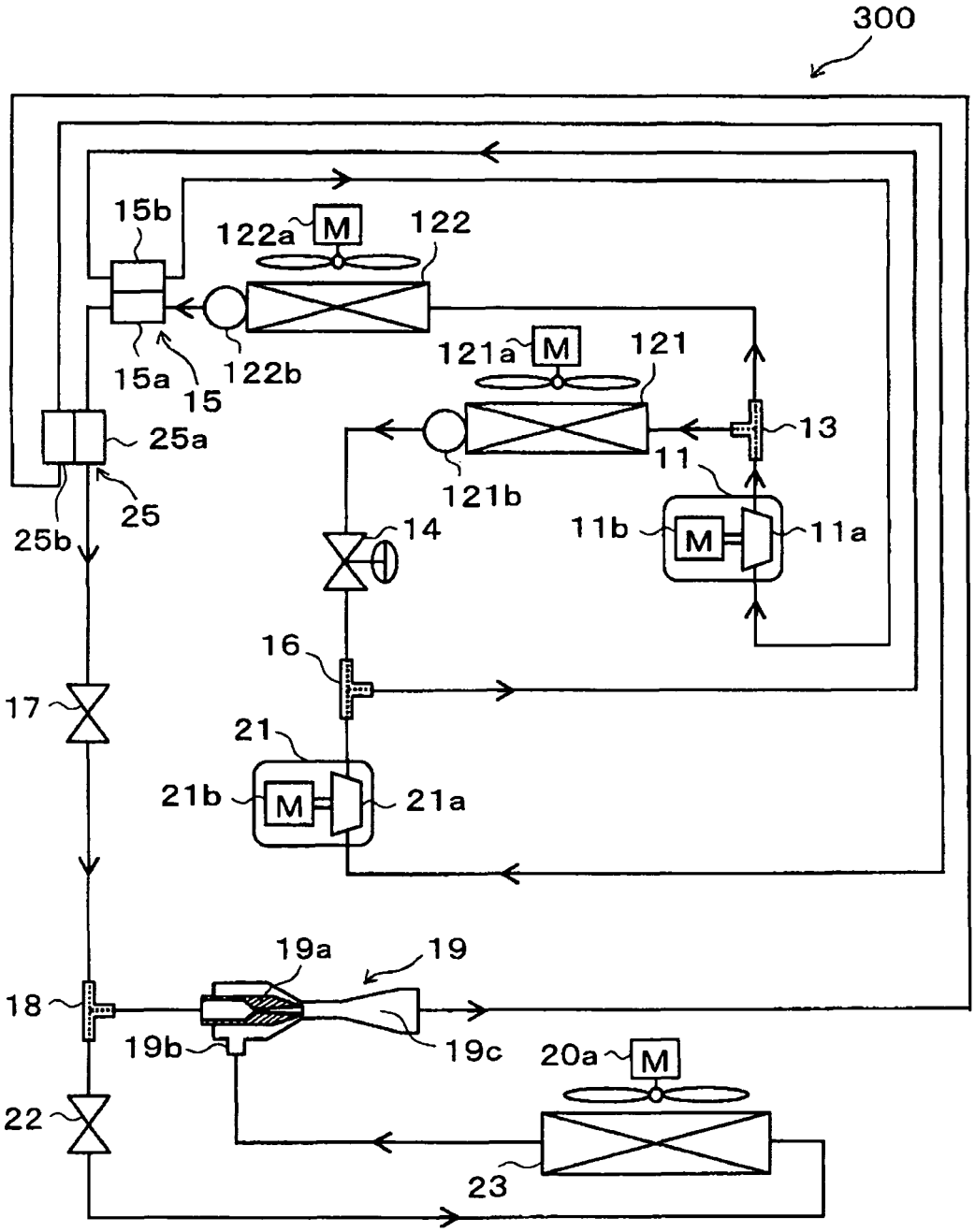
FIG. 104 is an entire schematic diagram of an ejector-type refrigerant cycle device according to a 67th embodiment of the invention.

In 67th embodiment, as in the entire schematic diagram of FIG. 104, first and second liquid receivers 121*b*, 122*b* as first and second high-pressure side gas-liquid separators are provided respectively at the refrigerant outlet sides of the first and second radiators 121, 122, with respect to the ejector-type refrigerant cycle device 300 of the 61st embodiment.

The present embodiment is operated substantially similarly to the 14th embodiment, and the same effects as in the 14th embodiment can be obtained. In the 66th, 67th embodiment, both the first and second receivers 121*b*, 122*b* are provided; however, any one of the first and second receivers 121*b*, 122*b* may be provided.

(68th-73rd Embodiments)

Figure 105:
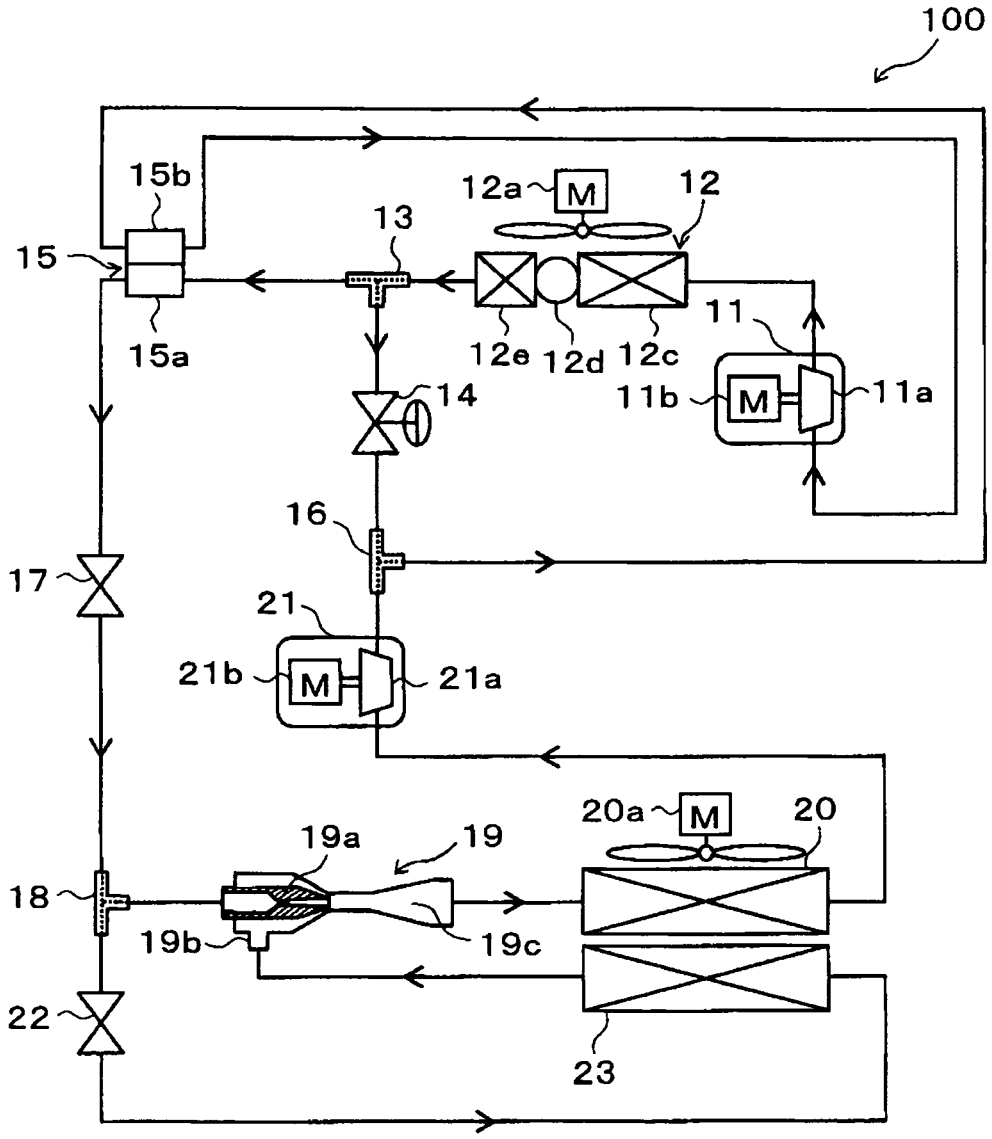
FIG. 105 is an entire schematic diagram of an ejector-type refrigerant cycle device according to a 68th embodiment of the invention.

In 68th embodiment, as in the entire schematic diagram of FIG. 105, the structure of the radiator 12 is configured as a sub-cool type condenser similarly to the 15th embodiment, with respect to the ejector-type refrigerant cycle device 100 of the 54th embodiment. The other configurations of the present embodiment are similar to the 54th embodiment. Thus, the present embodiment is operated substantially similarly to the 15th embodiment, and the same effects as in the 15th embodiment can be obtained.

Figure 106:
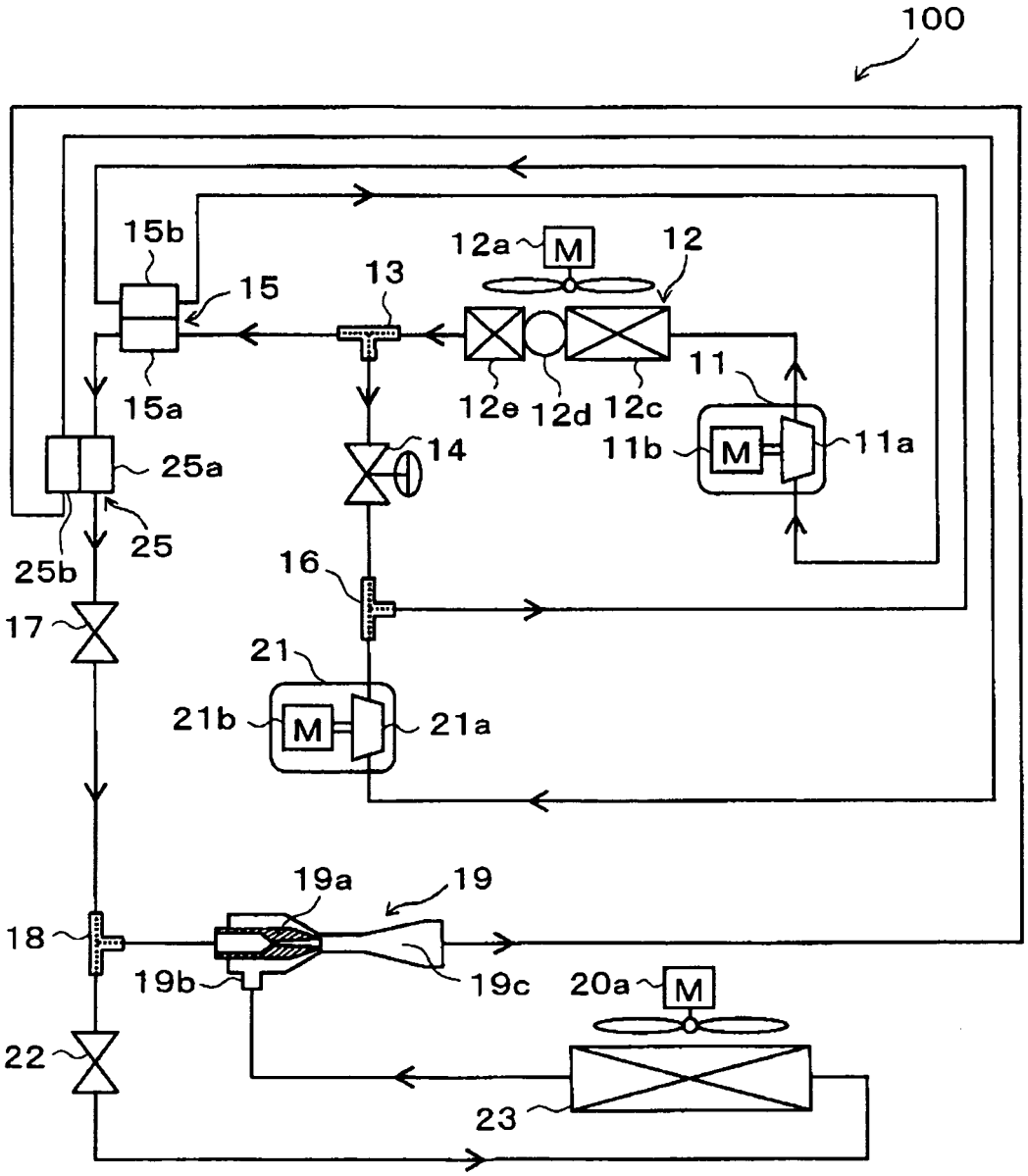
FIG. 106 is an entire schematic diagram of an ejector-type refrigerant cycle device according to a 69th embodiment of the invention.

In 69th embodiment, as in the entire schematic diagram of FIG. 106, the structure of the radiator 12 is configured as a sub-cool type condenser similarly to the 15th embodiment, with respect to the ejector-type refrigerant cycle device 100 of the 55th embodiment. The other configurations of the present embodiment are similar to the 55th embodiment. Thus, the present embodiment is operated substantially similarly to the 16th embodiment, and the same effects as in the 16th embodiment can be obtained.

Figure 107:
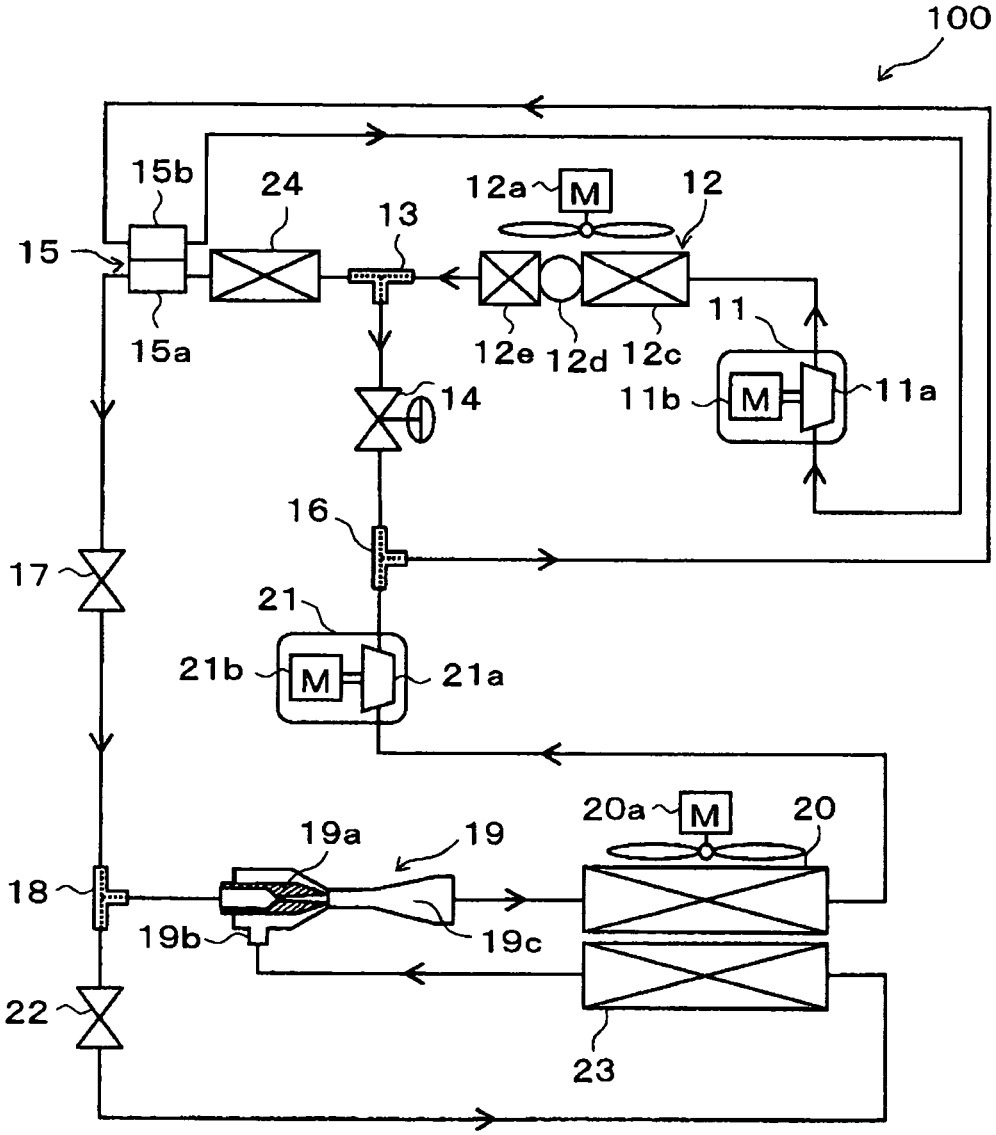
FIG. 107 is an entire schematic diagram of an ejector-type refrigerant cycle device according to a 70th embodiment of the invention.

In 70th embodiment, as in the entire schematic diagram of FIG. 107, the structure of the radiator 12 is configured as a sub-cool type condenser similarly to the 15th embodiment, with respect to the ejector-type refrigerant cycle device 100 of the 56th embodiment. The other configurations of the present embodiment are similar to the 56th embodiment. Thus, the present embodiment is operated, substantially similarly to the 17th embodiment, and the same effects as in the 17th embodiment can be obtained.

Figure 108:
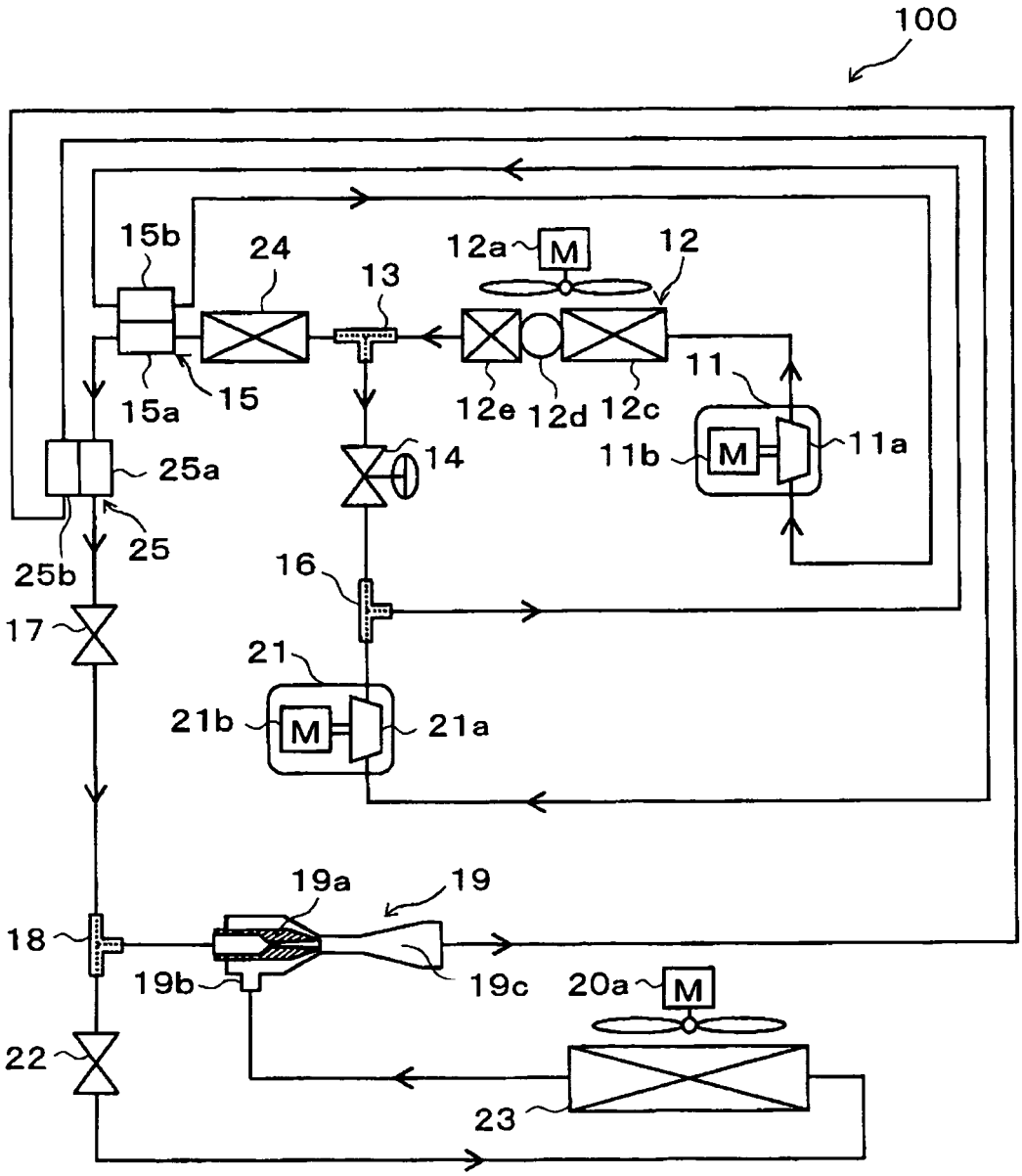
FIG. 108 is an entire schematic diagram of an ejector-type refrigerant cycle device according to a 71st embodiment of the invention.

In 71st embodiment, as in the entire schematic diagram of FIG. 108, the structure of the radiator 12 is configured as a sub-cool type condenser similarly to the 15th embodiment, with respect to the ejector-type refrigerant cycle device 100 of the 57th embodiment. The other configurations of the present embodiment are similar to the 57th embodiment. Thus, the present embodiment is operated substantially similarly to the 18th embodiment, and the same effects as in the 18th embodiment can be obtained.

With respect to the ejector-type refrigerant cycle device 200 of the 58th, 59th embodiment, a sub-cool type condenser may be used as the radiator 12.

Figure 109:
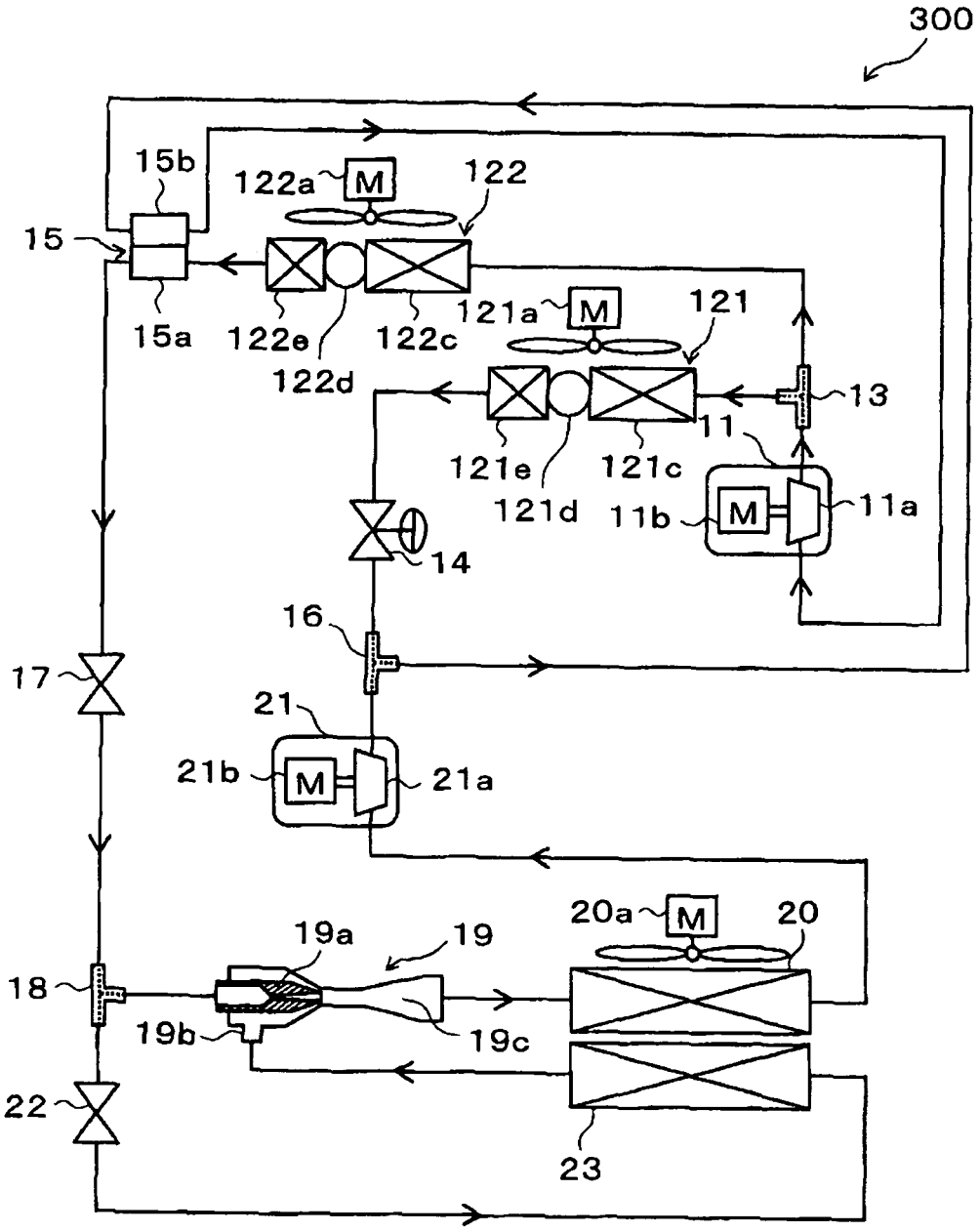
FIG. 109 is an entire schematic diagram of an ejector-type refrigerant cycle device according to a 72nd embodiment of the invention.

In 72nd embodiment, as in the entire schematic diagram of FIG. 109, the structure of each of the first and second radiators 121, 122 is configured as a sub-cool type condenser similarly to the 19th embodiment, with respect to the ejector-type refrigerant cycle device 300 of the 58th embodiment. The other configurations of the present embodiment are similar to the 60th embodiment. Thus, the present embodiment is operated substantially similarly to the 19th embodiment, and the same effects as in the 19th embodiment can be obtained.

Figure 110:
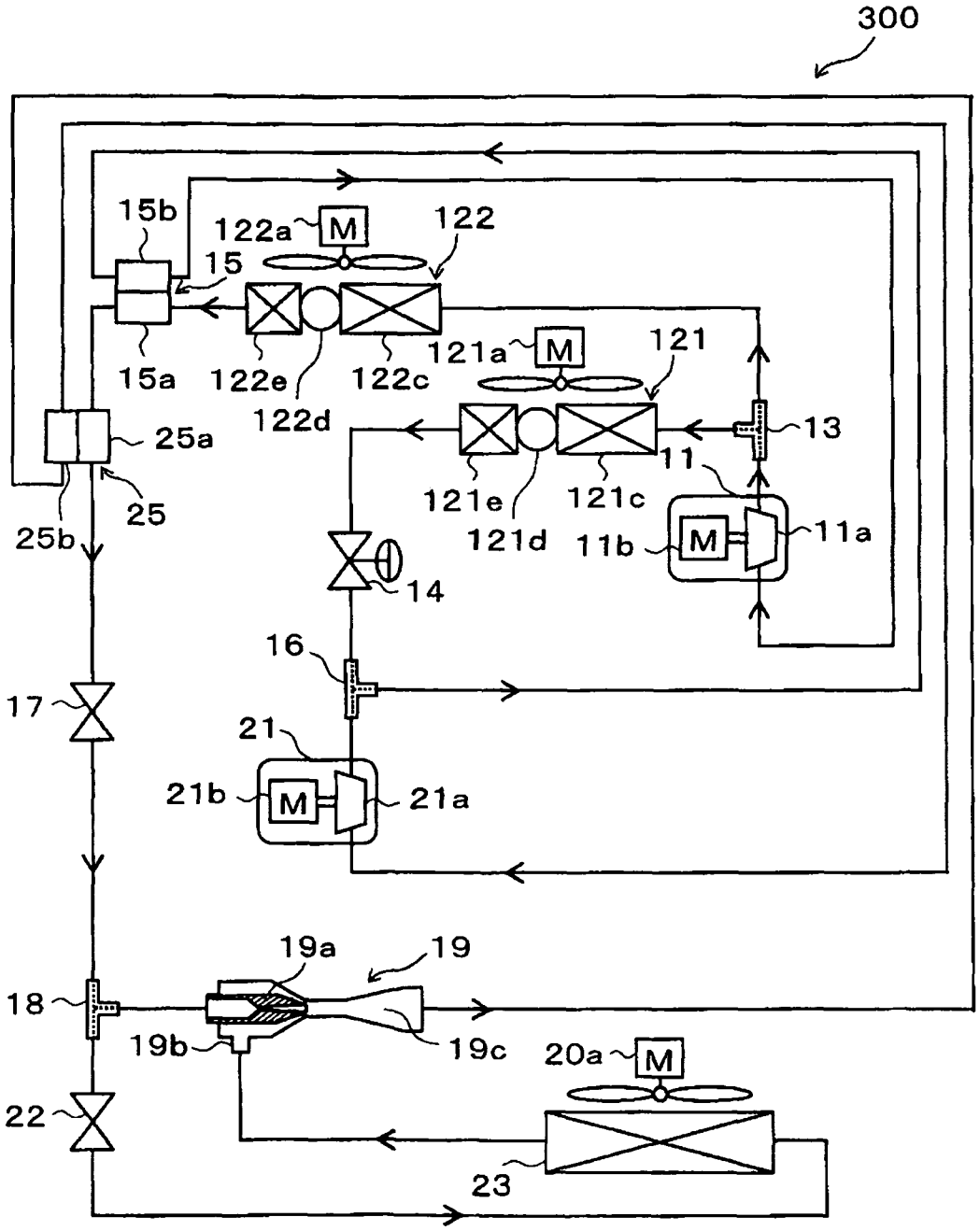
FIG. 110 is an entire schematic diagram of an ejector-type refrigerant cycle device according to a 73rd embodiment of the invention.

In 73rd embodiment, as in the entire schematic diagram of FIG. 110, the structure of each of the first and second radiators 121, 122 is configured as a sub-cool type condenser similarly to the 15th embodiment, with respect to the ejector-type refrigerant cycle device 300 of the 59th embodiment. The other configurations of the present embodiment are similar to the 61st embodiment. Thus, the present embodiment is operated substantially similarly to the 20th embodiment, and the same effects as in the 20th embodiment can be obtained.

In the 72nd and 73rd embodiments, both the first and second radiators 121, 122 are adapted as the sub-cool type condensers, respectively. In the 72nd or 73rd embodiment, any one of the first and second radiators 121, 122 may be adapted as the sub-cool type condenser.

( 74th-79th Embodiments)

Figure 111:
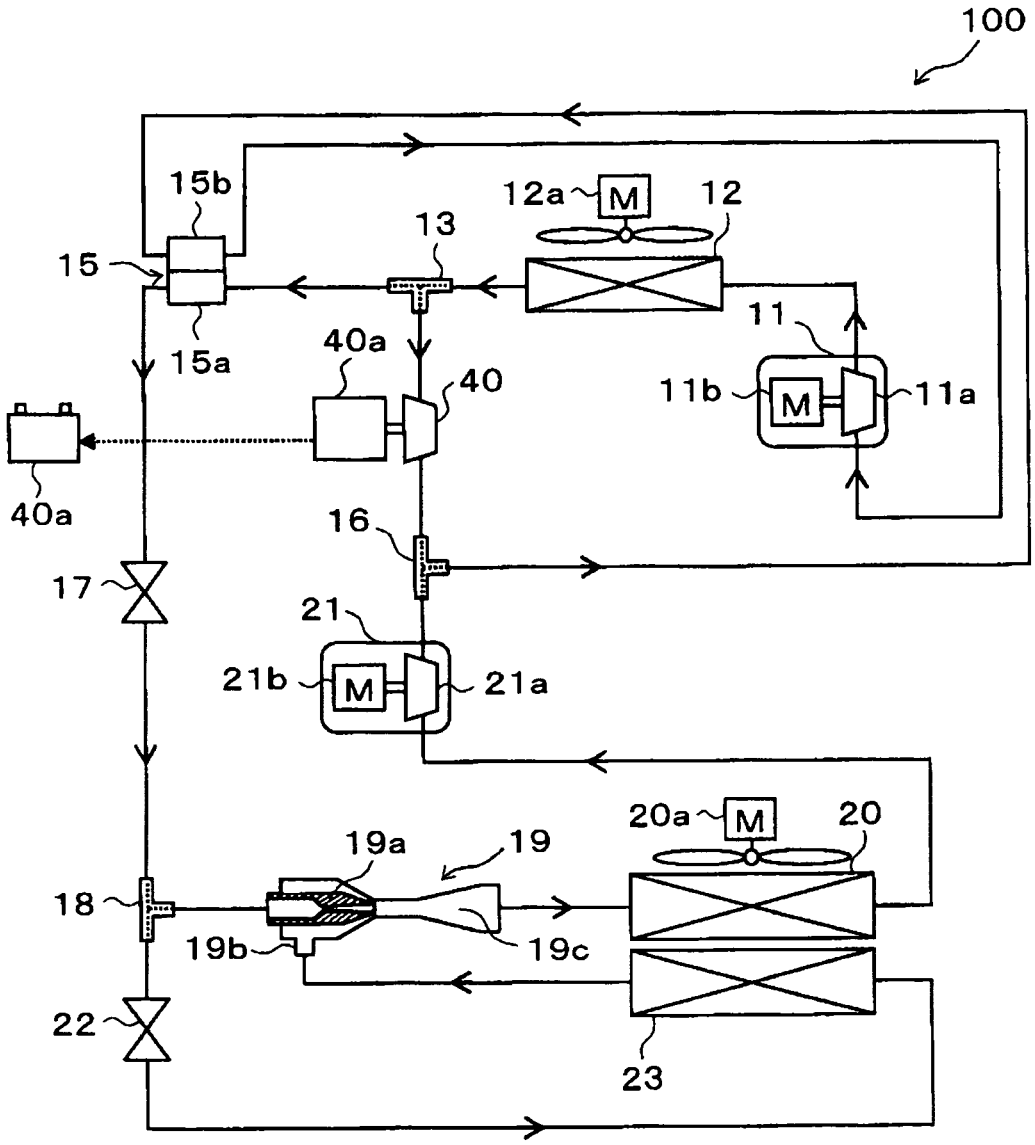
FIG. 111 is an entire schematic diagram of an ejector-type refrigerant cycle device according to a 74th embodiment of the invention.

In 74th embodiment, as in the entire schematic diagram of FIG. 111, with respect to the ejector-type refrigerant cycle device 100 of the 54th embodiment, the thermal expansion valve 14 is removed, and an expansion unit 40 similar to the 21st embodiment is provided, with respect to the ejector-type refrigerant cycle device 100 of the 54th embodiment. Thus, the present embodiment is operated substantially similarly to the 21st embodiment, and energy efficiency in the entire ejector-type refrigerant cycle device 100 can be obtained.

Figure 112:
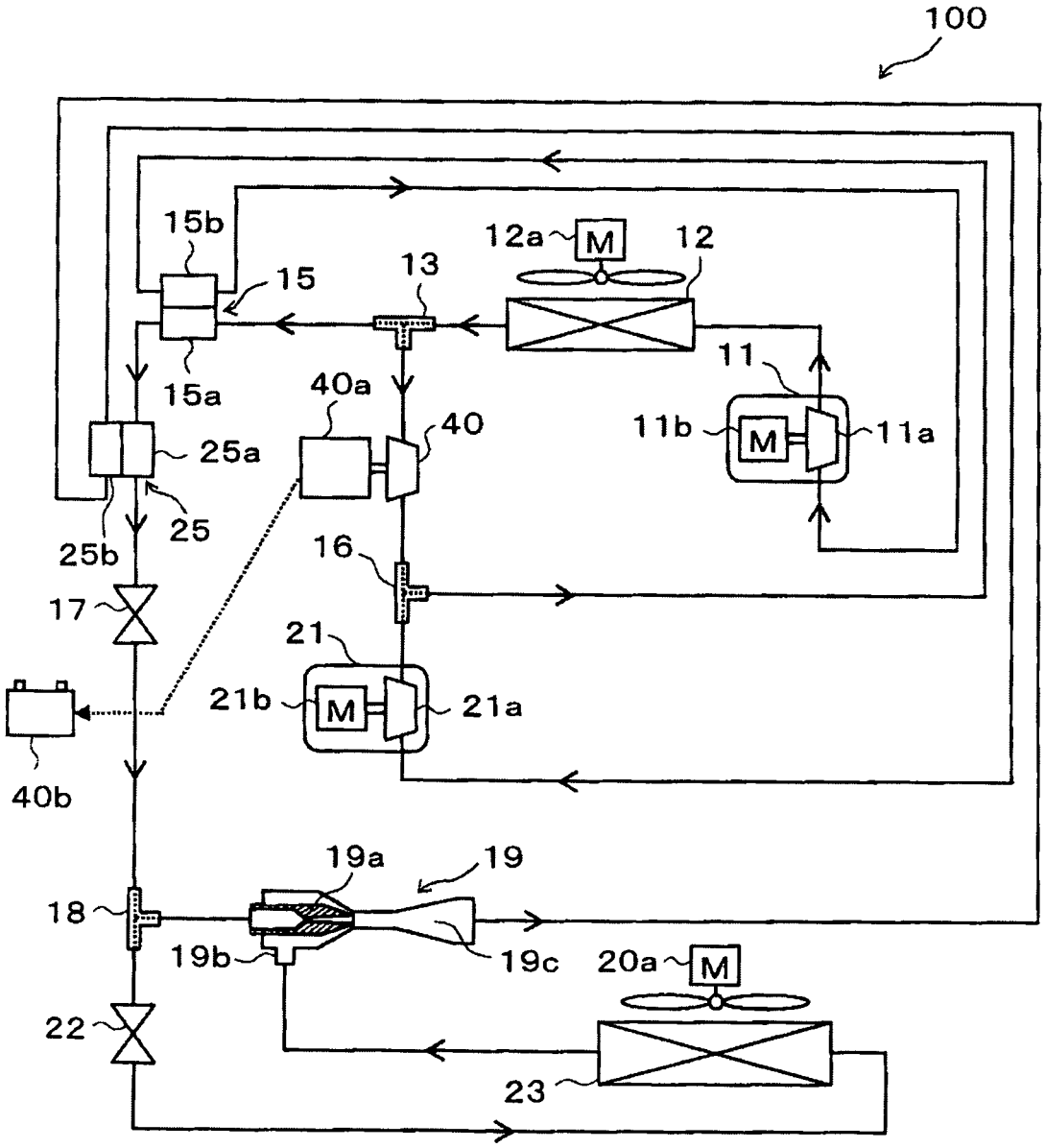
FIG. 112 is an entire schematic diagram of an ejector-type refrigerant cycle device according to a 75th embodiment of the invention.

In 75th embodiment, as in the entire schematic diagram of FIG. 112, with respect to the ejector-type refrigerant cycle device 100 of the 55th embodiment, the thermal expansion valve 14 is removed, and an expansion unit 40 similar to the 21st embodiment is provided, with respect to the ejector-type refrigerant cycle device 100 of the 55th embodiment. Thus, the present embodiment is operated substantially similarly to the 22nd embodiment, and energy efficiency in the entire ejector-type refrigerant cycle device 100 can be obtained.

Figure 113:
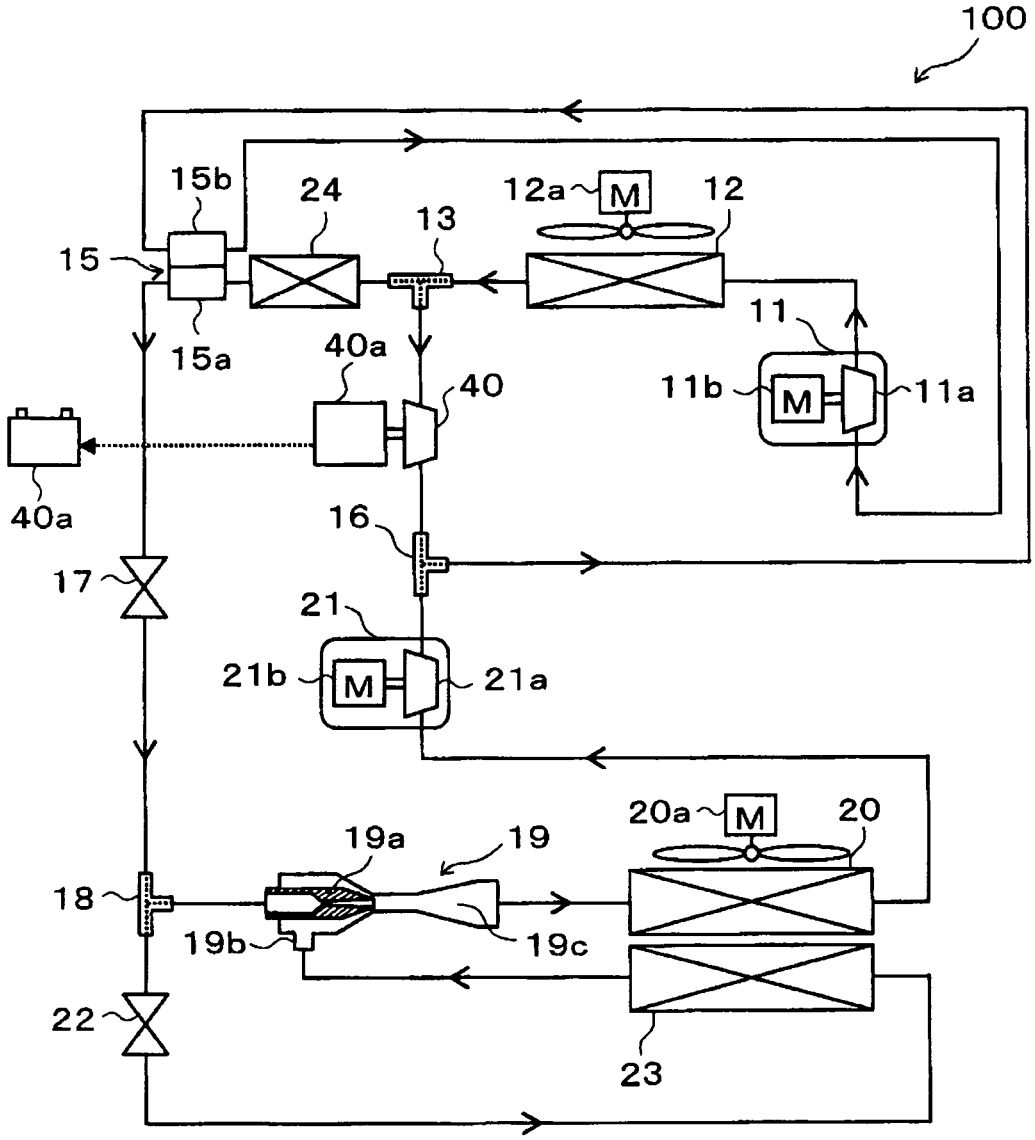
FIG. 113 is an entire schematic diagram of an ejector-type refrigerant cycle device according to a 76th embodiment of the invention.
Figure 114:
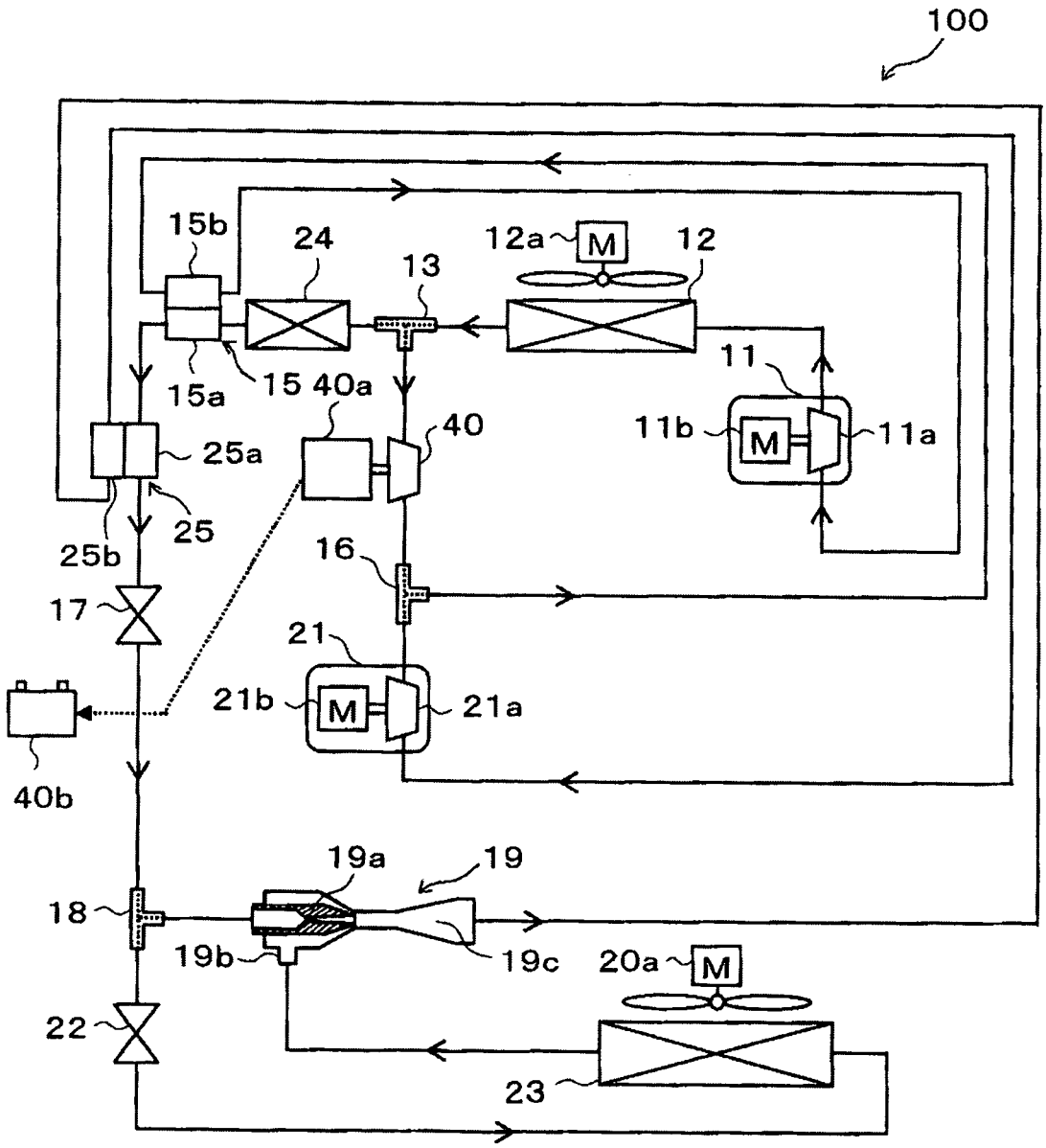
FIG. 114 is an entire schematic diagram of an ejector-type refrigerant cycle device according to a 77th embodiment of the invention.

In 76th embodiment, as in the entire schematic diagram of FIG. 113, with respect to the ejector-type refrigerant cycle device 100 of the 56th embodiment, the thermal expansion valve 14 is removed, and an expansion unit 40 similar to the 21st embodiment is provided, with respect to the ejector-type refrigerant cycle device 100 of the 56th embodiment. Thus, the present embodiment is operated substantially similarly to the 23rd embodiment, and energy efficiency in the entire ejector-type refrigerant cycle device 100 can be obtained.

In 77th embodiment, as in the entire schematic diagram of FIG. 111, with respect to the ejector-type refrigerant cycle device 100 of the 57th embodiment, the thermal expansion valve 14 is removed, and an expansion unit 40 similar to the 21st embodiment is provided, with respect to the ejector-type refrigerant cycle device 100 of the 57th embodiment. Thus, the present embodiment is operated substantially similarly to the 24th embodiment, and energy efficiency in the entire ejector-type refrigerant cycle device 100 can be obtained.

Figure 115:
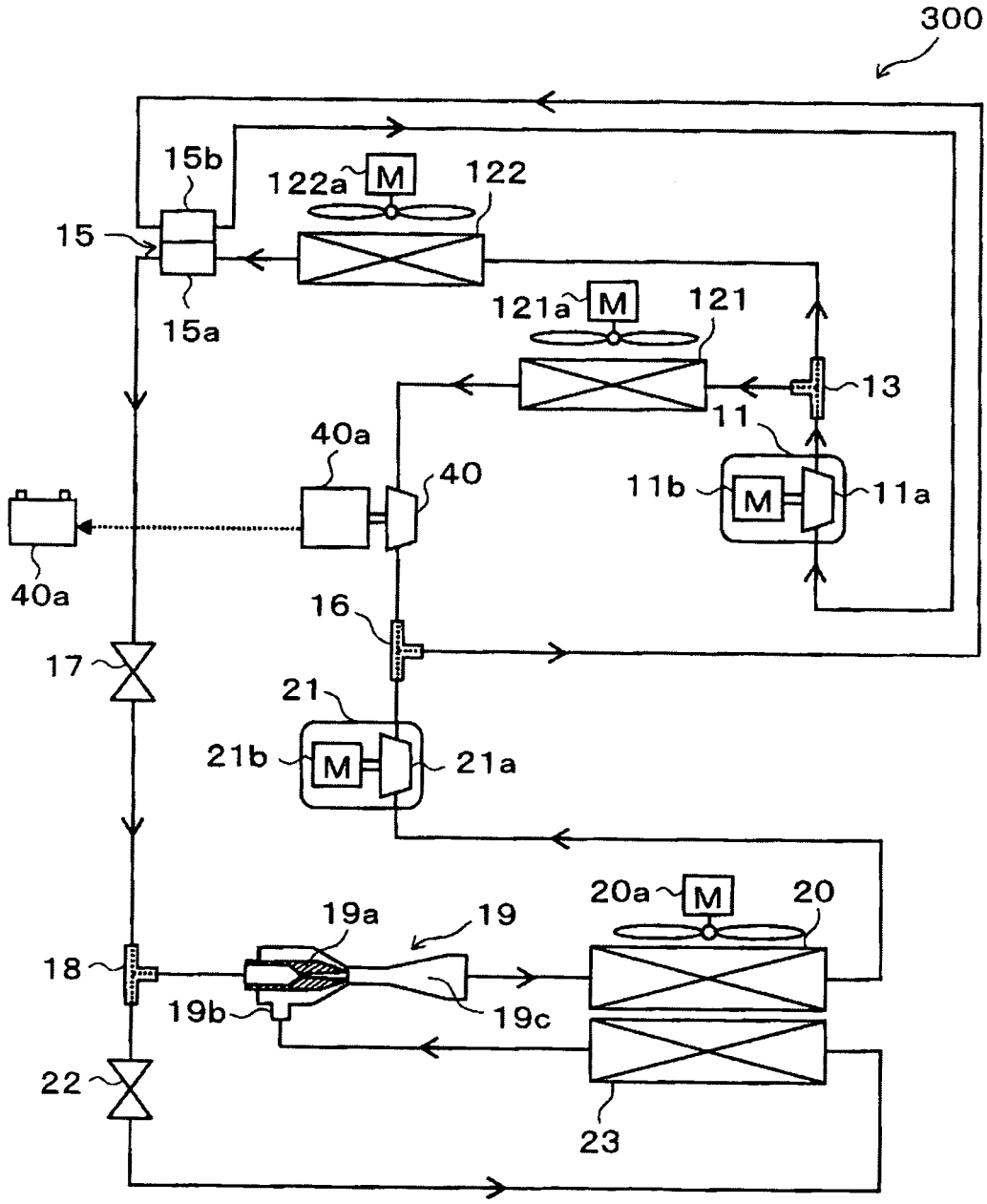
FIG. 115 is an entire schematic diagram of an ejector-type refrigerant cycle device according to a 78th embodiment of the invention.

In 78th embodiment, as in the entire schematic diagram of FIG. 115, with respect to the ejector-type refrigerant cycle device 300 of the 60th embodiment, the thermal expansion valve 14 is removed, and an expansion unit 40 similar to the 21st embodiment is provided, with respect to the ejector-type refrigerant cycle device 300 of the 60th embodiment. Thus, the present embodiment is operated substantially similarly to the 25th embodiment, and energy efficiency in the entire ejector-type refrigerant cycle device 100 can be obtained.

Figure 116:
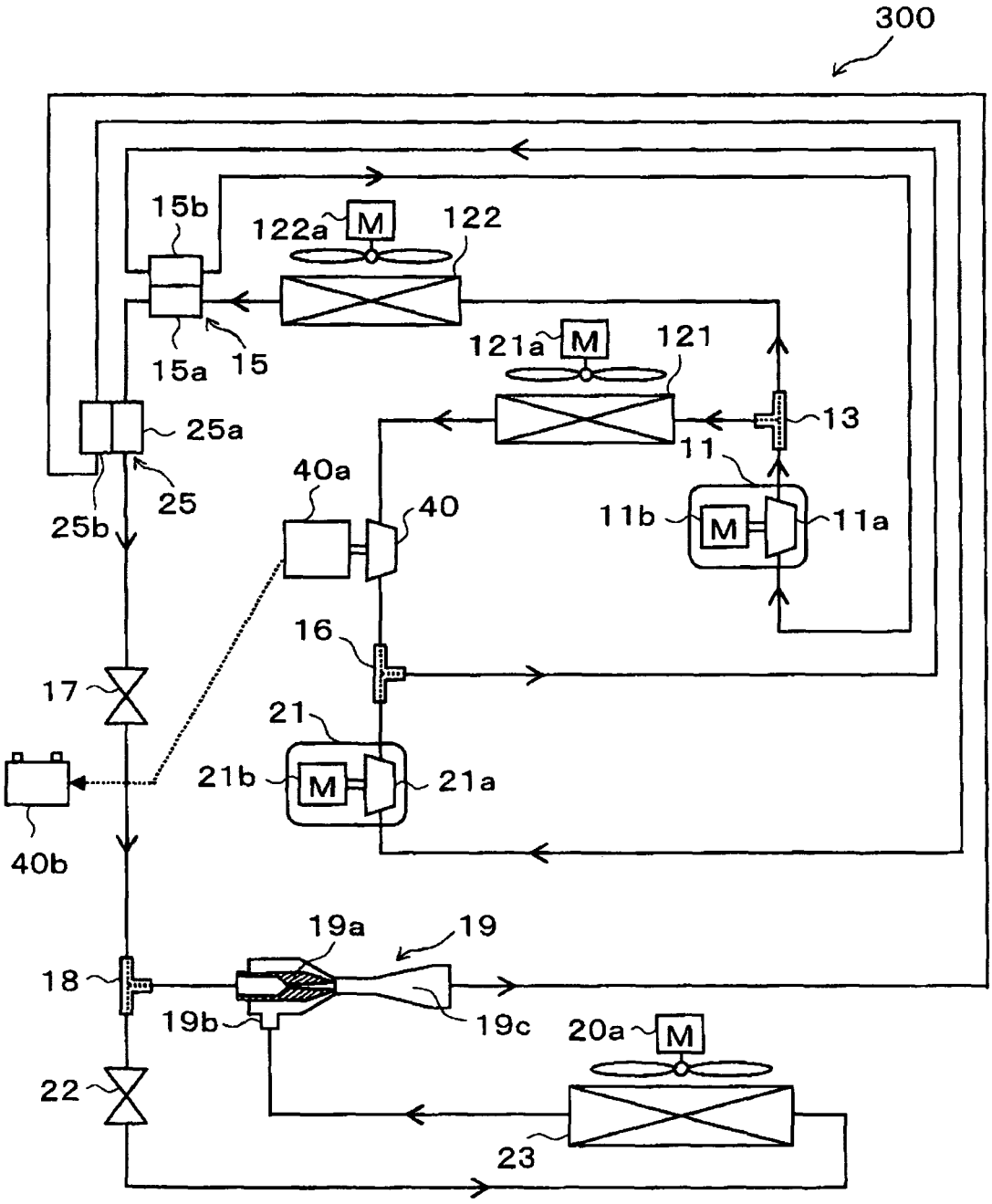
FIG. 116 is an entire schematic diagram of an ejector-type refrigerant cycle device according to a 79th embodiment of the invention.

In 79th embodiment, as in the entire schematic diagram of FIG. 116, with respect to the ejector-type refrigerant cycle device 300 of the 61st embodiment, the thermal expansion valve 14 is removed, and an expansion unit 40 similar to the 21st embodiment is provided, with respect to the ejector-type refrigerant cycle device 100 of the 61st embodiment. Thus, the present embodiment is operated substantially similarly to the 26th embodiment, and energy efficiency in the entire ejector-type refrigerant cycle device 100 can be obtained.

In 74th-79th embodiments, the expansion unit 40 is used as the high-pressure side decompression portion. However, in 74th-79th embodiments, the first fixed throttle 17 may be removed, and an expansion unit may be used as the pre-nozzle decompression portion. Alternatively, the second fixed throttle 22 may be removed, and an expansion unit may be used as the suction side decompression portion. Furthermore, in the ejector-type refrigerant cycle device 200 of the 58th, 59th embodiment, an expansion unit may be used as the thermal expansion valve 14, the first and second fixed throttles 17, 22.

(80th Embodiment)

In the above-described 54th-79th embodiments describe regarding an example in which general flon-based refrigerant is used as the refrigerant, so as to constitute a sub-critical refrigerant cycle in which the pressure of the refrigerant discharged from the compressor 11 becomes lower than the critical pressure of the refrigerant. However, the present embodiment describes regarding an example in which carbon dioxide is used as the refrigerant, so as to constitute a super-critical refrigerant cycle in which the pressure of the refrigerant discharged from the first compressor 11 becomes higher than the critical pressure of the refrigerant.

Figure 117:
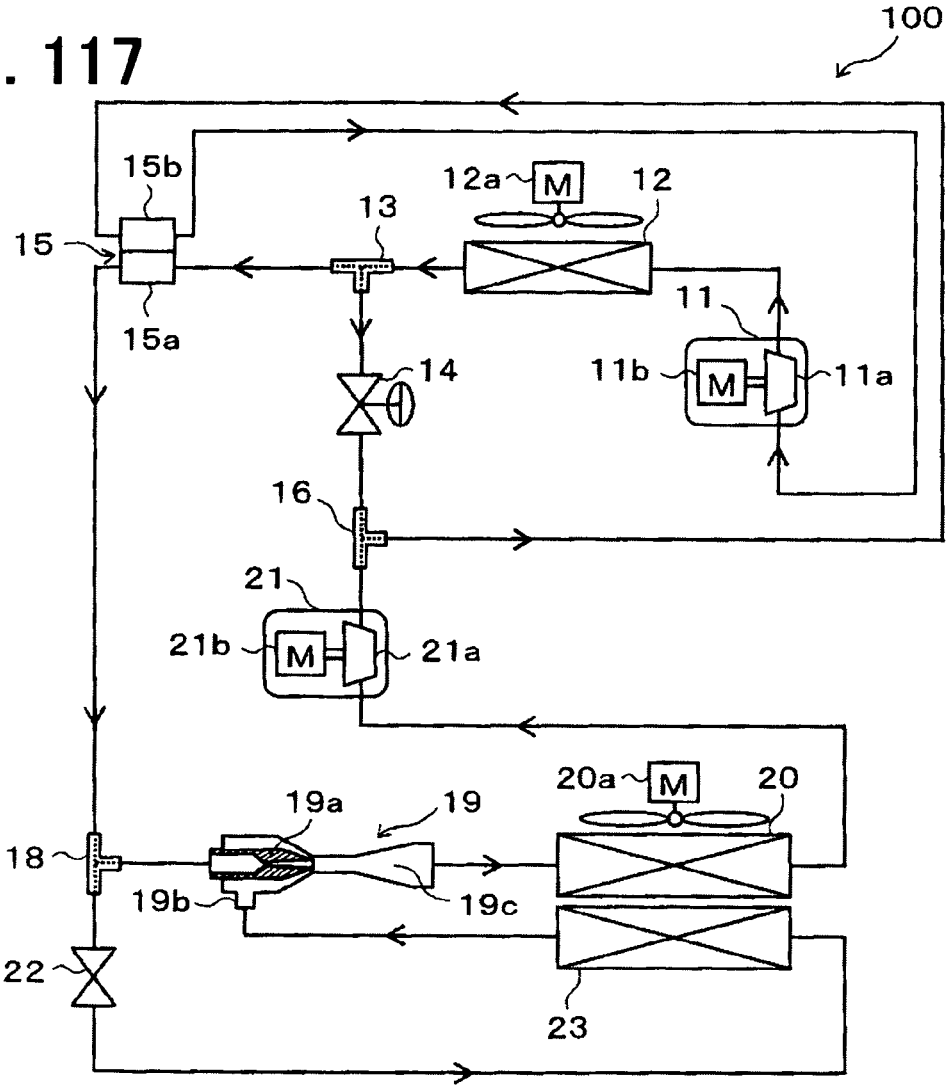
FIG. 117 is an entire schematic diagram of an ejector-type refrigerant cycle device according to an 80th embodiment of the invention.

In the present embodiment, as shown in the entire schematic diagram of FIG. 117, the first fixed throttle 17 that is the pre-nozzle decompression portion is omitted with respect to the 54th embodiment. The other configurations in the present embodiment are similar to those of the 54th embodiment.

Figure 118:
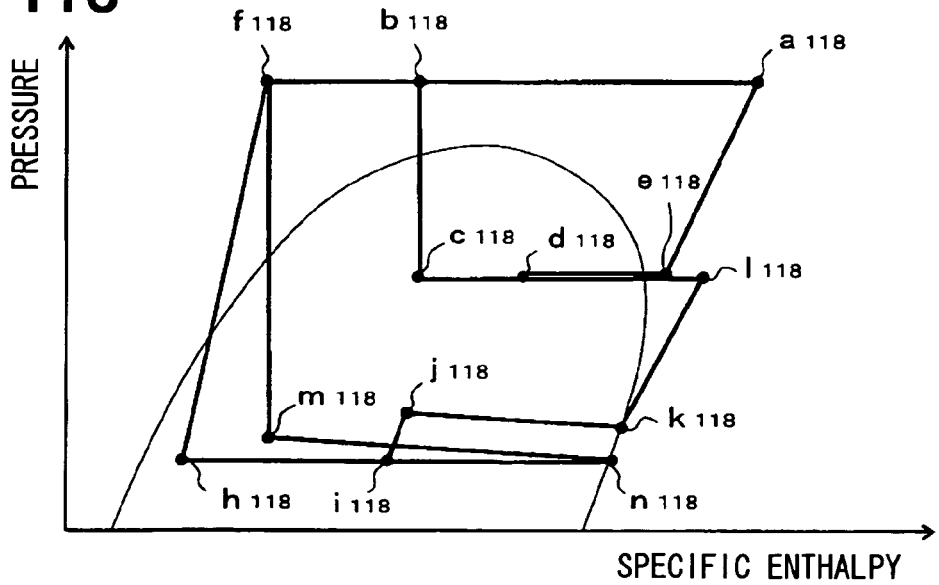
FIG. 118 is a Mollier diagram showing a refrigerant state in the ejector-type refrigerant cycle device according to the 80th embodiment.

According to the present embodiment, as in the Mollier diagram of FIG. 118, the COP can be improved by increasing the decompression amount (pressure difference between point $f_{118}$ and point $h_{118}$, in FIG. 118) in the nozzle portion 19*a* of the ejector 19, thereby obtaining the effects similar to the 33rd embodiment.

(81st Embodiment)

Figure 119:
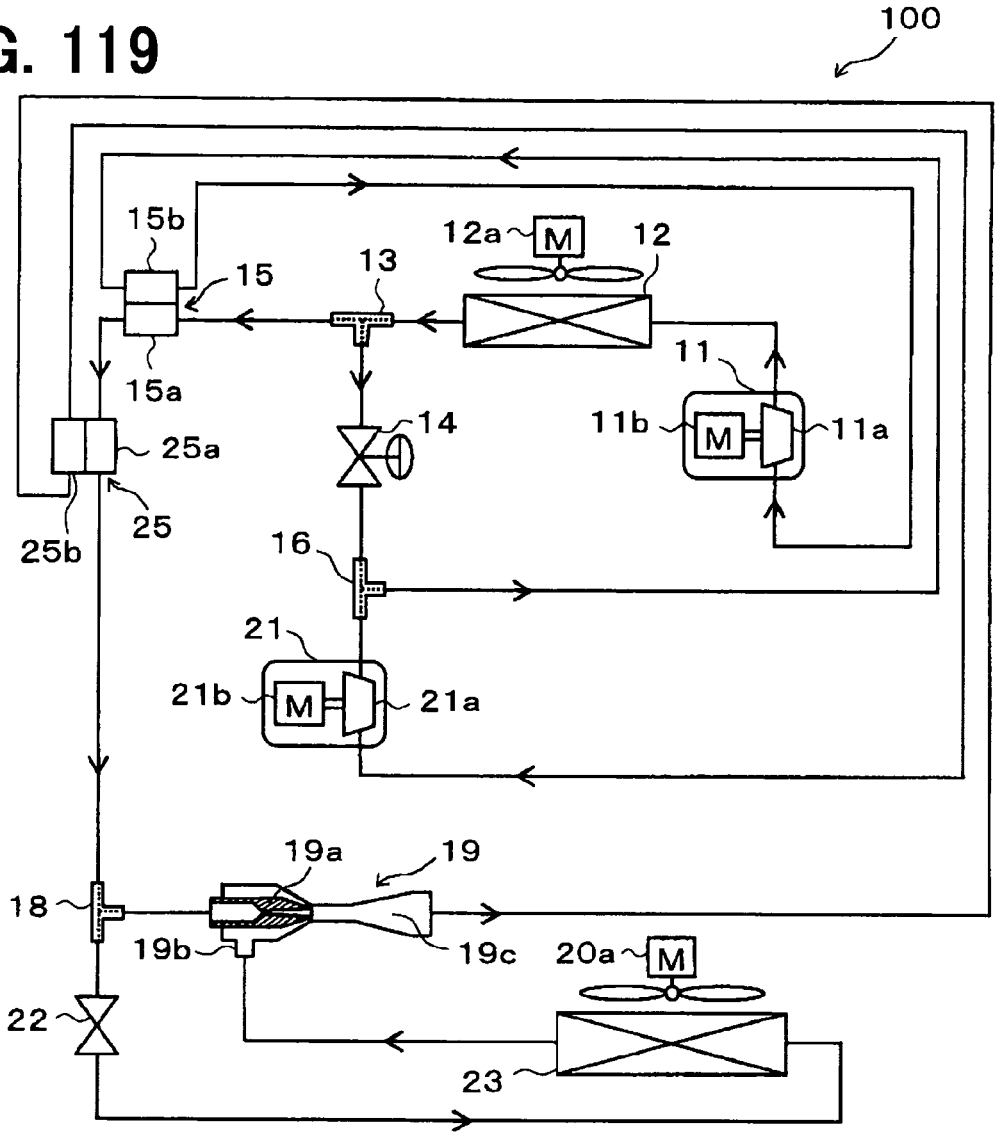
FIG. 119 is an entire schematic diagram of an ejector-type refrigerant cycle device according to an 81st embodiment of the invention.

In 81st embodiment, as in the entire schematic diagram of FIG. 119, with respect to the ejector-type refrigerant cycle device 100 of the 55th embodiment, the first fixed throttle 17 is omitted with respect to the 80th embodiment, so as to configure a super-critical refrigerant cycle device in which the pressure of the refrigerant discharged from the first compressor 11 becomes equal to or larger than the critical pressure of the refrigerant.

Figure 120:
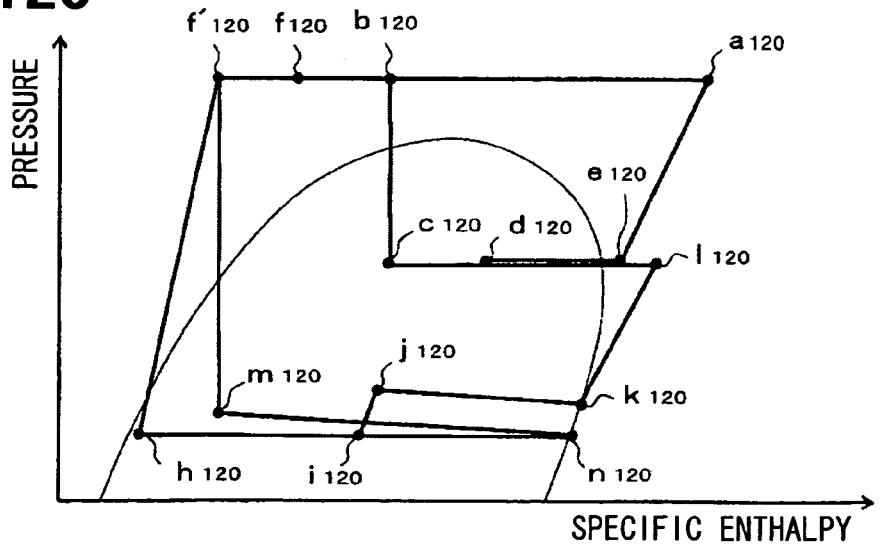

According to the present embodiment, as in the Mollier diagram of FIG. 120, the COP can be improved by increasing the decompression amount (pressure difference between point $f'_{120}$ and point $h_{120}$, in FIG. 120) in the nozzle portion 19*a* of the ejector 19, thereby obtaining the effects similar to the 34th embodiment.

(82nd Embodiment)

Figure 121:
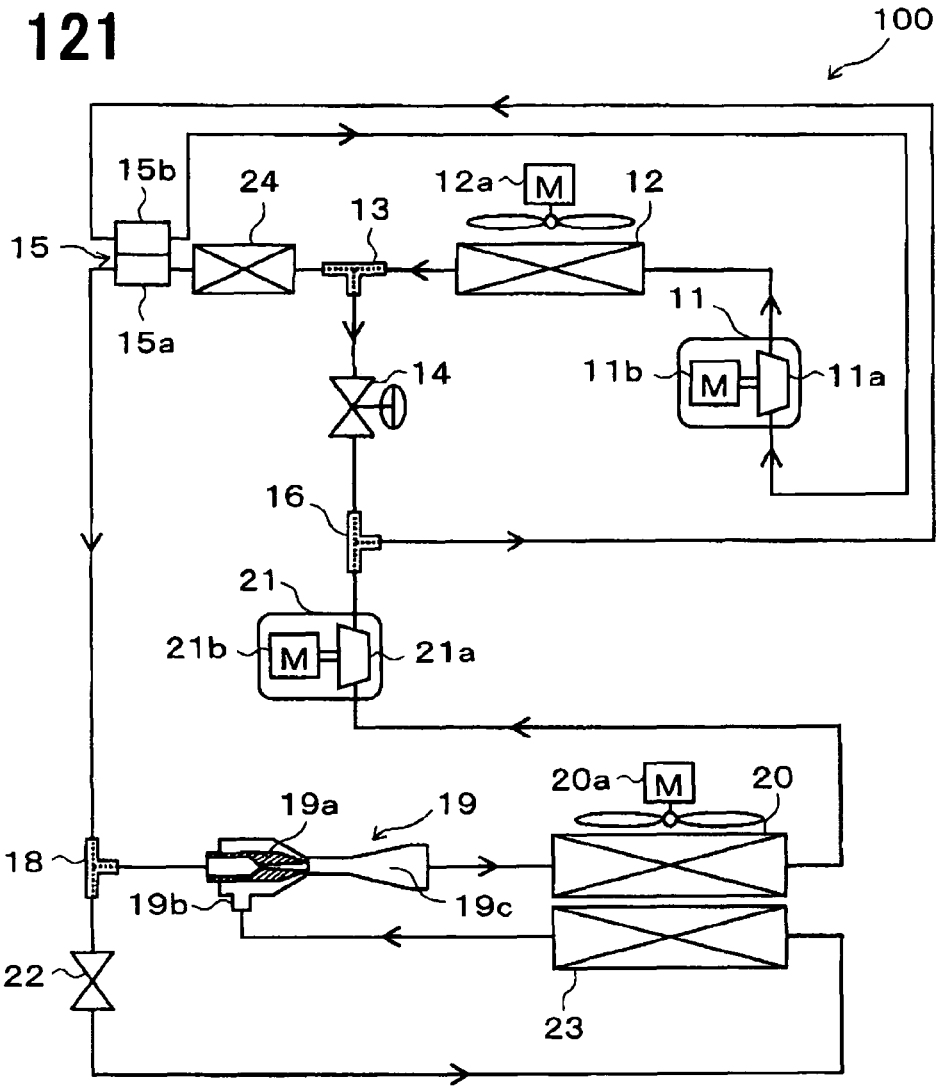

In the present embodiment, as in the entire schematic diagram of FIG. 121, with respect to the ejector-type refrigerant cycle device 100 of the 56th embodiment, the first fixed throttle 17 is omitted with respect to the 80th embodiment, so as to configure a super-critical refrigerant cycle device in which the pressure of the refrigerant discharged from the first compressor 11 becomes equal to or larger than the critical pressure of the refrigerant.

Figure 122:
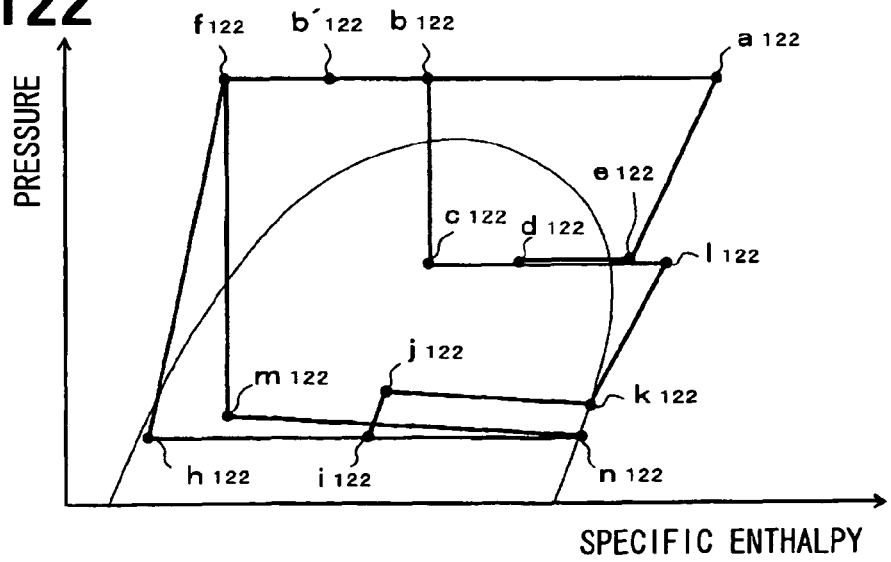

According to the present embodiment, as in the Mollier diagram of FIG. 122, the COP can be improved by increasing the decompression amount (pressure difference between point $f_{122}$ and point $h_{122}$, in FIG. 122) in the nozzle portion 19*a* of the ejector 19, thereby obtaining the effects similar to the 35th embodiment.

(83rd Embodiment)

Figure 123:
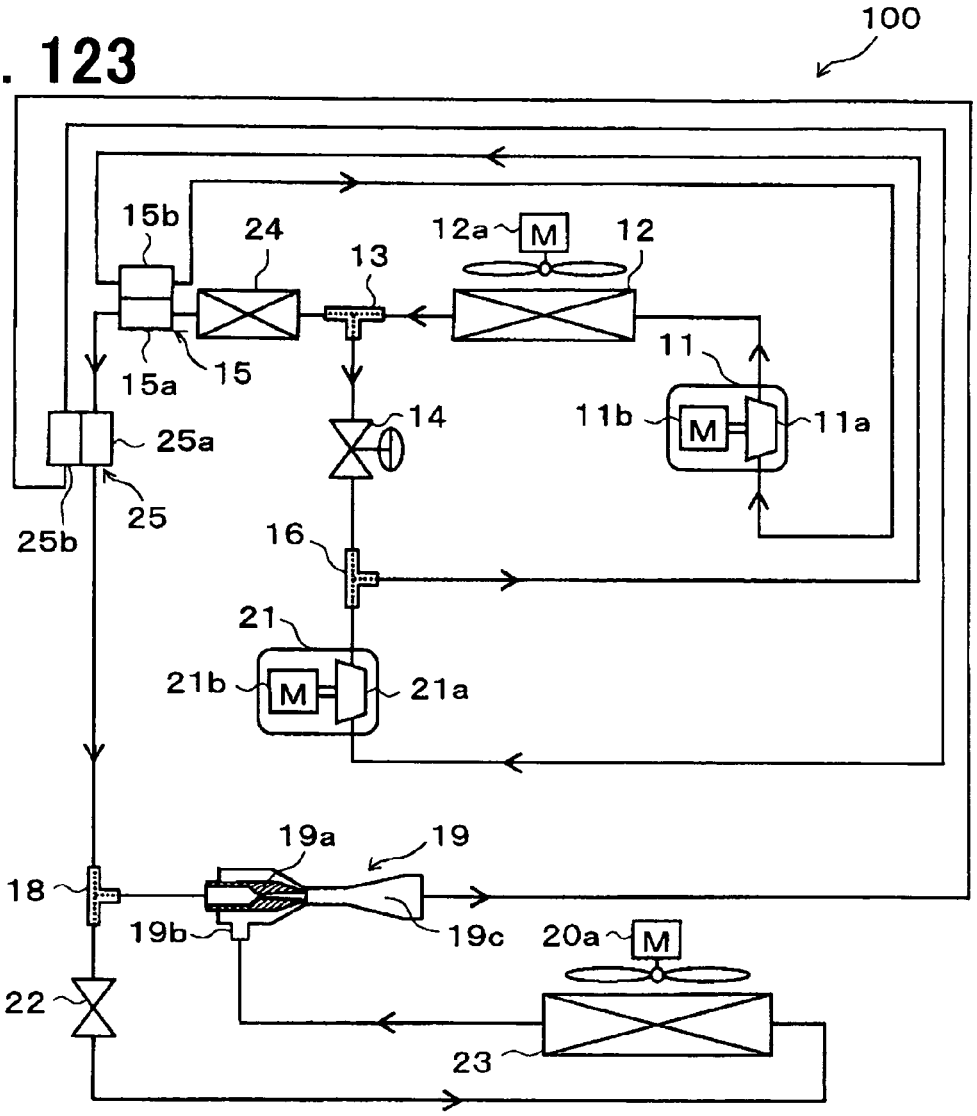

In the present embodiment, as in the entire schematic diagram of FIG. 123, with respect to the ejector-type refrigerant cycle device 100 of the 57th embodiment, the first fixed throttle 17 is omitted similarly to the 80th embodiment, so as to configure a super-critical refrigerant cycle device in which the pressure of the refrigerant discharged from the first compressor 11 becomes equal to or larger than the critical pressure of the refrigerant.

Figure 124:
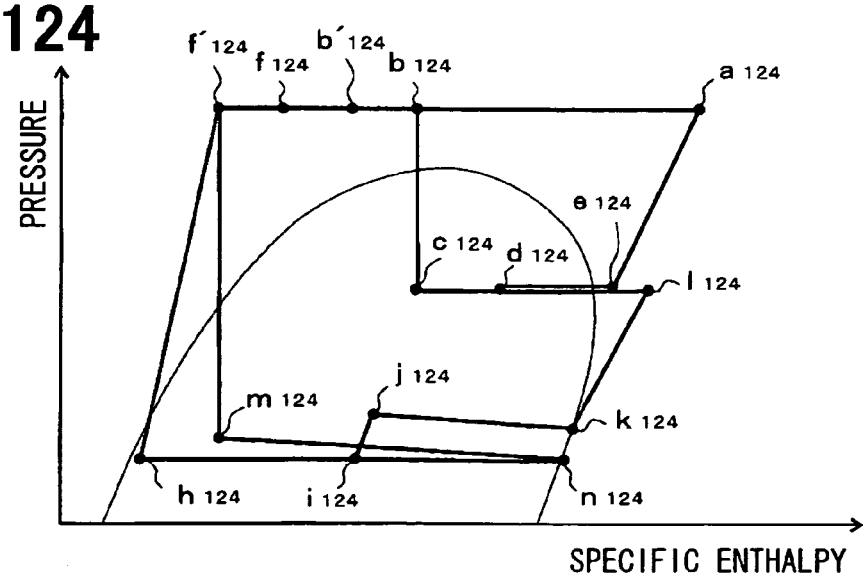

According to the present embodiment, as in the Mollier diagram of FIG. 124, the COP can be improved by increasing the decompression amount (pressure difference between point $f'_{124}$ and point $h_{124}$, in FIG. 124) in the nozzle portion 19*a* of the ejector 19, thereby obtaining the effects similar to the 36th embodiment.

(84th Embodiment)

Figure 125:
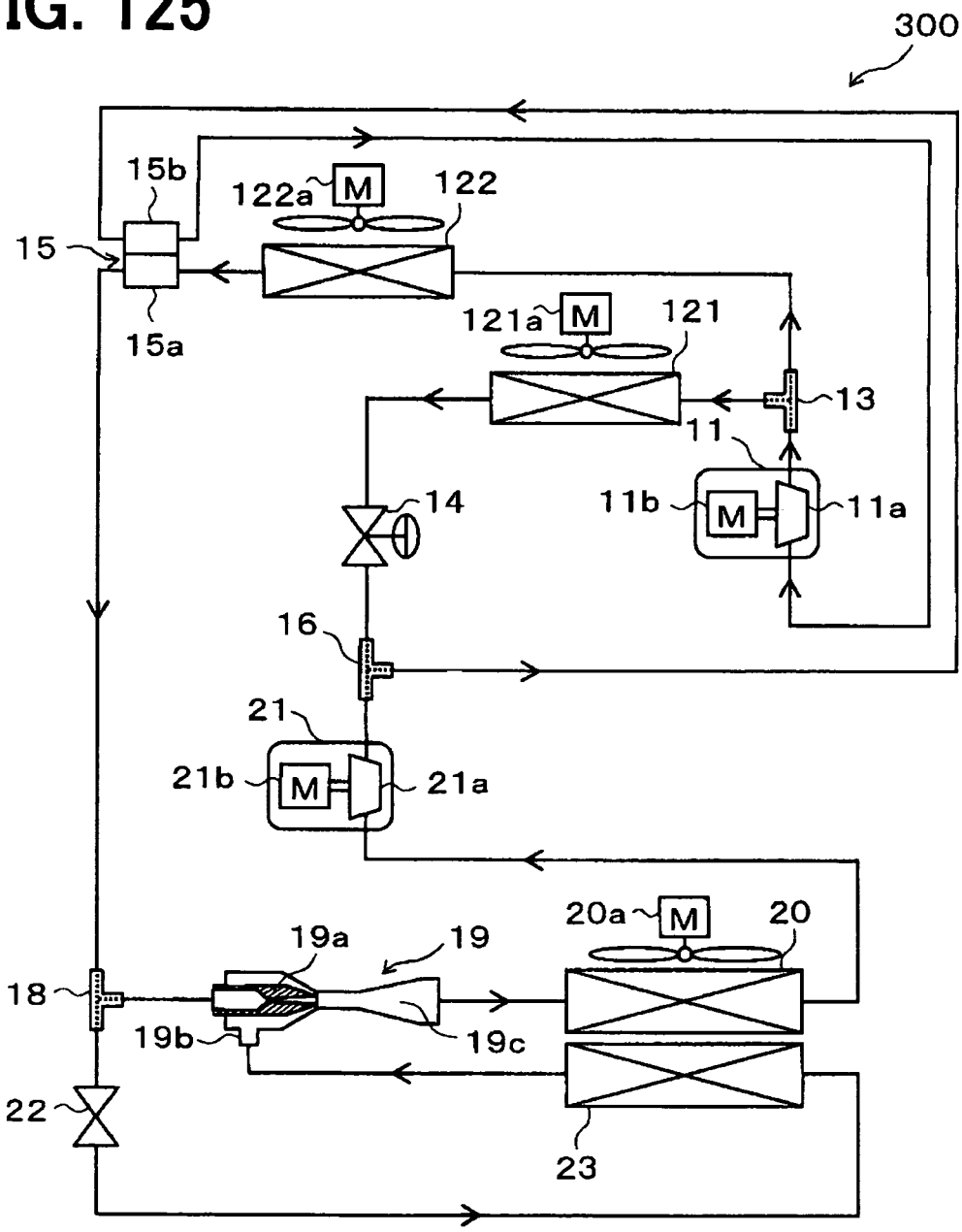

In the present embodiment, as in the entire schematic diagram of FIG. 125, with respect to the ejector-type refrigerant cycle device 300 of the 60th embodiment, the first fixed throttle 17 is omitted similarly to the 80th embodiment, so as to configure a super-critical refrigerant cycle device in which the pressure of the refrigerant discharged from the first compressor 11 becomes equal to or larger than the critical pressure of the refrigerant.

Figure 126:
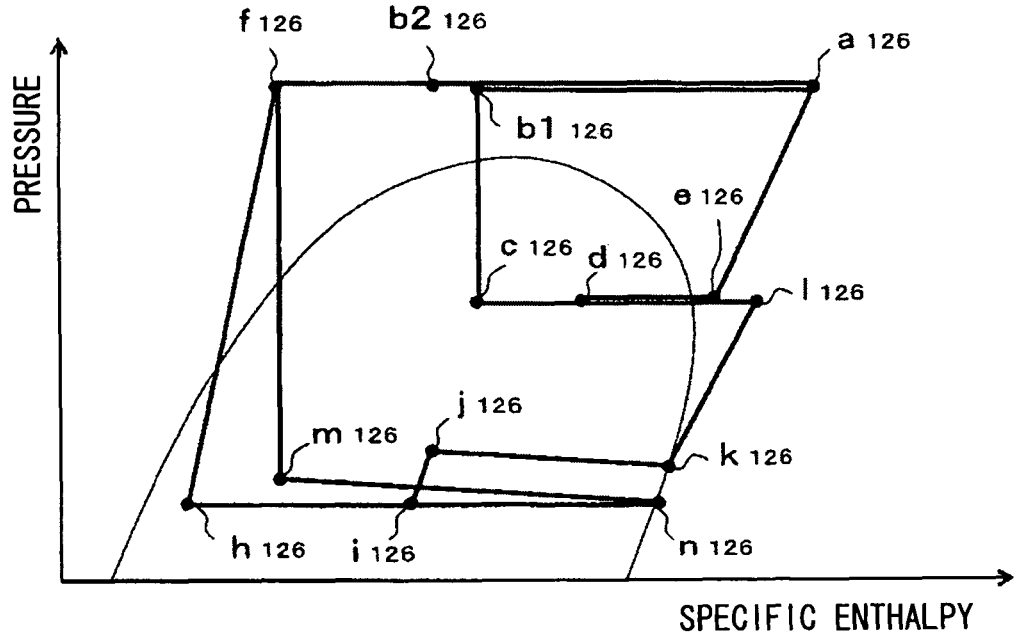

According to the present embodiment, as in the Mollier diagram of FIG. 126, the COP can be improved by increasing the decompression amount (pressure difference between point $f_{126}$ and point $h_{126}$, in FIG. 126) in the nozzle portion 19*a* of the ejector 19, thereby obtaining the effects similar to the 37th embodiment.

(85th Embodiment)

Figure 127:
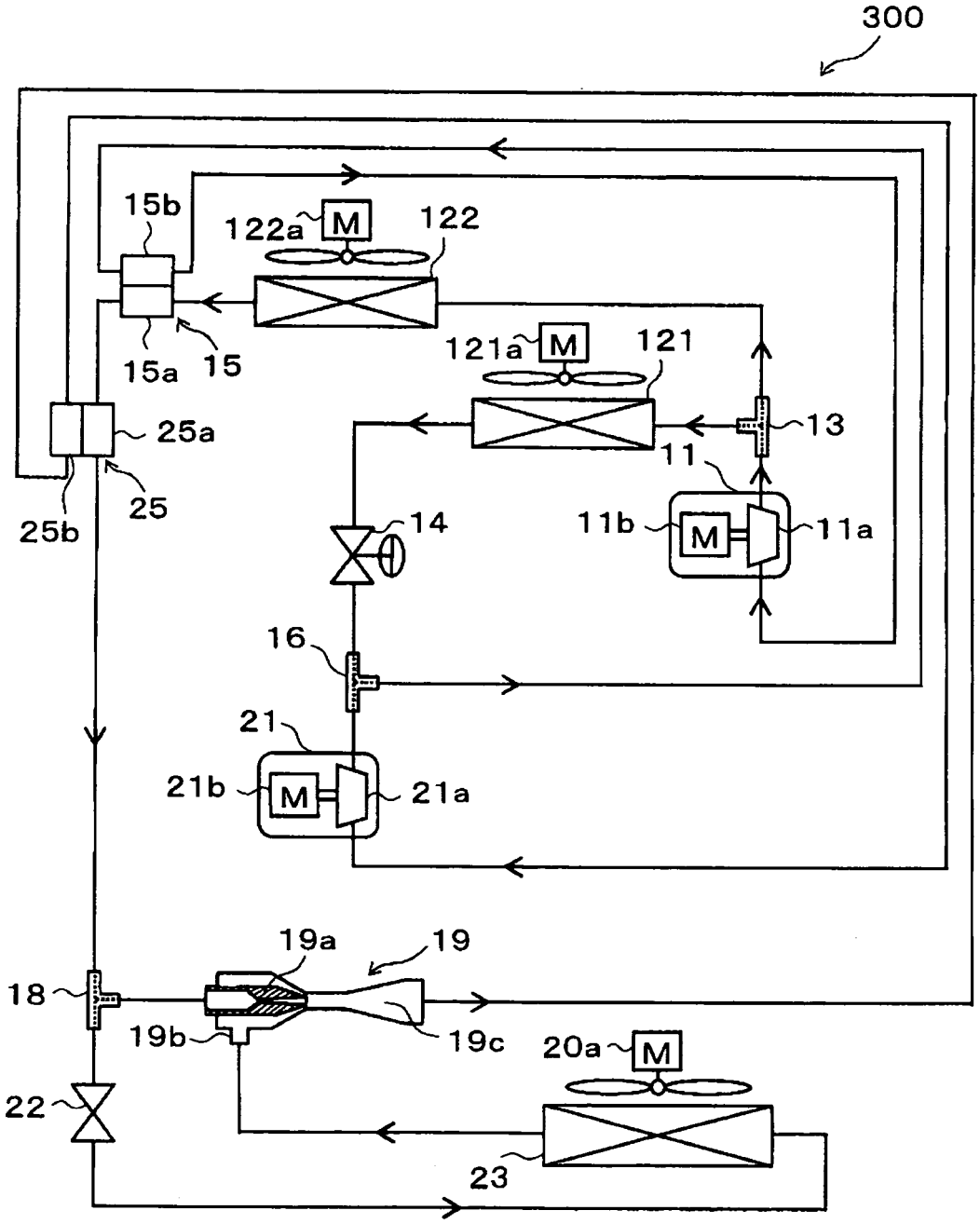

In the present embodiment, as in the entire schematic diagram of FIG. 127, with respect to the ejector-type refrigerant cycle device 300 of the 61st embodiment, the first fixed throttle 17 is omitted similarly to the 80th embodiment, so as to configure a super-critical refrigerant cycle device in which the pressure of the refrigerant discharged from the first compressor 11 becomes equal to or larger than the critical pressure of the refrigerant.

Figure 128:
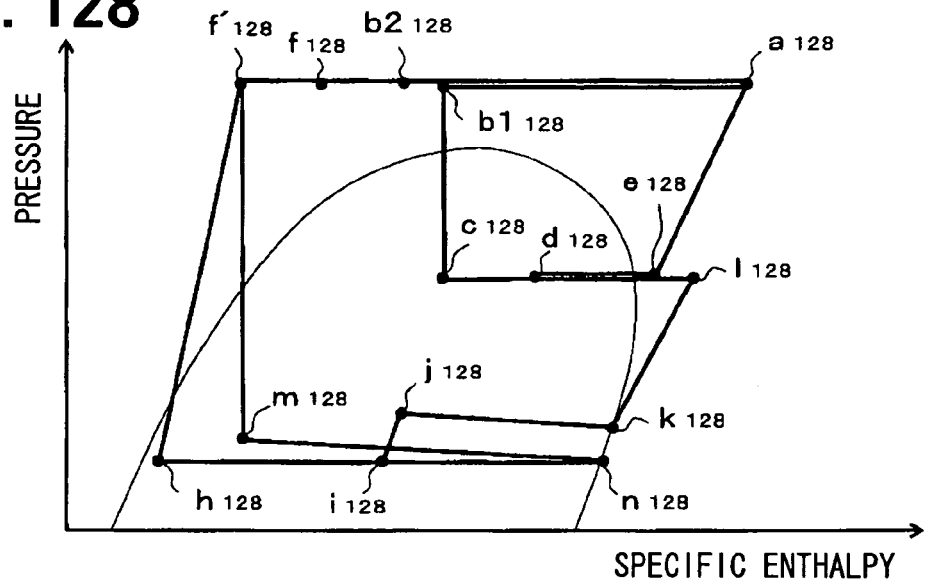

According to the present embodiment, as in the Mollier diagram of FIG. 128, the COP can be improved by increasing the decompression amount (pressure difference between point $f'_{128}$ and point $h_{128}$, in FIG. 128) in the nozzle portion 19*a* of the ejector 19, thereby obtaining the effects similar to the 38th embodiment.

In the above-described 80th-85th embodiments, the ejector-type refrigerant cycle devices 100, 300 according to the 54th-57th, 60th, 61st embodiments are configured as the super-critical refrigerant cycles, respectively. However, the ejector-type refrigerant cycle device 200 of the 58th, 59th embodiment may be configured as the super-critical refrigerant cycle.

(86th Embodiment)

86th embodiment of the present invention will be described with reference to FIGS. 129, 130A, 130B. In an ejector-type refrigerant cycle device 100 adapted to a refrigerator, the suction side evaporator 23 may be frosted as in the 39th embodiment.

Figure 129:
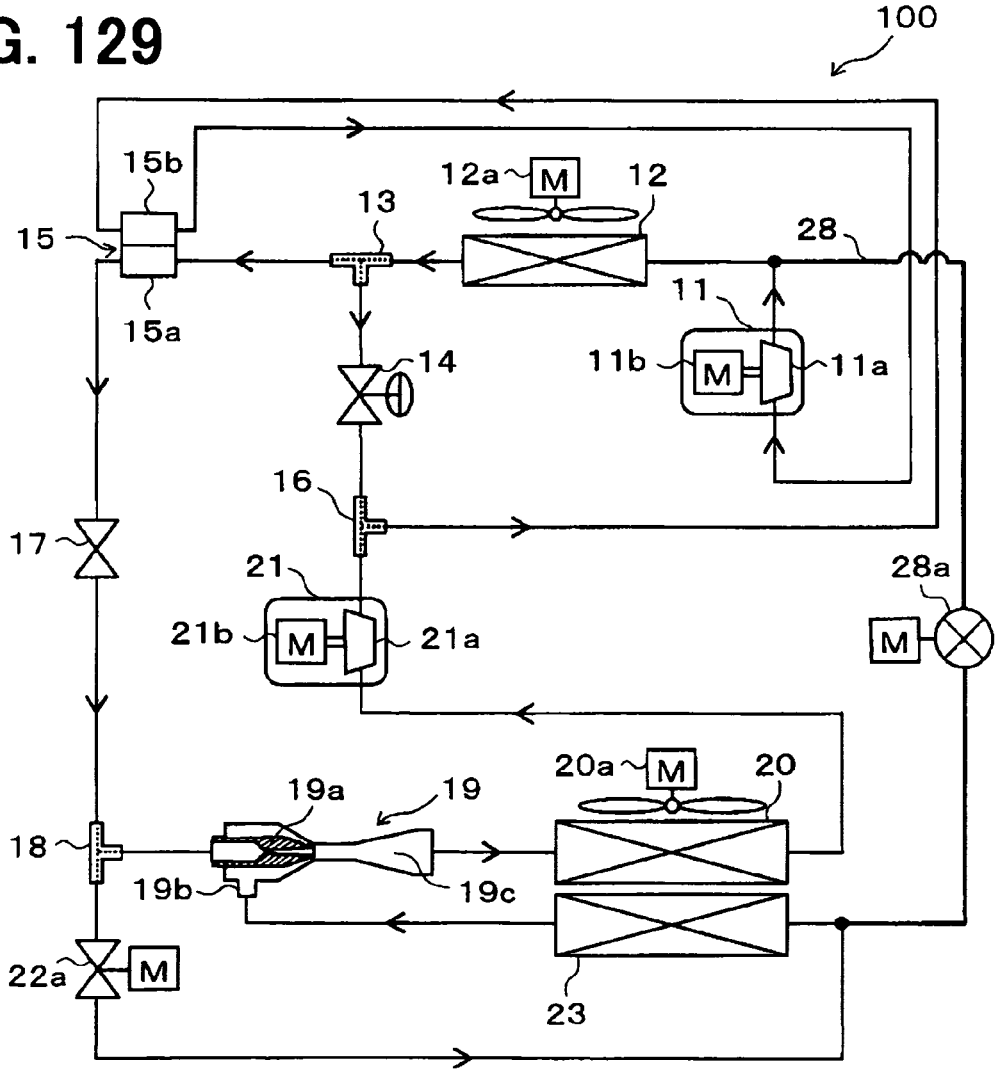

In the present embodiment, as in the entire schematic diagram of FIG. 129, with respect to the ejector-type refrigerant cycle device 100 of the 54th embodiment, a bypass passage 28 and an opening/closing valve 28*a* similarly to the 39th embodiment are added, and an electrical variable throttle mechanism 22*a* is adapted as the suction side decompression portion. The other configurations are similar to 54th embodiment.

The operation of the present embodiment will be described based on the Mollier diagram of FIGS. 130A, 130B. In the present embodiment, the ejector-type refrigerant cycle device 100 is configured to selectively switch between a generation operation mode for cooling the room of the refrigerator, and a defrosting operation mode for performing a defrosting operation of the suction side evaporator 23 and the discharge side evaporator 20, similarly to the 39th embodiment.

Figure 130A:
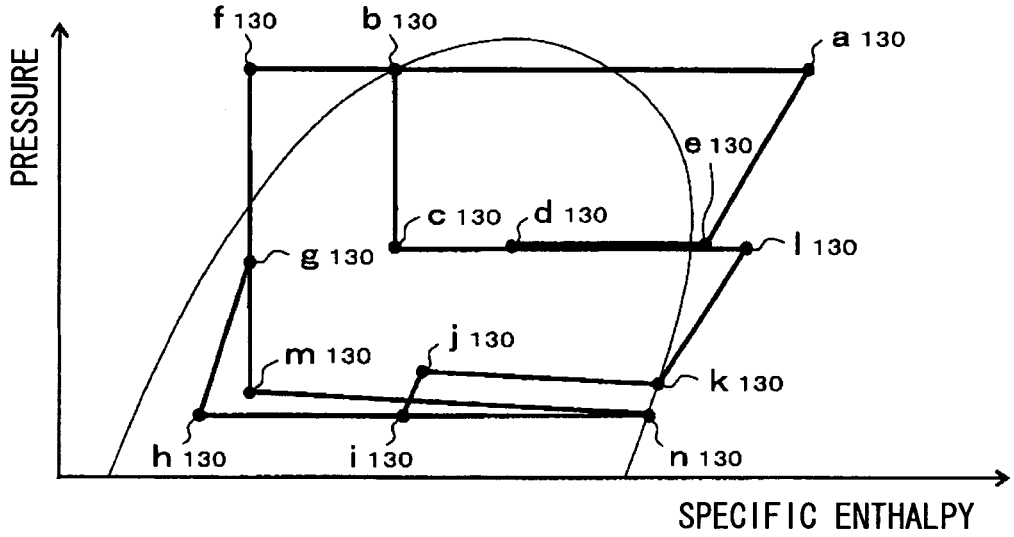
Figure 130B:
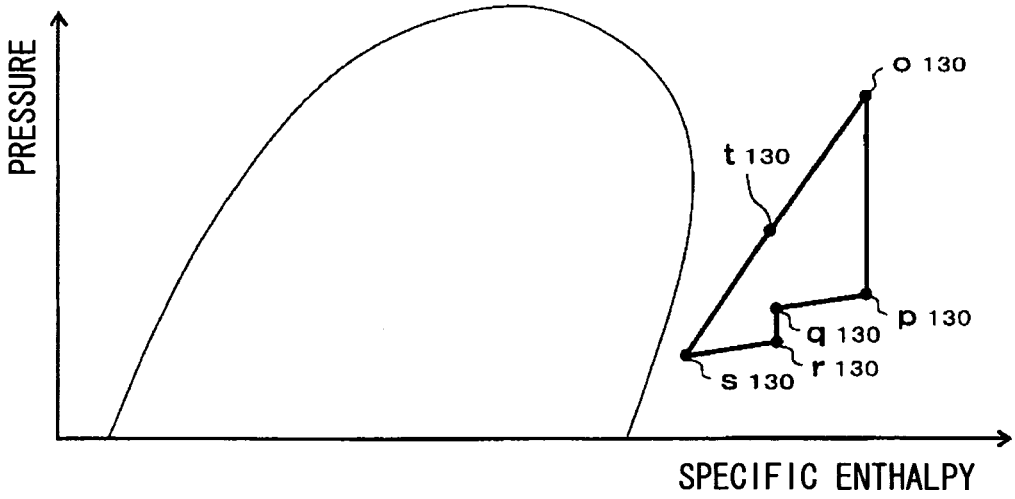

FIG. 130A is a Mollier diagram showing refrigerant states in the general operation mode, and FIG. 130B is a Mollier diagram showing refrigerant states in the defrosting operation mode.

In the general operation mode, the control device causes the opening/closing valve 28*a* in a valve-closing state, and causes the variable throttle mechanism 22*a* to be set at a predetermined throttle degree. Thus, in the general operation mode, the present embodiment is operated similarly to FIG. 84 of the 54th embodiment, as in the Mollier diagram of FIG. 130A.

In contrast, in the defrosting operation mode, the control device causes the cooling fan 12*a* to stop its operation, causes the variable throttle mechanism 22*a* to be in a fully close state, and causes the opening/closing valve 28*a* to be opened. Thus, in the defrosting operation mode, the present embodiment is operated similarly to FIG. 54B of the 39th embodiment, as in the Mollier diagram of FIG. 130B.

Thus, in the ejector-type refrigerant cycle device 100 of the present embodiment, the same effects as in the 54th embodiment can be obtained in the general operation mode, and the defrosting of the suction side evaporator 23 and the discharge side evaporator 20 can be performed in the defrosting operation mode.

In the present embodiment, in the defrosting operation mode, the heat radiating capacity of the radiator 12 is not exerted when the control device stops the operation of the cooling fan 12*a*. Thus, for example, the bypass passage 28 may be configured such that high-pressure refrigerant downstream of the radiator 12 and upstream of the first branch portion 13 flows into the bypass passage 28.

(87th Embodiment)

Figure 131:
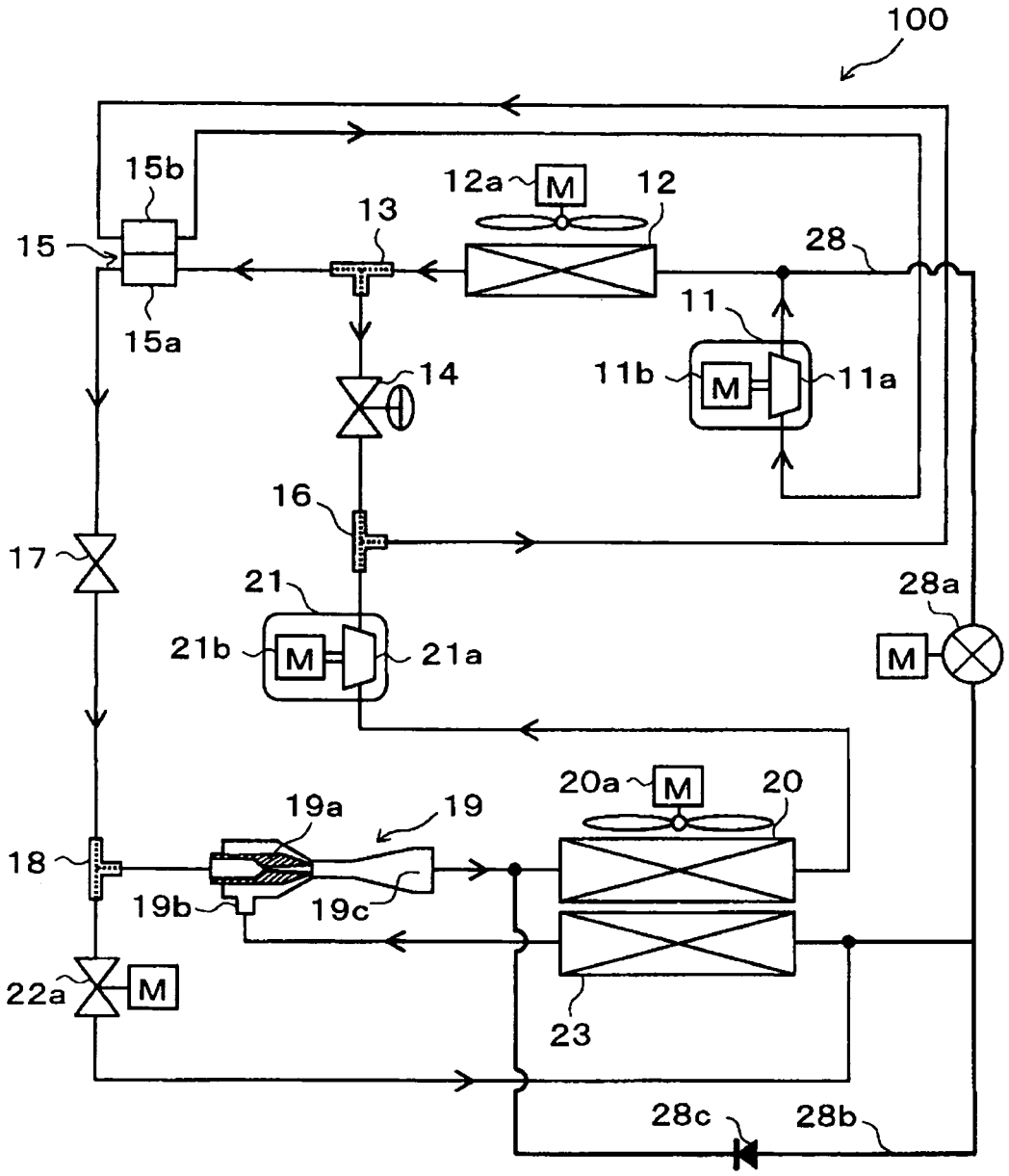

In the present embodiment, as shown in FIG. 131, with respect to the ejector-type refrigerant cycle device 100 of the 86th embodiment, the bypass passage 28, the opening/closing valve 28*a*, an auxiliary bypass passage 28*b* and an auxiliary check valve 28*c* are added as in the 40th embodiment, so as to perform a defrosting operation mode.

The basic operation of the present embodiment is similar to 86th embodiment. When the ejector-type refrigerant cycle device 100 of the present embodiment is operated in the general operation mode, the present embodiment is operated similarly to FIG. 86 of the 54th embodiment, as in the Mollier diagram of FIG. 132A. In contrast, the defrosting operation mode is performed similarly to the defrosting operation mode of the 40th embodiment of FIG. 56B, as shown in the Mollier diagram of FIG. 132B.

Thus, in the ejector-type refrigerant cycle device 100 of the present embodiment, the same effects as in the 54th embodiment can be obtained in the general operation mode, and the defrosting of the suction side evaporator 23 and the discharge side evaporator 20 can be performed in the defrosting operation mode.

(88th Embodiment)

In the present embodiment, as in the entire schematic diagram of FIG. 133, with respect to the ejector-type refrigerant cycle device 100 of the 55th embodiment, a bypass passage 28 and an opening/closing valve 28*a* similarly to the 39th embodiment are added, and an electrical variable throttle mechanism 22*a* is adapted as the suction side decompression portion. The other configurations are similar to 55th embodiment.

The basic operation of the present embodiment is similar to the 86th embodiment. Thus, when the ejector-type refrigerant cycle device 100 of the present embodiment is operated in the general operation mode, the present embodiment is operated similarly to FIG. 86 of the 55th embodiment, as in the Mollier diagram of FIG. 134A. In contrast, the defrosting operation mode is performed similarly to the defrosting operation mode of the 41st embodiment of FIG. 58B, as shown in the Mollier diagram of FIG. 134B.

Thus, in the ejector-type refrigerant cycle device 100 of the present embodiment, the same effects as in the 55th embodiment can be obtained in the general operation mode, and the defrosting of the suction side evaporator 23 can be performed in the defrosting operation mode.

(89th Embodiment)

In the present embodiment, as in the entire schematic diagram of FIG. 135, with respect to the ejector-type refrigerant cycle device 100 of the 56th embodiment, a bypass passage 28 and an opening/closing valve 28*a* similarly to the 39th embodiment are added, and an electrical variable throttle mechanism 22*a* is adapted as the suction side decompression portion. The other configurations are similar to 56th embodiment.

The basic operation of the present embodiment is similar to the 86th embodiment. Thus, when the ejector-type refrigerant cycle device 100 of the present embodiment is operated in the general operation mode, the present embodiment is operated similarly to FIG. 88 of the 56th embodiment, as in the Mollier diagram of FIG. 136A. In contrast, the defrosting operation mode is performed similarly to the defrosting operation mode of the 42nd embodiment of FIG. 60B, as shown in the Mollier diagram of FIG. 136B.

Thus, in the ejector-type refrigerant cycle device 100 of the present embodiment, the same effects as in the 56th embodiment can be obtained in the general operation mode, and the defrosting of the suction side evaporator 23 and the discharge side evaporator 20 can be performed in the defrosting operation mode.

(90th Embodiment)

In the present embodiment, as shown in FIG. 137, with respect to the ejector-type refrigerant cycle device 100 of the 56th embodiment, a bypass passage 28, an opening/closing valve 28*a*, an auxiliary bypass passage 28*b* and an auxiliary check valve 28*c* are added, and an electrical variable throttle mechanism 22*a* is added as the suction side decompression portion, so as to perform a defrosting operation mode. The other configurations are similar to the 56th embodiment.

The basic operation of the present embodiment is similar to 86th embodiment. When the ejector-type refrigerant cycle device 100 of the present embodiment is operated in the general operation mode, the present embodiment is operated similarly to FIG. 88 of the 56th embodiment, as in the Mollier diagram of FIG. 138A. In contrast, the defrosting operation mode is performed similarly to the defrosting operation mode of the 43rd embodiment of FIG. 62B, as shown in the Mollier diagram of FIG. 138B.

Thus, in the ejector-type refrigerant cycle device 100 of the present embodiment, the same effects as in the 56th embodiment can be obtained in the general operation mode, and the defrosting of the suction side evaporator 23 and the discharge side evaporator 20 can be performed in the defrosting operation mode.

(91st Embodiment)

In the present embodiment, as in the entire schematic diagram of FIG. 139, with respect to the ejector-type refrigerant cycle device 100 of the 57th embodiment, a bypass passage 28 and an opening/closing valve 28*a* similarly to the 39th embodiment are added, and an electrical variable throttle mechanism 22*a* is adapted as the suction side decompression portion. The other configurations are similar to 57th embodiment.

The basic operation of the present embodiment is similar to the 86th embodiment. Thus, when the ejector-type refrigerant cycle device 100 of the present embodiment is operated in the general operation mode, the present embodiment is operated similarly to FIG. 90 of the 57th embodiment, as in the Mollier diagram of FIG. 140A. In contrast, the defrosting operation mode is performed similarly to the defrosting operation mode of the 44th embodiment of FIG. 64B, as shown in the Mollier diagram of FIG. 140B.

Thus, in the ejector-type refrigerant cycle device 100 of the present embodiment, the same effects as in the 57th embodiment can be obtained in the general operation mode, and the defrosting of the suction side evaporator 23 can be performed in the defrosting operation mode.

In the 86th-91st embodiments, the bypass passage 28 and the opening/closing valve 28*a* are added with respect to the ejector-type refrigerant cycle device 100 of the 54th-57th embodiments. However, the bypass passage 28 and the opening/closing valve 28*a* may be added with respect to the ejector-type refrigerant cycle device 200 in each of the 58th and 59th embodiments.

(92nd Embodiment)

In the present embodiment, as in the entire schematic diagram of FIG. 141, with respect to the ejector-type refrigerant cycle device 300 of the 60th embodiment, a bypass passage 28 and an opening/closing valve 28*a* similarly to the 39th embodiment are added, and an electrical variable throttle mechanism 22*a* is adapted as the suction side decompression portion.

More specifically, in the present embodiment, the bypass passage 28 is a refrigerant passage through which high-pressure refrigerant downstream of the first branch portion 13 and upstream of the second radiator 122 is directly introduced into the suction side evaporator 23 while bypassing the first and second radiators 121, 122.

Alternatively, the bypass passage 28 may be configured as a refrigerant passage, through which the high-pressure refrigerant downstream of the first branch portion 13 and upstream of the second radiator 122, or the refrigerant discharged from the first compressor 11 and upstream of the first branch portion 13 may be directly introduced into the suction side evaporator 23. The other configurations are similar to 60th embodiment.

The basic operation of the present embodiment is similar to the 86th embodiment. Thus, when the ejector-type refrigerant cycle device 100 of the present embodiment is operated in the general operation mode, the present embodiment is operated similarly to FIG. 96 of the 60th embodiment, as in the Mollier diagram of FIG. 142A. In contrast, the defrosting operation mode is performed similarly to the defrosting operation mode of the 45th embodiment of FIG. 66B, as shown in the Mollier diagram of FIG. 142B.

Thus, in the ejector-type refrigerant cycle device 300 of the present embodiment, the same effects as in the 60th embodiment can be obtained in the general operation mode, and the defrosting of the suction side evaporator 23 and the discharge side evaporator 20 can be performed in the defrosting operation mode.

In the present embodiment, in the defrosting operation mode, the heat radiating capacities of the first and second radiators 121, 122 are not exerted when the control device stops the operation of the first and second cooling fans 121*a*, 122*a*.

Thus, for example, the bypass passage 28 may be configured such that high-pressure refrigerant downstream of the first radiator 121 and upstream of the thermal expansion valve 14 flows into the bypass passage 28. Alternatively, the bypass passage 28 may be configured such that high-pressure refrigerant downstream of the second radiator 122 and upstream of the inner heat exchanger 15 flows into the bypass passage 28.

(93rd Embodiment)

In the present embodiment, as shown in FIG. 143, with respect to the ejector-type refrigerant cycle device 300 of the 60th embodiment, a bypass passage 28, an opening/closing valve 28*a*, an auxiliary bypass passage 28*b* and an auxiliary check valve 28*c* are added, and an electrical variable throttle mechanism 22*a* is adapted as the suction side decompression portion, so as to perform a defrosting operation mode. The other configurations are similar to the 60th embodiment.

The basic operation of the present embodiment is similar to 86th embodiment. When the ejector-type refrigerant cycle device 300 of the present embodiment is operated in the general operation mode, the present embodiment is operated similarly to FIG. 96 of the 60th embodiment, as in the Mollier diagram of FIG. 144A. In contrast, the defrosting operation mode is performed similarly to the defrosting operation mode of the 46th embodiment of FIG. 66B, as shown in the Mollier diagram of FIG. 144B.

Thus, in the ejector-type refrigerant cycle device 300 of the present embodiment, the same effects as in the 60th embodiment can be obtained in the general operation mode, and the defrosting of the suction side evaporator 23 and the discharge side evaporator 20 can be performed in the defrosting operation mode.

(94th Embodiment)

In the present embodiment, as shown in FIG. 145, with respect to the ejector-type refrigerant cycle device 300 of the 61st embodiment, a bypass passage 28, an opening/closing valve 28*a* are added similarly to 45th embodiment, and an electrical variable throttle mechanism 22*a* is adapted as the suction side decompression portion, so as to perform a defrosting operation mode. The other configurations are similar to the 61st embodiment.

The basic operation of the present embodiment is similar to 86th embodiment. When the ejector-type refrigerant cycle device 300 of the present embodiment is operated in the general operation mode, the present embodiment is operated similarly to FIG. 98 of the 61st embodiment, as in the Mollier diagram of FIG. 146A. In contrast, the defrosting operation mode is performed similarly to the defrosting operation mode of the 47th embodiment of FIG. 70B, as shown in the Mollier diagram of FIG. 146B.

Thus, in the ejector-type refrigerant cycle device 300 of the present embodiment, the same effects as in the 61st embodiment can be obtained in the general operation mode, and the defrosting of the suction side evaporator 23 can be performed in the defrosting operation mode.

(95th Embodiment)

Next, 95th embodiment of the present embodiment will be described with reference to FIGS. 147, 148A, 148B. In the present embodiment, the ejector-type refrigerant cycle device of the present invention is typically applied to a cooling/heating storage unit. FIG. 147 is an entire schematic diagram of an ejector-type refrigerant cycle device 500 of the present embodiment. In the present embodiment, as in the entire schematic diagram of FIG. 147, the arrangement of the join portion 16 is changed, with respect to the ejector-type refrigerant cycle device 500 of the 48th embodiment.

That is, in the 48 embodiment, at the join portion 16, the refrigerant flowing out of the middle-pressure side refrigerant passage 15*b* of the inner heat exchanger 15 and the refrigerant discharged from the second compressor 21 are joined. In contrast, in the present embodiment, at the join portion 16, the refrigerant flowing out of the thermal expansion valve 14 and the refrigerant discharged from the second compressor 21 are joined. The other configurations are similar to 48th embodiment.

Next, operation of the present embodiment with the above structure will be described with reference to FIGS. 148A, 148B. FIG. 148A is the Mollier diagram showing refrigerant states in a cooling operation mode, and FIG. 148B is the Mollier diagram showing refrigerant states in a heating operation mode.

In the cooling operation mode, the control device causes the first and second electrical motors 11*b*, 21*b* and the blower fans 53*a*, 54*a* to be operated, and controls the throttle open degree of the variable throttle mechanism 14*a*. Furthermore, similarly to 48th embodiment, the control device switches the first and second electrical four-way valve 51, 52. Thus, as in the solid arrows in FIG. 147, the following first, second and third refrigerant circuits are configured.

The first refrigerant circuit is configured so that the refrigerant flows in the circuit in this order of the first compressor 11→the first electrical four-way valve 51→the exterior heat exchanger 53→the first branch passage 13→the variable throttle mechanism 14*a*→the join portion 16→the middle-pressure side refrigerant passage 15*b* of the inner heat exchanger 15→the first compressor 11.

The second refrigerant circuit is configured so that the refrigerant flows in the circuit in this order of the first compressor 11→the first electrical four-way valve 51→the exterior heat exchanger 53→the first branch, passage 13→the high-pressure side refrigerant passage 15*a* of the inner heat exchanger 15→the first fixed throttle 17→the second branch portion 18→the pre-nozzle check valve 29→the ejector 19→the auxiliary using-side heat exchanger 54→the second electrical four-way valve 52→the second compressor 21→the join portion 16→the first compressor 11.

The third refrigerant circuit is configured so that the refrigerant flows in the circuit in this order of the first compressor 11→the first electrical four-way valve 51→the exterior heat exchanger 53→the first branch passage 13→the high-pressure side refrigerant passage 15*a* of the inner heat exchanger 15→the first fixed throttle 17→the second branch portion 18→the second fixed throttle 22→the using-side heat exchanger 55→the ejector 19→the auxiliary using-side heat exchanger 54→the second electrical four-way valve 52→the second compressor 21→the join portion 16→the middle-pressure side refrigerant passage 15*b* of the inner heat exchanger 15→the first compressor 11.

That is, in the cooling operation mode of the present embodiment, the exterior heat exchanger 53, the using-side heat exchanger 55 and the auxiliary using-side heat exchanger 54 are configured to respectively correspond to the radiator 12, the suction side evaporator 23 and the discharge side evaporator 20 of the 54th embodiment. Thus, as shown in FIG. 148A, the cooling operation mode of the present embodiment is performed similarly to that in FIG. 84 of the 54th embodiment, so as to cool the air of the room.

In contrast, in the heating operation mode, the control device causes the first and second electrical motors 11*b*, 21*b* and the blower fans 53*a*, 54*a* to be operated, and causes the variable throttle mechanism 14*a* to be in the fully close state. Furthermore, similarly to 48th embodiment, the control device switches the first and second electrical four-way valves 51, 52.

Thus, as in the chain arrows of FIG. 147, the refrigerant flows in the circuit in this order of the first compressor 11→the first and second electrical four-way valve 51, 52→the auxiliary using-side heat exchanger 54→the diffuser portion 19*c* of the ejector 19→the refrigerant suction port 19*b* of the ejector 19→the using-side heat exchanger 55→the second fixed throttle 22→the second branch passage 18→the first fixed throttle 17→the high-pressure side refrigerant passage 15*a* of the inner heat exchanger 15→the first branch portion 13→the exterior heat exchanger 53→the first, second electrical four-way valve 51, 52→the second compressor 21→the join portion 16→the middle-pressure side refrigerant passage 15*b* of the inner heat exchanger 15→the first compressor 11.

Because the variable throttle mechanism 14*a* is in the fully close state, refrigerant does not flow from the first branch portion 13 toward the throttle mechanism 14*a*, and thereby heat exchange is substantially not performed in the inner heat exchanger 15. In the heating operation mode of the present embodiment, as shown in FIG. 148B, the ejector-type refrigerant cycle device is operated similarly to FIG. 72B of the 48th embodiment, so that the air inside the room can be heated.

The ejector-type refrigerant cycle device 500 of the present embodiment is operated above, and thereby the air in the room can be cooled in the cooling operation mode, and the air in the room can be heated in the heating operation mode. Furthermore, in the cooling operation mode using the ejector 19 as the refrigerant decompression portion, the ejector-type refrigerant cycle device can be stably operated without reducing the COP even when a variation in the flow amount of the drive flow of the ejector 19 is caused, similarly to the 54th embodiment.

(96th Embodiment)

In the present embodiment, as in the entire schematic diagram of FIG. 149, the arrangement of the join portion 16 is changed similar to the 95th embodiment, with respect to the ejector-type refrigerant cycle device 500 of the 49th embodiment.

The auxiliary inner heat exchanger 25 of the present embodiment is configured such that the refrigerant flowing out of the inner heat exchanger 15 from the first branch portion 13 passes through the high-pressure side heat exchanger 25*a* and is heat-exchanged with the refrigerant passing through the low-pressure side refrigerant passage 25*b* having passed through the diffuser portion 19*c* of the ejector 19. The other configurations are similar to 49th embodiment.

Next, operation of the present embodiment with the above structure will be described with reference to FIGS. 150A, 150B. In the cooling operation mode, the control device causes the first and second electrical motors 11*b*, 21*b* and the blower fans 53*a*, 54*a* to be operated, and controls the throttle open degree of the variable throttle mechanism 14*a*. Furthermore, similarly to 49th embodiment, the control device switches the first and second electrical four-way valve 51, 52. Thus, as in the solid arrows in FIG. 149, the following first, second and third refrigerant circuits are configured.

The first refrigerant circuit is configured so that the refrigerant flows in the circuit in this order of the first compressor 11→the first electrical four-way valve 51→the exterior heat exchanger 53→the first branch passage 13→the variable throttle mechanism 14*a*→the join portion 16→the middle-pressure side refrigerant passage 15*b* of the inner heat exchanger 15→the first compressor 11.

The second refrigerant circuit is configured so that the refrigerant flows in the circuit in this order of the first compressor 11→the first electrical four-way valve 51→the exterior heat exchanger 53→the first branch passage 13→the high-pressure side refrigerant passage 15*a* of the inner heat exchanger 15→the high-pressure side refrigerant passage 25*a* of the auxiliary inner heat exchanger 25→the first fixed throttle 17→the second branch portion 18→the pre-nozzle check valve 29→the ejector 19→the first, second electrical four-way valves 51, 52→the low-pressure side refrigerant passage 25*b* of the auxiliary inner heat exchanger 25→the second compressor 21→the join portion 16→the middle-pressure side refrigerant passage 15*b* of the inner heat exchanger 15→the first compressor 11.

The third refrigerant circuit is configured so that the refrigerant flows in the circuit in this order of the first compressor 11→the first electrical four-Way valve 51→the exterior heat exchanger 53→the first branch passage 13→the high-pressure side refrigerant passage 15*a* of the inner heat exchanger 15→the high-pressure side refrigerant passage 25*a* of the auxiliary inner heat exchanger 25→the first fixed throttle 17→the second branch portion 18→the second fixed throttle 22→the using-side heat exchanger 55→the ejector 19→the first, second electrical four-way valve 51, 52→the low-pressure side refrigerant passage 25*b* of the auxiliary inner heat exchanger 25→the second compressor 21→the join portion 16→the middle-pressure side refrigerant passage 15*b* of the inner heat exchanger 15→the first compressor 11.

That is, in the cooling operation mode of the present embodiment, the exterior heat exchanger 53 and the using-side heat exchanger 55 are configured to respectively correspond to the radiator 12 and the suction side evaporator 23 of the 55th embodiment. Thus, as shown in FIG. 150A, the cooling operation mode of the present embodiment is performed similarly to that in FIG. 86 of the 55th embodiment, so as to cool the air of the room.

In contrast, in the heating operation mode, the control device causes the first and second electrical motors 11*b*, 21*b* and the blower fans 53*a*, 54*a* to be operated, and causes the variable throttle mechanism 14*a* to be in the fully close state. Furthermore, similarly to 49th embodiment, the control device switches the first and second electrical four-way valves 51, 52.

Thus, as in the chain arrows of FIG. 149, the refrigerant flows in the circuit in this order of the first compressor 11→the first and second electrical four-way valve 51, 52→the diffuser portion 19*c* of the ejector 19→the refrigerant suction port 19*b* of the ejector 19→the using-side heat exchanger 55→the second fixed throttle 22→the second branch passage 18→the first fixed throttle 17→the high-pressure side refrigerant passage 25*a* of the auxiliary inner heat exchanger 25→the high-pressure side, refrigerant passage 15*a* of the inner heat exchanger 15→the first branch portion 13→the exterior heat exchanger 53→the first, second electrical four-way valve 51, 52→the low-pressure side refrigerant passage 25*b* of the auxiliary inner heat exchanger 25→the second compressor 21→the join portion 16→the middle-pressure side refrigerant passage 15*b* of the inner heat exchanger 15→the first compressor 11.

Because the variable throttle mechanism 14*a* is in the fully close state, refrigerant does not flow from the first branch portion 13 toward the throttle mechanism 14*a*, and thereby heat exchange is substantially not performed in the inner heat exchanger 15. Furthermore, the auxiliary inner heat exchanger 25 almost does not perform heat exchange, because a temperature difference between the refrigerant flowing through the high-pressure side refrigerant passage 25*a* and the refrigerant flowing through the low-pressure side refrigerant passage 25*b* is extremely small.

Figure 74B:
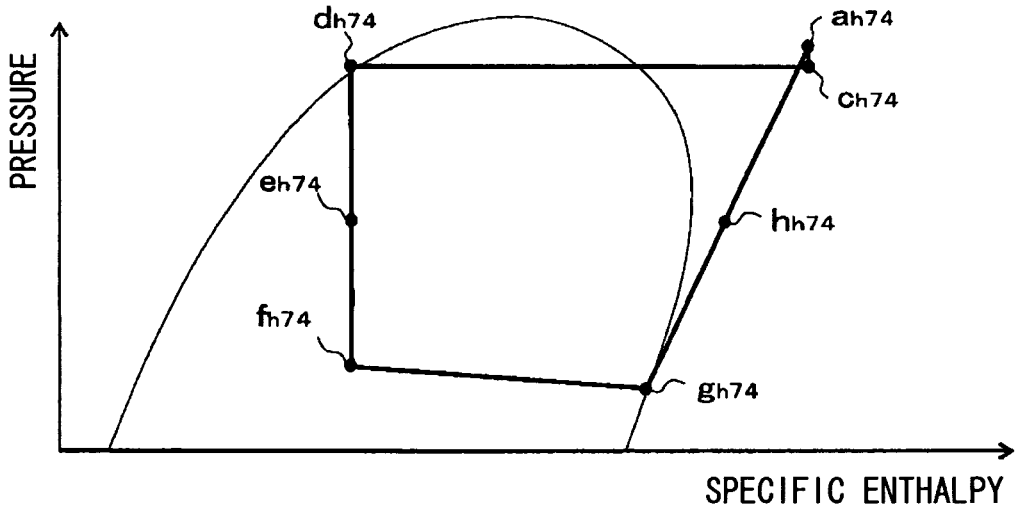
FIG. 74B is a Mollier diagram showing a refrigerant state in a heating operation mode according to the 49th embodiment.

In the heating operation mode of the present embodiment, as shown in FIG. 150B, the ejector-type refrigerant cycle device is operated similarly to FIG. 74B of the 49th embodiment, so that the air inside the room can be heated.

The ejector-type refrigerant cycle device 500 of the present embodiment is operated above, and thereby the air in the room can be cooled in the cooling operation mode, and the air in the room can be heated in the heating operation mode. Furthermore, in the cooling operation mode using the ejector 19 as the refrigerant decompression portion, the ejector-type refrigerant cycle device can be stably operated without reducing the COP even when a variation in the flow amount of the drive flow of the ejector 19 is caused, similarly to the 55th embodiment.

(97th Embodiment)

In the present embodiment, as in the entire schematic diagram of FIG. 151, the arrangement of the join portion 16 is changed similarly to 95th embodiment, with respect to the ejector-type refrigerant cycle device 500 of the 50th embodiment.

Next, operation of the present embodiment with the above structure will be described with reference to FIGS. 152A, 152B. In the cooling operation mode, the control device causes the first and second electrical motors 11*b*, 21*b* and the blower fans 53*a*, 54*a* to be operated, and controls the throttle open degree of the variable throttle mechanism 14*a*. Furthermore, similarly to 50th embodiment, the control device switches the first and second electrical four-way valve 51, 52. Thus, as in the solid arrows in FIG. 151, the following first, second and third refrigerant circuits are configured.

The first refrigerant circuit is configured so that the refrigerant flows in the circuit in this order of the first compressor 11→the first electrical four-way valve 51→the exterior heat exchanger 53→the first branch passage 13→the variable throttle mechanism 14*a*→the join portion 16→the middle-pressure side refrigerant passage 15*b* of the inner heat exchanger 15→the first compressor 11.

The second refrigerant circuit is configured so that the refrigerant flows in the circuit in this order of the first compressor 11→the first electrical four-way valve 51→the exterior heat exchanger 53→the first branch passage 13→the auxiliary exterior heat exchanger 53*b*→the high-pressure side refrigerant passage 15*a* of the inner heat exchanger 15→the first fixed throttle 17→the second branch portion 18→the pre-nozzle check valve 29→the ejector 19→the auxiliary using-side heat exchanger 54→the second electrical four-way valve 52→the second compressor 21→the join portion 16→the middle-pressure side refrigerant passage 15*b* of the inner heat exchanger 15→the first compressor 11.

The third refrigerant circuit is configured so that the refrigerant flows in the circuit in this order of the first compressor 11→the first electrical four-way valve 51→the exterior heat exchanger 53→the first branch passage 13→the auxiliary exterior heat exchanger 53*b*→the high-pressure side refrigerant passage 15*a* of the inner heat exchanger 15→the first fixed throttle 17→the second branch portion 18→the second fixed throttle 22→the using-side heat exchanger 55→the ejector 19→the auxiliary using-side heat exchanger 54→the second electrical four-way valve 52→the second compressor 21→the join portion 16→the middle-pressure side refrigerant passage 15*b* of the inner heat exchanger 15→the first compressor 11.

That is, in the cooling operation mode of the present embodiment, the exterior heat exchanger 53, the auxiliary using-side heat exchanger 54 and the using-side heat exchanger 55 are configured to respectively correspond to the radiator 12, the discharge side evaporator 20 and the suction side evaporator 23 of the 56th embodiment. Thus, as shown in FIG. 152A, the cooling operation mode of the present embodiment is performed similarly to that in FIG. 88 of the 56th embodiment, so as to cool the air of the room.

In contrast, in the heating operation mode, the control device causes the first and second electrical motors 11*b*, 21*b* and the blower fans 53*a*, 54*a* to be operated, and causes the variable throttle mechanism 14*a* to be in the fully close state. Furthermore, similarly to 50th embodiment, the control device switches the first and second electrical four-way valves 51, 52.

Thus, as in the chain arrows of FIG. 151, the refrigerant flows in the circuit in this order of the first compressor 11→the first and second electrical four-way valve 51, 52→the auxiliary using-side heat exchanger 54→the diffuser portion 19*c* of the ejector 19→the refrigerant suction port 19*b* of the ejector 19→the using-side heat exchanger 55→the second fixed throttle 22→the second branch passage 18→the first fixed throttle 17→the high-pressure side refrigerant passage 15*a* of the inner heat exchanger 15→the auxiliary exterior heat exchanger 53*b*→the first branch portion 13→the exterior heat exchanger 53→the first, second electrical four-way valve 51, 52→the second compressor 21→the join portion 16→the middle-pressure side refrigerant passage 15*b* of the inner heat exchanger 15→the first compressor 11.

Because the variable throttle mechanism 14*a* is in the fully close state, refrigerant does not flow from the first branch portion 13 toward the throttle mechanism 14*a*, and thereby heat exchange is substantially not performed in the inner heat exchanger 15.

That is, in the heating operation mode of the present embodiment, as in FIG. 152B, the ejector-type refrigerant cycle device 500 is operated similarly to FIG. 76B of the 50th embodiment, thereby heating air in the room.

The ejector-type refrigerant cycle device 500 of the present embodiment is operated above, and thereby the air in the room can be cooled in the cooling operation mode, and the air in the room can be heated in the heating operation mode. Furthermore, in the cooling operation mode using the ejector 19 as the refrigerant decompression portion, the ejector-type refrigerant cycle device can be stably operated without reducing the COP even when a variation in the flow amount of the drive flow of the ejector 19 is caused, similarly to the 56th embodiment.

(98th Embodiment)

In the present embodiment, as in the entire schematic diagram of FIG. 153, the arrangement of the join portion 16 is changed similar to the 95th embodiment, with respect to the ejector-type refrigerant cycle device 500 of the 51st embodiment.

Next, operation of the present embodiment with the above structure will be described with reference to FIGS. 154A, 154B. In the cooling operation mode, the control device causes the first and second electrical motors 11*b*, 21*b* and the blower fans 53*a*, 54*a* to be operated, and controls the throttle open degree of the variable throttle mechanism 14*a*. Furthermore, similarly to 51st embodiment, the control device switches the first and second electrical four-way valve 51, 52. Thus, as in the solid arrows in FIG. 153, the following first, second and third refrigerant circuits are configured.

The first refrigerant circuit is configured so that the refrigerant flows in the circuit in this order of the first compressor 11→the first electrical four-way valve 51→the exterior heat exchanger 53→the first branch passage 13→the variable throttle mechanism 14*a*→the join portion 16→the middle-pressure side refrigerant passage 15*b* of the inner heat exchanger 15→the first compressor 11.

The second refrigerant circuit is configured so that the refrigerant flows in the circuit in this order of the first compressor 11→the first electrical four-way valve 51→the exterior heat exchanger 53→the first branch passage 13→the auxiliary exterior heat exchanger 53*b*→the high-pressure side refrigerant passage 15*a* of the inner heat exchanger 15→the high-pressure side refrigerant passage 25*a* of the auxiliary inner heat exchanger 25→the first fixed throttle 17→the second branch portion 18→the pre-nozzle check valve 29→the ejector 19→the first, second electrical four-way valves 51, 52→the low-pressure side refrigerant passage 25*b* of the auxiliary inner heat exchanger 25→the second compressor 21→the join portion 16→the middle-pressure side refrigerant passage 15*b* of the inner heat exchanger 15→the first compressor 11.

The third refrigerant circuit is configured so that the refrigerant flows in the circuit in this order of the first compressor 11→the first electrical four-way valve 51→the exterior heat exchanger 53→the first branch passage 13→the auxiliary exterior heat exchanger 53*b*→the high-pressure side refrigerant passage 15*a* of the inner heat exchanger 15→the high-pressure side refrigerant passage 25*a* of the auxiliary inner heat exchanger 25→the first fixed throttle 17→the second branch portion 18→the second fixed throttle 22→the using-side heat exchanger 55→the ejector 19→the first, second electrical four-way valve 51, 52→the low-pressure side refrigerant passage 25*b* of the auxiliary inner heat exchanger 25→the second compressor 21→the join portion 16→the middle-pressure side refrigerant passage 15*b* of the inner heat exchanger 15→the first compressor 11.

That is, in the cooling operation mode of the present embodiment, the exterior heat exchanger 53, the auxiliary exterior heat exchanger 53*b* and the using-side heat exchanger 55 are configured to respectively correspond to the radiator 12, the auxiliary radiator 24 and the suction side evaporator 23 of the 57th embodiment. Thus, as shown in FIG. 154A, the cooling operation mode of the present embodiment is performed similarly to that in FIG. 90 of the 57th embodiment, so as to cool the air of the room.

In contrast, in the heating operation mode, the control device causes the first and second electrical motors 11*b*, 21*b* and the blower fans 53*a*, 54*a* to be operated, and causes the variable throttle mechanism 14*a* to be in the fully close state. Furthermore, similarly to 51st embodiment, the control device switches the first and second electrical four-way valves 51, 52.

Thus, as in the chain arrows of FIG. 153, the refrigerant flows in the circuit in this order of the first compressor 11→the first and second electrical four-way valve 51, 52→the diffuser portion 19*c* of the ejector 19→the refrigerant suction port 19*b* of the ejector 19→the using-side heat exchanger 55→the second-fixed throttle 22→the second branch passage 18→the first fixed throttle 17→the high-pressure side refrigerant passage 25*a* of the auxiliary inner heat exchanger 25→the high-pressure side refrigerant passage 15*a* of the inner heat exchanger 15→the first branch portion 13→the exterior heat exchanger 53→the first, second electrical four-way valve 51, 52→the low-pressure side refrigerant passage 25*b* of the auxiliary inner heat exchanger 25→the second compressor 21→the join portion 16→the middle-pressure side refrigerant passage 15*b* of the inner heat exchanger 15→the first compressor 11.

Because the variable throttle mechanism 14*a* is in the fully close state, refrigerant does not flow from the first branch portion 13 toward the throttle mechanism 14*a*, and thereby heat exchange is substantially not performed in the inner heat exchanger 15. Furthermore, the auxiliary inner heat exchanger 25 almost does not perform heat exchange, because a temperature difference between the refrigerant flowing through the high-pressure side refrigerant passage 25*a* and the refrigerant flowing through the low-pressure side refrigerant passage 25*b* is extremely small.

In the heating operation mode of the present embodiment, as shown in FIG. 154B, the ejector-type refrigerant cycle device is operated similarly to FIG. 78B of the 51st embodiment, so that the air inside the room can be heated.

The ejector-type refrigerant cycle device 500 of the present embodiment is operated above, and thereby the air in the room can be cooled in the cooling operation mode, and the air in the room can be heated in the heating operation mode. Furthermore, in the cooling operation mode using the ejector 19 as the refrigerant decompression portion, the ejector-type refrigerant cycle device can be stably operated without reducing the COP even when a variation in the flow amount of the drive flow of the ejector 19 is caused, similarly to the 57th embodiment.

(99th Embodiment)

In the present embodiment, as in the entire schematic diagram of FIG. 155, the arrangement of the join portion 16 is changed similarly to 95th embodiment, with respect to the ejector-type refrigerant cycle device 600 of the 52nd embodiment.

Next, operation of the present embodiment with the above structure will be described with reference to FIGS. 156A, 156B. In the cooling operation mode, the control device causes the first and second electrical motors 11*b*, 21*b* and the blower fans 531*a*, 532*a*, 54*a* to be operated, and controls the throttle open degree of the variable throttle mechanism 14*a* to a predetermined open degree. Furthermore, similarly to 52nd embodiment, the control device switches the first and second electrical four-way valve 51, 52.

Thus, in the cooling operation mode, as in the solid arrows in FIG. 155, the following first, second and third refrigerant circuits are configured.

The first refrigerant circuit is configured so that the refrigerant flows in the circuit in this order of the first compressor 11→the first electrical four-way valve 51→the first branch passage 13→the first exterior heat exchanger 531→the variable throttle mechanism 14*a*→the join portion 16→the middle-pressure side refrigerant passage 15*b* of the inner heat exchanger 15→the first compressor 11.

The second refrigerant circuit is configured so that the refrigerant flows, in the circuit in this order of the first compressor 11→the first electrical four-way valve 51→the first branch passage 13→the second exterior heat exchanger 532→the high-pressure side refrigerant passage 15*a* of the inner heat exchanger 15→the first fixed throttle 17→the second branch portion 18→the pre-nozzle check valve 29→the ejector 19→the auxiliary using-side heat exchanger 54→the first, second electrical four-way valves 51, 52→the second compressor 21→the join portion 16→the middle-pressure side refrigerant passage 15*b* of the inner heat exchanger 15→the first compressor 11.

The third refrigerant circuit is configured so that the refrigerant flows in the circuit in this order of the first compressor 11→the first electrical four-way valve 51→the first branch passage 13→the second exterior heat exchanger 532→the high-pressure side refrigerant passage 15*a* of the inner heat exchanger 15→the first fixed throttle 17→the second branch portion 18→the second fixed throttle 22→the using-side heat exchanger 55→the ejector 19→the auxiliary using-side heat exchanger 54→the first, second electrical four-way valves 51, 52→the second compressor 21→the join portion 16→the middle-pressure side refrigerant passage 15*b* of the inner heat exchanger 15→the first compressor 11.

That is, in the cooling operation mode of the present embodiment, the first exterior heat exchanger 531, the second exterior heat exchanger 532, the auxiliary using-side heat exchanger 54 and the using-side heat exchanger 55 are configured to respectively correspond to the first radiator 121, the second radiator 122, the discharge side evaporator 20 and the suction side evaporator 23 of the 60th embodiment. Thus, as shown in FIG. 156A, the cooling operation mode of the present embodiment is performed similarly to that in FIG. 96 of the 60th embodiment, so as to cool the air of the room.

In contrast, in the heating operation mode, similarly to 52nd embodiment, the control device switches the first and second electrical four-way valves 51, 52, and causes the variable throttle mechanism 14*a* in the fully close state, and operation of the first blower fan 531*a* is stopped.

Thus, as in the chain arrows of FIG. 155, the refrigerant flows in the circuit in this order of the first compressor 11→the first and second electrical four-way valve 51, 52→the auxiliary using-side heat exchanger 54→the diffuser portion 19*c* of the ejector 19→the refrigerant suction port 19*b* of the ejector 19→the using-side heat exchanger 55→the second fixed throttle 22→the second branch passage 18→the first fixed throttle 17→the high-pressure side refrigerant passage 15*a* of the inner heat exchanger 15→the second exterior heat exchanger 532→the first branch portion 13→the first, second electrical four-way valve 51, 52→the second compressor 21→the join portion 16→the middle-pressure side refrigerant passage 15*b* of the inner heat exchanger 15→the first compressor 11.

Because the variable throttle mechanism 14*a* is in the fully close state, refrigerant does not flow from the first branch portion 13 toward the throttle mechanism 14*a*, and thereby heat exchange is substantially not performed in the inner heat exchanger 15.

Figure 80B:
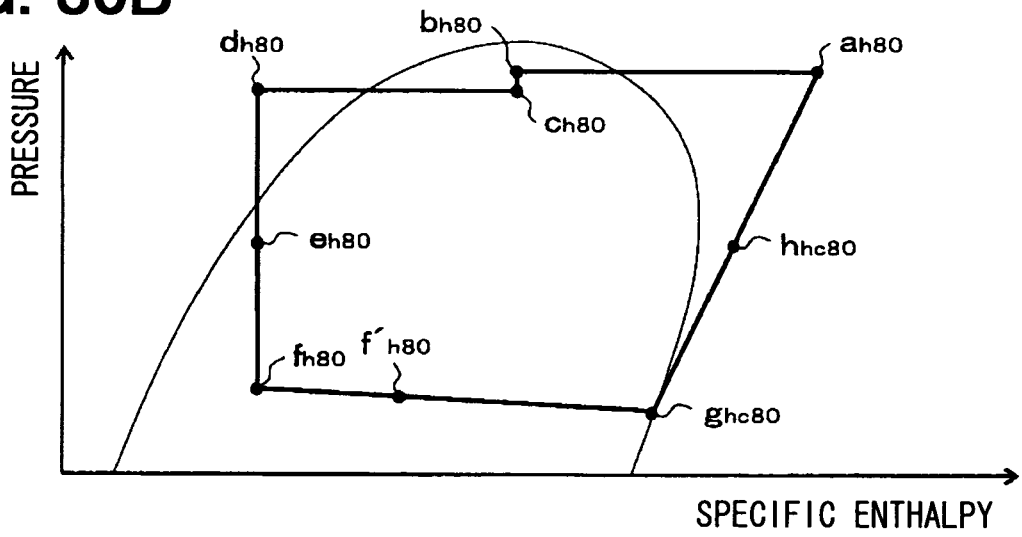
FIG. 80B is a Mollier diagram showing a refrigerant state in a heating operation mode according to the 52nd embodiment.

That is, in the heating operation mode of the present embodiment, as in FIG. 156B, the ejector-type refrigerant cycle device 600 is operated similarly to FIG. 80B of the 52nd embodiment, thereby heating air in the room.

The ejector-type refrigerant cycle device 600 of the present embodiment is operated above, and thereby the air in the room can be cooled in the cooling operation mode, and the air in the room can be heated in the heating operation mode. Furthermore, in the cooling operation mode using the ejector 19 as the refrigerant decompression portion, the ejector-type refrigerant cycle device can be stably operated without reducing the COP even when a variation in the flow amount of the drive flow of the ejector 19 is caused, similarly to the 60th embodiment.

(100th Embodiment)

In the present embodiment, as in the entire schematic diagram of FIG. 157, the arrangement of the join portion 16 is changed similarly to 95th embodiment, with respect to the ejector-type refrigerant cycle device 600 of the 53rd embodiment.

Next, operation of the present embodiment with the above structure will be described with reference to FIGS. 158A, 158B. In the cooling operation mode, the control device causes the first and second electrical motors 11*b*, 21*b* and the blower fans 531*a*, 532*a*, 54*a* to be operated, and controls the throttle open degree of the variable throttle mechanism 14*a* to a predetermined open degree. Furthermore, similarly to 53rd embodiment, the control device switches the first and second electrical four-way valve 51, 52.

Thus, in the cooling operation mode, as in the solid arrows in FIG. 157, the following first, second and third refrigerant circuits are configured.

The first refrigerant circuit is configured so that the refrigerant flows in the circuit in this order of the first compressor 11→the first electrical four-way valve 51→the first branch passage 13→the first exterior heat exchanger 531→the variable throttle mechanism 14*a*→the join portion 16→the middle-pressure side refrigerant passage 15*b* of the inner heat exchanger 15→the first compressor 11.

The second refrigerant circuit is configured so that the refrigerant flows in the circuit in this order of the first compressor 11→the first electrical four-way valve 51→the first branch passage 13→the second exterior heat exchanger 532→the high-pressure side refrigerant passage 15*a* of the inner heat exchanger 15→the high-pressure side refrigerant passage 25*a* of the auxiliary inner heat exchanger 25→the first fixed throttle 17→the second branch portion 18→the pre-nozzle check valve 29→the ejector 19→the first, second electrical four-way valves 51, 52→the low-pressure side refrigerant passage 25*b* of the auxiliary inner heat exchanger 25→the second compressor 21→the join portion 16→the middle-pressure side refrigerant passage 15*b* of the inner heat exchanger 15→the first compressor 11.

The third refrigerant circuit is configured so that the refrigerant flows in the circuit in this order of the first compressor 11→the first electrical four-way valve 51→the first branch passage 13→the second exterior heat exchanger 532→the high-pressure side refrigerant passage 15*a* of the inner heat exchanger 15→the high-pressure side refrigerant passage 25*a* of the auxiliary inner heat exchanger 25→the first fixed throttle 17→the second branch portion 18→the second fixed throttle 22→the using-side heat exchanger 55→the ejector 19→the first, second electrical four-way valves 51, 52→the low-pressure side refrigerant passage 25*b* of the auxiliary inner heat exchanger 25→the second compressor 21→the join portion 16→the middle-pressure side refrigerant passage 15*b* of the inner heat exchanger 15→the first compressor 11.

That is, in the cooling operation mode of the present embodiment, the first exterior heat exchanger 531, the second exterior heat exchanger 532, and the using-side heat exchanger 55 are configured to respectively correspond to the first radiator 121, the second radiator 122 and the suction side evaporator 23 of the 61st embodiment. Thus, as shown in FIG. 158A, the cooling operation mode of the present embodiment is performed similarly to that in FIG. 98 of the 61st embodiment, so as to cool the air of the room.

In contrast, in the heating operation mode, similarly to 53rd embodiment, the control device switches the first and second electrical four-way valves 51, 52, and causes the variable throttle mechanism 14*a* in the fully close state, and operation of the first blower fan 531*a* is stopped.

Thus, as in the chain arrows of FIG. 157, the refrigerant flows in the circuit in this order of the first compressor 11→the first and second electrical four-way valve 51, 52→the diffuser portion 19*c* of the ejector 19→the refrigerant suction port 19*b* of the ejector 19→the using-side heat exchanger 55→the second fixed throttle 22→the second branch passage 18→the first fixed throttle 17→the high-pressure side refrigerant passage 25*a* of the auxiliary inner heat exchanger 25→the high-pressure side refrigerant passage 15*a* of the inner heat exchanger 15→the first branch portion 13→the first, second electrical four-way valve 51, 52→the low-pressure side refrigerant passage 25*b* of the auxiliary inner heat exchanger 25→the second compressor 21→the join portion 16→the middle-pressure side refrigerant passage 15*b* of the inner heat exchanger 15→the first compressor 11.

Because the variable throttle mechanism 14*a* is in the fully close state, refrigerant does not flow from the first branch portion 13 toward the throttle mechanism 14*a*, and thereby heat exchange is substantially not performed in the inner heat exchanger 15. Furthermore, the auxiliary inner heat exchanger 25 almost does not perform heat exchange, because a temperature difference between the refrigerant flowing through the high-pressure side refrigerant passage 25*a* and the refrigerant flowing through the low-pressure side refrigerant passage 25*b* is extremely small.

Figure 82B:
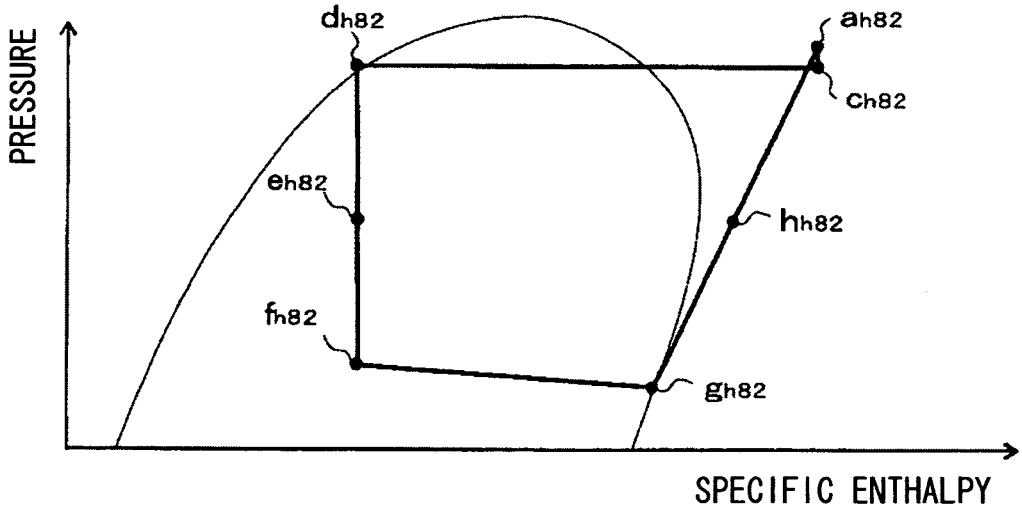
FIG. 82B is a Mollier diagram showing a refrigerant state in a heating operation mode according to the 53rd embodiment.

That is, in the heating operation mode of the present embodiment, as in FIG. 158B, the ejector-type refrigerant cycle device 600 is operated similarly to FIG. 82B of the 53rd embodiment, thereby heating air in the room.

The ejector-type refrigerant cycle device 600 of the present embodiment is operated above, and thereby the air in the room can be cooled in the cooling operation mode, and the air in the room can be heated in the heating operation mode. Furthermore, in the cooling operation mode using the ejector 19 as the refrigerant decompression portion, the ejector-type refrigerant cycle device can be stably operated without reducing the COP even when a variation in the flow amount of the drive flow of the ejector 19 is caused, similarly to the 61st embodiment.

(101st Embodiment)

In the present embodiment, as in the entire schematic diagram of FIG. 159, the second branch portion 18 of the 1st embodiment is removed, and a second branch portion 18*a* is used instead of the second branch portion 18. In the ejector-type refrigerant cycle device 100 of the present embodiment, the second branch portion 18*a* is used, so that a flow amount ratio Gnoz/Ge of a nozzle-side refrigerant flow amount Gnoz to a decompression-portion side refrigerant flow amount Ge is adjusted in accordance with a load in the refrigerant cycle.

Here, the decompression-side refrigerant flow amount Ge is a flow amount of the refrigerant flowing from the second branch portion 18*a* toward the second fixed throttle 22, and the nozzle-side refrigerant flow amount Gnoz is a flow amount of the refrigerant flowing from the second branch portion 18*a* toward the nozzle portion 19*a* of the ejector 19.

The second branch portion 18*a* is configured to have a centrifugal separator structure having therein an inner space, which causes the refrigerant flowing from the first fixed throttle 17 to generate a scroll flow. By the action of the centrifugal force caused due to the scroll flow of the refrigerant, a dryness distribution is generated in the refrigerant in the inner space of the second branch portion 18*a*. Refrigerant outlets, from which the refrigerant with predetermined dryness flows respectively toward the nozzle portion 19*a* and the second fixed throttle 22, are provided in the second branch portion 18*a*.

More specifically, the inner space of the second branch portion 18*a* of the present embodiment is formed into a cylindrical shape extending approximately vertically in its axial direction. The refrigerant outlet for introducing the refrigerant to the side of the nozzle portion 19*a* is arranged at a lower side of the inner space of the second branch portion 18*a*, and the refrigerant outlet for introducing the refrigerant to the side of the second fixed throttle 22 is arranged at an upper side of the refrigerant outlet for the side of the nozzle portion 19*a*.

The dryness of the refrigerant flowing toward the nozzle portion 19*a* and the dryness of the refrigerant flowing toward the second fixed throttle 22 are changed in accordance with the load of the refrigerant cycle, so as to adjust the flow amount ratio Gnoz/Ge.

For example, in a low load operation in which the load of the refrigerant cycle is decreased than that in the general operation mode, the refrigerant flow amount circulated in the refrigerant cycle is decreased, and refrigerant is distributed in the second branch portion 18*a* such that the dryness on the lower side is lower than that on the upper side in the inner space of the second branch portion 18*a*. Thus, in the low load operation, the mass flow amount of the nozzle-side refrigerant flow amount Gnoz relative to the decompression-portion side refrigerant flow amount Ge is increased, thereby increasing the flow amount ratio Gnoz/Ge as compared with the general operation mode.

In contrast, in a high load operation in which the load of the refrigerant cycle is increased than that in the general operation mode, the refrigerant flow amount circulated in the refrigerant cycle is increased, and refrigerant having the low dryness is also distributed at the upper side in the inner space of the second branch portion 18*a*. Thus, in the high load operation, the dryness of the refrigerant flowing toward the second fixed throttle 22 from the second branch portion 18*a* is approached to the dryness of the refrigerant flowing toward the nozzle portion 19*a* from the second branch portion 18*a*, thereby decreasing the flow amount ratio Gnoz/Ge as compared with the general operation mode. The other configurations are similar to the 1st embodiment.

Next, operation of the present embodiment will be described with reference to FIG. 160. The basic operation of the ejector-type refrigerant cycle device 100 of the present embodiment is similar to the 1st embodiment. In FIG. 160, the refrigerant states in the low load operation are indicated as the chain line, and the refrigerant states in the high load operation are indicated as the solid line.

The additional symbols showing the refrigerant states in the low load operation are indicated as "160L", and the additional symbols showing the refrigerant states in the high load operation are indicated as "160H". For easily clearly indicating the Mollier diagram in FIG. 160, the dimension of the vertical axis (pressure axis) is changed with respect to the Mollier diagram of FIG. 2.

First, in the low load operation, similarly to the 1st embodiment, the flow of the middle-pressure refrigerant (point $g_{160L}$ in FIG. 160) decompressed and expanded by the first fixed throttle 17 is branched by the second branch portion 18*a* into a flow of the refrigerant flowing into the nozzle portion 19*a* of the ejector 19 and a flow of the refrigerant flowing into the second fixed throttle 22. At this time, because the flow amount of the refrigerant circulating in the refrigerant cycle is decreased in the inner space of the second branch portion 18*a*, the refrigerant is distributed such that the dryness on the lower side is lower than that on the upper side in the inner space of the second branch portion 18*a*.

Thus, the dryness of the refrigerant (point $X_{1L}$ shown by white round in FIG. 160) flowing from the second branch portion 18*a* toward the nozzle portion 19*a* becomes lower than the dryness of the refrigerant (point $X_{2L}$ shown by white round in FIG. 160) flowing from the second branch portion 18*a* toward the second fixed throttle 22. Therefore, the mass flow amount of the nozzle-side refrigerant flow amount Gnoz is increased as compared with the decompression-side refrigerant flow amount Ge, thereby increasing the flow amount ratio Gnoz/Ge as compared with the general operation mode. The other operation is similar to that of the 1st embodiment.

Next, in the high load operation, similarly to the 1st embodiment, the flow of the middle-pressure refrigerant (point $g_{160H}$ in FIG. 160) decompressed and expanded by the first fixed throttle 17 is branched by the second branch portion 18*a* into a flow of the refrigerant flowing into the nozzle portion 19*a* of the ejector 19 and a flow of the refrigerant flowing into the second fixed throttle 22. At this time, because the flow amount of the refrigerant circulating in the refrigerant cycle is increased in the inner space of the second branch portion 18*a*, the refrigerant is distributed such that the dryness on the upper side is reduced similarly to that on the lower side in the inner space of the second branch portion 18*a*.

Thus, the dryness of the refrigerant (point $X_{1H}$ shown by white round in FIG. 160) flowing from the second branch portion 18*a* toward the nozzle portion 19*a* is approached to the dryness of the refrigerant (point $X_{2H}$ shown by white round in FIG. 160) flowing from the second branch portion 18*a* toward the second fixed throttle 22. Therefore, the flow amount ratio Gnoz/Ge is decreased as compared with the general operation mode. The other operation is similar to that of the 1st embodiment.

The ejector 19 draws the refrigerant from the refrigerant suction port 19*b* by the negative pressure generated due to the jet refrigerant jetted from the nozzle portion 19*a*. Furthermore, the speed energy of the mixed refrigerant between the jet refrigerant and the drawn refrigerant is converted to the pressure energy in the diffuser portion 19*c*. Thus, if the refrigerant supplied to the nozzle portion 19*a* of the nozzle 19, that is, the drive flow, is not secured, it is impossible to exert the refrigerant suction action and the pressurizing action.

That is, if the drive flow of the ejector 19 cannot be sufficiently secured, the pressurizing action cannot be obtained. In this case, the pressure of the suction refrigerant of the second compressor 21 is increased, and thereby it is difficult to reduce the drive force of the second compressor 21. In contrast, when liquid refrigerant or gas-liquid two-phase refrigerant is supplied to the section side evaporator 23, a required refrigerating capacity can be obtained.

In the present embodiment, in the low load operation in which the flow amount of the refrigerant circulating in the refrigerant cycle becomes smaller and the refrigerating capacity required in the suction side evaporator 23 becomes lower, because the flow amount ration Gnoz/Ge is increased than that in the general operation mode, the refrigerant flow amount required as the drive flow in the nozzle portion 19*a* of the ejector 19*s* is sufficiently supplied, and then the refrigerant flow amount required in the suction side evaporator 23 for obtaining the cooling capacity can be supplied.

On the other hand, in the high load operation in which the flow amount of the refrigerant circulating in the refrigerant cycle becomes larger and the refrigerating capacity required in the suction side evaporator 23 becomes higher, the flow amount ration Gnoz/Ge is decreased than that in the general operation mode. Thus, not only the refrigerant flow amount required as the drive flow in the nozzle portion 19*a* of the ejector 19*s* can be sufficiently supplied, but also the refrigerant flow amount required in the suction side evaporator 23 for obtaining the cooling capacity can be supplied.

Thus, according to the ejector-type refrigerant cycle device 100 of the present embodiment, the same effects as in the 1st embodiment can be obtained, and a high COP can be achieved regardless of the operation condition. That is, in a condition other than the operation condition in which the variation in the flow amount of the drive flow can be caused, the high COP can be achieved in the refrigerant cycle.

In the present embodiment, the second branch portion 18*a* with the centrifugal separation structure is described as an example; however, the structure of the second branch portion 18*a* is not limited to that. For example, as the second branch portion 18*a*, a flow amount distributor can be adapted, which can change the dryness of the refrigerant flowing toward the nozzle portion 19*a* and the dryness of the refrigerant flowing toward the second fixed throttle 22 in accordance with a variation in the load of the refrigerant cycle.

The second branch portion 18*a* of the present embodiment can be adapted to any ejector-cycle refrigerant cycle device of 3rd embodiment, 7th embodiment, 9th embodiment, 11th embodiment, 13th embodiment, 15th embodiment, 17th embodiment, 19th embodiment, 21st embodiment, 23rd embodiment, 25th embodiment, 27th embodiment, 29th embodiment, 31st embodiment, 33rd embodiment, 35th embodiment, 37th embodiment, 39th embodiment, 40th embodiment, 42nd embodiment, 43rd embodiment, 45th embodiment, 46th embodiment, 48th embodiment, 50th embodiment, 54th embodiment, 56th embodiment, 60th embodiment, 62nd embodiment, 64th embodiment, 66th embodiment, 68th embodiment, 70th embodiment, 72nd embodiment, 74th embodiment, 76th embodiment, 78th embodiment, 80th embodiment, 82nd embodiment, 84th embodiment, 85th embodiment, 86th embodiment, 89th embodiment, 90th embodiment, 92nd embodiment, 93rd embodiment, 95th embodiment, 97th embodiment, 99th embodiment.

More specifically, when the present embodiment is adapted to the 39th embodiment, 40th embodiment, 42nd embodiment, 43rd embodiment, 45th embodiment, 46th embodiment, 86th embodiment, 89th embodiment, 90th embodiment, 92nd embodiment, 93rd embodiment, the COP in the general operation mode can be improved. Furthermore, when the present embodiment is adapted to the 48th embodiment, 50th embodiment, 52nd embodiment, 95th embodiment, 97th embodiment, 99th embodiment, the COP in the cooling operation mode can be improved.

(102nd Embodiment)

In the present embodiment, as in the entire schematic diagram of FIG. 161, the first fixed throttle 17 of the 1st embodiment is removed, and an electrical first variable throttle mechanism 17*a* is arranged between the second branch portion 18 and the refrigerant inlet side of the nozzle portion 19*a* of the ejector 19, with respect to the 1st embodiment. Furthermore, in the present embodiment, with respect to the 1st embodiment, the second fixed throttle 22 is removed, and a variable throttle mechanism 22*a* similar to the 39th embodiment is arranged.

The basic structure of the first variable throttle mechanism 17*a* is similar to the variable throttle mechanism 22*a* of 39th embodiment. The operation of the first variable throttle mechanism 17*a* is controlled based on the control signal output from the control device 60. For clearly indicating the difference of the two variable throttle mechanisms 17*a*, 22*a*, the variable throttle mechanism 22*a* is indicated as "second variable throttle mechanism 22*a*".

An electrical control system of the present embodiment will be described with reference to FIG. 162. FIG. 162 is a block diagram showing the electrical control system of the present embodiment. The basic structure of a control device 60 of the present embodiment is similar to the 1st embodiment.

At the input side of the control device 60, a refrigerant-side load detection portion and an air-side load detection portion are connected. The refrigerant-side load detection portion is for detecting the physical amounts having a relationship with the refrigerant cycle load, such as a refrigerant temperature at the refrigerant inlet side of the discharge side evaporator 20, a refrigerant temperature at the refrigerant outlet side of the discharge side evaporator 20, a refrigerant temperature at the refrigerant inlet side of the suction side evaporator 23, a refrigerant temperature at the refrigerant outlet side of the suction side evaporator 23, a refrigerant temperature at the refrigerant inlet side of the middle-pressure side refrigerant passage 15*b* of the inner heat exchanger 15, a refrigerant temperature at the refrigerant outlet side of the middle-pressure side refrigerant passage 15*b* of the inner heat exchanger 15, a rotation speed of the first compressor 11, a rotation speed of the second compressor 21 or the like. The air-side load detection portion is for detecting the physical amounts having a relationship with the refrigerant cycle load, such as an outside air temperature, a room temperature of the refrigerator or the like.

The first and second variable throttle mechanisms 17*a*, 22*a*, the first and second electrical motors 11*b*, 21*b*, an operation panel or the like are connected to the outlet side of the control device 60. Thus, the control device 60 of the present embodiment functions as a first throttle capacity control portion 60*a* for controlling the operation of the first variable throttle mechanism 17*a* and as a second throttle capacity control portion 60*b* for controlling operation of the second variable throttle mechanism 22*a*, in addition to the control function of the 1st embodiment. The other configurations are similar to those of the 1st embodiment.

Next, operation of the present embodiment will be described. The basic operation of the ejector-type refrigerant cycle device 100 of the present embodiment is similar to the 1st embodiment. Next, detail control of the first and second variable throttle mechanisms 17*a*, 22*a* by using the control device 60 will be described.

In the present embodiment, the control device 60 determines a target flow amount ratio in accordance with the load state of the refrigerant cycle based on detection values of respective detection portions, and controls the operation of the first and second variable throttle mechanisms 17*a*, 22*a* such that the flow amount ratio Gnoz/Ge is approached to the target flow amount ratio.

Specifically, in a low load operation, the flow amount ratio Gnoz/Ge is controlled to be increased than that in the general operation mode, as the load of the refrigerant cycle decreases. In contrast, in a high load operation, the flow amount ratio Gnoz/Ge is controlled to be decreased than that in the general operation mode, as the load of the refrigerant cycle increases.

For example, the control device 60 controls the operation (valve open degree) of the first variable throttle mechanism 17*a* such that the super-heat degree of the suction refrigerant of the second compressor 21 becomes a predetermined value, and controls the operation (valve open degree) of the second variable throttle mechanism 22*a* so that the flow amount ratio Gnoz/Ge is approached to the target flow amount ratio in a state where the valve open degree of the first variable throttle 17*a* is maintained.

According to the ejector-type refrigerant cycle device 100 of the present embodiment, because the flow amount ratio Gnoz/Ge can be adjusted in accordance with the variation in the refrigerant cycle load similarly to 101st embodiment, a high COP can be achieved even in a condition other than the operation condition in which the variation in the flow amount of the drive flow can be caused.

In the present embodiment, the thermal expansion valve 14 is used as the high-pressure side decompression portion. However, as the high-pressure side decompression portion, an electrical variable throttle mechanism 14*a* may be used similarly to the 48th embodiment. In this case, the control portion 60 controls the variable throttle mechanism 14*a* in addition to the control of the first and second variable throttles 17*a*, 22*a*.

In this case, the operation (valve open degree) of the variable throttle mechanism 14*a* is controlled so that the super-heat degree of the suction refrigerant of the first compressor 11 becomes to a predetermined value, and the operation (valve open degree) of the first variable throttle mechanism 17*a* is controlled so that the super-heat degree of the suction refrigerant of the second compressor 21 becomes to a predetermined value. Furthermore, the operation of the second variable throttle mechanism 22*a* may be controlled so that the flow amount ratio Gnoz/Ge is approached to the target flow amount ratio, in a state where the valve open degrees of the variable throttle mechanism 14*a* and the first variable throttle 17*a* are maintained.

In the present embodiment, the first variable throttle mechanism 17*a* is arranged between the second branch portion 18 and the refrigerant inlet side of the nozzle portion 19*a* of the ejector 19. However, the first variable throttle mechanism 17*a* may be arranged between the high-pressure side refrigerant passage 15*a* of the inner heat exchanger 15 and the refrigerant inlet side of the second branch portion 18.

The adjustment of the flow amount ratio Gnoz/Ge due to the open degree control of the variable throttle mechanism 14*a*, 17*a*, 22*a* of the present embodiment can be adapted to any ejector-cycle refrigerant cycle device of 3rd embodiment, 7th embodiment, 9th embodiment, 11th embodiment, 13th embodiment, 15th embodiment, 17th embodiment, 19th embodiment, 21st embodiment, 23rd embodiment, 25th embodiment, 27th embodiment, 29th embodiment, 31st embodiment, 33rd embodiment, 35th embodiment, 37th embodiment, 39th embodiment, 40th embodiment, 42nd embodiment, 43rd embodiment, 45th embodiment, 46th embodiment, 48th embodiment, 50th embodiment, 52nd embodiment, 54th embodiment, 56th embodiment, 60th embodiment, 62nd embodiment, 64th embodiment, 66th embodiment, 68th embodiment, 70th embodiment, 72nd embodiment, 74th embodiment, 76th embodiment, 78th embodiment, 80th embodiment, 82nd embodiment, 84th embodiment, 85th embodiment, 86th embodiment, 89th embodiment, 90th embodiment, 92nd embodiment, 93rd embodiment, 95th embodiment, 97th embodiment, 99th embodiment.

More specifically, when the present embodiment is adapted to the 39th embodiment, 40th embodiment, 42nd embodiment, 43rd embodiment, 45th embodiment, 46th embodiment, 86th embodiment, 89th embodiment, 90th embodiment, 92nd embodiment, 93rd embodiment, the COP in the general operation mode can be improved. Furthermore, when the present embodiment is adapted to the 48th embodiment, 50th embodiment, 52nd embodiment, 95th embodiment, 97th embodiment, 99th embodiment, the COP in the cooling operation mode can be improved.

(103rd Embodiment)

In the present embodiment, the flow amount characteristics of the first fixed throttle 17, the second fixed throttle 22 and the nozzle portion 19*a* of the ejector 19 are set in the ejector-type refrigerant cycle device 100 of the 1st embodiment, as means for obtaining a suitable flow amount ratio Gnoz/Ge.

The inventors of the present application searched regarding relationships between the COP and the pressure difference between the refrigerant inlet and outlet in the fixed throttle 17 and nozzle portion 19*a*, when the decompression portions such as the fixed throttle 17, the second fixed throttle 22 and the nozzle portion 19*a* are formed as fixed throttles in which the refrigerant passage area (throttle passage area) cannot be changed similarly to the ejector-type refrigerant cycle device 100 of the 1st embodiment.

FIGS. 163A, 163B are diagrams for explaining the searched results. In the explanation of FIGS. 163A, 163B, the refrigerant pressure at the inlet side of the first fixed throttle 17 is Pdei, the refrigerant pressure at the inlet side of the nozzle portion 19*a* is Pnozi, and the refrigerant pressure at the outlet side of the nozzle portion 19*a* is Pnozo. The refrigerant pressure Pnozi at the inlet side of the nozzle portion 19*a* is determined by the flow amount characteristics (pressure loss characteristics) of the respective fixed throttles 17, 22, 19*a*.

More specifically, the refrigerant pressure Pnozi at the inlet side of the nozzle portion 19*a* is set so that a refrigerant flow amount G flowing into the second branch portion 18 via the first fixed throttle 17 is the total value of the refrigerant flow amount Ge on the side of the decompression portion and the refrigerant flow amount Gnoz on the side of the nozzle. At this time, because the nozzle portion 19*a* is formed as the fixed throttle, the pressure difference (Pnozi−Pnozo) between the refrigerant inlet and the refrigerant outlet of the nozzle portion 19*a* has a peak at which the nozzle efficiency can be most improved.

Here, the nozzle efficiency is the energy conversion efficiency when the pressure energy of the refrigerant is converted to the speed energy thereof in the nozzle portion 19*a*. Thus, in the Pnozi area where the nozzle efficiency is near to the peak point, when the flow amount characteristic (pressure loss characteristic) of the second fixed throttle 22 is determined so that the flow amount ratio Gnoz/Ge becomes a suitable value, the COP of the refrigerant cycle can be improved only by suitably controlling the refrigerant pressure Pnozi at the inlet side of the nozzle portion 19*a*.

The inventors of the present application determined the flow characteristic of the second fixed throttle 22 as described above, and searched regarding the relationships between a first pressure difference (Pdei−Pnozi), a second pressure difference (Pdei−Pnozo) and the COP. Here, the first pressure difference (Pdei−Pnozi) is the pressure difference between the refrigerant pressure Pdei at the inlet side of the fixed throttle 17 and the refrigerant pressure Pnozi the inlet side of the nozzle portion 19*a*, and the second pressure difference (Pdei−Pnozo) is the pressure difference between the refrigerant pressure Pdei at the inlet side of the fixed throttle 17 and the refrigerant pressure Pnozo at the outlet side of the nozzle portion 19*a*.

As shown in FIGS. 163A, 163B, the high COP can be obtained when the following formula F1 is satisfied.

$$0.1 \leq (Pdei-Pnozi)/(Pdei-Pnozo) \leq 0.6 \quad \text{(F1)}$$

The reasons are considered as follows. If the ratio of (Pdei−Pnozi)/(Pdei−Pnozo) is smaller than 0.1, the nozzle-side refrigerant flow amount Gnoz is too increased, thereby deteriorating the nozzle efficiency. In contrast, if the ratio of (Pdei−Pnozi)/(Pdei−Pnozo) becomes larger than 0.6, the nozzle-side refrigerant flow amount Gnoz is decreased, and thereby the drive flow of the ejector 19 cannot be sufficiently obtained.

As described above, as specific means for realizing the suitable flow amount ratio Gnoz/Ge, the flow amount characteristics of the first fixed throttle 17, the second fixed throttle 22 and the nozzle portion 19*a* of the ejector 19 are suitably set so that the first pressure difference (Pdei−Pnozi) becomes in a range of multiplying a value not smaller than 0.1 and not larger than 0.6, to the second pressure difference (Pdei−Pnozo).

Thus, according to the ejector-type refrigerant cycle device 100 of the present embodiment, a high COP can be achieved, regardless the operation condition, even in the operation condition in which the variation in the flow amount of the drive flow can be caused.

The adjustment of the flow amount ratio Gnoz/Ge, due to the regulation of the flow amount characteristics of the first fixed throttle 17, the second fixed throttle 22 and the nozzle portion 19*a* of the ejector 19, can be applied to the ejector-type refrigerant cycle device in the 2nd-32nd embodiments, 39th-79th embodiments, and 86th-100th embodiments. More specifically, when the present embodiment is adapted to the 39th-46th embodiments and 86th-94th embodiments, the COP in the general operation mode can be improved. Furthermore, when the present embodiment is adapted to 48th-53rd embodiments and 95th-100th embodiments, the COP in the cooling operation mode can be improved.

(104th Embodiment)

In the present embodiment, with respect to the ejector-type refrigerant cycle device 100 of the 1st embodiment, the dryness of the refrigerant flowing into the nozzle portion 19*a* of the ejector 19 is set as means for obtaining the suitable flow amount ratio Gnoz/Ge.

Even when the flow amount characteristics of the nozzle portion 19*a* and the second fixed throttle 22 are set, the flow amount ratio Gnoz/Ge may be changed in accordance with the variation in the load of the refrigerant cycle, because of the following reason that is one example. That is, the refrigerant flowing out of the second branch portion 18 is not in a uniform gas-liquid state, but is in an un-uniform state in which the liquid refrigerant and the gas refrigerant are distributed in un-uniform.

The inventors of the present application searched regarding relationship between the COP and a dryness X0 of the refrigerant flowing into the nozzle portion 19*a* of the ejector 19. FIG. 164 is a graph showing the searched result. According to FIG. 164, it is determined that the high COP can be obtained when the following formula F2 is satisfied.

$$0.003 \leq X0 \leq 0.14 \quad \text{(F2)}$$

The reason is follow. As in the 101st embodiment, even if the dryness of the refrigerant flowing into the nozzle portion 19*a* is not adjusted in accordance with the variation of the refrigerant cycle load, when the dryness of the refrigerant flowing into the nozzle portion 19*a* of the ejector 19 is in a predetermined range, it is possible to distribute the refrigerant having the same dryness from the second branch portion 18 toward the nozzle portion 19*a* and the second fixed throttle 22, while restricting an un-uniform distribution of the gas refrigerant and the liquid refrigerant in the refrigerant branched at the second branch portion 18.

In the present embodiment, as the specific means for obtaining the suitable flow amount ratio Gnoz/Ge, the first fixed throttle 17 is adapted to decompress and expand the refrigerant so that the dryness of the refrigerant flowing into the nozzle portion 19*a* becomes in a range not smaller than 0.003 and not larger than 0.14. Thus, according to the ejector-type refrigerant cycle device 100 of the present embodiment, a high COP can be achieved, regardless the operation condition, even in the operation condition in which the variation in the flow amount of the drive flow can be caused.

The adjustment of the flow amount ratio Gnoz/Ge, due to the regulation of the dryness X0 of the present embodiment, can be applied to the ejector-type refrigerant cycle device in the 2nd-32nd embodiments, 39th-79th embodiments, and 86th-100th embodiments. More specifically, when the present embodiment is adapted to the 39th-46th embodiments and 86th-94th embodiments, the COP in the general operation mode can be improved. Furthermore, when the present embodiment is adapted to 48th-53rd embodiments and 95th-100th embodiments, the COP in the cooling operation mode can be improved.

(105th Embodiment)

In the present embodiment, as shown by the entire schematic diagram of FIG. 165, a second auxiliary inner heat exchanger 35 is added, with respect to the ejector-type refrigerant cycle device 100 of the 1st embodiment. The basic structure of the second auxiliary inner heat exchanger 35 of the present embodiment is the same as that of the inner heat exchanger 15 of the 1st embodiment or the auxiliary inner heat exchanger 25 of the 2nd embodiment.

The second auxiliary inner heat exchanger 35 is configured to perform heat exchange between the refrigerant passing through a high-pressure side refrigerant passage 35*a*, having passed through the inner heat exchanger 15 from the first branch portion 13, and the refrigerant passing through a low-pressure side refrigerant passage 35*b*, which is the refrigerant flowing from the suction side evaporator 23 and to be drawn into the refrigerant suction port 19*b* of the ejector 19.

The refrigerant passing through the high-pressure side refrigerant passage 35*a* in the present embodiment is the refrigerant flowing through a refrigerant passage from an outlet side of the high-pressure side refrigerant passage 15*a* of the inner heat exchanger 15 toward the first fixed throttle 17. Thus, the refrigerant flowing toward the inner heat exchanger 15 from the first branch portion 13 flows in this order of the inner heat exchanger 15→the high-pressure side refrigerant passage 35*a* of the second auxiliary inner heat exchanger 35→the first fixed throttle 17. The other configurations are the same as those in the 1st embodiment.

Operation of the present embodiment with the above structure will be described based on the Mollier diagram of FIG. 166. When the ejector-type refrigerant cycle device 100 of the present embodiment is operated, the refrigerant flowing out of the suction side evaporator 23 flows through the low-pressure side refrigerant passage 35*b* of the second auxiliary inner heat exchanger 35, thereby increasing the enthalpy of the refrigerant (point $n_{166}$→point $n'_{166}$, in FIG. 166). Furthermore, the refrigerant flowing out of the low-pressure side refrigerant passage 35*a* is drawn into the ejector 19 from the refrigerant suction port 19*b* of the ejector 19 (point $n'_{166}$→point $i_{166}$, in FIG. 166).

The refrigerant flowing out of the high-pressure side refrigerant passage 15*a* of the inner heat exchanger 15 flows through the high-pressure side refrigerant passage 35*a* of the second auxiliary inner heat exchanger 35, thereby further decreasing the enthalpy of the refrigerant (point $f_{166}$→point $f'_{166}$, in FIG. 166). Furthermore, the refrigerant flowing out of the high-pressure side refrigerant passage 35*a* is decompressed and expanded in iso-enthalpy in the first fixed throttle 17 (point $f'_{166}$→point $g_{166}$, in FIG. 166), and then flows into the second branch portion 18.

The other operations of the present embodiment are similar to those of the above-described 1st embodiment. Thus, in the present embodiment, by the operation of the second auxiliary inner heat exchanger 35, the enthalpy of the refrigerant flowing into the discharge side evaporator 20 and the suction side evaporator 23 is reduced, and the refrigerating capacity obtained in the discharge side evaporator 20 and the suction side evaporator 23 can be increased, thereby further improving the COP.

In the present embodiment, the refrigerant flowing from the first branch portion 13 toward the inner heat exchanger 15 flows in this order of the inner heat exchanger 15→the second auxiliary inner heat exchanger 35→the first fixed throttle 17, and thereby the enthalpy of the refrigerant flowing to the discharge side evaporator 20 and the suction side evaporator 23 can be reduced. The reason is that the temperature of a low-pressure refrigerant flowing through the low-pressure side refrigerant passage 35*b* of the second auxiliary inner heat exchanger 35 is lower than a middle-pressure refrigerant flowing through the middle-pressure side refrigerant passage 15*b* of the inner heat exchanger 15.

In a case where a temperature difference between the middle pressure refrigerant and the low-pressure refrigerant becomes smaller, the second auxiliary inner heat exchanger 35 may be configured, such that the refrigerant flowing from the first branch portion 13 toward the inner heat exchanger 15 flows in this order of the second auxiliary inner heat exchanger 35→the inner heat exchanger 15→the first fixed throttle 17.

The second auxiliary inner heat exchanger 35 of the present embodiment can be adapted to the ejector-type refrigerant cycle device in any one of 2nd-47th embodiments, 54th-94th embodiments, 101st-104th embodiments.

Furthermore, when the present embodiment is adapted to a refrigerant cycle having the auxiliary inner heat exchanger 25 (here, referred to as "first auxiliary inner heat exchanger 25" to clearly indicate the difference from the second auxiliary inner heat exchanger 35), as in the 2nd embodiment, 4th embodiment, 8th embodiment, 10th embodiment, 12th embodiment, 14th embodiment, 16th embodiment, 18th embodiment, 20th embodiment, 22nd embodiment, 24th embodiment, 26th embodiment, 28th embodiment, 30th embodiment, 32nd embodiment, 34th embodiment, 36th embodiment, 38th embodiment, 41st embodiment, 44th embodiment, 47th embodiment, 55th embodiment, 57th embodiment, 61st embodiment, 63rd embodiment, 65th embodiment, 67th embodiment, 69th embodiment, 71st embodiment, 73rd embodiment, 75th embodiment, 77th embodiment, 79th embodiment, 81st embodiment, 83rd embodiment, 85th embodiment, 88th embodiment, 91st embodiment, 94th embodiment, the refrigerant flowing toward the inner heat exchanger 15 from the first branch portion 13 passes through in this order of the inner heat exchanger 15→the first auxiliary inner heat exchanger 25→the second auxiliary inner heat exchanger 35→the first fixed throttle 17, thereby effectively reducing the enthalpy of the refrigerant flowing into the suction side evaporator 23.

When the second auxiliary inner heat exchanger 35 of the present embodiment is adapted to the ejector-type refrigerant cycle device in any one of the 48th to 53rd embodiments and the 95th to 100th embodiments, the heating capacity in the heating operation mode may be decreased; however, the above-described COP improvement can be obtained in the cooling operation mode.

(106th Embodiment)

In the present embodiment, as shown by the entire schematic diagram of FIG. 167, the discharge side evaporator 20 is added, with respect to the ejector-type refrigerant cycle device 100 of the 2nd embodiment. That is, in the ejector-type refrigerant cycle device 100 of the present embodiment, the auxiliary inner heat exchanger 25 is added with respect to the ejector-type refrigerant cycle device 100 of the 1st embodiment.

The auxiliary inner heat exchanger 25 is configured to perform heat exchange between the refrigerant passing through a high-pressure side refrigerant passage 25*a*, having passed through the inner heat exchanger 15 from the first branch portion 13, and the refrigerant passing through a low-pressure side refrigerant passage 25*b* from the ejector 19 (i.e., from the discharge side evaporator 20). The other configurations are similar to those in the 2nd embodiment.

Operation of the present embodiment with the above structure will be described based on the Mollier diagram of FIG. 168. When the ejector-type refrigerant cycle device 100 of the present embodiment is operated, the refrigerant flowing out of the diffuser portion 19*c* is evaporated in the discharge side evaporator 20 by absorbing heat from air inside the room, circulated and blown by the blower fan 20*a* (point $j_{168}$→point $k_{168}$, in FIG. 168). Thus, the air inside the room is cooled.

The refrigerant flowing out of the discharge side evaporator 20 flows through the low-pressure side refrigerant passage 25*b* of the auxiliary inner heat exchanger 25, thereby increasing the enthalpy of the refrigerant (point $k_{168}$→point $k'_{168}$, in FIG. 168).

The refrigerant flowing out of the high-pressure side refrigerant passage 15*a* of the inner heat exchanger 15 flows through the high-pressure side refrigerant passage 25*a* of the auxiliary inner heat exchanger 25, thereby decreasing the enthalpy of the refrigerant (point $f_{168}$→point $f'_{168}$). Furthermore, the refrigerant flowing out of the high-pressure side refrigerant passage 25*a* is decompressed and expanded in iso-enthalpy in the first fixed throttle 17 (point $f'_{168}$→point $g_{168}$, in FIG. 168).

The other operations of the present embodiment are similar to those of the above-described 1st embodiment. Thus, in the present embodiment, by the operation of the auxiliary inner heat exchanger 25, the enthalpy of the refrigerant flowing into the discharge side evaporator 20 and the suction side evaporator 23 is reduced, and the refrigerating capacity obtained in the discharge side evaporator 20 and the suction side evaporator 23 can be increased, thereby further improving the COP.

In the present embodiment, the refrigerant flowing from the first branch portion 13 toward the inner heat exchanger 15 flows in this order of the inner heat exchanger 15→the auxiliary inner heat exchanger 25→the first fixed throttle 17, and thereby the enthalpy of the refrigerant flowing to the discharge side evaporator 20 and the suction side evaporator 23 can be reduced.

In a case where a temperature difference between the middle pressure refrigerant and the low-pressure refrigerant becomes smaller, the refrigerant flowing from the first branch portion 13 toward the inner heat exchanger 15 may flow in this order of the auxiliary inner heat exchanger 25→the inner heat exchanger 15→the first fixed throttle 17.

The discharge side evaporator 20 may be adapted to the ejector-type refrigerant cycle device in any one of 4th embodiment, 8th embodiment, 10th embodiment, 12th embodiment, 14th embodiment, 16th embodiment, 18th embodiment, 20th embodiment, 22nd embodiment, 24th embodiment, 26th embodiment, 28th embodiment, 30th embodiment, 32nd embodiment, 34th embodiment, 36th embodiment, 38th embodiment, 41st embodiment, 44th embodiment, 47th embodiment, 55th embodiment, 57th embodiment, 61st embodiment, 63rd embodiment, 65th embodiment, 67th embodiment, 69th embodiment, 71st embodiment, 73rd embodiment, 75th embodiment, 77th embodiment, 79th embodiment, 81st embodiment, 83rd embodiment, 85th embodiment, 88th embodiment, 91st embodiment, 94th embodiment. Even in this case, the refrigerating capacity in both the discharge side evaporator 20 and the suction side evaporator 23 can be obtained while improving the COP, similarly to the present embodiment.

Furthermore, the auxiliary inner heat exchanger 25 may be adapted to the ejector-type refrigerant cycle device in any one of 3rd embodiment, 6th embodiment, 7th embodiment, 9th embodiment, 11th embodiment, 13th embodiment, 15th embodiment, 17th embodiment, 19th embodiment, 21st embodiment, 23rd embodiment, 25th embodiment, 27th embodiment, 29th embodiment, 31st embodiment, 33rd embodiment, 35th embodiment, 37th embodiment, 39th embodiment, 40th embodiment, 42nd embodiment, 43rd embodiment, 45th embodiment, 46th embodiment, 54th embodiment, 56th embodiment, 60th embodiment, 62nd embodiment, 64th embodiment, 66th embodiment, 68th embodiment, 70th embodiment, 72nd embodiment, 74th embodiment, 76th embodiment, 78th embodiment, 80th embodiment, 82nd embodiment, 84th embodiment, 86th embodiment, 87th embodiment, 89th embodiment, 90th embodiment, 92nd embodiment, 94 embodiment, 101st-104th embodiments. Even in this case, the same effects of the present embodiment can be obtained.

In a case where the auxiliary inner heat exchanger 25 is added in addition to the discharge side evaporator 20 with respect to the ejector-type refrigerant cycle device of the 5th embodiment or 58th embodiment, the refrigerant flowing out of the discharge side evaporator 20 toward the accumulator 26 or gas refrigerant flowing out of the accumulator 26 may pass through the low-pressure side refrigerant passage 25*b* of the auxiliary inner heat exchanger 25. The same may be adapted to a case where the auxiliary inner heat exchanger 25 is added with respect to the ejector-type refrigerant cycle device of the 6th embodiment or 59th embodiment.

An auxiliary using-side heat exchanger 54 may be added as a structure corresponding to the discharge side evaporator 20 of the present embodiment, with respect to the ejector-type refrigerant cycle device in any one of the 49th embodiment, 51st embodiment, 53rd embodiment, 96th embodiment, 98th embodiment, 100th embodiment. In this case, the heating capacity in the heating operation mode may be decreased; however, the above-described effects can be obtained in the cooling operation mode.

(107th Embodiment)

In the present embodiment, as shown by the entire schematic diagram of FIG. 169, with respect to the ejector-type refrigerant cycle device 100 of the 1st embodiment, the arrangement of the high-pressure side refrigerant passage 15*a* of the inner heat exchanger 15 and the second branch portion 18 is changed, and the first fixed throttle 17 is arranged between the second branch portion 18 and the refrigerant inlet side of the nozzle portion 19*a* of the ejector 19.

Specifically, the second branch portion 18 is arranged to branch the flow of the refrigerant immediately flowing out of the first branch portion 13. Furthermore, the second branch portion 18 is arranged such that one-side refrigerant branched at the second branch portion 18 flows into the first fixed throttle 17, and the other-side refrigerant branched at the second branch portion 18 flows through the high-pressure side refrigerant passage 15*a* of the inner heat exchanger 15.

The inner heat exchanger 15 of the present embodiment is configured to perform heat exchange between the refrigerant passing through the high-pressure side refrigerant passage 15*a*, which is the refrigerant flowing from the second branch portion 18 toward the second fixed throttle 22, and the refrigerant passing through the middle-pressure side refrigerant passage 15*b* downstream of the thermal expansion valve 14. The other configurations are similar to those in the 1st embodiment.

Operation of the present embodiment with the above structure will be described based on the Mollier diagram of FIG. 170. When the ejector-type refrigerant cycle device 100 of the present embodiment is operated, the high-pressure side refrigerant branched at the first branch portion 13 and flowing toward the inner heat exchanger 15 is further branched at the second branch portion 18.

In the present embodiment, because the first and second branch portions 13, 18 are arranged adjacent to each other, a pressure loss and a temperature variation of the refrigerant while flowing from the first branch portion 18 to the second branch portion 18 may be ignored. Thus, on the Mollier diagram of FIG. 170, the first branch portion 13 (point $b_{170}$) and the second branch portion 18 (point $g_{170}$) correspond to each other.

The one-side refrigerant branched at the second branch portion 18 toward the first fixed throttle 17 flows into the first fixed throttle 17 to be, decompressed and expanded in iso-enthalpy (point $b_{170}$ (point $g_{170}$)→point $g'_{170}$, in FIG. 170), and then flows into the nozzle portion 19*a* of the ejector 19.

The other-side refrigerant branched at the second branch portion 18 flows into the high-pressure side refrigerant passage 15*a* of the inner heat exchanger 15 and is heat exchanged with the middle-pressure refrigerant flowing into the middle-pressure side refrigerant passage 15*b*, thereby reducing the enthalpy (point bin (point $g_{170}$)→point $f_{170}$, in FIG. 170). The refrigerant flowing out of the high-pressure side refrigerant passage 15*a* of the inner heat exchanger 15 flows into the second fixed throttle 22, and is decompressed and expanded in iso-enthalpy in the second fixed throttle 22 (point $f_{170}$→point $m_{170}$, in FIG. 170). The other operation is similar to the 1st embodiment.

Thus, in the present embodiment, the effects similar to those of the above-described 1st embodiment can be obtained. Furthermore, in the present embodiment, by the operation of the inner heat exchanger 15, the enthalpy of the refrigerant flowing from the second branch portion 18 to a side of the inner heat exchanger 15 can be reduced. Thus, an enthalpy difference between the refrigerant at the refrigerant inlet side of the suction side evaporator 23 and the refrigerant at the refrigerant outlet side of the suction side evaporator 23 can be enlarged, thereby increasing the refrigerating capacity of the suction side evaporator 23.

At this time, the enthalpy of the refrigerant flowing from the second branch portion 18 toward the first fixed throttle 17, that is, the enthalpy of the refrigerant flowing toward the nozzle portion 19*a* of the ejector 19 from the second branch portion 18 is not reduced in the inner heat exchanger 15. The COP can be further improved. That is, because the enthalpy of the refrigerant flowing into the nozzle portion 19*a* is not reduced unnecessarily, recovery energy amount in the nozzle portion 19*a* can be increased.

The reason will be described in more detail. The tilt of the iso-entropy line on the Mollier diagram of FIG. 170 is gradual as the enthalpy of the refrigerant flowing into the nozzle portion 19*a* increases. Thus, when the refrigerant is expanded in the nozzle portion 19*a* in iso-entropy by the same pressure, the enthalpy difference (recovery energy) between the enthalpy of the refrigerant at the inlet side of the nozzle portion 19*a* and the enthalpy of the refrigerant at the outlet side of the nozzle portion 19*a* can be made larger as the enthalpy of the refrigerant at the inlet side of the nozzle portion 19*a* becomes higher.

Thus, the recovery energy in the nozzle portion 19*a* increases as the enthalpy of the refrigerant flowing into the nozzle portion 19*a* increases. Therefore, in accordance with the increase of the recovery energy in the nozzle portion 19*a*, the pressurizing amount in the diffuser portion 19*c* can be increased (pressure difference between point $i_{170}$ and point $j_{170}$, in FIG. 170). As a result, the suction refrigerant of the second compressor 21 is pressurized, and thereby the COP can be further improved.

The arrangement structure, in which the position relationship between the inner heat exchanger 15 and the second branch portion 18 is changed and the first fixed throttle 17 is arranged between the second branch portion 18 and the inlet side of the nozzle portion 19*a* of the ejector 19, can be adapted to the ejector-type refrigerant cycle device in any one of 2nd embodiment, 3rd embodiment, 9th-12th embodiments, 15th-18th embodiments, 21st-24th embodiments, 27th-30th embodiments, 33rd-36th embodiments, 39th-44th embodiments, 54th-57th embodiments, 62nd-65th embodiments; 68th-71st embodiments, 74th-77th embodiments, 80th-83rd embodiments, 86th-91st embodiments.

In particular, in the refrigerant cycle having the auxiliary radiator 24 as in the 3rd embodiment, the other-side refrigerant branched at the first branch portion 13 may flow in this order of the auxiliary radiator 24→the second branch portion 18→the high-pressure side refrigerant passage 15*a* of the inner heat exchanger 15, or may flow in this order of the second branch portion 18→the auxiliary radiator 24→the high-pressure side refrigerant passage 15*a* of the inner heat exchanger 15.

The first branch portion 13 and the second branch portion 18 may be integrally formed. In this case, the configuration of the present embodiment can be easily realized. For example, the first branch portion 13 and the second branch portion 18 may be configured by a four-way joint. In this case, one refrigerant port among the four ports of the four-way joint is connected to a refrigerant outlet side of the radiator 12, the other three refrigerant ports among the four ports are respectively connected to the refrigerant inlet side of the thermal expansion valve 14, the refrigerant inlet side of the high-pressure side refrigerant passage 15*a* of the inner heat exchanger 15, and the refrigerant inlet side of the first fixed throttle 17.

(108th Embodiment)

In the present embodiment, as shown by the entire schematic diagram of FIG. 171, with respect to the ejector-type refrigerant cycle device 300 of the 7th embodiment, the position relationship between the inner heat exchanger 15 and the second branch portion 18 is changed, and the first fixed throttle 17 is arranged between the second branch portion 18 and the refrigerant inlet side of the nozzle portion 19*a* of the ejector 19.

Specifically, the second branch portion 18 is arranged to branch the flow of the refrigerant immediately flowing out of the second radiator 122. Furthermore, the second branch portion 18 is arranged such that one-side refrigerant branched at the second branch portion 18 flows into the first fixed throttle 17, and the other-side refrigerant branched at the second branch portion 18 flows through the high-pressure side refrigerant passage 15*a* of the inner heat exchanger 15. The other configurations are similar to those in the 7th embodiment.

Operation of the present embodiment with the above structure will be described based on the Mollier diagram of FIG. 172. When the ejector-type refrigerant cycle device 300 of the present embodiment is operated, the high-pressure side refrigerant flowing out of the second radiator 122 is branched at the second branch portion 18 (point $b_{172}$ in FIG. 172). The one-side refrigerant branched at the second branch portion 18 flows into the first fixed throttle 17 to be decompressed and expanded in iso-enthalpy (point $b2_{172}$→point $g'_{172}$, in FIG. 172), and then flows into the nozzle portion 19*a* of the ejector 19.

The other-side refrigerant branched at the second branch portion 18 flows into the high-pressure side refrigerant passage 15*a* of the inner heat exchanger 15 and is heat exchanged with the middle-pressure refrigerant flowing into the middle-pressure side refrigerant passage 15*b*, thereby reducing the enthalpy (point $b2_{172}$→point $f_{172}$, in FIG. 172). The refrigerant flowing out of the high-pressure side refrigerant passage 15*a* of the inner heat exchanger 15 flows into the second fixed throttle 22, and is decompressed and expanded in iso-enthalpy in the second fixed throttle 22 (point $f_{172}$→point $m_{172}$, in FIG. 172).

The other operation is similar to the 7th embodiment. Thus, in the present embodiment, the effects similar to those of the above-described 7th embodiment can be obtained. Furthermore, in the present embodiment, the refrigerating capacity of the suction side evaporator 23 can be increased and the COP is improved, because the enthalpy of the refrigerant flowing toward the nozzle portion 19*a* of the ejector 19 is not reduced unnecessary, similarly to 107th embodiment.

The arrangement structure, in which the position relationship between the inner heat exchanger 15 and the second branch portion 18 is changed and the first fixed throttle 17 is arranged between the second branch portion 18 and the inlet side of the nozzle portion 19*a* of the ejector 19, can be adapted to the ejector-type refrigerant cycle device in any one of 8th embodiment, 13th embodiment, 14th embodiment, 19th embodiment, 20th embodiment, 25th embodiment, 26th embodiment, 31st embodiment, 32nd embodiment, 37th embodiment, 38th embodiment, 45th embodiment, 46th embodiment, 47th embodiment, 60th embodiment, 61st embodiment, 66th embodiment, 67th embodiment, 72nd embodiment, 73rd embodiment, 78th embodiment, 79th embodiment, 84th embodiment, 85th embodiment, 92nd-94th embodiment.

(109th Embodiment)

In the present embodiment, as shown by the entire schematic diagram of FIG. 173, with respect to the ejector-type refrigerant cycle device 100 of the 105th embodiment, the arrangement of the second auxiliary inner heat exchanger 35 and the second branch portion 18 is changed, and the first fixed throttle 17 is arranged between the second branch portion 18 and the refrigerant inlet side of the nozzle portion 19*a* of the ejector 19.

Specifically, the second branch portion 18 is arranged to branch the flow of the refrigerant immediately flowing out of the high-pressure side refrigerant passage 15*a* of the inner heat exchanger 15. Furthermore, the second branch portion 18 is arranged such that one-side refrigerant branched at the second branch portion 18 flows into the first fixed throttle 17, and the other-side refrigerant branched at the second branch portion 18 flows through the high-pressure side refrigerant passage 35*a* of the second auxiliary inner heat exchanger 35.

The second auxiliary inner heat exchanger 35 of the present embodiment is configured to perform heat exchange between the refrigerant passing through the high-pressure side refrigerant passage 35*a*, which is the refrigerant to flow toward the second fixed throttle 22 from the second branch portion 18, and the refrigerant passing through the low-pressure side refrigerant passage 35*b*, which is the refrigerant from the suction side evaporator 23 and to be drawn into the refrigerant suction port 19*b* of the ejector 19. The other configurations are the same as those in the 105th embodiment.

Operation of the present embodiment with the above structure will be described based on the Mollier diagram of FIG. 174. When the ejector-type refrigerant cycle device 100 of the present embodiment is operated, the refrigerant flowing out of the suction side evaporator 23 flows through the low-pressure side refrigerant passage 35*b* of the second auxiliary inner heat exchanger 35, thereby increasing the enthalpy of the refrigerant (point $n_{174}$→point $n'_{174}$, in FIG. 174).

Furthermore, the refrigerant flowing out of the low-pressure side refrigerant passage 35*a* is drawn into the ejector 19 from the refrigerant suction port 19*b* of the ejector 19 (point $n'_{174}$→point $i_{174}$, in FIG. 174). Furthermore, the one-side refrigerant branched at the second branch portion 18 flows into the first fixed throttle 17 to be decompressed and expanded in iso-enthalpy (point $f_{174}$→point $g_{174}$, in FIG. 174), and then flows into the nozzle portion 19*a* of the ejector 19.

The other-side refrigerant branched at the second branch portion 18 flows into the high-pressure side refrigerant passage 35*a* of the second auxiliary inner heat exchanger 35, thereby reducing the enthalpy (point $f_{174}$→point $f'_{174}$, in FIG. 174). The refrigerant flowing out of the high-pressure side refrigerant passage 35*a* flows into the second fixed throttle 22, and is decompressed and expanded in iso-enthalpy in the second fixed throttle 22 (point $f'_{174}$→point $m_{174}$, in FIG. 174).

The other operation is similar to the 105th embodiment. Thus, in the present embodiment, the effects similar to those of the above-described 1st embodiment can be obtained. Furthermore, in the present embodiment, by the operation of the second auxiliary inner heat exchanger 35, the enthalpy of the refrigerant flowing into the suction side evaporator 23 is reduced, and the refrigerating capacity obtained in the suction side evaporator 23 can be increased.

At this time, the enthalpy of the refrigerant flowing from the second branch portion 18 toward the first fixed throttle 17, that is, the enthalpy of the refrigerant flowing into the nozzle portion 19*a* of the ejector 19 is not reduced unnecessary in the second auxiliary inner heat exchanger 35. Thus, similarly to 107th embodiment, the COP can be further improved.

The arrangement structure, in which the arrangement of the second auxiliary inner heat exchanger 35 and the second branch portion 18 is changed and the first fixed throttle 17 is arranged between the second branch portion 18 and the inlet side of the nozzle portion 19*a* of the ejector 19, can be adapted to the ejector-type refrigerant cycle device in the embodiments to which the second auxiliary inner heat exchanger 35 can be applied as described in the 105th embodiment.

In the refrigerant cycle to which the second auxiliary inner heat exchanger 35 can be adapted, the second branch portion 18 may be arranged between the first branch portion 13 and the high-pressure side refrigerant passage 15*a* of the inner heat exchanger 15. Thus, the enthalpy of the refrigerant flowing into the nozzle portion 19*a* of the ejector 19 is not reduced unnecessary in the inner heat exchanger 15.

When the second auxiliary inner heat exchanger 35 is adapted to a refrigerant cycle having the auxiliary inner heat exchanger 25 as the first auxiliary inner heat exchanger, the second branch portion 18 may be arranged between the first auxiliary inner heat exchanger 25 and the second auxiliary inner heat exchanger 35, and the refrigerant flowing from the first branch portion 13 toward the inner heat exchanger 15 flows in this order of the inner heat exchanger 15→the first auxiliary inner heat exchanger 25→the second auxiliary inner heat exchanger 35.

When the second auxiliary inner heat exchanger 35 is adapted to a refrigerant cycle having the auxiliary radiator 24 as in the 3rd embodiment, the second branch portion 18 may be arranged between the refrigerant outlet port of the first branch portion 13 and the refrigerant inlet side of the auxiliary radiator 24, or may be arranged between the refrigerant outlet side of the auxiliary radiator 24 and the refrigerant inlet side of the high-pressure side refrigerant passage 15*a* of the inner heat exchanger 15.

(110th Embodiment)

In the present embodiment, as shown by the entire schematic diagram of FIG. 175, with respect to the ejector-type refrigerant cycle device 100 of the 106th embodiment, the arrangement of the auxiliary inner heat exchanger 25 and the second branch portion 18 is changed, and the first fixed throttle 17 is arranged between the second branch portion 18 and the refrigerant inlet side of the nozzle portion 19*a* of the ejector 19.

Specifically, the second branch portion 18 is arranged to branch the flow of the refrigerant immediately flowing out of the high-pressure side refrigerant passage 15*a* of the inner heat exchanger 15. Furthermore, the second branch portion 18 is arranged such that one-side refrigerant branched at the second branch portion 18 flows into the first fixed throttle 17, and the other-side refrigerant branched at the second branch portion 18 flows through the high-pressure side refrigerant passage 25*a* of the auxiliary inner heat exchanger 25.

The auxiliary inner heat exchanger 25 of the present embodiment is configured to perform heat exchange between the refrigerant passing through the high-pressure side refrigerant passage 25*a*, which is the refrigerant having passed through the high-pressure side refrigerant passage 15*a* of the inner heat exchanger 15, and the refrigerant passing through the low-pressure side refrigerant passage 25*b* from the discharge side evaporator 20. The other configurations are the same as those in the 106th embodiment.

Operation of the present embodiment with the above structure will be described based on the Mollier diagram of FIG. 176. When the ejector-type refrigerant cycle device 100 of the present embodiment is operated, the refrigerant flowing out of the discharge side evaporator 20 flows through the low-pressure side refrigerant passage 25*b* of the auxiliary inner heat exchanger 25, thereby increasing the enthalpy of the refrigerant (point $k_{176}$→point $k'_{176}$, in FIG. 176).

Furthermore, the refrigerant flowing out of the high-pressure side refrigerant passage 15*a* of the inner heat exchanger 15 is branched in the second branch portion 18. The one-side refrigerant branched at the second branch portion 18 flows into the first fixed throttle 17 to be decompressed and expanded in iso-enthalpy (point $f_{176}$→point $g_{176}$, in FIG. 176), and then flows into the nozzle portion 19*a* of the ejector 19.

The other-side refrigerant branched at the second branch portion 18 flows into the high-pressure side refrigerant passage 25*a* of the auxiliary inner heat exchanger 25, thereby reducing the enthalpy (point $f_{176}$→point $f'_{176}$; in FIG. 176). The refrigerant flowing out of the high-pressure side refrigerant passage 25*a* flows into the second fixed throttle 22, and is decompressed and expanded in iso-enthalpy in the second fixed throttle 22 (point $f'_{176}$→point $m_{176}$, in FIG. 176).

The other operation is similar to the 106th embodiment. Thus, in the present embodiment, the effects similar to those of the above-described 1st embodiment can be obtained. Furthermore, in the present embodiment, by the operation of the auxiliary inner heat exchanger 25, the enthalpy of the refrigerant flowing into the suction side evaporator 23 is reduced, and the refrigerating capacity obtained in the suction side evaporator 23 can be increased, similarly to the 106th embodiment.

At this time, the enthalpy of the refrigerant flowing from the second branch portion 18 toward the first fixed throttle 17, that is, the enthalpy of the refrigerant flowing into the nozzle portion 19*a* of the ejector 19 is not reduced unnecessary in the auxiliary inner heat exchanger 25. Thus, similarly to 107th embodiment, the COP can be further improved.

The arrangement structure, in which the arrangement of the auxiliary inner heat exchanger 25 and the second branch portion 18 is changed and the first fixed throttle 17 is arranged between the second branch portion 18 and the inlet side of the nozzle portion 19*a* of the ejector 19, can be adapted to the ejector-type refrigerant cycle device in the embodiments to which the discharge side evaporator 20 described in the 106th embodiment can be added.

In the refrigerant cycle to which the discharge side evaporator 20 is added, the second branch portion 18 may be arranged between the first branch portion 13 and the high-pressure side refrigerant passage 15*a* of the inner heat exchanger 15. Thus, the enthalpy of the refrigerant flowing into the nozzle portion 19*a* of the ejector 19 is not reduced unnecessary in the inner heat exchanger 15.

When the second auxiliary inner heat exchanger 35 of the present embodiment is adapted to a refrigerant cycle having the auxiliary radiator 24, the second branch portion 18 may be arranged between the first branch portion 13 and the auxiliary radiator 24, or may be arranged between the auxiliary radiator 24 and the high-pressure side refrigerant passage 15*a* of the inner heat exchanger 15.

(111th Embodiment)

In the present embodiment, as shown by the entire schematic diagram of FIG. 177, with respect to the ejector-type refrigerant cycle device 100 of the 106th embodiment, the discharge side evaporator 20 is removed, the arrangement of the auxiliary inner heat exchanger 25 and the second branch portion 18 is changed, and the first fixed throttle 17 is arranged between the second branch portion 18 and the refrigerant inlet side of the nozzle portion 19*a* of the ejector 19.

That is, in the ejector-type refrigerant cycle device 100 of the present embodiment, with respect to the ejector-type refrigerant cycle device 100 of the 2nd embodiment, the arrangement of the auxiliary inner heat exchanger 25 and the second branch portion 18 is changed, and the first fixed throttle 17 is arranged between the second branch portion 18 and the refrigerant inlet side of the nozzle portion 19*a* of the ejector 19.

Operation of the present embodiment with the above structure will be described based on the Mollier diagram of FIG. 178. When the ejector-type refrigerant cycle device 100 of the present embodiment is operated, the refrigerant flowing out of the diffuser portion 19*c* flows through the low-pressure side refrigerant passage 25*b* of the auxiliary inner heat exchanger 25, thereby increasing the enthalpy of the refrigerant (point $j_{178}$→point $k_{178}$, in FIG. 178).

The other-side refrigerant branched at the second branch portion 18 flows into the high-pressure side refrigerant passage 25*a* of the auxiliary inner heat exchanger 25, thereby reducing the enthalpy (point $f_{178}$→point $f'_{178}$, in FIG. 178). The other operation is similar to 106th embodiment.

Thus, in the present embodiment, the effects similar to those of the above-described 2nd embodiment can be obtained. Furthermore, in the present embodiment, by the operation of the auxiliary inner heat exchanger 25, the enthalpy of the refrigerant flowing into the suction side evaporator 23 is reduced, and the refrigerating capacity obtained in the suction side evaporator 23 can be increased, similarly to the 106th embodiment.

At this time, the enthalpy of the refrigerant flowing from the second branch portion 18 toward the first fixed throttle 17, that is, the enthalpy of the refrigerant flowing into the nozzle portion 19*a* of the ejector 19 is not reduced unnecessary in the auxiliary inner heat exchanger 25. Thus, similarly to 107th embodiment, the COP can be further improved.

The arrangement structure, in which the arrangement of the auxiliary inner heat exchanger 25 and the second branch portion 18 is changed and the first fixed throttle 17 is arranged between the second branch portion 18 and the inlet side of the nozzle portion 19*a* of the ejector 19, without providing the discharge side evaporator 20, can be adapted to the ejector-type refrigerant cycle device in the embodiments to which the discharge side evaporator 20 described in the 106th embodiment can be added.

Furthermore, in the refrigerant cycles described above, the second branch portion 18 may be arranged between the first branch portion 13 and the high-pressure side refrigerant passage 15*a* of the inner heat exchanger 15. Thus, the enthalpy of the refrigerant flowing into the nozzle portion 19*a* of the ejector 19 is not reduced unnecessary in the inner heat exchanger 15.

In a refrigerant cycle having the auxiliary radiator 24 as in the 4th embodiment, the second branch portion 18 may be arranged between the first branch portion 13 and the auxiliary radiator 24, or may be arranged between the auxiliary radiator 24 and the high-pressure side refrigerant passage 15*a* of the inner heat exchanger 15.

(112th Embodiment)

In the present embodiment, with respect to the ejector-type refrigerant cycle device 100 of the 39th embodiment, the connection state of the bypass passage is changed. The bypass passage 28 of the present embodiment is connected such that the refrigerant after passing through the radiator 12, in the high-pressure refrigerant discharged from the first compression portion 11*a* of the first compressor 11, is introduced to the suction side evaporator 23 via the bypass passage 28, as shown in FIG. 179.

More specifically, the bypass passage 28 is configured by a refrigerant pipe connected to a position between the refrigerant outlet side of the radiator 12 and the first branch portion 13, and to a position between the variable throttle mechanism 22*a* and the suction side evaporator 23. The other cycle configurations are similar to the 39th embodiment.

An electrical control system of the present embodiment will be described with reference to FIG. 180. FIG. 180 is a block diagram showing the electrical control system of the present embodiment. The basic structure of a control device 60 of the present embodiment is similar to the 39th embodiment. At the input side of the control device 60, various detection portions similar to the 102nd embodiment and an operation panel 61 are connected. The operation panel 61 includes an operation mode switch which can selectively switches between the general operation mode and the defrosting operation mode.

At the outlet side of the control device 60, the first and second electrical motors 11*b*, 21*b*, the cooling fan 12*a*, the variable throttle mechanism 22*a*, the opening/closing valve 28*a* and the like are connected. Thus, the control device 60 functions as a radiating capacity control portion 60*c* which controls the operation of the cooling fan 12*a* as the heat-radiating capacity adjusting portion.

Operation according to the present embodiment will be described. In the ejector-type refrigerant cycle device 100 of the present embodiment, by the operation of the operation mode switch, it is possible to selectively switch between the general operation mode for cooling the room, and the defrosting operation mode for performing defrosting in the suction side evaporator 23 and the discharge side evaporator 20, similarly to the 39th embodiment.

In the general operation mode, the control device 60 causes the opening/closing valve 28*a* to be in a valve close state and causes the variable throttle mechanism 22*a* to be set at a predetermined throttle open degree. Thus, in the general operation mode, the present embodiment is operated similarly to the Mollier diagram shown in FIG. 54A of the 39th embodiment, so as to cool the interior of the room.

In contrast, in the defrosting operation mode, the control device 60 causes the cooling fan 12 to be stopped, causes the variable throttle mechanism 22*a* to be in a fully open state, and causes the opening/closing valve 28*a* to be opened. Thus, in the defrosting operation mode, the present embodiment is operated similarly to the defrosting operation mode of the 39th embodiment of FIG. 54B, and thereby the defrosting of the suction side evaporator 23 and the discharge side evaporator 20 can be performed.

Even when the refrigerant after passing through the radiator 12 flows into the bypass passage 28 in the defrosting operation mode as in the present embodiment, the radiating capacity control portion 60*c* causes the cooling fan 12*a* to be stopped thereby reducing the heat-radiating capacity of the radiator 12. Thus, the temperature of the refrigerant flowing into the bypass passage 28 is not largely reduced. Accordingly, in the present embodiment, the defrosting of the suction side evaporator 23 and the discharge side evaporator 20 can be performed similarly to the 39th embodiment.

In the present embodiment, the refrigerant inlet side of the bypass passage 28 is arranged between the refrigerant outlet side of the radiator 12 and the first branch portion 13. However, the refrigerant inlet side of the bypass passage 28 may be arranged between the first branch portion 13 and the high-pressure side refrigerant passage 15*a* of the inner heat exchanger 15, or may be arranged between the first branch portion 13 and the thermal expansion valve 14.

The deformation of the arrangement of the refrigerant inlet side of the bypass passage 28 can be adapted to the ejector-type refrigerant cycle device of any one of the 40th-44th embodiments and 86th-91st embodiments. In particular, the refrigerant cycle having the auxiliary radiator 24 of the 42nd embodiment, because the cooling fan 12*a* is stopped in the defrosting operation mode, the heat radiating capacity of the auxiliary radiator 24 is decreased. Thus, the refrigerant inlet side of the bypass passage 28 may be arranged in any passage from the refrigerant outlet side of the radiator 12 and the high-pressure side refrigerant passage 15*a* of the inner heat exchanger 15.

(113th Embodiment)

In the present embodiment, with respect to the ejector-type refrigerant cycle device 300 of the 45th embodiment, the connection state of the bypass passage 28 is changed. The bypass passage 28 of the present embodiment is connected such that the refrigerant after passing through the second radiator 122, among the high-pressure refrigerant discharged from the first compression portion 11*a* of the first compressor 11, is introduced to the suction side evaporator 23 via the bypass passage 28, as shown in FIG. 181.

More specifically, the bypass passage 28 is configured by a refrigerant pipe connected to a position between the refrigerant outlet side of the second radiator 122 and the first branch portion 13, and to a position between the variable throttle mechanism 22*a* and the suction side evaporator 23. The other cycle configurations are similar to the 45th embodiment.

An electrical control system of the present embodiment will be described with reference to FIG. 182. FIG. 180 is a block diagram showing the electrical control system of the present embodiment. The basic structure of a control device 60 of the present embodiment is similar to the 45th embodiment. At the input side of the control device 60, various detection portions similar to the 102nd embodiment and an operation panel 61 are connected. The operation panel 61 includes an operation mode switch which can selectively switches between the general operation mode and the defrosting operation mode.

At the outlet side of the control device 60, the first and second electrical motors 11*b*, 21*b*, the first and second cooling fans 121*a*, 122*a*, the variable throttle mechanism 22*a*, the opening/closing valve 28*a* and the like are connected. Thus, the control device 60 functions as first and second radiating capacity control portions 60*d*, 60*e* which respectively control the operation of the first and second cooling fans 121*a*, 122*a* as the heat-radiating capacity adjusting portion.

Operation according to the present embodiment will be described. In the ejector-type refrigerant cycle device 300 of the present embodiment, by the operation mode switch, it is possible to selectively switch between the general operation mode for cooling the room, and the defrosting operation mode for performing the defrosting in the suction side evaporator 23 and the discharge side evaporator 20, similarly to the 39th embodiment.

In the general operation mode, the control device 60 causes the opening/closing valve 28*a* to be in a valve close state and causes the variable throttle mechanism 22*a* to be set at a predetermined throttle open degree. Thus, in the general operation mode, the present embodiment is operated similarly to the Mollier diagram shown in FIG. 66A of the 45th embodiment, so as to cool the interior of the room.

In contrast, in the defrosting operation mode, the second radiating capacity control portion 60*e* of the control device 60 causes the second cooling fan 122*a* to be stopped, and the control device 60 causes the variable throttle mechanism 22*a* to be in a fully open state and causes the opening/closing valve 28*a* to be opened. Thus, in the defrosting operation mode, the present embodiment is operated similarly to the defrosting operation mode of the 45th embodiment of FIG. 66B, and thereby the defrosting of the suction side evaporator 23 and the discharge side evaporator 20 can be performed.

Even when the refrigerant after passing through the second radiator 122 flows into the bypass passage 28 in the defrosting operation mode as in the present embodiment, the radiating capacity control portion 60*e* causes the second cooling fan 122*a* to be stopped thereby reducing the heat-radiating capacity of the second radiator 122. Thus, the temperature of the refrigerant flowing into the bypass passage 28 may be not largely reduced. Accordingly, in the present embodiment, the defrosting of the suction side evaporator 23 and the discharge side evaporator 20 can be performed similarly to the 45th embodiment.

In the present embodiment, the refrigerant inlet side of the bypass passage 28 is arranged between the refrigerant outlet side of the second radiator 122 and the high-pressure side refrigerant passage 15*a* of the inner heat exchanger 15. However, the refrigerant inlet side of the bypass passage 28 may be arranged between the refrigerant outlet side of the first radiator 121 and the thermal expansion valve 14. Furthermore, the deformation of the arrangement of the refrigerant inlet side of the bypass passage 28 can be adapted to the ejector-type refrigerant cycle device of any one of the 46th, 47th embodiments and 92nd-94th embodiments.

(Other Embodiments)

The invention is not limited to the disclosed embodiments, and various modifications can be made to the embodiments as follows.

(1) In the above-described respective embodiments, the refrigerant discharge capacity of the second compressor 21 is controlled so that the refrigerant suction action can be exerted in the ejector 19, and the refrigerant discharge capacity of the second compressor 21 is controlled so that the refrigerant pressure discharged from the first compressor 11 is increased unnecessarily. However, it is preferable to control the pressurizing amounts of the first and second compression portions 11*a*, 21*a* to be approximately equal.

The reason is follows. That is, when the pressurizing amounts of the first and second compression portions 11*a*, 21*a* are controlled to be approximately equal, the compression efficiency of the first and second compression portions 11*a*, 21*a* can be improved, and the COP in the ejector-cycle refrigerant cycle device can be improved.

Here, the compression efficiency is a ratio of $\Delta H1/\Delta H2$, in which $\Delta H1$ is an increase amount of the enthalpy of the refrigerant when the refrigerant is decompressed in iso-entropy in the first and second compressors 11, 21, and $\Delta H2$ is an increase amount of the enthalpy when the refrigerant is pressurized actually in the first and second compressors 11, 21.

In the above described embodiments, respective compressors are used as the first and second compressors 11, 21. However, the first and second compressors 11, 21 may be integrated, and the first compression portion 11*a* and the second compression portion 21*a* may be driven by an electrical motor which is used in common for the first and second compression portions 11*a*, 21*a*.

(2) In the above-described embodiments, electrical compressors are used as the first and second compressors 11, 21. However, the type of the first and second compressors 11, 21 is not limited to it.

For example, a variable-displacement type compressor that is driven by a driving source such as an engine for adjusting the refrigerant discharge capacity by the change of the discharge capacity may be used as the first and second compressors 11, 21. In this case, the discharge capacity changing portion is a displacement changing portion. A fixed-displacement type compressor, which is connected to a driving source to be interrupted by using an electromagnetic clutch so as to adjust the discharge capacity of the refrigerant, may be used as the first and second compressors 11, 21. In this case, the electromagnetic clutch is the discharge capacity changing portion.

The same type compressors or different-type compressors may be used for the first and second compressors 11, 21.

In a case where the same type compressors are used as the first and second compressors, if the first and second compressors 11, 21 are formed integrally as the compressor 10 as in the 27th-32nd, an inlet port for introducing the refrigerant may be provided in a compression stage in a single compression mechanism (e.g., scroll-type compression mechanism), a compression stage from the suction port to the inlet port is configured as the second compressor 21, and a compression stage from the inlet port to the discharge port is configured as the first compressor 11.

(3) in the above-described respective embodiments, a fixed-type ejector, in which a throttle passage area of the nozzle portion 19*a* is fixed, is used as the ejector 19. However, a variable-type ejector, in which a throttle passage area of the nozzle portion 19*a* is variable, may be used as the ejector 19.

For example, in the 48th-53rd embodiments and 95th-100th embodiments, a variable-type ejector may be used as the ejector 19. In this case, if the throttle passage of the variable-type ejector is made in a fully close state in the heating operation mode, it can prevent a reverse flow of the refrigerant from the diffuser portion to the nozzle portion in the ejector, thereby omitting the pre-nozzle check valve 29.

Furthermore, in the above-described 48th-53rd embodiments and 95th-100th embodiments, the variable throttle mechanism 14*a* is fully closed in the heating operation mode; however, may be set at a valve open state. Thus, a fixed throttle may be used as the high-pressure side decompression portion.

In the above-described respective embodiments, a first fixed throttle is used as the pre-nozzle decompression portion; however, a variable throttle mechanism may be used as the pre-nozzle decompression portion. For example, a thermal expansion valve or an electrical expansion valve, which adjusts the throttle open degree so that the super-heat degree of the refrigerant at the refrigerant outlet side of the suction side evaporator 23 becomes in a predetermined range, may be used as the suction side decompression portion.

Furthermore, in the above-described respective embodiments, the second fixed throttle 22 or the electrical variable throttle mechanism 22*a* is used as examples of the suction side decompression portion; however, a thermal expansion valve, which adjusts the throttle open degree so that the super-heat degree of the refrigerant at the refrigerant outlet side of the suction side evaporator 23 becomes in a predetermined range, may be used as the suction side decompression portion.

In the above-described 1st-47th embodiments and 54th-94th embodiments, the discharge side evaporator 20 and the suction side evaporator 23 are adapted to cool the same space to be cooled; however, the respective evaporators 20, 23 may be adapted to cool different spaces to be cooled. For example, the suction side evaporator 23 may be adapted to cool a freezer space, and the discharge side evaporator 20 which has a refrigerant evaporation temperature higher than that of the suction side evaporator 23 may be adapted to cool a cold storage space or to perform air-conditioning.

In the above-described 1st-47th embodiments and 54th-94th embodiments, the discharge side evaporator and the suction side evaporator are adapted as the using side heat exchanger adapted in the 33rd-38th embodiments and 80th-85th embodiments, and the radiator 12, the first and second radiators 121, 122 are adapted as an exterior heat exchanger. Conversely, the discharge side evaporator 20 and the suction side evaporator 23 may be adapted as an exterior heat exchanger which absorbs heat from a heat source such as atmosphere, and the radiator 12 may be adapted as a using side heat exchanger for heating a fluid to be heated such as air or water, so as to configure a heat pump cycle.

(5) In the above-described 33rd-38th embodiments and 80th-85th embodiments, the carbon dioxide is used as the refrigerant so as to configure a super-critical refrigerant cycle. In the above-described 33rd-38th embodiments and 80th-85th embodiments, a pre-nozzle decompression portion may be further provided. For example, a pressure control valve may be used to adjust the refrigerant pressure on the high-pressure side to be approached to a target pressure that is determined based on the temperature of the refrigerant at the refrigerant outlet side of the radiator 12 or the second radiator 122 such that the COP becomes approximately maximum.

The pressure control valve may have a temperature sensing portion located at the refrigerant outlet side of the radiator 12 or the second radiator 122, and may be configured to generate a pressure inside the temperature sensing portion corresponding to the temperature of the high-pressure refrigerant on the refrigerant outlet side of the radiator 12, so as to adjust mechanically the valve open degree based on a balance between the inner pressure of the temperature sensing portion and the refrigerant pressure on the refrigerant outlet side of the radiator 12.

(6) In the above-described 39th-47th embodiments, 86th-94th embodiments, 112th embodiment and 113th embodiment, the switch operation between the general operation mode and the defrosting operation mode is performed based on the operation signal from the switch of the operation panel; however, the switch operation between the general operation mode and the defrosting operation mode is not limited to the above.

For example, the control device may be adapted to alternately switch between the general operation mode and the defrosting operation mode by a predetermined time period. Specifically, when the general operation mode is continuously performed for a first predetermined time, the defrosting operation mode may be switched from the general operation mode. Furthermore, when the defrosting operation mode is continuously performed for a second predetermined time, the general operation mode may be switched from the defrosting operation mode.

(7) The configuration features described in any one of the respective embodiments may be applied to another embodiment, if there are no a contradiction. For example, in the above-described 1st-6th embodiments and 12th-14th embodiments, the discharge side evaporator is not provided. However, in those embodiments, the discharge side evaporator 20 may be provided. In this case, the discharge side evaporator 20 may be adapted to cool the interior of a refrigerator.

For example, in the above-described 7th-40th embodiments, the variable throttle mechanism 22*a* and the check valve 19*b* may be used as the suction side decompression portion, or a decompression-integrated check valve may be used as the suction side decompression portion.

In the respective embodiments without providing a discharge-side gas-liquid separator and a suction-side gas-liquid separator, the discharge-side gas-liquid separator and the suction-side gas-liquid separator may be added. In the 7th-25th embodiments, the high-pressure side decompression portion may be arranged in a refrigerant passage from the outlet side of the second branch portion 18 to the refrigerant inlet side of the nozzle portion 19*a* of the ejector 19.

As the inner heat exchanger 15 (or the auxiliary inner heat exchanger 25) described in the above embodiments, a counter-parallel flow heat exchanger or an identical-parallel flow heat exchanger may be adapted. In the counter-parallel flow heat exchanger, a flow direction of the refrigerant flowing through the high-pressure side refrigerant passage is different from a flow direction of the refrigerant flowing through the low-pressure side refrigerant passage. In the identical-parallel flow heat exchanger, the flow direction of the refrigerant flowing through the high-pressure side refrigerant passage is identical to the flow direction of the refrigerant flowing through the low-pressure side refrigerant passage.

(9) In the above-described 103rd embodiment, the first fixed throttle 17, the second fixed throttle 22 and the nozzle portion 19*a* of the ejector 19 are adapted as fixed throttles, and the flow amount characteristics of the respective fixed throttles 17, 22, 19*a* are determined such that the Pdei, the Pnozi and the Pnozo are satisfied as in the formula F1. However, the first fixed throttle 17, the second fixed throttle 22 and the nozzle portion 19*a* of the ejector 19 are not limited as the fixed throttles.

For example, in the ejector-type refrigerant cycle device 100 of the 102nd embodiment, the open degrees of the variable throttle mechanisms 14*a*, 17*a*, 22*a* may be controlled such that the Pdei, the Pnozi and the Pnozo are satisfied as in the formula F1. Alternatively, only the first fixed throttle 17 may be changed as a variable throttle mechanism, and the open degrees of the variable throttle mechanism may be controlled such that the Pdei, the Pnozi and the Pnozo are satisfied as in the formula F1.

In the above-described 104th embodiment, the first fixed throttle 17, the second fixed throttle 22 and the nozzle portion 19*a* of the ejector 19 are adapted as fixed throttles, and the flow amount characteristics of the respective fixed throttles 17, 22, 19*a* are determined such that the dryness is satisfied as in the formula F2. However, the first fixed throttle 17, the second fixed throttle 22 and the nozzle portion 19*a* of the ejector 19 are not limited to the fixed throttles.

For example, in the ejector-type refrigerant cycle device 100 of the 102nd embodiment, the open degrees of the variable throttle mechanisms 14*a*, 17*a*, 22*a* may be controlled such that the X0 is satisfied as in the formula F2. Alternatively, only the first fixed throttle 17 may be changed as a variable throttle mechanism, and the open degrees of the variable throttle mechanism may be controlled such that the X0 is satisfied as in the formula F2.

(10) In the above-described embodiments, Freon-based refrigerant or carbon dioxide refrigerant is used as the refrigerant in the ejector-type refrigerant cycle device 100-300; however, the refrigerant is not limited to it. For example, carbon hydride (CH) type refrigerant may be used as the refrigerant.

(11) In the above-described respective embodiments, each of the various-type heat exchangers, such as the radiators 12, 121, 122, the discharge side evaporator 20, the suction side evaporator 23, the using-side heat exchanger 55 and the auxiliary using-side heat exchanger 54 is described as a single structure; however, the structure of the heat exchangers is not limited to the above. For example, instead of the single-structure heat exchanger, plural small-type heat exchangers may be arranged in series or in parallel with respect to the refrigerant flow. In this case, heat exchanging performance similar to that in the single structure heat exchanger can be obtained by combining the plural small-type heat exchangers, and the mounting performance can be improved as compared with the single structure heat exchanger.

In the above-described respective embodiments, the ejector-type refrigerant cycle device 100-300 of the present invention is adapted to a refrigerator; however, it is not limited to be adapted to the refrigerator. For example, the ejector-type refrigerant cycle device may be adapted as a fixed-type refrigerant cycle device for an air conditioner, a cold storage unit, a cooling device for an automatic selling machine, or the like. Alternatively, the ejector-type refrigerant cycle device may be adapted as a vehicle refrigerant cycle device for a vehicle air conditioner, a vehicle refrigerator or the like.

(13) In the 39th-47th embodiments, 86th-94th embodiments, 112th embodiment and 113th embodiment, the respective cooling fans 12*a*, 121*a*, 122*a* are stopped so as to decrease the radiating capacity of the respective radiators 12, 121, 122 (radiating degree is zero). However, the means for reducing the radiating capacity of the respective radiators 12, 121, 122 is not limited to it.

For example, a shutting portion for shutting the flow of the cool air flowing from the cooling fan 12*a* to the radiator 12 may be provided between the cooling fan 12*a* and the radiator 12, so that the flow of the cool air toward the radiator 12 may be shut by the shutting portion in the defrosting operation mode.

The above-described embodiments and deformations thereof can include the following aspects.

According to one aspect of the present invention, an ejector-type refrigerant cycle device includes: a first compression portion (11*a*) which compresses and discharges refrigerant; a radiator (12) which cools high-pressure refrigerant discharged from the first compression portion (11*a*); a first branch portion (13) which branches a flow of the refrigerant flowing out of the radiator (12); a high-pressure side decompression portion (14) which decompresses and expands the refrigerant of one side branched at the first branch portion (13); a second branch portion (18, 18*a*) which branches a flow of the refrigerant of the other side branched at the first branch portion (13); an ejector (19) which draws refrigerant from a refrigerant suction port (19*b*) by a flow of high-speed jet refrigerant jetted from a nozzle portion (19*a*) in which the refrigerant of one side branched at the second branch portion (18, 18*a*) is decompressed and expanded, and mixes the jet refrigerant and the refrigerant drawn from the refrigerant suction port (19*b*) to be pressurized; a second compression portion (21*a*) which draws the refrigerant flowing from the ejector (19), and compresses and discharges the drawn refrigerant; a suction side decompression portion (22, 22*a*) which decompresses and expands the refrigerant of the other side branched at the second branch portion (18, 18*a*); a suction side evaporator (23) which evaporates the refrigerant decompressed and expanded by the suction side decompression portion (22, 22*a*), and causes the evaporated refrigerant to flow toward the refrigerant suction port (19*b*); a join portion (16) adapted to join a flow of the refrigerant discharged from the second compression portion (21*a*) and a flow of the refrigerant decompressed and expanded by the high-pressure side decompression portion (14), and to cause the joined refrigerant to flow toward a suction side of the first compression portion (11*a*); and an inner heat exchanger (15) which performs heat exchange between the refrigerant downstream of the high-pressure side decompression portion (14) and the refrigerant of the other side branched at the first branch portion (13).

For example, in the ejector-type refrigerant cycle device, a first auxiliary inner heat exchanger (25) may be provided to perform heat exchange between the refrigerant flowing from the ejector (19) and the refrigerant of the other side branched at the first branch portion (13). Furthermore, a second auxiliary inner heat exchanger (35) may be provided to perform heat exchange between the refrigerant to be drawn into the refrigerant suction port (19*b*) and the refrigerant of the other side branched at the first branch portion (13). Furthermore, an auxiliary radiator (24) may be provided to cool the refrigerant of the other side branched at the first branch portion (13). Furthermore, a discharge side evaporator (20) may be located between an outlet side of the ejector (19) and a suction side of the second compression portion (21*a*), to evaporate the refrigerant flowing out of the ejector (19).

In the ejector-type refrigerant cycle device, when a refrigerant flow amount flowing from the second branch portion (18*a*) to the nozzle portion (19*a*) is as a nozzle-side refrigerant flow amount (Gnoz) and a refrigerant flow amount flowing from the second branch portion (18*a*) toward the suction side decompression portion (22, 22*a*) is as a decompression-side refrigerant flow amount (Ge), the second branch portion (18*a*) may be configured such that a flow amount ratio (Gnoz/Ge) of the nozzle-side refrigerant flow amount (Gnoz) to the decompression-side refrigerant flow amount (Ge) can be adjusted in accordance with a variation of a cycle load. Furthermore, in a low load operation in which the cycle load is decreased than a general operation, the flow amount ratio (Gnoz/Ge) may be increased than that in the general operation. Alternatively, in a high load operation in which the cycle load is increased than the general operation, the flow amount ratio (Gnoz/Ge) may be decreased than that in the general operation.

For example, the suction side decompression portion may be an electrical variable throttle mechanism (22) configured to change its refrigerant passage area, and the ejector-type refrigerant cycle device may be provided with a throttle capacity control portion (60*b*) which controls operation of the variable throttle mechanism (22). In this case, the control portion controls operation of the variable throttle mechanism (22*a*) so as to adjust the flow amount ratio (Gnoz/Ge).

According to another aspect of the present invention, an ejector-type refrigerant cycle device includes: a first compression portion (11*a*) which compresses and discharges refrigerant; a radiator (12) which cools high-pressure refrigerant discharged from the first compression portion (11*a*); a first branch portion (13) which branches a flow of the refrigerant flowing out of the radiator (12); a high-pressure side decompression portion (14) which decompresses and expands the refrigerant of one side branched at the first branch portion (13); an ejector (19) which draws refrigerant from a refrigerant suction port (19*b*) by a flow of high-speed jet refrigerant jetted from a nozzle portion (19*a*) in which the refrigerant of the other side branched at the first branch portion (13) is decompressed and, expanded, and mixes the jet refrigerant and the refrigerant drawn from the refrigerant suction port (19*b*) to be pressurized; a discharge side gas-liquid separator (26) which separates the refrigerant flowing out of the ejector (19) into gas refrigerant and liquid refrigerant; a second compression portion (21*a*) which draws gas refrigerant separated at the discharge-side gas-liquid separator (26), and compresses and discharges the drawn refrigerant; a suction side decompression portion (22) which decompresses and expands the liquid refrigerant separated at the discharge side gas-liquid separator (26); a suction side evaporator (23) which evaporates the refrigerant decompressed and expanded by the suction side decompression portion (22), and causes the evaporated refrigerant to flow toward the refrigerant suction port (19*b*); a join portion (16) adapted to join a flow of the refrigerant discharged from the second compression portion (21*a*) and a flow of the refrigerant decompressed and expanded by the high-pressure side decompression portion (14), and to cause the joined refrigerant to flow toward a suction side of the first compression portion (11*a*); an inner heat exchanger (15) which performs heat exchange between the refrigerant downstream of the high-pressure side decompression portion (14) and the refrigerant of the other side branched at the first branch portion (13); and an oil return passage (27) configured to communicate a refrigerant outlet side of the suction side evaporator (23) with a suction side of the second compressor (21*a*) so as to return oil mixed in the refrigerant to a side of the second compression portion (21*a*).

For example, in the ejector-type refrigerant cycle device, a first auxiliary inner heat exchanger (25) may be provided to perform heat exchange between the refrigerant flowing from the ejector (19) and the refrigerant of the other side branched at the first branch portion (13). Furthermore, a second auxiliary inner heat exchanger (35) may be provided to perform heat exchange between the refrigerant to be drawn into the refrigerant suction, port (19*b*) and the refrigerant of the other side branched at the first branch portion (13). Furthermore, a discharge side evaporator (20) may be located between an outlet side of the ejector (19) and an inlet side of the discharge side gas-liquid separator (26), to evaporate the refrigerant flowing out of the ejector (19).

In any above-described ejector-type refrigerant cycle device, a high-pressure side gas-liquid separator (12*b*, 24*b*) may be provided to separate the refrigerant flowing from the radiator (12) into gas refrigerant and liquid refrigerant, and to introduce the separated liquid refrigerant toward downstream. Furthermore, the radiator (12) may be provided with a condensation portion (12*c*) which condenses the refrigerant, a gas-liquid separation portion (12*d*) which separates the refrigerant flowing out of the condensation portion (12*c*) into gas refrigerant and liquid refrigerant, and a super-cool portion (12*e*) which super-cools the liquid refrigerant flowing out of the gas-liquid separator (12*d*). Furthermore, a bypass passage (28) through which the high-pressure refrigerant discharged from the first compression portion (11*a*) is introduced to the suction side evaporator (23), and an opening/closing portion (28*a*) for opening and closing the bypass passage (28) may be provided. Alternatively, a bypass passage (28) through which the high-pressure refrigerant discharged from the first compression portion (11*a*) is introduced to the discharge side evaporator (20), and an opening/closing portion (28*a*) for opening and closing the bypass passage (28) may be provided.

In any above-described ejector-type refrigerant cycle device, a radiation capacity adjusting portion (12*a*) adjusting a radiation capacity of the radiator (12) may be further provided. In this case, the high-pressure refrigerant discharged from the first compression portion (11*a*) is the refrigerant flowing out of the radiator (12). The radiation capacity adjusting portion (12*a*) can reduce the radiation capacity of the radiator (12) when the opening/closing portion (28*a*) opens the bypass passage (28).

According to another aspect of the present invention, an ejector-type refrigerant cycle device includes: a first compression portion (11*a*) which compresses and discharges refrigerant; a first branch portion (13) which branches a flow of high-pressure refrigerant discharged from the first compression portion (11*a*); a first radiator (121) which cools the refrigerant of one side branched at the first branch portion (13); a second radiator (122) which cools the refrigerant of the other side branched at the first branch portion (13); a high-pressure side decompression portion (14) which decompresses and expands the refrigerant cooled at the first radiator (121); a second branch portion (18, 18*a*) which branches a flow of the refrigerant cooled at the second radiator (122); an ejector (19) which draws refrigerant from a refrigerant suction port (19*b*) by a flow of high-speed jet refrigerant jetted from a nozzle portion (19*a*) in which the refrigerant of one side branched at the second branch portion (18, 18*a*) is decompressed and expanded, and mixes the jet refrigerant and the refrigerant drawn from the refrigerant suction port (19*b*) to be pressurized; a second compression portion (21*a*) which draws the refrigerant flowing from the ejector (19), and compresses and discharges the drawn refrigerant; a suction side decompression portion (22, 22*a*) which decompresses and expands the refrigerant of the other side, branched at the second branch portion (18, 18*a*); a suction side evaporator (23) which evaporates the refrigerant decompressed and expanded in the suction side decompression portion (22, 22*a*), and causes the evaporated refrigerant to flow toward the refrigerant suction port (19*b*); a join portion (16) adapted to join a flow of the refrigerant discharged from the second compression portion (21*a*) and a flow of the refrigerant decompressed and expanded by the high-pressure side decompression portion (14), and to cause the joined refrigerant to flow toward a suction side of the first compression portion (11*a*); and an inner heat exchanger (15) which performs heat exchange between the refrigerant downstream of the high-pressure side decompression portion (14) and the refrigerant of the other side branched at the first branch portion (13).

In the ejector-type refrigerant cycle device, a first auxiliary inner heat exchanger (25) may be provided to perform heat exchange between the refrigerant flowing from the ejector (19) and the refrigerant flowing from the second radiator (122). Furthermore, a second auxiliary inner heat exchanger (35) may be provided to perform heat exchange between the refrigerant to be drawn into the refrigerant suction port (19*b*) and the refrigerant of the other side branched at the first branch portion (13). Furthermore, a discharge side evaporator (20) may be located between an outlet side of the ejector (19) and a suction side of the second compression portion (21*a*), to evaporate the refrigerant flowing out of the ejector (19). Furthermore, when a refrigerant flow amount flowing from the second branch portion (18*a*) to the nozzle portion (19*a*) is as a nozzle-side refrigerant flow amount (Gnoz) and a refrigerant flow amount flowing from the second branch portion (18*a*) toward the suction side decompression portion (22, 22*a*) is as a decompression-side refrigerant flow amount (Ge), the second branch portion (18*a*) may be configured such that a flow amount ratio (Gnoz/Ge) of the nozzle-side refrigerant flow amount (Gnoz) to the decompression-side refrigerant flow amount (Ge) can be adjusted in accordance with a variation of a cycle load. Furthermore, in a low load operation in which the cycle load is decreased than a general operation, the flow amount ratio (Gnoz/Ge) may be increased than that in the general operation. Alternatively, in a high load operation in which the cycle load is increased than the general operation, the flow amount ratio (Gnoz/Ge) may be decreased than that in the general operation.

In the above-described ejector-type refrigerant cycle device, at least one of a first high-pressure side gas-liquid separator (121*b*) and a second high-pressure side gas-liquid separator (122*b*) may be provided. The first high-pressure side gas-liquid separator (121*b*) is provided to separate the refrigerant flowing from the first radiator (121) into gas refrigerant and liquid refrigerant and to introduce the separated liquid refrigerant toward downstream, and the second high-pressure side gas-liquid separator (122*b*) is provided to separate the refrigerant flowing from the second radiator (122) into gas refrigerant and liquid refrigerant and to introduce the separated liquid refrigerant toward downstream. Furthermore, at least one of the first and second radiators (121, 122) may include a condensation portion (121*c*, 122*c*) which condenses the refrigerant, a gas-liquid separation portion (121*d*, 122*d*) which separates the refrigerant flowing out of the condensation portion (121*c*, 122*c*) into gas refrigerant and liquid refrigerant, and a super-cool portion (121*e*, 122*e*) which super-cools the liquid refrigerant flowing out of the gas-liquid separation portion (121*d*, 122*d*). Furthermore, a bypass passage (28) through which the high-pressure refrigerant discharged from the first compression portion (11*a*) is introduced to the suction side evaporator (23), and an opening/closing portion (28*a*) for opening and closing the bypass passage (28) may be provided. Alternatively, a bypass passage (28, 28*b*) through which the high-pressure refrigerant discharged from the first compression portion (11*a*) is introduced to the discharge side evaporator (20), and an opening/closing portion (28*a*) for opening and closing the bypass passage (28, 28*b*) may be provided.

In any above-described ejector-type refrigerant cycle device, a radiation capacity adjusting portion (121*a*, 122*a*) adjusting a radiation capacity of the first and second radiators (121, 122) may be further provided. In this case, the high-pressure refrigerant discharged from the first compression portion (11*a*) is the refrigerant flowing out of the first and second radiators (121, 122). The radiation capacity adjusting portion (121*a*, 122*a*) can reduce the radiation capacity of the first and second radiators (121, 122) when the opening/closing portion (28*a*) opens the bypass passage (28).

The inner heat exchanger (15) may be adapted to perform heat exchange between the refrigerant upstream of the join portion (16) and downstream of the high-pressure side decompression portion (14), and the refrigerant of the other side branched at the first branch portion (13). Alternatively, the inner heat exchanger (15) may be adapted to perform heat exchange between the refrigerant, joined at the join portion (16) with the refrigerant discharged from the second compression portion (21*a*), among the refrigerant downstream of the high-pressure side decompression portion (14), and the refrigerant of the other side branched at the first branch portion (13).

The suction side decompression portion (22, 22*a*) may be an expansion unit (40) which expands the refrigerant in volume and decompresses the refrigerant so as to convert the pressure energy of the refrigerant to the mechanical energy of the refrigerant. Furthermore, a pre-nozzle decompression portion (17) may be provided to decompress and expand the refrigerant to flow into the nozzle portion (19*a*). The pre-nozzle decompression portion (17) may be located between an outlet side of the second branch portion (18, 18*a*) and an inlet side of the nozzle portion (19*a*), to decompress and expand the refrigerant to flow into the nozzle portion (19*a*). Furthermore, an inner heat exchanger (15) may be provided to perform heat exchange between the refrigerant downstream of the high-pressure side decompression portion (14) and the refrigerant of the other side branched at the second branch portion (18, 18*a*).

Alternatively, a pre-nozzle decompression portion (17) may be located between a refrigerant outlet side of the second branch portion (18, 18*a*) and a refrigerant inlet side of the nozzle portion (19*a*), to decompress and expand the refrigerant to flow into the nozzle portion (19*a*). In this case, the first auxiliary heat exchanger (25) is adapted to perform heat exchange between the refrigerant flowing out of the ejector (19) and the refrigerant of the other side branched at the second branch portion (18, 18*a*).

Alternatively, a pre-nozzle decompression portion (17) may be located between a refrigerant outlet side of the second branch portion (18, 18*a*) and a refrigerant inlet side of the nozzle portion (19*a*), to decompress and expand the refrigerant to flow into the nozzle portion (19*a*). In this case, the second auxiliary heat exchanger (35) is adapted to perform heat exchange between the refrigerant to be drawn into the refrigerant suction port (19*b*) and the refrigerant of the other side branched at the second branch portion (18, 18*a*).

For example, a first pressure difference (Pdei−Pnozi) between a refrigerant pressure (Pdei) at the inlet side of the pre-nozzle decompression portion (17) and a refrigerant pressure (Pnozi) at the inlet side of the nozzle portion 19*a*, and a second pressure difference (Pdei−Pnozo) between the refrigerant pressure Pdei at the inlet side of the pre-nozzle decompression portion (17) and the refrigerant pressure (Pnozo) at the outlet side of the nozzle portion (19*a*) may be set such that $0.1 \leq (Pdei-Pnozi)/(Pdei-Pnozo) \leq 0.6$. Furthermore, the pre-nozzle decompression portion (17) may decompress and expand the refrigerant such that a dryness (X0) of the refrigerant flowing into the nozzle portion (19*a*) is not smaller than 0.003 and not larger than 0.14. Furthermore, the pre-nozzle decompression portion (17) may be an expansion unit (40) which expands the refrigerant in volume and decompresses the refrigerant so as to convert the pressure energy of the refrigerant to the mechanical energy of the refrigerant.

According to another aspect of the present invention, an ejector-type refrigerant cycle device includes: a first compression portion (11*a*) which compresses and discharges refrigerant; an exterior heat exchanger (53) adapted to perform heat exchange between the refrigerant and outside air; a using side heat exchanger (55) adapted to perform heat exchange between the refrigerant and a fluid to be heat-exchanged; a refrigerant passage switching portion (51, 52) selectively switches between a refrigerant passage of a cooling operation mode for cooling the fluid to be heat-exchanged, and a refrigerant passage of a heating operation mode for heating the fluid to be heat-exchanged; a first branch portion (13) which branches a flow of the refrigerant flowing out of the exterior heat exchanger (53) in the cooling operation mode; a high-pressure side decompression portion (14) which decompresses and expands the refrigerant of one side branched at the first branch portion (13) in the cooling operation mode; a second branch portion (18) which branches a flow of the refrigerant of the other side branched at the first branch portion (13) in the cooling operation mode; an ejector (19) which draws refrigerant from a refrigerant suction port (19*b*) by a flow of high-speed jet refrigerant jetted from a nozzle portion (19*a*) in which the refrigerant of one side branched at the second branch portion (18) is decompressed and expanded in the cooling operation mode, and mixes the jet refrigerant and the refrigerant drawn from the refrigerant suction port (19*b*) to be pressurized; a second compression portion (21*a*) which draws the refrigerant flowing from the ejector (19), and compresses and discharges the drawn refrigerant, in the cooling operation mode; a suction side decompression portion (22) which decompresses and expands the refrigerant of the other side branched at the second branch portion (18) in the cooling operation mode; a join portion (16) adapted to join a flow of the refrigerant discharged from the second compression portion (21*a*) and a flow of the refrigerant decompressed and expanded by the high-pressure side decompression portion (14), and to cause the joined refrigerant to flow toward a suction side of the first compression portion (11*a*), in the cooling operation mode; and an inner heat exchanger (15) which performs heat exchange between the refrigerant downstream of the high-pressure side decompression portion (14) and the refrigerant of the other side branched at the first branch portion (13), in the cooling operation mode. In the ejector-type refrigerant cycle device, in the cooling operation mode, the refrigerant passage switching portion (51, 52) is switched such that: the using side heat exchanger (55) causes the refrigerant decompressed and expanded by the suction side decompression portion (22) is evaporated and to flow toward the refrigerant suction port (19*b*), and the refrigerant discharged from the first compressor (11*a*) is cooled in the exterior heat exchanger (53). Furthermore, in the heating operation mode, the refrigerant passage switching portion (51, 52) is switched such that the refrigerant discharged from the first compression portion (11*a*) is cooled in the using side heat exchanger (55) and the refrigerant is evaporated in the exterior heat exchanger (53).

For example, a first auxiliary inner heat exchanger (25) may be provided such that the refrigerant flowing out of the ejector (19) is heat exchanged with the refrigerant of the other side branched at the first branch portion (13) in the cooling operation mode. Alternatively, an auxiliary exterior heat exchanger (53*b*) may be provided to cool the refrigerant of the other side branched at the first branch portion (13) in the cooling operation mode.

According to another aspect of the present invention, an ejector-type refrigerant cycle device includes: a first compression portion (11*a*) which compresses and discharges refrigerant; first and second exterior heat exchangers (531, 532) adapted to perform heat exchange between the refrigerant and outside air; a using side heat exchanger (55) adapted to perform heat exchange between the refrigerant and a fluid to be heat-exchanged; a refrigerant passage switching portion (51, 52) selectively switches between a refrigerant passage of a cooling operation mode for cooling the fluid to be heat-exchanged, and a refrigerant passage of a heating operation mode for heating the fluid to be heat-exchanged; a first branch portion (13) which branches a flow of the refrigerant discharged from the first compression portion (11*a*), and causes the branched refrigerant of one side to flow toward the first exterior heat exchanger (531) and causes the branched refrigerant of the other side to flow toward the second exterior heat exchanger (532), in the cooling operation mode; a high-pressure side decompression portion (14) which decompresses and expands the refrigerant heat-exchanged in the first exterior heat exchanger (531), in the cooling operation mode; a second branch portion (18) which branches a flow of the refrigerant heat-exchanged in the second exterior heat exchanger (532), in the cooling operation mode; an ejector (19) which draws refrigerant from a refrigerant suction port (19*b*) by a flow of high-speed jet refrigerant jetted from a nozzle portion (19*a*) in which the refrigerant of one side branched at the second branch portion (18) is decompressed and expanded in the cooling operation mode, and mixes the jet refrigerant and the refrigerant drawn from the refrigerant suction port (19*b*) to be pressurized; a second compression portion (21*a*) which draws the refrigerant flowing from the ejector (19), and compresses and discharges the drawn refrigerant, in the cooling operation mode; a suction side decompression portion (22) which decompresses and expands the refrigerant of the other side branched at the second branch portion (18) in the cooling operation mode; a join portion (16) adapted to join a flow of the refrigerant discharged from the second compression portion (21*a*) and a flow of the refrigerant decompressed and expanded by the high-pressure side decompression portion (14), and to cause the joined refrigerant to flow toward a suction side of the first compression portion (11*a*), in the cooling operation mode; and an inner heat exchanger (15) which performs heat exchange between the refrigerant downstream of the high-pressure side decompression portion (14*a*) and the refrigerant flowing out of the second exterior heat exchanger (532), in the cooling operation mode. In the ejector-type refrigerant cycle device, in the cooling operation mode, the refrigerant passage switching portion (51, 52) is switched such that: the refrigerant discharged from the first compressor (11*a*) is cooled in the first and second exterior heat exchangers (531, 532), and the using side heat exchanger (55) causes the refrigerant decompressed and expanded by the suction side decompression portion (22) to be evaporated and to flow toward the refrigerant suction port (19*b*). Furthermore, in the heating operation mode, the refrigerant passage switching portion (51, 52) is switched such that the refrigerant discharged from the first compression portion (11*a*) is cooled in the using side heat exchanger (55) and the refrigerant is evaporated in the second exterior heat exchanger (532).

For example, a first auxiliary inner heat exchanger (25) may be provided such that the refrigerant flowing out of the ejector (19) is heat exchanged with the refrigerant cooled in the second exterior heat exchanger, in the cooling operation mode. Furthermore, an auxiliary using-side heat exchanger (54) may be provided to evaporate the refrigerant flowing out of the ejector (19), in the cooling operation mode. Furthermore, the inner heat exchanger (15) may be adapted to perform heat exchange between the refrigerant upstream of the join portion (16) and downstream of the high-pressure side decompression portion (14), and the refrigerant of the other side branched at the first branch portion (13), in the cooling operation mode. Alternatively, the inner heat exchanger (15) may be adapted to perform heat exchange between the refrigerant, joined at the join portion (16) with the refrigerant discharged from the second compression portion (21*a*), among the refrigerant downstream of the high-pressure side decompression portion (14), and the refrigerant of the other side branched at the first branch portion (13), in the cooling operation mode.

In any above-described ejector-type refrigerant cycle device, a first discharge capacity changing portion (11*b*) for changing a discharge capacity of the refrigerant discharged from the first compression portion (11*a*), and a second discharge capacity changing portion (21*b*) for changing a discharge capacity of the refrigerant discharged from the second compression portion (21*a*) may be further provided. In this case, the first discharge capacity changing portion (11*b*) and the second discharge capacity changing portion (21*b*) may be configured to be capable of changing the refrigerant discharge capacity of the first compression portion (11*a*) and the second compression portion (21*a*), respectively. Furthermore, the first compression portion (11*a*) and the second compression portion (21*a*) may be accommodated in the same house (10*a*). Furthermore, the first compression portion (11*a*) may pressurize the refrigerant to be equal to or higher than the critical pressure of the refrigerant.

What is claimed is:

1. An ejector-type refrigerant cycle device comprising:

a first compression portion which compresses and discharges refrigerant;

a radiator which cools high-pressure refrigerant discharged from the first compression portion;

a first branch portion which branches a flow of the refrigerant flowing out of the radiator;

a high-pressure side decompression portion which decompresses and expands the refrigerant of one side branched at the first branch portion;

a second branch portion which branches a flow of the refrigerant of the other side branched at the first branch portion;

an ejector which draws refrigerant from a refrigerant suction port by a flow of high-speed jet refrigerant jetted from a nozzle portion in which the refrigerant of one side branched at the second branch portion is decompressed and expanded, and mixes the jet refrigerant and the refrigerant drawn from the refrigerant suction port to be pressurized;

a second compression portion which draws the refrigerant flowing from the ejector, and compresses and discharges the drawn refrigerant;

a suction side decompression portion which decompresses and expands the refrigerant of the other side branched at the second branch portion;

a suction side evaporator which evaporates the refrigerant decompressed and expanded by the suction side decompression portion, and causes the evaporated refrigerant to flow toward the refrigerant suction port;

a join portion adapted to join a flow of the refrigerant discharged from the second compression portion and a flow of the refrigerant decompressed and expanded by the high-pressure side decompression portion, and to cause the joined refrigerant to flow toward a suction side of the first compression portion; and an inner heat exchanger which performs heat exchange between the refrigerant downstream of the high-pressure side decompression portion and the refrigerant of the other side branched at the first branch portion.

2. The ejector-type refrigerant cycle device in claim 1, further comprising a first auxiliary inner heat exchanger which performs heat exchange between the refrigerant flowing from the ejector and the refrigerant of the other side branched at the first branch portion.

3. The ejector-type refrigerant cycle device in claim 1, further comprising a second auxiliary inner heat exchanger which performs heat exchange between the refrigerant to be drawn into the refrigerant suction port and the refrigerant of the other side branched at the first branch portion.

4. The ejector-type refrigerant cycle device in claim 1, further comprising an auxiliary radiator which cools the refrigerant of the other side branched at the first branch portion.

5. The ejector-type refrigerant cycle device in claim 1, further comprising a discharge side evaporator located between an outlet side of the ejector and a suction side of the second compression portion, to evaporate the refrigerant flowing out of the ejector.

6. An ejector-type refrigerant cycle device comprising:

a first compression portion which compresses and discharges refrigerant;

a first branch portion which branches a flow of high-pressure refrigerant discharged from the first compression portion;

a first radiator which cools the refrigerant of one side branched at the first branch portion;

a second radiator which cools the refrigerant of the other side branched at the first branch portion;

a high-pressure side decompression portion which decompresses and expands the refrigerant cooled at the first radiator;

a second branch portion which branches a flow of the refrigerant cooled at the second radiator;

an ejector which draws refrigerant from a refrigerant suction port by a flow of high-speed jet refrigerant jetted from a nozzle portion in which the refrigerant of one side branched at the second branch portion is decompressed and expanded, and mixes the jet refrigerant and the refrigerant drawn from the refrigerant suction port to be pressurized;

a second compression portion which draws the refrigerant flowing from the ejector, and compresses and discharges the drawn refrigerant;

a suction side decompression portion which decompresses and expands the refrigerant of the other side, branched at the second branch portion;

a suction side evaporator which evaporates the refrigerant decompressed and expanded in the suction side decompression portion, and causes the evaporated refrigerant to flow toward the refrigerant suction port;

a join portion adapted to join a flow of the refrigerant discharged from the second compression portion and a flow of the refrigerant decompressed and expanded by the high-pressure side decompression portion, and to cause the joined refrigerant to flow toward a suction side of the first compression portion; and an inner heat exchanger which performs heat exchange between the refrigerant downstream of the high-pressure side decompression portion and the refrigerant of the other side branched at the first branch portion.

7. The ejector-type refrigerant cycle device in claim 6, further comprising a first auxiliary inner heat exchanger which performs heat exchange between the refrigerant flowing from the ejector and the refrigerant flowing from the second radiator.

8. The ejector-type refrigerant cycle device in claim 6, further comprising a second auxiliary inner heat exchanger which performs heat exchange between the refrigerant to be drawn into the refrigerant suction port and the refrigerant of the other side branched at the first branch portion.

9. The ejector-type refrigerant cycle device in claim 6, further comprising a discharge side evaporator located between an outlet side of the ejector and a suction side of the second compression portion, to evaporate the refrigerant flowing out of the ejector.

10. The ejector-type refrigerant cycle device in claim 1, wherein the inner heat exchanger is adapted to perform heat exchange between the refrigerant upstream of the join portion and downstream of the high-pressure side decompression portion, and the refrigerant of the other side branched at the first branch portion.

11. The ejector-type refrigerant cycle device in claim 1, wherein the inner heat exchanger is adapted to perform heat exchange between the refrigerant, joined at the join portion with the refrigerant discharged from the second compression portion, among the refrigerant downstream of the high-pressure side decompression portion, and the refrigerant of the other side branched at the first branch portion.

12. The ejector-type refrigerant cycle device in claim 1, further comprising a pre-nozzle decompression portion which decompresses and expands the refrigerant to flow into the nozzle portion.

13. The ejector-type refrigerant cycle device in claim 2, further comprising a pre-nozzle decompression portion located between an outlet side of the second branch portion and an inlet side of the nozzle portion, to decompress and expand the refrigerant to flow into the nozzle portion, wherein the first auxiliary heat exchanger is adapted to perform heat exchange between the refrigerant flowing from the ejector and the refrigerant of the other side branched at the second branch portion.

14. The ejector-type refrigerant cycle device in claim 3, further comprising a pre-nozzle decompression portion located between a refrigerant outlet side of the second branch portion and a refrigerant inlet side of the nozzle portion, to decompress and expand the refrigerant to flow into the nozzle portion, wherein the second auxiliary heat exchanger is adapted to perform heat exchange between the refrigerant to be drawn into the refrigerant suction port and the refrigerant of the other side branched at the second branch portion.

15. The ejector-type refrigerant cycle device in claim 6, wherein the inner heat exchanger is adapted to perform heat exchange between the refrigerant upstream of the join portion and downstream of the high-pressure side decompression portion, and the refrigerant of the other side branched at the first branch portion.

16. The ejector-type refrigerant cycle device in claim 6, wherein the inner heat exchanger is adapted to perform heat exchange between the refrigerant, joined at the join portion with the refrigerant discharged from the second compression portion, among the refrigerant downstream of the high-pressure side decompression portion, and the refrigerant of the other side branched at the first branch portion.

17. The ejector-type refrigerant cycle device in claim 6, further comprising a pre-nozzle decompression portion which decompresses and expands the refrigerant to flow into the nozzle portion.

18. The ejector-type refrigerant cycle device in claim 7, further comprising a pre-nozzle decompression portion located between an outlet side of the second branch portion and an inlet side of the nozzle portion, to decompress and expand the refrigerant to flow into the nozzle portion, wherein the first auxiliary heat exchanger is adapted to perform heat exchange between the refrigerant flowing from the ejector and the refrigerant of the other side branched at the second branch portion.

19. The ejector-type refrigerant cycle device in claim 8, further comprising a pre-nozzle decompression portion located between a refrigerant outlet side of the second branch portion and a refrigerant inlet side of the nozzle portion, to decompress and expand the refrigerant to flow into the nozzle portion, wherein the second auxiliary heat exchanger is adapted to perform heat exchange between the refrigerant to be drawn into the refrigerant suction port and the refrigerant of the other side branched at the second branch portion.

* * * * *